US009765314B2

(12) United States Patent
Bouvier et al.

(10) Patent No.: US 9,765,314 B2
(45) Date of Patent: Sep. 19, 2017

(54) POLYPEPTIDE FRAGMENTS COMPRISING ENDONUCLEASE ACTIVITY AND THEIR USE

(71) Applicants: European Molecular Biology Laboratory (EMBL), Heidelberg (DE); Universite Grenoble Alpes, Saint Martin d'Heres (FR); Centre National de la Recherche Scientifique, Paris (FR)

(72) Inventors: Denis Bouvier, Meylan (FR); Thibaut Crepin, Grenoble (FR); Rob Ruigrok, Sassenage (FR); Aelxander Dias, Voiron (FR); Stephen Cusack, Seyssinet-Pariset (FR)

(73) Assignees: European Molecular Biology Laboratory (EMBL), Heidelberg (DE); Université Grenoble Alpes, Saint Martin d'Heres (FR); Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 14/519,525

(22) Filed: Oct. 21, 2014

(65) Prior Publication Data

US 2015/0105315 A1 Apr. 16, 2015

Related U.S. Application Data

(63) Continuation of application No. 13/140,626, filed as application No. PCT/EP2009/009161 on Dec. 18, 2009, now abandoned.

(Continued)

(51) Int. Cl.

| | |
|---|---|
| ***C12N 9/22*** | (2006.01) |
| ***C12N 9/12*** | (2006.01) |

(Continued)

(52) U.S. Cl.

CPC ..... *C12N 9/22* (2013.01); *A61K 31/192* (2013.01); *C12N 9/127* (2013.01); *C12Q 1/44* (2013.01);

(Continued)

(58) Field of Classification Search

None

See application file for complete search history.

(56) References Cited

U.S. PATENT DOCUMENTS

| | | | | |
|---|---|---|---|---|
| 7,074,414 | B2 * | 7/2006 | Dowling | A61K 39/145 424/186.1 |
| 2005/0143402 | A1 | 6/2005 | Cheetham et al. | |

FOREIGN PATENT DOCUMENTS

| | | |
|---|---|---|
| JP | 2006-504415 | 2/2006 |
| JP | 2006-525032 | 11/2006 |

(Continued)

OTHER PUBLICATIONS

The active sites of the influenza cap-dependent endonuclease are on different polymerase subunits: Mei-Ling Li et al., The EMBO journal vol. 20 No. 8 pp. 2078-2086, 2001.

(Continued)

*Primary Examiner* — Paul Holland

(74) *Attorney, Agent, or Firm* — Barnes & Thornburg LLP

(57) ABSTRACT

The present invention relates to polypeptide fragments comprising an amino-terminal fragment of the PA subunit of a viral RNA-dependent RNA polymerase or variants thereof possessing endonuclease activity, wherein said PA subunit is from a virus belonging to the Orthomyxoviridae family. This invention also relates to (i) crystals of the polypeptide fragments which are suitable for structure determination of said polypeptide fragments using X-ray crystallography and (ii) computational methods using the structural coordinates (Continued)

of said polypeptide to screen for and design compounds that modulate, preferably inhibit the endonucleolytically active site within the polypeptide fragment. In addition, this invention relates to methods identifying compounds that bind to the PA polypeptide fragments possessing endonuclease activity and preferably inhibit said endonucleolytic activity, preferably in a high throughput setting. This invention also relates to compounds and pharmaceutical compositions comprising the identified compounds for the treatment of disease conditions due to viral infections caused by viruses of the Orthomyxoviridae family.

18 Claims, 143 Drawing Sheets

Related U.S. Application Data

(60) Provisional application No. 61/203,259, filed on Dec. 19, 2008.

(51) Int. Cl.

| | |
|---|---|
| ***A61K 31/192*** | (2006.01) |
| ***C12Q 1/44*** | (2006.01) |
| ***G06F 19/12*** | (2011.01) |
| ***G06F 19/16*** | (2011.01) |

(52) U.S. Cl.

CPC ..... *G06F 19/12* (2013.01); *G06F 19/16* (2013.01); *C07K 2299/00* (2013.01); *G01N 2333/922* (2013.01); *G01N 2500/02* (2013.01)

(56) References Cited

FOREIGN PATENT DOCUMENTS

| | | |
|---|---|---|
| JP | 2008-526263 | 7/2008 |
| WO | 02/00884 A2 | 1/2002 |

OTHER PUBLICATIONS

Influenza Polymerase Fragment, Database PDB (Online), Dec. 17, 2008, retrieved from EBI, Database accession No. 2W69.

Fodor et al., A single amino acid mutation in the PA subunit of the influenza virus RNA polymerase inhibits endonucleolytic cleavage of capped RNAs, Journal of Virology, 2002, 8989-9001, 76(18).

Sanz-Ezquerro et al., The amino-terminal one-third of the influenza virus PA protein is responsible for the induction of proteolysis, Journal of Virology, 1996, 1905-1911, 70(3).

Hara Koyu et al., Amino acid residues in the N-terminal region of the PA subunit of influenza A virus RNA polymerase play a critical role in protein stability, endonuclease activity, cap binding and virion RNA promoter binding, Journal of Virology, 2006, 7789-7798, 80(16).

Zürcher et al., "Mutational analysis of the influenza virus A/Victoria/3/75 PA protein: studies of the interaction with PB1 protein and identification of a dominant negative mutant," Journal of General Virology, 1996, vol. 77, pp. 1745-1749.

Thathaisong et al., "Human Monoclonal Single Chain Anti-bodies (HuScFv) that Bind to the Polymerase Proteins of Influenza a Virus," Asian Pacific Journal of Allergy and Immunology, Mar. 2008, vol. 26, No. 1, pp. 23-25.

Nakazawa et al., "PA subunit of RNA polymerase as a promising target for anti-influenza virus agents," Antiviral Research, 2008-06, vol. 78, No. 3, pp. 194-201.

Ochoa et al., "Epitope mapping of cross-reactive monoclonal antibodies specific for the influenza A virus PA and PB2 polypeptides," Virus Research, Aug. 1995, vol. 37, No. 3, pp. 305-315.

Dias et al., "The cap-snatching endonuclease of influenza virus polymerase resides in the PA Subunit," Nature, pub. In print Apr. 16, 2009, Epub Feb. 4, 1995, vol. 458, No. 7240, pp. 914-918.

Kuzuhara et al., Green tea catechins inhibit the endonuclease activity of influenza a virus RNA polymerase, PLoS Currents, Oct. 13, 2009, 1:RRN1052.

Zhao et al., "Nucleoside Monophosphate Complex Structures of the Endonuclease Domain from the Influenza Virus Polymerase PA Subunit Reveal the Substrate Binding Site Inside the Catalytic Center," Journal of Virology, Jul. 8, 2009, vol. 83, No. 18, pp. 9024-9030.

Yuan et al., "Crystal structure of an avian influenza polymerase PAN reveals an endonuclease active site," Nature Letters, 2009, 458: pp. 909-913.

Fodor et al, "A Single Amino Acid Mutation in the PA Subunit of the Influenza Virus RNA Polymerase Inhibits Endonucleolytic Cleavage of Capped RNAs," Journal of Virology, 76(18): 8989-9001.

Database PDB, "Influenza Polymerase Fragment," 2008, pp. 1-157.

Sanz-Ezquerro et al., "The amino-terminal one-third of the influenza virus PA protein is responsible for the induction of proteolysis," Journal of Virology, 1996, 70(3): 1905-1911.

Singapore Search Report for Corresponding Singapore Patent Application No. 201104461-7, completed Aug. 25, 2012.

* cited by examiner

Figure 2

| Type of metal | Tm (°C) |
|---|---|
| No metal | 44 |
| **$CaCl_2$** | **52** |
| **$MgCl_2$** | **50** |
| **$MnCl_2$** | **57** |
| $NiCl_2$ | 48 |
| $FeCl_2$ | 45 |
| $CuCl_2$ | 44 |
| $ZnCl_2$ | 39 |

37°C, 40 min, 1 mM $Mn^{2+}$

37°C, 40 min, 1 mM $Mn^{2+}$

```
COMPND    --REMARK   3
REMARK   3 REFINEMENT.
REMARK   3   PROGRAM     : REFMAC 5.2.0019
REMARK   3   AUTHORS     : MURSHUDOV,VAGIN,DODSON
REMARK   3
REMARK   3    REFINEMENT TARGET : MAXIMUM LIKELIHOOD
REMARK   3
REMARK   3  DATA USED IN REFINEMENT.
REMARK   3   RESOLUTION RANGE HIGH (ANGSTROMS) :   2.05
REMARK   3   RESOLUTION RANGE LOW  (ANGSTROMS) :  75.81
REMARK   3   DATA CUTOFF            (SIGMA(F)) : NONE
REMARK   3   COMPLETENESS FOR RANGE        (%) :  93.18
REMARK   3   NUMBER OF REFLECTIONS             :   39713
REMARK   3
REMARK   3  FIT TO DATA USED IN REFINEMENT.
REMARK   3   CROSS-VALIDATION METHOD          : THROUGHOUT
REMARK   3   FREE R VALUE TEST SET SELECTION  : RANDOM
REMARK   3   R VALUE     (WORKING + TEST SET) : 0.21971
REMARK   3   R VALUE            (WORKING SET) :  0.21716
REMARK   3   FREE R VALUE                     :  0.26750
REMARK   3   FREE R VALUE TEST SET SIZE   (%) :  5.1
REMARK   3   FREE R VALUE TEST SET COUNT      :  2118
REMARK   3
REMARK   3  FIT IN THE HIGHEST RESOLUTION BIN.
REMARK   3   TOTAL NUMBER OF BINS USED           :      20
REMARK   3   BIN RESOLUTION RANGE HIGH           :    2.050
REMARK   3   BIN RESOLUTION RANGE LOW            :    2.103
REMARK   3   REFLECTION IN BIN     (WORKING SET) :     3094
REMARK   3   BIN COMPLETENESS (WORKING+TEST) (%) :    99.42
REMARK   3   BIN R VALUE           (WORKING SET) :    0.278
REMARK   3   BIN FREE R VALUE SET COUNT          :      169
REMARK   3   BIN FREE R VALUE                    :    0.320
REMARK   3
REMARK   3  NUMBER OF NON-HYDROGEN ATOMS USED IN REFINEMENT.
REMARK   3   ALL ATOMS                 :     4939
REMARK   3
REMARK   3  B VALUES.
REMARK   3   FROM WILSON PLOT           (A**2) : NULL
REMARK   3   MEAN B VALUE      (OVERALL, A**2) :  45.800
REMARK   3   OVERALL ANISOTROPIC B VALUE.
REMARK   3    B11 (A**2) :    -0.36
REMARK   3    B22 (A**2) :    -0.36
REMARK   3    B33 (A**2) :     0.71
REMARK   3    B12 (A**2) :     0.00
REMARK   3    B13 (A**2) :     0.00
REMARK   3    B23 (A**2) :     0.00
REMARK   3
REMARK   3  ESTIMATED OVERALL COORDINATE ERROR.
REMARK   3   ESU BASED ON R VALUE                                (A):   0.231
REMARK   3   ESU BASED ON FREE R VALUE                           (A):   0.201
REMARK   3   ESU BASED ON MAXIMUM LIKELIHOOD                     (A):   0.156
REMARK   3   ESU FOR B VALUES BASED ON MAXIMUM LIKELIHOOD (A**2):  11.611
REMARK   3
REMARK   3 CORRELATION COEFFICIENTS.
REMARK   3   CORRELATION COEFFICIENT FO-FC      :   0.943
REMARK   3   CORRELATION COEFFICIENT FO-FC FREE :   0.914
REMARK   3
REMARK   3  RMS DEVIATIONS FROM IDEAL VALUES         COUNT    RMS    WEIGHT
REMARK   3   BOND LENGTHS REFINED ATOMS        (A):  4869 ; 0.014 ; 0.022
REMARK   3   BOND LENGTHS OTHERS               (A):  3354 ; 0.002 ; 0.020
REMARK   3   BOND ANGLES REFINED ATOMS   (DEGREES):  6555 ; 1.363 ; 1.946
REMARK   3   BOND ANGLES OTHERS          (DEGREES):  8117 ; 0.981 ; 3.000
REMARK   3   TORSION ANGLES, PERIOD 1    (DEGREES):   573 ; 5.789 ; 5.000
REMARK   3   TORSION ANGLES, PERIOD 2    (DEGREES):   259 ;36.576 ;23.977
REMARK   3   TORSION ANGLES, PERIOD 3    (DEGREES):   895 ;16.069 ;15.000
REMARK   3   TORSION ANGLES, PERIOD 4    (DEGREES):    37 ;18.457 ;15.000
REMARK   3   CHIRAL-CENTER RESTRAINTS       (A**3):   701 ; 0.081 ; 0.200
REMARK   3   GENERAL PLANES REFINED ATOMS      (A):  5348 ; 0.005 ; 0.020
REMARK   3   GENERAL PLANES OTHERS             (A):  1043 ; 0.002 ; 0.020
REMARK   3   NON-BONDED CONTACTS REFINED ATOMS (A):  1019 ; 0.215 ; 0.200
REMARK   3   NON-BONDED CONTACTS OTHERS        (A):  3369 ; 0.194 ; 0.200
REMARK   3   NON-BONDED TORSION REFINED ATOMS  (A):  2308 ; 0.178 ; 0.200
REMARK   3   NON-BONDED TORSION OTHERS         (A):  2563 ; 0.084 ; 0.200
REMARK   3   H-BOND (X...Y) REFINED ATOMS      (A):   179 ; 0.180 ; 0.200
REMARK   3   SYMMETRY VDW REFINED ATOMS        (A):    25 ; 0.239 ; 0.200
REMARK   3   SYMMETRY VDW OTHERS               (A):    50 ; 0.274 ; 0.200
REMARK   3   SYMMETRY H-BOND REFINED ATOMS     (A):     5 ; 0.192 ; 0.200
```

FIG. 18

```
REMARK   3
REMARK   3  ISOTROPIC THERMAL FACTOR RESTRAINTS.      COUNT   RMS    WEIGHT
REMARK   3   MAIN-CHAIN BOND REFINED ATOMS  (A**2):  3179 ; 1.590 ; 2.000
REMARK   3   MAIN-CHAIN BOND OTHER ATOMS    (A**2):  1159 ; 0.347 ; 2.000
REMARK   3   MAIN-CHAIN ANGLE REFINED ATOMS (A**2):  4635 ; 2.247 ; 3.000
REMARK   3   SIDE-CHAIN BOND REFINED ATOMS  (A**2):  2210 ; 1.426 ; 2.000
REMARK   3   SIDE-CHAIN ANGLE REFINED ATOMS (A**2):  1918 ; 1.974 ; 3.000
REMARK   3
REMARK   3  NCS RESTRAINTS STATISTICS
REMARK   3   NUMBER OF DIFFERENT NCS GROUPS :   2
REMARK   3
REMARK   3  NCS GROUP NUMBER                  :   1
REMARK   3     CHAIN NAMES                    : A B
REMARK   3     NUMBER OF COMPONENTS NCS GROUP :    8
REMARK   3       COMPONENT C  SSSEQI  TO  C   SSSEQI   CODE
REMARK   3           1     A      1       A      8      1
REMARK   3           1     B      1       B      8      1
REMARK   3           2     A     12       A     17      1
REMARK   3           2     B     12       B     17      1
REMARK   3           3     A     33       A     45      1
REMARK   3           3     B     33       B     45      1
REMARK   3           4     A    110       A    116      1
REMARK   3           4     B    110       B    116      1
REMARK   3           5     A    122       A    132      1
REMARK   3           5     B    122       B    132      1
REMARK   3           6     A    144       A    150      1
REMARK   3           6     B    144       B    150      1
REMARK   3           7     A    154       A    163      1
REMARK   3           7     B    154       B    163      1
REMARK   3           8     A    174       A    192      1
REMARK   3           8     B    174       B    192      1
REMARK   3                   GROUP CHAIN         COUNT   RMS     WEIGHT
REMARK   3   TIGHT POSITIONAL   1    A    (A):   1143 ;  0.06 ;  0.05
REMARK   3   TIGHT THERMAL      1    A (A**2):   1143 ;  0.17 ;  0.50
REMARK   3
REMARK   3  NCS GROUP NUMBER                  :   2
REMARK   3     CHAIN NAMES                    : B D
REMARK   3     NUMBER OF COMPONENTS NCS GROUP :    5
REMARK   3       COMPONENT C  SSSEQI  TO  C   SSSEQI   CODE
REMARK   3           1     B     33       B     45      2
REMARK   3           1     D     33       D     45      2
REMARK   3           2     B    121       B    133      2
REMARK   3           2     D    121       D    133      2
REMARK   3           3     B    144       B    150      2
REMARK   3           3     D    144       D    150      2
REMARK   3           4     B    161       B    164      2
REMARK   3           4     D    161       D    164      2
REMARK   3           5     B    168       B    183      2
REMARK   3           5     D    168       D    183      2
REMARK   3                   GROUP CHAIN         COUNT   RMS     WEIGHT
REMARK   3   TIGHT POSITIONAL   2    B    (A):    317 ;  0.04 ;  0.05
REMARK   3   MEDIUM POSITIONAL  2    B    (A):    443 ;  0.24 ;  0.50
REMARK   3   TIGHT THERMAL      2    B (A**2):    317 ;  0.18 ;  0.50
REMARK   3   MEDIUM THERMAL     2    B (A**2):    443 ;  0.69 ;  2.00
REMARK   3
REMARK   3
REMARK   3  TLS DETAILS
REMARK   3   NUMBER OF TLS GROUPS  :    3
REMARK   3   ATOM RECORD CONTAINS SUM OF TLS AND RESIDUAL B FACTORS
REMARK   3   ANISOU RECORD CONTAINS SUM OF TLS AND RESIDUAL U FACTORS
REMARK   3
REMARK   3   TLS GROUP :     1
REMARK   3    NUMBER OF COMPONENTS GROUP :    2
REMARK   3    COMPONENTS        C SSSEQI   TO  C SSSEQI
REMARK   3    RESIDUE RANGE :   A     0        A   196
REMARK   3    RESIDUE RANGE :   A   301        A   402
REMARK   3    ORIGIN FOR THE GROUP (A):   0.4380  31.9220  84.5340
REMARK   3    T TENSOR
REMARK   3      T11:   0.0340 T22:   0.1320
REMARK   3      T33:  -0.0452 T12:  -0.0193
REMARK   3      T13:   0.0298 T23:   0.0543
REMARK   3    L TENSOR
REMARK   3      L11:   2.6068 L22:   2.0135
REMARK   3      L33:   2.5508 L12:   1.0612
REMARK   3      L13:   0.0150 L23:  -0.1527
REMARK   3    S TENSOR
REMARK   3      S11:  -0.1001 S12:   0.2362 S13:  -0.0361
REMARK   3      S21:  -0.1237 S22:   0.1658 S23:   0.0784
REMARK   3      S31:   0.0830 S32:  -0.2500 S33:  -0.0657
```

FIG. 18 (continued)

```
REMARK   3
REMARK   3   TLS GROUP :      2
REMARK   3    NUMBER OF COMPONENTS GROUP :     2
REMARK   3    COMPONENTS        C SSSEQI   TO  C SSSEQI
REMARK   3    RESIDUE RANGE :   B     0        B   196
REMARK   3    RESIDUE RANGE :   B   301        B   403
REMARK   3    ORIGIN FOR THE GROUP (A):  22.5390  42.1420 102.7410
REMARK   3    T TENSOR
REMARK   3      T11:   0.0404 T22:   0.0842
REMARK   3      T33:  -0.0604 T12:   0.0210
REMARK   3      T13:   0.0303 T23:  -0.0277
REMARK   3    L TENSOR
REMARK   3      L11:   2.8576 L22:   2.1021
REMARK   3      L33:   3.1067 L12:   0.1958
REMARK   3      L13:  -0.8397 L23:  -0.3874
REMARK   3    S TENSOR
REMARK   3      S11:   0.0073 S12:  -0.2765 S13:   0.2133
REMARK   3      S21:   0.0189 S22:   0.0880 S23:  -0.1481
REMARK   3      S31:   0.0012 S32:   0.2691 S33:  -0.0953
REMARK   3
REMARK   3   TLS GROUP :      3
REMARK   3    NUMBER OF COMPONENTS GROUP :     2
REMARK   3    COMPONENTS        C SSSEQI   TO  C SSSEQI
REMARK   3    RESIDUE RANGE :   D     0        D   196
REMARK   3    RESIDUE RANGE :   D   301        D   403
REMARK   3    ORIGIN FOR THE GROUP (A): -22.4770  20.8930 102.3720
REMARK   3    T TENSOR
REMARK   3      T11:   0.1570 T22:   0.1217
REMARK   3      T33:   0.1402 T12:  -0.0869
REMARK   3      T13:   0.1110 T23:  -0.0160
REMARK   3    L TENSOR
REMARK   3      L11:   2.5483 L22:   2.0767
REMARK   3      L33:   8.2665 L12:   0.0117
REMARK   3      L13:   0.0498 L23:   0.6732
REMARK   3    S TENSOR
REMARK   3      S11:  -0.2912 S12:  -0.3117 S13:  -0.2484
REMARK   3      S21:   0.2341 S22:  -0.4001 S23:  -0.1232
REMARK   3      S31:   0.6684 S32:  -0.3291 S33:   0.6913
REMARK   3
REMARK   3
REMARK   3  BULK SOLVENT MODELLING.
REMARK   3   METHOD USED :  MASK
REMARK   3   PARAMETERS FOR MASK CALCULATION
REMARK   3   VDW PROBE RADIUS    :   1.20
REMARK   3   ION PROBE RADIUS    :   0.80
REMARK   3   SHRINKAGE RADIUS    :   0.80
REMARK   3
REMARK   3  OTHER REFINEMENT REMARKS:
REMARK   3  HYDROGENS HAVE BEEN ADDED IN THE RIDING POSITIONS
REMARK   3
LINK             LEU A  71                    LYS A  73                gap
LINK             SER A 140                    THR A 143                gap
LINK             VAL D  62                    HIS D  74                gap
LINK             LYS D 139                    THR D 143                gap
CRYST1   67.130   67.130  302.950  90.00  90.00  90.00 P 43 21 2
SCALE1      0.014896  0.000000  0.000000        0.00000
SCALE2      0.000000  0.014896  0.000000        0.00000
SCALE3      0.000000  0.000000  0.003301        0.00000
ATOM      1  N   ALA A   0       9.315  10.382  90.066  1.00 50.72            N
ANISOU    1  N   ALA A   0     7389   3921   7962    611     76    464        N
ATOM      2  CA  ALA A   0      10.124  11.028  88.989  1.00 50.07            C
ANISOU    2  CA  ALA A   0     7165   3975   7882    726    202    231        C
ATOM      4  CB  ALA A   0      10.165  10.148  87.721  1.00 52.25            C
ANISOU    4  CB  ALA A   0     7530   4037   8286    741    344    -42        C
ATOM      8  C   ALA A   0       9.671  12.452  88.645  1.00 46.70            C
ANISOU    8  C   ALA A   0     6647   3914   7182    603    245    183        C
ATOM      9  O   ALA A   0      10.538  13.316  88.477  1.00 47.00            O
ANISOU    9  O   ALA A   0     6529   4129   7199    713    272    143        O
ATOM     13  N   MET A   1       8.350  12.713  88.567  1.00 44.40            N
ANISOU   13  N   MET A   1     6441   3734   6694    381    247    197        N
ATOM     14  CA  MET A   1       7.837  14.031  88.151  1.00 42.59            C
ANISOU   14  CA  MET A   1     6131   3825   6226    272    288    149        C
ATOM     16  CB  MET A   1       6.338  14.001  87.763  1.00 42.12            C
ANISOU   16  CB  MET A   1     6168   3833   6002     37    307    119        C
ATOM     19  CG  MET A   1       5.743  15.382  87.386  1.00 38.09            C
ANISOU   19  CG  MET A   1     5567   3643   5263    -59    334     97        C
ATOM     22  SD  MET A   1       6.495  16.073  85.893  1.00 38.49            S
ANISOU   22  SD  MET A   1     5531   3825   5269      1    455   -136        S
ATOM     23  CE  MET A   1       5.333  15.561  84.636  1.00 37.87            C
```

FIG. 18 (continued)

```
ANISOU  23  CE  MET A  1   5562   3744   5084   -209    520   -306      C
ATOM    27  C   MET A  1     8.057  15.081  89.228  1.00 41.39        C
ANISOU  27  C   MET A  1   5876   3876   5975    306    199    335      C
ATOM    28  O   MET A  1     8.385  16.224  88.905  1.00 39.08        O
ANISOU  28  O   MET A  1   5471   3802   5576    328    235    283      O
ATOM    30  N   GLU A  2     7.854  14.717  90.492  1.00 42.43        N
ANISOU  30  N   GLU A  2   6056   3939   6127    292     86    548      N
ATOM    31  CA  GLU A  2     8.073  15.657  91.571  1.00 43.33        C
ANISOU  31  CA  GLU A  2   6087   4242   6132    309      3    712      C
ATOM    33  CB  GLU A  2     7.656  15.061  92.913  1.00 46.20        C
ANISOU  33  CB  GLU A  2   6540   4521   6492    249   -115    945      C
ATOM    36  CG  GLU A  2     7.491  16.108  94.002  1.00 45.99        C
ANISOU  36  CG  GLU A  2   6459   4732   6282    198   -179   1088      C
ATOM    39  CD  GLU A  2     7.296  15.490  95.355  1.00 47.39        C
ANISOU  39  CD  GLU A  2   6719   4838   6448    146   -297   1325      C
ATOM    40  OE1 GLU A  2     6.846  14.324  95.413  1.00 50.77        O
ANISOU  40  OE1 GLU A  2   7269   5051   6970     89   -318   1387      O
ATOM    41  OE2 GLU A  2     7.570  16.174  96.362  1.00 48.11        O
ANISOU  41  OE2 GLU A  2   6765   5089   6427    145   -371   1450      O
ATOM    42  C   GLU A  2     9.537  16.090  91.591  1.00 42.82        C
ANISOU  42  C   GLU A  2   5884   4218   6169    499    -14    694      C
ATOM    43  O   GLU A  2     9.835  17.264  91.719  1.00 40.12        O
ANISOU  43  O   GLU A  2   5439   4094   5710    504    -13    693      O
ATOM    45  N   ASP A  3    10.448  15.138  91.413  1.00 44.73        N
ANISOU  45  N   ASP A  3   6115   4242   6638    654    -22    668      N
ATOM    46  CA  ASP A  3    11.880  15.449  91.280  1.00 45.34        C
ANISOU  46  CA  ASP A  3   6031   4358   6840    844    -21    628      C
ATOM    48  CB  ASP A  3    12.704  14.167  91.109  1.00 49.33        C
ANISOU  48  CB  ASP A  3   6538   4574   7631   1025    -26    604      C
ATOM    51  CG  ASP A  3    12.855  13.393  92.403  1.00 52.53        C
ANISOU  51  CG  ASP A  3   6995   4815   8147   1079   -195    862      C
ATOM    52  OD1 ASP A  3    12.810  14.021  93.478  1.00 53.28        O
ANISOU  52  OD1 ASP A  3   7062   5075   8108   1024   -313   1051      O
ATOM    53  OD2 ASP A  3    13.016  12.161  92.343  1.00 56.60        O
ANISOU  53  OD2 ASP A  3   7590   5033   8881   1171   -209    874      O
ATOM    54  C   ASP A  3    12.177  16.363  90.099  1.00 42.26        C
ANISOU  54  C   ASP A  3   5540   4147   6370    841    114    417      C
ATOM    55  O   ASP A  3    12.991  17.287  90.189  1.00 41.12        O
ANISOU  55  O   ASP A  3   5252   4179   6192    900    107    419      O
ATOM    57  N   PHE A  4    11.537  16.073  88.984  1.00 41.38        N
ANISOU  57  N   PHE A  4   5509   3988   6225    759    233    238      N
ATOM    58  CA  PHE A  4    11.670  16.923  87.821  1.00 40.24        C
ANISOU  58  CA  PHE A  4   5294   4024   5972    722    358     53      C
ATOM    60  CB  PHE A  4    10.836  16.386  86.665  1.00 41.11        C
ANISOU  60  CB  PHE A  4   5523   4063   6036    607    466   -127      C
ATOM    63  CG  PHE A  4    10.797  17.308  85.529  1.00 40.25        C
ANISOU  63  CG  PHE A  4   5360   4162   5769    533    573   -280      C
ATOM    64  CD1 PHE A  4    11.880  17.401  84.679  1.00 42.34        C
ANISOU  64  CD1 PHE A  4   5524   4460   6103    636    685   -442      C
ATOM    66  CE1 PHE A  4    11.872  18.304  83.633  1.00 40.40        C
ANISOU  66  CE1 PHE A  4   5235   4424   5692    549    781   -563      C
ATOM    68  CZ  PHE A  4    10.794  19.105  83.448  1.00 38.66        C
ANISOU  68  CZ  PHE A  4   5068   4363   5260    381    752   -514      C
ATOM    70  CE2 PHE A  4     9.728  19.045  84.307  1.00 38.18        C
ANISOU  70  CE2 PHE A  4   5087   4272   5148    300    643   -360      C
ATOM    72  CD2 PHE A  4     9.730  18.149  85.341  1.00 38.74        C
ANISOU  72  CD2 PHE A  4   5205   4151   5364    366    561   -248      C
ATOM    74  C   PHE A  4    11.273  18.381  88.119  1.00 37.76        C
ANISOU  74  C   PHE A  4   4927   3981   5438    618    327    128      C
ATOM    75  O   PHE A  4    12.027  19.306  87.806  1.00 34.70        O
ANISOU  75  O   PHE A  4   4418   3754   5013    658    363     81      O
ATOM    77  N   VAL A  5    10.097  18.571  88.723  1.00 36.13        N
ANISOU  77  N   VAL A  5   4812   3818   5099    483    267    241      N
ATOM    78  CA  VAL A  5     9.572  19.908  88.996  1.00 34.93        C
ANISOU  78  CA  VAL A  5   4625   3893   4753    389    249    298      C
ATOM    80  CB  VAL A  5     8.135  19.854  89.650  1.00 33.81        C
ANISOU  80  CB  VAL A  5   4584   3771   4490    245    202    407      C
ATOM    82  CG1 VAL A  5     7.674  21.216  90.170  1.00 31.16        C
ANISOU  82  CG1 VAL A  5   4205   3648   3986    184    181    476      C
ATOM    86  CG2 VAL A  5     7.098  19.313  88.674  1.00 33.46        C
ANISOU  86  CG2 VAL A  5   4624   3681   4407    127    268    301      C
ATOM    90  C   VAL A  5    10.542  20.662  89.894  1.00 34.74        C
ANISOU  90  C   VAL A  5   4495   3968   4737    474    177    401      C
ATOM    91  O   VAL A  5    10.910  21.788  89.618  1.00 33.00        O
ANISOU  91  O   VAL A  5   4194   3911   4435    466    206    361      O
ATOM    93  N   ARG A  6    10.953  20.025  90.982  1.00 37.74        N
ANISOU  93  N   ARG A  6   4881   4245   5213    542     72    542      N
ATOM    94  CA  ARG A  6    11.827  20.670  91.955  1.00 39.90        C
ANISOU  94  CA  ARG A  6   5060   4622   5478    600    -22    656      C
```

FIG. 18 (continued)

| | | | | | | | | | | | | | | |
|---|---|---|---|---|---|---|---|---|---|---|---|---|---|---|
| ATOM | 96 | CB | ARG | A | 6 | 11.981 | 19.791 | 93.190 | 1.00 | 41.23 | | | | C |
| ANISOU | 96 | CB | ARG | A | 6 | 5272 | 4669 | 5725 | 641 | -156 | 843 | | | C |
| ATOM | 99 | CG | ARG | A | 6 | 10.697 | 19.651 | 93.975 | 1.00 | 40.79 | | | | C |
| ANISOU | 99 | CG | ARG | A | 6 | 5351 | 4617 | 5531 | 498 | -195 | 958 | | | C |
| ATOM | 102 | CD | ARG | A | 6 | 10.928 | 18.851 | 95.278 | 1.00 | 42.89 | | | | C |
| ANISOU | 102 | CD | ARG | A | 6 | 5664 | 4785 | 5848 | 521 | -340 | 1172 | | | C |
| ATOM | 105 | NE | ARG | A | 6 | 9.652 | 18.568 | 95.912 | 1.00 | 43.90 | | | | N |
| ANISOU | 105 | NE | ARG | A | 6 | 5925 | 4907 | 5848 | 368 | -353 | 1271 | | | N |
| ATOM | 107 | CZ | ARG | A | 6 | 8.902 | 19.457 | 96.546 | 1.00 | 42.02 | | | | C |
| ANISOU | 107 | CZ | ARG | A | 6 | 5708 | 4857 | 5402 | 242 | -346 | 1309 | | | C |
| ATOM | 108 | NH1 | ARG | A | 6 | 9.316 | 20.704 | 96.693 | 1.00 | 40.53 | | | | N |
| ANISOU | 108 | NH1 | ARG | A | 6 | 5434 | 4855 | 5109 | 250 | -339 | 1262 | | | N |
| ATOM | 111 | NH2 | ARG | A | 6 | 7.734 | 19.083 | 97.060 | 1.00 | 42.78 | | | | N |
| ANISOU | 111 | NH2 | ARG | A | 6 | 5910 | 4947 | 5396 | 105 | -341 | 1391 | | | N |
| ATOM | 114 | C | ARG | A | 6 | 13.208 | 21.030 | 91.402 | 1.00 | 41.92 | | | | C |
| ANISOU | 114 | C | ARG | A | 6 | 5160 | 4932 | 5836 | 720 | 12 | 568 | | | C |
| ATOM | 115 | O | ARG | A | 6 | 13.807 | 22.008 | 91.844 | 1.00 | 41.81 | | | | O |
| ANISOU | 115 | O | ARG | A | 6 | 5054 | 5073 | 5759 | 716 | -31 | 608 | | | O |
| ATOM | 117 | N | GLN | A | 7 | 13.689 | 20.255 | 90.429 | 1.00 | 44.86 | | | | N |
| ANISOU | 117 | N | GLN | A | 7 | 5502 | 5182 | 6361 | 813 | 99 | 437 | | | N |
| ATOM | 118 | CA | GLN | A | 7 | 14.980 | 20.509 | 89.794 | 1.00 | 47.32 | | | | C |
| ANISOU | 118 | CA | GLN | A | 7 | 5649 | 5553 | 6778 | 926 | 160 | 333 | | | C |
| ATOM | 120 | CB | GLN | A | 7 | 15.596 | 19.206 | 89.265 | 1.00 | 50.83 | | | | C |
| ANISOU | 120 | CB | GLN | A | 7 | 6067 | 5789 | 7458 | 1081 | 214 | 243 | | | C |
| ATOM | 123 | CG | GLN | A | 7 | 16.042 | 18.245 | 90.381 | 1.00 | 55.13 | | | | C |
| ANISOU | 123 | CG | GLN | A | 7 | 6603 | 6162 | 8182 | 1209 | 69 | 419 | | | C |
| ATOM | 126 | CD | GLN | A | 7 | 16.546 | 16.882 | 89.861 | 1.00 | 59.09 | | | | C |
| ANISOU | 126 | CD | GLN | A | 7 | 7099 | 6405 | 8947 | 1378 | 126 | 329 | | | C |
| ATOM | 127 | OE1 | GLN | A | 7 | 16.678 | 16.665 | 88.642 | 1.00 | 62.39 | | | | O |
| ANISOU | 127 | OE1 | GLN | A | 7 | 7506 | 6788 | 9411 | 1404 | 289 | 108 | | | O |
| ATOM | 128 | NE2 | GLN | A | 7 | 16.824 | 15.959 | 90.790 | 1.00 | 61.66 | | | | N |
| ANISOU | 128 | NE2 | GLN | A | 7 | 7441 | 6543 | 9443 | 1492 | -9 | 499 | | | N |
| ATOM | 131 | C | GLN | A | 7 | 14.864 | 21.532 | 88.674 | 1.00 | 44.06 | | | | C |
| ANISOU | 131 | C | GLN | A | 7 | 5206 | 5308 | 6227 | 834 | 288 | 182 | | | C |
| ATOM | 132 | O | GLN | A | 7 | 15.798 | 22.282 | 88.440 | 1.00 | 43.88 | | | | O |
| ANISOU | 132 | O | GLN | A | 7 | 5046 | 5421 | 6206 | 862 | 316 | 145 | | | O |
| ATOM | 134 | N | CYS | A | 8 | 13.713 | 21.608 | 88.006 | 1.00 | 41.71 | | | | N |
| ANISOU | 134 | N | CYS | A | 8 | 5033 | 5013 | 5802 | 712 | 354 | 112 | | | N |
| ATOM | 135 | CA | CYS | A | 8 | 13.632 | 22.405 | 86.780 | 1.00 | 41.63 | | | | C |
| ANISOU | 135 | CA | CYS | A | 8 | 5001 | 5141 | 5673 | 632 | 474 | -28 | | | C |
| ATOM | 137 | CB | CYS | A | 8 | 13.175 | 21.523 | 85.634 | 1.00 | 44.73 | | | | C |
| ANISOU | 137 | CB | CYS | A | 8 | 5476 | 5432 | 6086 | 607 | 584 | -188 | | | C |
| ATOM | 140 | SG | CYS | A | 8 | 14.467 | 20.295 | 85.173 | 1.00 | 52.87 | | | | S |
| ANISOU | 140 | SG | CYS | A | 8 | 6419 | 6299 | 7370 | 794 | 670 | -327 | | | S |
| ATOM | 142 | C | CYS | A | 8 | 12.851 | 23.730 | 86.821 | 1.00 | 37.13 | | | | C |
| ANISOU | 142 | C | CYS | A | 8 | 4468 | 4738 | 4901 | 495 | 456 | 26 | | | C |
| ATOM | 143 | O | CYS | A | 8 | 12.992 | 24.544 | 85.907 | 1.00 | 36.80 | | | | O |
| ANISOU | 143 | O | CYS | A | 8 | 4392 | 4822 | 4768 | 436 | 534 | -55 | | | O |
| ATOM | 145 | N | PHE | A | 9 | 12.076 | 23.962 | 87.882 | 1.00 | 34.09 | | | | N |
| ANISOU | 145 | N | PHE | A | 9 | 4149 | 4353 | 4449 | 448 | 358 | 162 | | | N |
| ATOM | 146 | CA | PHE | A | 9 | 11.500 | 25.282 | 88.136 | 1.00 | 29.79 | | | | C |
| ANISOU | 146 | CA | PHE | A | 9 | 3620 | 3951 | 3748 | 354 | 336 | 217 | | | C |
| ATOM | 148 | CB | PHE | A | 9 | 9.991 | 25.175 | 88.443 | 1.00 | 28.54 | | | | C |
| ANISOU | 148 | CB | PHE | A | 9 | 3575 | 3776 | 3495 | 265 | 312 | 273 | | | C |
| ATOM | 151 | CG | PHE | A | 9 | 9.169 | 24.801 | 87.252 | 1.00 | 25.87 | | | | C |
| ANISOU | 151 | CG | PHE | A | 9 | 3292 | 3425 | 3113 | 196 | 385 | 177 | | | C |
| ATOM | 152 | CD1 | PHE | A | 9 | 8.712 | 25.773 | 86.385 | 1.00 | 26.33 | | | | C |
| ANISOU | 152 | CD1 | PHE | A | 9 | 3346 | 3607 | 3052 | 121 | 430 | 136 | | | C |
| ATOM | 154 | CE1 | PHE | A | 9 | 7.961 | 25.434 | 85.252 | 1.00 | 26.62 | | | | C |
| ANISOU | 154 | CE1 | PHE | A | 9 | 3431 | 3655 | 3029 | 41 | 482 | 55 | | | C |
| ATOM | 156 | CZ | PHE | A | 9 | 7.648 | 24.110 | 84.998 | 1.00 | 28.44 | | | | C |
| ANISOU | 156 | CZ | PHE | A | 9 | 3722 | 3762 | 3321 | 27 | 498 | -6 | | | C |
| ATOM | 158 | CE2 | PHE | A | 9 | 8.086 | 23.119 | 85.848 | 1.00 | 29.05 | | | | C |
| ANISOU | 158 | CE2 | PHE | A | 9 | 3816 | 3688 | 3535 | 107 | 463 | 28 | | | C |
| ATOM | 160 | CD2 | PHE | A | 9 | 8.862 | 23.479 | 86.986 | 1.00 | 29.88 | | | | C |
| ANISOU | 160 | CD2 | PHE | A | 9 | 3863 | 3793 | 3698 | 197 | 400 | 131 | | | C |
| ATOM | 162 | C | PHE | A | 9 | 12.225 | 25.984 | 89.283 | 1.00 | 29.37 | | | | C |
| ANISOU | 162 | C | PHE | A | 9 | 3502 | 3962 | 3694 | 383 | 249 | 318 | | | C |
| ATOM | 163 | O | PHE | A | 9 | 12.692 | 25.361 | 90.216 | 1.00 | 29.17 | | | | O |
| ANISOU | 163 | O | PHE | A | 9 | 3457 | 3874 | 3753 | 448 | 167 | 400 | | | O |
| ATOM | 165 | N | ASN | A | 10 | 12.285 | 27.297 | 89.197 | 1.00 | 27.08 | | | | N |
| ANISOU | 165 | N | ASN | A | 10 | 3189 | 3797 | 3304 | 322 | 261 | 315 | | | N |
| ATOM | 166 | CA | ASN | A | 10 | 12.898 | 28.112 | 90.216 | 1.00 | 29.20 | | | | C |
| ANISOU | 166 | CA | ASN | A | 10 | 3412 | 4137 | 3546 | 316 | 185 | 389 | | | C |
| ATOM | 168 | CB | ASN | A | 10 | 12.948 | 29.565 | 89.738 | 1.00 | 30.10 | | | | C |
| ANISOU | 168 | CB | ASN | A | 10 | 3515 | 4358 | 3563 | 238 | 228 | 352 | | | C |
| ATOM | 171 | CG | ASN | A | 10 | 13.991 | 29.772 | 88.634 | 1.00 | 33.67 | | | | C |
| ANISOU | 171 | CG | ASN | A | 10 | 3864 | 4863 | 4064 | 246 | 304 | 266 | | | C |
| ATOM | 172 | OD1 | ASN | A | 10 | 13.776 | 30.548 | 87.672 | 1.00 | 35.92 | | | | O |

FIG. 18 (continued)

| | | | | | | | | | | | | | |
|---|---|---|---|---|---|---|---|---|---|---|---|---|---|
| ANISOU | 172 | OD1 | ASN | A | 10 | 4167 | 5205 | 4276 | 177 | 375 | 218 | | O |
| ATOM | 173 | ND2 | ASN | A | 10 | 15.130 | 29.076 | 88.763 | 1.00 | 35.79 | | | N |
| ANISOU | 173 | ND2 | ASN | A | 10 | 4020 | 5121 | 4459 | 330 | 289 | 253 | | N |
| ATOM | 176 | C | ASN | A | 10 | 12.223 | 27.971 | 91.586 | 1.00 | 27.94 | | | C |
| ANISOU | 176 | C | ASN | A | 10 | 3329 | 3955 | 3331 | 294 | 94 | 501 | | C |
| ATOM | 177 | O | ASN | A | 10 | 11.046 | 27.661 | 91.681 | 1.00 | 26.18 | | | O |
| ANISOU | 177 | O | ASN | A | 10 | 3198 | 3695 | 3055 | 256 | 107 | 521 | | O |
| ATOM | 179 | N | PRO | A | 11 | 13.006 | 28.085 | 92.655 | 1.00 | 29.58 | | | N |
| ANISOU | 179 | N | PRO | A | 11 | 3492 | 4197 | 3551 | 311 | -2 | 577 | | N |
| ATOM | 180 | CA | PRO | A | 11 | 12.460 | 27.811 | 93.973 | 1.00 | 28.66 | | | C |
| ANISOU | 180 | CA | PRO | A | 11 | 3450 | 4070 | 3368 | 281 | -88 | 687 | | C |
| ATOM | 182 | CB | PRO | A | 11 | 13.627 | 28.106 | 94.913 | 1.00 | 31.75 | | | C |
| ANISOU | 182 | CB | PRO | A | 11 | 3764 | 4532 | 3768 | 291 | -197 | 754 | | C |
| ATOM | 185 | CG | PRO | A | 11 | 14.853 | 27.909 | 94.052 | 1.00 | 31.76 | | | C |
| ANISOU | 185 | CG | PRO | A | 11 | 3623 | 4531 | 3912 | 374 | -175 | 696 | | C |
| ATOM | 188 | CD | PRO | A | 11 | 14.464 | 28.338 | 92.693 | 1.00 | 30.86 | | | C |
| ANISOU | 188 | CD | PRO | A | 11 | 3520 | 4417 | 3790 | 353 | -40 | 571 | | C |
| ATOM | 191 | C | PRO | A | 11 | 11.208 | 28.574 | 94.358 | 1.00 | 26.61 | | | C |
| ANISOU | 191 | C | PRO | A | 11 | 3292 | 3859 | 2960 | 190 | -54 | 687 | | C |
| ATOM | 192 | O | PRO | A | 11 | 10.325 | 27.973 | 94.985 | 1.00 | 24.43 | | | O |
| ANISOU | 192 | O | PRO | A | 11 | 3093 | 3550 | 2640 | 163 | -72 | 752 | | O |
| ATOM | 193 | N | MET | A | 12 | 11.095 | 29.848 | 93.984 | 1.00 | 26.22 | | | N |
| ANISOU | 193 | N | MET | A | 12 | 3241 | 3880 | 2842 | 145 | -1 | 619 | | N |
| ATOM | 194 | CA | MET | A | 12 | 9.903 | 30.635 | 94.385 | 1.00 | 28.23 | | | C |
| ANISOU | 194 | CA | MET | A | 12 | 3579 | 4171 | 2977 | 82 | 38 | 613 | | C |
| ATOM | 196 | CB | MET | A | 12 | 10.081 | 32.171 | 94.254 | 1.00 | 32.63 | | | C |
| ANISOU | 196 | CB | MET | A | 12 | 4137 | 4783 | 3477 | 41 | 70 | 552 | | C |
| ATOM | 199 | CG | MET | A | 12 | 10.074 | 32.766 | 92.830 | 1.00 | 34.41 | | | C |
| ANISOU | 199 | CG | MET | A | 12 | 4335 | 5000 | 3740 | 46 | 143 | 487 | | C |
| ATOM | 202 | SD | MET | A | 12 | 11.555 | 32.239 | 91.976 | 1.00 | 42.95 | | | S |
| ANISOU | 202 | SD | MET | A | 12 | 5307 | 6083 | 4930 | 82 | 136 | 460 | | S |
| ATOM | 203 | CE | MET | A | 12 | 11.763 | 33.541 | 90.745 | 1.00 | 41.59 | | | C |
| ANISOU | 203 | CE | MET | A | 12 | 5120 | 5945 | 4736 | 31 | 210 | 399 | | C |
| ATOM | 207 | C | MET | A | 12 | 8.653 | 30.147 | 93.665 | 1.00 | 24.85 | | | C |
| ANISOU | 207 | C | MET | A | 12 | 3190 | 3702 | 2551 | 80 | 105 | 597 | | C |
| ATOM | 208 | O | MET | A | 12 | 7.596 | 30.147 | 94.238 | 1.00 | 21.72 | | | O |
| ANISOU | 208 | O | MET | A | 12 | 2846 | 3322 | 2083 | 45 | 120 | 626 | | O |
| ATOM | 210 | N | ILE | A | 13 | 8.812 | 29.709 | 92.423 | 1.00 | 23.59 | | | N |
| ANISOU | 210 | N | ILE | A | 13 | 2996 | 3501 | 2465 | 109 | 147 | 547 | | N |
| ATOM | 211 | CA | ILE | A | 13 | 7.721 | 29.165 | 91.627 | 1.00 | 23.37 | | | C |
| ANISOU | 211 | CA | ILE | A | 13 | 3000 | 3443 | 2436 | 90 | 198 | 526 | | C |
| ATOM | 213 | CB | ILE | A | 13 | 8.155 | 28.825 | 90.165 | 1.00 | 24.53 | | | C |
| ANISOU | 213 | CB | ILE | A | 13 | 3112 | 3565 | 2644 | 107 | 248 | 444 | | C |
| ATOM | 215 | CG1 | ILE | A | 13 | 8.633 | 30.091 | 89.404 | 1.00 | 26.07 | | | C |
| ANISOU | 215 | CG1 | ILE | A | 13 | 3268 | 3832 | 2804 | 93 | 286 | 397 | | C |
| ATOM | 218 | CD1 | ILE | A | 13 | 7.533 | 31.193 | 89.236 | 1.00 | 24.60 | | | C |
| ANISOU | 218 | CD1 | ILE | A | 13 | 3116 | 3699 | 2531 | 49 | 307 | 414 | | C |
| ATOM | 222 | CG2 | ILE | A | 13 | 7.023 | 28.099 | 89.423 | 1.00 | 23.39 | | | C |
| ANISOU | 222 | CG2 | ILE | A | 13 | 3008 | 3391 | 2486 | 65 | 283 | 422 | | C |
| ATOM | 226 | C | ILE | A | 13 | 7.229 | 27.894 | 92.309 | 1.00 | 22.73 | | | C |
| ANISOU | 226 | C | ILE | A | 13 | 2965 | 3296 | 2377 | 82 | 162 | 591 | | C |
| ATOM | 227 | O | ILE | A | 13 | 6.021 | 27.711 | 92.492 | 1.00 | 22.24 | | | O |
| ANISOU | 227 | O | ILE | A | 13 | 2943 | 3247 | 2261 | 29 | 182 | 617 | | O |
| ATOM | 229 | N | VAL | A | 14 | 8.172 | 27.038 | 92.728 | 1.00 | 23.62 | | | N |
| ANISOU | 229 | N | VAL | A | 14 | 3064 | 3338 | 2574 | 131 | 105 | 629 | | N |
| ATOM | 230 | CA | VAL | A | 14 | 7.813 | 25.784 | 93.357 | 1.00 | 24.71 | | | C |
| ANISOU | 230 | CA | VAL | A | 14 | 3257 | 3384 | 2749 | 123 | 60 | 711 | | C |
| ATOM | 232 | CB | VAL | A | 14 | 9.035 | 24.866 | 93.522 | 1.00 | 27.10 | | | C |
| ANISOU | 232 | CB | VAL | A | 14 | 3525 | 3583 | 3188 | 212 | -4 | 746 | | C |
| ATOM | 234 | CG1 | VAL | A | 14 | 8.680 | 23.609 | 94.318 | 1.00 | 26.89 | | | C |
| ANISOU | 234 | CG1 | VAL | A | 14 | 3574 | 3442 | 3203 | 199 | -69 | 864 | | C |
| ATOM | 238 | CG2 | VAL | A | 14 | 9.639 | 24.470 | 92.119 | 1.00 | 25.97 | | | C |
| ANISOU | 238 | CG2 | VAL | A | 14 | 3331 | 3371 | 3165 | 279 | 64 | 622 | | C |
| ATOM | 242 | C | VAL | A | 14 | 7.093 | 26.013 | 94.706 | 1.00 | 25.47 | | | C |
| ANISOU | 242 | C | VAL | A | 14 | 3406 | 3544 | 2727 | 54 | 23 | 809 | | C |
| ATOM | 243 | O | VAL | A | 14 | 6.178 | 25.303 | 95.056 | 1.00 | 23.75 | | | O |
| ANISOU | 243 | O | VAL | A | 14 | 3246 | 3295 | 2484 | -4 | 26 | 866 | | O |
| ATOM | 245 | N | GLU | A | 15 | 7.550 | 27.014 | 95.444 | 1.00 | 25.34 | | | N |
| ANISOU | 245 | N | GLU | A | 15 | 3371 | 3623 | 2635 | 50 | -4 | 820 | | N |
| ATOM | 246 | CA | GLU | A | 15 | 6.969 | 27.398 | 96.721 | 1.00 | 28.74 | | | C |
| ANISOU | 246 | CA | GLU | A | 15 | 3852 | 4138 | 2930 | -20 | -21 | 883 | | C |
| ATOM | 248 | CB | GLU | A | 15 | 7.850 | 28.494 | 97.302 | 1.00 | 29.23 | | | C |
| ANISOU | 248 | CB | GLU | A | 15 | 3889 | 4284 | 2934 | -18 | -57 | 860 | | C |
| ATOM | 251 | CG | GLU | A | 15 | 7.467 | 29.092 | 98.642 | 1.00 | 32.33 | | | C |
| ANISOU | 251 | CG | GLU | A | 15 | 4339 | 4779 | 3167 | -97 | -69 | 891 | | C |
| ATOM | 254 | CD | GLU | A | 15 | 8.460 | 30.216 | 98.988 | 1.00 | 32.87 | | | C |
| ANISOU | 254 | CD | GLU | A | 15 | 4382 | 4913 | 3192 | -105 | -105 | 839 | | C |
| ATOM | 255 | OE1 | GLU | A | 15 | 9.671 | 29.977 | 98.958 | 1.00 | 32.55 | | | O |
| ANISOU | 255 | OE1 | GLU | A | 15 | 4286 | 4861 | 3222 | -71 | -193 | 873 | | O |

FIG. 18 (continued)

```
ATOM    256  OE2 GLU A  15      8.036  31.362  99.223  1.00 36.39          O
ANISOU  256  OE2 GLU A  15   4860   5417   3551   -142    -43   758        O
ATOM    257  C   GLU A  15      5.532  27.855  96.544  1.00 26.04          C
ANISOU  257  C   GLU A  15   3533   3852   2510    -75     72   842        C
ATOM    258  O   GLU A  15      4.665  27.393  97.259  1.00 27.52          O
ANISOU  258  O   GLU A  15   3764   4065   2629   -141     82   905        O
ATOM    260  N   LEU A  16      5.302  28.726  95.577  1.00 25.65          N
ANISOU  260  N   LEU A  16   3444   3826   2476    -50    136   748        N
ATOM    261  CA  LEU A  16      3.965  29.244  95.252  1.00 24.91          C
ANISOU  261  CA  LEU A  16   3343   3789   2334    -78    216   713        C
ATOM    263  CB  LEU A  16      4.048  30.344  94.195  1.00 24.76          C
ANISOU  263  CB  LEU A  16   3282   3783   2341    -36    257   632        C
ATOM    266  CG  LEU A  16      4.731  31.643  94.615  1.00 24.47          C
ANISOU  266  CG  LEU A  16   3250   3776   2271    -15    256   592        C
ATOM    268  CD1 LEU A  16      4.989  32.523  93.431  1.00 23.58          C
ANISOU  268  CD1 LEU A  16   3107   3650   2203     16    282   538        C
ATOM    272  CD2 LEU A  16      3.812  32.369  95.689  1.00 25.23          C
ANISOU  272  CD2 LEU A  16   3375   3939   2271    -38    305   583        C
ATOM    276  C   LEU A  16      3.058  28.125  94.804  1.00 25.87          C
ANISOU  276  C   LEU A  16   3470   3874   2486   -122    231   745        C
ATOM    277  O   LEU A  16      1.904  28.030  95.283  1.00 26.98          O
ANISOU  277  O   LEU A  16   3613   4076   2564   -181    270   775        O
ATOM    279  N   ALA A  17      3.573  27.212  93.970  1.00 23.75          N
ANISOU  279  N   ALA A  17   3204   3507   2312   -104    204   734        N
ATOM    280  CA  ALA A  17      2.773  26.040  93.554  1.00 24.45          C
ANISOU  280  CA  ALA A  17   3318   3538   2434   -166    211   754        C
ATOM    282  CB  ALA A  17      3.521  25.270  92.413  1.00 23.02          C
ANISOU  282  CB  ALA A  17   3143   3241   2364   -128    201   692        C
ATOM    286  C   ALA A  17      2.388  25.061  94.675  1.00 27.68          C
ANISOU  286  C   ALA A  17   3786   3911   2818   -234    178   863        C
ATOM    287  O   ALA A  17      1.245  24.559  94.729  1.00 28.32          O
ANISOU  287  O   ALA A  17   3878   4015   2868   -327    206   894        O
ATOM    289  N   GLU A  18      3.357  24.729  95.548  1.00 29.66          N
ANISOU  289  N   GLU A  18   4073   4112   3086   -201    109   934        N
ATOM    290  CA  GLU A  18      3.113  23.885  96.731  1.00 32.10          C
ANISOU  290  CA  GLU A  18   4450   4395   3352   -272     61  1067        C
ATOM    292  CB  GLU A  18      4.406  23.580  97.499  1.00 33.49          C
ANISOU  292  CB  GLU A  18   4649   4513   3564   -213    -42  1151        C
ATOM    295  CG  GLU A  18      5.222  22.443  96.915  1.00 35.82          C
ANISOU  295  CG  GLU A  18   4958   4620   4032   -139    -98  1169        C
ATOM    298  CD  GLU A  18      6.444  22.109  97.750  1.00 36.93          C
ANISOU  298  CD  GLU A  18   5099   4712   4220    -70   -216  1279        C
ATOM    299  OE1 GLU A  18      7.464  22.788  97.585  1.00 40.01          O
ANISOU  299  OE1 GLU A  18   5413   5148   4640     16   -239  1228        O
ATOM    300  OE2 GLU A  18      6.393  21.154  98.540  1.00 38.83          O
ANISOU  300  OE2 GLU A  18   5410   4871   4473   -108   -292  1427        O
ATOM    301  C   GLU A  18      2.124  24.513  97.689  1.00 34.60          C
ANISOU  301  C   GLU A  18   4768   4867   3513   -358    111  1099        C
ATOM    302  O   GLU A  18      1.250  23.809  98.246  1.00 37.00          O
ANISOU  302  O   GLU A  18   5111   5182   3764   -466    124  1181        O
ATOM    304  N   LYS A  19      2.264  25.818  97.886  1.00 36.99          N
ANISOU  304  N   LYS A  19   5029   5281   3745   -318    147  1029        N
ATOM    305  CA  LYS A  19      1.304  26.583  98.680  1.00 39.73          C
ANISOU  305  CA  LYS A  19   5366   5775   3956   -377    224  1016        C
ATOM    307  CB  LYS A  19      1.658  28.076  98.712  1.00 39.96          C
ANISOU  307  CB  LYS A  19   5361   5876   3945   -309    261   914        C
ATOM    310  CG  LYS A  19      0.928  28.921  99.792  1.00 41.11          C
ANISOU  310  CG  LYS A  19   5514   6160   3946   -355    342   883        C
ATOM    313  CD  LYS A  19      0.895  30.421  99.365  1.00 42.09          C
ANISOU  313  CD  LYS A  19   5595   6311   4084   -273    406   755        C
ATOM    316  CE  LYS A  19      0.107  31.338 100.341  1.00 43.50          C
ANISOU  316  CE  LYS A  19   5777   6607   4142   -297    513   688        C
ATOM    319  NZ  LYS A  19     -0.326  32.646  99.663  1.00 42.49          N
ANISOU  319  NZ  LYS A  19   5593   6471   4080   -200    591   575        N
ATOM    323  C   LYS A  19     -0.073  26.352  98.058  1.00 39.62          C
ANISOU  323  C   LYS A  19   5302   5797   3954   -429    302   995        C
ATOM    324  O   LYS A  19     -0.961  25.842  98.727  1.00 39.77          O
ANISOU  324  O   LYS A  19   5334   5877   3902   -532    336  1061        O
ATOM    326  N   ALA A  20     -0.223  26.685  96.768  1.00 38.37          N
ANISOU  326  N   ALA A  20   5085   5612   3880   -373    322   914        N
ATOM    327  CA  ALA A  20     -1.500  26.511  96.061  1.00 37.94          C
ANISOU  327  CA  ALA A  20   4967   5608   3840   -426    375   896        C
ATOM    329  CB  ALA A  20     -1.368  26.873  94.530  1.00 36.88          C
ANISOU  329  CB  ALA A  20   4784   5439   3790   -363    368   815        C
ATOM    333  C   ALA A  20     -2.097  25.117  96.265  1.00 38.18          C
ANISOU  333  C   ALA A  20   5036   5595   3874   -551    359   980        C
ATOM    334  O   ALA A  20     -3.279  24.991  96.568  1.00 41.92          O
ANISOU  334  O   ALA A  20   5463   6172   4295   -642    414  1009        O
ATOM    336  N   MET A  21     -1.283  24.068  96.171  1.00 39.05          N
```

FIG. 18 (continued)

| | | | | | | | | | | | | | |
|---|---|---|---|---|---|---|---|---|---|---|---|---|---|
| ANISOU | 336 | N | MET | A | 21 | 5230 | 5551 | 4055 | -558 | 285 | 1025 | | N |
| ATOM | 337 | CA | MET | A | 21 | -1.788 | 22.702 | 96.299 | 1.00 | 38.52 | | | C |
| ANISOU | 337 | CA | MET | A | 21 | 5224 | 5400 | 4014 | -681 | 263 | 1107 | | C |
| ATOM | 339 | CB | MET | A | 21 | -0.778 | 21.695 | 95.755 | 1.00 | 38.62 | | | C |
| ANISOU | 339 | CB | MET | A | 21 | 5317 | 5200 | 4156 | -639 | 189 | 1110 | | C |
| ATOM | 342 | CG | MET | A | 21 | -0.687 | 21.739 | 94.239 | 1.00 | 35.47 | | | C |
| ANISOU | 342 | CG | MET | A | 21 | 4884 | 4753 | 3841 | -596 | 205 | 980 | | C |
| ATOM | 345 | SD | MET | A | 21 | 0.362 | 20.453 | 93.625 | 1.00 | 39.81 | | | S |
| ANISOU | 345 | SD | MET | A | 21 | 5528 | 5049 | 4550 | -551 | 150 | 956 | | S |
| ATOM | 346 | CE | MET | A | 21 | -0.856 | 19.178 | 93.255 | 1.00 | 39.90 | | | C |
| ANISOU | 346 | CE | MET | A | 21 | 5603 | 4977 | 4582 | -737 | 161 | 972 | | C |
| ATOM | 350 | C | MET | A | 21 | -2.188 | 22.324 | 97.729 | 1.00 | 42.81 | | | C |
| ANISOU | 350 | C | MET | A | 21 | 5814 | 6000 | 4451 | -786 | 267 | 1235 | | C |
| ATOM | 351 | O | MET | A | 21 | -3.102 | 21.504 | 97.932 | 1.00 | 40.74 | | | O |
| ANISOU | 351 | O | MET | A | 21 | 5568 | 5742 | 4167 | -928 | 285 | 1304 | | O |
| ATOM | 353 | N | LYS | A | 22 | -1.488 | 22.897 | 98.711 | 1.00 | 44.96 | | | N |
| ANISOU | 353 | N | LYS | A | 22 | 6112 | 6322 | 4647 | -735 | 246 | 1268 | | N |
| ATOM | 354 | CA | LYS | A | 22 | -1.806 | 22.648 | 100.100 | 1.00 | 48.37 | | | C |
| ANISOU | 354 | CA | LYS | A | 22 | 6596 | 6838 | 4945 | -843 | 252 | 1386 | | C |
| ATOM | 356 | CB | LYS | A | 22 | -0.727 | 23.210 | 101.039 | 1.00 | 48.58 | | | C |
| ANISOU | 356 | CB | LYS | A | 22 | 6666 | 6896 | 4895 | -781 | 196 | 1416 | | C |
| ATOM | 359 | CG | LYS | A | 22 | -0.641 | 22.465 | 102.378 | 1.00 | 51.38 | | | C |
| ANISOU | 359 | CG | LYS | A | 22 | 7121 | 7268 | 5134 | -900 | 139 | 1588 | | C |
| ATOM | 362 | CD | LYS | A | 22 | 0.454 | 23.060 | 103.288 | 1.00 | 51.62 | | | C |
| ANISOU | 362 | CD | LYS | A | 22 | 7188 | 7354 | 5072 | -853 | 65 | 1616 | | C |
| ATOM | 365 | CE | LYS | A | 22 | 0.468 | 22.433 | 104.691 | 1.00 | 54.38 | | | C |
| ANISOU | 365 | CE | LYS | A | 22 | 7638 | 7762 | 5263 | -991 | 5 | 1798 | | C |
| ATOM | 368 | NZ | LYS | A | 22 | 1.414 | 23.155 | 105.593 | 1.00 | 55.29 | | | N |
| ANISOU | 368 | NZ | LYS | A | 22 | 7780 | 7975 | 5253 | -969 | -63 | 1807 | | N |
| ATOM | 372 | C | LYS | A | 22 | -3.165 | 23.271 | 100.388 | 1.00 | 49.24 | | | C |
| ANISOU | 372 | C | LYS | A | 22 | 6618 | 7146 | 4945 | -921 | 378 | 1344 | | C |
| ATOM | 373 | O | LYS | A | 22 | -4.017 | 22.651 | 101.022 | 1.00 | 50.12 | | | O |
| ANISOU | 373 | O | LYS | A | 22 | 6743 | 7322 | 4977 | -1069 | 416 | 1432 | | O |
| ATOM | 375 | N | GLU | A | 23 | -3.363 | 24.486 | 99.892 | 1.00 | 49.84 | | | N |
| ANISOU | 375 | N | GLU | A | 23 | 6598 | 7312 | 5026 | -820 | 444 | 1213 | | N |
| ATOM | 376 | CA | GLU | A | 23 | -4.602 | 25.224 | 100.118 | 1.00 | 52.80 | | | C |
| ANISOU | 376 | CA | GLU | A | 23 | 6865 | 7870 | 5326 | -851 | 569 | 1157 | | C |
| ATOM | 378 | CB | GLU | A | 23 | -4.446 | 26.647 | 99.587 | 1.00 | 53.64 | | | C |
| ANISOU | 378 | CB | GLU | A | 23 | 6896 | 8017 | 5470 | -697 | 611 | 1023 | | C |
| ATOM | 381 | CG | GLU | A | 23 | -4.252 | 27.619 | 100.703 | 1.00 | 56.62 | | | C |
| ANISOU | 381 | CG | GLU | A | 23 | 7293 | 8494 | 5726 | -668 | 674 | 976 | | C |
| ATOM | 384 | CD | GLU | A | 23 | -3.453 | 28.803 | 100.299 | 1.00 | 57.33 | | | C |
| ANISOU | 384 | CD | GLU | A | 23 | 7383 | 8536 | 5865 | -525 | 660 | 871 | | C |
| ATOM | 385 | OE1 | GLU | A | 23 | -3.765 | 29.392 | 99.231 | 1.00 | 57.26 | | | O |
| ANISOU | 385 | OE1 | GLU | A | 23 | 7292 | 8506 | 5958 | -436 | 677 | 805 | | O |
| ATOM | 386 | OE2 | GLU | A | 23 | -2.527 | 29.138 | 101.078 | 1.00 | 59.20 | | | O |
| ANISOU | 386 | OE2 | GLU | A | 23 | 7703 | 8762 | 6027 | -518 | 625 | 864 | | O |
| ATOM | 387 | C | GLU | A | 23 | -5.879 | 24.610 | 99.528 | 1.00 | 54.24 | | | C |
| ANISOU | 387 | C | GLU | A | 23 | 6960 | 8103 | 5547 | -954 | 613 | 1176 | | C |
| ATOM | 388 | O | GLU | A | 23 | -6.848 | 24.378 | 100.251 | 1.00 | 52.18 | | | O |
| ANISOU | 388 | O | GLU | A | 23 | 6657 | 7975 | 5195 | -1076 | 692 | 1224 | | O |
| ATOM | 390 | N | TYR | A | 24 | -5.888 | 24.371 | 98.216 | 1.00 | 54.13 | | | N |
| ANISOU | 390 | N | TYR | A | 24 | 6913 | 7999 | 5655 | -920 | 566 | 1135 | | N |
| ATOM | 391 | CA | TYR | A | 24 | -7.117 | 23.923 | 97.537 | 1.00 | 56.06 | | | C |
| ANISOU | 391 | CA | TYR | A | 24 | 7057 | 8312 | 5932 | -1023 | 596 | 1138 | | C |
| ATOM | 393 | CB | TYR | A | 24 | -7.128 | 24.376 | 96.073 | 1.00 | 55.46 | | | C |
| ANISOU | 393 | CB | TYR | A | 24 | 6909 | 8209 | 5954 | -934 | 563 | 1049 | | C |
| ATOM | 396 | CG | TYR | A | 24 | -7.039 | 25.884 | 95.813 | 1.00 | 54.06 | | | C |
| ANISOU | 396 | CG | TYR | A | 24 | 6644 | 8111 | 5785 | -767 | 601 | 964 | | C |
| ATOM | 397 | CD1 | TYR | A | 24 | -8.131 | 26.606 | 95.329 | 1.00 | 55.06 | | | C |
| ANISOU | 397 | CD1 | TYR | A | 24 | 6608 | 8381 | 5929 | -738 | 652 | 931 | | C |
| ATOM | 399 | CE1 | TYR | A | 24 | -8.038 | 27.983 | 95.056 | 1.00 | 54.09 | | | C |
| ANISOU | 399 | CE1 | TYR | A | 24 | 6420 | 8296 | 5836 | -577 | 679 | 865 | | C |
| ATOM | 401 | CZ | TYR | A | 24 | -6.846 | 28.647 | 95.270 | 1.00 | 54.39 | | | C |
| ANISOU | 401 | CZ | TYR | A | 24 | 6557 | 8234 | 5873 | -466 | 662 | 822 | | C |
| ATOM | 402 | OH | TYR | A | 24 | -6.714 | 30.017 | 95.011 | 1.00 | 53.12 | | | O |
| ANISOU | 402 | OH | TYR | A | 24 | 6352 | 8082 | 5748 | -320 | 687 | 760 | | O |
| ATOM | 404 | CE2 | TYR | A | 24 | -5.750 | 27.938 | 95.740 | 1.00 | 53.28 | | | C |
| ANISOU | 404 | CE2 | TYR | A | 24 | 6562 | 7976 | 5708 | -504 | 610 | 849 | | C |
| ATOM | 406 | CD2 | TYR | A | 24 | -5.861 | 26.568 | 95.998 | 1.00 | 53.90 | | | C |
| ANISOU | 406 | CD2 | TYR | A | 24 | 6700 | 8011 | 5769 | -642 | 578 | 923 | | C |
| ATOM | 408 | C | TYR | A | 24 | -7.310 | 22.392 | 97.659 | 1.00 | 57.80 | | | C |
| ANISOU | 408 | C | TYR | A | 24 | 7368 | 8430 | 6165 | -1201 | 548 | 1242 | | C |
| ATOM | 409 | O | TYR | A | 24 | -8.220 | 21.814 | 97.060 | 1.00 | 59.88 | | | O |
| ANISOU | 409 | O | TYR | A | 24 | 7572 | 8722 | 6459 | -1321 | 553 | 1249 | | O |
| ATOM | 411 | N | GLY | A | 25 | -6.452 | 21.739 | 98.435 | 1.00 | 58.14 | | | N |
| ANISOU | 411 | N | GLY | A | 25 | 7555 | 8349 | 6187 | -1224 | 493 | 1329 | | N |
| ATOM | 412 | CA | GLY | A | 25 | -6.660 | 20.356 | 98.823 | 1.00 | 59.62 | | | C |
| ANISOU | 412 | CA | GLY | A | 25 | 7845 | 8432 | 6377 | -1396 | 453 | 1455 | | C |

FIG. 18 (continued)

| | | | | | | | | | | | | | | |
|---|---|---|---|---|---|---|---|---|---|---|---|---|---|---|
| ATOM | 415 | C | GLY | A | 25 | -6.280 | 19.359 | 97.758 | 1.00 | 60.24 | | | | C |
| ANISOU | 415 | C | GLY | A | 25 | 8002 | 8288 | 6599 | -1412 | 370 | 1437 | | | C |
| ATOM | 416 | O | GLY | A | 25 | -7.006 | 18.387 | 97.531 | 1.00 | 61.72 | | | | O |
| ANISOU | 416 | O | GLY | A | 25 | 8213 | 8425 | 6812 | -1580 | 366 | 1482 | | | O |
| ATOM | 418 | N | GLU | A | 26 | -5.140 | 19.603 | 97.101 | 1.00 | 58.49 | | | | N |
| ANISOU | 418 | N | GLU | A | 26 | 7819 | 7934 | 6469 | -1247 | 314 | 1360 | | | N |
| ATOM | 419 | CA | GLU | A | 26 | -4.573 | 18.654 | 96.153 | 1.00 | 57.03 | | | | C |
| ANISOU | 419 | CA | GLU | A | 26 | 7724 | 7520 | 6423 | -1238 | 248 | 1322 | | | C |
| ATOM | 421 | CB | GLU | A | 26 | -4.273 | 19.345 | 94.815 | 1.00 | 56.28 | | | | C |
| ANISOU | 421 | CB | GLU | A | 26 | 7559 | 7441 | 6386 | -1118 | 257 | 1163 | | | C |
| ATOM | 424 | CG | GLU | A | 26 | -5.398 | 20.266 | 94.273 | 1.00 | 56.09 | | | | C |
| ANISOU | 424 | CG | GLU | A | 26 | 7379 | 7640 | 6293 | -1148 | 319 | 1096 | | | C |
| ATOM | 427 | CD | GLU | A | 26 | -6.391 | 19.557 | 93.373 | 1.00 | 57.17 | | | | C |
| ANISOU | 427 | CD | GLU | A | 26 | 7489 | 7782 | 6452 | -1307 | 316 | 1063 | | | C |
| ATOM | 428 | OE1 | GLU | A | 26 | -6.124 | 18.402 | 92.969 | 1.00 | 57.88 | | | | O |
| ANISOU | 428 | OE1 | GLU | A | 26 | 7696 | 7680 | 6618 | -1385 | 274 | 1055 | | | O |
| ATOM | 429 | OE2 | GLU | A | 26 | -7.434 | 20.174 | 93.052 | 1.00 | 57.39 | | | | O |
| ANISOU | 429 | OE2 | GLU | A | 26 | 7374 | 8006 | 6427 | -1351 | 353 | 1041 | | | O |
| ATOM | 430 | C | GLU | A | 26 | -3.294 | 18.067 | 96.757 | 1.00 | 55.47 | | | | C |
| ANISOU | 430 | C | GLU | A | 26 | 7655 | 7128 | 6292 | -1156 | 167 | 1406 | | | C |
| ATOM | 431 | O | GLU | A | 26 | -2.421 | 18.804 | 97.216 | 1.00 | 54.68 | | | | O |
| ANISOU | 431 | O | GLU | A | 26 | 7542 | 7068 | 6166 | -1020 | 148 | 1407 | | | O |
| ATOM | 433 | N | ASP | A | 27 | -3.181 | 16.744 | 96.754 | 1.00 | 56.04 | | | | N |
| ANISOU | 433 | N | ASP | A | 27 | 7850 | 6985 | 6458 | -1238 | 114 | 1479 | | | N |
| ATOM | 434 | CA | ASP | A | 27 | -1.972 | 16.071 | 97.227 | 1.00 | 57.03 | | | | C |
| ANISOU | 434 | CA | ASP | A | 27 | 8090 | 6896 | 6683 | -1143 | 23 | 1570 | | | C |
| ATOM | 436 | CB | ASP | A | 27 | -2.331 | 14.714 | 97.844 | 1.00 | 60.81 | | | | C |
| ANISOU | 436 | CB | ASP | A | 27 | 8706 | 7201 | 7198 | -1302 | -27 | 1735 | | | C |
| ATOM | 439 | CG | ASP | A | 27 | -1.117 | 13.949 | 98.349 | 1.00 | 63.20 | | | | C |
| ANISOU | 439 | CG | ASP | A | 27 | 9124 | 7263 | 7627 | -1194 | -138 | 1857 | | | C |
| ATOM | 440 | OD1 | ASP | A | 27 | -0.059 | 14.571 | 98.576 | 1.00 | 63.01 | | | | O |
| ANISOU | 440 | OD1 | ASP | A | 27 | 9056 | 7272 | 7615 | -1018 | -179 | 1849 | | | O |
| ATOM | 441 | OD2 | ASP | A | 27 | -1.231 | 12.712 | 98.526 | 1.00 | 67.60 | | | | O |
| ANISOU | 441 | OD2 | ASP | A | 27 | 9814 | 7594 | 8279 | -1289 | -189 | 1968 | | | O |
| ATOM | 442 | C | ASP | A | 27 | -0.954 | 15.894 | 96.083 | 1.00 | 54.84 | | | | C |
| ANISOU | 442 | C | ASP | A | 27 | 7824 | 6441 | 6572 | -982 | 0 | 1431 | | | C |
| ATOM | 443 | O | ASP | A | 27 | -1.196 | 15.121 | 95.144 | 1.00 | 53.52 | | | | O |
| ANISOU | 443 | O | ASP | A | 27 | 7707 | 6124 | 6505 | -1035 | 13 | 1345 | | | O |
| ATOM | 445 | N | LEU | A | 28 | 0.187 | 16.584 | 96.190 | 1.00 | 52.54 | | | | N |
| ANISOU | 445 | N | LEU | A | 28 | 7487 | 6172 | 6303 | -801 | -29 | 1405 | | | N |
| ATOM | 446 | CA | LEU | A | 28 | 1.171 | 16.640 | 95.104 | 1.00 | 51.53 | | | | C |
| ANISOU | 446 | CA | LEU | A | 28 | 7335 | 5935 | 6310 | -644 | -25 | 1257 | | | C |
| ATOM | 448 | CB | LEU | A | 28 | 2.194 | 17.790 | 95.311 | 1.00 | 51.51 | | | | C |
| ANISOU | 448 | CB | LEU | A | 28 | 7240 | 6056 | 6276 | -482 | -38 | 1228 | | | C |
| ATOM | 451 | CG | LEU | A | 28 | 3.419 | 17.618 | 96.227 | 1.00 | 52.17 | | | | C |
| ANISOU | 451 | CG | LEU | A | 28 | 7339 | 6064 | 6418 | -366 | -136 | 1350 | | | C |
| ATOM | 453 | CD1 | LEU | A | 28 | 4.457 | 16.720 | 95.582 | 1.00 | 54.19 | | | | C |
| ANISOU | 453 | CD1 | LEU | A | 28 | 7622 | 6080 | 6889 | -234 | -170 | 1305 | | | C |
| ATOM | 457 | CD2 | LEU | A | 28 | 4.050 | 18.952 | 96.586 | 1.00 | 50.01 | | | | C |
| ANISOU | 457 | CD2 | LEU | A | 28 | 6968 | 5982 | 6052 | -280 | -140 | 1324 | | | C |
| ATOM | 461 | C | LEU | A | 28 | 1.859 | 15.299 | 94.898 | 1.00 | 52.19 | | | | C |
| ANISOU | 461 | C | LEU | A | 28 | 7527 | 5716 | 6585 | -595 | -79 | 1281 | | | C |
| ATOM | 462 | O | LEU | A | 28 | 2.400 | 15.051 | 93.825 | 1.00 | 49.56 | | | | O |
| ANISOU | 462 | O | LEU | A | 28 | 7192 | 5266 | 6374 | -507 | -48 | 1131 | | | O |
| ATOM | 464 | N | LYS | A | 29 | 1.805 | 14.418 | 95.903 | 1.00 | 54.37 | | | | N |
| ANISOU | 464 | N | LYS | A | 29 | 7905 | 5864 | 6891 | -658 | -154 | 1468 | | | N |
| ATOM | 465 | CA | LYS | A | 29 | 2.234 | 13.028 | 95.714 | 1.00 | 56.67 | | | | C |
| ANISOU | 465 | CA | LYS | A | 29 | 8321 | 5829 | 7383 | -632 | -204 | 1504 | | | C |
| ATOM | 467 | CB | LYS | A | 29 | 2.332 | 12.281 | 97.053 | 1.00 | 60.77 | | | | C |
| ANISOU | 467 | CB | LYS | A | 29 | 8942 | 6236 | 7913 | -681 | -313 | 1765 | | | C |
| ATOM | 470 | CG | LYS | A | 29 | 3.331 | 12.882 | 98.074 | 1.00 | 61.40 | | | | C |
| ANISOU | 470 | CG | LYS | A | 29 | 8961 | 6420 | 7947 | -548 | -405 | 1902 | | | C |
| ATOM | 473 | CD | LYS | A | 29 | 4.776 | 12.965 | 97.533 | 1.00 | 61.64 | | | | C |
| ANISOU | 473 | CD | LYS | A | 29 | 8918 | 6343 | 8159 | -299 | -438 | 1812 | | | C |
| ATOM | 476 | CE | LYS | A | 29 | 5.749 | 13.516 | 98.602 | 1.00 | 61.76 | | | | C |
| ANISOU | 476 | CE | LYS | A | 29 | 8866 | 6476 | 8125 | -193 | -550 | 1965 | | | C |
| ATOM | 479 | NZ | LYS | A | 29 | 7.214 | 13.367 | 98.263 | 1.00 | 62.01 | | | | N |
| ANISOU | 479 | NZ | LYS | A | 29 | 8817 | 6380 | 8363 | 45 | -608 | 1930 | | | N |
| ATOM | 483 | C | LYS | A | 29 | 1.298 | 12.264 | 94.757 | 1.00 | 56.76 | | | | C |
| ANISOU | 483 | C | LYS | A | 29 | 8408 | 5720 | 7438 | -784 | -139 | 1386 | | | C |
| ATOM | 484 | O | LYS | A | 29 | 1.749 | 11.380 | 94.015 | 1.00 | 58.33 | | | | O |
| ANISOU | 484 | O | LYS | A | 29 | 8685 | 5660 | 7816 | -726 | -134 | 1289 | | | O |
| ATOM | 486 | N | ILE | A | 30 | 0.010 | 12.602 | 94.772 | 1.00 | 55.11 | | | | N |
| ANISOU | 486 | N | ILE | A | 30 | 8170 | 5700 | 7068 | -977 | -89 | 1385 | | | N |
| ATOM | 487 | CA | ILE | A | 30 | -0.979 | 11.965 | 93.888 | 1.00 | 55.91 | | | | C |
| ANISOU | 487 | CA | ILE | A | 30 | 8324 | 5736 | 7182 | -1155 | -39 | 1278 | | | C |
| ATOM | 489 | CB | ILE | A | 30 | -2.405 | 11.956 | 94.530 | 1.00 | 57.14 | | | | C |
| ANISOU | 489 | CB | ILE | A | 30 | 8468 | 6060 | 7182 | -1401 | -23 | 1397 | | | C |
| ATOM | 491 | CG1 | ILE | A | 30 | -2.431 | 11.085 | 95.795 | 1.00 | 60.05 | | | | C |

FIG. 18 (continued)

| | | | | | | | | | | | | | | |
|---|---|---|---|---|---|---|---|---|---|---|---|---|---|---|
| ANISOU | 491 | CG1 | ILE | A | 30 | 8960 | 6285 | 7570 | -1491 | -93 | 1636 | | | C |
| ATOM | 494 | CD1 | ILE | A | 30 | -3.644 | 11.334 | 96.706 | 1.00 | 60.30 | | | | C |
| ANISOU | 494 | CD1 | ILE | A | 30 | 8948 | 6551 | 7412 | -1706 | -64 | 1777 | | | C |
| ATOM | 498 | CG2 | ILE | A | 30 | -3.452 | 11.454 | 93.541 | 1.00 | 57.27 | | | | C |
| ANISOU | 498 | CG2 | ILE | A | 30 | 8504 | 6060 | 7195 | -1597 | 23 | 1275 | | | C |
| ATOM | 502 | C | ILE | A | 30 | -1.020 | 12.725 | 92.559 | 1.00 | 52.50 | | | | C |
| ANISOU | 502 | C | ILE | A | 30 | 7791 | 5441 | 6715 | -1107 | 35 | 1049 | | | C |
| ATOM | 503 | O | ILE | A | 30 | -0.714 | 12.178 | 91.495 | 1.00 | 52.50 | | | | O |
| ANISOU | 503 | O | ILE | A | 30 | 7846 | 5279 | 6821 | -1084 | 63 | 887 | | | O |
| ATOM | 505 | N | GLU | A | 31 | -1.356 | 14.005 | 92.638 | 1.00 | 49.19 | | | | N |
| ANISOU | 505 | N | GLU | A | 31 | 7230 | 5315 | 6143 | -1087 | 68 | 1037 | | | N |
| ATOM | 506 | CA | GLU | A | 31 | -1.551 | 14.817 | 91.451 | 1.00 | 46.29 | | | | C |
| ANISOU | 506 | CA | GLU | A | 31 | 6765 | 5107 | 5717 | -1065 | 125 | 860 | | | C |
| ATOM | 508 | CB | GLU | A | 31 | -2.580 | 15.937 | 91.723 | 1.00 | 47.00 | | | | C |
| ANISOU | 508 | CB | GLU | A | 31 | 6718 | 5504 | 5635 | -1138 | 154 | 900 | | | C |
| ATOM | 511 | CG | GLU | A | 31 | -3.867 | 15.553 | 92.458 | 1.00 | 50.43 | | | | C |
| ANISOU | 511 | CG | GLU | A | 31 | 7151 | 6021 | 5991 | -1342 | 156 | 1024 | | | C |
| ATOM | 514 | CD | GLU | A | 31 | -4.996 | 15.056 | 91.550 | 1.00 | 54.58 | | | | C |
| ANISOU | 514 | CD | GLU | A | 31 | 7666 | 6578 | 6495 | -1541 | 173 | 946 | | | C |
| ATOM | 515 | OE1 | GLU | A | 31 | -5.591 | 14.009 | 91.877 | 1.00 | 58.90 | | | | O |
| ANISOU | 515 | OE1 | GLU | A | 31 | 8299 | 7011 | 7067 | -1720 | 157 | 1018 | | | O |
| ATOM | 516 | OE2 | GLU | A | 31 | -5.314 | 15.713 | 90.526 | 1.00 | 56.75 | | | | O |
| ANISOU | 516 | OE2 | GLU | A | 31 | 7845 | 6996 | 6719 | -1534 | 195 | 825 | | | O |
| ATOM | 517 | C | GLU | A | 31 | -0.201 | 15.423 | 91.018 | 1.00 | 42.27 | | | | C |
| ANISOU | 517 | C | GLU | A | 31 | 6212 | 4579 | 5270 | -842 | 134 | 766 | | | C |
| ATOM | 518 | O | GLU | A | 31 | -0.042 | 16.653 | 90.984 | 1.00 | 37.78 | | | | O |
| ANISOU | 518 | O | GLU | A | 31 | 5530 | 4214 | 4610 | -761 | 154 | 746 | | | O |
| ATOM | 520 | N | THR | A | 32 | 0.776 | 14.582 | 90.687 | 1.00 | 40.10 | | | | N |
| ANISOU | 520 | N | THR | A | 32 | 6020 | 4058 | 5157 | -742 | 125 | 707 | | | N |
| ATOM | 521 | CA | THR | A | 32 | 2.094 | 15.118 | 90.374 | 1.00 | 40.90 | | | | C |
| ANISOU | 521 | CA | THR | A | 32 | 6058 | 4157 | 5325 | -534 | 138 | 631 | | | C |
| ATOM | 523 | CB | THR | A | 32 | 3.208 | 14.074 | 90.532 | 1.00 | 44.16 | | | | C |
| ANISOU | 523 | CB | THR | A | 32 | 6549 | 4283 | 5948 | -398 | 107 | 638 | | | C |
| ATOM | 525 | OG1 | THR | A | 32 | 3.063 | 13.429 | 91.789 | 1.00 | 46.29 | | | | O |
| ANISOU | 525 | OG1 | THR | A | 32 | 6893 | 4438 | 6256 | -433 | 21 | 848 | | | O |
| ATOM | 527 | CG2 | THR | A | 32 | 4.559 | 14.761 | 90.531 | 1.00 | 45.28 | | | | C |
| ANISOU | 527 | CG2 | THR | A | 32 | 6585 | 4474 | 6145 | -187 | 107 | 609 | | | C |
| ATOM | 531 | C | THR | A | 32 | 2.173 | 15.838 | 89.010 | 1.00 | 37.44 | | | | C |
| ANISOU | 531 | C | THR | A | 32 | 5549 | 3851 | 4826 | -517 | 214 | 435 | | | C |
| ATOM | 532 | O | THR | A | 32 | 2.959 | 16.768 | 88.855 | 1.00 | 35.16 | | | | O |
| ANISOU | 532 | O | THR | A | 32 | 5166 | 3676 | 4515 | -389 | 231 | 400 | | | O |
| ATOM | 534 | N | ASN | A | 33 | 1.349 | 15.437 | 88.050 | 1.00 | 36.73 | | | | N |
| ANISOU | 534 | N | ASN | A | 33 | 5503 | 3759 | 4695 | -663 | 252 | 319 | | | N |
| ATOM | 535 | CA | ASN | A | 33 | 1.246 | 16.169 | 86.786 | 1.00 | 35.92 | | | | C |
| ANISOU | 535 | CA | ASN | A | 33 | 5336 | 3819 | 4492 | -684 | 309 | 162 | | | C |
| ATOM | 537 | CB | ASN | A | 33 | 0.452 | 15.366 | 85.759 | 1.00 | 37.30 | | | | C |
| ANISOU | 537 | CB | ASN | A | 33 | 5593 | 3936 | 4641 | -862 | 336 | 29 | | | C |
| ATOM | 540 | CG | ASN | A | 33 | 1.250 | 14.204 | 85.166 | 1.00 | 40.42 | | | | C |
| ANISOU | 540 | CG | ASN | A | 33 | 6110 | 4057 | 5191 | -815 | 383 | -126 | | | C |
| ATOM | 541 | OD1 | ASN | A | 33 | 2.451 | 14.299 | 84.935 | 1.00 | 40.77 | | | | O |
| ANISOU | 541 | OD1 | ASN | A | 33 | 6131 | 4034 | 5326 | -640 | 427 | -203 | | | O |
| ATOM | 542 | ND2 | ASN | A | 33 | 0.562 | 13.105 | 84.884 | 1.00 | 42.22 | | | | N |
| ANISOU | 542 | ND2 | ASN | A | 33 | 6462 | 4127 | 5454 | -979 | 381 | -183 | | | N |
| ATOM | 545 | C | ASN | A | 33 | 0.655 | 17.581 | 86.961 | 1.00 | 32.68 | | | | C |
| ANISOU | 545 | C | ASN | A | 33 | 4799 | 3695 | 3923 | -700 | 298 | 236 | | | C |
| ATOM | 546 | O | ASN | A | 33 | 1.146 | 18.544 | 86.370 | 1.00 | 30.17 | | | | O |
| ANISOU | 546 | O | ASN | A | 33 | 4405 | 3506 | 3551 | -620 | 327 | 173 | | | O |
| ATOM | 548 | N | LYS | A | 34 | -0.380 | 17.698 | 87.787 | 1.00 | 33.13 | | | | N |
| ANISOU | 548 | N | LYS | A | 34 | 4834 | 3841 | 3913 | -800 | 262 | 370 | | | N |
| ATOM | 549 | CA | LYS | A | 34 | -0.987 | 18.992 | 88.106 | 1.00 | 32.07 | | | | C |
| ANISOU | 549 | CA | LYS | A | 34 | 4578 | 3951 | 3655 | -796 | 259 | 442 | | | C |
| ATOM | 551 | CB | LYS | A | 34 | -2.261 | 18.796 | 88.953 | 1.00 | 32.73 | | | | C |
| ANISOU | 551 | CB | LYS | A | 34 | 4643 | 4113 | 3680 | -935 | 240 | 566 | | | C |
| ATOM | 554 | CG | LYS | A | 34 | -3.130 | 20.026 | 89.096 | 1.00 | 32.91 | | | | C |
| ANISOU | 554 | CG | LYS | A | 34 | 4529 | 4386 | 3588 | -944 | 253 | 612 | | | C |
| ATOM | 557 | CD | LYS | A | 34 | -4.372 | 19.746 | 89.990 | 1.00 | 33.73 | | | | C |
| ANISOU | 557 | CD | LYS | A | 34 | 4597 | 4576 | 3641 | -1083 | 254 | 726 | | | C |
| ATOM | 560 | CE | LYS | A | 34 | -5.480 | 18.934 | 89.267 | 1.00 | 36.01 | | | | C |
| ANISOU | 560 | CE | LYS | A | 34 | 4886 | 4881 | 3914 | -1285 | 242 | 694 | | | C |
| ATOM | 563 | NZ | LYS | A | 34 | -6.680 | 18.663 | 90.150 | 1.00 | 36.38 | | | | N |
| ANISOU | 563 | NZ | LYS | A | 34 | 4878 | 5033 | 3913 | -1434 | 253 | 809 | | | N |
| ATOM | 567 | C | LYS | A | 34 | 0.022 | 19.945 | 88.814 | 1.00 | 30.19 | | | | C |
| ANISOU | 567 | C | LYS | A | 34 | 4288 | 3757 | 3425 | -622 | 256 | 495 | | | C |
| ATOM | 568 | O | LYS | A | 34 | 0.016 | 21.141 | 88.579 | 1.00 | 28.05 | | | | O |
| ANISOU | 568 | O | LYS | A | 34 | 3932 | 3646 | 3081 | -571 | 271 | 482 | | | O |
| ATOM | 570 | N | PHE | A | 35 | 0.860 | 19.404 | 89.690 | 1.00 | 30.61 | | | | N |
| ANISOU | 570 | N | PHE | A | 35 | 4396 | 3665 | 3569 | -543 | 226 | 562 | | | N |
| ATOM | 571 | CA | PHE | A | 35 | 1.952 | 20.158 | 90.295 | 1.00 | 30.02 | | | | C |
| ANISOU | 571 | CA | PHE | A | 35 | 4275 | 3620 | 3510 | -393 | 209 | 600 | | | C |

FIG. 18 (continued)

| | | | | | | | | | | | | | | |
|---|---|---|---|---|---|---|---|---|---|---|---|---|---|---|
| ATOM | 573 | CB | PHE | A | 35 | | 2.723 | 19.217 | 91.241 | 1.00 | 32.73 | | | C |
| ANISOU | 573 | CB | PHE | A | 35 | 4687 | 3782 | 3965 | -334 | 152 | | 696 | | C |
| ATOM | 576 | CG | PHE | A | 35 | | 3.857 | 19.866 | 92.046 | 1.00 | 31.98 | | | C |
| ANISOU | 576 | CG | PHE | A | 35 | 4542 | 3725 | 3885 | -199 | 109 | | 761 | | C |
| ATOM | 577 | CD1 | PHE | A | 35 | | 3.804 | 21.188 | 92.476 | 1.00 | 31.05 | | | C |
| ANISOU | 577 | CD1 | PHE | A | 35 | 4350 | 3797 | 3649 | -184 | 116 | | 781 | | C |
| ATOM | 579 | CE1 | PHE | A | 35 | | 4.854 | 21.747 | 93.212 | 1.00 | 31.16 | | | C |
| ANISOU | 579 | CE1 | PHE | A | 35 | 4326 | 3846 | 3669 | -86 | 69 | | 832 | | C |
| ATOM | 581 | CZ | PHE | A | 35 | | 5.974 | 20.982 | 93.538 | 1.00 | 31.16 | | | C |
| ANISOU | 581 | CZ | PHE | A | 35 | 4337 | 3705 | 3797 | 9 | 5 | | 880 | | C |
| ATOM | 583 | CE2 | PHE | A | 35 | | 6.040 | 19.668 | 93.130 | 1.00 | 33.92 | | | C |
| ANISOU | 583 | CE2 | PHE | A | 35 | 4751 | 3854 | 4283 | 20 | -1 | | 869 | | C |
| ATOM | 585 | CD2 | PHE | A | 35 | | 4.976 | 19.112 | 92.385 | 1.00 | 33.99 | | | C |
| ANISOU | 585 | CD2 | PHE | A | 35 | 4822 | 3813 | 4281 | -91 | 56 | | 802 | | C |
| ATOM | 587 | C | PHE | A | 35 | | 2.861 | 20.812 | 89.220 | 1.00 | 28.76 | | | C |
| ANISOU | 587 | C | PHE | A | 35 | 4062 | 3498 | 3369 | -295 | 250 | | 468 | | C |
| ATOM | 588 | O | PHE | A | 35 | | 3.106 | 22.015 | 89.251 | 1.00 | 27.23 | | | O |
| ANISOU | 588 | O | PHE | A | 35 | 3794 | 3444 | 3109 | -242 | 259 | | 470 | | O |
| ATOM | 590 | N | ALA | A | 36 | | 3.266 | 20.030 | 88.220 | 1.00 | 29.13 | | | N |
| ANISOU | 590 | N | ALA | A | 36 | 4152 | 3423 | 3495 | -289 | 284 | | 346 | | N |
| ATOM | 591 | CA | ALA | A | 36 | | 4.033 | 20.555 | 87.092 | 1.00 | 28.71 | | | C |
| ANISOU | 591 | CA | ALA | A | 36 | 4051 | 3422 | 3437 | -227 | 341 | | 210 | | C |
| ATOM | 593 | CB | ALA | A | 36 | | 4.535 | 19.393 | 86.164 | 1.00 | 27.40 | | | C |
| ANISOU | 593 | CB | ALA | A | 36 | 3952 | 3081 | 3378 | -218 | 393 | | 60 | | C |
| ATOM | 597 | C | ALA | A | 36 | | 3.246 | 21.604 | 86.303 | 1.00 | 26.67 | | | C |
| ANISOU | 597 | C | ALA | A | 36 | 3740 | 3363 | 3030 | -309 | 364 | | 179 | | C |
| ATOM | 598 | O | ALA | A | 36 | | 3.804 | 22.616 | 85.883 | 1.00 | 26.96 | | | O |
| ANISOU | 598 | O | ALA | A | 36 | 3714 | 3507 | 3023 | -253 | 387 | | 150 | | O |
| ATOM | 600 | N | ALA | A | 37 | | 1.949 | 21.366 | 86.104 | 1.00 | 26.67 | | | N |
| ANISOU | 600 | N | ALA | A | 37 | 3761 | 3414 | 2959 | -445 | 350 | | 196 | | N |
| ATOM | 601 | CA | ALA | A | 37 | | 1.102 | 22.313 | 85.378 | 1.00 | 26.47 | | | C |
| ANISOU | 601 | CA | ALA | A | 37 | 3673 | 3579 | 2805 | -517 | 351 | | 191 | | C |
| ATOM | 603 | CB | ALA | A | 37 | | -0.284 | 21.666 | 85.021 | 1.00 | 26.28 | | | C |
| ANISOU | 603 | CB | ALA | A | 37 | 3669 | 3588 | 2727 | -687 | 328 | | 192 | | C |
| ATOM | 607 | C | ALA | A | 37 | | 0.913 | 23.646 | 86.133 | 1.00 | 24.12 | | | C |
| ANISOU | 607 | C | ALA | A | 37 | 3293 | 3415 | 2457 | -452 | 331 | | 300 | | C |
| ATOM | 608 | O | ALA | A | 37 | | 0.871 | 24.698 | 85.520 | 1.00 | 24.65 | | | O |
| ANISOU | 608 | O | ALA | A | 37 | 3305 | 3604 | 2457 | -436 | 338 | | 292 | | O |
| ATOM | 610 | N | ILE | A | 38 | | 0.801 | 23.598 | 87.460 | 1.00 | 24.50 | | | N |
| ANISOU | 610 | N | ILE | A | 38 | 3342 | 3435 | 2532 | -421 | 309 | | 400 | | N |
| ATOM | 611 | CA | ILE | A | 38 | | 0.678 | 24.832 | 88.245 | 1.00 | 24.59 | | | C |
| ANISOU | 611 | CA | ILE | A | 38 | 3290 | 3557 | 2496 | -360 | 304 | | 476 | | C |
| ATOM | 613 | CB | ILE | A | 38 | | 0.338 | 24.545 | 89.746 | 1.00 | 25.30 | | | C |
| ANISOU | 613 | CB | ILE | A | 38 | 3398 | 3630 | 2586 | -370 | 287 | | 579 | | C |
| ATOM | 615 | CG1 | ILE | A | 38 | | -1.039 | 23.903 | 89.862 | 1.00 | 26.63 | | | C |
| ANISOU | 615 | CG1 | ILE | A | 38 | 3560 | 3836 | 2721 | -499 | 289 | | 621 | | C |
| ATOM | 618 | CD1 | ILE | A | 38 | | -1.263 | 23.155 | 91.222 | 1.00 | 26.37 | | | C |
| ANISOU | 618 | CD1 | ILE | A | 38 | 3577 | 3750 | 2691 | -548 | 275 | | 723 | | C |
| ATOM | 622 | CG2 | ILE | A | 38 | | 0.386 | 25.839 | 90.570 | 1.00 | 25.16 | | | C |
| ANISOU | 622 | CG2 | ILE | A | 38 | 3330 | 3714 | 2516 | -301 | 297 | | 623 | | C |
| ATOM | 626 | C | ILE | A | 38 | | 1.958 | 25.644 | 88.180 | 1.00 | 22.71 | | | C |
| ANISOU | 626 | C | ILE | A | 38 | 3036 | 3315 | 2279 | -248 | 313 | | 446 | | C |
| ATOM | 627 | O | ILE | A | 38 | | 1.906 | 26.842 | 87.993 | 1.00 | 24.59 | | | O |
| ANISOU | 627 | O | ILE | A | 38 | 3226 | 3649 | 2469 | -217 | 322 | | 453 | | O |
| ATOM | 629 | N | CYS | A | 39 | | 3.093 | 24.971 | 88.338 | 1.00 | 23.42 | | | N |
| ANISOU | 629 | N | CYS | A | 39 | 3160 | 3286 | 2452 | -191 | 308 | | 418 | | N |
| ATOM | 630 | CA | CYS | A | 39 | | 4.409 | 25.599 | 88.109 | 1.00 | 23.82 | | | C |
| ANISOU | 630 | CA | CYS | A | 39 | 3176 | 3341 | 2535 | -99 | 320 | | 376 | | C |
| ATOM | 632 | CB | CYS | A | 39 | | 5.570 | 24.609 | 88.281 | 1.00 | 23.03 | | | C |
| ANISOU | 632 | CB | CYS | A | 39 | 3093 | 3104 | 2555 | -28 | 312 | | 348 | | C |
| ATOM | 635 | SG | CYS | A | 39 | | 5.779 | 24.064 | 90.011 | 1.00 | 24.90 | | | S |
| ANISOU | 635 | SG | CYS | A | 39 | 3357 | 3262 | 2840 | 9 | 233 | | 485 | | S |
| ATOM | 637 | C | CYS | A | 39 | | 4.513 | 26.272 | 86.771 | 1.00 | 21.59 | | | C |
| ANISOU | 637 | C | CYS | A | 39 | 2864 | 3138 | 2202 | -119 | 363 | | 296 | | C |
| ATOM | 638 | O | CYS | A | 39 | | 4.981 | 27.414 | 86.691 | 1.00 | 20.99 | | | O |
| ANISOU | 638 | O | CYS | A | 39 | 2747 | 3134 | 2093 | -85 | 370 | | 305 | | O |
| ATOM | 640 | N | THR | A | 40 | | 4.083 | 25.581 | 85.720 | 1.00 | 24.21 | | | N |
| ANISOU | 640 | N | THR | A | 40 | 3225 | 3456 | 2516 | -189 | 389 | | 221 | | N |
| ATOM | 641 | CA | THR | A | 40 | | 4.177 | 26.130 | 84.384 | 1.00 | 24.15 | | | C |
| ANISOU | 641 | CA | THR | A | 40 | 3201 | 3540 | 2436 | -230 | 426 | | 149 | | C |
| ATOM | 643 | CB | THR | A | 40 | | 3.782 | 25.078 | 83.318 | 1.00 | 26.04 | | | C |
| ANISOU | 643 | CB | THR | A | 40 | 3493 | 3749 | 2653 | -324 | 455 | | 43 | | C |
| ATOM | 645 | OG1 | THR | A | 40 | | 4.591 | 23.911 | 83.435 | 1.00 | 27.23 | | | O |
| ANISOU | 645 | OG1 | THR | A | 40 | 3686 | 3744 | 2918 | -276 | 490 | | -40 | | O |
| ATOM | 647 | CG2 | THR | A | 40 | | 3.905 | 25.623 | 81.912 | 1.00 | 26.28 | | | C |
| ANISOU | 647 | CG2 | THR | A | 40 | 3514 | 3895 | 2575 | -387 | 492 | | -29 | | C |
| ATOM | 651 | C | THR | A | 40 | | 3.294 | 27.384 | 84.249 | 1.00 | 24.25 | | | C |
| ANISOU | 651 | C | THR | A | 40 | 3173 | 3686 | 2352 | -262 | 397 | | 229 | | C |
| ATOM | 652 | O | THR | A | 40 | | 3.698 | 28.418 | 83.683 | 1.00 | 22.06 | | | O |

FIG. 18 (continued)

| | | | | | | | | | | | | | |
|---|---|---|---|---|---|---|---|---|---|---|---|---|---|
| ANISOU | 652 | O | THR | A | 40 | 2869 | 3483 | 2028 | -250 | 409 | 233 | | O |
| ATOM | 654 | N | HIS | A | 41 | 2.054 | 27.272 | 84.728 | 1.00 | 24.75 | | | N |
| ANISOU | 654 | N | HIS | A | 41 | 3230 | 3780 | 2395 | -305 | 361 | 296 | | N |
| ATOM | 655 | CA | HIS | A | 41 | 1.110 | 28.358 | 84.580 | 1.00 | 22.71 | | | C |
| ANISOU | 655 | CA | HIS | A | 41 | 2918 | 3640 | 2072 | -318 | 334 | 371 | | C |
| ATOM | 657 | CB | HIS | A | 41 | -0.263 | 27.955 | 85.102 | 1.00 | 24.08 | | | C |
| ANISOU | 657 | CB | HIS | A | 41 | 3063 | 3851 | 2237 | -372 | 308 | 428 | | C |
| ATOM | 660 | CG | HIS | A | 41 | -1.261 | 29.062 | 85.040 | 1.00 | 24.23 | | | C |
| ANISOU | 660 | CG | HIS | A | 41 | 3002 | 3988 | 2219 | -357 | 283 | 507 | | C |
| ATOM | 661 | ND1 | HIS | A | 41 | -1.632 | 29.795 | 86.150 | 1.00 | 23.09 | | | N |
| ANISOU | 661 | ND1 | HIS | A | 41 | 2815 | 3857 | 2101 | -282 | 295 | 568 | | N |
| ATOM | 663 | CE1 | HIS | A | 41 | -2.472 | 30.743 | 85.778 | 1.00 | 23.45 | | | C |
| ANISOU | 663 | CE1 | HIS | A | 41 | 2785 | 3995 | 2129 | -259 | 275 | 624 | | C |
| ATOM | 665 | NE2 | HIS | A | 41 | -2.683 | 30.623 | 84.481 | 1.00 | 25.84 | | | N |
| ANISOU | 665 | NE2 | HIS | A | 41 | 3078 | 4357 | 2382 | -329 | 235 | 620 | | N |
| ATOM | 667 | CD2 | HIS | A | 41 | -1.915 | 29.603 | 83.990 | 1.00 | 23.45 | | | C |
| ANISOU | 667 | CD2 | HIS | A | 41 | 2854 | 3994 | 2062 | -397 | 247 | 536 | | C |
| ATOM | 669 | C | HIS | A | 41 | 1.627 | 29.625 | 85.279 | 1.00 | 22.14 | | | C |
| ANISOU | 669 | C | HIS | A | 41 | 2821 | 3574 | 2016 | -222 | 338 | 422 | | C |
| ATOM | 670 | O | HIS | A | 41 | 1.649 | 30.696 | 84.699 | 1.00 | 21.61 | | | O |
| ANISOU | 670 | O | HIS | A | 41 | 2732 | 3564 | 1913 | -210 | 332 | 447 | | O |
| ATOM | 672 | N | LEU | A | 42 | 2.092 | 29.466 | 86.508 | 1.00 | 23.49 | | | N |
| ANISOU | 672 | N | LEU | A | 42 | 3006 | 3679 | 2239 | -167 | 341 | 437 | | N |
| ATOM | 673 | CA | LEU | A | 42 | 2.716 | 30.555 | 87.262 | 1.00 | 23.66 | | | C |
| ANISOU | 673 | CA | LEU | A | 42 | 3021 | 3698 | 2272 | -96 | 344 | 464 | | C |
| ATOM | 675 | CB | LEU | A | 42 | 3.180 | 30.029 | 88.639 | 1.00 | 24.26 | | | C |
| ANISOU | 675 | CB | LEU | A | 42 | 3120 | 3712 | 2384 | -65 | 333 | 481 | | C |
| ATOM | 678 | CG | LEU | A | 42 | 2.066 | 29.837 | 89.672 | 1.00 | 24.99 | | | C |
| ANISOU | 678 | CG | LEU | A | 42 | 3213 | 3832 | 2451 | -85 | 331 | 537 | | C |
| ATOM | 680 | CD1 | LEU | A | 42 | 2.546 | 28.992 | 90.907 | 1.00 | 24.15 | | | C |
| ANISOU | 680 | CD1 | LEU | A | 42 | 3148 | 3667 | 2363 | -85 | 308 | 571 | | C |
| ATOM | 684 | CD2 | LEU | A | 42 | 1.447 | 31.179 | 90.141 | 1.00 | 24.98 | | | C |
| ANISOU | 684 | CD2 | LEU | A | 42 | 3181 | 3895 | 2414 | -49 | 353 | 559 | | C |
| ATOM | 688 | C | LEU | A | 42 | 3.871 | 31.210 | 86.537 | 1.00 | 23.89 | | | C |
| ANISOU | 688 | C | LEU | A | 42 | 3048 | 3725 | 2302 | -79 | 358 | 426 | | C |
| ATOM | 689 | O | LEU | A | 42 | 3.889 | 32.453 | 86.402 | 1.00 | 22.28 | | | O |
| ANISOU | 689 | O | LEU | A | 42 | 2836 | 3552 | 2078 | -62 | 358 | 456 | | O |
| ATOM | 691 | N | GLU | A | 43 | 4.818 | 30.379 | 86.044 | 1.00 | 25.62 | | | N |
| ANISOU | 691 | N | GLU | A | 43 | 3275 | 3905 | 2553 | -85 | 377 | 360 | | N |
| ATOM | 692 | CA | GLU | A | 43 | 5.987 | 30.882 | 85.344 | 1.00 | 26.73 | | | C |
| ANISOU | 692 | CA | GLU | A | 43 | 3398 | 4064 | 2695 | -80 | 407 | 316 | | C |
| ATOM | 694 | CB | GLU | A | 43 | 6.968 | 29.755 | 84.980 | 1.00 | 29.59 | | | C |
| ANISOU | 694 | CB | GLU | A | 43 | 3750 | 4376 | 3117 | -64 | 443 | 229 | | C |
| ATOM | 697 | CG | GLU | A | 43 | 8.201 | 30.291 | 84.313 | 1.00 | 32.74 | | | C |
| ANISOU | 697 | CG | GLU | A | 43 | 4106 | 4818 | 3517 | -63 | 490 | 180 | | C |
| ATOM | 700 | CD | GLU | A | 43 | 9.435 | 29.411 | 84.398 | 1.00 | 34.73 | | | C |
| ANISOU | 700 | CD | GLU | A | 43 | 4311 | 5018 | 3869 | -2 | 524 | 105 | | C |
| ATOM | 701 | OE1 | GLU | A | 43 | 10.525 | 29.968 | 84.162 | 1.00 | 39.37 | | | O |
| ANISOU | 701 | OE1 | GLU | A | 43 | 4835 | 5653 | 4469 | 5 | 557 | 81 | | O |
| ATOM | 702 | OE2 | GLU | A | 43 | 9.341 | 28.207 | 84.649 | 1.00 | 38.05 | | | O |
| ANISOU | 702 | OE2 | GLU | A | 43 | 4749 | 5349 | 4361 | 36 | 521 | 73 | | O |
| ATOM | 703 | C | GLU | A | 43 | 5.584 | 31.682 | 84.104 | 1.00 | 25.14 | | | C |
| ANISOU | 703 | C | GLU | A | 43 | 3197 | 3943 | 2410 | -139 | 419 | 327 | | C |
| ATOM | 704 | O | GLU | A | 43 | 6.123 | 32.761 | 83.844 | 1.00 | 23.62 | | | O |
| ANISOU | 704 | O | GLU | A | 43 | 2997 | 3779 | 2198 | -143 | 426 | 351 | | O |
| ATOM | 706 | N | VAL | A | 44 | 4.647 | 31.158 | 83.317 | 1.00 | 26.30 | | | N |
| ANISOU | 706 | N | VAL | A | 44 | 3357 | 4131 | 2505 | -199 | 413 | 318 | | N |
| ATOM | 707 | CA | VAL | A | 44 | 4.189 | 31.881 | 82.087 | 1.00 | 24.47 | | | C |
| ANISOU | 707 | CA | VAL | A | 44 | 3127 | 3995 | 2176 | -268 | 402 | 350 | | C |
| ATOM | 709 | CB | VAL | A | 44 | 3.228 | 30.998 | 81.259 | 1.00 | 25.56 | | | C |
| ANISOU | 709 | CB | VAL | A | 44 | 3277 | 4187 | 2248 | -355 | 386 | 321 | | C |
| ATOM | 711 | CG1 | VAL | A | 44 | 2.518 | 31.809 | 80.181 | 1.00 | 27.31 | | | C |
| ANISOU | 711 | CG1 | VAL | A | 44 | 3490 | 4524 | 2363 | -425 | 341 | 396 | | C |
| ATOM | 715 | CG2 | VAL | A | 44 | 3.995 | 29.789 | 80.657 | 1.00 | 25.16 | | | C |
| ANISOU | 715 | CG2 | VAL | A | 44 | 3260 | 4104 | 2196 | -397 | 449 | 182 | | C |
| ATOM | 719 | C | VAL | A | 44 | 3.573 | 33.257 | 82.469 | 1.00 | 24.35 | | | C |
| ANISOU | 719 | C | VAL | A | 44 | 3095 | 3995 | 2160 | -229 | 358 | 464 | | C |
| ATOM | 720 | O | VAL | A | 44 | 3.861 | 34.275 | 81.871 | 1.00 | 24.34 | | | O |
| ANISOU | 720 | O | VAL | A | 44 | 3102 | 4023 | 2123 | -246 | 353 | 511 | | O |
| ATOM | 722 | N | CYS | A | 45 | 2.756 | 33.291 | 83.516 | 1.00 | 22.47 | | | N |
| ANISOU | 722 | N | CYS | A | 45 | 2840 | 3728 | 1971 | -174 | 334 | 505 | | N |
| ATOM | 723 | CA | CYS | A | 45 | 2.133 | 34.539 | 83.947 | 1.00 | 24.10 | | | C |
| ANISOU | 723 | CA | CYS | A | 45 | 3028 | 3931 | 2197 | -117 | 310 | 589 | | C |
| ATOM | 725 | CB | CYS | A | 45 | 1.122 | 34.312 | 85.078 | 1.00 | 24.08 | | | C |
| ANISOU | 725 | CB | CYS | A | 45 | 2994 | 3920 | 2236 | -67 | 307 | 608 | | C |
| ATOM | 728 | SG | CYS | A | 45 | -0.429 | 33.526 | 84.567 | 1.00 | 25.97 | | | S |
| ANISOU | 728 | SG | CYS | A | 45 | 3169 | 4256 | 2443 | -123 | 271 | 644 | | S |
| ATOM | 730 | C | CYS | A | 45 | 3.166 | 35.577 | 84.402 | 1.00 | 24.89 | | | C |
| ANISOU | 730 | C | CYS | A | 45 | 3160 | 3968 | 2331 | -78 | 329 | 589 | | C |

FIG. 18 (continued)

```
ATOM    731  O   CYS A  45      3.111  36.748  83.970  1.00 26.01          O
ANISOU  731  O   CYS A  45   3314   4101   2469    -71    312    651       O
ATOM    733  N   PHE A  46      4.116  35.127  85.229  1.00 22.58          N
ANISOU  733  N   PHE A  46   2879   3628   2073    -62    353    528       N
ATOM    734  CA  PHE A  46      5.219  35.987  85.681  1.00 23.67          C
ANISOU  734  CA  PHE A  46   3038   3720   2236    -51    364    517       C
ATOM    736  CB  PHE A  46      6.053  35.293  86.766  1.00 25.34          C
ANISOU  736  CB  PHE A  46   3243   3901   2484    -30    368    465       C
ATOM    739  CG  PHE A  46      5.299  35.093  88.070  1.00 24.62          C
ANISOU  739  CG  PHE A  46   3164   3788   2403     12    356    478       C
ATOM    740  CD1 PHE A  46      4.466  36.076  88.571  1.00 26.61          C
ANISOU  740  CD1 PHE A  46   3432   4027   2651     44    361    505       C
ATOM    742  CE1 PHE A  46      3.793  35.891  89.777  1.00 28.54          C
ANISOU  742  CE1 PHE A  46   3683   4273   2888     73    371    502       C
ATOM    744  CZ  PHE A  46      3.941  34.710  90.484  1.00 25.98          C
ANISOU  744  CZ  PHE A  46   3358   3961   2553     56    359    496       C
ATOM    746  CE2 PHE A  46      4.784  33.740  90.002  1.00 26.44          C
ANISOU  746  CE2 PHE A  46   3405   4008   2633     34    338    484       C
ATOM    748  CD2 PHE A  46      5.465  33.945  88.797  1.00 25.62          C
ANISOU  748  CD2 PHE A  46   3286   3906   2544     19    344    463       C
ATOM    750  C   PHE A  46      6.100  36.490  84.554  1.00 25.50          C
ANISOU  750  C   PHE A  46   3274   3979   2436   -112    380    518       C
ATOM    751  O   PHE A  46      6.507  37.660  84.559  1.00 28.56          O
ANISOU  751  O   PHE A  46   3687   4333   2831   -124    377    552       O
ATOM    753  N   MET A  47      6.372  35.638  83.577  1.00 24.45          N
ANISOU  753  N   MET A  47   3124   3903   2263   -161    403    478       N
ATOM    754  CA  MET A  47      7.125  36.034  82.414  1.00 27.52          C
ANISOU  754  CA  MET A  47   3514   4347   2595   -237    434    474       C
ATOM    756  CB  MET A  47      7.456  34.795  81.550  1.00 29.96          C
ANISOU  756  CB  MET A  47   3803   4716   2864   -281    482    383       C
ATOM    759  CG  MET A  47      8.508  33.845  82.087  1.00 29.99          C
ANISOU  759  CG  MET A  47   3764   4686   2945   -237    526    285       C
ATOM    762  SD  MET A  47      8.844  32.417  80.998  1.00 35.52          S
ANISOU  762  SD  MET A  47   4452   5426   3617   -273    603    152       S
ATOM    763  CE  MET A  47      9.609  33.306  79.673  1.00 24.48          C
ANISOU  763  CE  MET A  47   3044   4147   2110   -380    667    148       C
ATOM    767  C   MET A  47      6.336  37.073  81.558  1.00 26.50          C
ANISOU  767  C   MET A  47   3419   4246   2403   -278    397    581       C
ATOM    768  O   MET A  47      6.878  38.113  81.143  1.00 24.05          O
ANISOU  768  O   MET A  47   3134   3932   2073   -325    399    634       O
ATOM    770  N   TYR A  48      5.060  36.795  81.321  1.00 25.62          N
ANISOU  770  N   TYR A  48   3304   4164   2267   -265    354    624       N
ATOM    771  CA  TYR A  48      4.168  37.681  80.553  1.00 27.91          C
ANISOU  771  CA  TYR A  48   3607   4486   2511   -285    295    746       C
ATOM    773  CB  TYR A  48      2.771  37.068  80.540  1.00 27.09          C
ANISOU  773  CB  TYR A  48   3462   4430   2400   -261    247    772       C
ATOM    776  CG  TYR A  48      1.830  37.470  79.414  1.00 27.00          C
ANISOU  776  CG  TYR A  48   3439   4509   2311   -311    172    887       C
ATOM    777  CD1 TYR A  48      1.387  36.525  78.482  1.00 27.73          C
ANISOU  777  CD1 TYR A  48   3518   4721   2296   -410    150    860       C
ATOM    779  CE1 TYR A  48      0.488  36.877  77.493  1.00 27.94          C
ANISOU  779  CE1 TYR A  48   3525   4852   2240   -466     61    977       C
ATOM    781  CZ  TYR A  48      0.029  38.194  77.406  1.00 28.84          C
ANISOU  781  CZ  TYR A  48   3628   4934   2396   -404     -9   1138       C
ATOM    782  OH  TYR A  48     -0.859  38.577  76.412  1.00 32.13          O
ANISOU  782  OH  TYR A  48   4014   5457   2735   -452   -118   1282       O
ATOM    784  CE2 TYR A  48      0.447  39.129  78.314  1.00 28.18          C
ANISOU  784  CE2 TYR A  48   3566   4706   2436   -295     23   1156       C
ATOM    786  CD2 TYR A  48      1.331  38.760  79.320  1.00 27.08          C
ANISOU  786  CD2 TYR A  48   3449   4479   2359   -258    113   1025       C
ATOM    788  C   TYR A  48      4.146  39.121  81.136  1.00 27.96          C
ANISOU  788  C   TYR A  48   3642   4389   2592   -223    272    830       C
ATOM    789  O   TYR A  48      4.295  40.092  80.419  1.00 24.17          O
ANISOU  789  O   TYR A  48   3199   3901   2084   -265    247    922       O
ATOM    791  N   SER A  49      4.009  39.208  82.458  1.00 31.66          N
ANISOU  791  N   SER A  49   4105   4775   3151   -133    285    789       N
ATOM    792  CA  SER A  49      3.940  40.462  83.221  1.00 30.51          C
ANISOU  792  CA  SER A  49   3995   4511   3085    -67    279    826       C
ATOM    794  CB  SER A  49      3.389  40.155  84.639  1.00 30.79          C
ANISOU  794  CB  SER A  49   4010   4507   3183     25    300    763       C
ATOM    797  OG  SER A  49      4.270  39.342  85.400  1.00 32.22          O
ANISOU  797  OG  SER A  49   4189   4697   3356      2    333    667       O
ATOM    799  C   SER A  49      5.282  41.202  83.332  1.00 30.80          C
ANISOU  799  C   SER A  49   4086   4486   3131   -125    305    805       C
ATOM    800  O   SER A  49      5.309  42.391  83.653  1.00 30.72          O
ANISOU  800  O   SER A  49   4129   4365   3176   -104    296    845       O
ATOM    802  N   ASP A  50      6.368  40.483  83.044  1.00 30.09          N
ANISOU  802  N   ASP A  50   3975   4464   2995   -201    340    738       N
ATOM    803  CA  ASP A  50      7.739  40.932  83.181  1.00 31.26          C
```

FIG. 18 (continued)

| | | | | | | | | | | | | | | |
|---|---|---|---|---|---|---|---|---|---|---|---|---|---|---|
| ANISOU | 803 | CA | ASP | A | 50 | 4136 | 4592 | 3149 | -270 | 370 | 703 | | | C |
| ATOM | 805 | CB | ASP | A | 50 | 8.054 | 42.111 | 82.221 | 1.00 | 34.46 | | | | C |
| ANISOU | 805 | CB | ASP | A | 50 | 4596 | 4975 | 3523 | -359 | 361 | 801 | | | C |
| ATOM | 808 | CG | ASP | A | 50 | 9.556 | 42.306 | 82.011 | 1.00 | 34.45 | | | | C |
| ANISOU | 808 | CG | ASP | A | 50 | 4580 | 5010 | 3501 | -472 | 406 | 763 | | | C |
| ATOM | 809 | OD1 | ASP | A | 50 | 10.316 | 41.354 | 82.227 | 1.00 | 35.00 | | | | O |
| ANISOU | 809 | OD1 | ASP | A | 50 | 4576 | 5157 | 3567 | -477 | 445 | 667 | | | O |
| ATOM | 810 | OD2 | ASP | A | 50 | 9.999 | 43.423 | 81.703 | 1.00 | 38.36 | | | | O |
| ANISOU | 810 | OD2 | ASP | A | 50 | 5130 | 5450 | 3996 | -553 | 400 | 831 | | | O |
| ATOM | 811 | C | ASP | A | 50 | 8.034 | 41.309 | 84.629 | 1.00 | 32.60 | | | | C |
| ANISOU | 811 | C | ASP | A | 50 | 4325 | 4673 | 3390 | -223 | 368 | 649 | | | C |
| ATOM | 812 | O | ASP | A | 50 | 8.832 | 42.191 | 84.895 | 1.00 | 29.95 | | | | O |
| ANISOU | 812 | O | ASP | A | 50 | 4024 | 4280 | 3075 | -278 | 371 | 646 | | | O |
| ATOM | 814 | N | PHE | A | 51 | 7.355 | 40.628 | 85.547 | 1.00 | 33.02 | | | | N |
| ANISOU | 814 | N | PHE | A | 51 | 4358 | 4723 | 3466 | -140 | 363 | 606 | | | N |
| ATOM | 815 | CA | PHE | A | 51 | 7.507 | 40.828 | 86.979 | 1.00 | 35.93 | | | | C |
| ANISOU | 815 | CA | PHE | A | 51 | 4748 | 5034 | 3870 | -104 | 362 | 549 | | | C |
| ATOM | 817 | CB | PHE | A | 51 | 6.453 | 39.989 | 87.711 | 1.00 | 39.13 | | | | C |
| ANISOU | 817 | CB | PHE | A | 51 | 5130 | 5462 | 4276 | -24 | 363 | 530 | | | C |
| ATOM | 820 | CG | PHE | A | 51 | 6.493 | 40.131 | 89.192 | 1.00 | 40.63 | | | | C |
| ANISOU | 820 | CG | PHE | A | 51 | 5348 | 5617 | 4472 | 1 | 368 | 473 | | | C |
| ATOM | 821 | CD1 | PHE | A | 51 | 6.038 | 41.293 | 89.790 | 1.00 | 43.02 | | | | C |
| ANISOU | 821 | CD1 | PHE | A | 51 | 5713 | 5832 | 4801 | 32 | 385 | 457 | | | C |
| ATOM | 823 | CE1 | PHE | A | 51 | 6.075 | 41.438 | 91.155 | 1.00 | 43.28 | | | | C |
| ANISOU | 823 | CE1 | PHE | A | 51 | 5783 | 5847 | 4815 | 38 | 399 | 387 | | | C |
| ATOM | 825 | CZ | PHE | A | 51 | 6.595 | 40.423 | 91.939 | 1.00 | 42.62 | | | | C |
| ANISOU | 825 | CZ | PHE | A | 51 | 5672 | 5840 | 4682 | 8 | 378 | 359 | | | C |
| ATOM | 827 | CE2 | PHE | A | 51 | 7.072 | 39.256 | 91.341 | 1.00 | 41.58 | | | | C |
| ANISOU | 827 | CE2 | PHE | A | 51 | 5473 | 5777 | 4548 | -8 | 350 | 392 | | | C |
| ATOM | 829 | CD2 | PHE | A | 51 | 7.024 | 39.122 | 89.985 | 1.00 | 40.74 | | | | C |
| ANISOU | 829 | CD2 | PHE | A | 51 | 5334 | 5682 | 4465 | -10 | 354 | 435 | | | C |
| ATOM | 831 | C | PHE | A | 51 | 8.936 | 40.456 | 87.440 | 1.00 | 32.80 | | | | C |
| ANISOU | 831 | C | PHE | A | 51 | 4318 | 4674 | 3470 | -164 | 362 | 489 | | | C |
| ATOM | 832 | O | PHE | A | 51 | 9.499 | 39.477 | 86.993 | 1.00 | 33.31 | | | | O |
| ANISOU | 832 | O | PHE | A | 51 | 4317 | 4815 | 3524 | -179 | 371 | 470 | | | O |
| ATOM | 834 | N | HIS | A | 52 | 9.527 | 41.300 | 88.271 | 1.00 | 31.67 | | | | N |
| ANISOU | 834 | N | HIS | A | 52 | 4216 | 4475 | 3342 | -200 | 351 | 460 | | | N |
| ATOM | 835 | CA | HIS | A | 52 | 10.856 | 41.077 | 88.838 | 1.00 | 30.90 | | | | C |
| ANISOU | 835 | CA | HIS | A | 52 | 4072 | 4424 | 3244 | -263 | 331 | 413 | | | C |
| ATOM | 837 | CB | HIS | A | 52 | 11.741 | 42.308 | 88.619 | 1.00 | 32.49 | | | | C |
| ANISOU | 837 | CB | HIS | A | 52 | 4308 | 4583 | 3454 | -372 | 330 | 417 | | | C |
| ATOM | 840 | CG | HIS | A | 52 | 12.132 | 42.526 | 87.188 | 1.00 | 33.35 | | | | C |
| ANISOU | 840 | CG | HIS | A | 52 | 4391 | 4726 | 3554 | -437 | 361 | 470 | | | C |
| ATOM | 841 | ND1 | HIS | A | 52 | 13.010 | 41.699 | 86.520 | 1.00 | 33.92 | | | | N |
| ANISOU | 841 | ND1 | HIS | A | 52 | 4357 | 4917 | 3615 | -471 | 386 | 456 | | | N |
| ATOM | 843 | CE1 | HIS | A | 52 | 13.164 | 42.124 | 85.281 | 1.00 | 34.70 | | | | C |
| ANISOU | 843 | CE1 | HIS | A | 52 | 4463 | 5041 | 3683 | -544 | 423 | 505 | | | C |
| ATOM | 845 | NE2 | HIS | A | 52 | 12.409 | 43.197 | 85.114 | 1.00 | 37.35 | | | | N |
| ANISOU | 845 | NE2 | HIS | A | 52 | 4908 | 5267 | 4018 | -553 | 407 | 571 | | | N |
| ATOM | 847 | CD2 | HIS | A | 52 | 11.751 | 43.469 | 86.290 | 1.00 | 36.58 | | | | C |
| ANISOU | 847 | CD2 | HIS | A | 52 | 4869 | 5071 | 3957 | -477 | 374 | 542 | | | C |
| ATOM | 849 | C | HIS | A | 52 | 10.725 | 40.738 | 90.337 | 1.00 | 29.53 | | | | C |
| ANISOU | 849 | C | HIS | A | 52 | 3914 | 4250 | 3057 | -229 | 300 | 367 | | | C |
| ATOM | 850 | O | HIS | A | 52 | 10.238 | 41.517 | 91.110 | 1.00 | 29.94 | | | | O |
| ANISOU | 850 | O | HIS | A | 52 | 4044 | 4233 | 3098 | -225 | 303 | 340 | | | O |
| ATOM | 852 | N | PHE | A | 53 | 11.175 | 39.552 | 90.710 | 1.00 | 28.41 | | | | N |
| ANISOU | 852 | N | PHE | A | 53 | 3698 | 4182 | 2913 | -206 | 273 | 360 | | | N |
| ATOM | 853 | CA | PHE | A | 53 | 11.117 | 39.067 | 92.076 | 1.00 | 28.00 | | | | C |
| ANISOU | 853 | CA | PHE | A | 53 | 3657 | 4150 | 2831 | -188 | 231 | 342 | | | C |
| ATOM | 855 | CB | PHE | A | 53 | 11.217 | 37.539 | 92.101 | 1.00 | 29.97 | | | | C |
| ANISOU | 855 | CB | PHE | A | 53 | 3834 | 4453 | 3101 | -132 | 208 | 369 | | | C |
| ATOM | 858 | CG | PHE | A | 53 | 9.920 | 36.809 | 91.838 | 1.00 | 32.27 | | | | C |
| ANISOU | 858 | CG | PHE | A | 53 | 4149 | 4726 | 3388 | -67 | 241 | 392 | | | C |
| ATOM | 859 | CD1 | PHE | A | 53 | 9.570 | 36.398 | 90.541 | 1.00 | 32.38 | | | | C |
| ANISOU | 859 | CD1 | PHE | A | 53 | 4135 | 4739 | 3430 | -45 | 281 | 401 | | | C |
| ATOM | 861 | CE1 | PHE | A | 53 | 8.393 | 35.686 | 90.323 | 1.00 | 32.06 | | | | C |
| ANISOU | 861 | CE1 | PHE | A | 53 | 4108 | 4693 | 3381 | -6 | 300 | 420 | | | C |
| ATOM | 863 | CZ | PHE | A | 53 | 7.562 | 35.360 | 91.407 | 1.00 | 31.73 | | | | C |
| ANISOU | 863 | CZ | PHE | A | 53 | 4099 | 4648 | 3308 | 14 | 289 | 435 | | | C |
| ATOM | 865 | CE2 | PHE | A | 53 | 7.901 | 35.751 | 92.690 | 1.00 | 32.50 | | | | C |
| ANISOU | 865 | CE2 | PHE | A | 53 | 4227 | 4751 | 3368 | -3 | 261 | 427 | | | C |
| ATOM | 867 | CD2 | PHE | A | 53 | 9.081 | 36.457 | 92.903 | 1.00 | 33.84 | | | | C |
| ANISOU | 867 | CD2 | PHE | A | 53 | 4391 | 4924 | 3541 | -44 | 232 | 402 | | | C |
| ATOM | 869 | C | PHE | A | 53 | 12.262 | 39.618 | 92.940 | 1.00 | 24.66 | | | | C |
| ANISOU | 869 | C | PHE | A | 53 | 3228 | 3754 | 2387 | -275 | 177 | 312 | | | C |
| ATOM | 870 | O | PHE | A | 53 | 12.277 | 39.379 | 94.147 | 1.00 | 26.28 | | | | O |
| ANISOU | 870 | O | PHE | A | 53 | 3456 | 3988 | 2542 | -284 | 131 | 300 | | | O |
| ATOM | 872 | N | ILE | A | 54 | 13.269 | 40.243 | 92.323 | 1.00 | 24.42 | | | | N |
| ANISOU | 872 | N | ILE | A | 54 | 3157 | 3734 | 2385 | -352 | 175 | 306 | | | N |

FIG. 18 (continued)

| | | | | | | | | | | | | | |
|---|---|---|---|---|---|---|---|---|---|---|---|---|---|
| ATOM | 873 | CA | ILE | A | 54 | 14.328 | 40.925 | 93.065 | 1.00 | 24.07 | | | C |
| ANISOU | 873 | CA | ILE | A | 54 | 3106 | 3719 | 2321 | -462 | 120 | 275 | | C |
| ATOM | 875 | CB | ILE | A | 54 | 15.773 | 40.475 | 92.694 | 1.00 | 24.49 | | | C |
| ANISOU | 875 | CB | ILE | A | 54 | 3007 | 3879 | 2421 | -508 | 83 | 293 | | C |
| ATOM | 877 | CG1 | ILE | A | 54 | 15.969 | 38.980 | 92.940 | 1.00 | 25.84 | | | C |
| ANISOU | 877 | CG1 | ILE | A | 54 | 3074 | 4120 | 2626 | -408 | 44 | 327 | | C |
| ATOM | 880 | CD1 | ILE | A | 54 | 17.447 | 38.528 | 92.683 | 1.00 | 26.89 | | | C |
| ANISOU | 880 | CD1 | ILE | A | 54 | 3027 | 4361 | 2828 | -430 | 7 | 339 | | C |
| ATOM | 884 | CG2 | ILE | A | 54 | 16.871 | 41.300 | 93.491 | 1.00 | 23.74 | | | C |
| ANISOU | 884 | CG2 | ILE | A | 54 | 2894 | 3829 | 2298 | -652 | 12 | 263 | | C |
| ATOM | 888 | C | ILE | A | 54 | 14.165 | 42.399 | 92.795 | 1.00 | 26.55 | | | C |
| ANISOU | 888 | C | ILE | A | 54 | 3526 | 3930 | 2632 | -541 | 157 | 246 | | C |
| ATOM | 889 | O | ILE | A | 54 | 14.046 | 42.814 | 91.648 | 1.00 | 25.14 | | | O |
| ANISOU | 889 | O | ILE | A | 54 | 3353 | 3709 | 2490 | -547 | 206 | 277 | | O |
| ATOM | 891 | N | ASN | A | 55 | 14.169 | 43.184 | 93.873 | 1.00 | 26.33 | | | N |
| ANISOU | 891 | N | ASN | A | 55 | 3590 | 3858 | 2555 | -608 | 131 | 185 | | N |
| ATOM | 892 | CA | ASN | A | 55 | 14.033 | 44.631 | 93.768 | 1.00 | 26.16 | | | C |
| ANISOU | 892 | CA | ASN | A | 55 | 3691 | 3704 | 2545 | -684 | 163 | 143 | | C |
| ATOM | 894 | CB | ASN | A | 55 | 13.366 | 45.210 | 95.057 | 1.00 | 24.59 | | | C |
| ANISOU | 894 | CB | ASN | A | 55 | 3625 | 3433 | 2286 | -687 | 171 | 50 | | C |
| ATOM | 897 | CG | ASN | A | 55 | 14.295 | 45.235 | 96.278 | 1.00 | 25.40 | | | C |
| ANISOU | 897 | CG | ASN | A | 55 | 3724 | 3623 | 2302 | -814 | 92 | -12 | | C |
| ATOM | 898 | OD1 | ASN | A | 55 | 15.511 | 45.081 | 96.164 | 1.00 | 25.83 | | | O |
| ANISOU | 898 | OD1 | ASN | A | 55 | 3679 | 3774 | 2361 | -914 | 23 | 16 | | O |
| ATOM | 899 | ND2 | ASN | A | 55 | 13.718 | 45.501 | 97.459 | 1.00 | 22.69 | | | N |
| ANISOU | 899 | ND2 | ASN | A | 55 | 3490 | 3257 | 1874 | -821 | 103 | -101 | | N |
| ATOM | 902 | C | ASN | A | 55 | 15.340 | 45.344 | 93.366 | 1.00 | 27.10 | | | C |
| ANISOU | 902 | C | ASN | A | 55 | 3773 | 3839 | 2686 | -844 | 135 | 146 | | C |
| ATOM | 903 | O | ASN | A | 55 | 16.428 | 44.729 | 93.266 | 1.00 | 25.14 | | | O |
| ANISOU | 903 | O | ASN | A | 55 | 3383 | 3729 | 2441 | -895 | 88 | 171 | | O |
| ATOM | 905 | N | GLU | A | 56 | 15.259 | 46.655 | 93.142 | 1.00 | 27.09 | | | N |
| ANISOU | 905 | N | GLU | A | 56 | 3893 | 3693 | 2708 | -926 | 164 | 123 | | N |
| ATOM | 906 | CA | GLU | A | 56 | 16.419 | 47.371 | 92.625 | 1.00 | 27.66 | | | C |
| ANISOU | 906 | CA | GLU | A | 56 | 3935 | 3771 | 2802 | -1096 | 147 | 140 | | C |
| ATOM | 908 | CB | GLU | A | 56 | 16.022 | 48.757 | 92.108 | 1.00 | 31.50 | | | C |
| ANISOU | 908 | CB | GLU | A | 56 | 4581 | 4051 | 3337 | -1154 | 191 | 149 | | C |
| ATOM | 911 | CG | GLU | A | 56 | 15.215 | 48.684 | 90.833 | 1.00 | 33.75 | | | C |
| ANISOU | 911 | CG | GLU | A | 56 | 4874 | 4282 | 3669 | -1047 | 245 | 252 | | C |
| ATOM | 914 | CD | GLU | A | 56 | 15.966 | 48.036 | 89.631 | 1.00 | 37.52 | | | C |
| ANISOU | 914 | CD | GLU | A | 56 | 5203 | 4914 | 4140 | -1090 | 258 | 339 | | C |
| ATOM | 915 | OE1 | GLU | A | 56 | 17.235 | 47.987 | 89.609 | 1.00 | 39.97 | | | O |
| ANISOU | 915 | OE1 | GLU | A | 56 | 5410 | 5341 | 4437 | -1229 | 237 | 330 | | O |
| ATOM | 916 | OE2 | GLU | A | 56 | 15.256 | 47.567 | 88.696 | 1.00 | 39.44 | | | O |
| ANISOU | 916 | OE2 | GLU | A | 56 | 5426 | 5172 | 4387 | -986 | 294 | 410 | | O |
| ATOM | 917 | C | GLU | A | 56 | 17.540 | 47.468 | 93.633 | 1.00 | 28.01 | | | C |
| ANISOU | 917 | C | GLU | A | 56 | 3933 | 3912 | 2797 | -1244 | 67 | 78 | | C |
| ATOM | 918 | O | GLU | A | 56 | 18.716 | 47.665 | 93.268 | 1.00 | 24.70 | | | O |
| ANISOU | 918 | O | GLU | A | 56 | 3414 | 3577 | 2392 | -1386 | 38 | 101 | | O |
| ATOM | 920 | N | GLN | A | 57 | 17.183 | 47.325 | 94.909 | 1.00 | 27.64 | | | N |
| ANISOU | 920 | N | GLN | A | 57 | 3949 | 3871 | 2682 | -1222 | 29 | 1 | | N |
| ATOM | 921 | CA | GLN | A | 57 | 18.153 | 47.339 | 96.010 | 1.00 | 25.76 | | | C |
| ANISOU | 921 | CA | GLN | A | 57 | 3671 | 3748 | 2369 | -1365 | -68 | -54 | | C |
| ATOM | 923 | CB | GLN | A | 57 | 17.487 | 47.911 | 97.281 | 1.00 | 26.60 | | | C |
| ANISOU | 923 | CB | GLN | A | 57 | 3954 | 3765 | 2386 | -1392 | -68 | -175 | | C |
| ATOM | 926 | CG | GLN | A | 57 | 16.938 | 49.378 | 97.107 | 1.00 | 27.17 | | | C |
| ANISOU | 926 | CG | GLN | A | 57 | 4230 | 3592 | 2501 | -1444 | 11 | -258 | | C |
| ATOM | 929 | CD | GLN | A | 57 | 15.507 | 49.424 | 96.565 | 1.00 | 22.87 | | | C |
| ANISOU | 929 | CD | GLN | A | 57 | 3766 | 2899 | 2024 | -1245 | 115 | -237 | | C |
| ATOM | 930 | OE1 | GLN | A | 57 | 14.942 | 48.415 | 96.230 | 1.00 | 22.60 | | | O |
| ANISOU | 930 | OE1 | GLN | A | 57 | 3641 | 2947 | 1998 | -1091 | 132 | -164 | | O |
| ATOM | 931 | NE2 | GLN | A | 57 | 14.943 | 50.627 | 96.461 | 1.00 | 26.95 | | | N |
| ANISOU | 931 | NE2 | GLN | A | 57 | 4451 | 3189 | 2599 | -1252 | 180 | -299 | | N |
| ATOM | 934 | C | GLN | A | 57 | 18.751 | 45.935 | 96.271 | 1.00 | 24.69 | | | C |
| ANISOU | 934 | C | GLN | A | 57 | 3340 | 3824 | 2217 | -1303 | -145 | 11 | | C |
| ATOM | 935 | O | GLN | A | 57 | 19.511 | 45.756 | 97.196 | 1.00 | 26.48 | | | O |
| ANISOU | 935 | O | GLN | A | 57 | 3509 | 4172 | 2380 | -1398 | -246 | -7 | | O |
| ATOM | 937 | N | GLY | A | 58 | 18.390 | 44.945 | 95.460 | 1.00 | 25.39 | | | N |
| ANISOU | 937 | N | GLY | A | 58 | 3334 | 3947 | 2365 | -1145 | -102 | 88 | | N |
| ATOM | 938 | CA | GLY | A | 58 | 19.081 | 43.669 | 95.443 | 1.00 | 23.98 | | | C |
| ANISOU | 938 | CA | GLY | A | 58 | 2963 | 3934 | 2215 | -1079 | -162 | 154 | | C |
| ATOM | 941 | C | GLY | A | 58 | 18.506 | 42.605 | 96.371 | 1.00 | 25.23 | | | C |
| ANISOU | 941 | C | GLY | A | 58 | 3126 | 4140 | 2322 | -962 | -212 | 176 | | C |
| ATOM | 942 | O | GLY | A | 58 | 19.249 | 41.680 | 96.776 | 1.00 | 24.79 | | | O |
| ANISOU | 942 | O | GLY | A | 58 | 2926 | 4215 | 2277 | -939 | -303 | 231 | | O |
| ATOM | 944 | N | GLU | A | 59 | 17.230 | 42.763 | 96.743 | 1.00 | 22.57 | | | N |
| ANISOU | 944 | N | GLU | A | 59 | 2944 | 3698 | 1932 | -896 | -157 | 139 | | N |
| ATOM | 945 | CA | GLU | A | 59 | 16.540 | 41.872 | 97.667 | 1.00 | 25.49 | | | C |
| ANISOU | 945 | CA | GLU | A | 59 | 3345 | 4108 | 2234 | -811 | -188 | 159 | | C |
| ATOM | 947 | CB | GLU | A | 59 | 16.125 | 42.588 | 98.975 | 1.00 | 27.46 | | | C |

FIG. 18 (continued)

| | | | | | | | | | | | | | | |
|---|---|---|---|---|---|---|---|---|---|---|---|---|---|---|
| ANISOU | 947 | CB | GLU | A | 59 | 3747 | 4341 | 2348 | -903 | -204 | 71 | | | C |
| ATOM | 950 | CG | GLU | A | 59 | 17.300 | 43.101 | 99.767 | 1.00 | 28.40 | | | | C |
| ANISOU | 950 | CG | GLU | A | 59 | 3842 | 4552 | 2395 | -1081 | -315 | 37 | | | C |
| ATOM | 953 | CD | GLU | A | 59 | 16.891 | 43.853 | 101.024 | 1.00 | 31.33 | | | | C |
| ANISOU | 953 | CD | GLU | A | 59 | 4383 | 4907 | 2613 | -1190 | -318 | -77 | | | C |
| ATOM | 954 | OE1 | GLU | A | 59 | 17.064 | 45.096 | 101.021 | 1.00 | 34.12 | | | | O |
| ANISOU | 954 | OE1 | GLU | A | 59 | 4839 | 5166 | 2959 | -1310 | -285 | -182 | | | O |
| ATOM | 955 | OE2 | GLU | A | 59 | 16.440 | 43.217 | 102.009 | 1.00 | 28.23 | | | | O |
| ANISOU | 955 | OE2 | GLU | A | 59 | 4027 | 4593 | 2104 | -1170 | -352 | -64 | | | O |
| ATOM | 956 | C | GLU | A | 59 | 15.314 | 41.274 | 97.041 | 1.00 | 24.02 | | | | C |
| ANISOU | 956 | C | GLU | A | 59 | 3189 | 3848 | 2088 | -657 | -97 | 188 | | | C |
| ATOM | 957 | O | GLU | A | 59 | 14.549 | 41.949 | 96.319 | 1.00 | 22.20 | | | | O |
| ANISOU | 957 | O | GLU | A | 59 | 3036 | 3505 | 1893 | -624 | -5 | 159 | | | O |
| ATOM | 959 | N | SER | A | 60 | 15.111 | 40.008 | 97.364 | 1.00 | 22.25 | | | | N |
| ANISOU | 959 | N | SER | A | 60 | 2909 | 3687 | 1860 | -569 | -136 | 254 | | | N |
| ATOM | 960 | CA | SER | A | 60 | 13.896 | 39.301 | 96.995 | 1.00 | 22.85 | | | | C |
| ANISOU | 960 | CA | SER | A | 60 | 3016 | 3710 | 1955 | -445 | -65 | 282 | | | C |
| ATOM | 962 | CB | SER | A | 60 | 14.030 | 37.786 | 97.305 | 1.00 | 21.97 | | | | C |
| ANISOU | 962 | CB | SER | A | 60 | 2824 | 3664 | 1861 | -371 | -130 | 372 | | | C |
| ATOM | 965 | OG | SER | A | 60 | 13.811 | 37.490 | 98.690 | 1.00 | 24.84 | | | | O |
| ANISOU | 965 | OG | SER | A | 60 | 3246 | 4085 | 2109 | -410 | -195 | 394 | | | O |
| ATOM | 967 | C | SER | A | 60 | 12.640 | 39.944 | 97.633 | 1.00 | 21.33 | | | | C |
| ANISOU | 967 | C | SER | A | 60 | 2968 | 3456 | 1680 | -443 | 4 | 219 | | | C |
| ATOM | 968 | O | SER | A | 60 | 12.653 | 40.375 | 98.764 | 1.00 | 20.58 | | | | O |
| ANISOU | 968 | O | SER | A | 60 | 2948 | 3390 | 1480 | -519 | -23 | 168 | | | O |
| ATOM | 970 | N | ILE | A | 61 | 11.562 | 40.016 | 96.867 | 1.00 | 22.00 | | | | N |
| ANISOU | 970 | N | ILE | A | 61 | 3082 | 3464 | 1813 | -357 | 95 | 217 | | | N |
| ATOM | 971 | CA | ILE | A | 61 | 10.318 | 40.650 | 97.320 | 1.00 | 25.14 | | | | C |
| ANISOU | 971 | CA | ILE | A | 61 | 3585 | 3801 | 2166 | -328 | 176 | 156 | | | C |
| ATOM | 973 | CB | ILE | A | 61 | 10.153 | 42.039 | 96.678 | 1.00 | 25.28 | | | | C |
| ANISOU | 973 | CB | ILE | A | 61 | 3668 | 3696 | 2243 | -337 | 236 | 98 | | | C |
| ATOM | 975 | CG1 | ILE | A | 61 | 10.433 | 41.934 | 95.154 | 1.00 | 25.66 | | | | C |
| ANISOU | 975 | CG1 | ILE | A | 61 | 3642 | 3715 | 2391 | -305 | 241 | 168 | | | C |
| ATOM | 978 | CD1 | ILE | A | 61 | 9.640 | 42.917 | 94.273 | 1.00 | 27.70 | | | | C |
| ANISOU | 978 | CD1 | ILE | A | 61 | 3956 | 3851 | 2717 | -258 | 308 | 169 | | | C |
| ATOM | 982 | CG2 | ILE | A | 61 | 11.045 | 43.056 | 97.374 | 1.00 | 25.04 | | | | C |
| ANISOU | 982 | CG2 | ILE | A | 61 | 3707 | 3643 | 2165 | -465 | 202 | 17 | | | C |
| ATOM | 986 | C | ILE | A | 61 | 9.064 | 39.795 | 97.007 | 1.00 | 24.11 | | | | C |
| ANISOU | 986 | C | ILE | A | 61 | 3432 | 3674 | 2054 | -222 | 231 | 203 | | | C |
| ATOM | 987 | O | ILE | A | 61 | 8.009 | 40.341 | 96.626 | 1.00 | 26.04 | | | | O |
| ANISOU | 987 | O | ILE | A | 61 | 3710 | 3854 | 2331 | -161 | 311 | 177 | | | O |
| ATOM | 989 | N | VAL | A | 62 | 9.157 | 38.475 | 97.229 | 1.00 | 24.31 | | | | N |
| ANISOU | 989 | N | VAL | A | 62 | 3400 | 3772 | 2063 | -204 | 182 | 276 | | | N |
| ATOM | 990 | CA | VAL | A | 62 | 7.990 | 37.565 | 97.066 | 1.00 | 25.04 | | | | C |
| ANISOU | 990 | CA | VAL | A | 62 | 3477 | 3874 | 2162 | -135 | 226 | 322 | | | C |
| ATOM | 992 | CB | VAL | A | 62 | 8.370 | 36.080 | 97.311 | 1.00 | 26.36 | | | | C |
| ANISOU | 992 | CB | VAL | A | 62 | 3594 | 4091 | 2329 | -132 | 153 | 411 | | | C |
| ATOM | 994 | CG1 | VAL | A | 62 | 7.126 | 35.151 | 97.315 | 1.00 | 25.73 | | | | C |
| ANISOU | 994 | CG1 | VAL | A | 62 | 3516 | 4020 | 2242 | -96 | 197 | 457 | | | C |
| ATOM | 998 | CG2 | VAL | A | 62 | 9.379 | 35.639 | 96.270 | 1.00 | 23.78 | | | | C |
| ANISOU | 998 | CG2 | VAL | A | 62 | 3184 | 3743 | 2108 | -107 | 111 | 440 | | | C |
| ATOM | 1002 | C | VAL | A | 62 | 6.783 | 37.943 | 97.917 | 1.00 | 24.77 | | | | C |
| ANISOU | 1002 | C | VAL | A | 62 | 3508 | 3855 | 2051 | -129 | 302 | 274 | | | C |
| ATOM | 1003 | O | VAL | A | 62 | 5.588 | 37.771 | 97.514 | 1.00 | 22.52 | | | | O |
| ANISOU | 1003 | O | VAL | A | 62 | 3201 | 3560 | 1794 | -67 | 372 | 285 | | | O |
| ATOM | 1005 | N | VAL | A | 63 | 7.096 | 38.510 | 99.073 | 1.00 | 25.45 | | | | N |
| ANISOU | 1005 | N | VAL | A | 63 | 3663 | 3973 | 2035 | -199 | 295 | 212 | | | N |
| ATOM | 1006 | CA | VAL | A | 63 | 6.096 | 39.054 | 99.984 | 1.00 | 27.31 | | | | C |
| ANISOU | 1006 | CA | VAL | A | 63 | 3967 | 4228 | 2182 | -204 | 388 | 130 | | | C |
| ATOM | 1008 | CB | VAL | A | 63 | 6.784 | 39.675 | 101.209 | 1.00 | 25.58 | | | | C |
| ANISOU | 1008 | CB | VAL | A | 63 | 3836 | 4051 | 1831 | -313 | 360 | 48 | | | C |
| ATOM | 1010 | CG1 | VAL | A | 63 | 7.470 | 40.992 | 100.811 | 1.00 | 26.25 | | | | C |
| ANISOU | 1010 | CG1 | VAL | A | 63 | 3966 | 4032 | 1975 | -339 | 360 | -41 | | | C |
| ATOM | 1014 | CG2 | VAL | A | 63 | 5.786 | 39.862 | 102.345 | 1.00 | 28.91 | | | | C |
| ANISOU | 1014 | CG2 | VAL | A | 63 | 4327 | 4536 | 2122 | -336 | 460 | -33 | | | C |
| ATOM | 1018 | C | VAL | A | 63 | 5.104 | 40.076 | 99.354 | 1.00 | 26.94 | | | | C |
| ANISOU | 1018 | C | VAL | A | 63 | 3929 | 4087 | 2222 | -114 | 498 | 60 | | | C |
| ATOM | 1019 | O | VAL | A | 63 | 3.999 | 40.296 | 99.879 | 1.00 | 27.90 | | | | O |
| ANISOU | 1019 | O | VAL | A | 63 | 4065 | 4229 | 2308 | -76 | 598 | 4 | | | O |
| ATOM | 1021 | N | GLU | A | 64 | 5.493 | 40.712 | 98.263 | 1.00 | 27.38 | | | | N |
| ANISOU | 1021 | N | GLU | A | 64 | 3969 | 4044 | 2390 | -80 | 483 | 68 | | | N |
| ATOM | 1022 | CA | GLU | A | 64 | 4.672 | 41.766 | 97.677 | 1.00 | 29.23 | | | | C |
| ANISOU | 1022 | CA | GLU | A | 64 | 4219 | 4172 | 2717 | 6 | 563 | 23 | | | C |
| ATOM | 1024 | CB | GLU | A | 64 | 5.510 | 42.714 | 96.809 | 1.00 | 30.76 | | | | C |
| ANISOU | 1024 | CB | GLU | A | 64 | 4442 | 4249 | 2995 | -14 | 526 | 24 | | | C |
| ATOM | 1027 | CG | GLU | A | 64 | 6.369 | 43.615 | 97.662 | 1.00 | 33.75 | | | | C |
| ANISOU | 1027 | CG | GLU | A | 64 | 4924 | 4582 | 3319 | -113 | 516 | -80 | | | C |
| ATOM | 1030 | CD | GLU | A | 64 | 7.247 | 44.555 | 96.848 | 1.00 | 35.99 | | | | C |
| ANISOU | 1030 | CD | GLU | A | 64 | 5241 | 4751 | 3682 | -162 | 479 | -73 | | | C |

FIG. 18 (continued)

```
ATOM   1031  OE1 GLU A  64      6.940  44.839  95.659  1.00 38.30          O
ANISOU 1031  OE1 GLU A  64   5505   4970   4078    -99    487    -1        O
ATOM   1032  OE2 GLU A  64      8.252  45.010  97.418  1.00 40.17          O
ANISOU 1032  OE2 GLU A  64   5828   5277   4160   -281    437   -133       O
ATOM   1033  C   GLU A  64      3.506  41.205  96.882  1.00 27.19          C
ANISOU 1033  C   GLU A  64   3870   3935   2525    103    599    97        C
ATOM   1034  O   GLU A  64      2.590  41.952  96.526  1.00 27.12          O
ANISOU 1034  O   GLU A  64   3850   3862   2594    193    664    77        O
ATOM   1036  N   LEU A  65      3.497  39.898  96.648  1.00 25.89          N
ANISOU 1036  N   LEU A  65   3640   3859   2338     85    553   182        N
ATOM   1037  CA  LEU A  65      2.341  39.257  95.992  1.00 26.97          C
ANISOU 1037  CA  LEU A  65   3691   4035   2520    147    581   246        C
ATOM   1039  CB  LEU A  65      2.643  37.824  95.554  1.00 26.93          C
ANISOU 1039  CB  LEU A  65   3639   4089   2505    106    515   332        C
ATOM   1042  CG  LEU A  65      3.668  37.645  94.426  1.00 26.38          C
ANISOU 1042  CG  LEU A  65   3553   3977   2491     90    446   370        C
ATOM   1044  CD1 LEU A  65      3.991  36.143  94.234  1.00 25.60          C
ANISOU 1044  CD1 LEU A  65   3420   3920   2387     58    395   427        C
ATOM   1048  CD2 LEU A  65      3.198  38.260  93.092  1.00 26.60          C
ANISOU 1048  CD2 LEU A  65   3548   3962   2595    140    457   397        C
ATOM   1052  C   LEU A  65      1.157  39.293  96.925  1.00 27.94          C
ANISOU 1052  C   LEU A  65   3801   4219   2597    177    675   200        C
ATOM   1053  O   LEU A  65      0.056  39.678  96.525  1.00 29.11          O
ANISOU 1053  O   LEU A  65   3887   4361   2812    261    735   200        O
ATOM   1055  N   ASP A  66      1.381  38.914  98.178  1.00 29.74          N
ANISOU 1055  N   ASP A  66   4078   4516   2704    104    687   164        N
ATOM   1056  CA  ASP A  66      0.323  38.886  99.181  1.00 29.92          C
ANISOU 1056  CA  ASP A  66   4091   4624   2651    107    792   112        C
ATOM   1058  CB  ASP A  66      0.530  37.691 100.122  1.00 31.42          C
ANISOU 1058  CB  ASP A  66   4305   4929   2706     -3    759   166        C
ATOM   1061  CG  ASP A  66      0.130  36.346  99.481  1.00 31.92          C
ANISOU 1061  CG  ASP A  66   4291   5031   2806    -17    711   292        C
ATOM   1062  OD1 ASP A  66     -0.242  36.296  98.253  1.00 28.23          O
ANISOU 1062  OD1 ASP A  66   3751   4518   2457     46    697   331        O
ATOM   1063  OD2 ASP A  66      0.180  35.340 100.242  1.00 31.45          O
ANISOU 1063  OD2 ASP A  66   4255   5046   2649   -105    685   354        O
ATOM   1064  C   ASP A  66      0.209  40.183  99.997  1.00 31.68          C
ANISOU 1064  C   ASP A  66   4388   4804   2844    131    888   -36        C
ATOM   1065  O   ASP A  66     -0.821  40.455 100.606  1.00 31.73          O
ANISOU 1065  O   ASP A  66   4369   4863   2825    171   1009  -107        O
ATOM   1067  N   ASP A  67      1.242  41.001 100.002  1.00 32.12          N
ANISOU 1067  N   ASP A  67   4533   4763   2908    103    843   -92        N
ATOM   1068  CA  ASP A  67      1.215  42.268 100.732  1.00 34.27          C
ANISOU 1068  CA  ASP A  67   4899   4965   3159    113    930  -249        C
ATOM   1070  CB  ASP A  67      1.958  42.076 102.055  1.00 36.09          C
ANISOU 1070  CB  ASP A  67   5228   5285   3201    -31    910  -314        C
ATOM   1073  CG  ASP A  67      1.643  43.166 103.078  1.00 39.18          C
ANISOU 1073  CG  ASP A  67   5720   5647   3519    -42   1035  -508        C
ATOM   1074  OD1 ASP A  67      0.833  44.065 102.757  1.00 40.11          O
ANISOU 1074  OD1 ASP A  67   5824   5655   3760     84   1145  -591        O
ATOM   1075  OD2 ASP A  67      2.220  43.116 104.201  1.00 41.11          O
ANISOU 1075  OD2 ASP A  67   6058   5977   3585   -178   1020  -576        O
ATOM   1076  C   ASP A  67      1.876  43.390  99.906  1.00 34.58          C
ANISOU 1076  C   ASP A  67   4988   4827   3324    147    891  -272        C
ATOM   1077  O   ASP A  67      2.994  43.832 100.203  1.00 34.93          O
ANISOU 1077  O   ASP A  67   5124   4826   3322     51    833  -319        O
ATOM   1079  N   PRO A  68      1.227  43.818  98.825  1.00 34.97          N
ANISOU 1079  N   PRO A  68   4974   4784   3529    270    909  -221        N
ATOM   1080  CA  PRO A  68      1.922  44.750  97.918  1.00 37.05          C
ANISOU 1080  CA  PRO A  68   5289   4886   3904    281    853  -201        C
ATOM   1082  CB  PRO A  68      1.007  44.786  96.695  1.00 33.89          C
ANISOU 1082  CB  PRO A  68   4785   4448   3643    410    852   -92        C
ATOM   1085  CG  PRO A  68     -0.317  44.483  97.241  1.00 34.86          C
ANISOU 1085  CG  PRO A  68   4826   4659   3761    497    952  -127        C
ATOM   1088  CD  PRO A  68     -0.101  43.470  98.323  1.00 35.15          C
ANISOU 1088  CD  PRO A  68   4872   4855   3630    387    963  -161        C
ATOM   1091  C   PRO A  68      2.064  46.170  98.469  1.00 42.28          C
ANISOU 1091  C   PRO A  68   6077   5388   4601    290    921  -349        C
ATOM   1092  O   PRO A  68      1.343  46.559  99.383  1.00 38.83          O
ANISOU 1092  O   PRO A  68   5670   4949   4136    336   1037  -478        O
ATOM   1093  N   ASN A  69      2.982  46.913  97.863  1.00 46.43          N
ANISOU 1093  N   ASN A  69   6673   5778   5188    239    856  -330        N
ATOM   1094  CA  ASN A  69      3.057  48.359  98.000  1.00 54.20          C
ANISOU 1094  CA  ASN A  69   7781   6552   6260    260    907  -439        C
ATOM   1096  CB  ASN A  69      4.522  48.789  97.921  1.00 55.32          C
ANISOU 1096  CB  ASN A  69   8019   6633   6365     94    818  -448        C
ATOM   1099  CG  ASN A  69      5.350  48.138  98.990  1.00 56.44          C
ANISOU 1099  CG  ASN A  69   8184   6935   6326    -60    778  -513        C
ATOM   1100  OD1 ASN A  69      4.981  48.182 100.169  1.00 58.37          O
```

FIG. 18 (continued)

| | | | | | | | | | | | | | |
|---|---|---|---|---|---|---|---|---|---|---|---|---|---|
| ANISOU | 1100 | OD1 | ASN | A | 69 | 8483 | 7229 | 6466 | -78 | 852 | -648 | | O |
| ATOM | 1101 | ND2 | ASN | A | 69 | 6.459 | 47.499 | 98.595 | 1.00 | 56.12 | | | N |
| ANISOU | 1101 | ND2 | ASN | A | 69 | 8094 | 6990 | 6240 | -171 | 661 | -414 | | N |
| ATOM | 1104 | C | ASN | A | 69 | 2.194 | 49.016 | 96.914 | 1.00 | 56.82 | | | C |
| ANISOU | 1104 | C | ASN | A | 69 | 8070 | 6737 | 6782 | 424 | 926 | -353 | | C |
| ATOM | 1105 | O | ASN | A | 69 | 1.017 | 48.687 | 96.782 | 1.00 | 58.09 | | | O |
| ANISOU | 1105 | O | ASN | A | 69 | 8122 | 6955 | 6994 | 561 | 981 | -319 | | O |
| ATOM | 1107 | N | ALA | A | 70 | 2.760 | 49.923 | 96.124 | 1.00 | 60.58 | | | N |
| ANISOU | 1107 | N | ALA | A | 70 | 8622 | 7036 | 7361 | 402 | 874 | -301 | | N |
| ATOM | 1108 | CA | ALA | A | 70 | 1.972 | 50.635 | 95.119 | 1.00 | 62.44 | | | C |
| ANISOU | 1108 | CA | ALA | A | 70 | 8830 | 7117 | 7777 | 553 | 875 | -199 | | C |
| ATOM | 1110 | CB | ALA | A | 70 | 2.731 | 51.858 | 94.614 | 1.00 | 64.29 | | | C |
| ANISOU | 1110 | CB | ALA | A | 70 | 9206 | 7115 | 8107 | 493 | 835 | -181 | | C |
| ATOM | 1114 | C | ALA | A | 70 | 1.572 | 49.699 | 93.957 | 1.00 | 62.05 | | | C |
| ANISOU | 1114 | C | ALA | A | 70 | 8629 | 7213 | 7735 | 595 | 797 | -5 | | C |
| ATOM | 1115 | O | ALA | A | 70 | 2.137 | 48.603 | 93.790 | 1.00 | 60.11 | | | O |
| ANISOU | 1115 | O | ALA | A | 70 | 8323 | 7145 | 7370 | 492 | 738 | 48 | | O |
| ATOM | 1117 | N | LEU | A | 71 | 0.568 | 50.129 | 93.193 | 1.00 | 63.56 | | | N |
| ANISOU | 1117 | N | LEU | A | 71 | 8756 | 7325 | 8067 | 751 | 797 | 95 | | N |
| ATOM | 1118 | CA | LEU | A | 71 | 0.032 | 49.356 | 92.077 | 1.00 | 63.39 | | | C |
| ANISOU | 1118 | CA | LEU | A | 71 | 8595 | 7440 | 8053 | 790 | 721 | 271 | | C |
| ATOM | 1120 | CB | LEU | A | 71 | -1.456 | 49.087 | 92.298 | 1.00 | 64.17 | | | C |
| ANISOU | 1120 | CB | LEU | A | 71 | 8551 | 7613 | 8216 | 960 | 783 | 270 | | C |
| ATOM | 1123 | CG | LEU | A | 71 | -1.806 | 48.307 | 93.566 | 1.00 | 64.20 | | | C |
| ANISOU | 1123 | CG | LEU | A | 71 | 8509 | 7770 | 8113 | 947 | 883 | 126 | | C |
| ATOM | 1125 | CD1 | LEU | A | 71 | -3.320 | 48.263 | 93.765 | 1.00 | 65.50 | | | C |
| ANISOU | 1125 | CD1 | LEU | A | 71 | 8524 | 7995 | 8368 | 1119 | 962 | 121 | | C |
| ATOM | 1129 | CD2 | LEU | A | 71 | -1.203 | 46.908 | 93.510 | 1.00 | 61.39 | | | C |
| ANISOU | 1129 | CD2 | LEU | A | 71 | 8114 | 7616 | 7594 | 797 | 822 | 168 | | C |
| ATOM | 1133 | C | LEU | A | 71 | 0.234 | 50.123 | 90.770 | 1.00 | 65.14 | | | C |
| ANISOU | 1133 | C | LEU | A | 71 | 8854 | 7525 | 8371 | 797 | 631 | 435 | | C |
| ATOM | 1134 | O | LEU | A | 71 | 0.408 | 49.526 | 89.703 | 1.00 | 65.15 | | | O |
| ANISOU | 1134 | O | LEU | A | 71 | 8793 | 7639 | 8321 | 737 | 544 | 579 | | O |
| ATOM | 1136 | N | LYS | A | 73 | 2.755 | 50.516 | 88.990 | 1.00 | 57.68 | | | N |
| ANISOU | 1136 | N | LYS | A | 73 | 8068 | 6523 | 7324 | 459 | 466 | 624 | | N |
| ATOM | 1137 | CA | LYS | A | 73 | 4.127 | 50.939 | 88.742 | 1.00 | 59.28 | | | C |
| ANISOU | 1137 | CA | LYS | A | 73 | 8373 | 6669 | 7482 | 280 | 436 | 629 | | C |
| ATOM | 1139 | CB | LYS | A | 73 | 5.084 | 50.317 | 89.781 | 1.00 | 59.35 | | | C |
| ANISOU | 1139 | CB | LYS | A | 73 | 8388 | 6786 | 7376 | 160 | 467 | 473 | | C |
| ATOM | 1142 | CG | LYS | A | 73 | 4.898 | 50.867 | 91.216 | 1.00 | 61.37 | | | C |
| ANISOU | 1142 | CG | LYS | A | 73 | 8728 | 6931 | 7658 | 199 | 543 | 290 | | C |
| ATOM | 1145 | CD | LYS | A | 73 | 5.860 | 50.248 | 92.232 | 1.00 | 60.40 | | | C |
| ANISOU | 1145 | CD | LYS | A | 73 | 8610 | 6936 | 7402 | 66 | 549 | 161 | | C |
| ATOM | 1148 | CE | LYS | A | 73 | 5.454 | 50.604 | 93.678 | 1.00 | 62.52 | | | C |
| ANISOU | 1148 | CE | LYS | A | 73 | 8950 | 7146 | 7658 | 107 | 631 | -24 | | C |
| ATOM | 1151 | NZ | LYS | A | 73 | 6.288 | 49.979 | 94.796 | 1.00 | 62.08 | | | N |
| ANISOU | 1151 | NZ | LYS | A | 73 | 8901 | 7236 | 7452 | -25 | 623 | -141 | | N |
| ATOM | 1155 | C | LYS | A | 73 | 4.568 | 50.597 | 87.305 | 1.00 | 58.49 | | | C |
| ANISOU | 1155 | C | LYS | A | 73 | 8232 | 6671 | 7322 | 183 | 359 | 801 | | C |
| ATOM | 1156 | O | LYS | A | 73 | 5.327 | 51.345 | 86.692 | 1.00 | 59.71 | | | O |
| ANISOU | 1156 | O | LYS | A | 73 | 8472 | 6726 | 7487 | 70 | 326 | 876 | | O |
| ATOM | 1158 | N | HIS | A | 74 | 4.059 | 49.494 | 86.758 | 1.00 | 56.23 | | | N |
| ANISOU | 1158 | N | HIS | A | 74 | 7819 | 6579 | 6967 | 217 | 335 | 860 | | N |
| ATOM | 1159 | CA | HIS | A | 74 | 4.466 | 49.028 | 85.425 | 1.00 | 54.38 | | | C |
| ANISOU | 1159 | CA | HIS | A | 74 | 7545 | 6473 | 6646 | 114 | 277 | 992 | | C |
| ATOM | 1161 | CB | HIS | A | 74 | 5.345 | 47.787 | 85.598 | 1.00 | 55.24 | | | C |
| ANISOU | 1161 | CB | HIS | A | 74 | 7586 | 6772 | 6630 | 9 | 298 | 903 | | C |
| ATOM | 1164 | CG | HIS | A | 74 | 6.685 | 48.098 | 86.193 | 1.00 | 56.85 | | | C |
| ANISOU | 1164 | CG | HIS | A | 74 | 7850 | 6938 | 6812 | -117 | 323 | 811 | | C |
| ATOM | 1165 | ND1 | HIS | A | 74 | 7.636 | 48.843 | 85.525 | 1.00 | 58.49 | | | N |
| ANISOU | 1165 | ND1 | HIS | A | 74 | 8122 | 7089 | 7011 | -257 | 306 | 875 | | N |
| ATOM | 1167 | CE1 | HIS | A | 74 | 8.703 | 48.980 | 86.292 | 1.00 | 58.24 | | | C |
| ANISOU | 1167 | CE1 | HIS | A | 74 | 8118 | 7048 | 6965 | -358 | 327 | 770 | | C |
| ATOM | 1169 | NE2 | HIS | A | 74 | 8.475 | 48.358 | 87.436 | 1.00 | 57.72 | | | N |
| ANISOU | 1169 | NE2 | HIS | A | 74 | 8014 | 7027 | 6889 | -287 | 350 | 647 | | N |
| ATOM | 1171 | CD2 | HIS | A | 74 | 7.219 | 47.799 | 87.400 | 1.00 | 56.54 | | | C |
| ANISOU | 1171 | CD2 | HIS | A | 74 | 7812 | 6917 | 6755 | -139 | 355 | 669 | | C |
| ATOM | 1173 | C | HIS | A | 74 | 3.277 | 48.741 | 84.503 | 1.00 | 49.58 | | | C |
| ANISOU | 1173 | C | HIS | A | 74 | 6853 | 5939 | 6047 | 210 | 222 | 1131 | | C |
| ATOM | 1174 | O | HIS | A | 74 | 2.127 | 48.782 | 84.934 | 1.00 | 48.65 | | | O |
| ANISOU | 1174 | O | HIS | A | 74 | 6681 | 5793 | 6010 | 364 | 230 | 1124 | | O |
| ATOM | 1176 | N | ARG | A | 75 | 3.572 | 48.433 | 83.242 | 1.00 | 44.38 | | | N |
| ANISOU | 1176 | N | ARG | A | 75 | 6175 | 5392 | 5294 | 106 | 168 | 1252 | | N |
| ATOM | 1177 | CA | ARG | A | 75 | 2.538 | 48.162 | 82.238 | 1.00 | 42.84 | | | C |
| ANISOU | 1177 | CA | ARG | A | 75 | 5906 | 5293 | 5077 | 158 | 96 | 1397 | | C |
| ATOM | 1179 | CB | ARG | A | 75 | 3.150 | 47.803 | 80.876 | 1.00 | 43.33 | | | C |
| ANISOU | 1179 | CB | ARG | A | 75 | 5975 | 5498 | 4992 | -6 | 53 | 1500 | | C |
| ATOM | 1182 | CG | ARG | A | 75 | 2.130 | 47.102 | 79.983 | 1.00 | 44.41 | | | C |
| ANISOU | 1182 | CG | ARG | A | 75 | 6015 | 5800 | 5057 | 17 | -17 | 1598 | | C |

FIG. 18 (continued)

```
ATOM   1185  CD   ARG A  75      2.519  46.931  78.567  1.00 45.17          C
ANISOU 1185  CD   ARG A  75   6132   6031   4999   -141    -67   1714       C
ATOM   1188  NE   ARG A  75      1.378  46.422  77.814  1.00 45.60          N
ANISOU 1188  NE   ARG A  75   6101   6229   4997   -112   -153   1815       N
ATOM   1190  CZ   ARG A  75      1.427  46.073  76.541  1.00 47.50          C
ANISOU 1190  CZ   ARG A  75   6343   6633   5073   -249   -208   1910       C
ATOM   1191  NH1  ARG A  75      2.573  46.188  75.854  1.00 49.50          N
ANISOU 1191  NH1  ARG A  75   6675   6930   5202   -420   -170   1917       N
ATOM   1194  NH2  ARG A  75      0.330  45.625  75.944  1.00 47.45          N
ANISOU 1194  NH2  ARG A  75   6252   6760   5015   -228   -298   1996       N
ATOM   1197  C    ARG A  75      1.554  47.059  82.634  1.00 38.70          C
ANISOU 1197  C    ARG A  75   5254   4912   4539    252    107   1333       C
ATOM   1198  O    ARG A  75      0.341  47.192  82.413  1.00 39.11          O
ANISOU 1198  O    ARG A  75   5233   4974   4654    369     60   1421       O
ATOM   1200  N    PHE A  76      2.081  45.963  83.171  1.00 36.37          N
ANISOU 1200  N    PHE A  76   4923   4731   4165    195    163   1194       N
ATOM   1201  CA   PHE A  76      1.246  44.862  83.653  1.00 33.46          C
ANISOU 1201  CA   PHE A  76   4449   4485   3780    258    181   1127       C
ATOM   1203  CB   PHE A  76      1.709  43.524  83.110  1.00 31.10          C
ANISOU 1203  CB   PHE A  76   4109   4356   3351    145    181   1088       C
ATOM   1206  CG   PHE A  76      1.627  43.410  81.639  1.00 29.66          C
ANISOU 1206  CG   PHE A  76   3918   4272   3079     58    117   1205       C
ATOM   1207  CD1  PHE A  76      0.388  43.326  80.996  1.00 30.89          C
ANISOU 1207  CD1  PHE A  76   4001   4504   3231    102     43   1314       C
ATOM   1209  CE1  PHE A  76      0.316  43.224  79.611  1.00 32.24          C
ANISOU 1209  CE1  PHE A  76   4173   4788   3291     -1    -28   1427       C
ATOM   1211  CZ   PHE A  76      1.484  43.191  78.864  1.00 32.12          C
ANISOU 1211  CZ   PHE A  76   4231   4809   3165   -145     -6   1419       C
ATOM   1213  CE2  PHE A  76      2.710  43.271  79.488  1.00 31.38          C
ANISOU 1213  CE2  PHE A  76   4193   4641   3090   -179     77   1308       C
ATOM   1215  CD2  PHE A  76      2.780  43.376  80.872  1.00 30.54          C
ANISOU 1215  CD2  PHE A  76   4084   4422   3096    -79    128   1207       C
ATOM   1217  C    PHE A  76      1.186  44.788  85.167  1.00 32.17          C
ANISOU 1217  C    PHE A  76   4288   4262   3673    333    257    985       C
ATOM   1218  O    PHE A  76      2.199  44.857  85.870  1.00 33.20          O
ANISOU 1218  O    PHE A  76   4485   4344   3787    276    300    886       O
ATOM   1220  N    GLU A  77     -0.016  44.647  85.676  1.00 32.14          N
ANISOU 1220  N    GLU A  77   4205   4280   3727    450    273    976       N
ATOM   1221  CA   GLU A  77     -0.171  44.271  87.074  1.00 33.86          C
ANISOU 1221  CA   GLU A  77   4409   4501   3954    495    353    838       C
ATOM   1223  CB   GLU A  77     -1.243  45.118  87.751  1.00 37.44          C
ANISOU 1223  CB   GLU A  77   4832   4864   4529    651    399    821       C
ATOM   1226  CG   GLU A  77     -1.225  45.001  89.267  1.00 38.59          C
ANISOU 1226  CG   GLU A  77   5002   4996   4666    676    499    663       C
ATOM   1229  CD   GLU A  77      0.136  45.324  89.826  1.00 40.39          C
ANISOU 1229  CD   GLU A  77   5363   5139   4846    578    516    573       C
ATOM   1230  OE1  GLU A  77      0.607  46.454  89.560  1.00 41.10          O
ANISOU 1230  OE1  GLU A  77   5545   5071   5001    579    504    590       O
ATOM   1231  OE2  GLU A  77      0.739  44.448  90.511  1.00 41.39          O
ANISOU 1231  OE2  GLU A  77   5498   5356   4875    493    533    496       O
ATOM   1232  C    GLU A  77     -0.538  42.798  87.187  1.00 32.58          C
ANISOU 1232  C    GLU A  77   4158   4509   3710    453    357    810       C
ATOM   1233  O    GLU A  77     -1.537  42.356  86.606  1.00 30.66          O
ANISOU 1233  O    GLU A  77   3817   4363   3469    479    321    882       O
ATOM   1235  N    ILE A  78      0.247  42.061  87.983  1.00 32.80          N
ANISOU 1235  N    ILE A  78   4221   4567   3674    385    394    711       N
ATOM   1236  CA   ILE A  78     -0.013  40.658  88.267  1.00 32.17          C
ANISOU 1236  CA   ILE A  78   4082   4611   3530    343    401    680       C
ATOM   1238  CB   ILE A  78      1.144  39.917  89.004  1.00 35.15          C
ANISOU 1238  CB   ILE A  78   4512   4996   3846    265    417    599       C
ATOM   1240  CG1  ILE A  78      2.490  40.514  88.694  1.00 37.61          C
ANISOU 1240  CG1  ILE A  78   4896   5239   4154    209    399    587       C
ATOM   1243  CD1  ILE A  78      3.566  39.515  88.868  1.00 38.45          C
ANISOU 1243  CD1  ILE A  78   5006   5393   4211    135    389    545       C
ATOM   1247  CG2  ILE A  78      1.154  38.400  88.582  1.00 34.89          C
ANISOU 1247  CG2  ILE A  78   4434   5064   3759    199    393    608       C
ATOM   1251  C    ILE A  78     -1.210  40.502  89.183  1.00 29.43          C
ANISOU 1251  C    ILE A  78   3666   4307   3211    419    454    652       C
ATOM   1252  O    ILE A  78     -1.377  41.215  90.153  1.00 31.03          O
ANISOU 1252  O    ILE A  78   3895   4446   3449    483    515    588       O
ATOM   1254  N    ILE A  79     -2.013  39.518  88.876  1.00 27.25          N
ANISOU 1254  N    ILE A  79   3299   4146   2907    395    437    688       N
ATOM   1255  CA   ILE A  79     -3.133  39.155  89.698  1.00 27.32          C
ANISOU 1255  CA   ILE A  79   3224   4230   2927    435    492    667       C
ATOM   1257  CB   ILE A  79     -4.463  39.464  88.988  1.00 27.34          C
ANISOU 1257  CB   ILE A  79   3095   4298   2996    507    465    752       C
ATOM   1259  CG1  ILE A  79     -4.508  40.982  88.680  1.00 28.36          C
ANISOU 1259  CG1  ILE A  79   3244   4305   3228    627    458    787       C
ATOM   1262  CD1  ILE A  79     -5.606  41.394  87.959  1.00 29.36          C
```

FIG. 18 (continued)

| | | | | | | | | | | | | | |
|---|---|---|---|---|---|---|---|---|---|---|---|---|---|
| ANISOU | 1262 | CD1 | ILE | A | 79 | 3249 | 4476 | 3432 | 710 | 412 | 889 | | C |
| ATOM | 1266 | CG2 | ILE | A | 79 | -5.677 | 38.964 | 89.866 | 1.00 | 25.69 | | | C |
| ANISOU | 1266 | CG2 | ILE | A | 79 | 2766 | 4199 | 2794 | 533 | 536 | 726 | | C |
| ATOM | 1270 | C | ILE | A | 79 | -2.969 | 37.684 | 90.137 | 1.00 | 26.09 | | | C |
| ANISOU | 1270 | C | ILE | A | 79 | 3070 | 4155 | 2689 | 330 | 496 | 640 | | C |
| ATOM | 1271 | O | ILE | A | 79 | -3.153 | 37.383 | 91.287 | 1.00 | 25.54 | | | O |
| ANISOU | 1271 | O | ILE | A | 79 | 3004 | 4110 | 2589 | 325 | 556 | 590 | | O |
| ATOM | 1273 | N | GLU | A | 80 | -2.603 | 36.797 | 89.205 | 1.00 | 27.04 | | | N |
| ANISOU | 1273 | N | GLU | A | 80 | 3197 | 4306 | 2771 | 245 | 434 | 673 | | N |
| ATOM | 1274 | CA | GLU | A | 80 | -2.247 | 35.410 | 89.501 | 1.00 | 25.71 | | | C |
| ANISOU | 1274 | CA | GLU | A | 80 | 3055 | 4167 | 2548 | 151 | 429 | 649 | | C |
| ATOM | 1276 | CB | GLU | A | 80 | -1.877 | 34.695 | 88.187 | 1.00 | 26.30 | | | C |
| ANISOU | 1276 | CB | GLU | A | 80 | 3139 | 4256 | 2598 | 75 | 369 | 668 | | C |
| ATOM | 1279 | CG | GLU | A | 80 | -1.644 | 33.183 | 88.331 | 1.00 | 26.98 | | | C |
| ANISOU | 1279 | CG | GLU | A | 80 | 3253 | 4345 | 2653 | -14 | 363 | 641 | | C |
| ATOM | 1282 | CD | GLU | A | 80 | -2.775 | 32.428 | 89.021 | 1.00 | 26.25 | | | C |
| ANISOU | 1282 | CD | GLU | A | 80 | 3105 | 4318 | 2551 | -55 | 384 | 662 | | C |
| ATOM | 1283 | OE1 | GLU | A | 80 | -3.686 | 31.964 | 88.326 | 1.00 | 27.76 | | | O |
| ANISOU | 1283 | OE1 | GLU | A | 80 | 3231 | 4582 | 2733 | -113 | 357 | 691 | | O |
| ATOM | 1284 | OE2 | GLU | A | 80 | -2.749 | 32.242 | 90.268 | 1.00 | 29.66 | | | O |
| ANISOU | 1284 | OE2 | GLU | A | 80 | 3559 | 4738 | 2972 | -49 | 424 | 652 | | O |
| ATOM | 1285 | C | GLU | A | 80 | -1.040 | 35.329 | 90.445 | 1.00 | 25.80 | | | C |
| ANISOU | 1285 | C | GLU | A | 80 | 3160 | 4108 | 2535 | 140 | 447 | 593 | | C |
| ATOM | 1286 | O | GLU | A | 80 | -0.112 | 36.125 | 90.330 | 1.00 | 28.39 | | | O |
| ANISOU | 1286 | O | GLU | A | 80 | 3543 | 4369 | 2877 | 163 | 439 | 571 | | O |
| ATOM | 1288 | N | GLY | A | 81 | -1.014 | 34.339 | 91.326 | 1.00 | 24.70 | | | N |
| ANISOU | 1288 | N | GLY | A | 81 | 3038 | 3988 | 2357 | 90 | 460 | 583 | | N |
| ATOM | 1289 | CA | GLY | A | 81 | 0.128 | 34.155 | 92.217 | 1.00 | 24.30 | | | C |
| ANISOU | 1289 | CA | GLY | A | 81 | 3066 | 3889 | 2278 | 73 | 453 | 552 | | C |
| ATOM | 1292 | C | GLY | A | 81 | -0.065 | 34.738 | 93.590 | 1.00 | 26.10 | | | C |
| ANISOU | 1292 | C | GLY | A | 81 | 3319 | 4134 | 2464 | 92 | 505 | 519 | | C |
| ATOM | 1293 | O | GLY | A | 81 | 0.738 | 34.510 | 94.488 | 1.00 | 27.55 | | | O |
| ANISOU | 1293 | O | GLY | A | 81 | 3564 | 4305 | 2601 | 60 | 489 | 505 | | O |
| ATOM | 1295 | N | ARG | A | 82 | -1.118 | 35.518 | 93.748 | 1.00 | 27.05 | | | N |
| ANISOU | 1295 | N | ARG | A | 82 | 3389 | 4289 | 2598 | 146 | 566 | 504 | | N |
| ATOM | 1296 | CA | ARG | A | 82 | -1.416 | 36.204 | 94.995 | 1.00 | 28.37 | | | C |
| ANISOU | 1296 | CA | ARG | A | 82 | 3579 | 4477 | 2723 | 171 | 642 | 443 | | C |
| ATOM | 1298 | CB | ARG | A | 82 | -2.036 | 37.567 | 94.725 | 1.00 | 30.64 | | | C |
| ANISOU | 1298 | CB | ARG | A | 82 | 3832 | 4728 | 3083 | 278 | 696 | 404 | | C |
| ATOM | 1301 | CG | ARG | A | 82 | -1.248 | 38.495 | 93.789 | 1.00 | 31.98 | | | C |
| ANISOU | 1301 | CG | ARG | A | 82 | 4045 | 4786 | 3321 | 318 | 644 | 408 | | C |
| ATOM | 1304 | CD | ARG | A | 82 | -1.879 | 39.904 | 93.894 | 1.00 | 32.65 | | | C |
| ANISOU | 1304 | CD | ARG | A | 82 | 4120 | 4803 | 3482 | 430 | 708 | 363 | | C |
| ATOM | 1307 | NE | ARG | A | 82 | -1.185 | 40.812 | 93.014 | 1.00 | 32.54 | | | N |
| ANISOU | 1307 | NE | ARG | A | 82 | 4159 | 4672 | 3534 | 454 | 657 | 386 | | N |
| ATOM | 1309 | CZ | ARG | A | 82 | -0.297 | 41.733 | 93.386 | 1.00 | 32.86 | | | C |
| ANISOU | 1309 | CZ | ARG | A | 82 | 4304 | 4602 | 3580 | 445 | 664 | 322 | | C |
| ATOM | 1310 | NH1 | ARG | A | 82 | 0.042 | 41.898 | 94.651 | 1.00 | 35.06 | | | N |
| ANISOU | 1310 | NH1 | ARG | A | 82 | 4652 | 4877 | 3792 | 412 | 716 | 220 | | N |
| ATOM | 1313 | NH2 | ARG | A | 82 | 0.286 | 42.486 | 92.460 | 1.00 | 31.75 | | | N |
| ANISOU | 1313 | NH2 | ARG | A | 82 | 4205 | 4362 | 3498 | 447 | 614 | 366 | | N |
| ATOM | 1316 | C | ARG | A | 82 | -2.475 | 35.429 | 95.705 | 1.00 | 28.05 | | | C |
| ANISOU | 1316 | C | ARG | A | 82 | 3484 | 4544 | 2630 | 129 | 697 | 463 | | C |
| ATOM | 1317 | O | ARG | A | 82 | -3.285 | 34.760 | 95.071 | 1.00 | 29.62 | | | O |
| ANISOU | 1317 | O | ARG | A | 82 | 3601 | 4796 | 2858 | 109 | 687 | 519 | | O |
| ATOM | 1319 | N | ASP | A | 83 | -2.514 | 35.598 | 97.017 | 1.00 | 28.35 | | | N |
| ANISOU | 1319 | N | ASP | A | 83 | 3565 | 4624 | 2581 | 104 | 762 | 413 | | N |
| ATOM | 1320 | CA | ASP | A | 83 | -3.654 | 35.190 | 97.838 | 1.00 | 31.75 | | | C |
| ANISOU | 1320 | CA | ASP | A | 83 | 3936 | 5177 | 2949 | 67 | 852 | 413 | | C |
| ATOM | 1322 | CB | ASP | A | 83 | -3.415 | 35.686 | 99.285 | 1.00 | 33.97 | | | C |
| ANISOU | 1322 | CB | ASP | A | 83 | 4298 | 5497 | 3111 | 38 | 928 | 328 | | C |
| ATOM | 1325 | CG | ASP | A | 83 | -4.642 | 35.701 | 100.095 | 1.00 | 39.62 | | | C |
| ANISOU | 1325 | CG | ASP | A | 83 | 4942 | 6343 | 3768 | 26 | 1062 | 291 | | C |
| ATOM | 1326 | OD1 | ASP | A | 83 | -4.828 | 34.764 | 100.916 | 1.00 | 43.86 | | | O |
| ANISOU | 1326 | OD1 | ASP | A | 83 | 5500 | 6981 | 4185 | -94 | 1078 | 340 | | O |
| ATOM | 1327 | OD2 | ASP | A | 83 | -5.418 | 36.655 | 99.925 | 1.00 | 41.34 | | | O |
| ANISOU | 1327 | OD2 | ASP | A | 83 | 5079 | 6564 | 4062 | 138 | 1154 | 217 | | O |
| ATOM | 1328 | C | ASP | A | 83 | -4.937 | 35.752 | 97.216 | 1.00 | 29.35 | | | C |
| ANISOU | 1328 | C | ASP | A | 83 | 3493 | 4917 | 2740 | 159 | 917 | 405 | | C |
| ATOM | 1329 | O | ASP | A | 83 | -4.970 | 36.904 | 96.801 | 1.00 | 28.64 | | | O |
| ANISOU | 1329 | O | ASP | A | 83 | 3389 | 4760 | 2735 | 272 | 935 | 357 | | O |
| ATOM | 1331 | N | ARG | A | 84 | -5.980 | 34.922 | 97.126 | 1.00 | 31.59 | | | N |
| ANISOU | 1331 | N | ARG | A | 84 | 3671 | 5312 | 3018 | 106 | 940 | 463 | | N |
| ATOM | 1332 | CA | ARG | A | 84 | -7.229 | 35.297 | 96.445 | 1.00 | 32.89 | | | C |
| ANISOU | 1332 | CA | ARG | A | 84 | 3671 | 5546 | 3281 | 183 | 977 | 479 | | C |
| ATOM | 1334 | CB | ARG | A | 84 | -8.252 | 34.137 | 96.428 | 1.00 | 36.23 | | | C |
| ANISOU | 1334 | CB | ARG | A | 84 | 3983 | 6108 | 3675 | 71 | 988 | 551 | | C |
| ATOM | 1337 | CG | ARG | A | 84 | -8.340 | 33.474 | 95.063 | 1.00 | 36.13 | | | C |
| ANISOU | 1337 | CG | ARG | A | 84 | 3927 | 6078 | 3721 | 27 | 869 | 635 | | C |

FIG. 18 (continued)

| | | | | | | | | | | | | | |
|---|---|---|---|---|---|---|---|---|---|---|---|---|---|
| ATOM | 1340 | CD | ARG | A | 84 | -9.437 | 32.463 | 95.010 | 1.00 | 37.46 | | | C |
| ANISOU | 1340 | CD | ARG | A | 84 | 3979 | 6383 | 3872 | -91 | 880 | 696 | | C |
| ATOM | 1343 | NE | ARG | A | 84 | -10.636 | 32.982 | 94.346 | 1.00 | 37.69 | | | N |
| ANISOU | 1343 | NE | ARG | A | 84 | 3810 | 6520 | 3990 | -21 | 892 | 719 | | N |
| ATOM | 1345 | CZ | ARG | A | 84 | -10.858 | 32.908 | 93.044 | 1.00 | 36.67 | | | C |
| ANISOU | 1345 | CZ | ARG | A | 84 | 3618 | 6394 | 3921 | -21 | 787 | 775 | | C |
| ATOM | 1346 | NH1 | ARG | A | 84 | -9.997 | 32.317 | 92.221 | 1.00 | 35.58 | | | N |
| ANISOU | 1346 | NH1 | ARG | A | 84 | 3600 | 6157 | 3762 | -92 | 679 | 797 | | N |
| ATOM | 1349 | NH2 | ARG | A | 84 | -11.977 | 33.393 | 92.562 | 1.00 | 37.40 | | | N |
| ANISOU | 1349 | NH2 | ARG | A | 84 | 3516 | 6602 | 4092 | 44 | 789 | 811 | | N |
| ATOM | 1352 | C | ARG | A | 84 | -7.914 | 36.537 | 96.984 | 1.00 | 32.60 | | | C |
| ANISOU | 1352 | C | ARG | A | 84 | 3565 | 5532 | 3291 | 315 | 1101 | 388 | | C |
| ATOM | 1353 | O | ARG | A | 84 | -8.390 | 37.347 | 96.197 | 1.00 | 32.12 | | | O |
| ANISOU | 1353 | O | ARG | A | 84 | 3414 | 5437 | 3355 | 440 | 1091 | 396 | | O |
| ATOM | 1355 | N | THR | A | 85 | -7.977 | 36.698 | 98.309 | 1.00 | 30.52 | | | N |
| ANISOU | 1355 | N | THR | A | 85 | 3345 | 5322 | 2929 | 289 | 1218 | 301 | | N |
| ATOM | 1356 | CA | THR | A | 85 | -8.495 | 37.946 | 98.862 | 1.00 | 34.33 | | | C |
| ANISOU | 1356 | CA | THR | A | 85 | 3786 | 5798 | 3460 | 423 | 1353 | 178 | | C |
| ATOM | 1358 | CB | THR | A | 85 | -8.484 | 37.956 | 100.403 | 1.00 | 37.53 | | | C |
| ANISOU | 1358 | CB | THR | A | 85 | 4264 | 6289 | 3709 | 352 | 1488 | 69 | | C |
| ATOM | 1360 | OG1 | THR | A | 85 | -9.124 | 36.776 | 100.904 | 1.00 | 40.39 | | | O |
| ANISOU | 1360 | OG1 | THR | A | 85 | 4559 | 6824 | 3963 | 211 | 1524 | 136 | | O |
| ATOM | 1362 | CG2 | THR | A | 85 | -9.276 | 39.150 | 100.899 | 1.00 | 40.37 | | | C |
| ANISOU | 1362 | CG2 | THR | A | 85 | 4547 | 6658 | 4135 | 500 | 1657 | -76 | | C |
| ATOM | 1366 | C | THR | A | 85 | -7.710 | 39.158 | 98.361 | 1.00 | 33.08 | | | C |
| ANISOU | 1366 | C | THR | A | 85 | 3720 | 5449 | 3398 | 543 | 1307 | 127 | | C |
| ATOM | 1367 | O | THR | A | 85 | -8.283 | 40.169 | 97.955 | 1.00 | 33.53 | | | O |
| ANISOU | 1367 | O | THR | A | 85 | 3698 | 5447 | 3595 | 699 | 1350 | 95 | | O |
| ATOM | 1369 | N | MET | A | 86 | -6.389 | 39.044 | 98.359 | 1.00 | 33.51 | | | N |
| ANISOU | 1369 | N | MET | A | 86 | 3937 | 5406 | 3390 | 469 | 1215 | 132 | | N |
| ATOM | 1370 | CA | MET | A | 86 | -5.556 | 40.156 | 97.935 | 1.00 | 33.43 | | | C |
| ANISOU | 1370 | CA | MET | A | 86 | 4024 | 5221 | 3456 | 547 | 1172 | 88 | | C |
| ATOM | 1372 | CB | MET | A | 86 | -4.090 | 39.935 | 98.325 | 1.00 | 34.23 | | | C |
| ANISOU | 1372 | CB | MET | A | 86 | 4291 | 5264 | 3452 | 432 | 1095 | 72 | | C |
| ATOM | 1375 | CG | MET | A | 86 | -3.173 | 41.133 | 98.013 | 1.00 | 35.36 | | | C |
| ANISOU | 1375 | CG | MET | A | 86 | 4541 | 5233 | 3661 | 482 | 1061 | 15 | | C |
| ATOM | 1378 | SD | MET | A | 86 | -3.793 | 42.675 | 98.790 | 1.00 | 40.15 | | | S |
| ANISOU | 1378 | SD | MET | A | 86 | 5178 | 5750 | 4328 | 608 | 1219 | -159 | | S |
| ATOM | 1379 | CE | MET | A | 86 | -3.531 | 43.774 | 97.412 | 1.00 | 40.55 | | | C |
| ANISOU | 1379 | CE | MET | A | 86 | 5239 | 5596 | 4571 | 724 | 1140 | -99 | | C |
| ATOM | 1383 | C | MET | A | 86 | -5.687 | 40.396 | 96.432 | 1.00 | 31.58 | | | C |
| ANISOU | 1383 | C | MET | A | 86 | 3720 | 4915 | 3364 | 624 | 1072 | 194 | | C |
| ATOM | 1384 | O | MET | A | 86 | -5.658 | 41.534 | 96.014 | 1.00 | 32.98 | | | O |
| ANISOU | 1384 | O | MET | A | 86 | 3913 | 4965 | 3652 | 738 | 1075 | 170 | | O |
| ATOM | 1386 | N | ALA | A | 87 | -5.781 | 39.327 | 95.631 | 1.00 | 30.33 | | | N |
| ANISOU | 1386 | N | ALA | A | 87 | 3502 | 4830 | 3193 | 551 | 979 | 310 | | N |
| ATOM | 1387 | CA | ALA | A | 87 | -6.031 | 39.433 | 94.181 | 1.00 | 29.64 | | | C |
| ANISOU | 1387 | CA | ALA | A | 87 | 3340 | 4716 | 3206 | 598 | 882 | 415 | | C |
| ATOM | 1389 | CB | ALA | A | 87 | -6.051 | 38.041 | 93.501 | 1.00 | 26.74 | | | C |
| ANISOU | 1389 | CB | ALA | A | 87 | 2935 | 4442 | 2785 | 474 | 795 | 508 | | C |
| ATOM | 1393 | C | ALA | A | 87 | -7.304 | 40.220 | 93.857 | 1.00 | 30.57 | | | C |
| ANISOU | 1393 | C | ALA | A | 87 | 3306 | 4858 | 3453 | 745 | 928 | 434 | | C |
| ATOM | 1394 | O | ALA | A | 87 | -7.275 | 41.092 | 92.977 | 1.00 | 30.95 | | | O |
| ANISOU | 1394 | O | ALA | A | 87 | 3347 | 4806 | 3608 | 840 | 871 | 485 | | O |
| ATOM | 1396 | N | TRP | A | 88 | -8.395 | 39.950 | 94.585 | 1.00 | 32.58 | | | N |
| ANISOU | 1396 | N | TRP | A | 88 | 3434 | 5243 | 3702 | 765 | 1032 | 400 | | N |
| ATOM | 1397 | CA | TRP | A | 88 | -9.641 | 40.724 | 94.437 | 1.00 | 35.11 | | | C |
| ANISOU | 1397 | CA | TRP | A | 88 | 3580 | 5598 | 4163 | 927 | 1095 | 404 | | C |
| ATOM | 1399 | CB | TRP | A | 88 | -10.846 | 40.059 | 95.131 | 1.00 | 38.65 | | | C |
| ANISOU | 1399 | CB | TRP | A | 88 | 3856 | 6249 | 4580 | 900 | 1203 | 385 | | C |
| ATOM | 1402 | CG | TRP | A | 88 | -11.446 | 38.916 | 94.345 | 1.00 | 38.41 | | | C |
| ANISOU | 1402 | CG | TRP | A | 88 | 3698 | 6370 | 4527 | 787 | 1107 | 514 | | C |
| ATOM | 1403 | CD1 | TRP | A | 88 | -11.518 | 37.597 | 94.733 | 1.00 | 37.92 | | | C |
| ANISOU | 1403 | CD1 | TRP | A | 88 | 3640 | 6433 | 4337 | 605 | 1111 | 534 | | C |
| ATOM | 1405 | NE1 | TRP | A | 88 | -12.125 | 36.851 | 93.741 | 1.00 | 38.39 | | | N |
| ANISOU | 1405 | NE1 | TRP | A | 88 | 3576 | 6593 | 4417 | 530 | 1007 | 648 | | N |
| ATOM | 1407 | CE2 | TRP | A | 88 | -12.461 | 37.677 | 92.700 | 1.00 | 38.38 | | | C |
| ANISOU | 1407 | CE2 | TRP | A | 88 | 3483 | 6557 | 4544 | 663 | 928 | 713 | | C |
| ATOM | 1408 | CD2 | TRP | A | 88 | -12.065 | 38.986 | 93.046 | 1.00 | 38.67 | | | C |
| ANISOU | 1408 | CD2 | TRP | A | 88 | 3589 | 6442 | 4660 | 833 | 988 | 640 | | C |
| ATOM | 1409 | CE3 | TRP | A | 88 | -12.296 | 40.036 | 92.118 | 1.00 | 40.65 | | | C |
| ANISOU | 1409 | CE3 | TRP | A | 88 | 3778 | 6610 | 5059 | 993 | 915 | 710 | | C |
| ATOM | 1411 | CZ3 | TRP | A | 88 | -12.935 | 39.746 | 90.925 | 1.00 | 40.21 | | | C |
| ANISOU | 1411 | CZ3 | TRP | A | 88 | 3580 | 6652 | 5045 | 974 | 782 | 851 | | C |
| ATOM | 1413 | CH2 | TRP | A | 88 | -13.322 | 38.428 | 90.614 | 1.00 | 40.09 | | | C |
| ANISOU | 1413 | CH2 | TRP | A | 88 | 3494 | 6805 | 4932 | 791 | 726 | 905 | | C |
| ATOM | 1415 | CZ2 | TRP | A | 88 | -13.098 | 37.385 | 91.487 | 1.00 | 39.54 | | | C |
| ANISOU | 1415 | CZ2 | TRP | A | 88 | 3494 | 6793 | 4737 | 636 | 801 | 835 | | C |
| ATOM | 1417 | C | TRP | A | 88 | -9.483 | 42.190 | 94.903 | 1.00 | 36.45 | | | C |

FIG. 18 (continued)

| | | | | | | | | | | | | | |
|---|---|---|---|---|---|---|---|---|---|---|---|---|---|
| ANISOU | 1417 | C | TRP | A | 88 | 3816 | 5602 | 4433 | 1089 | 1182 | 296 | | C |
| ATOM | 1418 | O | TRP | A | 88 | -10.014 | 43.085 | 94.261 | 1.00 | 33.89 | | | O |
| ANISOU | 1418 | O | TRP | A | 88 | 3407 | 5200 | 4268 | 1247 | 1162 | 342 | | O |
| ATOM | 1420 | N | THR | A | 89 | -8.753 | 42.427 | 95.994 | 1.00 | 35.46 | | | N |
| ANISOU | 1420 | N | THR | A | 89 | 3844 | 5414 | 4214 | 1044 | 1269 | 158 | | N |
| ATOM | 1421 | CA | THR | A | 89 | -8.412 | 43.800 | 96.407 | 1.00 | 38.05 | | | C |
| ANISOU | 1421 | CA | THR | A | 89 | 4279 | 5555 | 4625 | 1165 | 1341 | 37 | | C |
| ATOM | 1423 | CB | THR | A | 89 | -7.577 | 43.786 | 97.724 | 1.00 | 37.77 | | | C |
| ANISOU | 1423 | CB | THR | A | 89 | 4417 | 5506 | 4428 | 1053 | 1426 | -120 | | C |
| ATOM | 1425 | OG1 | THR | A | 89 | -8.433 | 43.412 | 98.797 | 1.00 | 39.86 | | | O |
| ANISOU | 1425 | OG1 | THR | A | 89 | 4596 | 5935 | 4615 | 1042 | 1580 | -213 | | O |
| ATOM | 1427 | CG2 | THR | A | 89 | -6.952 | 45.155 | 98.032 | 1.00 | 39.26 | | | C |
| ANISOU | 1427 | CG2 | THR | A | 89 | 4760 | 5474 | 4683 | 1129 | 1471 | -248 | | C |
| ATOM | 1431 | C | THR | A | 89 | -7.640 | 44.596 | 95.326 | 1.00 | 36.39 | | | C |
| ANISOU | 1431 | C | THR | A | 89 | 4166 | 5145 | 4517 | 1210 | 1213 | 118 | | C |
| ATOM | 1432 | O | THR | A | 89 | -7.857 | 45.781 | 95.154 | 1.00 | 35.42 | | | O |
| ANISOU | 1432 | O | THR | A | 89 | 4054 | 4860 | 4544 | 1361 | 1242 | 90 | | O |
| ATOM | 1434 | N | VAL | A | 90 | -6.742 | 43.926 | 94.607 | 1.00 | 36.12 | | | N |
| ANISOU | 1434 | N | VAL | A | 90 | 4203 | 5120 | 4402 | 1075 | 1077 | 218 | | N |
| ATOM | 1435 | CA | VAL | A | 90 | -5.989 | 44.539 | 93.523 | 1.00 | 36.31 | | | C |
| ANISOU | 1435 | CA | VAL | A | 90 | 4311 | 4994 | 4493 | 1083 | 958 | 308 | | C |
| ATOM | 1437 | CB | VAL | A | 90 | -4.743 | 43.682 | 93.123 | 1.00 | 33.77 | | | C |
| ANISOU | 1437 | CB | VAL | A | 90 | 4090 | 4703 | 4039 | 904 | 855 | 355 | | C |
| ATOM | 1439 | CG1 | VAL | A | 90 | -4.062 | 44.227 | 91.818 | 1.00 | 33.91 | | | C |
| ANISOU | 1439 | CG1 | VAL | A | 90 | 4166 | 4606 | 4112 | 895 | 736 | 467 | | C |
| ATOM | 1443 | CG2 | VAL | A | 90 | -3.772 | 43.620 | 94.264 | 1.00 | 32.32 | | | C |
| ANISOU | 1443 | CG2 | VAL | A | 90 | 4045 | 4493 | 3744 | 809 | 906 | 226 | | C |
| ATOM | 1447 | C | VAL | A | 90 | -6.930 | 44.820 | 92.336 | 1.00 | 37.86 | | | C |
| ANISOU | 1447 | C | VAL | A | 90 | 4359 | 5200 | 4825 | 1198 | 883 | 458 | | C |
| ATOM | 1448 | O | VAL | A | 90 | -6.987 | 45.943 | 91.848 | 1.00 | 39.28 | | | O |
| ANISOU | 1448 | O | VAL | A | 90 | 4564 | 5218 | 5142 | 1317 | 858 | 498 | | O |
| ATOM | 1450 | N | VAL | A | 91 | -7.722 | 43.825 | 91.937 | 1.00 | 38.11 | | | N |
| ANISOU | 1450 | N | VAL | A | 91 | 4235 | 5421 | 4824 | 1161 | 846 | 542 | | N |
| ATOM | 1451 | CA | VAL | A | 91 | -8.709 | 44.001 | 90.871 | 1.00 | 37.70 | | | C |
| ANISOU | 1451 | CA | VAL | A | 91 | 4019 | 5421 | 4883 | 1255 | 763 | 689 | | C |
| ATOM | 1453 | CB | VAL | A | 91 | -9.583 | 42.706 | 90.606 | 1.00 | 36.70 | | | C |
| ANISOU | 1453 | CB | VAL | A | 91 | 3720 | 5536 | 4688 | 1166 | 730 | 756 | | C |
| ATOM | 1455 | CG1 | VAL | A | 91 | -10.783 | 43.013 | 89.669 | 1.00 | 37.26 | | | C |
| ANISOU | 1455 | CG1 | VAL | A | 91 | 3585 | 5687 | 4887 | 1278 | 649 | 901 | | C |
| ATOM | 1459 | CG2 | VAL | A | 91 | -8.723 | 41.528 | 90.063 | 1.00 | 31.69 | | | C |
| ANISOU | 1459 | CG2 | VAL | A | 91 | 3179 | 4966 | 3897 | 961 | 637 | 794 | | C |
| ATOM | 1463 | C | VAL | A | 91 | -9.630 | 45.182 | 91.186 | 1.00 | 42.11 | | | C |
| ANISOU | 1463 | C | VAL | A | 91 | 4481 | 5888 | 5630 | 1478 | 842 | 663 | | C |
| ATOM | 1464 | O | VAL | A | 91 | -9.904 | 45.981 | 90.301 | 1.00 | 42.86 | | | O |
| ANISOU | 1464 | O | VAL | A | 91 | 4539 | 5887 | 5859 | 1592 | 756 | 783 | | O |
| ATOM | 1466 | N | ASN | A | 92 | -10.102 | 45.299 | 92.433 | 1.00 | 41.94 | | | N |
| ANISOU | 1466 | N | ASN | A | 92 | 4421 | 5893 | 5620 | 1542 | 1008 | 507 | | N |
| ATOM | 1467 | CA | ASN | A | 92 | -11.017 | 46.388 | 92.798 | 1.00 | 45.47 | | | C |
| ANISOU | 1467 | CA | ASN | A | 92 | 4764 | 6252 | 6261 | 1772 | 1112 | 453 | | C |
| ATOM | 1469 | CB | ASN | A | 92 | -11.642 | 46.146 | 94.167 | 1.00 | 47.13 | | | C |
| ANISOU | 1469 | CB | ASN | A | 92 | 4899 | 6579 | 6430 | 1795 | 1311 | 274 | | C |
| ATOM | 1472 | CG | ASN | A | 92 | -12.623 | 45.000 | 94.153 | 1.00 | 48.73 | | | C |
| ANISOU | 1472 | CG | ASN | A | 92 | 4881 | 7060 | 6571 | 1727 | 1318 | 337 | | C |
| ATOM | 1473 | OD1 | ASN | A | 92 | -13.247 | 44.726 | 93.130 | 1.00 | 50.39 | | | O |
| ANISOU | 1473 | OD1 | ASN | A | 92 | 4933 | 7364 | 6850 | 1749 | 1195 | 503 | | O |
| ATOM | 1474 | ND2 | ASN | A | 92 | -12.761 | 44.312 | 95.289 | 1.00 | 49.41 | | | N |
| ANISOU | 1474 | ND2 | ASN | A | 92 | 4964 | 7291 | 6519 | 1624 | 1457 | 212 | | N |
| ATOM | 1477 | C | ASN | A | 92 | -10.354 | 47.764 | 92.735 | 1.00 | 46.67 | | | C |
| ANISOU | 1477 | C | ASN | A | 92 | 5088 | 6110 | 6534 | 1881 | 1113 | 413 | | C |
| ATOM | 1478 | O | ASN | A | 92 | -10.917 | 48.694 | 92.164 | 1.00 | 47.73 | | | O |
| ANISOU | 1478 | O | ASN | A | 92 | 5150 | 6118 | 6867 | 2066 | 1078 | 497 | | O |
| ATOM | 1480 | N | SER | A | 93 | -9.152 | 47.880 | 93.294 | 1.00 | 46.31 | | | N |
| ANISOU | 1480 | N | SER | A | 93 | 5268 | 5955 | 6374 | 1757 | 1142 | 298 | | N |
| ATOM | 1481 | CA | SER | A | 93 | -8.383 | 49.115 | 93.197 | 1.00 | 48.88 | | | C |
| ANISOU | 1481 | CA | SER | A | 93 | 5779 | 5999 | 6794 | 1810 | 1130 | 262 | | C |
| ATOM | 1483 | CB | SER | A | 93 | -7.008 | 48.973 | 93.854 | 1.00 | 48.97 | | | C |
| ANISOU | 1483 | CB | SER | A | 93 | 6013 | 5958 | 6636 | 1621 | 1148 | 139 | | C |
| ATOM | 1486 | OG | SER | A | 93 | -6.323 | 50.223 | 93.856 | 1.00 | 52.31 | | | O |
| ANISOU | 1486 | OG | SER | A | 93 | 6615 | 6106 | 7156 | 1658 | 1150 | 87 | | O |
| ATOM | 1488 | C | SER | A | 93 | -8.215 | 49.513 | 91.743 | 1.00 | 49.95 | | | C |
| ANISOU | 1488 | C | SER | A | 93 | 5918 | 6039 | 7021 | 1833 | 954 | 483 | | C |
| ATOM | 1489 | O | SER | A | 93 | -8.478 | 50.658 | 91.376 | 1.00 | 51.74 | | | O |
| ANISOU | 1489 | O | SER | A | 93 | 6163 | 6056 | 7438 | 1994 | 937 | 533 | | O |
| ATOM | 1491 | N | ILE | A | 94 | -7.794 | 48.561 | 90.912 | 1.00 | 47.72 | | | N |
| ANISOU | 1491 | N | ILE | A | 94 | 5622 | 5907 | 6603 | 1672 | 824 | 615 | | N |
| ATOM | 1492 | CA | ILE | A | 94 | -7.625 | 48.813 | 89.483 | 1.00 | 48.30 | | | C |
| ANISOU | 1492 | CA | ILE | A | 94 | 5699 | 5936 | 6718 | 1658 | 656 | 828 | | C |
| ATOM | 1494 | CB | ILE | A | 94 | -7.089 | 47.550 | 88.721 | 1.00 | 46.53 | | | C |
| ANISOU | 1494 | CB | ILE | A | 94 | 5468 | 5910 | 6300 | 1449 | 548 | 917 | | C |

FIG. 18 (continued)

```
ATOM   1496  CG1 ILE A  94      -5.640  47.272  89.152  1.00 44.45          C
ANISOU 1496  CG1 ILE A  94    5395   5600   5893   1275    572    810       C
ATOM   1499  CD1 ILE A  94      -4.988  46.052  88.532  1.00 42.38          C
ANISOU 1499  CD1 ILE A  94    5140   5502   5461   1087    493    862       C
ATOM   1503  CG2 ILE A  94      -7.172  47.757  87.197  1.00 47.27          C
ANISOU 1503  CG2 ILE A  94    5534   6009   6418   1436    381   1141       C
ATOM   1507  C   ILE A  94      -8.897  49.357  88.832  1.00 51.10          C
ANISOU 1507  C   ILE A  94    5871   6284   7261   1859    601    975       C
ATOM   1508  O   ILE A  94      -8.844  50.353  88.120  1.00 52.51          O
ANISOU 1508  O   ILE A  94    6101   6279   7572   1949    518   1100       O
ATOM   1510  N   CYS A  95     -10.034  48.712  89.072  1.00 51.34          N
ANISOU 1510  N   CYS A  95    5683   6517   7308   1924    640    971       N
ATOM   1511  CA  CYS A  95     -11.293  49.150  88.489  1.00 53.81          C
ANISOU 1511  CA  CYS A  95    5781   6860   7805   2117    581   1116       C
ATOM   1513  CB  CYS A  95     -12.411  48.139  88.772  1.00 53.69          C
ANISOU 1513  CB  CYS A  95    5514   7132   7753   2115    623   1103       C
ATOM   1516  SG  CYS A  95     -12.131  46.537  87.963  1.00 50.24          S
ANISOU 1516  SG  CYS A  95    5054   6966   7068   1833    488   1203       S
ATOM   1518  C   CYS A  95     -11.666  50.539  89.005  1.00 58.16          C
ANISOU 1518  C   CYS A  95    6346   7155   8597   2367    676   1050       C
ATOM   1519  O   CYS A  95     -12.103  51.382  88.233  1.00 58.50          O
ANISOU 1519  O   CYS A  95    6336   7070   8822   2523    575   1216       O
ATOM   1521  N   ASN A  96     -11.459  50.775  90.303  1.00 60.33          N
ANISOU 1521  N   ASN A  96    6705   7346   8870   2397    868    808       N
ATOM   1522  CA  ASN A  96     -11.687  52.096  90.909  1.00 64.36          C
ANISOU 1522  CA  ASN A  96    7271   7584   9600   2619    988    691       C
ATOM   1524  CB  ASN A  96     -11.307  52.094  92.408  1.00 64.57          C
ANISOU 1524  CB  ASN A  96    7418   7581   9537   2573   1204    392       C
ATOM   1527  CG  ASN A  96     -12.500  51.921  93.330  1.00 66.64          C
ANISOU 1527  CG  ASN A  96    7466   7988   9865   2722   1388    247       C
ATOM   1528  OD1 ASN A  96     -12.789  50.816  93.802  1.00 65.86          O
ANISOU 1528  OD1 ASN A  96    7260   8167   9599   2599   1444    198       O
ATOM   1529  ND2 ASN A  96     -13.187  53.024  93.617  1.00 71.38          N
ANISOU 1529  ND2 ASN A  96    8009   8397  10716   2986   1494    172       N
ATOM   1532  C   ASN A  96     -10.879  53.181  90.185  1.00 65.56          C
ANISOU 1532  C   ASN A  96    7631   7428   9851   2634    876    800       C
ATOM   1533  O   ASN A  96     -11.417  54.207  89.788  1.00 67.82          O
ANISOU 1533  O   ASN A  96    7878   7511  10378   2849    841    896       O
ATOM   1535  N   THR A  97      -9.587  52.919  90.014  1.00 64.06          N
ANISOU 1535  N   THR A  97    7654   7209   9478   2402    818    794       N
ATOM   1536  CA  THR A  97      -8.648  53.883  89.457  1.00 65.08          C
ANISOU 1536  CA  THR A  97    8004   7061   9662   2360    732    873       C
ATOM   1538  CB  THR A  97      -7.213  53.463  89.781  1.00 62.77          C
ANISOU 1538  CB  THR A  97    7919   6783   9146   2095    743    766       C
ATOM   1540  OG1 THR A  97      -6.978  53.681  91.176  1.00 63.26          O
ANISOU 1540  OG1 THR A  97    8076   6771   9187   2098    921    493       O
ATOM   1542  CG2 THR A  97      -6.198  54.258  88.966  1.00 63.18          C
ANISOU 1542  CG2 THR A  97    8172   6616   9219   1998    628    893       C
ATOM   1546  C   THR A  97      -8.789  54.095  87.950  1.00 66.52          C
ANISOU 1546  C   THR A  97    8143   7231   9900   2369    524   1178       C
ATOM   1547  O   THR A  97      -8.737  55.235  87.473  1.00 70.07          O
ANISOU 1547  O   THR A  97    8685   7411  10528   2477    462   1292       O
ATOM   1549  N   THR A  98      -8.980  53.015  87.204  1.00 64.38          N
ANISOU 1549  N   THR A  98    7741   7244   9476   2250    413   1314       N
ATOM   1550  CA  THR A  98      -9.003  53.084  85.739  1.00 64.71          C
ANISOU 1550  CA  THR A  98    7759   7322   9506   2204    209   1598       C
ATOM   1552  CB  THR A  98      -8.247  51.875  85.113  1.00 61.83          C
ANISOU 1552  CB  THR A  98    7427   7203   8862   1927    130   1639       C
ATOM   1554  OG1 THR A  98      -8.883  50.648  85.496  1.00 60.42          O
ANISOU 1554  OG1 THR A  98    7071   7306   8581   1892    176   1558       O
ATOM   1556  CG2 THR A  98      -6.777  51.852  85.559  1.00 59.26          C
ANISOU 1556  CG2 THR A  98    7334   6782   8401   1738    197   1494       C
ATOM   1560  C   THR A  98     -10.425  53.146  85.170  1.00 66.84          C
ANISOU 1560  C   THR A  98    7772   7696   9929   2399    118   1776       C
ATOM   1561  O   THR A  98     -10.620  53.449  83.992  1.00 67.52          O
ANISOU 1561  O   THR A  98    7829   7779  10046   2406    -62   2032       O
ATOM   1563  N   GLY A  99     -11.420  52.856  86.002  1.00 67.98          N
ANISOU 1563  N   GLY A  99    7721   7949  10160   2548    238   1648       N
ATOM   1564  CA  GLY A  99     -12.791  52.709  85.519  1.00 69.72          C
ANISOU 1564  CA  GLY A  99    7651   8335  10504   2709    156   1805       C
ATOM   1567  C   GLY A  99     -13.000  51.466  84.659  1.00 67.84          C
ANISOU 1567  C   GLY A  99    7287   8434  10056   2512     15   1940       C
ATOM   1568  O   GLY A  99     -14.062  51.305  84.055  1.00 69.32          O
ANISOU 1568  O   GLY A  99    7236   8785  10316   2600    -97   2106       O
ATOM   1570  N   ALA A 100     -12.006  50.571  84.613  1.00 64.70          N
ANISOU 1570  N   ALA A 100    7038   8141   9403   2248     22   1862       N
ATOM   1571  CA  ALA A 100     -12.150  49.314  83.878  1.00 62.86          C
ANISOU 1571  CA  ALA A 100    6709   8209   8965   2048    -86   1946       C
ATOM   1573  CB  ALA A 100     -10.838  48.528  83.873  1.00 59.57          C
```

FIG. 18 (continued)

| | | | | | | | | | | | | | |
|---|---|---|---|---|---|---|---|---|---|---|---|---|---|
| ANISOU | 1573 | CB | ALA | A | 100 | 6501 | 7828 | 8306 | 1787 | -61 | 1841 | | C |
| ATOM | 1577 | C | ALA | A | 100 | -13.299 | 48.489 | 84.473 | 1.00 | 63.88 | | | C |
| ANISOU | 1577 | C | ALA | A | 100 | 6582 | 8577 | 9111 | 2096 | -14 | 1869 | | C |
| ATOM | 1578 | O | ALA | A | 100 | -13.678 | 48.670 | 85.639 | 1.00 | 64.76 | | | O |
| ANISOU | 1578 | O | ALA | A | 100 | 6635 | 8644 | 9325 | 2226 | 161 | 1695 | | O |
| ATOM | 1580 | N | GLU | A | 101 | -13.882 | 47.618 | 83.653 | 1.00 | 65.18 | | | N |
| ANISOU | 1580 | N | GLU | A | 101 | 6592 | 9003 | 9171 | 1981 | -146 | 1999 | | N |
| ATOM | 1581 | CA | GLU | A | 101 | -15.026 | 46.804 | 84.075 | 1.00 | 66.61 | | | C |
| ANISOU | 1581 | CA | GLU | A | 101 | 6512 | 9434 | 9364 | 1995 | -100 | 1957 | | C |
| ATOM | 1583 | CB | GLU | A | 101 | -15.728 | 46.192 | 82.851 | 1.00 | 68.16 | | | C |
| ANISOU | 1583 | CB | GLU | A | 101 | 6536 | 9880 | 9482 | 1887 | -306 | 2164 | | C |
| ATOM | 1586 | CG | GLU | A | 101 | -17.031 | 45.440 | 83.166 | 1.00 | 70.09 | | | C |
| ANISOU | 1586 | CG | GLU | A | 101 | 6476 | 10396 | 9760 | 1897 | -284 | 2153 | | C |
| ATOM | 1589 | CD | GLU | A | 101 | -17.290 | 44.241 | 82.244 | 1.00 | 70.06 | | | C |
| ANISOU | 1589 | CD | GLU | A | 101 | 6399 | 10668 | 9554 | 1641 | -435 | 2244 | | C |
| ATOM | 1590 | OE1 | GLU | A | 101 | -16.319 | 43.538 | 81.865 | 1.00 | 68.48 | | | O |
| ANISOU | 1590 | OE1 | GLU | A | 101 | 6411 | 10466 | 9142 | 1414 | -460 | 2195 | | O |
| ATOM | 1591 | OE2 | GLU | A | 101 | -18.473 | 43.995 | 81.912 | 1.00 | 72.44 | | | O |
| ANISOU | 1591 | OE2 | GLU | A | 101 | 6422 | 11189 | 9914 | 1665 | -525 | 2356 | | O |
| ATOM | 1592 | C | GLU | A | 101 | -14.540 | 45.702 | 85.032 | 1.00 | 62.33 | | | C |
| ANISOU | 1592 | C | GLU | A | 101 | 6051 | 8980 | 8651 | 1821 | 54 | 1736 | | C |
| ATOM | 1593 | O | GLU | A | 101 | -13.541 | 45.042 | 84.753 | 1.00 | 59.26 | | | O |
| ANISOU | 1593 | O | GLU | A | 101 | 5847 | 8597 | 8072 | 1614 | 26 | 1700 | | O |
| ATOM | 1595 | N | LYS | A | 102 | -15.241 | 45.540 | 86.154 | 1.00 | 61.86 | | | N |
| ANISOU | 1595 | N | LYS | A | 102 | 5852 | 8987 | 8665 | 1913 | 218 | 1596 | | N |
| ATOM | 1596 | CA | LYS | A | 102 | -14.905 | 44.520 | 87.142 | 1.00 | 60.11 | | | C |
| ANISOU | 1596 | CA | LYS | A | 102 | 5693 | 8856 | 8288 | 1755 | 361 | 1409 | | C |
| ATOM | 1598 | CB | LYS | A | 102 | -15.591 | 44.769 | 88.496 | 1.00 | 62.51 | | | C |
| ANISOU | 1598 | CB | LYS | A | 102 | 5878 | 9175 | 8698 | 1900 | 572 | 1246 | | C |
| ATOM | 1601 | CG | LYS | A | 102 | -15.716 | 43.482 | 89.333 | 1.00 | 61.91 | | | C |
| ANISOU | 1601 | CG | LYS | A | 102 | 5772 | 9295 | 8457 | 1715 | 681 | 1124 | | C |
| ATOM | 1604 | CD | LYS | A | 102 | -15.694 | 43.711 | 90.840 | 1.00 | 63.25 | | | C |
| ANISOU | 1604 | CD | LYS | A | 102 | 5981 | 9417 | 8632 | 1780 | 912 | 914 | | C |
| ATOM | 1607 | CE | LYS | A | 102 | -15.557 | 42.378 | 91.593 | 1.00 | 62.12 | | | C |
| ANISOU | 1607 | CE | LYS | A | 102 | 5871 | 9443 | 8288 | 1553 | 991 | 825 | | C |
| ATOM | 1610 | NZ | LYS | A | 102 | -14.873 | 42.532 | 92.913 | 1.00 | 62.77 | | | N |
| ANISOU | 1610 | NZ | LYS | A | 102 | 6132 | 9430 | 8289 | 1536 | 1163 | 633 | | N |
| ATOM | 1614 | C | LYS | A | 102 | -15.302 | 43.140 | 86.636 | 1.00 | 56.47 | | | C |
| ANISOU | 1614 | C | LYS | A | 102 | 5126 | 8658 | 7672 | 1540 | 275 | 1468 | | C |
| ATOM | 1615 | O | LYS | A | 102 | -16.492 | 42.875 | 86.443 | 1.00 | 53.45 | | | O |
| ANISOU | 1615 | O | LYS | A | 102 | 4485 | 8469 | 7353 | 1573 | 240 | 1545 | | O |
| ATOM | 1617 | N | PRO | A | 103 | -14.310 | 42.235 | 86.489 | 1.00 | 50.83 | | | N |
| ANISOU | 1617 | N | PRO | A | 103 | 4603 | 7947 | 6762 | 1318 | 253 | 1418 | | N |
| ATOM | 1618 | CA | PRO | A | 103 | -14.623 | 40.928 | 85.922 | 1.00 | 49.41 | | | C |
| ANISOU | 1618 | CA | PRO | A | 103 | 4353 | 7980 | 6439 | 1104 | 166 | 1464 | | C |
| ATOM | 1620 | CB | PRO | A | 103 | -13.242 | 40.372 | 85.532 | 1.00 | 47.17 | | | C |
| ANISOU | 1620 | CB | PRO | A | 103 | 4330 | 7604 | 5988 | 926 | 127 | 1421 | | C |
| ATOM | 1623 | CG | PRO | A | 103 | -12.284 | 41.037 | 86.434 | 1.00 | 46.27 | | | C |
| ANISOU | 1623 | CG | PRO | A | 103 | 4396 | 7281 | 5902 | 1010 | 249 | 1299 | | C |
| ATOM | 1626 | CD | PRO | A | 103 | -12.894 | 42.356 | 86.873 | 1.00 | 48.65 | | | C |
| ANISOU | 1626 | CD | PRO | A | 103 | 4603 | 7482 | 6399 | 1257 | 310 | 1309 | | C |
| ATOM | 1629 | C | PRO | A | 103 | -15.368 | 40.024 | 86.922 | 1.00 | 49.00 | | | C |
| ANISOU | 1629 | C | PRO | A | 103 | 4166 | 8093 | 6361 | 1037 | 292 | 1366 | | C |
| ATOM | 1630 | O | PRO | A | 103 | -15.219 | 40.170 | 88.130 | 1.00 | 48.61 | | | O |
| ANISOU | 1630 | O | PRO | A | 103 | 4159 | 7980 | 6329 | 1096 | 458 | 1229 | | O |
| ATOM | 1631 | N | LYS | A | 104 | -16.182 | 39.116 | 86.401 | 1.00 | 49.20 | | | N |
| ANISOU | 1631 | N | LYS | A | 104 | 4028 | 8334 | 6332 | 900 | 209 | 1439 | | N |
| ATOM | 1632 | CA | LYS | A | 104 | -16.886 | 38.118 | 87.217 | 1.00 | 50.49 | | | C |
| ANISOU | 1632 | CA | LYS | A | 104 | 4067 | 8668 | 6448 | 784 | 311 | 1368 | | C |
| ATOM | 1634 | CB | LYS | A | 104 | -17.998 | 37.515 | 86.366 | 1.00 | 53.16 | | | C |
| ANISOU | 1634 | CB | LYS | A | 104 | 4170 | 9247 | 6780 | 676 | 178 | 1493 | | C |
| ATOM | 1637 | CG | LYS | A | 104 | -18.908 | 36.534 | 87.048 | 1.00 | 55.48 | | | C |
| ANISOU | 1637 | CG | LYS | A | 104 | 4293 | 9744 | 7041 | 541 | 263 | 1452 | | C |
| ATOM | 1640 | CD | LYS | A | 104 | -19.899 | 35.974 | 86.029 | 1.00 | 58.04 | | | C |
| ANISOU | 1640 | CD | LYS | A | 104 | 4401 | 10302 | 7349 | 406 | 99 | 1584 | | C |
| ATOM | 1643 | CE | LYS | A | 104 | -21.155 | 35.418 | 86.673 | 1.00 | 60.51 | | | C |
| ANISOU | 1643 | CE | LYS | A | 104 | 4438 | 10853 | 7702 | 340 | 182 | 1578 | | C |
| ATOM | 1646 | NZ | LYS | A | 104 | -22.257 | 35.323 | 85.673 | 1.00 | 64.09 | | | N |
| ANISOU | 1646 | NZ | LYS | A | 104 | 4614 | 11541 | 8196 | 287 | 10 | 1729 | | N |
| ATOM | 1650 | C | LYS | A | 104 | -15.933 | 37.006 | 87.711 | 1.00 | 47.06 | | | C |
| ANISOU | 1650 | C | LYS | A | 104 | 3858 | 8179 | 5844 | 578 | 366 | 1259 | | C |
| ATOM | 1651 | O | LYS | A | 104 | -16.153 | 36.382 | 88.751 | 1.00 | 49.72 | | | O |
| ANISOU | 1651 | O | LYS | A | 104 | 4178 | 8575 | 6138 | 508 | 494 | 1173 | | O |
| ATOM | 1653 | N | PHE | A | 105 | -14.893 | 36.751 | 86.935 | 1.00 | 42.65 | | | N |
| ANISOU | 1653 | N | PHE | A | 105 | 3501 | 7513 | 5190 | 481 | 268 | 1272 | | N |
| ATOM | 1654 | CA | PHE | A | 105 | -13.890 | 35.740 | 87.235 | 1.00 | 40.17 | | | C |
| ANISOU | 1654 | CA | PHE | A | 105 | 3400 | 7124 | 4740 | 311 | 298 | 1183 | | C |
| ATOM | 1656 | CB | PHE | A | 105 | -13.703 | 34.854 | 85.994 | 1.00 | 40.89 | | | C |
| ANISOU | 1656 | CB | PHE | A | 105 | 3541 | 7271 | 4726 | 123 | 154 | 1235 | | C |

FIG. 18 (continued)

```
ATOM   1665  C    PHE A 105    -12.563  36.439  87.558  1.00 35.91          C
ANISOU 1665  C    PHE A 105    3078   6367   4198    402    343   1114      C
ATOM   1666  O    PHE A 105    -12.258  37.492  86.991  1.00 33.69          O
ANISOU 1666  O    PHE A 105    2827   5992   3981    525    291   1164      O
ATOM   1668  N    LEU A 106    -11.760  35.817  88.409  1.00 32.84          N
ANISOU 1668  N    LEU A 106    2842   5903   3731    323    424   1015      N
ATOM   1669  CA   LEU A 106    -10.459  36.339  88.762  1.00 32.13          C
ANISOU 1669  CA   LEU A 106    2949   5632   3626    377    459    948      C
ATOM   1671  CB   LEU A 106     -9.894  35.594  89.964  1.00 32.75          C
ANISOU 1671  CB   LEU A 106    3139   5678   3627    296    553    854      C
ATOM   1674  CG   LEU A 106     -9.261  36.283  91.171  1.00 34.36          C
ANISOU 1674  CG   LEU A 106    3445   5778   3833    382    661    761      C
ATOM   1676  CD1  LEU A 106     -7.953  35.530  91.510  1.00 32.24          C
ANISOU 1676  CD1  LEU A 106    3361   5420   3467    273    645    717      C
ATOM   1680  CD2  LEU A 106     -9.055  37.780  91.096  1.00 32.13          C
ANISOU 1680  CD2  LEU A 106    3180   5382   3646    553    678    742      C
ATOM   1684  C    LEU A 106     -9.513  36.135  87.589  1.00 30.77          C
ANISOU 1684  C    LEU A 106    2902   5392   3396    299    346    982      C
ATOM   1685  O    LEU A 106     -9.188  34.998  87.270  1.00 30.51          O
ANISOU 1685  O    LEU A 106    2930   5386   3277    147    311    966      O
ATOM   1687  N    PRO A 107     -9.062  37.225  86.948  1.00 32.33          N
ANISOU 1687  N    PRO A 107    3146   5497   3641    397    298   1025      N
ATOM   1688  CA   PRO A 107     -8.127  37.067  85.825  1.00 31.83          C
ANISOU 1688  CA   PRO A 107    3201   5389   3506    310    209   1053      C
ATOM   1690  CB   PRO A 107     -8.328  38.358  85.029  1.00 34.03          C
ANISOU 1690  CB   PRO A 107    3444   5629   3857    424    138   1160      C
ATOM   1693  CG   PRO A 107     -8.730  39.359  86.027  1.00 35.91          C
ANISOU 1693  CG   PRO A 107    3635   5790   4221    597    225   1133      C
ATOM   1696  CD   PRO A 107     -9.352  38.648  87.217  1.00 34.58          C
ANISOU 1696  CD   PRO A 107    3386   5702   4049    585    331   1046      C
ATOM   1699  C    PRO A 107     -6.664  36.899  86.277  1.00 28.45          C
ANISOU 1699  C    PRO A 107    2954   4827   3028    273    258    959      C
ATOM   1700  O    PRO A 107     -6.371  36.844  87.473  1.00 28.40          O
ANISOU 1700  O    PRO A 107    2991   4769   3032    302    346    880      O
ATOM   1701  N    ASP A 108     -5.748  36.853  85.323  1.00 27.20          N
ANISOU 1701  N    ASP A 108    2892   4631   2813    207    201    971      N
ATOM   1702  CA   ASP A 108     -4.341  36.614  85.640  1.00 26.33          C
ANISOU 1702  CA   ASP A 108    2923   4417   2663    167    240    888      C
ATOM   1704  CB   ASP A 108     -3.734  35.677  84.599  1.00 23.93          C
ANISOU 1704  CB   ASP A 108    2674   4149   2270     35    195    871      C
ATOM   1707  CG   ASP A 108     -4.221  34.291  84.717  1.00 26.16          C
ANISOU 1707  CG   ASP A 108    2927   4500   2514    -63    197    834      C
ATOM   1708  OD1  ASP A 108     -4.249  33.741  85.868  1.00 26.57          O
ANISOU 1708  OD1  ASP A 108    2987   4522   2587    -56    254    786      O
ATOM   1709  OD2  ASP A 108     -4.545  33.726  83.651  1.00 27.02          O
ANISOU 1709  OD2  ASP A 108    3017   4689   2560   -162    139    851      O
ATOM   1710  C    ASP A 108     -3.498  37.909  85.733  1.00 26.79          C
ANISOU 1710  C    ASP A 108    3062   4350   2766    248    255    890      C
ATOM   1711  O    ASP A 108     -2.553  37.993  86.535  1.00 26.02          O
ANISOU 1711  O    ASP A 108    3050   4167   2668    253    307    814      O
ATOM   1713  N    LEU A 109     -3.810  38.862  84.857  1.00 27.82          N
ANISOU 1713  N    LEU A 109    3169   4473   2928    293    196    988      N
ATOM   1714  CA   LEU A 109     -3.083  40.134  84.726  1.00 29.24          C
ANISOU 1714  CA   LEU A 109    3434   4522   3154    348    195   1015      C
ATOM   1716  CB   LEU A 109     -2.064  40.082  83.584  1.00 31.81          C
ANISOU 1716  CB   LEU A 109    3841   4852   3393    237    149   1046      C
ATOM   1719  CG   LEU A 109     -0.867  39.152  83.518  1.00 32.41          C
ANISOU 1719  CG   LEU A 109    3986   4945   3385    125    183    950      C
ATOM   1721  CD1  LEU A 109      0.015  39.561  82.305  1.00 32.29          C
ANISOU 1721  CD1  LEU A 109    4035   4934   3301     39    151    999      C
ATOM   1725  CD2  LEU A 109     -0.053  39.162  84.846  1.00 31.02          C
ANISOU 1725  CD2  LEU A 109    3863   4676   3247    158    256    845      C
ATOM   1729  C    LEU A 109     -4.021  41.265  84.385  1.00 30.85          C
ANISOU 1729  C    LEU A 109    3572   4695   3456    466    151   1128      C
ATOM   1730  O    LEU A 109     -5.124  41.021  83.839  1.00 27.87          O
ANISOU 1730  O    LEU A 109    3072   4432   3085    481     90   1213      O
ATOM   1732  N    TYR A 110     -3.616  42.489  84.758  1.00 30.67          N
ANISOU 1732  N    TYR A 110    3622   4512   3518    553    178   1128      N
ATOM   1733  CA ATYR A 110     -4.206  43.703  84.170  0.50 32.97          C
ANISOU 1733  CA ATYR A 110    3890   4724   3915    661    117   1261      C
ATOM   1734  CA BTYR A 110     -4.201  43.708  84.188  0.50 32.99          C
ANISOU 1734  CA BTYR A 110    3893   4724   3918    662    119   1259      C
ATOM   1737  CB ATYR A 110     -4.671  44.737  85.201  0.50 34.78          C
ANISOU 1737  CB ATYR A 110    4112   4803   4299    832    192   1212      C
ATOM   1738  CB BTYR A 110     -4.611  44.725  85.254  0.50 34.74          C
ANISOU 1738  CB BTYR A 110    4114   4794   4291    829    197   1203      C
ATOM   1743  CG ATYR A 110     -5.385  45.901  84.549  0.50 36.87          C
ANISOU 1743  CG ATYR A 110    4336   4973   4700    966    119   1365      C
ATOM   1744  CG BTYR A 110     -5.274  45.929  84.645  0.50 36.87          C
```

FIG. 18 (continued)

```
ANISOU 1744  CG BTYR A 110    4351   4958   4698    963    130   1349    C
ATOM   1745  CD1ATYR A 110     -6.586  45.704  83.882  0.50 38.79       C
ANISOU 1745  CD1ATYR A 110    4413   5347   4977   1025     34   1496    C
ATOM   1746  CD1BTYR A 110     -6.556  45.838  84.124  0.50 38.83       C
ANISOU 1746  CD1BTYR A 110    4429   5319   5005   1048     58   1470    C
ATOM   1749  CE1ATYR A 110     -7.260  46.743  83.273  0.50 40.71       C
ANISOU 1749  CE1ATYR A 110    4604   5508   5357   1160    -51   1659    C
ATOM   1750  CE1BTYR A 110     -7.184  46.918  83.548  0.50 40.56       C
ANISOU 1750  CE1BTYR A 110    4604   5442   5365   1186    -21   1627    C
ATOM   1753  CZ ATYR A 110     -6.734  48.015  83.289  0.50 41.68       C
ANISOU 1753  CZ ATYR A 110    4859   5388   5588   1234    -48   1695    C
ATOM   1754  CZ BTYR A 110     -6.530  48.124  83.453  0.50 41.45       C
ANISOU 1754  CZ BTYR A 110    4865   5320   5563   1232    -27   1667    C
ATOM   1755  OH ATYR A 110     -7.432  49.037  82.677  0.50 43.79       O
ANISOU 1755  OH ATYR A 110    5077   5552   6010   1381   -143   1877    O
ATOM   1756  OH BTYR A 110     -7.164  49.201  82.880  0.50 43.77       O
ANISOU 1756  OH BTYR A 110    5124   5492   6016   1379   -114   1841    O
ATOM   1759  CE2ATYR A 110     -5.540  48.257  83.927  0.50 40.43       C
ANISOU 1759  CE2ATYR A 110    4877   5090   5393   1160     42   1557    C
ATOM   1760  CE2BTYR A 110     -5.258  48.255  83.940  0.50 40.21       C
ANISOU 1760  CE2BTYR A 110    4885   5048   5344   1129     48   1542    C
ATOM   1763  CD2ATYR A 110     -4.854  47.188  84.559  0.50 38.71       C
ANISOU 1763  CD2ATYR A 110    4694   4984   5032   1025    122   1392    C
ATOM   1764  CD2BTYR A 110     -4.616  47.149  84.539  0.50 38.21       C
ANISOU 1764  CD2BTYR A 110    4656   4915   4946    996    123   1383    C
ATOM   1767  C    TYR A 110     -3.199  44.383  83.263  1.00 33.50       C
ANISOU 1767  C    TYR A 110    4081   4703   3944    583     62   1340    C
ATOM   1768  O    TYR A 110     -2.030  44.522  83.616  1.00 33.42       O
ANISOU 1768  O    TYR A 110    4187   4610   3900    516    113   1257    O
ATOM   1770  N    ASP A 111     -3.680  44.813  82.107  1.00 35.03       N
ANISOU 1770  N    ASP A 111    4242   4930   4138    585    -47   1512    N
ATOM   1771  CA   ASP A 111     -2.878  45.530  81.116  1.00 37.42       C
ANISOU 1771  CA   ASP A 111    4658   5166   4395    500   -109   1626    C
ATOM   1773  CB   ASP A 111     -3.110  44.891  79.747  1.00 36.43       C
ANISOU 1773  CB   ASP A 111    4490   5232   4121    372   -213   1743    C
ATOM   1776  CG   ASP A 111     -2.240  45.510  78.621  1.00 38.67       C
ANISOU 1776  CG   ASP A 111    4892   5489   4311    245   -270   1865    C
ATOM   1777  OD1  ASP A 111     -1.670  46.632  78.776  1.00 37.15       O
ANISOU 1777  OD1  ASP A 111    4803   5110   4201    275   -258   1911    O
ATOM   1778  OD2  ASP A 111     -2.174  44.867  77.534  1.00 37.78       O
ANISOU 1778  OD2  ASP A 111    4771   5551   4033    101   -329   1918    O
ATOM   1779  C    ASP A 111     -3.303  47.013  81.087  1.00 39.95       C
ANISOU 1779  C    ASP A 111    5006   5293   4879    643   -152   1753    C
ATOM   1780  O    ASP A 111     -4.361  47.351  80.551  1.00 41.48       O
ANISOU 1780  O    ASP A 111    5102   5518   5142    738   -245   1905    O
ATOM   1782  N    TYR A 112     -2.506  47.883  81.706  1.00 41.76       N
ANISOU 1782  N    TYR A 112    5364   5318   5185    663    -87   1689    N
ATOM   1783  CA   TYR A 112     -2.855  49.309  81.799  1.00 44.65       C
ANISOU 1783  CA   TYR A 112    5782   5452   5733    805   -111   1785    C
ATOM   1785  CB   TYR A 112     -1.979  50.038  82.826  1.00 46.56       C
ANISOU 1785  CB   TYR A 112    6166   5477   6048    811     -6   1637    C
ATOM   1788  CG   TYR A 112     -2.186  49.620  84.277  1.00 46.28       C
ANISOU 1788  CG   TYR A 112    6091   5446   6049    889    120   1416    C
ATOM   1789  CD1  TYR A 112     -3.246  50.131  85.034  1.00 47.39       C
ANISOU 1789  CD1  TYR A 112    6162   5492   6354   1093    173   1371    C
ATOM   1791  CE1  TYR A 112     -3.423  49.747  86.370  1.00 47.32       C
ANISOU 1791  CE1  TYR A 112    6123   5508   6348   1143    300   1166    C
ATOM   1793  CZ   TYR A 112     -2.511  48.885  86.945  1.00 44.57       C
ANISOU 1793  CZ   TYR A 112    5824   5263   5847    991    352   1031    C
ATOM   1794  OH   TYR A 112     -2.620  48.473  88.235  1.00 45.33       O
ANISOU 1794  OH   TYR A 112    5905   5399   5918   1014    462    851    O
ATOM   1796  CE2  TYR A 112     -1.454  48.394  86.223  1.00 43.84       C
ANISOU 1796  CE2  TYR A 112    5792   5247   5620    812    293   1078    C
ATOM   1798  CD2  TYR A 112     -1.289  48.760  84.910  1.00 44.02       C
ANISOU 1798  CD2  TYR A 112    5838   5256   5633    760    190   1257    C
ATOM   1800  C    TYR A 112     -2.746  50.003  80.453  1.00 46.33       C
ANISOU 1800  C    TYR A 112    6052   5630   5923    744   -241   2021    C
ATOM   1801  O    TYR A 112     -3.324  51.072  80.245  1.00 49.10       O
ANISOU 1801  O    TYR A 112    6413   5813   6431    878   -304   2165    O
ATOM   1803  N    LYS A 113     -2.020  49.396  79.522  1.00 45.38       N
ANISOU 1803  N    LYS A 113    5968   5666   5607    544   -281   2067    N
ATOM   1804  CA   LYS A 113     -1.923  49.943  78.167  1.00 48.09       C
ANISOU 1804  CA   LYS A 113    6366   6023   5882    451   -406   2302    C
ATOM   1806  CB   LYS A 113     -0.706  49.372  77.435  1.00 47.46       C
ANISOU 1806  CB   LYS A 113    6369   6083   5582    205   -383   2274    C
ATOM   1809  CG   LYS A 113     -0.459  50.009  76.088  1.00 50.63       C
ANISOU 1809  CG   LYS A 113    6852   6500   5886     76   -493   2509    C
ATOM   1812  CD   LYS A 113      1.004  49.910  75.698  1.00 50.77       C
ANISOU 1812  CD   LYS A 113    6983   6560   5749   -146   -421   2453    C
```

FIG. 18 (continued)

```
ATOM    1815  CE   LYS A 113      1.322  50.701  74.424  1.00 53.31          C
ANISOU  1815  CE   LYS A 113   7407   6879   5969   -294   -516   2698       C
ATOM    1818  NZ   LYS A 113      1.154  49.877  73.193  1.00 55.62          N
ANISOU  1818  NZ   LYS A 113   7653   7458   6021   -447   -578   2774       N
ATOM    1822  C    LYS A 113     -3.217  49.734  77.353  1.00 47.80          C
ANISOU  1822  C    LYS A 113   6190   6135   5839    519   -544   2484       C
ATOM    1823  O    LYS A 113     -3.790  50.699  76.825  1.00 49.42          O
ANISOU  1823  O    LYS A 113   6398   6232   6149    610   -658   2699       O
ATOM    1825  N    GLU A 114     -3.680  48.488  77.282  1.00 46.08          N
ANISOU  1825  N    GLU A 114   5847   6155   5507    474   -542   2402       N
ATOM    1826  CA   GLU A 114     -4.890  48.134  76.549  1.00 46.36          C
ANISOU  1826  CA   GLU A 114   5732   6371   5513    506   -675   2551       C
ATOM    1828  CB   GLU A 114     -4.813  46.699  76.030  1.00 45.98          C
ANISOU  1828  CB   GLU A 114   5633   6595   5241    324   -674   2462       C
ATOM    1831  CG   GLU A 114     -3.627  46.385  75.131  1.00 46.29          C
ANISOU  1831  CG   GLU A 114   5809   6718   5061     90   -661   2453       C
ATOM    1834  CD   GLU A 114     -3.669  47.049  73.763  1.00 49.91          C
ANISOU  1834  CD   GLU A 114   6322   7232   5409    -13   -808   2707       C
ATOM    1835  OE1  GLU A 114     -4.740  47.488  73.282  1.00 53.52          O
ANISOU  1835  OE1  GLU A 114   6688   7725   5920     71   -958   2911       O
ATOM    1836  OE2  GLU A 114     -2.601  47.126  73.133  1.00 51.33          O
ANISOU  1836  OE2  GLU A 114   6631   7433   5438   -188   -777   2711       O
ATOM    1837  C    GLU A 114     -6.133  48.288  77.418  1.00 46.21          C
ANISOU  1837  C    GLU A 114   5549   6306   5701    741   -665   2530       C
ATOM    1838  O    GLU A 114     -7.236  48.105  76.931  1.00 46.13          O
ANISOU  1838  O    GLU A 114   5384   6437   5707    794   -778   2660       O
ATOM    1840  N    ASN A 115     -5.945  48.586  78.704  1.00 44.75          N
ANISOU  1840  N    ASN A 115   5393   5949   5663    866   -525   2357       N
ATOM    1841  CA   ASN A 115     -7.042  48.746  79.651  1.00 45.53          C
ANISOU  1841  CA   ASN A 115   5341   6004   5953   1086   -475   2299       C
ATOM    1843  CB   ASN A 115     -7.865  49.988  79.346  1.00 50.82          C
ANISOU  1843  CB   ASN A 115   5956   6520   6834   1288   -573   2499       C
ATOM    1846  CG   ASN A 115     -7.014  51.233  79.254  1.00 52.61          C
ANISOU  1846  CG   ASN A 115   6387   6459   7145   1302   -572   2563       C
ATOM    1847  OD1  ASN A 115     -7.082  51.982  78.267  1.00 57.26          O
ANISOU  1847  OD1  ASN A 115   7019   6979   7757   1300   -714   2804       O
ATOM    1848  ND2  ASN A 115     -6.187  51.458  80.270  1.00 52.51          N
ANISOU  1848  ND2  ASN A 115   6505   6280   7167   1296   -420   2357       N
ATOM    1851  C    ASN A 115     -7.945  47.555  79.677  1.00 43.56          C
ANISOU  1851  C    ASN A 115   4903   6015   5633   1062   -488   2257       C
ATOM    1852  O    ASN A 115     -9.141  47.682  79.502  1.00 44.03          O
ANISOU  1852  O    ASN A 115   4783   6152   5794   1187   -565   2370       O
ATOM    1854  N    ARG A 116     -7.364  46.391  79.907  1.00 41.20          N
ANISOU  1854  N    ARG A 116   4639   5845   5168    899   -415   2097       N
ATOM    1855  CA   ARG A 116     -8.159  45.196  79.990  1.00 39.67          C
ANISOU  1855  CA   ARG A 116   4290   5878   4905    850   -419   2044       C
ATOM    1857  CB   ARG A 116     -8.409  44.609  78.604  1.00 40.42          C
ANISOU  1857  CB   ARG A 116   4343   6182   4832    688   -570   2185       C
ATOM    1860  CG   ARG A 116     -7.160  44.102  77.901  1.00 38.50          C
ANISOU  1860  CG   ARG A 116   4272   5974   4384    470   -564   2138       C
ATOM    1863  CD   ARG A 116     -7.371  44.094  76.390  1.00 40.36          C
ANISOU  1863  CD   ARG A 116   4501   6364   4470    337   -728   2326       C
ATOM    1866  NE   ARG A 116     -6.189  43.577  75.699  1.00 39.17          N
ANISOU  1866  NE   ARG A 116   4505   6265   4112    125   -698   2260       N
ATOM    1868  CZ   ARG A 116     -5.933  43.726  74.402  1.00 40.64          C
ANISOU  1868  CZ   ARG A 116   4754   6554   4133    -23   -803   2397       C
ATOM    1869  NH1  ARG A 116     -6.771  44.380  73.629  1.00 43.04          N
ANISOU  1869  NH1  ARG A 116   4987   6917   4448     11   -968   2632       N
ATOM    1872  NH2  ARG A 116     -4.832  43.218  73.875  1.00 38.90          N
ANISOU  1872  NH2  ARG A 116   4663   6386   3732   -207   -741   2302       N
ATOM    1875  C    ARG A 116     -7.438  44.231  80.858  1.00 35.53          C
ANISOU  1875  C    ARG A 116   3835   5372   4294    753   -282   1823       C
ATOM    1876  O    ARG A 116     -6.227  44.307  81.050  1.00 34.06          O
ANISOU  1876  O    ARG A 116   3810   5080   4050    679   -218   1736       O
ATOM    1878  N    PHE A 117     -8.225  43.349  81.424  1.00 34.44          N
ANISOU  1878  N    PHE A 117   3561   5367   4156    760   -240   1744       N
ATOM    1879  CA   PHE A 117     -7.701  42.227  82.132  1.00 32.67          C
ANISOU  1879  CA   PHE A 117   3386   5191   3837    650   -138   1568       C
ATOM    1881  CB   PHE A 117     -8.714  41.781  83.162  1.00 32.79          C
ANISOU  1881  CB   PHE A 117   3251   5280   3927    729    -61   1494       C
ATOM    1884  CG   PHE A 117     -8.904  42.756  84.270  1.00 32.52          C
ANISOU  1884  CG   PHE A 117   3209   5097   4051    917     45   1432       C
ATOM    1885  CD1  PHE A 117     -8.028  42.784  85.326  1.00 30.93          C
ANISOU  1885  CD1  PHE A 117   3140   4776   3834    911    167   1277       C
ATOM    1887  CE1  PHE A 117     -8.205  43.675  86.384  1.00 32.60          C
ANISOU  1887  CE1  PHE A 117   3358   4855   4172   1067    276   1194       C
ATOM    1889  CZ   PHE A 117     -9.289  44.537  86.385  1.00 34.44          C
ANISOU  1889  CZ   PHE A 117   3454   5060   4572   1254    274   1263       C
ATOM    1891  CE2  PHE A 117    -10.182  44.503  85.345  1.00 35.37          C
```

FIG. 18 (continued)

| | | | | | | | | | | | | | | |
|---|---|---|---|---|---|---|---|---|---|---|---|---|---|---|
| ANISOU | 1891 | CE2 | PHE | A | 117 | 3417 | 5295 | 4725 | 1280 | 145 | 1434 | | | C |
| ATOM | 1893 | CD2 | PHE | A | 117 | -9.982 | 43.612 | 84.279 | 1.00 | 35.22 | | | | C |
| ANISOU | 1893 | CD2 | PHE | A | 117 | 3402 | 5425 | 4555 | 1099 | 24 | 1522 | | | C |
| ATOM | 1895 | C | PHE | A | 117 | -7.414 | 41.126 | 81.120 | 1.00 | 32.66 | | | | C |
| ANISOU | 1895 | C | PHE | A | 117 | 3410 | 5345 | 3654 | 446 | -210 | 1580 | | | C |
| ATOM | 1896 | O | PHE | A | 117 | -8.081 | 41.022 | 80.079 | 1.00 | 32.09 | | | | O |
| ANISOU | 1896 | O | PHE | A | 117 | 3256 | 5408 | 3530 | 393 | -333 | 1709 | | | O |
| ATOM | 1898 | N | ILE | A | 118 | -6.403 | 40.325 | 81.434 | 1.00 | 31.44 | | | | N |
| ANISOU | 1898 | N | ILE | A | 118 | 3371 | 5168 | 3406 | 335 | -133 | 1441 | | | N |
| ATOM | 1899 | CA | ILE | A | 118 | -5.980 | 39.234 | 80.577 | 1.00 | 31.47 | | | | C |
| ANISOU | 1899 | CA | ILE | A | 118 | 3422 | 5287 | 3250 | 150 | -168 | 1408 | | | C |
| ATOM | 1901 | CB | ILE | A | 118 | -4.493 | 39.371 | 80.168 | 1.00 | 30.83 | | | | C |
| ANISOU | 1901 | CB | ILE | A | 118 | 3503 | 5121 | 3089 | 70 | -135 | 1359 | | | C |
| ATOM | 1903 | CG1 | ILE | A | 118 | -4.226 | 40.699 | 79.447 | 1.00 | 32.53 | | | | C |
| ANISOU | 1903 | CG1 | ILE | A | 118 | 3769 | 5267 | 3323 | 108 | -199 | 1501 | | | C |
| ATOM | 1906 | CD1 | ILE | A | 118 | -2.657 | 40.972 | 79.171 | 1.00 | 31.41 | | | | C |
| ANISOU | 1906 | CD1 | ILE | A | 118 | 3782 | 5039 | 3114 | 23 | -146 | 1450 | | | C |
| ATOM | 1910 | CG2 | ILE | A | 118 | -4.038 | 38.175 | 79.305 | 1.00 | 32.99 | | | | C |
| ANISOU | 1910 | CG2 | ILE | A | 118 | 3822 | 5509 | 3203 | -111 | -146 | 1292 | | | C |
| ATOM | 1914 | C | ILE | A | 118 | -6.134 | 37.932 | 81.344 | 1.00 | 29.63 | | | | C |
| ANISOU | 1914 | C | ILE | A | 118 | 3162 | 5104 | 2992 | 89 | -97 | 1275 | | | C |
| ATOM | 1915 | O | ILE | A | 118 | -5.744 | 37.853 | 82.509 | 1.00 | 26.21 | | | | O |
| ANISOU | 1915 | O | ILE | A | 118 | 2766 | 4578 | 2616 | 148 | 1 | 1177 | | | O |
| ATOM | 1917 | N | GLU | A | 119 | -6.681 | 36.926 | 80.654 | 1.00 | 29.65 | | | | N |
| ANISOU | 1917 | N | GLU | A | 119 | 3112 | 5253 | 2901 | -43 | -155 | 1278 | | | N |
| ATOM | 1918 | CA | GLU | A | 119 | -6.774 | 35.552 | 81.133 | 1.00 | 29.48 | | | | C |
| ANISOU | 1918 | CA | GLU | A | 119 | 3090 | 5270 | 2839 | -143 | -105 | 1163 | | | C |
| ATOM | 1920 | CB | GLU | A | 119 | -8.222 | 35.052 | 81.015 | 1.00 | 31.71 | | | | C |
| ANISOU | 1920 | CB | GLU | A | 119 | 3210 | 5711 | 3126 | -189 | -166 | 1220 | | | C |
| ATOM | 1923 | CG | GLU | A | 119 | -8.436 | 33.597 | 81.435 | 1.00 | 31.96 | | | | C |
| ANISOU | 1923 | CG | GLU | A | 119 | 3247 | 5781 | 3117 | -321 | -125 | 1117 | | | C |
| ATOM | 1926 | CD | GLU | A | 119 | -8.043 | 33.329 | 82.887 | 1.00 | 32.35 | | | | C |
| ANISOU | 1926 | CD | GLU | A | 119 | 3340 | 5715 | 3236 | -254 | -4 | 1030 | | | C |
| ATOM | 1927 | OE1 | GLU | A | 119 | -8.187 | 34.216 | 83.759 | 1.00 | 33.88 | | | | O |
| ANISOU | 1927 | OE1 | GLU | A | 119 | 3491 | 5860 | 3522 | -105 | 50 | 1051 | | | O |
| ATOM | 1928 | OE2 | GLU | A | 119 | -7.595 | 32.211 | 83.151 | 1.00 | 30.56 | | | | O |
| ANISOU | 1928 | OE2 | GLU | A | 119 | 3197 | 5445 | 2970 | -354 | 36 | 940 | | | O |
| ATOM | 1929 | C | GLU | A | 119 | -5.811 | 34.655 | 80.343 | 1.00 | 26.83 | | | | C |
| ANISOU | 1929 | C | GLU | A | 119 | 2880 | 4935 | 2377 | -296 | -101 | 1075 | | | C |
| ATOM | 1930 | O | GLU | A | 119 | -5.953 | 34.464 | 79.128 | 1.00 | 28.62 | | | | O |
| ANISOU | 1930 | O | GLU | A | 119 | 3113 | 5266 | 2494 | -410 | -178 | 1111 | | | O |
| ATOM | 1932 | N | ILE | A | 120 | -4.822 | 34.124 | 81.058 | 1.00 | 28.08 | | | | N |
| ANISOU | 1932 | N | ILE | A | 120 | 3136 | 4980 | 2553 | -292 | -8 | 957 | | | N |
| ATOM | 1933 | CA | ILE | A | 120 | -3.814 | 33.237 | 80.515 | 1.00 | 27.71 | | | | C |
| ANISOU | 1933 | CA | ILE | A | 120 | 3198 | 4905 | 2424 | -401 | 24 | 849 | | | C |
| ATOM | 1935 | CB | ILE | A | 120 | -2.389 | 33.641 | 81.009 | 1.00 | 28.47 | | | | C |
| ANISOU | 1935 | CB | ILE | A | 120 | 3388 | 4869 | 2560 | -330 | 100 | 790 | | | C |
| ATOM | 1937 | CG1 | ILE | A | 120 | -2.046 | 35.036 | 80.470 | 1.00 | 27.40 | | | | C |
| ANISOU | 1937 | CG1 | ILE | A | 120 | 3266 | 4726 | 2418 | -280 | 70 | 882 | | | C |
| ATOM | 1940 | CD1 | ILE | A | 120 | -0.891 | 35.704 | 81.146 | 1.00 | 27.72 | | | | C |
| ANISOU | 1940 | CD1 | ILE | A | 120 | 3371 | 4644 | 2518 | -205 | 133 | 848 | | | C |
| ATOM | 1944 | CG2 | ILE | A | 120 | -1.303 | 32.614 | 80.540 | 1.00 | 27.82 | | | | C |
| ANISOU | 1944 | CG2 | ILE | A | 120 | 3395 | 4755 | 2421 | -419 | 151 | 663 | | | C |
| ATOM | 1948 | C | ILE | A | 120 | -4.133 | 31.745 | 80.753 | 1.00 | 28.03 | | | | C |
| ANISOU | 1948 | C | ILE | A | 120 | 3246 | 4954 | 2448 | -503 | 44 | 757 | | | C |
| ATOM | 1949 | O | ILE | A | 120 | -4.724 | 31.358 | 81.771 | 1.00 | 29.24 | | | | O |
| ANISOU | 1949 | O | ILE | A | 120 | 3352 | 5090 | 2669 | -474 | 68 | 757 | | | O |
| ATOM | 1951 | N | GLY | A | 121 | -3.818 | 30.928 | 79.751 | 1.00 | 27.10 | | | | N |
| ANISOU | 1951 | N | GLY | A | 121 | 3192 | 4871 | 2233 | -636 | 35 | 681 | | | N |
| ATOM | 1952 | CA | GLY | A | 121 | -3.902 | 29.491 | 79.865 | 1.00 | 27.84 | | | | C |
| ANISOU | 1952 | CA | GLY | A | 121 | 3330 | 4929 | 2320 | -740 | 62 | 573 | | | C |
| ATOM | 1955 | C | GLY | A | 121 | -2.786 | 28.821 | 79.079 | 1.00 | 27.26 | | | | C |
| ANISOU | 1955 | C | GLY | A | 121 | 3373 | 4801 | 2185 | -809 | 114 | 439 | | | C |
| ATOM | 1956 | O | GLY | A | 121 | -2.300 | 29.381 | 78.088 | 1.00 | 27.54 | | | | O |
| ANISOU | 1956 | O | GLY | A | 121 | 3435 | 4900 | 2130 | -839 | 107 | 439 | | | O |
| ATOM | 1958 | N | VAL | A | 122 | -2.370 | 27.641 | 79.561 | 1.00 | 27.39 | | | | N |
| ANISOU | 1958 | N | VAL | A | 122 | 3455 | 4694 | 2257 | -830 | 172 | 329 | | | N |
| ATOM | 1959 | CA | VAL | A | 122 | -1.303 | 26.829 | 78.953 | 1.00 | 27.56 | | | | C |
| ANISOU | 1959 | CA | VAL | A | 122 | 3579 | 4634 | 2259 | -872 | 242 | 176 | | | C |
| ATOM | 1961 | CB | VAL | A | 122 | -0.025 | 26.782 | 79.828 | 1.00 | 25.64 | | | | C |
| ANISOU | 1961 | CB | VAL | A | 122 | 3368 | 4238 | 2134 | -732 | 317 | 135 | | | C |
| ATOM | 1963 | CG1 | VAL | A | 122 | 1.083 | 26.017 | 79.107 | 1.00 | 26.86 | | | | C |
| ANISOU | 1963 | CG1 | VAL | A | 122 | 3600 | 4322 | 2282 | -756 | 398 | -26 | | | C |
| ATOM | 1967 | CG2 | VAL | A | 122 | 0.431 | 28.225 | 80.207 | 1.00 | 24.95 | | | | C |
| ANISOU | 1967 | CG2 | VAL | A | 122 | 3231 | 4187 | 2064 | -615 | 312 | 237 | | | C |
| ATOM | 1971 | C | VAL | A | 122 | -1.842 | 25.414 | 78.757 | 1.00 | 29.09 | | | | C |
| ANISOU | 1971 | C | VAL | A | 122 | 3828 | 4781 | 2446 | -1006 | 241 | 78 | | | C |
| ATOM | 1972 | O | VAL | A | 122 | -2.409 | 24.834 | 79.686 | 1.00 | 28.96 | | | | O |
| ANISOU | 1972 | O | VAL | A | 122 | 3798 | 4694 | 2511 | -1006 | 227 | 112 | | | O |

FIG. 18 (continued)

| | | | | | | | | | | | | | |
|---|---|---|---|---|---|---|---|---|---|---|---|---|---|
| ATOM | 1974 | N | THR | A | 123 | -1.658 | 24.870 | 77.558 | 1.00 | 30.05 | | | N |
| ANISOU | 1974 | N | THR | A | 123 | 4017 | 4938 | 2461 | -1132 | 260 | -48 | | N |
| ATOM | 1975 | CA | THR | A | 123 | -2.205 | 23.567 | 77.197 | 1.00 | 31.81 | | | C |
| ANISOU | 1975 | CA | THR | A | 123 | 4310 | 5117 | 2661 | -1288 | 256 | -161 | | C |
| ATOM | 1977 | CB | THR | A | 123 | -3.425 | 23.724 | 76.240 | 1.00 | 33.44 | | | C |
| ANISOU | 1977 | CB | THR | A | 123 | 4471 | 5528 | 2705 | -1472 | 156 | -119 | | C |
| ATOM | 1979 | OG1 | THR | A | 123 | -4.011 | 22.445 | 75.971 | 1.00 | 34.29 | | | O |
| ANISOU | 1979 | OG1 | THR | A | 123 | 4648 | 5587 | 2792 | -1647 | 146 | -232 | | O |
| ATOM | 1981 | CG2 | THR | A | 123 | -3.031 | 24.400 | 74.907 | 1.00 | 32.87 | | | C |
| ANISOU | 1981 | CG2 | THR | A | 123 | 4417 | 5611 | 2461 | -1533 | 151 | -148 | | C |
| ATOM | 1985 | C | THR | A | 123 | -1.150 | 22.669 | 76.520 | 1.00 | 33.77 | | | C |
| ANISOU | 1985 | C | THR | A | 123 | 4680 | 5245 | 2906 | -1316 | 360 | -371 | | C |
| ATOM | 1986 | O | THR | A | 123 | -0.217 | 23.155 | 75.855 | 1.00 | 31.71 | | | O |
| ANISOU | 1986 | O | THR | A | 123 | 4433 | 5028 | 2586 | -1275 | 422 | -432 | | O |
| ATOM | 1988 | N | ARG | A | 124 | -1.336 | 21.364 | 76.708 | 1.00 | 34.06 | | | N |
| ANISOU | 1988 | N | ARG | A | 124 | 4801 | 5128 | 3012 | -1389 | 384 | -479 | | N |
| ATOM | 1989 | CA | ARG | A | 124 | -0.566 | 20.321 | 76.012 | 1.00 | 37.78 | | | C |
| ANISOU | 1989 | CA | ARG | A | 124 | 5398 | 5465 | 3492 | -1434 | 485 | -705 | | C |
| ATOM | 1991 | CB | ARG | A | 124 | -0.312 | 19.132 | 76.946 | 1.00 | 38.48 | | | C |
| ANISOU | 1991 | CB | ARG | A | 124 | 5562 | 5281 | 3779 | -1373 | 521 | -753 | | C |
| ATOM | 1994 | CG | ARG | A | 124 | 0.571 | 19.446 | 78.124 | 1.00 | 37.57 | | | C |
| ANISOU | 1994 | CG | ARG | A | 124 | 5397 | 5046 | 3831 | -1149 | 545 | -655 | | C |
| ATOM | 1997 | CD | ARG | A | 124 | 0.106 | 18.698 | 79.348 | 1.00 | 39.13 | | | C |
| ANISOU | 1997 | CD | ARG | A | 124 | 5620 | 5076 | 4170 | -1134 | 500 | -560 | | C |
| ATOM | 2000 | NE | ARG | A | 124 | -0.572 | 19.597 | 80.210 | 1.00 | 37.94 | | | N |
| ANISOU | 2000 | NE | ARG | A | 124 | 5363 | 5055 | 3998 | -1103 | 424 | -360 | | N |
| ATOM | 2002 | CZ | ARG | A | 124 | -1.193 | 19.304 | 81.339 | 1.00 | 36.52 | | | C |
| ANISOU | 2002 | CZ | ARG | A | 124 | 5171 | 4817 | 3889 | -1109 | 376 | -232 | | C |
| ATOM | 2003 | NH1 | ARG | A | 124 | -1.327 | 18.076 | 81.821 | 1.00 | 38.45 | | | N |
| ANISOU | 2003 | NH1 | ARG | A | 124 | 5511 | 4863 | 4237 | -1163 | 378 | -254 | | N |
| ATOM | 2006 | NH2 | ARG | A | 124 | -1.725 | 20.300 | 81.983 | 1.00 | 34.64 | | | N |
| ANISOU | 2006 | NH2 | ARG | A | 124 | 4823 | 4726 | 3612 | -1067 | 330 | -79 | | N |
| ATOM | 2009 | C | ARG | A | 124 | -1.320 | 19.788 | 74.813 | 1.00 | 39.67 | | | C |
| ANISOU | 2009 | C | ARG | A | 124 | 5706 | 5809 | 3560 | -1673 | 460 | -826 | | C |
| ATOM | 2010 | O | ARG | A | 124 | -0.813 | 18.916 | 74.136 | 1.00 | 41.12 | | | O |
| ANISOU | 2010 | O | ARG | A | 124 | 6004 | 5890 | 3728 | -1737 | 549 | -1038 | | O |
| ATOM | 2012 | N | ARG | A | 125 | -2.543 | 20.275 | 74.599 | 1.00 | 41.12 | | | N |
| ANISOU | 2012 | N | ARG | A | 125 | 5813 | 6189 | 3623 | -1803 | 337 | -697 | | N |
| ATOM | 2013 | CA | ARG | A | 125 | -3.411 | 19.830 | 73.500 | 1.00 | 45.63 | | | C |
| ANISOU | 2013 | CA | ARG | A | 125 | 6429 | 6899 | 4012 | -2057 | 279 | -783 | | C |
| ATOM | 2015 | CB | ARG | A | 125 | -4.786 | 19.447 | 74.053 | 1.00 | 46.29 | | | C |
| ANISOU | 2015 | CB | ARG | A | 125 | 6452 | 7012 | 4123 | -2180 | 166 | -672 | | C |
| ATOM | 2018 | CG | ARG | A | 125 | -4.743 | 18.383 | 75.153 | 1.00 | 48.85 | | | C |
| ANISOU | 2018 | CG | ARG | A | 125 | 6842 | 7071 | 4649 | -2140 | 210 | -701 | | C |
| ATOM | 2021 | CD | ARG | A | 125 | -4.514 | 16.986 | 74.587 | 1.00 | 55.08 | | | C |
| ANISOU | 2021 | CD | ARG | A | 125 | 7810 | 7673 | 5444 | -2289 | 278 | -941 | | C |
| ATOM | 2024 | NE | ARG | A | 125 | -4.604 | 15.981 | 75.651 | 1.00 | 57.60 | | | N |
| ANISOU | 2024 | NE | ARG | A | 125 | 8195 | 7731 | 5960 | -2268 | 297 | -930 | | N |
| ATOM | 2026 | CZ | ARG | A | 125 | -4.921 | 14.697 | 75.474 | 1.00 | 60.64 | | | C |
| ANISOU | 2026 | CZ | ARG | A | 125 | 8718 | 7939 | 6381 | -2441 | 312 | -1072 | | C |
| ATOM | 2027 | NH1 | ARG | A | 125 | -5.184 | 14.202 | 74.257 | 1.00 | 64.03 | | | N |
| ANISOU | 2027 | NH1 | ARG | A | 125 | 9244 | 8427 | 6658 | -2659 | 316 | -1265 | | N |
| ATOM | 2030 | NH2 | ARG | A | 125 | -4.967 | 13.896 | 76.532 | 1.00 | 60.93 | | | N |
| ANISOU | 2030 | NH2 | ARG | A | 125 | 8811 | 7735 | 6604 | -2407 | 321 | -1020 | | N |
| ATOM | 2033 | C | ARG | A | 125 | -3.538 | 20.948 | 72.446 | 1.00 | 45.79 | | | C |
| ANISOU | 2033 | C | ARG | A | 125 | 6386 | 7194 | 3817 | -2118 | 221 | -714 | | C |
| ATOM | 2034 | O | ARG | A | 125 | -2.938 | 22.006 | 72.589 | 1.00 | 44.62 | | | O |
| ANISOU | 2034 | O | ARG | A | 125 | 6174 | 7099 | 3681 | -1964 | 237 | -608 | | O |
| ATOM | 2036 | N | GLU | A | 126 | -4.333 | 20.715 | 71.403 | 1.00 | 48.29 | | | N |
| ANISOU | 2036 | N | GLU | A | 126 | 6727 | 7684 | 3936 | -2356 | 143 | -762 | | N |
| ATOM | 2037 | CA | GLU | A | 126 | -4.564 | 21.725 | 70.372 | 1.00 | 50.02 | | | C |
| ANISOU | 2037 | CA | GLU | A | 126 | 6892 | 8177 | 3936 | -2439 | 61 | -668 | | C |
| ATOM | 2039 | CB | GLU | A | 126 | -5.466 | 21.173 | 69.261 | 1.00 | 54.38 | | | C |
| ANISOU | 2039 | CB | GLU | A | 126 | 7490 | 8908 | 4264 | -2738 | -31 | -751 | | C |
| ATOM | 2042 | CG | GLU | A | 126 | -4.744 | 20.194 | 68.336 | 1.00 | 58.18 | | | C |
| ANISOU | 2042 | CG | GLU | A | 126 | 8160 | 9318 | 4628 | -2882 | 99 | -1055 | | C |
| ATOM | 2045 | CD | GLU | A | 126 | -5.599 | 19.708 | 67.177 | 1.00 | 62.53 | | | C |
| ANISOU | 2045 | CD | GLU | A | 126 | 8770 | 10066 | 4921 | -3205 | 5 | -1150 | | C |
| ATOM | 2046 | OE1 | GLU | A | 126 | -6.772 | 19.318 | 67.396 | 1.00 | 66.09 | | | O |
| ANISOU | 2046 | OE1 | GLU | A | 126 | 9164 | 10569 | 5379 | -3346 | -126 | -1081 | | O |
| ATOM | 2047 | OE2 | GLU | A | 126 | -5.090 | 19.700 | 66.029 | 1.00 | 67.00 | | | O |
| ANISOU | 2047 | OE2 | GLU | A | 126 | 9440 | 10751 | 5266 | -3334 | 64 | -1302 | | O |
| ATOM | 2048 | C | GLU | A | 126 | -5.161 | 22.998 | 70.981 | 1.00 | 46.88 | | | C |
| ANISOU | 2048 | C | GLU | A | 126 | 6319 | 7899 | 3593 | -2304 | -56 | -382 | | C |
| ATOM | 2049 | O | GLU | A | 126 | -6.163 | 22.923 | 71.687 | 1.00 | 45.32 | | | O |
| ANISOU | 2049 | O | GLU | A | 126 | 6021 | 7714 | 3485 | -2307 | -144 | -263 | | O |
| ATOM | 2051 | N | VAL | A | 127 | -4.539 | 24.151 | 70.693 | 1.00 | 44.69 | | | N |
| ANISOU | 2051 | N | VAL | A | 127 | 6009 | 7705 | 3265 | -2193 | -48 | -282 | | N |
| ATOM | 2052 | CA | VAL | A | 127 | -4.790 | 25.398 | 71.454 | 1.00 | 42.53 | | | C |

FIG. 18 (continued)

```
ANISOU 2052  CA  VAL A 127    5597   7463   3102  -2006   -116    -39        C
ATOM   2054  CB  VAL A 127     -3.921  26.626  70.971  1.00 42.31           C
ANISOU 2054  CB  VAL A 127    5571   7501   3003  -1915    -92     46        C
ATOM   2056  CG1 VAL A 127     -2.595  26.651  71.664  1.00 41.52           C
ANISOU 2056  CG1 VAL A 127    5521   7207   3049  -1739     59    -40        C
ATOM   2060  CG2 VAL A 127     -3.786  26.676  69.432  1.00 42.52           C
ANISOU 2060  CG2 VAL A 127    5675   7722   2759  -2119   -115    -11        C
ATOM   2064  C   VAL A 127     -6.242  25.849  71.496  1.00 42.91           C
ANISOU 2064  C   VAL A 127    5496   7681   3126  -2061   -287    156        C
ATOM   2065  O   VAL A 127     -6.676  26.391  72.527  1.00 38.29           O
ANISOU 2065  O   VAL A 127    4794   7052   2703  -1903   -316    301        O
ATOM   2067  N   HIS A 128     -6.993  25.591  70.413  1.00 45.20           N
ANISOU 2067  N   HIS A 128    5785   8170   3219  -2287   -396    151        N
ATOM   2068  CA  HIS A 128     -8.389  26.051  70.311  1.00 47.61           C
ANISOU 2068  CA  HIS A 128    5922   8675   3492  -2348   -578    350        C
ATOM   2070  CB  HIS A 128     -8.966  25.920  68.878  1.00 52.22           C
ANISOU 2070  CB  HIS A 128    6522   9513   3806  -2613   -710    351        C
ATOM   2073  CG  HIS A 128     -9.092  24.509  68.389  1.00 55.29           C
ANISOU 2073  CG  HIS A 128    7034   9889   4084  -2861   -676    113        C
ATOM   2074  ND1 HIS A 128     -8.044  23.833  67.803  1.00 57.20           N
ANISOU 2074  ND1 HIS A 128    7474  10035   4225  -2943   -533   -132        N
ATOM   2076  CE1 HIS A 128     -8.436  22.616  67.473  1.00 58.85           C
ANISOU 2076  CE1 HIS A 128    7770  10228   4362  -3165   -529   -320        C
ATOM   2078  NE2 HIS A 128     -9.708  22.485  67.803  1.00 59.70           N
ANISOU 2078  NE2 HIS A 128    7737  10437   4509  -3249   -673   -194        N
ATOM   2080  CD2 HIS A 128    -10.145  23.657  68.374  1.00 57.87           C
ANISOU 2080  CD2 HIS A 128    7316  10286   4387  -3054   -763     77        C
ATOM   2082  C   HIS A 128     -9.304  25.383  71.332  1.00 46.50           C
ANISOU 2082  C   HIS A 128    5685   8473   3511  -2346   -595    361        C
ATOM   2083  O   HIS A 128    -10.235  26.020  71.805  1.00 46.79           O
ANISOU 2083  O   HIS A 128    5542   8608   3630  -2269   -693    549        O
ATOM   2085  N   ILE A 129     -9.015  24.137  71.708  1.00 46.43           N
ANISOU 2085  N   ILE A 129    5791   8291   3558  -2420   -493    167        N
ATOM   2086  CA  ILE A 129     -9.842  23.417  72.690  1.00 45.59           C
ANISOU 2086  CA  ILE A 129    5613   8117   3593  -2448   -500    180        C
ATOM   2088  CB  ILE A 129     -9.346  21.959  72.928  1.00 46.37           C
ANISOU 2088  CB  ILE A 129    5890   7989   3741  -2548   -385    -48        C
ATOM   2090  CG1 ILE A 129     -9.480  21.130  71.650  1.00 49.20           C
ANISOU 2090  CG1 ILE A 129    6368   8425   3898  -2827   -417   -223        C
ATOM   2093  CD1 ILE A 129     -8.604  19.886  71.593  1.00 50.17           C
ANISOU 2093  CD1 ILE A 129    6709   8294   4059  -2884   -274   -485        C
ATOM   2097  CG2 ILE A 129    -10.130  21.287  74.078  1.00 46.25           C
ANISOU 2097  CG2 ILE A 129    5806   7884   3881  -2568   -385     -3        C
ATOM   2101  C   ILE A 129     -9.919  24.162  74.019  1.00 42.62           C
ANISOU 2101  C   ILE A 129    5112   7663   3417  -2198   -467    333        C
ATOM   2102  O   ILE A 129    -11.020  24.437  74.509  1.00 42.48           O
ANISOU 2102  O   ILE A 129    4919   7762   3459  -2192   -546    475        O
ATOM   2104  N   TYR A 130     -8.764  24.493  74.601  1.00 40.24           N
ANISOU 2104  N   TYR A 130    4893   7182   3216  -2001   -349    298        N
ATOM   2105  CA  TYR A 130     -8.722  25.192  75.890  1.00 38.32           C
ANISOU 2105  CA  TYR A 130    4559   6856   3146  -1775   -306    417        C
ATOM   2107  CB  TYR A 130     -7.328  25.056  76.582  1.00 36.58           C
ANISOU 2107  CB  TYR A 130    4470   6401   3029  -1619   -167    320        C
ATOM   2110  CG  TYR A 130     -7.282  25.441  78.057  1.00 35.93           C
ANISOU 2110  CG  TYR A 130    4325   6215   3112  -1434   -115    405        C
ATOM   2111  CD1 TYR A 130     -8.351  25.148  78.925  1.00 36.07           C
ANISOU 2111  CD1 TYR A 130    4237   6269   3201  -1462   -137    480        C
ATOM   2113  CE1 TYR A 130     -8.300  25.494  80.279  1.00 33.86           C
ANISOU 2113  CE1 TYR A 130    3911   5910   3045  -1309    -78    545        C
ATOM   2115  CZ  TYR A 130     -7.196  26.112  80.765  1.00 32.86           C
ANISOU 2115  CZ  TYR A 130    3846   5665   2974  -1135    -11    537        C
ATOM   2116  OH  TYR A 130     -7.169  26.413  82.116  1.00 33.26           O
ANISOU 2116  OH  TYR A 130    3862   5651   3124  -1008     43    591        O
ATOM   2118  CE2 TYR A 130     -6.101  26.403  79.926  1.00 32.09           C
ANISOU 2118  CE2 TYR A 130    3845   5525   2823  -1104      6    468        C
ATOM   2120  CD2 TYR A 130     -6.136  26.053  78.614  1.00 32.96           C
ANISOU 2120  CD2 TYR A 130    4000   5712   2810  -1249    -36    401        C
ATOM   2122  C   TYR A 130     -9.128  26.653  75.736  1.00 36.86           C
ANISOU 2122  C   TYR A 130    4229   6821   2955  -1649   -388    606        C
ATOM   2123  O   TYR A 130     -9.737  27.218  76.635  1.00 35.99           O
ANISOU 2123  O   TYR A 130    3983   6728   2963  -1522   -398    726        O
ATOM   2125  N   TYR A 131     -8.804  27.262  74.609  1.00 38.38           N
ANISOU 2125  N   TYR A 131    4454   7117   3012  -1684   -444    633        N
ATOM   2126  CA  TYR A 131     -9.315  28.599  74.318  1.00 40.22           C
ANISOU 2126  CA  TYR A 131    4554   7491   3238  -1587   -549    834        C
ATOM   2128  CB  TYR A 131     -8.871  29.095  72.931  1.00 42.14           C
ANISOU 2128  CB  TYR A 131    4870   7850   3291  -1678   -614    860        C
ATOM   2131  CG  TYR A 131     -9.357  30.506  72.685  1.00 42.83           C
ANISOU 2131  CG  TYR A 131    4831   8047   3395  -1561   -731   1093        C
```

FIG. 18 (continued)

```
ATOM    2132  CD1 TYR A 131      -8.554  31.597  72.981  1.00 41.19          C
ANISOU  2132  CD1 TYR A 131    4660   7725   3265  -1376   -679   1164       C
ATOM    2134  CE1 TYR A 131      -9.010  32.888  72.793  1.00 43.05          C
ANISOU  2134  CE1 TYR A 131    4793   8023   3540  -1259   -785   1381       C
ATOM    2136  CZ  TYR A 131     -10.299  33.091  72.329  1.00 45.42          C
ANISOU  2136  CZ  TYR A 131    4929   8515   3811  -1310   -952   1538       C
ATOM    2137  OH  TYR A 131     -10.765  34.365  72.155  1.00 46.58          O
ANISOU  2137  OH  TYR A 131    4969   8704   4025  -1172  -1064   1764       O
ATOM    2139  CE2 TYR A 131     -11.117  32.025  72.058  1.00 46.64          C
ANISOU  2139  CE2 TYR A 131    5025   8813   3885  -1496  -1011   1474       C
ATOM    2141  CD2 TYR A 131     -10.658  30.746  72.238  1.00 45.00          C
ANISOU  2141  CD2 TYR A 131    4939   8530   3631  -1629   -899   1250       C
ATOM    2143  C   TYR A 131     -10.838  28.645  74.420  1.00 42.10          C
ANISOU  2143  C   TYR A 131    4591   7905   3502  -1638   -674    966       C
ATOM    2144  O   TYR A 131     -11.379  29.467  75.156  1.00 41.12          O
ANISOU  2144  O   TYR A 131    4318   7792   3513  -1467   -690   1102       O
ATOM    2146  N   LEU A 132     -11.514  27.743  73.703  1.00 44.84          N
ANISOU  2146  N   LEU A 132    4928   8387   3721  -1877   -755    913       N
ATOM    2147  CA  LEU A 132     -12.987  27.687  73.705  1.00 48.46          C
ANISOU  2147  CA  LEU A 132    5175   9046   4193  -1961   -885   1035       C
ATOM    2149  CB  LEU A 132     -13.494  26.706  72.642  1.00 51.39          C
ANISOU  2149  CB  LEU A 132    5581   9572   4372  -2270   -985    953       C
ATOM    2152  CG  LEU A 132     -13.257  27.196  71.219  1.00 53.77          C
ANISOU  2152  CG  LEU A 132    5940  10030   4461  -2373  -1098    998       C
ATOM    2154  CD1 LEU A 132     -13.648  26.114  70.194  1.00 56.11          C
ANISOU  2154  CD1 LEU A 132    6309  10468   4543  -2707  -1177    870       C
ATOM    2158  CD2 LEU A 132     -14.022  28.498  70.954  1.00 55.16          C
ANISOU  2158  CD2 LEU A 132    5908  10390   4659  -2252  -1257   1266       C
ATOM    2162  C   LEU A 132     -13.582  27.317  75.056  1.00 48.29          C
ANISOU  2162  C   LEU A 132    5042   8957   4349  -1889   -812   1038       C
ATOM    2163  O   LEU A 132     -14.611  27.888  75.468  1.00 48.07          O
ANISOU  2163  O   LEU A 132    4791   9058   4414  -1807   -874   1187       O
ATOM    2165  N   GLU A 133     -12.955  26.353  75.731  1.00 47.34          N
ANISOU  2165  N   GLU A 133    5071   8640   4276  -1921   -679    878       N
ATOM    2166  CA  GLU A 133     -13.354  26.018  77.101  1.00 48.96          C
ANISOU  2166  CA  GLU A 133    5202   8764   4637  -1852   -593    885       C
ATOM    2168  CB  GLU A 133     -12.405  24.967  77.683  1.00 49.11          C
ANISOU  2168  CB  GLU A 133    5431   8538   4691  -1885   -461    719       C
ATOM    2171  CG  GLU A 133     -12.731  24.509  79.087  1.00 50.08          C
ANISOU  2171  CG  GLU A 133    5512   8571   4946  -1846   -374    732       C
ATOM    2174  CD  GLU A 133     -11.711  23.502  79.628  1.00 50.60          C
ANISOU  2174  CD  GLU A 133    5793   8378   5054  -1863   -264    594       C
ATOM    2175  OE1 GLU A 133     -11.265  22.635  78.831  1.00 53.37          O
ANISOU  2175  OE1 GLU A 133    6297   8651   5330  -2011   -270    461       O
ATOM    2176  OE2 GLU A 133     -11.357  23.589  80.835  1.00 49.10          O
ANISOU  2176  OE2 GLU A 133    5620   8066   4971  -1726   -174    618       O
ATOM    2177  C   GLU A 133     -13.397  27.295  77.961  1.00 47.58          C
ANISOU  2177  C   GLU A 133    4902   8576   4599  -1578   -553   1014       C
ATOM    2178  O   GLU A 133     -14.422  27.610  78.561  1.00 49.05          O
ANISOU  2178  O   GLU A 133    4887   8877   4874  -1527   -571   1116       O
ATOM    2180  N   LYS A 134     -12.304  28.052  77.970  1.00 46.22          N
ANISOU  2180  N   LYS A 134    4843   8272   4445  -1411   -498   1004       N
ATOM    2181  CA  LYS A 134     -12.245  29.329  78.678  1.00 46.32          C
ANISOU  2181  CA  LYS A 134    4770   8250   4580  -1162   -462   1108       C
ATOM    2183  CB  LYS A 134     -10.828  29.918  78.629  1.00 44.96          C
ANISOU  2183  CB  LYS A 134    4769   7907   4406  -1036   -394   1060       C
ATOM    2186  CG  LYS A 134      -9.840  29.287  79.606  1.00 43.52          C
ANISOU  2186  CG  LYS A 134    4734   7522   4280   -997   -257    930       C
ATOM    2189  CD  LYS A 134      -8.647  30.241  79.840  1.00 42.71          C
ANISOU  2189  CD  LYS A 134    4726   7283   4218   -825   -196    926       C
ATOM    2192  CE  LYS A 134      -7.758  29.817  80.993  1.00 40.35          C
ANISOU  2192  CE  LYS A 134    4531   6805   3994   -756    -77    832       C
ATOM    2195  NZ  LYS A 134      -8.469  29.722  82.297  1.00 37.26          N
ANISOU  2195  NZ  LYS A 134    4050   6413   3694   -699    -27    861       N
ATOM    2199  C   LYS A 134     -13.222  30.382  78.163  1.00 49.37          C
ANISOU  2199  C   LYS A 134    4954   8819   4986  -1088   -587   1283       C
ATOM    2200  O   LYS A 134     -13.880  31.053  78.966  1.00 48.21          O
ANISOU  2200  O   LYS A 134    4645   8699   4973   -930   -561   1366       O
ATOM    2202  N   ALA A 135     -13.302  30.531  76.837  1.00 51.15          N
ANISOU  2202  N   ALA A 135    5188   9168   5078  -1199   -719   1338       N
ATOM    2203  CA  ALA A 135     -14.077  31.611  76.218  1.00 55.42          C
ANISOU  2203  CA  ALA A 135    5556   9868   5633  -1117   -861   1532       C
ATOM    2205  CB  ALA A 135     -13.682  31.781  74.761  1.00 54.66          C
ANISOU  2205  CB  ALA A 135    5558   9858   5351  -1246   -983   1574       C
ATOM    2209  C   ALA A 135     -15.598  31.419  76.343  1.00 59.22          C
ANISOU  2209  C   ALA A 135    5772  10560   6167  -1168   -953   1631       C
ATOM    2210  O   ALA A 135     -16.343  32.391  76.380  1.00 59.37          O
ANISOU  2210  O   ALA A 135    5595  10670   6291  -1012  -1027   1793       O
ATOM    2212  N   ASN A 136     -16.059  30.177  76.416  1.00 63.22          N
```

FIG. 18 (continued)

| | | | | | | | | | | | | | |
|---|---|---|---|---|---|---|---|---|---|---|---|---|---|
| ANISOU | 2212 | N | ASN | A | 136 | 6267 | 11140 | 6614 | -1383 | -948 | 1535 | | N |
| ATOM | 2213 | CA | ASN | A | 136 | -17.498 | 29.922 | 76.561 | 1.00 | 68.68 | | | C |
| ANISOU | 2213 | CA | ASN | A | 136 | 6694 | 12050 | 7353 | -1460 | -1029 | 1622 | | C |
| ATOM | 2215 | CB | ASN | A | 136 | -17.859 | 28.536 | 76.018 | 1.00 | 70.03 | | | C |
| ANISOU | 2215 | CB | ASN | A | 136 | 6908 | 12323 | 7376 | -1788 | -1085 | 1523 | | C |
| ATOM | 2218 | CG | ASN | A | 136 | -17.876 | 28.502 | 74.511 | 1.00 | 71.39 | | | C |
| ANISOU | 2218 | CG | ASN | A | 136 | 7125 | 12646 | 7352 | -1968 | -1259 | 1559 | | C |
| ATOM | 2219 | OD1 | ASN | A | 136 | -18.630 | 29.243 | 73.872 | 1.00 | 73.71 | | | O |
| ANISOU | 2219 | OD1 | ASN | A | 136 | 7230 | 13145 | 7633 | -1939 | -1422 | 1738 | | O |
| ATOM | 2220 | ND2 | ASN | A | 136 | -17.040 | 27.649 | 73.927 | 1.00 | 70.50 | | | N |
| ANISOU | 2220 | ND2 | ASN | A | 136 | 7265 | 12439 | 7085 | -2153 | -1225 | 1391 | | N |
| ATOM | 2223 | C | ASN | A | 136 | -18.020 | 30.096 | 77.990 | 1.00 | 71.44 | | | C |
| ANISOU | 2223 | C | ASN | A | 136 | 6891 | 12363 | 7890 | -1300 | -897 | 1628 | | C |
| ATOM | 2224 | O | ASN | A | 136 | -19.213 | 29.948 | 78.236 | 1.00 | 73.94 | | | O |
| ANISOU | 2224 | O | ASN | A | 136 | 6961 | 12865 | 8266 | -1343 | -938 | 1699 | | O |
| ATOM | 2226 | N | LYS | A | 137 | -17.123 | 30.393 | 78.925 | 1.00 | 73.18 | | | N |
| ANISOU | 2226 | N | LYS | A | 137 | 7253 | 12359 | 8192 | -1130 | -738 | 1549 | | N |
| ATOM | 2227 | CA | LYS | A | 137 | -17.507 | 30.883 | 80.249 | 1.00 | 75.80 | | | C |
| ANISOU | 2227 | CA | LYS | A | 137 | 7455 | 12655 | 8690 | -937 | -608 | 1562 | | C |
| ATOM | 2229 | CB | LYS | A | 137 | -16.696 | 30.175 | 81.342 | 1.00 | 74.26 | | | C |
| ANISOU | 2229 | CB | LYS | A | 137 | 7450 | 12266 | 8501 | -956 | -437 | 1414 | | C |
| ATOM | 2232 | CG | LYS | A | 137 | -17.202 | 28.767 | 81.693 | 1.00 | 75.54 | | | C |
| ANISOU | 2232 | CG | LYS | A | 137 | 7603 | 12485 | 8612 | -1199 | -408 | 1346 | | C |
| ATOM | 2235 | CD | LYS | A | 137 | -16.833 | 28.376 | 83.142 | 1.00 | 74.49 | | | C |
| ANISOU | 2235 | CD | LYS | A | 137 | 7555 | 12211 | 8537 | -1156 | -233 | 1266 | | C |
| ATOM | 2238 | CE | LYS | A | 137 | -17.685 | 27.210 | 83.679 | 1.00 | 75.65 | | | C |
| ANISOU | 2238 | CE | LYS | A | 137 | 7621 | 12455 | 8669 | -1374 | -200 | 1251 | | C |
| ATOM | 2241 | NZ | LYS | A | 137 | -17.634 | 27.093 | 85.172 | 1.00 | 75.06 | | | N |
| ANISOU | 2241 | NZ | LYS | A | 137 | 7557 | 12311 | 8652 | -1310 | -35 | 1222 | | N |
| ATOM | 2245 | C | LYS | A | 137 | -17.261 | 32.396 | 80.299 | 1.00 | 77.32 | | | C |
| ANISOU | 2245 | C | LYS | A | 137 | 7610 | 12774 | 8995 | -653 | -607 | 1655 | | C |
| ATOM | 2246 | O | LYS | A | 137 | -18.187 | 33.186 | 80.494 | 1.00 | 77.66 | | | O |
| ANISOU | 2246 | O | LYS | A | 137 | 7416 | 12927 | 9165 | -500 | -634 | 1767 | | O |
| ATOM | 2248 | N | ILE | A | 138 | -15.995 | 32.764 | 80.094 | 1.00 | 78.30 | | | N |
| ANISOU | 2248 | N | ILE | A | 138 | 7968 | 12706 | 9077 | -591 | -576 | 1605 | | N |
| ATOM | 2249 | CA | ILE | A | 138 | -15.515 | 34.154 | 80.084 | 1.00 | 79.99 | | | C |
| ANISOU | 2249 | CA | ILE | A | 138 | 8211 | 12800 | 9380 | -354 | -572 | 1677 | | C |
| ATOM | 2251 | CB | ILE | A | 138 | -13.967 | 34.188 | 79.899 | 1.00 | 77.72 | | | C |
| ANISOU | 2251 | CB | ILE | A | 138 | 8210 | 12310 | 9012 | -365 | -519 | 1584 | | C |
| ATOM | 2253 | CG1 | ILE | A | 138 | -13.276 | 33.618 | 81.140 | 1.00 | 76.00 | | | C |
| ANISOU | 2253 | CG1 | ILE | A | 138 | 8118 | 11938 | 8821 | -354 | -348 | 1428 | | C |
| ATOM | 2256 | CD1 | ILE | A | 138 | -11.880 | 33.167 | 80.884 | 1.00 | 74.39 | | | C |
| ANISOU | 2256 | CD1 | ILE | A | 138 | 8159 | 11585 | 8519 | -432 | -309 | 1321 | | C |
| ATOM | 2260 | CG2 | ILE | A | 138 | -13.472 | 35.598 | 79.615 | 1.00 | 77.65 | | | C |
| ANISOU | 2260 | CG2 | ILE | A | 138 | 8245 | 12191 | 9069 | -176 | -547 | 1678 | | C |
| ATOM | 2264 | C | ILE | A | 138 | -16.165 | 34.951 | 78.960 | 1.00 | 83.58 | | | C |
| ANISOU | 2264 | C | ILE | A | 138 | 8524 | 13394 | 9838 | -314 | -754 | 1863 | | C |
| ATOM | 2265 | O | ILE | A | 138 | -16.048 | 34.579 | 77.798 | 1.00 | 84.31 | | | O |
| ANISOU | 2265 | O | ILE | A | 138 | 8676 | 13582 | 9777 | -487 | -885 | 1902 | | O |
| ATOM | 2267 | N | LYS | A | 139 | -16.855 | 36.037 | 79.312 | 1.00 | 87.23 | | | N |
| ANISOU | 2267 | N | LYS | A | 139 | 8802 | 13868 | 10475 | -85 | -762 | 1977 | | N |
| ATOM | 2268 | CA | LYS | A | 139 | -17.618 | 36.834 | 78.342 | 1.00 | 91.40 | | | C |
| ANISOU | 2268 | CA | LYS | A | 139 | 9156 | 14531 | 11042 | -16 | -950 | 2187 | | C |
| ATOM | 2270 | CB | LYS | A | 139 | -19.097 | 36.422 | 78.370 | 1.00 | 94.18 | | | C |
| ANISOU | 2270 | CB | LYS | A | 139 | 9193 | 15142 | 11448 | -63 | -1023 | 2262 | | C |
| ATOM | 2273 | CG | LYS | A | 139 | -19.373 | 35.006 | 77.848 | 1.00 | 94.45 | | | C |
| ANISOU | 2273 | CG | LYS | A | 139 | 9234 | 15358 | 11294 | -388 | -1091 | 2200 | | C |
| ATOM | 2276 | CD | LYS | A | 139 | -20.717 | 34.467 | 78.340 | 1.00 | 96.28 | | | C |
| ANISOU | 2276 | CD | LYS | A | 139 | 9169 | 15811 | 11603 | -443 | -1089 | 2218 | | C |
| ATOM | 2279 | CE | LYS | A | 139 | -20.853 | 32.969 | 78.056 | 1.00 | 96.23 | | | C |
| ANISOU | 2279 | CE | LYS | A | 139 | 9218 | 15924 | 11420 | -783 | -1114 | 2116 | | C |
| ATOM | 2282 | NZ | LYS | A | 139 | -22.068 | 32.369 | 78.681 | 1.00 | 97.63 | | | N |
| ANISOU | 2282 | NZ | LYS | A | 139 | 9126 | 16300 | 11669 | -865 | -1082 | 2116 | | N |
| ATOM | 2286 | C | LYS | A | 139 | -17.476 | 38.346 | 78.595 | 1.00 | 92.86 | | | C |
| ANISOU | 2286 | C | LYS | A | 139 | 9324 | 14549 | 11409 | 281 | -933 | 2285 | | C |
| ATOM | 2287 | O | LYS | A | 139 | -18.387 | 38.990 | 79.127 | 1.00 | 95.32 | | | O |
| ANISOU | 2287 | O | LYS | A | 139 | 9409 | 14893 | 11913 | 482 | -913 | 2353 | | O |
| ATOM | 2289 | N | SER | A | 140 | -16.322 | 38.895 | 78.210 | 1.00 | 92.08 | | | N |
| ANISOU | 2289 | N | SER | A | 140 | 9465 | 14266 | 11255 | 302 | -933 | 2286 | | N |
| ATOM | 2290 | CA | SER | A | 140 | -16.079 | 40.341 | 78.252 | 1.00 | 92.86 | | | C |
| ANISOU | 2290 | CA | SER | A | 140 | 9590 | 14182 | 11508 | 546 | -941 | 2394 | | C |
| ATOM | 2292 | CB | SER | A | 140 | -15.804 | 40.810 | 79.686 | 1.00 | 91.69 | | | C |
| ANISOU | 2292 | CB | SER | A | 140 | 9478 | 13834 | 11527 | 742 | -731 | 2248 | | C |
| ATOM | 2295 | OG | SER | A | 140 | -15.576 | 42.212 | 79.720 | 1.00 | 92.19 | | | O |
| ANISOU | 2295 | OG | SER | A | 140 | 9582 | 13697 | 11749 | 968 | -736 | 2339 | | O |
| ATOM | 2297 | C | SER | A | 140 | -14.913 | 40.730 | 77.339 | 1.00 | 92.03 | | | C |
| ANISOU | 2297 | C | SER | A | 140 | 9735 | 13963 | 11271 | 464 | -1008 | 2445 | | C |
| ATOM | 2298 | O | SER | A | 140 | -14.881 | 41.832 | 76.788 | 1.00 | 93.16 | | | O |
| ANISOU | 2298 | O | SER | A | 140 | 9887 | 14025 | 11483 | 585 | -1108 | 2617 | | O |

FIG. 18 (continued)

```
ATOM   2300  N   THR A 143    -12.500  40.872  79.269  1.00 47.17          N
ANISOU 2300  N   THR A 143    4479   7820   5623    542   -627   2069      N
ATOM   2301  CA  THR A 143    -11.294  40.112  79.611  1.00 44.77          C
ANISOU 2301  CA  THR A 143    4379   7437   5195    405   -515   1890      C
ATOM   2303  CB  THR A 143    -11.526  39.043  80.716  1.00 44.28          C
ANISOU 2303  CB  THR A 143    4273   7418   5133    360   -386   1722      C
ATOM   2305  OG1 THR A 143    -11.833  39.676  81.967  1.00 45.24          O
ANISOU 2305  OG1 THR A 143    4332   7439   5419    551   -265   1668      O
ATOM   2307  CG2 THR A 143    -10.270  38.189  80.922  1.00 41.35          C
ANISOU 2307  CG2 THR A 143    4104   6969   4637    218   -301   1566      C
ATOM   2311  C   THR A 143    -10.760  39.434  78.348  1.00 43.76          C
ANISOU 2311  C   THR A 143    4355   7415   4857    181   -612   1914      C
ATOM   2312  O   THR A 143    -11.485  38.717  77.670  1.00 46.32          O
ANISOU 2312  O   THR A 143    4580   7934   5087     49   -711   1959      O
ATOM   2314  N   HIS A 144     -9.468  39.620  78.094  1.00 40.51          N
ANISOU 2314  N   HIS A 144    4144   6882   4368    127   -569   1862      N
ATOM   2315  CA  HIS A 144     -8.793  39.135  76.900  1.00 39.05          C
ANISOU 2315  CA  HIS A 144    4077   6779   3981    -73   -631   1867      C
ATOM   2317  CB  HIS A 144     -7.682  40.134  76.579  1.00 40.22          C
ANISOU 2317  CB  HIS A 144    4381   6777   4122    -41   -615   1915      C
ATOM   2320  CG  HIS A 144     -7.268  40.159  75.143  1.00 40.58          C
ANISOU 2320  CG  HIS A 144    4511   6930   3976   -210   -714   2008      C
ATOM   2321  ND1 HIS A 144     -7.949  40.869  74.181  1.00 43.03          N
ANISOU 2321  ND1 HIS A 144    4759   7334   4255   -213   -879   2231      N
ATOM   2323  CE1 HIS A 144     -7.348  40.713  73.015  1.00 42.66          C
ANISOU 2323  CE1 HIS A 144    4823   7386   3999   -400   -929   2267      C
ATOM   2325  NE2 HIS A 144     -6.293  39.936  73.191  1.00 40.23          N
ANISOU 2325  NE2 HIS A 144    4637   7045   3604   -504   -790   2061      N
ATOM   2327  CD2 HIS A 144     -6.205  39.601  74.520  1.00 39.11          C
ANISOU 2327  CD2 HIS A 144    4467   6774   3617   -381   -664   1909      C
ATOM   2329  C   HIS A 144     -8.186  37.773  77.210  1.00 36.00          C
ANISOU 2329  C   HIS A 144    3774   6406   3496   -215   -527   1663      C
ATOM   2330  O   HIS A 144     -7.598  37.623  78.255  1.00 34.79          O
ANISOU 2330  O   HIS A 144    3679   6122   3419   -149   -401   1539      O
ATOM   2332  N   ILE A 145     -8.326  36.800  76.316  1.00 35.70          N
ANISOU 2332  N   ILE A 145    3747   6521   3295   -410   -585   1631      N
ATOM   2333  CA  ILE A 145     -7.771  35.438  76.499  1.00 34.71          C
ANISOU 2333  CA  ILE A 145    3712   6390   3087   -548   -493   1437      C
ATOM   2335  CB  ILE A 145     -8.802  34.311  76.153  1.00 35.82          C
ANISOU 2335  CB  ILE A 145    3758   6700   3151   -704   -560   1410      C
ATOM   2337  CG1 ILE A 145    -10.039  34.391  77.054  1.00 37.69          C
ANISOU 2337  CG1 ILE A 145    3806   6982   3533   -601   -574   1471      C
ATOM   2340  CD1 ILE A 145    -11.292  33.742  76.458  1.00 39.09          C
ANISOU 2340  CD1 ILE A 145    3836   7375   3642   -748   -695   1527      C
ATOM   2344  CG2 ILE A 145     -8.195  32.911  76.264  1.00 34.65          C
ANISOU 2344  CG2 ILE A 145    3726   6509   2930   -847   -468   1211      C
ATOM   2348  C   ILE A 145     -6.531  35.230  75.614  1.00 33.76          C
ANISOU 2348  C   ILE A 145    3760   6252   2816   -672   -461   1362      C
ATOM   2349  O   ILE A 145     -6.529  35.612  74.436  1.00 32.44          O
ANISOU 2349  O   ILE A 145    3618   6193   2516   -766   -553   1458      O
ATOM   2351  N   HIS A 146     -5.494  34.624  76.201  1.00 30.52          N
ANISOU 2351  N   HIS A 146    3454   5716   2425   -672   -329   1196      N
ATOM   2352  CA  HIS A 146     -4.276  34.273  75.492  1.00 30.69          C
ANISOU 2352  CA  HIS A 146    3614   5722   2326   -777   -267   1090      C
ATOM   2354  CB  HIS A 146     -3.179  35.304  75.787  1.00 30.54          C
ANISOU 2354  CB  HIS A 146    3662   5575   2366   -672   -205   1116      C
ATOM   2357  CG  HIS A 146     -2.031  35.272  74.836  1.00 29.21          C
ANISOU 2357  CG  HIS A 146    3603   5435   2061   -785   -157   1058      C
ATOM   2358  ND1 HIS A 146     -1.281  36.388  74.554  1.00 31.04          N
ANISOU 2358  ND1 HIS A 146    3885   5624   2284   -759   -149   1144      N
ATOM   2360  CE1 HIS A 146     -0.332  36.074  73.687  1.00 32.01          C
ANISOU 2360  CE1 HIS A 146    4089   5807   2265   -888    -88   1062      C
ATOM   2362  NE2 HIS A 146     -0.453  34.797  73.384  1.00 33.21          N
ANISOU 2362  NE2 HIS A 146    4252   6026   2340   -986    -55    914      N
ATOM   2364  CD2 HIS A 146     -1.504  34.269  74.101  1.00 32.00          C
ANISOU 2364  CD2 HIS A 146    4023   5854   2281   -930   -102    914      C
ATOM   2366  C   HIS A 146     -3.848  32.882  75.946  1.00 30.54          C
ANISOU 2366  C   HIS A 146    3649   5641   2314   -836   -168    895      C
ATOM   2367  O   HIS A 146     -3.496  32.666  77.106  1.00 28.95          O
ANISOU 2367  O   HIS A 146    3453   5307   2241   -732    -89    831      O
ATOM   2369  N   ILE A 147     -3.882  31.943  75.021  1.00 32.17          N
ANISOU 2369  N   ILE A 147    3904   5940   2380  -1007   -178    802      N
ATOM   2370  CA  ILE A 147     -3.512  30.560  75.304  1.00 32.34          C
ANISOU 2370  CA  ILE A 147    3990   5884   2412  -1072    -91    614      C
ATOM   2372  CB  ILE A 147     -4.612  29.532  74.812  1.00 32.68          C
ANISOU 2372  CB  ILE A 147    4007   6038   2372  -1243   -162    574      C
ATOM   2374  CG1 ILE A 147     -6.003  29.856  75.380  1.00 32.46          C
ANISOU 2374  CG1 ILE A 147    3827   6086   2420  -1202   -261    721      C
ATOM   2377  CD1 ILE A 147     -6.156  29.828  76.943  1.00 30.54          C
```

FIG. 18 (continued)

```
ANISOU 2377  CD1 ILE A 147    3528   5710   2365  -1048   -198    732        C
ATOM   2381  CG2 ILE A 147     -4.223  28.089  75.170  1.00 31.89            C
ANISOU 2381  CG2 ILE A 147    3994   5813   2312  -1303    -68    381        C
ATOM   2385  C   ILE A 147     -2.186  30.252  74.627  1.00 31.80            C
ANISOU 2385  C   ILE A 147    4040   5781   2262  -1126      8    474        C
ATOM   2386  O   ILE A 147     -1.951  30.674  73.488  1.00 33.41            O
ANISOU 2386  O   ILE A 147    4280   6103   2311  -1224    -16    497        O
ATOM   2388  N   PHE A 148     -1.310  29.550  75.353  1.00 31.13            N
ANISOU 2388  N   PHE A 148    4005   5540   2281  -1059    119    339        N
ATOM   2389  CA  PHE A 148     -0.071  28.996  74.815  1.00 32.27            C
ANISOU 2389  CA  PHE A 148    4240   5640   2382  -1097    232    172        C
ATOM   2391  CB  PHE A 148      1.135  29.450  75.657  1.00 30.15            C
ANISOU 2391  CB  PHE A 148    3968   5243   2244   -940    316    163        C
ATOM   2394  CG  PHE A 148      1.391  30.945  75.660  1.00 29.42            C
ANISOU 2394  CG  PHE A 148    3841   5193   2145   -877    283    312        C
ATOM   2395  CD1 PHE A 148      2.305  31.515  74.758  1.00 30.11            C
ANISOU 2395  CD1 PHE A 148    3964   5350   2129   -932    332    300        C
ATOM   2397  CE1 PHE A 148      2.549  32.872  74.735  1.00 29.73            C
ANISOU 2397  CE1 PHE A 148    3900   5320   2077   -893    300    444        C
ATOM   2399  CZ  PHE A 148      1.916  33.700  75.690  1.00 30.26            C
ANISOU 2399  CZ  PHE A 148    3917   5317   2264   -772    226    585        C
ATOM   2401  CE2 PHE A 148      1.030  33.149  76.615  1.00 27.15            C
ANISOU 2401  CE2 PHE A 148    3478   4867   1970   -705    192    582        C
ATOM   2403  CD2 PHE A 148      0.776  31.774  76.610  1.00 28.23            C
ANISOU 2403  CD2 PHE A 148    3629   4999   2098   -764    218    455        C
ATOM   2405  C   PHE A 148     -0.105  27.459  74.836  1.00 32.95            C
ANISOU 2405  C   PHE A 148    4387   5642   2490  -1169    286     -7        C
ATOM   2406  O   PHE A 148     -0.477  26.888  75.842  1.00 31.17            O
ANISOU 2406  O   PHE A 148    4145   5305   2395  -1111    279     -3        O
ATOM   2408  N   SER A 149      0.364  26.784  73.776  1.00 36.22            N
ANISOU 2408  N   SER A 149    4882   6095   2784  -1292    352   -170        N
ATOM   2409  CA  SER A 149      0.638  25.324  73.867  1.00 36.59            C
ANISOU 2409  CA  SER A 149    5008   6000   2894  -1326    435   -370        C
ATOM   2411  CB  SER A 149      0.099  24.569  72.667  1.00 39.67            C
ANISOU 2411  CB  SER A 149    5474   6490   3107  -1542    426   -501        C
ATOM   2414  OG  SER A 149      0.994  24.741  71.571  1.00 42.98            O
ANISOU 2414  OG  SER A 149    5948   7000   3383  -1604    520   -620        O
ATOM   2416  C   SER A 149      2.134  25.043  73.982  1.00 37.30            C
ANISOU 2416  C   SER A 149    5130   5967   3074  -1216    579   -509        C
ATOM   2417  O   SER A 149      2.952  25.850  73.547  1.00 38.59            O
ANISOU 2417  O   SER A 149    5272   6210   3179  -1187    629   -495        O
ATOM   2419  N   PHE A 150      2.493  23.866  74.492  1.00 37.91            N
ANISOU 2419  N   PHE A 150    5256   5855   3293  -1165    646   -643        N
ATOM   2420  CA  PHE A 150      3.916  23.485  74.625  1.00 38.73            C
ANISOU 2420  CA  PHE A 150    5370   5835   3513  -1040    780   -779        C
ATOM   2422  CB  PHE A 150      4.054  22.174  75.416  1.00 37.56            C
ANISOU 2422  CB  PHE A 150    5270   5444   3558   -965    811   -870        C
ATOM   2425  CG  PHE A 150      3.898  22.365  76.886  1.00 35.80            C
ANISOU 2425  CG  PHE A 150    4991   5116   3494   -831    735   -701        C
ATOM   2426  CD1 PHE A 150      5.006  22.554  77.715  1.00 34.57            C
ANISOU 2426  CD1 PHE A 150    4780   4865   3490   -652    773   -671        C
ATOM   2428  CE1 PHE A 150      4.835  22.758  79.078  1.00 33.31            C
ANISOU 2428  CE1 PHE A 150    4579   4631   3445   -552    697   -514        C
ATOM   2430  CZ  PHE A 150      3.574  22.789  79.613  1.00 32.29            C
ANISOU 2430  CZ  PHE A 150    4457   4524   3287   -621    602   -395        C
ATOM   2432  CE2 PHE A 150      2.473  22.625  78.800  1.00 32.54            C
ANISOU 2432  CE2 PHE A 150    4523   4653   3187   -787    568   -419        C
ATOM   2434  CD2 PHE A 150      2.631  22.427  77.448  1.00 34.29            C
ANISOU 2434  CD2 PHE A 150    4791   4949   3287   -895    624   -565        C
ATOM   2436  C   PHE A 150      4.699  23.386  73.301  1.00 41.53            C
ANISOU 2436  C   PHE A 150    5765   6286   3728  -1124    905   -961        C
ATOM   2437  O   PHE A 150      5.942  23.490  73.300  1.00 41.64            O
ANISOU 2437  O   PHE A 150    5741   6267   3812  -1017   1017  -1038        O
ATOM   2439  N   THR A 151      3.973  23.208  72.205  1.00 44.42            N
ANISOU 2439  N   THR A 151    6198   6787   3891  -1321    883  -1026        N
ATOM   2440  CA  THR A 151      4.576  23.112  70.873  1.00 48.73            C
ANISOU 2440  CA  THR A 151    6799   7459   4257  -1440   1002  -1206        C
ATOM   2442  CB  THR A 151      3.922  21.976  70.094  1.00 52.10            C
ANISOU 2442  CB  THR A 151    7346   7875   4576  -1621   1020  -1398        C
ATOM   2444  OG1 THR A 151      2.494  22.101  70.183  1.00 52.81            O
ANISOU 2444  OG1 THR A 151    7436   8043   4586  -1746    846  -1249        O
ATOM   2446  CG2 THR A 151      4.351  20.621  70.688  1.00 53.45            C
ANISOU 2446  CG2 THR A 151    7575   7762   4973  -1516   1114  -1581        C
ATOM   2450  C   THR A 151      4.500  24.429  70.086  1.00 48.34            C
ANISOU 2450  C   THR A 151    6713   7663   3990  -1538    954  -1064        C
ATOM   2451  O   THR A 151      4.640  24.454  68.877  1.00 50.49            O
ANISOU 2451  O   THR A 151    7042   8098   4045  -1697   1013  -1168        O
ATOM   2453  N   GLY A 152      4.273  25.533  70.787  1.00 47.87            N
ANISOU 2453  N   GLY A 152    6569   7631   3988  -1446    848   -824        N
```

FIG. 18 (continued)

| | | | | | | | | | | | | | | |
|---|---|---|---|---|---|---|---|---|---|---|---|---|---|---|
| ATOM | 2454 | CA | GLY | A | 152 | 4.529 | 26.845 | 70.212 | 1.00 | 47.31 | | | | C |
| ANISOU | 2454 | CA | GLY | A | 152 | 6463 | 7739 | 3773 | -1491 | 824 | -682 | | | C |
| ATOM | 2457 | C | GLY | A | 152 | 3.358 | 27.530 | 69.553 | 1.00 | 46.47 | | | | C |
| ANISOU | 2457 | C | GLY | A | 152 | 6365 | 7816 | 3475 | -1640 | 668 | -511 | | | C |
| ATOM | 2458 | O | GLY | A | 152 | 3.507 | 28.654 | 69.075 | 1.00 | 45.72 | | | | O |
| ANISOU | 2458 | O | GLY | A | 152 | 6251 | 7855 | 3265 | -1679 | 631 | -364 | | | O |
| ATOM | 2460 | N | GLU | A | 153 | 2.189 | 26.897 | 69.512 | 1.00 | 46.87 | | | | N |
| ANISOU | 2460 | N | GLU | A | 153 | 6439 | 7878 | 3493 | -1729 | 569 | -513 | | | N |
| ATOM | 2461 | CA | GLU | A | 153 | 1.048 | 27.634 | 68.987 | 1.00 | 48.49 | | | | C |
| ANISOU | 2461 | CA | GLU | A | 153 | 6616 | 8265 | 3544 | -1846 | 398 | -316 | | | C |
| ATOM | 2463 | CB | GLU | A | 153 | 0.003 | 26.776 | 68.238 | 1.00 | 53.95 | | | | C |
| ANISOU | 2463 | CB | GLU | A | 153 | 7358 | 9064 | 4075 | -2055 | 322 | -397 | | | C |
| ATOM | 2466 | CG | GLU | A | 153 | -0.354 | 25.409 | 68.822 | 1.00 | 57.64 | | | | C |
| ANISOU | 2466 | CG | GLU | A | 153 | 7861 | 9364 | 4674 | -2057 | 355 | -564 | | | C |
| ATOM | 2469 | CD | GLU | A | 153 | 0.683 | 24.322 | 68.514 | 1.00 | 60.20 | | | | C |
| ANISOU | 2469 | CD | GLU | A | 153 | 8295 | 9565 | 5015 | -2072 | 545 | -861 | | | C |
| ATOM | 2470 | OE1 | GLU | A | 153 | 1.142 | 24.239 | 67.338 | 1.00 | 61.76 | | | | O |
| ANISOU | 2470 | OE1 | GLU | A | 153 | 8569 | 9898 | 5001 | -2218 | 625 | -999 | | | O |
| ATOM | 2471 | OE2 | GLU | A | 153 | 1.011 | 23.556 | 69.464 | 1.00 | 59.30 | | | | O |
| ANISOU | 2471 | OE2 | GLU | A | 153 | 8186 | 9218 | 5125 | -1936 | 614 | -949 | | | O |
| ATOM | 2472 | C | GLU | A | 153 | 0.445 | 28.520 | 70.088 | 1.00 | 44.10 | | | | C |
| ANISOU | 2472 | C | GLU | A | 153 | 5953 | 7643 | 3158 | -1684 | 280 | -79 | | | C |
| ATOM | 2473 | O | GLU | A | 153 | 0.711 | 28.350 | 71.287 | 1.00 | 40.32 | | | | O |
| ANISOU | 2473 | O | GLU | A | 153 | 5438 | 6986 | 2897 | -1516 | 319 | -86 | | | O |
| ATOM | 2475 | N | GLU | A | 154 | -0.295 | 29.520 | 69.631 | 1.00 | 41.23 | | | | N |
| ANISOU | 2475 | N | GLU | A | 154 | 5546 | 7432 | 2688 | -1735 | 140 | 131 | | | N |
| ATOM | 2476 | CA | GLU | A | 154 | -1.002 | 30.439 | 70.493 | 1.00 | 39.61 | | | | C |
| ANISOU | 2476 | CA | GLU | A | 154 | 5238 | 7186 | 2625 | -1593 | 26 | 353 | | | C |
| ATOM | 2478 | CB | GLU | A | 154 | -0.314 | 31.783 | 70.520 | 1.00 | 39.87 | | | | C |
| ANISOU | 2478 | CB | GLU | A | 154 | 5261 | 7210 | 2679 | -1501 | 32 | 498 | | | C |
| ATOM | 2481 | CG | GLU | A | 154 | 0.990 | 31.844 | 71.237 | 1.00 | 39.64 | | | | C |
| ANISOU | 2481 | CG | GLU | A | 154 | 5252 | 7025 | 2786 | -1373 | 177 | 402 | | | C |
| ATOM | 2484 | CD | GLU | A | 154 | 1.688 | 33.144 | 70.947 | 1.00 | 39.68 | | | | C |
| ANISOU | 2484 | CD | GLU | A | 154 | 5265 | 7056 | 2755 | -1354 | 181 | 535 | | | C |
| ATOM | 2485 | OE1 | GLU | A | 154 | 2.387 | 33.217 | 69.933 | 1.00 | 41.79 | | | | O |
| ANISOU | 2485 | OE1 | GLU | A | 154 | 5591 | 7434 | 2854 | -1482 | 245 | 486 | | | O |
| ATOM | 2486 | OE2 | GLU | A | 154 | 1.516 | 34.087 | 71.738 | 1.00 | 38.36 | | | | O |
| ANISOU | 2486 | OE2 | GLU | A | 154 | 5050 | 6797 | 2726 | -1219 | 127 | 684 | | | O |
| ATOM | 2487 | C | GLU | A | 154 | -2.345 | 30.710 | 69.899 | 1.00 | 40.55 | | | | C |
| ANISOU | 2487 | C | GLU | A | 154 | 5301 | 7479 | 2629 | -1702 | -149 | 508 | | | C |
| ATOM | 2488 | O | GLU | A | 154 | -2.493 | 30.712 | 68.693 | 1.00 | 38.34 | | | | O |
| ANISOU | 2488 | O | GLU | A | 154 | 5067 | 7376 | 2124 | -1883 | -199 | 514 | | | O |
| ATOM | 2490 | N | MET | A | 155 | -3.287 | 31.067 | 70.753 | 1.00 | 40.24 | | | | N |
| ANISOU | 2490 | N | MET | A | 155 | 5149 | 7400 | 2739 | -1586 | -244 | 650 | | | N |
| ATOM | 2491 | CA | MET | A | 155 | -4.554 | 31.620 | 70.291 | 1.00 | 41.74 | | | | C |
| ANISOU | 2491 | CA | MET | A | 155 | 5241 | 7756 | 2860 | -1640 | -426 | 850 | | | C |
| ATOM | 2493 | CB | MET | A | 155 | -5.611 | 30.528 | 70.200 | 1.00 | 44.38 | | | | C |
| ANISOU | 2493 | CB | MET | A | 155 | 5532 | 8176 | 3155 | -1776 | -492 | 779 | | | C |
| ATOM | 2496 | CG | MET | A | 155 | -6.897 | 30.974 | 69.543 | 1.00 | 47.07 | | | | C |
| ANISOU | 2496 | CG | MET | A | 155 | 5757 | 8732 | 3396 | -1867 | -692 | 974 | | | C |
| ATOM | 2499 | SD | MET | A | 155 | -7.967 | 29.595 | 69.230 | 1.00 | 50.35 | | | | S |
| ANISOU | 2499 | SD | MET | A | 155 | 6140 | 9272 | 3717 | -2094 | -762 | 857 | | | S |
| ATOM | 2500 | CE | MET | A | 155 | -9.417 | 30.460 | 68.602 | 1.00 | 50.87 | | | | C |
| ANISOU | 2500 | CE | MET | A | 155 | 6018 | 9602 | 3708 | -2143 | -1019 | 1149 | | | C |
| ATOM | 2504 | C | MET | A | 155 | -4.977 | 32.730 | 71.255 | 1.00 | 39.19 | | | | C |
| ANISOU | 2504 | C | MET | A | 155 | 4805 | 7347 | 2738 | -1422 | -479 | 1043 | | | C |
| ATOM | 2505 | O | MET | A | 155 | -4.970 | 32.547 | 72.475 | 1.00 | 35.53 | | | | O |
| ANISOU | 2505 | O | MET | A | 155 | 4302 | 6733 | 2463 | -1278 | -410 | 995 | | | O |
| ATOM | 2507 | N | ALA | A | 156 | -5.340 | 33.883 | 70.710 | 1.00 | 38.22 | | | | N |
| ANISOU | 2507 | N | ALA | A | 156 | 4637 | 7314 | 2570 | -1401 | -600 | 1259 | | | N |
| ATOM | 2508 | CA | ALA | A | 156 | -5.758 | 34.999 | 71.541 | 1.00 | 37.62 | | | | C |
| ANISOU | 2508 | CA | ALA | A | 156 | 4462 | 7142 | 2691 | -1188 | -647 | 1433 | | | C |
| ATOM | 2510 | CB | ALA | A | 156 | -4.647 | 36.006 | 71.686 | 1.00 | 36.51 | | | | C |
| ANISOU | 2510 | CB | ALA | A | 156 | 4408 | 6867 | 2599 | -1090 | -573 | 1475 | | | C |
| ATOM | 2514 | C | ALA | A | 156 | -6.986 | 35.671 | 70.974 | 1.00 | 40.19 | | | | C |
| ANISOU | 2514 | C | ALA | A | 156 | 4661 | 7620 | 2988 | -1194 | -840 | 1666 | | | C |
| ATOM | 2515 | O | ALA | A | 156 | -7.241 | 35.644 | 69.765 | 1.00 | 43.24 | | | | O |
| ANISOU | 2515 | O | ALA | A | 156 | 5067 | 8190 | 3171 | -1366 | -953 | 1743 | | | O |
| ATOM | 2517 | N | THR | A | 157 | -7.726 | 36.309 | 71.860 | 1.00 | 40.31 | | | | N |
| ANISOU | 2517 | N | THR | A | 157 | 4543 | 7562 | 3210 | -1000 | -877 | 1779 | | | N |
| ATOM | 2518 | CA | THR | A | 157 | -8.865 | 37.101 | 71.488 | 1.00 | 43.22 | | | | C |
| ANISOU | 2518 | CA | THR | A | 157 | 4765 | 8042 | 3614 | -943 | -1054 | 2017 | | | C |
| ATOM | 2520 | CB | THR | A | 157 | -9.466 | 37.790 | 72.733 | 1.00 | 42.78 | | | | C |
| ANISOU | 2520 | CB | THR | A | 157 | 4573 | 7850 | 3832 | -684 | -1028 | 2082 | | | C |
| ATOM | 2522 | OG1 | THR | A | 157 | -9.773 | 36.780 | 73.689 | 1.00 | 41.00 | | | | O |
| ANISOU | 2522 | OG1 | THR | A | 157 | 4291 | 7607 | 3681 | -681 | -927 | 1910 | | | O |
| ATOM | 2524 | CG2 | THR | A | 157 | -10.747 | 38.525 | 72.376 | 1.00 | 45.30 | | | | C |
| ANISOU | 2524 | CG2 | THR | A | 157 | 4703 | 8290 | 4220 | -602 | -1211 | 2323 | | | C |
| ATOM | 2528 | C | THR | A | 157 | -8.509 | 38.102 | 70.390 | 1.00 | 45.59 | | | | C |

FIG. 18 (continued)

```
ANISOU 2528  C   THR A 157   5140   8392   3792   -989  -1160   2208   C
ATOM   2529  O   THR A 157    -7.499  38.823  70.479  1.00 44.83      O
ANISOU 2529  O   THR A 157   5164   8145   3723   -928  -1081   2217   O
ATOM   2531  N   LYS A 158    -9.312  38.073  69.325  1.00 49.52      N
ANISOU 2531  N   LYS A 158   5570   9112   4134  -1127  -1343   2359   N
ATOM   2532  CA  LYS A 158    -9.192  38.990  68.178  1.00 52.94      C
ANISOU 2532  CA  LYS A 158   6057   9634   4422  -1198  -1486   2588   C
ATOM   2534  CB  LYS A 158    -9.389  40.445  68.636  1.00 55.48      C
ANISOU 2534  CB  LYS A 158   6322   9785   4974   -946  -1543   2813   C
ATOM   2537  CG  LYS A 158   -10.784  40.789  69.145  1.00 58.74      C
ANISOU 2537  CG  LYS A 158   6498  10225   5597   -762  -1666   2961   C
ATOM   2540  CD  LYS A 158   -10.771  42.198  69.769  1.00 59.82      C
ANISOU 2540  CD  LYS A 158   6611  10123   5994   -486  -1664   3120   C
ATOM   2543  CE  LYS A 158   -12.118  42.901  69.670  1.00 64.23      C
ANISOU 2543  CE  LYS A 158   6946  10746   6711   -323  -1856   3376   C
ATOM   2546  NZ  LYS A 158   -11.989  44.387  69.772  1.00 66.14      N
ANISOU 2546  NZ  LYS A 158   7220  10767   7145   -109  -1902   3585   N
ATOM   2550  C   LYS A 158    -7.859  38.873  67.419  1.00 50.94      C
ANISOU 2550  C   LYS A 158   6022   9386   3949  -1374  -1388   2490   C
ATOM   2551  O   LYS A 158    -7.491  39.781  66.663  1.00 50.57      O
ANISOU 2551  O   LYS A 158   6052   9357   3805  -1415  -1462   2675   O
ATOM   2553  N   ALA A 159    -7.151  37.759  67.618  1.00 47.86      N
ANISOU 2553  N   ALA A 159   5722   8978   3485  -1478  -1220   2208   N
ATOM   2554  CA  ALA A 159    -5.774  37.569  67.132  1.00 46.94      C
ANISOU 2554  CA  ALA A 159   5787   8837   3209  -1605  -1074   2063   C
ATOM   2556  CB  ALA A 159    -5.739  37.437  65.604  1.00 48.10      C
ANISOU 2556  CB  ALA A 159   6017   9234   3026  -1873  -1168   2124   C
ATOM   2560  C   ALA A 159    -4.797  38.658  67.612  1.00 45.61      C
ANISOU 2560  C   ALA A 159   5691   8464   3176  -1458   -984   2128   C
ATOM   2561  O   ALA A 159    -3.791  38.962  66.945  1.00 45.10      O
ANISOU 2561  O   ALA A 159   5754   8419   2962  -1572   -921   2124   O
ATOM   2563  N   ASP A 160    -5.090  39.217  68.780  1.00 43.97      N
ANISOU 2563  N   ASP A 160   5401   8065   3242  -1221   -970   2174   N
ATOM   2564  CA  ASP A 160    -4.322  40.294  69.378  1.00 43.28      C
ANISOU 2564  CA  ASP A 160   5371   7762   3310  -1072   -900   2235   C
ATOM   2566  CB  ASP A 160    -5.264  41.359  69.956  1.00 44.70      C
ANISOU 2566  CB  ASP A 160   5440   7828   3716   -854  -1015   2444   C
ATOM   2569  CG  ASP A 160    -4.530  42.536  70.623  1.00 44.17      C
ANISOU 2569  CG  ASP A 160   5446   7510   3825   -702   -945   2499   C
ATOM   2570  OD1 ASP A 160    -3.293  42.525  70.783  1.00 42.33      O
ANISOU 2570  OD1 ASP A 160   5332   7192   3558   -757   -807   2373   O
ATOM   2571  OD2 ASP A 160    -5.226  43.506  70.986  1.00 46.42      O
ANISOU 2571  OD2 ASP A 160   5662   7681   4293   -525  -1033   2670   O
ATOM   2572  C   ASP A 160    -3.526  39.628  70.468  1.00 40.52      C
ANISOU 2572  C   ASP A 160   5052   7267   3078  -1000   -707   1979   C
ATOM   2573  O   ASP A 160    -4.077  39.221  71.511  1.00 36.77      O
ANISOU 2573  O   ASP A 160   4486   6717   2770   -868   -676   1897   O
ATOM   2575  N   TYR A 161    -2.226  39.509  70.232  1.00 40.22      N
ANISOU 2575  N   TYR A 161   5131   7200   2949  -1091   -578   1861   N
ATOM   2576  CA  TYR A 161    -1.354  38.758  71.139  1.00 40.02      C
ANISOU 2576  CA  TYR A 161   5131   7060   3013  -1042   -405   1619   C
ATOM   2578  CB  TYR A 161    -0.285  38.045  70.300  1.00 41.77      C
ANISOU 2578  CB  TYR A 161   5447   7386   3037  -1226   -294   1460   C
ATOM   2581  CG  TYR A 161    -0.919  37.087  69.328  1.00 43.40      C
ANISOU 2581  CG  TYR A 161   5653   7794   3042  -1399   -349   1406   C
ATOM   2582  CD1 TYR A 161    -1.464  35.884  69.775  1.00 43.49      C
ANISOU 2582  CD1 TYR A 161   5617   7809   3097  -1394   -327   1247   C
ATOM   2584  CE1 TYR A 161    -2.070  35.009  68.893  1.00 45.61      C
ANISOU 2584  CE1 TYR A 161   5894   8255   3181  -1572   -382   1186   C
ATOM   2586  CZ  TYR A 161    -2.165  35.338  67.538  1.00 47.23      C
ANISOU 2586  CZ  TYR A 161   6151   8659   3136  -1758   -467   1289   C
ATOM   2587  OH  TYR A 161    -2.775  34.431  66.684  1.00 48.06      O
ANISOU 2587  OH  TYR A 161   6271   8949   3041  -1955   -524   1209   O
ATOM   2589  CE2 TYR A 161    -1.633  36.538  67.070  1.00 47.95      C
ANISOU 2589  CE2 TYR A 161   6288   8759   3170  -1764   -492   1466   C
ATOM   2591  CD2 TYR A 161    -1.023  37.405  67.971  1.00 46.55      C
ANISOU 2591  CD2 TYR A 161   6105   8382   3199  -1584   -433   1524   C
ATOM   2593  C   TYR A 161    -0.728  39.616  72.250  1.00 38.11      C
ANISOU 2593  C   TYR A 161   4902   6599   2977   -873   -333   1627   C
ATOM   2594  O   TYR A 161     0.113  39.136  73.011  1.00 35.34      O
ANISOU 2594  O   TYR A 161   4573   6156   2698   -834   -203   1453   O
ATOM   2596  N   THR A 162    -1.118  40.889  72.295  1.00 38.49      N
ANISOU 2596  N   THR A 162   4944   6565   3115   -782   -426   1832   N
ATOM   2597  CA  THR A 162    -0.718  41.825  73.356  1.00 37.10      C
ANISOU 2597  CA  THR A 162   4787   6169   3141   -622   -375   1848   C
ATOM   2599  CB  THR A 162    -1.166  41.328  74.752  1.00 34.17      C
ANISOU 2599  CB  THR A 162   4336   5702   2946   -463   -317   1716   C
ATOM   2601  OG1 THR A 162    -2.593  41.219  74.763  1.00 32.45      O
ANISOU 2601  OG1 THR A 162   4002   5554   2775   -392   -423   1807   O
```

FIG. 18 (continued)

```
ATOM   2603  CG2 THR A 162      -0.745  42.295  75.837  1.00 33.95          C
ANISOU 2603  CG2 THR A 162    4340   5460   3101   -319   -263   1713       C
ATOM   2607  C   THR A 162      0.779  42.166  73.336  1.00 36.45          C
ANISOU 2607  C   THR A 162    4809   6015   3025   -697   -263   1780       C
ATOM   2608  O   THR A 162      1.138  43.298  73.036  1.00 33.73          O
ANISOU 2608  O   THR A 162    4531   5590   2694   -712   -295   1924       O
ATOM   2610  N   LEU A 163      1.622  41.172  73.626  1.00 35.33          N
ANISOU 2610  N   LEU A 163    4674   5904   2847   -747   -137   1568       N
ATOM   2611  CA  LEU A 163      3.071  41.334  73.668  1.00 35.43          C
ANISOU 2611  CA  LEU A 163    4749   5875   2838   -814    -21   1480       C
ATOM   2613  CB  LEU A 163      3.703  40.158  74.403  1.00 33.67          C
ANISOU 2613  CB  LEU A 163    4490   5644   2657   -786     98   1249       C
ATOM   2616  CG  LEU A 163      3.261  39.915  75.832  1.00 31.31          C
ANISOU 2616  CG  LEU A 163    4140   5216   2540   -619    104   1181       C
ATOM   2618  CD1 LEU A 163      3.732  38.518  76.281  1.00 30.01          C
ANISOU 2618  CD1 LEU A 163    3945   5075   2381   -619    195    980       C
ATOM   2622  CD2 LEU A 163      3.783  41.012  76.718  1.00 32.37          C
ANISOU 2622  CD2 LEU A 163    4304   5187   2810   -535    122   1220       C
ATOM   2626  C   LEU A 163      3.696  41.371  72.298  1.00 37.64          C
ANISOU 2626  C   LEU A 163    5088   6309   2904  -1011     -3   1519       C
ATOM   2627  O   LEU A 163      3.105  40.935  71.301  1.00 36.46          O
ANISOU 2627  O   LEU A 163    4940   6322   2590  -1117    -63   1561       O
ATOM   2629  N   ASP A 164      4.925  41.862  72.264  1.00 40.18          N
ANISOU 2629  N   ASP A 164    5456   6594   3216  -1077     86   1496       N
ATOM   2630  CA  ASP A 164      5.705  41.777  71.052  1.00 43.07          C
ANISOU 2630  CA  ASP A 164    5869   7124   3372  -1276    146   1492       C
ATOM   2632  CB  ASP A 164      6.867  42.797  71.028  1.00 46.28          C
ANISOU 2632  CB  ASP A 164    6325   7466   3792  -1351    207   1554       C
ATOM   2635  CG  ASP A 164      7.964  42.496  72.036  1.00 45.91          C
ANISOU 2635  CG  ASP A 164    6229   7334   3881  -1288    334   1371       C
ATOM   2636  OD1 ASP A 164      7.985  41.417  72.645  1.00 45.65          O
ANISOU 2636  OD1 ASP A 164    6129   7303   3912  -1198    389   1191       O
ATOM   2637  OD2 ASP A 164      8.829  43.371  72.219  1.00 49.97          O
ANISOU 2637  OD2 ASP A 164    6770   7776   4438  -1339    369   1421       O
ATOM   2638  C   ASP A 164      6.192  40.346  70.805  1.00 42.50          C
ANISOU 2638  C   ASP A 164    5759   7181   3208  -1334    269   1252       C
ATOM   2639  O   ASP A 164      6.177  39.470  71.703  1.00 37.45          O
ANISOU 2639  O   ASP A 164    5062   6471   2695  -1215    317   1090       O
ATOM   2641  N   GLU A 165      6.661  40.166  69.577  1.00 44.17          N
ANISOU 2641  N   GLU A 165    6010   7574   3197  -1521    324   1236       N
ATOM   2642  CA  GLU A 165      7.064  38.888  69.014  1.00 47.25          C
ANISOU 2642  CA  GLU A 165    6386   8108   3459  -1608    445   1013       C
ATOM   2644  CB  GLU A 165      7.532  39.110  67.558  1.00 49.74          C
ANISOU 2644  CB  GLU A 165    6765   8636   3498  -1842    494   1051       C
ATOM   2647  CG  GLU A 165      7.649  37.866  66.690  1.00 52.86          C
ANISOU 2647  CG  GLU A 165    7172   9211   3703  -1965    599    837       C
ATOM   2650  CD  GLU A 165      8.409  38.116  65.369  1.00 55.85          C
ANISOU 2650  CD  GLU A 165    7607   9807   3805  -2202    699    836       C
ATOM   2651  OE1 GLU A 165      9.198  39.082  65.276  1.00 55.86          O
ANISOU 2651  OE1 GLU A 165    7617   9809   3799  -2261    738    951       O
ATOM   2652  OE2 GLU A 165      8.229  37.333  64.418  1.00 61.51          O
ANISOU 2652  OE2 GLU A 165    8365  10703   4304  -2345    747    712       O
ATOM   2653  C   GLU A 165      8.167  38.270  69.848  1.00 45.25          C
ANISOU 2653  C   GLU A 165    6068   7772   3354  -1516    596    803       C
ATOM   2654  O   GLU A 165      8.147  37.070  70.107  1.00 43.06          O
ANISOU 2654  O   GLU A 165    5754   7489   3118  -1459    659    612       O
ATOM   2656  N   GLU A 166      9.093  39.112  70.305  1.00 46.32          N
ANISOU 2656  N   GLU A 166    6188   7832   3581  -1500    640    852       N
ATOM   2657  CA  GLU A 166     10.241  38.669  71.095  1.00 46.57          C
ANISOU 2657  CA  GLU A 166    6138   7802   3754  -1421    767    682       C
ATOM   2659  CB  GLU A 166     11.304  39.774  71.206  1.00 48.03          C
ANISOU 2659  CB  GLU A 166    6313   7966   3968  -1486    811    765       C
ATOM   2662  CG  GLU A 166     12.059  40.029  69.890  1.00 53.22          C
ANISOU 2662  CG  GLU A 166    6992   8820   4408  -1702    913    775       C
ATOM   2665  CD  GLU A 166     12.915  41.310  69.882  1.00 54.66          C
ANISOU 2665  CD  GLU A 166    7187   8983   4598  -1808    929    912       C
ATOM   2666  OE1 GLU A 166     12.529  42.324  70.534  1.00 54.98          O
ANISOU 2666  OE1 GLU A 166    7278   8855   4757  -1752    809   1078       O
ATOM   2667  OE2 GLU A 166     13.970  41.297  69.184  1.00 58.48          O
ANISOU 2667  OE2 GLU A 166    7631   9623   4966  -1958   1070    848       O
ATOM   2668  C   GLU A 166      9.869  38.162  72.485  1.00 42.12          C
ANISOU 2668  C   GLU A 166    5526   7068   3409  -1220    724    617       C
ATOM   2669  O   GLU A 166     10.371  37.109  72.904  1.00 39.73          O
ANISOU 2669  O   GLU A 166    5161   6750   3183  -1149    811    436       O
ATOM   2671  N   SER A 167      9.039  38.898  73.231  1.00 41.10          N
ANISOU 2671  N   SER A 167    5423   6808   3385  -1126    599    761       N
ATOM   2672  CA  SER A 167      8.586  38.393  74.541  1.00 38.85          C
ANISOU 2672  CA  SER A 167    5098   6385   3278   -954    562    701       C
ATOM   2674  CB  SER A 167      7.831  39.471  75.358  1.00 40.37          C
```

FIG. 18 (continued)

| | | | | | | | | | | | | | | |
|---|---|---|---|---|---|---|---|---|---|---|---|---|---|---|
| ANISOU | 2674 | CB | SER | A | 167 | 5318 | 6437 | 3583 | -860 | 450 | 856 | | | C |
| ATOM | 2677 | OG | SER | A | 167 | 8.449 | 40.743 | 75.221 | 1.00 | 43.59 | | | | O |
| ANISOU | 2677 | OG | SER | A | 167 | 5767 | 6803 | 3992 | -923 | 446 | 968 | | | O |
| ATOM | 2679 | C | SER | A | 167 | 7.731 | 37.114 | 74.405 | 1.00 | 36.14 | | | | C |
| ANISOU | 2679 | C | SER | A | 167 | 4744 | 6081 | 2906 | -925 | 550 | 604 | | | C |
| ATOM | 2680 | O | SER | A | 167 | 7.811 | 36.202 | 75.237 | 1.00 | 33.55 | | | | O |
| ANISOU | 2680 | O | SER | A | 167 | 4376 | 5681 | 2690 | -825 | 581 | 484 | | | O |
| ATOM | 2682 | N | ARG | A | 168 | 6.888 | 37.053 | 73.383 | 1.00 | 37.12 | | | | N |
| ANISOU | 2682 | N | ARG | A | 168 | 4909 | 6316 | 2879 | -1021 | 494 | 666 | | | N |
| ATOM | 2683 | CA | ARG | A | 168 | 6.145 | 35.834 | 73.118 | 1.00 | 39.36 | | | | C |
| ANISOU | 2683 | CA | ARG | A | 168 | 5191 | 6651 | 3114 | -1036 | 486 | 562 | | | C |
| ATOM | 2685 | CB | ARG | A | 168 | 5.185 | 36.032 | 71.950 | 1.00 | 43.65 | | | | C |
| ANISOU | 2685 | CB | ARG | A | 168 | 5777 | 7339 | 3470 | -1167 | 393 | 670 | | | C |
| ATOM | 2688 | CG | ARG | A | 168 | 4.008 | 36.898 | 72.338 | 1.00 | 44.92 | | | | C |
| ANISOU | 2688 | CG | ARG | A | 168 | 5921 | 7449 | 3698 | -1092 | 240 | 875 | | | C |
| ATOM | 2691 | CD | ARG | A | 168 | 2.872 | 36.651 | 71.426 | 1.00 | 48.22 | | | | C |
| ANISOU | 2691 | CD | ARG | A | 168 | 6345 | 8008 | 3968 | -1193 | 132 | 949 | | | C |
| ATOM | 2694 | NE | ARG | A | 168 | 2.961 | 37.416 | 70.218 | 1.00 | 50.50 | | | | N |
| ANISOU | 2694 | NE | ARG | A | 168 | 6688 | 8431 | 4070 | -1338 | 83 | 1089 | | | N |
| ATOM | 2696 | CZ | ARG | A | 168 | 2.692 | 36.960 | 68.988 | 1.00 | 53.49 | | | | C |
| ANISOU | 2696 | CZ | ARG | A | 168 | 7106 | 9001 | 4216 | -1519 | 59 | 1073 | | | C |
| ATOM | 2697 | NH1 | ARG | A | 168 | 2.264 | 35.719 | 68.755 | 1.00 | 54.74 | | | | N |
| ANISOU | 2697 | NH1 | ARG | A | 168 | 7261 | 9233 | 4306 | -1581 | 78 | 911 | | | N |
| ATOM | 2700 | NH2 | ARG | A | 168 | 2.826 | 37.774 | 67.969 | 1.00 | 53.68 | | | | N |
| ANISOU | 2700 | NH2 | ARG | A | 168 | 7185 | 9145 | 4066 | -1653 | 9 | 1229 | | | N |
| ATOM | 2703 | C | ARG | A | 168 | 7.082 | 34.649 | 72.861 | 1.00 | 39.34 | | | | C |
| ANISOU | 2703 | C | ARG | A | 168 | 5175 | 6681 | 3091 | -1066 | 629 | 337 | | | C |
| ATOM | 2704 | O | ARG | A | 168 | 6.890 | 33.562 | 73.421 | 1.00 | 39.19 | | | | O |
| ANISOU | 2704 | O | ARG | A | 168 | 5138 | 6588 | 3164 | -993 | 651 | 213 | | | O |
| ATOM | 2706 | N | ALA | A | 169 | 8.107 | 34.873 | 72.049 | 1.00 | 38.86 | | | | N |
| ANISOU | 2706 | N | ALA | A | 169 | 5122 | 6722 | 2923 | -1169 | 732 | 287 | | | N |
| ATOM | 2707 | CA | ALA | A | 169 | 9.109 | 33.847 | 71.764 | 1.00 | 39.70 | | | | C |
| ANISOU | 2707 | CA | ALA | A | 169 | 5198 | 6862 | 3025 | -1182 | 891 | 64 | | | C |
| ATOM | 2709 | CB | ALA | A | 169 | 10.123 | 34.347 | 70.732 | 1.00 | 40.38 | | | | C |
| ANISOU | 2709 | CB | ALA | A | 169 | 5283 | 7101 | 2957 | -1325 | 1004 | 43 | | | C |
| ATOM | 2713 | C | ALA | A | 169 | 9.829 | 33.355 | 73.024 | 1.00 | 37.99 | | | | C |
| ANISOU | 2713 | C | ALA | A | 169 | 4904 | 6492 | 3039 | -1012 | 938 | -27 | | | C |
| ATOM | 2714 | O | ALA | A | 169 | 10.196 | 32.192 | 73.085 | 1.00 | 37.56 | | | | O |
| ANISOU | 2714 | O | ALA | A | 169 | 4826 | 6401 | 3043 | -964 | 1024 | -205 | | | O |
| ATOM | 2716 | N | ARG | A | 170 | 10.015 | 34.220 | 74.022 | 1.00 | 38.51 | | | | N |
| ANISOU | 2716 | N | ARG | A | 170 | 4937 | 6464 | 3232 | -924 | 876 | 94 | | | N |
| ATOM | 2717 | CA | ARG | A | 170 | 10.674 | 33.804 | 75.257 | 1.00 | 40.21 | | | | C |
| ANISOU | 2717 | CA | ARG | A | 170 | 5080 | 6553 | 3646 | -778 | 898 | 30 | | | C |
| ATOM | 2719 | CB | ARG | A | 170 | 11.046 | 35.009 | 76.134 | 1.00 | 42.67 | | | | C |
| ANISOU | 2719 | CB | ARG | A | 170 | 5368 | 6802 | 4045 | -737 | 841 | 160 | | | C |
| ATOM | 2722 | CG | ARG | A | 170 | 12.023 | 35.936 | 75.426 | 1.00 | 48.08 | | | | C |
| ANISOU | 2722 | CG | ARG | A | 170 | 6034 | 7588 | 4647 | -855 | 906 | 197 | | | C |
| ATOM | 2725 | CD | ARG | A | 170 | 12.687 | 36.967 | 76.331 | 1.00 | 50.23 | | | | C |
| ANISOU | 2725 | CD | ARG | A | 170 | 6272 | 7789 | 5024 | -829 | 873 | 281 | | | C |
| ATOM | 2728 | NE | ARG | A | 170 | 11.893 | 38.200 | 76.458 | 1.00 | 53.38 | | | | N |
| ANISOU | 2728 | NE | ARG | A | 170 | 6758 | 8124 | 5400 | -857 | 765 | 456 | | | N |
| ATOM | 2730 | CZ | ARG | A | 170 | 11.189 | 38.536 | 77.537 | 1.00 | 53.20 | | | | C |
| ANISOU | 2730 | CZ | ARG | A | 170 | 6763 | 7968 | 5483 | -751 | 671 | 518 | | | C |
| ATOM | 2731 | NH1 | ARG | A | 170 | 11.163 | 37.734 | 78.607 | 1.00 | 54.69 | | | | N |
| ANISOU | 2731 | NH1 | ARG | A | 170 | 6908 | 8086 | 5787 | -629 | 662 | 436 | | | N |
| ATOM | 2734 | NH2 | ARG | A | 170 | 10.507 | 39.684 | 77.555 | 1.00 | 52.77 | | | | N |
| ANISOU | 2734 | NH2 | ARG | A | 170 | 6783 | 7848 | 5420 | -767 | 590 | 666 | | | N |
| ATOM | 2737 | C | ARG | A | 170 | 9.835 | 32.794 | 76.054 | 1.00 | 36.27 | | | | C |
| ANISOU | 2737 | C | ARG | A | 170 | 4595 | 5938 | 3249 | -672 | 841 | -12 | | | C |
| ATOM | 2738 | O | ARG | A | 170 | 10.387 | 31.866 | 76.670 | 1.00 | 33.96 | | | | O |
| ANISOU | 2738 | O | ARG | A | 170 | 4256 | 5563 | 3083 | -575 | 887 | -121 | | | O |
| ATOM | 2740 | N | ILE | A | 171 | 8.516 | 32.995 | 76.040 | 1.00 | 31.19 | | | | N |
| ANISOU | 2740 | N | ILE | A | 171 | 4006 | 5289 | 2554 | -692 | 737 | 89 | | | N |
| ATOM | 2741 | CA | ILE | A | 171 | 7.574 | 32.081 | 76.684 | 1.00 | 31.00 | | | | C |
| ANISOU | 2741 | CA | ILE | A | 171 | 3997 | 5181 | 2602 | -629 | 683 | 64 | | | C |
| ATOM | 2743 | CB | ILE | A | 171 | 6.140 | 32.692 | 76.755 | 1.00 | 28.12 | | | | C |
| ANISOU | 2743 | CB | ILE | A | 171 | 3658 | 4835 | 2192 | -647 | 561 | 215 | | | C |
| ATOM | 2745 | CG1 | ILE | A | 171 | 6.175 | 33.903 | 77.699 | 1.00 | 27.38 | | | | C |
| ANISOU | 2745 | CG1 | ILE | A | 171 | 3543 | 4674 | 2187 | -562 | 508 | 346 | | | C |
| ATOM | 2748 | CD1 | ILE | A | 171 | 4.932 | 34.839 | 77.667 | 1.00 | 28.27 | | | | C |
| ANISOU | 2748 | CD1 | ILE | A | 171 | 3665 | 4804 | 2271 | -560 | 402 | 508 | | | C |
| ATOM | 2752 | CG2 | ILE | A | 171 | 5.108 | 31.621 | 77.164 | 1.00 | 27.54 | | | | C |
| ANISOU | 2752 | CG2 | ILE | A | 171 | 3593 | 4714 | 2158 | -629 | 519 | 177 | | | C |
| ATOM | 2756 | C | ILE | A | 171 | 7.575 | 30.743 | 75.950 | 1.00 | 29.83 | | | | C |
| ANISOU | 2756 | C | ILE | A | 171 | 3877 | 5051 | 2405 | -683 | 754 | -103 | | | C |
| ATOM | 2757 | O | ILE | A | 171 | 7.767 | 29.705 | 76.579 | 1.00 | 27.63 | | | | O |
| ANISOU | 2757 | O | ILE | A | 171 | 3589 | 4660 | 2248 | -603 | 783 | -199 | | | O |
| ATOM | 2759 | N | LYS | A | 172 | 7.434 | 30.805 | 74.624 | 1.00 | 30.83 | | | | N |
| ANISOU | 2759 | N | LYS | A | 172 | 4046 | 5316 | 2354 | -824 | 785 | -138 | | | N |

FIG. 18 (continued)

```
ATOM   2760  CA  LYS A 172      7.447  29.636  73.770  1.00 34.56          C
ANISOU 2760  CA  LYS A 172   4562   5821   2748   -905    865   -320       C
ATOM   2762  CB  LYS A 172      7.298  30.039  72.294  1.00 37.24          C
ANISOU 2762  CB  LYS A 172   4951   6353   2844  -1088    885   -322       C
ATOM   2765  CG  LYS A 172      5.875  30.464  71.966  1.00 38.58          C
ANISOU 2765  CG  LYS A 172   5158   6603   2898  -1178    734   -169       C
ATOM   2768  CD  LYS A 172      5.687  30.824  70.514  1.00 41.54          C
ANISOU 2768  CD  LYS A 172   5588   7181   3016  -1371    730   -150       C
ATOM   2771  CE  LYS A 172      5.782  32.312  70.251  1.00 42.73          C
ANISOU 2771  CE  LYS A 172   5728   7415   3095  -1402    665     64       C
ATOM   2774  NZ  LYS A 172      5.290  32.666  68.884  1.00 46.85          N
ANISOU 2774  NZ  LYS A 172   6310   8141   3351  -1602    611    137       N
ATOM   2778  C   LYS A 172      8.699  28.797  73.946  1.00 34.84          C
ANISOU 2778  C   LYS A 172   4560   5778   2902   -821   1005   -501       C
ATOM   2779  O   LYS A 172      8.638  27.576  73.891  1.00 35.70          O
ANISOU 2779  O   LYS A 172   4700   5802   3061   -804   1056   -654       O
ATOM   2781  N   THR A 173      9.828  29.467  74.140  1.00 36.99          N
ANISOU 2781  N   THR A 173   4757   6073   3223   -770   1065   -481       N
ATOM   2782  CA  THR A 173     11.119  28.808  74.249  1.00 38.96          C
ANISOU 2782  CA  THR A 173   4934   6278   3592   -682   1199   -640       C
ATOM   2784  CB  THR A 173     12.268  29.849  74.110  1.00 39.55          C
ANISOU 2784  CB  THR A 173   4919   6457   3650   -698   1261   -593       C
ATOM   2786  OG1 THR A 173     12.366  30.218  72.727  1.00 42.37          O
ANISOU 2786  OG1 THR A 173   5314   6996   3789   -869   1342   -634       O
ATOM   2788  CG2 THR A 173     13.623  29.314  74.605  1.00 40.94          C
ANISOU 2788  CG2 THR A 173   4971   6579   4008   -566   1365   -710       C
ATOM   2792  C   THR A 173     11.169  28.027  75.549  1.00 37.48          C
ANISOU 2792  C   THR A 173   4715   5897   3629   -514   1153   -646       C
ATOM   2793  O   THR A 173     11.562  26.868  75.582  1.00 39.51          O
ANISOU 2793  O   THR A 173   4965   6054   3993   -442   1228   -798       O
ATOM   2795  N   ARG A 174     10.729  28.673  76.607  1.00 36.00          N
ANISOU 2795  N   ARG A 174   4518   5655   3507   -458   1030   -477       N
ATOM   2796  CA  ARG A 174     10.703  28.069  77.914  1.00 34.90          C
ANISOU 2796  CA  ARG A 174   4357   5355   3547   -321    969   -447       C
ATOM   2798  CB  ARG A 174     10.300  29.141  78.927  1.00 35.07          C
ANISOU 2798  CB  ARG A 174   4369   5371   3587   -294    853   -264       C
ATOM   2801  CG  ARG A 174     10.147  28.685  80.368  1.00 34.54          C
ANISOU 2801  CG  ARG A 174   4292   5168   3665   -179    776   -205       C
ATOM   2804  CD  ARG A 174     11.430  28.023  80.900  1.00 36.35          C
ANISOU 2804  CD  ARG A 174   4438   5324   4051    -63    819   -272       C
ATOM   2807  NE  ARG A 174     11.194  27.511  82.242  1.00 35.96          N
ANISOU 2807  NE  ARG A 174   4396   5149   4116     28    730   -196       N
ATOM   2809  CZ  ARG A 174     11.848  26.497  82.805  1.00 38.27          C
ANISOU 2809  CZ  ARG A 174   4652   5329   4561    136    732   -233       C
ATOM   2810  NH1 ARG A 174     12.813  25.823  82.159  1.00 39.26          N
ANISOU 2810  NH1 ARG A 174   4715   5432   4768    192    830   -366       N
ATOM   2813  NH2 ARG A 174     11.506  26.131  84.034  1.00 38.45          N
ANISOU 2813  NH2 ARG A 174   4699   5254   4655    191    636   -133       N
ATOM   2816  C   ARG A 174      9.786  26.822  77.956  1.00 34.44          C
ANISOU 2816  C   ARG A 174   4381   5185   3518   -325    947   -513       C
ATOM   2817  O   ARG A 174     10.179  25.794  78.503  1.00 33.35          O
ANISOU 2817  O   ARG A 174   4234   4905   3531   -224    968   -583       O
ATOM   2819  N   LEU A 175      8.607  26.914  77.331  1.00 32.55          N
ANISOU 2819  N   LEU A 175   4219   5013   3137   -448    901   -487       N
ATOM   2820  CA  LEU A 175      7.682  25.785  77.183  1.00 34.42          C
ANISOU 2820  CA  LEU A 175   4537   5171   3371   -499    882   -557       C
ATOM   2822  CB  LEU A 175      6.355  26.237  76.518  1.00 32.72          C
ANISOU 2822  CB  LEU A 175   4370   5083   2978   -650    802   -481       C
ATOM   2825  CG  LEU A 175      5.480  27.172  77.368  1.00 30.89          C
ANISOU 2825  CG  LEU A 175   4105   4876   2756   -621    679   -278       C
ATOM   2827  CD1 LEU A 175      4.195  27.605  76.636  1.00 30.17          C
ANISOU 2827  CD1 LEU A 175   4035   4921   2509   -754    596   -197       C
ATOM   2831  CD2 LEU A 175      5.099  26.510  78.703  1.00 27.44          C
ANISOU 2831  CD2 LEU A 175   3667   4289   2471   -532    630   -235       C
ATOM   2835  C   LEU A 175      8.305  24.606  76.412  1.00 36.46          C
ANISOU 2835  C   LEU A 175   4832   5367   3655   -509   1009   -780       C
ATOM   2836  O   LEU A 175      8.148  23.455  76.805  1.00 34.73          O
ANISOU 2836  O   LEU A 175   4659   4982   3556   -465   1014   -854       O
ATOM   2838  N   PHE A 176      9.017  24.912  75.327  1.00 38.45          N
ANISOU 2838  N   PHE A 176   5066   5746   3796   -569   1118   -887       N
ATOM   2839  CA  PHE A 176      9.703  23.895  74.505  1.00 40.84          C
ANISOU 2839  CA  PHE A 176   5396   6010   4113   -575   1271  -1129       C
ATOM   2841  CB  PHE A 176     10.338  24.546  73.254  1.00 44.17          C
ANISOU 2841  CB  PHE A 176   5794   6641   4348   -683   1387  -1212       C
ATOM   2844  CG  PHE A 176     11.020  23.572  72.322  1.00 47.03          C
ANISOU 2844  CG  PHE A 176   6181   6990   4696   -702   1570  -1485       C
ATOM   2845  CD1 PHE A 176     10.377  23.114  71.177  1.00 50.11          C
ANISOU 2845  CD1 PHE A 176   6691   7462   4887   -883   1614  -1627       C
ATOM   2847  CE1 PHE A 176     10.998  22.214  70.301  1.00 52.41          C
```

FIG. 18 (continued)

| | | | | | | | | | | | | | |
|---|---|---|---|---|---|---|---|---|---|---|---|---|---|
| ANISOU | 2847 | CE1 | PHE | A | 176 | 7018 | 7740 | 5156 | -906 | 1801 | -1910 | | C |
| ATOM | 2849 | CZ | PHE | A | 176 | 12.282 | 21.758 | 70.574 | 1.00 | 53.39 | | | C |
| ANISOU | 2849 | CZ | PHE | A | 176 | 7040 | 7763 | 5484 | -724 | 1948 | -2044 | | C |
| ATOM | 2851 | CE2 | PHE | A | 176 | 12.941 | 22.202 | 71.713 | 1.00 | 51.95 | | | C |
| ANISOU | 2851 | CE2 | PHE | A | 176 | 6720 | 7507 | 5510 | -538 | 1889 | -1884 | | C |
| ATOM | 2853 | CD2 | PHE | A | 176 | 12.307 | 23.120 | 72.580 | 1.00 | 49.32 | | | C |
| ANISOU | 2853 | CD2 | PHE | A | 176 | 6371 | 7195 | 5172 | -539 | 1699 | -1608 | | C |
| ATOM | 2855 | C | PHE | A | 176 | 10.768 | 23.186 | 75.349 | 1.00 | 39.76 | | | C |
| ANISOU | 2855 | C | PHE | A | 176 | 5184 | 5693 | 4229 | -375 | 1327 | -1191 | | C |
| ATOM | 2856 | O | PHE | A | 176 | 10.893 | 21.982 | 75.299 | 1.00 | 39.32 | | | O |
| ANISOU | 2856 | O | PHE | A | 176 | 5175 | 5477 | 4286 | -323 | 1390 | -1343 | | O |
| ATOM | 2858 | N | THR | A | 177 | 11.508 | 23.951 | 76.141 | 1.00 | 37.82 | | | N |
| ANISOU | 2858 | N | THR | A | 177 | 4824 | 5469 | 4075 | -266 | 1294 | -1065 | | N |
| ATOM | 2859 | CA | THR | A | 177 | 12.524 | 23.395 | 77.010 | 1.00 | 39.17 | | | C |
| ANISOU | 2859 | CA | THR | A | 177 | 4903 | 5498 | 4484 | -76 | 1317 | -1085 | | C |
| ATOM | 2861 | CB | THR | A | 177 | 13.366 | 24.498 | 77.691 | 1.00 | 39.85 | | | C |
| ANISOU | 2861 | CB | THR | A | 177 | 4854 | 5676 | 4612 | -9 | 1277 | -945 | | C |
| ATOM | 2863 | OG1 | THR | A | 177 | 13.971 | 25.335 | 76.693 | 1.00 | 41.61 | | | O |
| ANISOU | 2863 | OG1 | THR | A | 177 | 5021 | 6096 | 4694 | -103 | 1380 | -997 | | O |
| ATOM | 2865 | CG2 | THR | A | 177 | 14.476 | 23.879 | 78.544 | 1.00 | 41.92 | | | C |
| ANISOU | 2865 | CG2 | THR | A | 177 | 4999 | 5812 | 5117 | 184 | 1288 | -962 | | C |
| ATOM | 2869 | C | THR | A | 177 | 11.904 | 22.463 | 78.066 | 1.00 | 38.20 | | | C |
| ANISOU | 2869 | C | THR | A | 177 | 4844 | 5155 | 4514 | 5 | 1213 | -1021 | | C |
| ATOM | 2870 | O | THR | A | 177 | 12.417 | 21.383 | 78.310 | 1.00 | 40.54 | | | O |
| ANISOU | 2870 | O | THR | A | 177 | 5136 | 5277 | 4991 | 125 | 1258 | -1116 | | O |
| ATOM | 2872 | N | ILE | A | 178 | 10.789 | 22.860 | 78.667 | 1.00 | 35.86 | | | N |
| ANISOU | 2872 | N | ILE | A | 178 | 4609 | 4867 | 4149 | -62 | 1080 | -859 | | N |
| ATOM | 2873 | CA | ILE | A | 178 | 10.134 | 22.032 | 79.692 | 1.00 | 35.33 | | | C |
| ANISOU | 2873 | CA | ILE | A | 178 | 4606 | 4616 | 4202 | -15 | 983 | -780 | | C |
| ATOM | 2875 | CB | ILE | A | 178 | 8.909 | 22.747 | 80.325 | 1.00 | 33.49 | | | C |
| ANISOU | 2875 | CB | ILE | A | 178 | 4408 | 4451 | 3865 | -101 | 854 | -596 | | C |
| ATOM | 2877 | CG1 | ILE | A | 178 | 9.349 | 23.956 | 81.173 | 1.00 | 31.94 | | | C |
| ANISOU | 2877 | CG1 | ILE | A | 178 | 4120 | 4346 | 3671 | -37 | 792 | -442 | | C |
| ATOM | 2880 | CD1 | ILE | A | 178 | 8.219 | 24.945 | 81.388 | 1.00 | 29.60 | | | C |
| ANISOU | 2880 | CD1 | ILE | A | 178 | 3846 | 4161 | 3241 | -128 | 709 | -307 | | C |
| ATOM | 2884 | CG2 | ILE | A | 178 | 8.070 | 21.804 | 81.184 | 1.00 | 31.69 | | | C |
| ANISOU | 2884 | CG2 | ILE | A | 178 | 4260 | 4060 | 3722 | -102 | 775 | -532 | | C |
| ATOM | 2888 | C | ILE | A | 178 | 9.724 | 20.699 | 79.073 | 1.00 | 37.25 | | | C |
| ANISOU | 2888 | C | ILE | A | 178 | 4960 | 4712 | 4479 | -62 | 1043 | -945 | | C |
| ATOM | 2889 | O | ILE | A | 178 | 10.056 | 19.632 | 79.614 | 1.00 | 36.51 | | | O |
| ANISOU | 2889 | O | ILE | A | 178 | 4891 | 4406 | 4575 | 47 | 1046 | -979 | | O |
| ATOM | 2891 | N | ARG | A | 179 | 9.018 | 20.778 | 77.939 | 1.00 | 37.75 | | | N |
| ANISOU | 2891 | N | ARG | A | 179 | 5097 | 4887 | 4359 | -229 | 1083 | -1041 | | N |
| ATOM | 2892 | CA | ARG | A | 179 | 8.543 | 19.597 | 77.222 | 1.00 | 41.26 | | | C |
| ANISOU | 2892 | CA | ARG | A | 179 | 5665 | 5216 | 4796 | -318 | 1141 | -1220 | | C |
| ATOM | 2894 | CB | ARG | A | 179 | 7.807 | 20.015 | 75.936 | 1.00 | 41.55 | | | C |
| ANISOU | 2894 | CB | ARG | A | 179 | 5759 | 5453 | 4575 | -528 | 1165 | -1296 | | C |
| ATOM | 2897 | CG | ARG | A | 179 | 7.507 | 18.863 | 74.946 | 1.00 | 44.76 | | | C |
| ANISOU | 2897 | CG | ARG | A | 179 | 6296 | 5777 | 4935 | -648 | 1253 | -1536 | | C |
| ATOM | 2900 | CD | ARG | A | 179 | 6.521 | 19.325 | 73.893 | 1.00 | 46.07 | | | C |
| ANISOU | 2900 | CD | ARG | A | 179 | 6518 | 6161 | 4825 | -883 | 1218 | -1549 | | C |
| ATOM | 2903 | NE | ARG | A | 179 | 6.174 | 18.296 | 72.922 | 1.00 | 49.10 | | | N |
| ANISOU | 2903 | NE | ARG | A | 179 | 7036 | 6492 | 5127 | -1034 | 1292 | -1784 | | N |
| ATOM | 2905 | CZ | ARG | A | 179 | 6.865 | 18.026 | 71.818 | 1.00 | 53.12 | | | C |
| ANISOU | 2905 | CZ | ARG | A | 179 | 7583 | 7055 | 5546 | -1079 | 1451 | -2022 | | C |
| ATOM | 2906 | NH1 | ARG | A | 179 | 7.983 | 18.700 | 71.519 | 1.00 | 53.77 | | | N |
| ANISOU | 2906 | NH1 | ARG | A | 179 | 7565 | 7253 | 5613 | -984 | 1559 | -2051 | | N |
| ATOM | 2909 | NH2 | ARG | A | 179 | 6.439 | 17.065 | 71.007 | 1.00 | 55.06 | | | N |
| ANISOU | 2909 | NH2 | ARG | A | 179 | 7968 | 7241 | 5710 | -1234 | 1510 | -2243 | | N |
| ATOM | 2912 | C | ARG | A | 179 | 9.678 | 18.646 | 76.870 | 1.00 | 44.09 | | | C |
| ANISOU | 2912 | C | ARG | A | 179 | 6017 | 5419 | 5316 | -193 | 1284 | -1429 | | C |
| ATOM | 2913 | O | ARG | A | 179 | 9.566 | 17.437 | 77.061 | 1.00 | 43.91 | | | O |
| ANISOU | 2913 | O | ARG | A | 179 | 6082 | 5162 | 5438 | -156 | 1300 | -1518 | | O |
| ATOM | 2915 | N | GLN | A | 180 | 10.745 | 19.219 | 76.312 | 1.00 | 46.17 | | | N |
| ANISOU | 2915 | N | GLN | A | 180 | 6175 | 5815 | 5552 | -137 | 1395 | -1509 | | N |
| ATOM | 2916 | CA | GLN | A | 180 | 11.948 | 18.504 | 75.932 | 1.00 | 49.44 | | | C |
| ANISOU | 2916 | CA | GLN | A | 180 | 6537 | 6127 | 6119 | 1 | 1553 | -1712 | | C |
| ATOM | 2918 | CB | GLN | A | 180 | 12.959 | 19.529 | 75.417 | 1.00 | 51.72 | | | C |
| ANISOU | 2918 | CB | GLN | A | 180 | 6680 | 6647 | 6325 | 20 | 1648 | -1732 | | C |
| ATOM | 2921 | CG | GLN | A | 180 | 14.378 | 19.045 | 75.281 | 1.00 | 56.26 | | | C |
| ANISOU | 2921 | CG | GLN | A | 180 | 7128 | 7159 | 7089 | 201 | 1802 | -1891 | | C |
| ATOM | 2924 | CD | GLN | A | 180 | 14.697 | 18.698 | 73.875 | 1.00 | 61.33 | | | C |
| ANISOU | 2924 | CD | GLN | A | 180 | 7804 | 7884 | 7613 | 117 | 2007 | -2170 | | C |
| ATOM | 2925 | OE1 | GLN | A | 180 | 15.466 | 19.410 | 73.214 | 1.00 | 64.33 | | | O |
| ANISOU | 2925 | OE1 | GLN | A | 180 | 8075 | 8479 | 7888 | 86 | 2124 | -2230 | | O |
| ATOM | 2926 | NE2 | GLN | A | 180 | 14.085 | 17.617 | 73.371 | 1.00 | 64.71 | | | N |
| ANISOU | 2926 | NE2 | GLN | A | 180 | 8394 | 8154 | 8039 | 55 | 2058 | -2351 | | N |
| ATOM | 2929 | C | GLN | A | 180 | 12.554 | 17.700 | 77.092 | 1.00 | 49.59 | | | C |
| ANISOU | 2929 | C | GLN | A | 180 | 6509 | 5891 | 6442 | 223 | 1509 | -1651 | | C |

FIG. 18 (continued)

| | | | | | | | | | | | | |
|---|---|---|---|---|---|---|---|---|---|---|---|---|
| ATOM | 2930 | O | GLN | A | 180 | 12.852 | 16.499 | 76.949 | 1.00 | 50.00 | | O |
| ANISOU | 2930 | O | GLN | A | 180 | 6616 | 5717 | 6666 | 313 | 1588 | -1813 | O |
| ATOM | 2932 | N | GLU | A | 181 | 12.756 | 18.386 | 78.215 | 1.00 | 47.98 | | N |
| ANISOU | 2932 | N | GLU | A | 181 | 6207 | 5723 | 6299 | 308 | 1382 | -1421 | N |
| ATOM | 2933 | CA | GLU | A | 181 | 13.348 | 17.801 | 79.416 | 1.00 | 49.22 | | C |
| ANISOU | 2933 | CA | GLU | A | 181 | 6305 | 5682 | 6715 | 506 | 1306 | -1312 | C |
| ATOM | 2935 | CB | GLU | A | 181 | 13.647 | 18.886 | 80.455 | 1.00 | 49.52 | | C |
| ANISOU | 2935 | CB | GLU | A | 181 | 6222 | 5853 | 6740 | 552 | 1180 | -1077 | C |
| ATOM | 2938 | CG | GLU | A | 181 | 14.749 | 19.866 | 80.026 | 1.00 | 51.92 | | C |
| ANISOU | 2938 | CG | GLU | A | 181 | 6357 | 6370 | 7002 | 586 | 1262 | -1114 | C |
| ATOM | 2941 | CD | GLU | A | 181 | 16.073 | 19.198 | 79.797 | 1.00 | 56.38 | | C |
| ANISOU | 2941 | CD | GLU | A | 181 | 6790 | 6856 | 7777 | 769 | 1381 | -1257 | C |
| ATOM | 2942 | OE1 | GLU | A | 181 | 16.359 | 18.216 | 80.537 | 1.00 | 59.61 | | O |
| ANISOU | 2942 | OE1 | GLU | A | 181 | 7194 | 7038 | 8418 | 930 | 1329 | -1224 | O |
| ATOM | 2943 | OE2 | GLU | A | 181 | 16.819 | 19.639 | 78.873 | 1.00 | 59.10 | | O |
| ANISOU | 2943 | OE2 | GLU | A | 181 | 7033 | 7365 | 8059 | 752 | 1528 | -1397 | O |
| ATOM | 2944 | C | GLU | A | 181 | 12.446 | 16.741 | 80.035 | 1.00 | 48.20 | | C |
| ANISOU | 2944 | C | GLU | A | 181 | 6329 | 5306 | 6680 | 489 | 1213 | -1255 | C |
| ATOM | 2945 | O | GLU | A | 181 | 12.934 | 15.729 | 80.530 | 1.00 | 48.46 | | O |
| ANISOU | 2945 | O | GLU | A | 181 | 6368 | 5095 | 6949 | 642 | 1209 | -1268 | O |
| ATOM | 2947 | N | MET | A | 182 | 11.135 | 16.970 | 80.005 | 1.00 | 45.43 | | N |
| ANISOU | 2947 | N | MET | A | 182 | 6093 | 5014 | 6153 | 301 | 1137 | -1183 | N |
| ATOM | 2948 | CA | MET | A | 182 | 10.182 | 15.936 | 80.436 | 1.00 | 44.59 | | C |
| ANISOU | 2948 | CA | MET | A | 182 | 6139 | 4692 | 6111 | 238 | 1065 | -1148 | C |
| ATOM | 2950 | CB | MET | A | 182 | 8.741 | 16.443 | 80.362 | 1.00 | 41.86 | | C |
| ANISOU | 2950 | CB | MET | A | 182 | 5870 | 4489 | 5545 | 20 | 983 | -1056 | C |
| ATOM | 2953 | CG | MET | A | 182 | 8.296 | 17.263 | 81.557 | 1.00 | 39.33 | | C |
| ANISOU | 2953 | CG | MET | A | 182 | 5494 | 4268 | 5183 | 22 | 843 | -796 | C |
| ATOM | 2956 | SD | MET | A | 182 | 6.582 | 17.682 | 81.277 | 1.00 | 38.52 | | S |
| ANISOU | 2956 | SD | MET | A | 182 | 5463 | 4318 | 4853 | -220 | 775 | -732 | S |
| ATOM | 2957 | CE | MET | A | 182 | 6.295 | 18.790 | 82.676 | 1.00 | 34.74 | | C |
| ANISOU | 2957 | CE | MET | A | 182 | 4894 | 3966 | 4339 | -175 | 651 | -463 | C |
| ATOM | 2961 | C | MET | A | 182 | 10.337 | 14.692 | 79.564 | 1.00 | 47.22 | | C |
| ANISOU | 2961 | C | MET | A | 182 | 6581 | 4817 | 6544 | 240 | 1191 | -1400 | C |
| ATOM | 2962 | O | MET | A | 182 | 10.392 | 13.573 | 80.082 | 1.00 | 49.49 | | O |
| ANISOU | 2962 | O | MET | A | 182 | 6946 | 4819 | 7038 | 323 | 1167 | -1398 | O |
| ATOM | 2964 | N | ALA | A | 183 | 10.381 | 14.885 | 78.243 | 1.00 | 47.79 | | N |
| ANISOU | 2964 | N | ALA | A | 183 | 6669 | 5025 | 6463 | 138 | 1324 | -1616 | N |
| ATOM | 2965 | CA | ALA | A | 183 | 10.523 | 13.769 | 77.296 | 1.00 | 51.59 | | C |
| ANISOU | 2965 | CA | ALA | A | 183 | 7264 | 5331 | 7006 | 118 | 1468 | -1899 | C |
| ATOM | 2967 | CB | ALA | A | 183 | 10.467 | 14.262 | 75.852 | 1.00 | 51.38 | | C |
| ANISOU | 2967 | CB | ALA | A | 183 | 7249 | 5543 | 6729 | -41 | 1599 | -2105 | C |
| ATOM | 2971 | C | ALA | A | 183 | 11.810 | 12.996 | 77.527 | 1.00 | 54.11 | | C |
| ANISOU | 2971 | C | ALA | A | 183 | 7516 | 5424 | 7621 | 378 | 1562 | -2001 | C |
| ATOM | 2972 | O | ALA | A | 183 | 11.826 | 11.759 | 77.463 | 1.00 | 56.96 | | O |
| ANISOU | 2972 | O | ALA | A | 183 | 7993 | 5486 | 8164 | 431 | 1611 | -2136 | O |
| ATOM | 2974 | N | ASN | A | 184 | 12.892 | 13.723 | 77.793 | 1.00 | 54.11 | | N |
| ANISOU | 2974 | N | ASN | A | 184 | 7321 | 5559 | 7680 | 539 | 1585 | -1937 | N |
| ATOM | 2975 | CA | ASN | A | 184 | 14.171 | 13.091 | 78.137 | 1.00 | 56.95 | | C |
| ANISOU | 2975 | CA | ASN | A | 184 | 7566 | 5733 | 8339 | 811 | 1652 | -1993 | C |
| ATOM | 2977 | CB | ASN | A | 184 | 15.254 | 14.141 | 78.380 | 1.00 | 57.02 | | C |
| ANISOU | 2977 | CB | ASN | A | 184 | 7338 | 5975 | 8353 | 932 | 1661 | -1901 | C |
| ATOM | 2980 | CG | ASN | A | 184 | 15.743 | 14.801 | 77.084 | 1.00 | 58.55 | | C |
| ANISOU | 2980 | CG | ASN | A | 184 | 7453 | 6429 | 8362 | 851 | 1849 | -2113 | C |
| ATOM | 2981 | OD1 | ASN | A | 184 | 15.387 | 14.378 | 75.979 | 1.00 | 59.33 | | O |
| ANISOU | 2981 | OD1 | ASN | A | 184 | 7673 | 6525 | 8346 | 729 | 1986 | -2352 | O |
| ATOM | 2982 | ND2 | ASN | A | 184 | 16.555 | 15.853 | 77.223 | 1.00 | 57.58 | | N |
| ANISOU | 2982 | ND2 | ASN | A | 184 | 7136 | 6541 | 8199 | 900 | 1853 | -2022 | N |
| ATOM | 2985 | C | ASN | A | 184 | 14.067 | 12.159 | 79.348 | 1.00 | 57.31 | | C |
| ANISOU | 2985 | C | ASN | A | 184 | 7670 | 5460 | 8645 | 945 | 1512 | -1824 | C |
| ATOM | 2986 | O | ASN | A | 184 | 14.697 | 11.100 | 79.372 | 1.00 | 58.93 | | O |
| ANISOU | 2986 | O | ASN | A | 184 | 7886 | 5387 | 9117 | 1125 | 1577 | -1935 | O |
| ATOM | 2988 | N | ARG | A | 185 | 13.259 | 12.541 | 80.330 | 1.00 | 54.36 | | N |
| ANISOU | 2988 | N | ARG | A | 185 | 7340 | 5124 | 8192 | 854 | 1326 | -1557 | N |
| ATOM | 2989 | CA | ARG | A | 185 | 13.071 | 11.729 | 81.535 | 1.00 | 55.58 | | C |
| ANISOU | 2989 | CA | ARG | A | 185 | 7561 | 5007 | 8550 | 943 | 1179 | -1360 | C |
| ATOM | 2991 | CB | ARG | A | 185 | 12.810 | 12.642 | 82.739 | 1.00 | 53.50 | | C |
| ANISOU | 2991 | CB | ARG | A | 185 | 7223 | 4912 | 8192 | 917 | 998 | -1050 | C |
| ATOM | 2994 | CG | ARG | A | 185 | 13.948 | 13.615 | 83.044 | 1.00 | 54.02 | | C |
| ANISOU | 2994 | CG | ARG | A | 185 | 7063 | 5187 | 8274 | 1060 | 990 | -975 | C |
| ATOM | 3002 | C | ARG | A | 185 | 11.941 | 10.700 | 81.423 | 1.00 | 55.51 | | C |
| ANISOU | 3002 | C | ARG | A | 185 | 7787 | 4759 | 8544 | 788 | 1157 | -1406 | C |
| ATOM | 3003 | O | ARG | A | 185 | 11.687 | 9.956 | 82.380 | 1.00 | 56.48 | | O |
| ANISOU | 3003 | O | ARG | A | 185 | 7994 | 4641 | 8825 | 830 | 1037 | -1237 | O |
| ATOM | 3005 | N | GLY | A | 186 | 11.274 | 10.646 | 80.270 | 1.00 | 54.79 | | N |
| ANISOU | 3005 | N | GLY | A | 186 | 7805 | 4738 | 8276 | 596 | 1264 | -1625 | N |
| ATOM | 3006 | CA | GLY | A | 186 | 10.128 | 9.750 | 80.066 | 1.00 | 55.10 | | C |
| ANISOU | 3006 | CA | GLY | A | 186 | 8063 | 4588 | 8284 | 402 | 1242 | -1684 | C |
| ATOM | 3009 | C | GLY | A | 186 | 8.829 | 10.193 | 80.724 | 1.00 | 52.34 | | C |

FIG. 18 (continued)

```
ANISOU 3009  C    GLY A 186    7768   4366   7751    192   1084  -1452    C
ATOM   3010  O    GLY A 186      7.959   9.370  81.000  1.00 52.52       O
ANISOU 3010  O    GLY A 186    7949   4196   7809     61   1023  -1413    O
ATOM   3012  N    LEU A 187      8.683  11.500  80.952  1.00 49.24       N
ANISOU 3012  N    LEU A 187    7244   4298   7167    153   1026  -1307    N
ATOM   3013  CA   LEU A 187      7.541  12.050  81.698  1.00 46.49       C
ANISOU 3013  CA   LEU A 187    6909   4092   6662     -6    885  -1077    C
ATOM   3015  CB   LEU A 187      8.039  13.038  82.760  1.00 44.65       C
ANISOU 3015  CB   LEU A 187    6522   4015   6429    124    792   -843    C
ATOM   3018  CG   LEU A 187      9.035  12.558  83.827  1.00 46.15       C
ANISOU 3018  CG   LEU A 187    6662   4008   6865    349    732   -709    C
ATOM   3020  CD1  LEU A 187      9.632  13.743  84.570  1.00 43.03       C
ANISOU 3020  CD1  LEU A 187    6098   3838   6415    447    664   -540    C
ATOM   3024  CD2  LEU A 187      8.410  11.582  84.801  1.00 48.01       C
ANISOU 3024  CD2  LEU A 187    7031   3999   7212    306    621   -544    C
ATOM   3028  C    LEU A 187      6.498  12.766  80.820  1.00 44.89       C
ANISOU 3028  C    LEU A 187    6721   4158   6177   -242    898  -1141    C
ATOM   3029  O    LEU A 187      5.380  13.037  81.270  1.00 41.95       O
ANISOU 3029  O    LEU A 187    6371   3883   5685   -396    798   -990    O
ATOM   3031  N    TRP A 188      6.864  13.114  79.591  1.00 45.45       N
ANISOU 3031  N    TRP A 188    6766   4367   6135   -271   1017  -1350    N
ATOM   3032  CA   TRP A 188      5.980  13.895  78.734  1.00 44.47       C
ANISOU 3032  CA   TRP A 188    6639   4521   5736   -481   1013  -1385    C
ATOM   3034  CB   TRP A 188      6.699  14.334  77.466  1.00 45.78       C
ANISOU 3034  CB   TRP A 188    6762   4843   5788   -477   1152  -1597    C
ATOM   3037  CG   TRP A 188      5.769  15.034  76.523  1.00 44.93       C
ANISOU 3037  CG   TRP A 188    6669   5008   5395   -706   1133  -1622    C
ATOM   3038  CD1  TRP A 188      5.248  14.534  75.359  1.00 46.99       C
ANISOU 3038  CD1  TRP A 188    7044   5299   5509   -902   1192  -1829    C
ATOM   3040  NE1  TRP A 188      4.415  15.454  74.784  1.00 45.62       N
ANISOU 3040  NE1  TRP A 188    6836   5417   5079  -1079   1124  -1754    N
ATOM   3042  CE2  TRP A 188      4.377  16.573  75.574  1.00 43.20       C
ANISOU 3042  CE2  TRP A 188    6397   5251   4765   -989   1031  -1507    C
ATOM   3043  CD2  TRP A 188      5.226  16.343  76.675  1.00 42.24       C
ANISOU 3043  CD2  TRP A 188    6227   4940   4881   -765   1037  -1429    C
ATOM   3044  CE3  TRP A 188      5.363  17.345  77.641  1.00 40.40       C
ANISOU 3044  CE3  TRP A 188    5872   4804   4673   -653    954  -1200    C
ATOM   3046  CZ3  TRP A 188      4.680  18.540  77.474  1.00 38.46       C
ANISOU 3046  CZ3  TRP A 188    5560   4812   4242   -745    880  -1066    C
ATOM   3048  CH2  TRP A 188      3.850  18.741  76.371  1.00 39.59       C
ANISOU 3048  CH2  TRP A 188    5744   5128   4173   -946    871  -1131    C
ATOM   3050  CZ2  TRP A 188      3.683  17.774  75.405  1.00 42.11       C
ANISOU 3050  CZ2  TRP A 188    6179   5384   4437  -1080    939  -1348    C
ATOM   3052  C    TRP A 188      4.664  13.194  78.345  1.00 44.65       C
ANISOU 3052  C    TRP A 188    6807   4496   5663   -728    973  -1439    C
ATOM   3053  O    TRP A 188      3.612  13.802  78.419  1.00 42.57       O
ANISOU 3053  O    TRP A 188    6515   4427   5233   -881    880  -1311    O
ATOM   3055  N    ASP A 189      4.712  11.940  77.920  1.00 48.60       N
ANISOU 3055  N    ASP A 189    7453   4739   6272   -769   1041  -1631    N
ATOM   3056  CA   ASP A 189      3.477  11.243  77.497  1.00 50.57       C
ANISOU 3056  CA   ASP A 189    7846   4943   6425  -1033   1002  -1700    C
ATOM   3058  CB   ASP A 189      3.764   9.815  77.034  1.00 55.47       C
ANISOU 3058  CB   ASP A 189    8646   5228   7204  -1049   1100  -1946    C
ATOM   3061  CG   ASP A 189      4.463   9.759  75.690  1.00 58.87       C
ANISOU 3061  CG   ASP A 189    9104   5709   7555  -1046   1268  -2257    C
ATOM   3062  OD1  ASP A 189      4.806  10.833  75.152  1.00 59.44       O
ANISOU 3062  OD1  ASP A 189    9052   6079   7454  -1026   1304  -2261    O
ATOM   3063  OD2  ASP A 189      4.667   8.636  75.179  1.00 62.94       O
ANISOU 3063  OD2  ASP A 189    9773   5962   8180  -1071   1369  -2501    O
ATOM   3064  C    ASP A 189      2.398  11.191  78.585  1.00 49.31       C
ANISOU 3064  C    ASP A 189    7689   4772   6275  -1133    852  -1445    C
ATOM   3065  O    ASP A 189      1.232  11.404  78.287  1.00 49.37       O
ANISOU 3065  O    ASP A 189    7703   4950   6106  -1358    786  -1409    O
ATOM   3067  N    SER A 190      2.785  10.895  79.824  1.00 48.53       N
ANISOU 3067  N    SER A 190    7579   4486   6375   -974    801  -1270    N
ATOM   3068  CA   SER A 190      1.848  10.916  80.959  1.00 48.25       C
ANISOU 3068  CA   SER A 190    7533   4463   6335  -1060    673  -1016    C
ATOM   3070  CB   SER A 190      2.517  10.347  82.222  1.00 49.23       C
ANISOU 3070  CB   SER A 190    7682   4326   6696   -876    631   -857    C
ATOM   3073  OG   SER A 190      1.711  10.528  83.387  1.00 48.88       O
ANISOU 3073  OG   SER A 190    7612   4342   6619   -952    518   -598    O
ATOM   3075  C    SER A 190      1.315  12.327  81.225  1.00 44.94       C
ANISOU 3075  C    SER A 190    6950   4398   5725  -1086    607   -846    C
ATOM   3076  O    SER A 190      0.111  12.519  81.441  1.00 44.25       O
ANISOU 3076  O    SER A 190    6844   4449   5519  -1266    532   -736    O
ATOM   3078  N    PHE A 191      2.217  13.306  81.218  1.00 43.17       N
ANISOU 3078  N    PHE A 191    6604   4314   5483   -906    638   -827    N
ATOM   3079  CA   PHE A 191      1.853  14.718  81.396  1.00 40.71       C
ANISOU 3079  CA   PHE A 191    6147   4312   5008   -907    588   -686    C
```

FIG. 18 (continued)

```
ATOM    3081  CB   PHE A 191      3.119  15.594  81.407  1.00 38.24          C
ANISOU  3081  CB   PHE A 191   5727   4078   4725   -697    635   -689       C
ATOM    3084  CG   PHE A 191      2.866  17.052  81.698  1.00 35.68          C
ANISOU  3084  CG   PHE A 191   5270   4022   4264   -679    586   -542       C
ATOM    3085  CD1  PHE A 191      2.311  17.456  82.905  1.00 34.06          C
ANISOU  3085  CD1  PHE A 191   5018   3864   4062   -668    501   -336       C
ATOM    3087  CE1  PHE A 191      2.097  18.819  83.166  1.00 32.92          C
ANISOU  3087  CE1  PHE A 191   4759   3942   3806   -639    468   -222       C
ATOM    3089  CZ   PHE A 191      2.457  19.786  82.206  1.00 32.71          C
ANISOU  3089  CZ   PHE A 191   4670   4085   3672   -625    507   -292       C
ATOM    3091  CE2  PHE A 191      2.994  19.387  81.007  1.00 32.51          C
ANISOU  3091  CE2  PHE A 191   4690   4034   3627   -652    586   -478       C
ATOM    3093  CD2  PHE A 191      3.198  18.026  80.757  1.00 35.19          C
ANISOU  3093  CD2  PHE A 191   5139   4160   4072   -675    632   -614       C
ATOM    3095  C    PHE A 191      0.877  15.169  80.301  1.00 42.50          C
ANISOU  3095  C    PHE A 191   6360   4770   5020  -1111    581   -761       C
ATOM    3096  O    PHE A 191     -0.138  15.801  80.588  1.00 41.37          O
ANISOU  3096  O    PHE A 191   6143   4813   4764  -1209    504   -620       O
ATOM    3098  N    ARG A 192      1.158  14.841  79.048  1.00 45.60          N
ANISOU  3098  N    ARG A 192   6817   5160   5350  -1178    660   -982       N
ATOM    3099  CA   ARG A 192      0.195  15.172  77.984  1.00 48.27          C
ANISOU  3099  CA   ARG A 192   7153   5722   5467  -1397    634  -1045       C
ATOM    3101  CB   ARG A 192      0.741  14.867  76.597  1.00 51.08          C
ANISOU  3101  CB   ARG A 192   7587   6087   5736  -1457    739  -1305       C
ATOM    3104  CG   ARG A 192     -0.164  15.418  75.522  1.00 53.54          C
ANISOU  3104  CG   ARG A 192   7876   6679   5789  -1676    691  -1333       C
ATOM    3107  CD   ARG A 192      0.193  14.933  74.166  1.00 57.85          C
ANISOU  3107  CD   ARG A 192   8529   7233   6217  -1792    791  -1603       C
ATOM    3110  NE   ARG A 192     -0.439  15.765  73.145  1.00 60.47          N
ANISOU  3110  NE   ARG A 192   8811   7887   6278  -1965    735  -1587       N
ATOM    3112  CZ   ARG A 192     -1.623  15.529  72.563  1.00 63.32          C
ANISOU  3112  CZ   ARG A 192   9204   8378   6475  -2222    643  -1600       C
ATOM    3113  NH1  ARG A 192     -2.357  14.473  72.896  1.00 66.11          N
ANISOU  3113  NH1  ARG A 192   9645   8568   6906  -2358    603  -1638       N
ATOM    3116  NH2  ARG A 192     -2.078  16.366  71.619  1.00 62.99          N
ANISOU  3116  NH2  ARG A 192   9104   8641   6186  -2357    581  -1564       N
ATOM    3119  C    ARG A 192     -1.151  14.458  78.151  1.00 49.10          C
ANISOU  3119  C    ARG A 192   7317   5799   5541  -1621    552  -1003       C
ATOM    3120  O    ARG A 192     -2.203  15.089  78.070  1.00 48.14          O
ANISOU  3120  O    ARG A 192   7106   5908   5278  -1749    467   -888       O
ATOM    3122  N    GLN A 193     -1.116  13.153  78.384  1.00 52.50          N
ANISOU  3122  N    GLN A 193   7889   5944   6113  -1668    578  -1090       N
ATOM    3123  CA   GLN A 193     -2.357  12.381  78.480  1.00 55.90          C
ANISOU  3123  CA   GLN A 193   8389   6333   6518  -1912    508  -1066       C
ATOM    3125  CB   GLN A 193     -2.068  10.880  78.544  1.00 59.49          C
ANISOU  3125  CB   GLN A 193   9039   6418   7148  -1952    559  -1208       C
ATOM    3128  CG   GLN A 193     -1.476  10.314  77.278  1.00 62.20          C
ANISOU  3128  CG   GLN A 193   9506   6661   7465  -1991    668  -1513       C
ATOM    3131  CD   GLN A 193     -1.068   8.852  77.434  1.00 66.43          C
ANISOU  3131  CD   GLN A 193  10238   6780   8222  -1981    730  -1655       C
ATOM    3132  OE1  GLN A 193     -0.807   8.378  78.550  1.00 68.34          O
ANISOU  3132  OE1  GLN A 193  10508   6787   8670  -1857    701  -1508       O
ATOM    3133  NE2  GLN A 193     -1.015   8.127  76.312  1.00 69.74          N
ANISOU  3133  NE2  GLN A 193  10803   7099   8596  -2118    814  -1943       N
ATOM    3136  C    GLN A 193     -3.238  12.794  79.662  1.00 54.27          C
ANISOU  3136  C    GLN A 193   8074   6229   6318  -1934    408   -800       C
ATOM    3137  O    GLN A 193     -4.470  12.702  79.577  1.00 55.17          O
ANISOU  3137  O    GLN A 193   8157   6473   6332  -2152    337   -745       O
ATOM    3139  N    SER A 194     -2.630  13.254  80.752  1.00 52.51          N
ANISOU  3139  N    SER A 194   7785   5965   6201  -1721    406   -643       N
ATOM    3140  CA   SER A 194     -3.415  13.610  81.935  1.00 51.86          C
ANISOU  3140  CA   SER A 194   7610   5975   6118  -1741    333   -408       C
ATOM    3142  CB   SER A 194     -2.542  13.653  83.206  1.00 50.85          C
ANISOU  3142  CB   SER A 194   7481   5700   6140  -1524    338   -271       C
ATOM    3145  OG   SER A 194     -1.712  14.792  83.251  1.00 51.85          O
ANISOU  3145  OG   SER A 194   7500   5959   6240  -1323    360   -246       O
ATOM    3147  C    SER A 194     -4.268  14.895  81.764  1.00 49.77          C
ANISOU  3147  C    SER A 194   7167   6061   5682  -1784    282   -305       C
ATOM    3148  O    SER A 194     -5.159  15.139  82.563  1.00 49.24          O
ANISOU  3148  O    SER A 194   7014   6103   5593  -1844    233   -143       O
ATOM    3150  N    GLU A 195     -4.049  15.683  80.710  1.00 48.38          N
ANISOU  3150  N    GLU A 195   6936   6062   5386  -1763    296   -394       N
ATOM    3151  CA   GLU A 195     -4.897  16.859  80.479  1.00 48.67          C
ANISOU  3151  CA   GLU A 195   6809   6406   5277  -1801    235   -286       C
ATOM    3153  CB   GLU A 195     -4.323  17.786  79.394  1.00 46.71          C
ANISOU  3153  CB   GLU A 195   6522   6311   4915  -1734    254   -364       C
ATOM    3156  CG   GLU A 195     -5.043  19.143  79.364  1.00 44.13          C
ANISOU  3156  CG   GLU A 195   6022   6262   4482  -1711    185   -211       C
ATOM    3159  CD   GLU A 195     -4.361  20.182  78.516  1.00 42.87          C
```

FIG. 18 (continued)

| | | | | | | | | | | | | | |
|---|---|---|---|---|---|---|---|---|---|---|---|---|---|
| ANISOU | 3159 | CD | GLU | A | 195 | 5830 | 6230 | 4230 | -1619 | 201 | -239 | | C |
| ATOM | 3160 | OE1 | GLU | A | 195 | -5.036 | 21.165 | 78.156 | 1.00 | 41.99 | | | O |
| ANISOU | 3160 | OE1 | GLU | A | 195 | 5601 | 6338 | 4017 | -1640 | 132 | -135 | | O |
| ATOM | 3161 | OE2 | GLU | A | 195 | -3.159 | 20.038 | 78.218 | 1.00 | 41.40 | | | O |
| ANISOU | 3161 | OE2 | GLU | A | 195 | 5725 | 5926 | 4077 | -1525 | 282 | -356 | | O |
| ATOM | 3162 | C | GLU | A | 195 | -6.372 | 16.502 | 80.175 | 1.00 | 52.44 | | | C |
| ANISOU | 3162 | C | GLU | A | 195 | 7241 | 7021 | 5661 | -2055 | 159 | -256 | | C |
| ATOM | 3163 | O | GLU | A | 195 | -7.289 | 17.144 | 80.698 | 1.00 | 54.84 | | | O |
| ANISOU | 3163 | O | GLU | A | 195 | 7396 | 7511 | 5931 | -2074 | 106 | -99 | | O |
| ATOM | 3165 | N | ARG | A | 196 | -6.603 | 15.483 | 79.357 | 1.00 | 56.00 | | | N |
| ANISOU | 3165 | N | ARG | A | 196 | 7812 | 7385 | 6079 | -2252 | 159 | -412 | | N |
| ATOM | 3166 | CA | ARG | A | 196 | -7.964 | 14.971 | 79.122 | 1.00 | 57.53 | | | C |
| ANISOU | 3166 | CA | ARG | A | 196 | 7974 | 7688 | 6197 | -2524 | 82 | -392 | | C |
| ATOM | 3168 | CB | ARG | A | 196 | -7.972 | 13.965 | 77.970 | 1.00 | 59.65 | | | C |
| ANISOU | 3168 | CB | ARG | A | 196 | 8403 | 7861 | 6402 | -2736 | 92 | -616 | | C |
| ATOM | 3177 | C | ARG | A | 196 | -8.519 | 14.303 | 80.388 | 1.00 | 59.33 | | | C |
| ANISOU | 3177 | C | ARG | A | 196 | 8207 | 7792 | 6544 | -2580 | 74 | -263 | | C |
| ATOM | 3178 | O | ARG | A | 196 | -9.540 | 13.602 | 80.343 | 1.00 | 61.95 | | | O |
| ANISOU | 3178 | O | ARG | A | 196 | 8541 | 8148 | 6848 | -2824 | 26 | -255 | | O |
| ATOM | 3180 | MN | MN | A | 301 | -5.664 | 32.633 | 87.064 | 0.80 | 34.83 | | | MN |
| ANISOU | 3180 | MN | MN | A | 301 | 3930 | 5661 | 3642 | -113 | 299 | 788 | | MN |
| ATOM | 3181 | MN | MN | A | 302 | -5.252 | 31.856 | 83.885 | 0.40 | 49.14 | | | MN |
| ANISOU | 3181 | MN | MN | A | 302 | 5797 | 7549 | 5325 | -314 | 144 | 793 | | MN |
| ATOM | 3182 | OH2 | HOH | A | 303 | -5.570 | 34.267 | 88.637 | 1.00 | 24.91 | | | O |
| ANISOU | 3182 | OH2 | HOH | A | 303 | 2668 | 4340 | 2457 | 80 | 399 | 768 | | O |
| ATOM | 3185 | OH2 | HOH | A | 304 | -7.572 | 33.669 | 86.032 | 1.00 | 27.37 | | | O |
| ANISOU | 3185 | OH2 | HOH | A | 304 | 2755 | 4903 | 2743 | -56 | 224 | 918 | | O |
| ATOM | 3188 | OH2 | HOH | A | 305 | -2.907 | 27.064 | 82.458 | 1.00 | 25.70 | | | O |
| ANISOU | 3188 | OH2 | HOH | A | 305 | 3196 | 4310 | 2258 | -693 | 208 | 413 | | O |
| ATOM | 3191 | OH2 | HOH | A | 306 | -5.371 | 27.889 | 82.733 | 1.00 | 31.80 | | | O |
| ANISOU | 3191 | OH2 | HOH | A | 306 | 3751 | 5326 | 3006 | -734 | 120 | 593 | | O |
| ATOM | 3194 | S | SO4 | A | 401 | -11.964 | 32.190 | 89.101 | 0.50 | 36.98 | | | S |
| ANISOU | 3194 | S | SO4 | A | 401 | 3446 | 6573 | 4031 | -164 | 444 | 963 | | S |
| ATOM | 3195 | O1 | SO4 | A | 401 | -10.789 | 32.730 | 88.403 | 0.50 | 34.42 | | | O |
| ANISOU | 3195 | O1 | SO4 | A | 401 | 3270 | 6104 | 3703 | -98 | 384 | 947 | | O |
| ATOM | 3196 | O2 | SO4 | A | 401 | -12.755 | 33.239 | 89.799 | 0.50 | 30.74 | | | O |
| ANISOU | 3196 | O2 | SO4 | A | 401 | 2502 | 5854 | 3324 | -4 | 534 | 964 | | O |
| ATOM | 3197 | O3 | SO4 | A | 401 | -11.370 | 31.165 | 89.966 | 0.50 | 32.74 | | | O |
| ANISOU | 3197 | O3 | SO4 | A | 401 | 3050 | 5967 | 3423 | -280 | 498 | 914 | | O |
| ATOM | 3198 | O4 | SO4 | A | 401 | -12.852 | 31.537 | 88.124 | 0.50 | 35.27 | | | O |
| ANISOU | 3198 | O4 | SO4 | A | 401 | 3107 | 6495 | 3800 | -295 | 348 | 1026 | | O |
| ATOM | 3199 | S | SO4 | A | 402 | 2.793 | 15.687 | 71.380 | 0.40 | 56.51 | | | S |
| ANISOU | 3199 | S | SO4 | A | 402 | 8387 | 7320 | 5763 | -1716 | 1152 | -2099 | | S |
| ATOM | 3200 | O1 | SO4 | A | 402 | 2.962 | 16.829 | 72.269 | 0.40 | 53.07 | | | O |
| ANISOU | 3200 | O1 | SO4 | A | 402 | 7795 | 6981 | 5387 | -1552 | 1071 | -1827 | | O |
| ATOM | 3201 | O2 | SO4 | A | 402 | 3.511 | 14.517 | 71.878 | 0.40 | 57.16 | | | O |
| ANISOU | 3201 | O2 | SO4 | A | 402 | 8549 | 7061 | 6110 | -1569 | 1257 | -2251 | | O |
| ATOM | 3202 | O3 | SO4 | A | 402 | 3.318 | 16.051 | 70.066 | 0.40 | 58.13 | | | O |
| ANISOU | 3202 | O3 | SO4 | A | 402 | 8613 | 7726 | 5749 | -1807 | 1265 | -2275 | | O |
| ATOM | 3203 | O4 | SO4 | A | 402 | 1.386 | 15.341 | 71.249 | 0.40 | 57.55 | | | O |
| ANISOU | 3203 | O4 | SO4 | A | 402 | 8579 | 7504 | 5783 | -1952 | 1020 | -2053 | | O |
| ATOM | 3204 | N | ALA | B | 0 | 30.545 | 47.206 | 81.073 | 1.00 | 41.02 | | | N |
| ANISOU | 3204 | N | ALA | B | 0 | 6001 | 6061 | 3524 | -510 | 1990 | 853 | | N |
| ATOM | 3205 | CA | ALA | B | 0 | 31.428 | 47.994 | 81.988 | 1.00 | 40.58 | | | C |
| ANISOU | 3205 | CA | ALA | B | 0 | 5759 | 5926 | 3732 | -576 | 2050 | 836 | | C |
| ATOM | 3207 | CB | ALA | B | 0 | 31.363 | 49.490 | 81.648 | 1.00 | 42.81 | | | C |
| ANISOU | 3207 | CB | ALA | B | 0 | 6065 | 6102 | 4100 | -693 | 2112 | 1036 | | C |
| ATOM | 3211 | C | ALA | B | 0 | 31.029 | 47.753 | 83.452 | 1.00 | 37.95 | | | C |
| ANISOU | 3211 | C | ALA | B | 0 | 5341 | 5503 | 3573 | -526 | 1882 | 707 | | C |
| ATOM | 3212 | O | ALA | B | 0 | 31.871 | 47.587 | 84.306 | 1.00 | 37.38 | | | O |
| ANISOU | 3212 | O | ALA | B | 0 | 5108 | 5449 | 3647 | -527 | 1904 | 592 | | O |
| ATOM | 3216 | N | MET | B | 1 | 29.735 | 47.725 | 83.729 | 1.00 | 37.46 | | | N |
| ANISOU | 3216 | N | MET | B | 1 | 5382 | 5367 | 3486 | -481 | 1716 | 732 | | N |
| ATOM | 3217 | CA | MET | B | 1 | 29.291 | 47.458 | 85.101 | 1.00 | 37.00 | | | C |
| ANISOU | 3217 | CA | MET | B | 1 | 5255 | 5235 | 3567 | -432 | 1568 | 614 | | C |
| ATOM | 3219 | CB | MET | B | 1 | 27.811 | 47.796 | 85.318 | 1.00 | 35.58 | | | C |
| ANISOU | 3219 | CB | MET | B | 1 | 5173 | 4964 | 3383 | -403 | 1413 | 689 | | C |
| ATOM | 3222 | CG | MET | B | 1 | 27.303 | 47.444 | 86.759 | 1.00 | 32.62 | | | C |
| ANISOU | 3222 | CG | MET | B | 1 | 4732 | 4530 | 3131 | -348 | 1274 | 564 | | C |
| ATOM | 3225 | SD | MET | B | 1 | 28.149 | 48.373 | 88.055 | 1.00 | 32.96 | | | S |
| ANISOU | 3225 | SD | MET | B | 1 | 4614 | 4483 | 3425 | -416 | 1307 | 485 | | S |
| ATOM | 3226 | CE | MET | B | 1 | 27.121 | 49.874 | 88.115 | 1.00 | 32.54 | | | C |
| ANISOU | 3226 | CE | MET | B | 1 | 4636 | 4242 | 3485 | -453 | 1277 | 626 | | C |
| ATOM | 3230 | C | MET | B | 1 | 29.562 | 46.026 | 85.505 | 1.00 | 36.22 | | | C |
| ANISOU | 3230 | C | MET | B | 1 | 5127 | 5223 | 3414 | -335 | 1536 | 452 | | C |
| ATOM | 3231 | O | MET | B | 1 | 29.978 | 45.782 | 86.614 | 1.00 | 34.28 | | | O |
| ANISOU | 3231 | O | MET | B | 1 | 4759 | 4969 | 3299 | -306 | 1496 | 345 | | O |
| ATOM | 3233 | N | GLU | B | 2 | 29.387 | 45.080 | 84.584 | 1.00 | 37.89 | | | N |
| ANISOU | 3233 | N | GLU | B | 2 | 5455 | 5516 | 3426 | -286 | 1565 | 432 | | N |

FIG. 18 (continued)

| | | | | | | | | | | | | | | |
|---|---|---|---|---|---|---|---|---|---|---|---|---|---|---|
| ATOM | 3234 | CA | GLU | B | 2 | 29.663 | 43.696 | 84.897 | 1.00 | 38.86 | | | | C |
| ANISOU | 3234 | CA | GLU | B | 2 | 5575 | 5684 | 3506 | -187 | 1559 | 282 | | | C |
| ATOM | 3236 | CB | GLU | B | 2 | 29.228 | 42.785 | 83.753 | 1.00 | 41.78 | | | | C |
| ANISOU | 3236 | CB | GLU | B | 2 | 6125 | 6112 | 3637 | -161 | 1585 | 257 | | | C |
| ATOM | 3239 | CG | GLU | B | 2 | 29.125 | 41.350 | 84.174 | 1.00 | 42.11 | | | | C |
| ANISOU | 3239 | CG | GLU | B | 2 | 6213 | 6137 | 3650 | -62 | 1547 | 105 | | | C |
| ATOM | 3242 | CD | GLU | B | 2 | 28.871 | 40.406 | 83.023 | 1.00 | 43.51 | | | | C |
| ANISOU | 3242 | CD | GLU | B | 2 | 6577 | 6362 | 3593 | -53 | 1601 | 41 | | | C |
| ATOM | 3243 | OE1 | GLU | B | 2 | 28.395 | 40.850 | 81.959 | 1.00 | 45.80 | | | | O |
| ANISOU | 3243 | OE1 | GLU | B | 2 | 6978 | 6713 | 3711 | -132 | 1606 | 125 | | | O |
| ATOM | 3244 | OE2 | GLU | B | 2 | 29.137 | 39.209 | 83.208 | 1.00 | 44.32 | | | | O |
| ANISOU | 3244 | OE2 | GLU | B | 2 | 6722 | 6436 | 3681 | 35 | 1638 | -94 | | | O |
| ATOM | 3245 | C | GLU | B | 2 | 31.147 | 43.498 | 85.219 | 1.00 | 39.59 | | | | C |
| ANISOU | 3245 | C | GLU | B | 2 | 5498 | 5844 | 3701 | -153 | 1694 | 209 | | | C |
| ATOM | 3246 | O | GLU | B | 2 | 31.481 | 42.792 | 86.179 | 1.00 | 37.45 | | | | O |
| ANISOU | 3246 | O | GLU | B | 2 | 5134 | 5574 | 3520 | -68 | 1649 | 107 | | | O |
| ATOM | 3248 | N | ASP | B | 3 | 32.017 | 44.109 | 84.418 | 1.00 | 40.30 | | | | N |
| ANISOU | 3248 | N | ASP | B | 3 | 5537 | 6002 | 3773 | -218 | 1859 | 276 | | | N |
| ATOM | 3249 | CA | ASP | B | 3 | 33.471 | 44.118 | 84.665 | 1.00 | 42.09 | | | | C |
| ANISOU | 3249 | CA | ASP | B | 3 | 5560 | 6319 | 4113 | -210 | 1998 | 230 | | | C |
| ATOM | 3251 | CB | ASP | B | 3 | 34.232 | 44.908 | 83.568 | 1.00 | 44.99 | | | | C |
| ANISOU | 3251 | CB | ASP | B | 3 | 5901 | 6760 | 4433 | -313 | 2195 | 336 | | | C |
| ATOM | 3254 | CG | ASP | B | 3 | 34.316 | 44.158 | 82.263 | 1.00 | 48.10 | | | | C |
| ANISOU | 3254 | CG | ASP | B | 3 | 6438 | 7245 | 4594 | -255 | 2332 | 330 | | | C |
| ATOM | 3255 | OD1 | ASP | B | 3 | 34.202 | 42.919 | 82.309 | 1.00 | 49.35 | | | | O |
| ANISOU | 3255 | OD1 | ASP | B | 3 | 6660 | 7418 | 4672 | -125 | 2314 | 207 | | | O |
| ATOM | 3256 | OD2 | ASP | B | 3 | 34.503 | 44.801 | 81.195 | 1.00 | 51.10 | | | | O |
| ANISOU | 3256 | OD2 | ASP | B | 3 | 6877 | 7675 | 4865 | -343 | 2465 | 447 | | | O |
| ATOM | 3257 | C | ASP | B | 3 | 33.780 | 44.747 | 85.998 | 1.00 | 39.27 | | | | C |
| ANISOU | 3257 | C | ASP | B | 3 | 5020 | 5926 | 3976 | -256 | 1907 | 203 | | | C |
| ATOM | 3258 | O | ASP | B | 3 | 34.567 | 44.228 | 86.765 | 1.00 | 39.79 | | | | O |
| ANISOU | 3258 | O | ASP | B | 3 | 4920 | 6063 | 4133 | -188 | 1906 | 115 | | | O |
| ATOM | 3260 | N | PHE | B | 4 | 33.175 | 45.889 | 86.273 | 1.00 | 38.41 | | | | N |
| ANISOU | 3260 | N | PHE | B | 4 | 4939 | 5709 | 3946 | -370 | 1834 | 279 | | | N |
| ATOM | 3261 | CA | PHE | B | 4 | 33.352 | 46.499 | 87.570 | 1.00 | 37.36 | | | | C |
| ANISOU | 3261 | CA | PHE | B | 4 | 4664 | 5529 | 4002 | -427 | 1741 | 227 | | | C |
| ATOM | 3263 | CB | PHE | B | 4 | 32.513 | 47.757 | 87.681 | 1.00 | 37.89 | | | | C |
| ANISOU | 3263 | CB | PHE | B | 4 | 4818 | 5438 | 4139 | -535 | 1686 | 314 | | | C |
| ATOM | 3266 | CG | PHE | B | 4 | 32.526 | 48.332 | 89.036 | 1.00 | 37.33 | | | | C |
| ANISOU | 3266 | CG | PHE | B | 4 | 4642 | 5302 | 4238 | -590 | 1586 | 232 | | | C |
| ATOM | 3267 | CD1 | PHE | B | 4 | 33.610 | 49.072 | 89.467 | 1.00 | 40.07 | | | | C |
| ANISOU | 3267 | CD1 | PHE | B | 4 | 4815 | 5679 | 4732 | -723 | 1652 | 190 | | | C |
| ATOM | 3269 | CE1 | PHE | B | 4 | 33.651 | 49.563 | 90.747 | 1.00 | 38.64 | | | | C |
| ANISOU | 3269 | CE1 | PHE | B | 4 | 4543 | 5456 | 4684 | -786 | 1553 | 86 | | | C |
| ATOM | 3271 | CZ | PHE | B | 4 | 32.623 | 49.335 | 91.586 | 1.00 | 36.89 | | | | C |
| ANISOU | 3271 | CZ | PHE | B | 4 | 4405 | 5163 | 4448 | -706 | 1406 | 35 | | | C |
| ATOM | 3273 | CE2 | PHE | B | 4 | 31.542 | 48.589 | 91.186 | 1.00 | 35.90 | | | | C |
| ANISOU | 3273 | CE2 | PHE | B | 4 | 4437 | 5009 | 4193 | -569 | 1347 | 88 | | | C |
| ATOM | 3275 | CD2 | PHE | B | 4 | 31.493 | 48.083 | 89.925 | 1.00 | 36.44 | | | | C |
| ANISOU | 3275 | CD2 | PHE | B | 4 | 4596 | 5120 | 4131 | -519 | 1428 | 180 | | | C |
| ATOM | 3277 | C | PHE | B | 4 | 33.012 | 45.566 | 88.754 | 1.00 | 35.96 | | | | C |
| ANISOU | 3277 | C | PHE | B | 4 | 4455 | 5361 | 3848 | -306 | 1588 | 111 | | | C |
| ATOM | 3278 | O | PHE | B | 4 | 33.776 | 45.459 | 89.716 | 1.00 | 33.47 | | | | O |
| ANISOU | 3278 | O | PHE | B | 4 | 3960 | 5118 | 3638 | -298 | 1558 | 31 | | | O |
| ATOM | 3280 | N | VAL | B | 5 | 31.852 | 44.923 | 88.690 | 1.00 | 33.91 | | | | N |
| ANISOU | 3280 | N | VAL | B | 5 | 4363 | 5038 | 3484 | -225 | 1489 | 112 | | | N |
| ATOM | 3281 | CA | VAL | B | 5 | 31.415 | 44.050 | 89.769 | 1.00 | 33.64 | | | | C |
| ANISOU | 3281 | CA | VAL | B | 5 | 4322 | 4996 | 3464 | -122 | 1355 | 26 | | | C |
| ATOM | 3283 | CB | VAL | B | 5 | 30.007 | 43.451 | 89.488 | 1.00 | 32.36 | | | | C |
| ANISOU | 3283 | CB | VAL | B | 5 | 4358 | 4757 | 3182 | -73 | 1261 | 47 | | | C |
| ATOM | 3285 | CG1 | VAL | B | 5 | 29.671 | 42.326 | 90.530 | 1.00 | 29.96 | | | | C |
| ANISOU | 3285 | CG1 | VAL | B | 5 | 4053 | 4447 | 2883 | 38 | 1153 | -35 | | | C |
| ATOM | 3289 | CG2 | VAL | B | 5 | 28.911 | 44.566 | 89.475 | 1.00 | 31.11 | | | | C |
| ANISOU | 3289 | CG2 | VAL | B | 5 | 4274 | 4496 | 3051 | -158 | 1187 | 134 | | | C |
| ATOM | 3293 | C | VAL | B | 5 | 32.422 | 42.911 | 89.987 | 1.00 | 34.46 | | | | C |
| ANISOU | 3293 | C | VAL | B | 5 | 4320 | 5211 | 3562 | 1 | 1408 | -49 | | | C |
| ATOM | 3294 | O | VAL | B | 5 | 32.836 | 42.648 | 91.114 | 1.00 | 34.18 | | | | O |
| ANISOU | 3294 | O | VAL | B | 5 | 4151 | 5225 | 3611 | 51 | 1336 | -106 | | | O |
| ATOM | 3296 | N | ARG | B | 6 | 32.815 | 42.265 | 88.900 | 1.00 | 37.40 | | | | N |
| ANISOU | 3296 | N | ARG | B | 6 | 4754 | 5629 | 3829 | 57 | 1537 | -45 | | | N |
| ATOM | 3297 | CA | ARG | B | 6 | 33.742 | 41.126 | 88.948 | 1.00 | 40.63 | | | | C |
| ANISOU | 3297 | CA | ARG | B | 6 | 5081 | 6123 | 4233 | 207 | 1618 | -110 | | | C |
| ATOM | 3299 | CB | ARG | B | 6 | 33.852 | 40.472 | 87.568 | 1.00 | 41.27 | | | | C |
| ANISOU | 3299 | CB | ARG | B | 6 | 5304 | 6216 | 4161 | 256 | 1772 | -117 | | | C |
| ATOM | 3302 | CG | ARG | B | 6 | 32.539 | 39.829 | 87.131 | 1.00 | 40.52 | | | | C |
| ANISOU | 3302 | CG | ARG | B | 6 | 5465 | 6010 | 3922 | 266 | 1694 | -134 | | | C |
| ATOM | 3305 | CD | ARG | B | 6 | 32.676 | 39.065 | 85.841 | 1.00 | 42.28 | | | | C |
| ANISOU | 3305 | CD | ARG | B | 6 | 5841 | 6251 | 3974 | 313 | 1840 | -177 | | | C |
| ATOM | 3308 | NE | ARG | B | 6 | 31.352 | 38.625 | 85.396 | 1.00 | 42.64 | | | | N |

FIG. 18 (continued)

| | | | | | | | | | | | | | |
|---|---|---|---|---|---|---|---|---|---|---|---|---|---|
| ANISOU | 3308 | NE | ARG | B | 6 | 6120 | 6209 | 3873 | 271 | 1743 | -195 | | N |
| ATOM | 3310 | CZ | ARG | B | 6 | 30.645 | 37.624 | 85.950 | 1.00 | 40.99 | | | C |
| ANISOU | 3310 | CZ | ARG | B | 6 | 6013 | 5902 | 3661 | 332 | 1642 | -263 | | C |
| ATOM | 3311 | NH1 | ARG | B | 6 | 31.125 | 36.898 | 86.949 | 1.00 | 39.93 | | | N |
| ANISOU | 3311 | NH1 | ARG | B | 6 | 5789 | 5734 | 3649 | 461 | 1630 | -310 | | N |
| ATOM | 3314 | NH2 | ARG | B | 6 | 29.457 | 37.322 | 85.467 | 1.00 | 40.90 | | | N |
| ANISOU | 3314 | NH2 | ARG | B | 6 | 6191 | 5835 | 3515 | 260 | 1554 | -277 | | N |
| ATOM | 3317 | C | ARG | B | 6 | 35.130 | 41.498 | 89.464 | 1.00 | 43.15 | | | C |
| ANISOU | 3317 | C | ARG | B | 6 | 5129 | 6582 | 4686 | 203 | 1679 | -121 | | C |
| ATOM | 3318 | O | ARG | B | 6 | 35.805 | 40.678 | 90.071 | 1.00 | 44.22 | | | O |
| ANISOU | 3318 | O | ARG | B | 6 | 5139 | 6794 | 4868 | 342 | 1676 | -163 | | O |
| ATOM | 3320 | N | GLN | B | 7 | 35.559 | 42.731 | 89.213 | 1.00 | 45.76 | | | N |
| ANISOU | 3320 | N | GLN | B | 7 | 5360 | 6945 | 5082 | 41 | 1735 | -73 | | N |
| ATOM | 3321 | CA | GLN | B | 7 | 36.863 | 43.186 | 89.684 | 1.00 | 48.73 | | | C |
| ANISOU | 3321 | CA | GLN | B | 7 | 5458 | 7467 | 5590 | -8 | 1787 | -88 | | C |
| ATOM | 3323 | CB | GLN | B | 7 | 37.416 | 44.290 | 88.759 | 1.00 | 51.46 | | | C |
| ANISOU | 3323 | CB | GLN | B | 7 | 5753 | 7840 | 5962 | -181 | 1942 | -19 | | C |
| ATOM | 3326 | CG | GLN | B | 7 | 37.826 | 43.754 | 87.366 | 1.00 | 55.42 | | | C |
| ANISOU | 3326 | CG | GLN | B | 7 | 6321 | 8400 | 6335 | -113 | 2147 | 17 | | C |
| ATOM | 3329 | CD | GLN | B | 7 | 38.347 | 44.835 | 86.404 | 1.00 | 58.50 | | | C |
| ANISOU | 3329 | CD | GLN | B | 7 | 6674 | 8822 | 6731 | -288 | 2317 | 111 | | C |
| ATOM | 3330 | OE1 | GLN | B | 7 | 38.573 | 45.988 | 86.803 | 1.00 | 61.77 | | | O |
| ANISOU | 3330 | OE1 | GLN | B | 7 | 6983 | 9210 | 7276 | -468 | 2296 | 145 | | O |
| ATOM | 3331 | NE2 | GLN | B | 7 | 38.559 | 44.455 | 85.132 | 1.00 | 60.60 | | | N |
| ANISOU | 3331 | NE2 | GLN | B | 7 | 7035 | 9140 | 6850 | -242 | 2499 | 149 | | N |
| ATOM | 3334 | C | GLN | B | 7 | 36.806 | 43.649 | 91.131 | 1.00 | 45.96 | | | C |
| ANISOU | 3334 | C | GLN | B | 7 | 4982 | 7126 | 5355 | -65 | 1614 | -135 | | C |
| ATOM | 3335 | O | GLN | B | 7 | 37.775 | 43.527 | 91.855 | 1.00 | 46.60 | | | O |
| ANISOU | 3335 | O | GLN | B | 7 | 4828 | 7358 | 5520 | -41 | 1592 | -173 | | O |
| ATOM | 3337 | N | CYS | B | 8 | 35.671 | 44.178 | 91.562 | 1.00 | 43.23 | | | N |
| ANISOU | 3337 | N | CYS | B | 8 | 4785 | 6636 | 5005 | -136 | 1491 | -133 | | N |
| ATOM | 3338 | CA | CYS | B | 8 | 35.619 | 44.884 | 92.838 | 1.00 | 43.38 | | | C |
| ANISOU | 3338 | CA | CYS | B | 8 | 4702 | 6655 | 5124 | -231 | 1355 | -190 | | C |
| ATOM | 3340 | CB | CYS | B | 8 | 35.080 | 46.299 | 92.585 | 1.00 | 45.86 | | | C |
| ANISOU | 3340 | CB | CYS | B | 8 | 5107 | 6822 | 5497 | -422 | 1372 | -157 | | C |
| ATOM | 3343 | SG | CYS | B | 8 | 36.218 | 47.318 | 91.523 | 1.00 | 54.05 | | | S |
| ANISOU | 3343 | SG | CYS | B | 8 | 6025 | 7900 | 6610 | -604 | 1573 | -93 | | S |
| ATOM | 3345 | C | CYS | B | 8 | 34.915 | 44.201 | 94.029 | 1.00 | 39.48 | | | C |
| ANISOU | 3345 | C | CYS | B | 8 | 4254 | 6147 | 4601 | -120 | 1185 | -240 | | C |
| ATOM | 3346 | O | CYS | B | 8 | 35.067 | 44.633 | 95.152 | 1.00 | 39.97 | | | O |
| ANISOU | 3346 | O | CYS | B | 8 | 4207 | 6258 | 4722 | -180 | 1079 | -302 | | O |
| ATOM | 3348 | N | PHE | B | 9 | 34.168 | 43.133 | 93.793 | 1.00 | 36.84 | | | N |
| ANISOU | 3348 | N | PHE | B | 9 | 4080 | 5750 | 4166 | 29 | 1164 | -218 | | N |
| ATOM | 3349 | CA | PHE | B | 9 | 33.641 | 42.271 | 94.879 | 1.00 | 33.08 | | | C |
| ANISOU | 3349 | CA | PHE | B | 9 | 3636 | 5274 | 3657 | 151 | 1029 | -247 | | C |
| ATOM | 3351 | CB | PHE | B | 9 | 32.158 | 41.998 | 94.695 | 1.00 | 28.59 | | | C |
| ANISOU | 3351 | CB | PHE | B | 9 | 3304 | 4548 | 3012 | 168 | 975 | -222 | | C |
| ATOM | 3354 | CG | PHE | B | 9 | 31.301 | 43.209 | 94.868 | 1.00 | 28.22 | | | C |
| ANISOU | 3354 | CG | PHE | B | 9 | 3322 | 4401 | 3001 | 28 | 925 | -217 | | C |
| ATOM | 3355 | CD1 | PHE | B | 9 | 30.925 | 43.619 | 96.134 | 1.00 | 28.05 | | | C |
| ANISOU | 3355 | CD1 | PHE | B | 9 | 3261 | 4378 | 3018 | -4 | 812 | -267 | | C |
| ATOM | 3357 | CE1 | PHE | B | 9 | 30.099 | 44.794 | 96.310 | 1.00 | 27.48 | | | C |
| ANISOU | 3357 | CE1 | PHE | B | 9 | 3258 | 4190 | 2994 | -117 | 787 | -272 | | C |
| ATOM | 3359 | CZ | PHE | B | 9 | 29.713 | 45.518 | 95.217 | 1.00 | 25.04 | | | C |
| ANISOU | 3359 | CZ | PHE | B | 9 | 3043 | 3773 | 2698 | -187 | 865 | -202 | | C |
| ATOM | 3361 | CE2 | PHE | B | 9 | 30.126 | 45.118 | 93.929 | 1.00 | 28.18 | | | C |
| ANISOU | 3361 | CE2 | PHE | B | 9 | 3474 | 4193 | 3039 | -166 | 967 | -137 | | C |
| ATOM | 3363 | CD2 | PHE | B | 9 | 30.918 | 43.980 | 93.763 | 1.00 | 27.30 | | | C |
| ANISOU | 3363 | CD2 | PHE | B | 9 | 3303 | 4193 | 2876 | -64 | 1003 | -157 | | C |
| ATOM | 3365 | C | PHE | B | 9 | 34.383 | 40.930 | 94.845 | 1.00 | 32.66 | | | C |
| ANISOU | 3365 | C | PHE | B | 9 | 3519 | 5315 | 3577 | 343 | 1072 | -240 | | C |
| ATOM | 3366 | O | PHE | B | 9 | 34.707 | 40.447 | 93.789 | 1.00 | 32.02 | | | O |
| ANISOU | 3366 | O | PHE | B | 9 | 3484 | 5225 | 3459 | 403 | 1202 | -221 | | O |
| ATOM | 3368 | N | ASN | B | 10 | 34.626 | 40.341 | 96.006 | 1.00 | 33.06 | | | N |
| ANISOU | 3368 | N | ASN | B | 10 | 3472 | 5451 | 3639 | 446 | 967 | -252 | | N |
| ATOM | 3369 | CA | ASN | B | 10 | 35.328 | 39.084 | 96.084 | 1.00 | 35.34 | | | C |
| ANISOU | 3369 | CA | ASN | B | 10 | 3696 | 5813 | 3919 | 655 | 1006 | -225 | | C |
| ATOM | 3371 | CB | ASN | B | 10 | 35.822 | 38.836 | 97.517 | 1.00 | 38.44 | | | C |
| ANISOU | 3371 | CB | ASN | B | 10 | 3911 | 6359 | 4335 | 731 | 869 | -219 | | C |
| ATOM | 3374 | CG | ASN | B | 10 | 34.775 | 38.280 | 98.415 | 1.00 | 38.01 | | | C |
| ANISOU | 3374 | CG | ASN | B | 10 | 4010 | 6215 | 4218 | 789 | 748 | -200 | | C |
| ATOM | 3375 | OD1 | ASN | B | 10 | 34.098 | 37.315 | 98.066 | 1.00 | 40.91 | | | O |
| ANISOU | 3375 | OD1 | ASN | B | 10 | 4569 | 6435 | 4540 | 894 | 784 | -168 | | O |
| ATOM | 3376 | ND2 | ASN | B | 10 | 34.641 | 38.853 | 99.598 | 1.00 | 40.92 | | | N |
| ANISOU | 3376 | ND2 | ASN | B | 10 | 4296 | 6674 | 4577 | 712 | 610 | -226 | | N |
| ATOM | 3379 | C | ASN | B | 10 | 34.527 | 37.903 | 95.443 | 1.00 | 34.34 | | | C |
| ANISOU | 3379 | C | ASN | B | 10 | 3818 | 5516 | 3714 | 782 | 1061 | -206 | | C |
| ATOM | 3380 | O | ASN | B | 10 | 33.291 | 37.967 | 95.329 | 1.00 | 29.30 | | | O |
| ANISOU | 3380 | O | ASN | B | 10 | 3380 | 4734 | 3020 | 711 | 1011 | -209 | | O |

FIG. 18 (continued)

```
ATOM   3382  N   PRO B  11      35.239  36.878  94.946  1.00 34.64          N
ANISOU 3382  N   PRO B  11    3841   5570   3753    958   1177   -194       N
ATOM   3383  CA  PRO B  11      34.588  35.873  94.086  1.00 34.58          C
ANISOU 3383  CA  PRO B  11    4084   5386   3669   1039   1265   -207       C
ATOM   3385  CB  PRO B  11      35.728  34.898  93.726  1.00 36.61          C
ANISOU 3385  CB  PRO B  11    4256   5693   3960   1255   1410   -203       C
ATOM   3388  CG  PRO B  11      36.987  35.612  94.040  1.00 39.44          C
ANISOU 3388  CG  PRO B  11    4300   6279   4405   1248   1423   -182       C
ATOM   3391  CD  PRO B  11      36.678  36.602  95.127  1.00 38.15          C
ANISOU 3391  CD  PRO B  11    4032   6195   4269   1092   1240   -173       C
ATOM   3394  C   PRO B  11      33.395  35.119  94.720  1.00 31.75          C
ANISOU 3394  C   PRO B  11    3923   4875   3266   1071   1156   -195       C
ATOM   3395  O   PRO B  11      32.458  34.773  93.990  1.00 28.80          O
ANISOU 3395  O   PRO B  11    3774   4351   2818   1018   1184   -223       O
ATOM   3396  N   MET B  12      33.379  34.922  96.035  1.00 31.80          N
ANISOU 3396  N   MET B  12    3846   4932   3306   1133   1031   -151       N
ATOM   3397  CA  MET B  12      32.244  34.226  96.628  1.00 33.60          C
ANISOU 3397  CA  MET B  12    4256   5019   3491   1149    947   -127       C
ATOM   3399  CB  MET B  12      32.514  33.623  98.013  1.00 39.81          C
ANISOU 3399  CB  MET B  12    4954   5870   4300   1289    852    -53       C
ATOM   3402  CG  MET B  12      32.544  34.559  99.206  1.00 42.14          C
ANISOU 3402  CG  MET B  12    5086   6331   4595   1202    705    -42       C
ATOM   3405  SD  MET B  12      34.218  35.131  99.294  1.00 52.60          S
ANISOU 3405  SD  MET B  12    6093   7905   5987   1247    723    -48       S
ATOM   3406  CE  MET B  12      34.264  36.022 100.867  1.00 49.81          C
ANISOU 3406  CE  MET B  12    5568   7751   5608   1147    531    -54       C
ATOM   3410  C   MET B  12      30.990  35.071  96.646  1.00 29.79          C
ANISOU 3410  C   MET B  12    3875   4478   2965    952    860   -148       C
ATOM   3411  O   MET B  12      29.907  34.530  96.495  1.00 25.54          O
ANISOU 3411  O   MET B  12    3526   3799   2378    921    841   -147       O
ATOM   3413  N   ILE B  13      31.154  36.390  96.829  1.00 28.15          N
ANISOU 3413  N   ILE B  13    3534   4376   2785    820    814   -167       N
ATOM   3414  CA  ILE B  13      30.055  37.330  96.794  1.00 27.44          C
ANISOU 3414  CA  ILE B  13    3522   4230   2675    655    751   -180       C
ATOM   3416  CB  ILE B  13      30.480  38.801  97.144  1.00 27.48          C
ANISOU 3416  CB  ILE B  13    3366   4337   2737    527    717   -208       C
ATOM   3418  CG1 ILE B  13      31.003  38.905  98.591  1.00 29.24          C
ANISOU 3418  CG1 ILE B  13    3430   4695   2986    561    617   -220       C
ATOM   3421  CD1 ILE B  13      30.032  38.569  99.626  1.00 29.19          C
ANISOU 3421  CD1 ILE B  13    3506   4653   2932    582    515   -204       C
ATOM   3425  CG2 ILE B  13      29.323  39.796  96.867  1.00 25.15          C
ANISOU 3425  CG2 ILE B  13    3174   3947   2436    381    687   -211       C
ATOM   3429  C   ILE B  13      29.457  37.304  95.406  1.00 24.23          C
ANISOU 3429  C   ILE B  13    3277   3715   2213    589    829   -189       C
ATOM   3430  O   ILE B  13      28.243  37.238  95.266  1.00 22.87          O
ANISOU 3430  O   ILE B  13    3246   3450   1994    524    779   -179       O
ATOM   3432  N   VAL B  14      30.316  37.383  94.402  1.00 26.14          N
ANISOU 3432  N   VAL B  14    3485   3995   2453    601    948   -204       N
ATOM   3433  CA  VAL B  14      29.891  37.398  93.011  1.00 26.67          C
ANISOU 3433  CA  VAL B  14    3702   3995   2438    537   1030   -212       C
ATOM   3435  CB  VAL B  14      31.100  37.672  92.063  1.00 28.89          C
ANISOU 3435  CB  VAL B  14    3894   4361   2721    551   1181   -223       C
ATOM   3437  CG1 VAL B  14      30.706  37.478  90.624  1.00 28.17          C
ANISOU 3437  CG1 VAL B  14    3980   4217   2508    505   1274   -237       C
ATOM   3441  CG2 VAL B  14      31.639  39.109  92.329  1.00 27.45          C
ANISOU 3441  CG2 VAL B  14    3532   4274   2623    435   1170   -197       C
ATOM   3445  C   VAL B  14      29.148  36.116  92.618  1.00 26.80          C
ANISOU 3445  C   VAL B  14    3923   3888   2372    591   1040   -238       C
ATOM   3446  O   VAL B  14      28.138  36.154  91.892  1.00 25.35          O
ANISOU 3446  O   VAL B  14    3890   3640   2101    492   1017   -242       O
ATOM   3448  N   GLU B  15      29.667  34.994  93.096  1.00 28.12          N
ANISOU 3448  N   GLU B  15    4090   4025   2568    743   1073   -252       N
ATOM   3449  CA  GLU B  15      29.098  33.685  92.858  1.00 31.11          C
ANISOU 3449  CA  GLU B  15    4669   4257   2896    799   1099   -284       C
ATOM   3451  CB  GLU B  15      30.059  32.650  93.465  1.00 34.20          C
ANISOU 3451  CB  GLU B  15    5007   4629   3358   1008   1162   -273       C
ATOM   3454  CG  GLU B  15      29.699  31.204  93.369  1.00 36.94          C
ANISOU 3454  CG  GLU B  15    5557   4790   3689   1099   1215   -301       C
ATOM   3457  CD  GLU B  15      30.731  30.332  94.062  1.00 39.17          C
ANISOU 3457  CD  GLU B  15    5758   5063   4062   1337   1276   -254       C
ATOM   3458  OE1 GLU B  15      31.943  30.529  93.807  1.00 40.20          O
ANISOU 3458  OE1 GLU B  15    5728   5311   4234   1451   1369   -254       O
ATOM   3459  OE2 GLU B  15      30.314  29.454  94.839  1.00 42.53          O
ANISOU 3459  OE2 GLU B  15    6275   5369   4517   1409   1236   -205       O
ATOM   3460  C   GLU B  15      27.689  33.569  93.473  1.00 28.14          C
ANISOU 3460  C   GLU B  15    4394   3800   2500    703    965   -259       C
ATOM   3461  O   GLU B  15      26.787  33.006  92.883  1.00 28.24          O
ANISOU 3461  O   GLU B  15    4583   3707   2439    629    962   -293       O
ATOM   3463  N   LEU B  16      27.526  34.072  94.684  1.00 27.06          N
```

FIG. 18 (continued)

| | | | | | | | | | | | | | |
|---|---|---|---|---|---|---|---|---|---|---|---|---|---|
| ANISOU | 3463 | N | LEU | B | 16 | 4135 | 3723 | 2422 | 700 | 861 | -205 | | N |
| ATOM | 3464 | CA | LEU | B | 16 | 26.236 | 34.026 | 95.390 | 1.00 | 26.08 | | | C |
| ANISOU | 3464 | CA | LEU | B | 16 | 4076 | 3547 | 2286 | 620 | 749 | -173 | | C |
| ATOM | 3466 | CB | LEU | B | 16 | 26.394 | 34.430 | 96.856 | 1.00 | 25.85 | | | C |
| ANISOU | 3466 | CB | LEU | B | 16 | 3903 | 3605 | 2313 | 662 | 664 | -124 | | C |
| ATOM | 3469 | CG | LEU | B | 16 | 27.145 | 33.443 | 97.753 | 1.00 | 27.01 | | | C |
| ANISOU | 3469 | CG | LEU | B | 16 | 4015 | 3755 | 2491 | 830 | 675 | -83 | | C |
| ATOM | 3471 | CD1 | LEU | B | 16 | 27.489 | 34.066 | 99.121 | 1.00 | 26.92 | | | C |
| ANISOU | 3471 | CD1 | LEU | B | 16 | 3834 | 3892 | 2503 | 856 | 582 | -45 | | C |
| ATOM | 3475 | CD2 | LEU | B | 16 | 26.331 | 32.155 | 97.958 | 1.00 | 27.65 | | | C |
| ANISOU | 3475 | CD2 | LEU | B | 16 | 4277 | 3677 | 2552 | 856 | 680 | -51 | | C |
| ATOM | 3479 | C | LEU | B | 16 | 25.224 | 34.929 | 94.735 | 1.00 | 25.26 | | | C |
| ANISOU | 3479 | C | LEU | B | 16 | 4009 | 3453 | 2135 | 459 | 700 | -174 | | C |
| ATOM | 3480 | O | LEU | B | 16 | 24.072 | 34.569 | 94.631 | 1.00 | 24.70 | | | O |
| ANISOU | 3480 | O | LEU | B | 16 | 4045 | 3317 | 2022 | 380 | 649 | -168 | | O |
| ATOM | 3482 | N | ALA | B | 17 | 25.667 | 36.101 | 94.260 | 1.00 | 24.30 | | | N |
| ANISOU | 3482 | N | ALA | B | 17 | 3793 | 3416 | 2026 | 411 | 720 | -172 | | N |
| ATOM | 3483 | CA | ALA | B | 17 | 24.825 | 37.011 | 93.474 | 1.00 | 22.70 | | | C |
| ANISOU | 3483 | CA | ALA | B | 17 | 3626 | 3221 | 1778 | 284 | 688 | -148 | | C |
| ATOM | 3485 | CB | ALA | B | 17 | 25.574 | 38.297 | 93.204 | 1.00 | 20.87 | | | C |
| ANISOU | 3485 | CB | ALA | B | 17 | 3276 | 3061 | 1592 | 253 | 730 | -129 | | C |
| ATOM | 3489 | C | ALA | B | 17 | 24.357 | 36.403 | 92.171 | 1.00 | 25.31 | | | C |
| ANISOU | 3489 | C | ALA | B | 17 | 4116 | 3507 | 1992 | 231 | 723 | -174 | | C |
| ATOM | 3490 | O | ALA | B | 17 | 23.205 | 36.543 | 91.805 | 1.00 | 25.44 | | | O |
| ANISOU | 3490 | O | ALA | B | 17 | 4200 | 3515 | 1952 | 135 | 651 | -148 | | O |
| ATOM | 3492 | N | GLU | B | 18 | 25.256 | 35.750 | 91.446 | 1.00 | 26.71 | | | N |
| ANISOU | 3492 | N | GLU | B | 18 | 4349 | 3674 | 2127 | 291 | 836 | -229 | | N |
| ATOM | 3493 | CA | GLU | B | 18 | 24.860 | 35.063 | 90.225 | 1.00 | 28.33 | | | C |
| ANISOU | 3493 | CA | GLU | B | 18 | 4730 | 3837 | 2198 | 236 | 879 | -284 | | C |
| ATOM | 3495 | CB | GLU | B | 18 | 26.090 | 34.473 | 89.515 | 1.00 | 30.71 | | | C |
| ANISOU | 3495 | CB | GLU | B | 18 | 5069 | 4134 | 2467 | 334 | 1040 | -354 | | C |
| ATOM | 3498 | CG | GLU | B | 18 | 26.982 | 35.534 | 88.920 | 1.00 | 33.41 | | | C |
| ANISOU | 3498 | CG | GLU | B | 18 | 5298 | 4592 | 2806 | 329 | 1121 | -319 | | C |
| ATOM | 3501 | CD | GLU | B | 18 | 28.150 | 34.971 | 88.100 | 1.00 | 37.31 | | | C |
| ANISOU | 3501 | CD | GLU | B | 18 | 5821 | 5103 | 3252 | 423 | 1302 | -388 | | C |
| ATOM | 3502 | OE1 | GLU | B | 18 | 29.145 | 34.446 | 88.670 | 1.00 | 42.58 | | | O |
| ANISOU | 3502 | OE1 | GLU | B | 18 | 6397 | 5764 | 4019 | 570 | 1379 | -410 | | O |
| ATOM | 3503 | OE2 | GLU | B | 18 | 28.034 | 35.042 | 86.873 | 1.00 | 41.56 | | | O |
| ANISOU | 3503 | OE2 | GLU | B | 18 | 6472 | 5673 | 3645 | 355 | 1369 | -417 | | O |
| ATOM | 3504 | C | GLU | B | 18 | 23.799 | 33.990 | 90.497 | 1.00 | 27.83 | | | C |
| ANISOU | 3504 | C | GLU | B | 18 | 4801 | 3669 | 2105 | 191 | 810 | -318 | | C |
| ATOM | 3505 | O | GLU | B | 18 | 22.815 | 33.879 | 89.752 | 1.00 | 26.05 | | | O |
| ANISOU | 3505 | O | GLU | B | 18 | 4681 | 3445 | 1772 | 66 | 754 | -334 | | O |
| ATOM | 3507 | N | LYS | B | 19 | 23.994 | 33.233 | 91.568 | 1.00 | 30.12 | | | N |
| ANISOU | 3507 | N | LYS | B | 19 | 5077 | 3881 | 2485 | 284 | 809 | -318 | | N |
| ATOM | 3508 | CA | LYS | B | 19 | 23.063 | 32.171 | 91.979 | 1.00 | 32.75 | | | C |
| ANISOU | 3508 | CA | LYS | B | 19 | 5534 | 4096 | 2815 | 239 | 762 | -336 | | C |
| ATOM | 3510 | CB | LYS | B | 19 | 23.664 | 31.317 | 93.109 | 1.00 | 34.77 | | | C |
| ANISOU | 3510 | CB | LYS | B | 19 | 5776 | 4264 | 3172 | 389 | 800 | -313 | | C |
| ATOM | 3513 | CG | LYS | B | 19 | 22.661 | 30.498 | 93.921 | 1.00 | 36.61 | | | C |
| ANISOU | 3513 | CG | LYS | B | 19 | 6089 | 4389 | 3432 | 338 | 739 | -282 | | C |
| ATOM | 3516 | CD | LYS | B | 19 | 23.353 | 29.669 | 95.023 | 1.00 | 39.72 | | | C |
| ANISOU | 3516 | CD | LYS | B | 19 | 6474 | 4701 | 3915 | 509 | 784 | -229 | | C |
| ATOM | 3519 | CE | LYS | B | 19 | 22.500 | 29.474 | 96.305 | 1.00 | 39.85 | | | C |
| ANISOU | 3519 | CE | LYS | B | 19 | 6467 | 4703 | 3971 | 476 | 700 | -136 | | C |
| ATOM | 3522 | NZ | LYS | B | 19 | 23.108 | 30.230 | 97.483 | 1.00 | 40.11 | | | N |
| ANISOU | 3522 | NZ | LYS | B | 19 | 6308 | 4882 | 4049 | 587 | 651 | -54 | | N |
| ATOM | 3526 | C | LYS | B | 19 | 21.704 | 32.745 | 92.373 | 1.00 | 30.26 | | | C |
| ANISOU | 3526 | C | LYS | B | 19 | 5172 | 3828 | 2496 | 107 | 625 | -273 | | C |
| ATOM | 3527 | O | LYS | B | 19 | 20.703 | 32.174 | 92.016 | 1.00 | 30.79 | | | O |
| ANISOU | 3527 | O | LYS | B | 19 | 5347 | 3848 | 2504 | -12 | 578 | -300 | | O |
| ATOM | 3529 | N | ALA | B | 20 | 21.673 | 33.865 | 93.092 | 1.00 | 28.47 | | | N |
| ANISOU | 3529 | N | ALA | B | 20 | 4785 | 3698 | 2336 | 125 | 568 | -198 | | N |
| ATOM | 3530 | CA | ALA | B | 20 | 20.406 | 34.544 | 93.429 | 1.00 | 26.68 | | | C |
| ANISOU | 3530 | CA | ALA | B | 20 | 4497 | 3525 | 2115 | 26 | 458 | -136 | | C |
| ATOM | 3532 | CB | ALA | B | 20 | 20.629 | 35.736 | 94.379 | 1.00 | 25.75 | | | C |
| ANISOU | 3532 | CB | ALA | B | 20 | 4216 | 3482 | 2088 | 79 | 431 | -79 | | C |
| ATOM | 3536 | C | ALA | B | 20 | 19.664 | 34.987 | 92.152 | 1.00 | 26.58 | | | C |
| ANISOU | 3536 | C | ALA | B | 20 | 4529 | 3570 | 1999 | -95 | 415 | -130 | | C |
| ATOM | 3537 | O | ALA | B | 20 | 18.484 | 34.703 | 91.991 | 1.00 | 24.40 | | | O |
| ANISOU | 3537 | O | ALA | B | 20 | 4285 | 3304 | 1680 | -203 | 336 | -116 | | O |
| ATOM | 3539 | N | MET | B | 21 | 20.375 | 35.627 | 91.218 | 1.00 | 27.49 | | | N |
| ANISOU | 3539 | N | MET | B | 21 | 4642 | 3737 | 2064 | -81 | 468 | -134 | | N |
| ATOM | 3540 | CA | MET | B | 21 | 19.752 | 36.094 | 89.995 | 1.00 | 29.79 | | | C |
| ANISOU | 3540 | CA | MET | B | 21 | 4977 | 4106 | 2236 | -182 | 426 | -105 | | C |
| ATOM | 3542 | CB | MET | B | 21 | 20.749 | 36.872 | 89.115 | 1.00 | 30.08 | | | C |
| ANISOU | 3542 | CB | MET | B | 21 | 5004 | 4196 | 2228 | -147 | 513 | -89 | | C |
| ATOM | 3545 | CG | MET | B | 21 | 21.017 | 38.237 | 89.737 | 1.00 | 29.83 | | | C |
| ANISOU | 3545 | CG | MET | B | 21 | 4820 | 4193 | 2321 | -100 | 510 | 2 | | C |

FIG. 18 (continued)

| | | | | | | | | | | | | |
|---|---|---|---|---|---|---|---|---|---|---|---|---|
| ATOM | 3548 | SD | MET | B | 21 | 21.889 | 39.420 | 88.725 | 1.00 | 30.90 | | S |
| ANISOU | 3548 | SD | MET | B | 21 | 4930 | 4388 | 2424 | -102 | 600 | 66 | S |
| ATOM | 3549 | CE | MET | B | 21 | 20.530 | 40.208 | 87.807 | 1.00 | 28.12 | | C |
| ANISOU | 3549 | CE | MET | B | 21 | 4604 | 4111 | 1968 | -189 | 491 | 198 | C |
| ATOM | 3553 | C | MET | B | 21 | 19.112 | 34.930 | 89.221 | 1.00 | 29.38 | | C |
| ANISOU | 3553 | C | MET | B | 21 | 5083 | 4027 | 2053 | -289 | 400 | -187 | C |
| ATOM | 3554 | O | MET | B | 21 | 18.001 | 35.077 | 88.709 | 1.00 | 29.49 | | O |
| ANISOU | 3554 | O | MET | B | 21 | 5103 | 4118 | 1985 | -406 | 296 | -151 | O |
| ATOM | 3556 | N | LYS | B | 22 | 19.832 | 33.806 | 89.161 | 1.00 | 28.41 | | N |
| ANISOU | 3556 | N | LYS | B | 22 | 5081 | 3797 | 1917 | -247 | 497 | -295 | N |
| ATOM | 3557 | CA | LYS | B | 22 | 19.403 | 32.585 | 88.492 | 1.00 | 33.43 | | C |
| ANISOU | 3557 | CA | LYS | B | 22 | 5899 | 4360 | 2444 | -348 | 504 | -409 | C |
| ATOM | 3559 | CB | LYS | B | 22 | 20.562 | 31.574 | 88.519 | 1.00 | 36.47 | | C |
| ANISOU | 3559 | CB | LYS | B | 22 | 6398 | 4602 | 2856 | -230 | 659 | -515 | C |
| ATOM | 3562 | CG | LYS | B | 22 | 20.479 | 30.431 | 87.527 | 1.00 | 41.20 | | C |
| ANISOU | 3562 | CG | LYS | B | 22 | 7223 | 5109 | 3323 | -314 | 721 | -669 | C |
| ATOM | 3565 | CD | LYS | B | 22 | 21.222 | 29.178 | 88.078 | 1.00 | 42.96 | | C |
| ANISOU | 3565 | CD | LYS | B | 22 | 7559 | 5120 | 3646 | -187 | 854 | -748 | C |
| ATOM | 3568 | CE | LYS | B | 22 | 21.658 | 28.206 | 86.996 | 1.00 | 45.33 | | C |
| ANISOU | 3568 | CE | LYS | B | 22 | 8084 | 5311 | 3829 | -199 | 988 | -922 | C |
| ATOM | 3571 | NZ | LYS | B | 22 | 22.959 | 27.517 | 87.351 | 1.00 | 47.57 | | N |
| ANISOU | 3571 | NZ | LYS | B | 22 | 8403 | 5449 | 4222 | 29 | 1168 | -959 | N |
| ATOM | 3575 | C | LYS | B | 22 | 18.159 | 31.975 | 89.160 | 1.00 | 31.96 | | C |
| ANISOU | 3575 | C | LYS | B | 22 | 5719 | 4127 | 2298 | -460 | 400 | -398 | C |
| ATOM | 3576 | O | LYS | B | 22 | 17.194 | 31.606 | 88.496 | 1.00 | 33.06 | | O |
| ANISOU | 3576 | O | LYS | B | 22 | 5930 | 4303 | 2329 | -625 | 320 | -439 | O |
| ATOM | 3578 | N | GLU | B | 23 | 18.202 | 31.866 | 90.477 | 1.00 | 31.02 | | N |
| ANISOU | 3578 | N | GLU | B | 23 | 5519 | 3942 | 2325 | -378 | 403 | -343 | N |
| ATOM | 3579 | CA | GLU | B | 23 | 17.102 | 31.345 | 91.280 | 1.00 | 33.52 | | C |
| ANISOU | 3579 | CA | GLU | B | 23 | 5820 | 4218 | 2696 | -469 | 328 | -311 | C |
| ATOM | 3581 | CB | GLU | B | 23 | 17.454 | 31.384 | 92.785 | 1.00 | 33.98 | | C |
| ANISOU | 3581 | CB | GLU | B | 23 | 5784 | 4229 | 2899 | -337 | 356 | -236 | C |
| ATOM | 3584 | CG | GLU | B | 23 | 18.302 | 30.253 | 93.299 | 1.00 | 37.63 | | C |
| ANISOU | 3584 | CG | GLU | B | 23 | 6359 | 4522 | 3416 | -230 | 461 | -277 | C |
| ATOM | 3587 | CD | GLU | B | 23 | 18.011 | 29.938 | 94.768 | 1.00 | 36.25 | | C |
| ANISOU | 3587 | CD | GLU | B | 23 | 6128 | 4304 | 3340 | -182 | 448 | -189 | C |
| ATOM | 3588 | OE1 | GLU | B | 23 | 17.891 | 30.865 | 95.593 | 1.00 | 37.22 | | O |
| ANISOU | 3588 | OE1 | GLU | B | 23 | 6091 | 4543 | 3507 | -134 | 400 | -109 | O |
| ATOM | 3589 | OE2 | GLU | B | 23 | 17.886 | 28.747 | 95.092 | 1.00 | 41.74 | | O |
| ANISOU | 3589 | OE2 | GLU | B | 23 | 6953 | 4842 | 4064 | -198 | 495 | -202 | O |
| ATOM | 3590 | C | GLU | B | 23 | 15.828 | 32.167 | 91.158 | 1.00 | 32.37 | | C |
| ANISOU | 3590 | C | GLU | B | 23 | 5547 | 4228 | 2523 | -587 | 193 | -227 | C |
| ATOM | 3591 | O | GLU | B | 23 | 14.753 | 31.674 | 91.504 | 1.00 | 31.41 | | O |
| ANISOU | 3591 | O | GLU | B | 23 | 5415 | 4104 | 2416 | -709 | 126 | -213 | O |
| ATOM | 3593 | N | TYR | B | 24 | 15.949 | 33.430 | 90.750 | 1.00 | 30.92 | | N |
| ANISOU | 3593 | N | TYR | B | 24 | 5256 | 4175 | 2319 | -541 | 162 | -157 | N |
| ATOM | 3594 | CA | TYR | B | 24 | 14.799 | 34.330 | 90.750 | 1.00 | 30.96 | | C |
| ANISOU | 3594 | CA | TYR | B | 24 | 5116 | 4320 | 2326 | -601 | 45 | -50 | C |
| ATOM | 3596 | CB | TYR | B | 24 | 15.048 | 35.537 | 91.694 | 1.00 | 28.69 | | C |
| ANISOU | 3596 | CB | TYR | B | 24 | 4672 | 4060 | 2168 | -462 | 62 | 46 | C |
| ATOM | 3599 | CG | TYR | B | 24 | 14.882 | 35.230 | 93.157 | 1.00 | 27.95 | | C |
| ANISOU | 3599 | CG | TYR | B | 24 | 4519 | 3906 | 2193 | -414 | 82 | 59 | C |
| ATOM | 3600 | CD1 | TYR | B | 24 | 13.609 | 35.203 | 93.749 | 1.00 | 29.90 | | C |
| ANISOU | 3600 | CD1 | TYR | B | 24 | 4673 | 4209 | 2478 | -482 | 14 | 119 | C |
| ATOM | 3602 | CE1 | TYR | B | 24 | 13.448 | 34.924 | 95.085 | 1.00 | 28.57 | | C |
| ANISOU | 3602 | CE1 | TYR | B | 24 | 4458 | 4000 | 2396 | -440 | 45 | 137 | C |
| ATOM | 3604 | CZ | TYR | B | 24 | 14.566 | 34.630 | 95.855 | 1.00 | 27.36 | | C |
| ANISOU | 3604 | CZ | TYR | B | 24 | 4355 | 3757 | 2285 | -328 | 126 | 101 | C |
| ATOM | 3605 | OH | TYR | B | 24 | 14.451 | 34.383 | 97.162 | 1.00 | 26.40 | | O |
| ANISOU | 3605 | OH | TYR | B | 24 | 4194 | 3617 | 2220 | -282 | 152 | 131 | O |
| ATOM | 3607 | CE2 | TYR | B | 24 | 15.840 | 34.660 | 95.305 | 1.00 | 27.94 | | C |
| ANISOU | 3607 | CE2 | TYR | B | 24 | 4500 | 3783 | 2334 | -253 | 182 | 45 | C |
| ATOM | 3609 | CD2 | TYR | B | 24 | 15.981 | 34.937 | 93.956 | 1.00 | 27.00 | | C |
| ANISOU | 3609 | CD2 | TYR | B | 24 | 4427 | 3695 | 2135 | -300 | 169 | 21 | C |
| ATOM | 3611 | C | TYR | B | 24 | 14.393 | 34.738 | 89.338 | 1.00 | 33.00 | | C |
| ANISOU | 3611 | C | TYR | B | 24 | 5398 | 4710 | 2430 | -693 | -27 | -35 | C |
| ATOM | 3612 | O | TYR | B | 24 | 13.526 | 35.603 | 89.142 | 1.00 | 35.84 | | O |
| ANISOU | 3612 | O | TYR | B | 24 | 5632 | 5204 | 2781 | -716 | -125 | 77 | O |
| ATOM | 3614 | N | GLY | B | 25 | 14.990 | 34.088 | 88.341 | 1.00 | 33.77 | | N |
| ANISOU | 3614 | N | GLY | B | 25 | 5660 | 4776 | 2395 | -740 | 23 | -144 | N |
| ATOM | 3615 | CA | GLY | B | 25 | 14.696 | 34.383 | 86.967 | 1.00 | 35.16 | | C |
| ANISOU | 3615 | CA | GLY | B | 25 | 5882 | 5091 | 2385 | -833 | -39 | -139 | C |
| ATOM | 3618 | C | GLY | B | 25 | 15.161 | 35.723 | 86.419 | 1.00 | 35.00 | | C |
| ANISOU | 3618 | C | GLY | B | 25 | 5791 | 5172 | 2336 | -737 | -25 | -21 | C |
| ATOM | 3619 | O | GLY | B | 25 | 14.664 | 36.158 | 85.377 | 1.00 | 36.80 | | O |
| ANISOU | 3619 | O | GLY | B | 25 | 6021 | 5552 | 2410 | -808 | -107 | 40 | O |
| ATOM | 3621 | N | AGLU | B | 26 | 16.129 | 36.354 | 87.086 | 0.30 | 33.17 | | N |
| ANISOU | 3621 | N | AGLU | B | 26 | 5500 | 4861 | 2241 | -587 | 79 | 15 | N |
| ATOM | 3622 | N | BGLU | B | 26 | 16.126 | 36.363 | 87.071 | 0.70 | 32.54 | | N |

FIG. 18 (continued)

| | | | | | | | | | | | | | |
|---|---|---|---|---|---|---|---|---|---|---|---|---|---|
| ANISOU | 3622 | N | BGLU | B | 26 | 5421 | 4783 | 2160 | -588 | 78 | 16 | | N |
| ATOM | 3623 | CA | AGLU | B | 26 | 16.717 | 37.623 | 86.620 | 0.30 | 33.22 | | | C |
| ANISOU | 3623 | CA | AGLU | B | 26 | 5452 | 4926 | 2245 | -507 | 122 | 122 | | C |
| ATOM | 3624 | CA | BGLU | B | 26 | 16.666 | 37.642 | 86.568 | 0.70 | 32.82 | | | C |
| ANISOU | 3624 | CA | BGLU | B | 26 | 5401 | 4882 | 2187 | -512 | 116 | 126 | | C |
| ATOM | 3627 | CB | AGLU | B | 26 | 17.238 | 38.438 | 87.809 | 0.30 | 31.33 | | | C |
| ANISOU | 3627 | CB | AGLU | B | 26 | 5085 | 4605 | 2212 | -381 | 178 | 176 | | C |
| ATOM | 3628 | CB | BGLU | B | 26 | 16.975 | 38.584 | 87.732 | 0.70 | 31.72 | | | C |
| ANISOU | 3628 | CB | BGLU | B | 26 | 5121 | 4678 | 2254 | -392 | 152 | 202 | | C |
| ATOM | 3633 | CG | AGLU | B | 26 | 16.240 | 38.660 | 88.944 | 0.30 | 30.62 | | | C |
| ANISOU | 3633 | CG | AGLU | B | 26 | 4872 | 4506 | 2255 | -369 | 95 | 230 | | C |
| ATOM | 3634 | CG | BGLU | B | 26 | 15.893 | 38.642 | 88.802 | 0.70 | 32.48 | | | C |
| ANISOU | 3634 | CG | BGLU | B | 26 | 5103 | 4770 | 2468 | -393 | 62 | 247 | | C |
| ATOM | 3639 | CD | AGLU | B | 26 | 15.230 | 39.751 | 88.655 | 0.30 | 30.01 | | | C |
| ANISOU | 3639 | CD | AGLU | B | 26 | 4690 | 4529 | 2185 | -369 | 3 | 383 | | C |
| ATOM | 3640 | CD | BGLU | B | 26 | 14.865 | 39.690 | 88.523 | 0.70 | 31.84 | | | C |
| ANISOU | 3640 | CD | BGLU | B | 26 | 4914 | 4793 | 2393 | -393 | -33 | 399 | | C |
| ATOM | 3641 | OE1 | AGLU | B | 26 | 14.098 | 39.647 | 89.160 | 0.30 | 29.09 | | | O |
| ANISOU | 3641 | OE1 | AGLU | B | 26 | 4486 | 4456 | 2110 | -397 | -86 | 423 | | O |
| ATOM | 3642 | OE1 | BGLU | B | 26 | 14.433 | 39.803 | 87.366 | 0.70 | 33.57 | | | O |
| ANISOU | 3642 | OE1 | BGLU | B | 26 | 5167 | 5127 | 2462 | -458 | -100 | 458 | | O |
| ATOM | 3643 | OE2 | AGLU | B | 26 | 15.569 | 40.713 | 87.943 | 0.30 | 28.06 | | | O |
| ANISOU | 3643 | OE2 | AGLU | B | 26 | 4439 | 4314 | 1907 | -333 | 29 | 475 | | O |
| ATOM | 3644 | OE2 | BGLU | B | 26 | 14.496 | 40.396 | 89.471 | 0.70 | 27.95 | | | O |
| ANISOU | 3644 | OE2 | BGLU | B | 26 | 4302 | 4270 | 2048 | -320 | -37 | 461 | | O |
| ATOM | 3645 | C | AGLU | B | 26 | 17.892 | 37.370 | 85.674 | 0.30 | 34.43 | | | C |
| ANISOU | 3645 | C | AGLU | B | 26 | 5734 | 5071 | 2278 | -493 | 247 | 44 | | C |
| ATOM | 3646 | C | BGLU | B | 26 | 17.943 | 37.463 | 85.740 | 0.70 | 33.50 | | | C |
| ANISOU | 3646 | C | BGLU | B | 26 | 5604 | 4950 | 2175 | -482 | 252 | 53 | | C |
| ATOM | 3647 | O | AGLU | B | 26 | 18.668 | 36.436 | 85.883 | 0.30 | 34.39 | | | O |
| ANISOU | 3647 | O | AGLU | B | 26 | 5814 | 4965 | 2288 | -462 | 346 | -87 | | O |
| ATOM | 3648 | O | BGLU | B | 26 | 18.846 | 36.712 | 86.102 | 0.70 | 32.02 | | | O |
| ANISOU | 3648 | O | BGLU | B | 26 | 5476 | 4657 | 2035 | -429 | 360 | -62 | | O |
| ATOM | 3651 | N | ASP | B | 27 | 18.032 | 38.207 | 84.645 | 1.00 | 36.87 | | | N |
| ANISOU | 3651 | N | ASP | B | 27 | 6053 | 5487 | 2469 | -503 | 254 | 138 | | N |
| ATOM | 3652 | CA | ASP | B | 27 | 19.139 | 38.102 | 83.704 | 1.00 | 36.99 | | | C |
| ANISOU | 3652 | CA | ASP | B | 27 | 6176 | 5520 | 2359 | -488 | 391 | 83 | | C |
| ATOM | 3654 | CB | ASP | B | 27 | 18.570 | 38.266 | 82.298 | 1.00 | 41.40 | | | C |
| ANISOU | 3654 | CB | ASP | B | 27 | 6822 | 6244 | 2662 | -590 | 323 | 136 | | C |
| ATOM | 3657 | CG | ASP | B | 27 | 19.625 | 38.168 | 81.202 | 1.00 | 43.86 | | | C |
| ANISOU | 3657 | CG | ASP | B | 27 | 7260 | 6603 | 2802 | -587 | 474 | 83 | | C |
| ATOM | 3658 | OD1 | ASP | B | 27 | 20.845 | 38.048 | 81.499 | 1.00 | 44.98 | | | O |
| ANISOU | 3658 | OD1 | ASP | B | 27 | 7399 | 6652 | 3040 | -497 | 641 | 16 | | O |
| ATOM | 3659 | OD2 | ASP | B | 27 | 19.202 | 38.209 | 80.032 | 1.00 | 46.91 | | | O |
| ANISOU | 3659 | OD2 | ASP | B | 27 | 7738 | 7141 | 2943 | -675 | 423 | 112 | | O |
| ATOM | 3660 | C | ASP | B | 27 | 20.199 | 39.183 | 84.033 | 1.00 | 36.42 | | | C |
| ANISOU | 3660 | C | ASP | B | 27 | 6005 | 5408 | 2427 | -383 | 508 | 170 | | C |
| ATOM | 3661 | O | ASP | B | 27 | 19.948 | 40.372 | 83.831 | 1.00 | 35.43 | | | O |
| ANISOU | 3661 | O | ASP | B | 27 | 5808 | 5330 | 2325 | -374 | 478 | 329 | | O |
| ATOM | 3663 | N | LEU | B | 28 | 21.371 | 38.769 | 84.537 | 1.00 | 35.13 | | | N |
| ANISOU | 3663 | N | LEU | B | 28 | 5833 | 5154 | 2360 | -305 | 642 | 71 | | N |
| ATOM | 3664 | CA | LEU | B | 28 | 22.454 | 39.721 | 84.869 | 1.00 | 36.12 | | | C |
| ANISOU | 3664 | CA | LEU | B | 28 | 5849 | 5256 | 2621 | -233 | 753 | 132 | | C |
| ATOM | 3666 | CB | LEU | B | 28 | 23.610 | 39.043 | 85.647 | 1.00 | 36.23 | | | C |
| ANISOU | 3666 | CB | LEU | B | 28 | 5818 | 5192 | 2754 | -142 | 863 | 12 | | C |
| ATOM | 3669 | CG | LEU | B | 28 | 24.721 | 38.215 | 85.023 | 1.00 | 38.84 | | | C |
| ANISOU | 3669 | CG | LEU | B | 28 | 6222 | 5530 | 3005 | -93 | 1022 | -99 | | C |
| ATOM | 3671 | CD1 | LEU | B | 28 | 25.661 | 39.074 | 84.192 | 1.00 | 40.58 | | | C |
| ANISOU | 3671 | CD1 | LEU | B | 28 | 6405 | 5832 | 3180 | -98 | 1157 | -32 | | C |
| ATOM | 3675 | CD2 | LEU | B | 28 | 25.498 | 37.545 | 86.112 | 1.00 | 38.02 | | | C |
| ANISOU | 3675 | CD2 | LEU | B | 28 | 6042 | 5348 | 3057 | 19 | 1072 | -180 | | C |
| ATOM | 3679 | C | LEU | B | 28 | 22.973 | 40.537 | 83.685 | 1.00 | 37.83 | | | C |
| ANISOU | 3679 | C | LEU | B | 28 | 6096 | 5560 | 2719 | -261 | 844 | 227 | | C |
| ATOM | 3680 | O | LEU | B | 28 | 23.392 | 41.680 | 83.866 | 1.00 | 36.71 | | | O |
| ANISOU | 3680 | O | LEU | B | 28 | 5859 | 5401 | 2688 | -246 | 889 | 337 | | O |
| ATOM | 3682 | N | LYS | B | 29 | 22.932 | 39.965 | 82.478 | 1.00 | 40.35 | | | N |
| ANISOU | 3682 | N | LYS | B | 29 | 6558 | 5966 | 2806 | -313 | 877 | 183 | | N |
| ATOM | 3683 | CA | LYS | B | 29 | 23.401 | 40.659 | 81.287 | 1.00 | 41.88 | | | C |
| ANISOU | 3683 | CA | LYS | B | 29 | 6799 | 6264 | 2849 | -344 | 973 | 282 | | C |
| ATOM | 3685 | CB | LYS | B | 29 | 23.455 | 39.683 | 80.110 | 1.00 | 46.09 | | | C |
| ANISOU | 3685 | CB | LYS | B | 29 | 7512 | 6892 | 3109 | -395 | 1025 | 165 | | C |
| ATOM | 3688 | CG | LYS | B | 29 | 24.574 | 38.662 | 80.238 | 1.00 | 47.10 | | | C |
| ANISOU | 3688 | CG | LYS | B | 29 | 7680 | 6955 | 3263 | -324 | 1195 | -22 | | C |
| ATOM | 3691 | CD | LYS | B | 29 | 25.883 | 39.273 | 79.770 | 1.00 | 50.02 | | | C |
| ANISOU | 3691 | CD | LYS | B | 29 | 7994 | 7373 | 3638 | -280 | 1398 | 28 | | C |
| ATOM | 3694 | CE | LYS | B | 29 | 27.105 | 38.455 | 80.189 | 1.00 | 49.98 | | | C |
| ANISOU | 3694 | CE | LYS | B | 29 | 7948 | 7302 | 3739 | -169 | 1569 | -123 | | C |
| ATOM | 3697 | NZ | LYS | B | 29 | 28.321 | 39.114 | 79.626 | 1.00 | 52.57 | | | N |
| ANISOU | 3697 | NZ | LYS | B | 29 | 8202 | 7714 | 4060 | -146 | 1769 | -60 | | N |

FIG. 18 (continued)

```
ATOM    3701  C    LYS B  29      22.517  41.854  80.928  1.00 42.35          C
ANISOU  3701  C    LYS B  29    6828   6385   2880   -384    863    495       C
ATOM    3702  O    LYS B  29      22.960  42.828  80.297  1.00 41.87          O
ANISOU  3702  O    LYS B  29    6760   6364   2784   -391    946    640       O
ATOM    3704  N    ILE B  30      21.254  41.782  81.310  1.00 41.10          N
ANISOU  3704  N    ILE B  30    6647   6231   2737   -406    683    529       N
ATOM    3705  CA   ILE B  30      20.340  42.884  81.060  1.00 42.98          C
ANISOU  3705  CA   ILE B  30    6836   6522   2973   -411    572    743       C
ATOM    3707  CB   ILE B  30      18.987  42.352  80.635  1.00 44.63          C
ANISOU  3707  CB   ILE B  30    7084   6857   3017   -477    385    753       C
ATOM    3709  CG1  ILE B  30      19.121  41.661  79.281  1.00 47.58          C
ANISOU  3709  CG1  ILE B  30    7618   7384   3074   -566    404    688       C
ATOM    3712  CD1  ILE B  30      19.201  42.636  78.112  1.00 51.53          C
ANISOU  3712  CD1  ILE B  30    8161   8019   3397   -573    428    895       C
ATOM    3716  CG2  ILE B  30      17.978  43.488  80.542  1.00 47.42          C
ANISOU  3716  CG2  ILE B  30    7347   7264   3405   -446    262    991       C
ATOM    3720  C    ILE B  30      20.240  43.761  82.313  1.00 40.03          C
ANISOU  3720  C    ILE B  30    6316   6006   2887   -339    558    811       C
ATOM    3721  O    ILE B  30      20.211  44.985  82.240  1.00 39.57          O
ANISOU  3721  O    ILE B  30    6211   5912   2913   -308    580    983       O
ATOM    3723  N    GLU B  31      20.236  43.125  83.469  1.00 37.28          N
ANISOU  3723  N    GLU B  31    5911   5568   2687   -312    536    670       N
ATOM    3724  CA   GLU B  31      20.084  43.823  84.742  1.00 36.49          C
ANISOU  3724  CA   GLU B  31    5685   5347   2833   -252    518    698       C
ATOM    3726  CB   GLU B  31      18.971  43.132  85.540  1.00 36.84          C
ANISOU  3726  CB   GLU B  31    5690   5393   2916   -251    381    639       C
ATOM    3729  CG   GLU B  31      17.579  43.387  84.963  1.00 40.94          C
ANISOU  3729  CG   GLU B  31    6199   6022   3337   -277    235    773       C
ATOM    3732  CD   GLU B  31      16.488  43.046  85.962  1.00 43.02          C
ANISOU  3732  CD   GLU B  31    6370   6273   3701   -267    122    747       C
ATOM    3733  OE1  GLU B  31      15.912  43.985  86.586  1.00 45.26          O
ANISOU  3733  OE1  GLU B  31    6549   6514   4135   -196     95    853       O
ATOM    3734  OE2  GLU B  31      16.233  41.826  86.151  1.00 46.30          O
ANISOU  3734  OE2  GLU B  31    6826   6712   4055   -330     78    616       O
ATOM    3735  C    GLU B  31      21.404  43.896  85.527  1.00 33.41          C
ANISOU  3735  C    GLU B  31    5238   4858   2598   -219    650    597       C
ATOM    3736  O    GLU B  31      21.542  43.344  86.624  1.00 29.97          O
ANISOU  3736  O    GLU B  31    4748   4365   2274   -187    635    479       O
ATOM    3738  N    THR B  32      22.368  44.598  84.954  1.00 33.44          N
ANISOU  3738  N    THR B  32    5244   4858   2602   -232    778    655       N
ATOM    3739  CA   THR B  32      23.717  44.684  85.512  1.00 32.47          C
ANISOU  3739  CA   THR B  32    5047   4682   2607   -221    907    567       C
ATOM    3741  CB   THR B  32      24.764  45.059  84.395  1.00 35.41          C
ANISOU  3741  CB   THR B  32    5454   5111   2889   -262   1066    625       C
ATOM    3743  OG1  THR B  32      24.569  46.416  83.943  1.00 37.88          O
ANISOU  3743  OG1  THR B  32    5769   5383   3239   -297   1092    811       O
ATOM    3745  CG2  THR B  32      24.616  44.137  83.217  1.00 34.87          C
ANISOU  3745  CG2  THR B  32    5519   5163   2568   -277   1078    597       C
ATOM    3749  C    THR B  32      23.821  45.628  86.702  1.00 30.07          C
ANISOU  3749  C    THR B  32    4627   4264   2533   -208    900    576       C
ATOM    3750  O    THR B  32      24.624  45.388  87.618  1.00 27.93          O
ANISOU  3750  O    THR B  32    4269   3967   2375   -193    937    459       O
ATOM    3752  N    ASN B  33      23.025  46.693  86.733  1.00 31.16          N
ANISOU  3752  N    ASN B  33    4763   4337   2741   -207    853    708       N
ATOM    3753  CA   ASN B  33      22.964  47.526  87.946  1.00 29.31          C
ANISOU  3753  CA   ASN B  33    4440   3977   2718   -192    845    684       C
ATOM    3755  CB   ASN B  33      22.144  48.805  87.719  1.00 31.15          C
ANISOU  3755  CB   ASN B  33    4695   4115   3026   -175    831    855       C
ATOM    3758  CG   ASN B  33      22.885  49.832  86.866  1.00 33.74          C
ANISOU  3758  CG   ASN B  33    5058   4385   3375   -231    960    985       C
ATOM    3759  OD1  ASN B  33      24.099  49.916  86.933  1.00 34.77          O
ANISOU  3759  OD1  ASN B  33    5150   4506   3554   -298   1070    913       O
ATOM    3760  ND2  ASN B  33      22.161  50.584  86.044  1.00 34.09          N
ANISOU  3760  ND2  ASN B  33    5167   4405   3380   -205    948   1188       N
ATOM    3763  C    ASN B  33      22.405  46.720  89.108  1.00 26.85          C
ANISOU  3763  C    ASN B  33    4085   3673   2445   -145    743    560       C
ATOM    3764  O    ASN B  33      22.870  46.817  90.232  1.00 24.57          O
ANISOU  3764  O    ASN B  33    3719   3337   2279   -139    755    455       O
ATOM    3766  N    LYS B  34      21.389  45.911  88.846  1.00 27.76          N
ANISOU  3766  N    LYS B  34    4247   3857   2443   -122    641    573       N
ATOM    3767  CA   LYS B  34      20.822  45.038  89.879  1.00 26.52          C
ANISOU  3767  CA   LYS B  34    4058   3709   2309    -90    557    471       C
ATOM    3769  CB   LYS B  34      19.563  44.325  89.356  1.00 27.01          C
ANISOU  3769  CB   LYS B  34    4170   3850   2243    -99    445    516       C
ATOM    3772  CG   LYS B  34      18.750  43.591  90.443  1.00 26.49          C
ANISOU  3772  CG   LYS B  34    4062   3784   2219    -80    362    446       C
ATOM    3775  CD   LYS B  34      17.485  42.916  89.872  1.00 27.43          C
ANISOU  3775  CD   LYS B  34    4212   3992   2217   -122    250    492       C
ATOM    3778  CE   LYS B  34      16.342  43.902  89.600  1.00 28.72          C
```

FIG. 18 (continued)

| | | | | | | | | | | | | | |
|---|---|---|---|---|---|---|---|---|---|---|---|---|---|
| ANISOU | 3778 | CE | LYS | B | 34 | 4313 | 4190 | 2408 | -96 | 180 | 649 | | C |
| ATOM | 3781 | NZ | LYS | B | 34 | 15.074 | 43.223 | 89.165 | 1.00 | 28.25 | | | N |
| ANISOU | 3781 | NZ | LYS | B | 34 | 4242 | 4252 | 2238 | -149 | 53 | 690 | | N |
| ATOM | 3785 | C | LYS | B | 34 | 21.853 | 44.027 | 90.389 | 1.00 | 25.22 | | | C |
| ANISOU | 3785 | C | LYS | B | 34 | 3880 | 3564 | 2139 | -82 | 601 | 325 | | C |
| ATOM | 3786 | O | LYS | B | 34 | 21.907 | 43.777 | 91.566 | 1.00 | 23.46 | | | O |
| ANISOU | 3786 | O | LYS | B | 34 | 3598 | 3317 | 1998 | -51 | 575 | 247 | | O |
| ATOM | 3788 | N | PHE | B | 35 | 22.660 | 43.472 | 89.480 | 1.00 | 25.90 | | | N |
| ANISOU | 3788 | N | PHE | B | 35 | 4021 | 3700 | 2121 | -99 | 673 | 301 | | N |
| ATOM | 3789 | CA | PHE | B | 35 | 23.767 | 42.579 | 89.811 | 1.00 | 26.10 | | | C |
| ANISOU | 3789 | CA | PHE | B | 35 | 4023 | 3743 | 2148 | -64 | 739 | 184 | | C |
| ATOM | 3791 | CB | PHE | B | 35 | 24.523 | 42.209 | 88.494 | 1.00 | 28.93 | | | C |
| ANISOU | 3791 | CB | PHE | B | 35 | 4455 | 4160 | 2376 | -80 | 846 | 182 | | C |
| ATOM | 3794 | CG | PHE | B | 35 | 25.685 | 41.258 | 88.657 | 1.00 | 28.42 | | | C |
| ANISOU | 3794 | CG | PHE | B | 35 | 4365 | 4119 | 2313 | -18 | 937 | 73 | | C |
| ATOM | 3795 | CD1 | PHE | B | 35 | 25.664 | 40.230 | 89.597 | 1.00 | 27.98 | | | C |
| ANISOU | 3795 | CD1 | PHE | B | 35 | 4300 | 4034 | 2298 | 53 | 893 | -12 | | C |
| ATOM | 3797 | CE1 | PHE | B | 35 | 26.763 | 39.332 | 89.700 | 1.00 | 29.36 | | | C |
| ANISOU | 3797 | CE1 | PHE | B | 35 | 4448 | 4226 | 2481 | 141 | 985 | -91 | | C |
| ATOM | 3799 | CZ | PHE | B | 35 | 27.842 | 39.463 | 88.855 | 1.00 | 29.50 | | | C |
| ANISOU | 3799 | CZ | PHE | B | 35 | 4440 | 4303 | 2466 | 153 | 1125 | -99 | | C |
| ATOM | 3801 | CE2 | PHE | B | 35 | 27.833 | 40.476 | 87.882 | 1.00 | 31.96 | | | C |
| ANISOU | 3801 | CE2 | PHE | B | 35 | 4768 | 4652 | 2722 | 61 | 1176 | -19 | | C |
| ATOM | 3803 | CD2 | PHE | B | 35 | 26.767 | 41.349 | 87.796 | 1.00 | 30.61 | | | C |
| ANISOU | 3803 | CD2 | PHE | B | 35 | 4635 | 4452 | 2544 | -20 | 1078 | 71 | | C |
| ATOM | 3805 | C | PHE | B | 35 | 24.677 | 43.248 | 90.851 | 1.00 | 24.47 | | | C |
| ANISOU | 3805 | C | PHE | B | 35 | 3684 | 3513 | 2099 | -52 | 778 | 143 | | C |
| ATOM | 3806 | O | PHE | B | 35 | 24.954 | 42.650 | 91.882 | 1.00 | 24.51 | | | O |
| ANISOU | 3806 | O | PHE | B | 35 | 3634 | 3525 | 2154 | -3 | 749 | 62 | | O |
| ATOM | 3808 | N | ALA | B | 36 | 25.089 | 44.493 | 90.605 | 1.00 | 24.46 | | | N |
| ANISOU | 3808 | N | ALA | B | 36 | 3638 | 3483 | 2173 | -106 | 839 | 202 | | N |
| ATOM | 3809 | CA | ALA | B | 36 | 25.924 | 45.261 | 91.534 | 1.00 | 25.05 | | | C |
| ANISOU | 3809 | CA | ALA | B | 36 | 3589 | 3533 | 2396 | -134 | 872 | 150 | | C |
| ATOM | 3811 | CB | ALA | B | 36 | 26.291 | 46.642 | 90.923 | 1.00 | 23.46 | | | C |
| ANISOU | 3811 | CB | ALA | B | 36 | 3378 | 3269 | 2265 | -222 | 961 | 236 | | C |
| ATOM | 3815 | C | ALA | B | 36 | 25.228 | 45.461 | 92.905 | 1.00 | 22.43 | | | C |
| ANISOU | 3815 | C | ALA | B | 36 | 3219 | 3155 | 2148 | -111 | 775 | 97 | | C |
| ATOM | 3816 | O | ALA | B | 36 | 25.873 | 45.425 | 93.950 | 1.00 | 24.37 | | | O |
| ANISOU | 3816 | O | ALA | B | 36 | 3368 | 3430 | 2460 | -109 | 763 | 4 | | O |
| ATOM | 3818 | N | ALA | B | 37 | 23.934 | 45.720 | 92.868 | 1.00 | 21.52 | | | N |
| ANISOU | 3818 | N | ALA | B | 37 | 3169 | 2986 | 2022 | -96 | 712 | 162 | | N |
| ATOM | 3819 | CA | ALA | B | 37 | 23.120 | 45.929 | 94.078 | 1.00 | 22.35 | | | C |
| ANISOU | 3819 | CA | ALA | B | 37 | 3246 | 3053 | 2194 | -65 | 640 | 122 | | C |
| ATOM | 3821 | CB | ALA | B | 37 | 21.707 | 46.485 | 93.715 | 1.00 | 21.43 | | | C |
| ANISOU | 3821 | CB | ALA | B | 37 | 3182 | 2878 | 2081 | -44 | 598 | 232 | | C |
| ATOM | 3825 | C | ALA | B | 37 | 23.007 | 44.658 | 94.920 | 1.00 | 20.09 | | | C |
| ANISOU | 3825 | C | ALA | B | 37 | 2945 | 2835 | 1851 | -11 | 575 | 44 | | C |
| ATOM | 3826 | O | ALA | B | 37 | 23.055 | 44.726 | 96.146 | 1.00 | 21.87 | | | O |
| ANISOU | 3826 | O | ALA | B | 37 | 3113 | 3070 | 2125 | 5 | 545 | -29 | | O |
| ATOM | 3828 | N | ILE | B | 38 | 22.814 | 43.511 | 94.268 | 1.00 | 21.22 | | | N |
| ANISOU | 3828 | N | ILE | B | 38 | 3155 | 3021 | 1885 | 12 | 558 | 62 | | N |
| ATOM | 3829 | CA | ILE | B | 38 | 22.763 | 42.239 | 94.967 | 1.00 | 21.48 | | | C |
| ANISOU | 3829 | CA | ILE | B | 38 | 3198 | 3090 | 1875 | 64 | 516 | 6 | | C |
| ATOM | 3831 | CB | ILE | B | 38 | 22.430 | 41.050 | 94.030 | 1.00 | 22.50 | | | C |
| ANISOU | 3831 | CB | ILE | B | 38 | 3435 | 3225 | 1888 | 67 | 511 | 21 | | C |
| ATOM | 3833 | CG1 | ILE | B | 38 | 21.030 | 41.193 | 93.461 | 1.00 | 22.36 | | | C |
| ANISOU | 3833 | CG1 | ILE | B | 38 | 3476 | 3199 | 1820 | 20 | 447 | 93 | | C |
| ATOM | 3836 | CD1 | ILE | B | 38 | 20.780 | 40.294 | 92.238 | 1.00 | 21.55 | | | C |
| ANISOU | 3836 | CD1 | ILE | B | 38 | 3490 | 3117 | 1583 | -20 | 445 | 97 | | C |
| ATOM | 3840 | CG2 | ILE | B | 38 | 22.496 | 39.705 | 94.837 | 1.00 | 22.18 | | | C |
| ANISOU | 3840 | CG2 | ILE | B | 38 | 3417 | 3183 | 1826 | 125 | 488 | -32 | | C |
| ATOM | 3844 | C | ILE | B | 38 | 24.104 | 41.971 | 95.631 | 1.00 | 21.30 | | | C |
| ANISOU | 3844 | C | ILE | B | 38 | 3090 | 3115 | 1887 | 101 | 551 | -68 | | C |
| ATOM | 3845 | O | ILE | B | 38 | 24.156 | 41.611 | 96.815 | 1.00 | 22.38 | | | O |
| ANISOU | 3845 | O | ILE | B | 38 | 3180 | 3283 | 2040 | 142 | 506 | -110 | | O |
| ATOM | 3847 | N | CYS | B | 39 | 25.192 | 42.180 | 94.895 | 1.00 | 21.34 | | | N |
| ANISOU | 3847 | N | CYS | B | 39 | 3063 | 3148 | 1899 | 86 | 631 | -73 | | N |
| ATOM | 3848 | CA | CYS | B | 39 | 26.553 | 42.042 | 95.486 | 1.00 | 22.77 | | | C |
| ANISOU | 3848 | CA | CYS | B | 39 | 3120 | 3406 | 2125 | 118 | 663 | -134 | | C |
| ATOM | 3850 | CB | CYS | B | 39 | 27.656 | 42.325 | 94.463 | 1.00 | 22.18 | | | C |
| ANISOU | 3850 | CB | CYS | B | 39 | 3001 | 3368 | 2057 | 90 | 773 | -125 | | C |
| ATOM | 3853 | SG | CYS | B | 39 | 27.814 | 41.093 | 93.202 | 1.00 | 24.03 | | | S |
| ANISOU | 3853 | SG | CYS | B | 39 | 3349 | 3606 | 2176 | 158 | 851 | -110 | | S |
| ATOM | 3855 | C | CYS | B | 39 | 26.752 | 42.937 | 96.712 | 1.00 | 21.39 | | | C |
| ANISOU | 3855 | C | CYS | B | 39 | 2837 | 3256 | 2034 | 77 | 617 | -187 | | C |
| ATOM | 3856 | O | CYS | B | 39 | 27.299 | 42.498 | 97.740 | 1.00 | 21.55 | | | O |
| ANISOU | 3856 | O | CYS | B | 39 | 2771 | 3360 | 2056 | 126 | 573 | -236 | | O |
| ATOM | 3858 | N | THR | B | 40 | 26.288 | 44.174 | 96.606 | 1.00 | 22.76 | | | N |
| ANISOU | 3858 | N | THR | B | 40 | 3024 | 3355 | 2268 | -7 | 627 | -175 | | N |

FIG. 18 (continued)

```
ATOM   3859  CA  THR B  40      26.420  45.115  97.673  1.00 23.17          C
ANISOU 3859  CA  THR B  40    3002   3403   2398    -63    600   -248       C
ATOM   3861  CB  THR B  40      25.994  46.537  97.252  1.00 24.77          C
ANISOU 3861  CB  THR B  40    3246   3476   2689   -151    651   -221       C
ATOM   3863  OG1 THR B  40      26.824  46.992  96.160  1.00 26.01          O
ANISOU 3863  OG1 THR B  40    3386   3619   2879   -217    743   -174       O
ATOM   3865  CG2 THR B  40      26.191  47.493  98.412  1.00 25.21          C
ANISOU 3865  CG2 THR B  40    3243   3509   2828   -220    636   -333       C
ATOM   3869  C   THR B  40      25.640  44.676  98.893  1.00 23.02          C
ANISOU 3869  C   THR B  40    2998   3408   2341     -7    515   -286       C
ATOM   3870  O   THR B  40      26.167  44.708 100.001  1.00 22.97          O
ANISOU 3870  O   THR B  40    2908   3487   2334    -11    473   -368       O
ATOM   3872  N   HIS B  41      24.390  44.277  98.686  1.00 23.44          N
ANISOU 3872  N   HIS B  41    3149   3406   2352     37    490   -223       N
ATOM   3873  CA  HIS B  41      23.527  43.861  99.758  1.00 20.90          C
ANISOU 3873  CA  HIS B  41    2844   3106   1992     83    429   -241       C
ATOM   3875  CB  HIS B  41      22.120  43.518  99.235  1.00 21.24          C
ANISOU 3875  CB  HIS B  41    2976   3091   2005    105    413   -155       C
ATOM   3878  CG  HIS B  41      21.201  43.015 100.313  1.00 20.44          C
ANISOU 3878  CG  HIS B  41    2881   3020   1865    144    367   -160       C
ATOM   3879  ND1 HIS B  41      20.906  41.679 100.471  1.00 19.10          N
ANISOU 3879  ND1 HIS B  41    2752   2884   1620    182    335   -124       N
ATOM   3881  CE1 HIS B  41      20.083  41.531 101.498  1.00 20.87          C
ANISOU 3881  CE1 HIS B  41    2971   3137   1823    200    312   -124       C
ATOM   3883  NE2 HIS B  41      19.861  42.718 102.034  1.00 22.44          N
ANISOU 3883  NE2 HIS B  41    3126   3326   2073    186    331   -176       N
ATOM   3885  CD2 HIS B  41      20.543  43.668 101.299  1.00 19.96          C
ANISOU 3885  CD2 HIS B  41    2796   2958   1828    147    364   -200       C
ATOM   3887  C   HIS B  41      24.142  42.675 100.481  1.00 21.61          C
ANISOU 3887  C   HIS B  41    2897   3301   2012    150    388   -261       C
ATOM   3888  O   HIS B  41      24.244  42.672 101.709  1.00 20.41          O
ANISOU 3888  O   HIS B  41    2698   3223   1836    165    344   -314       O
ATOM   3890  N   LEU B  42      24.576  41.673  99.715  1.00 22.28          N
ANISOU 3890  N   LEU B  42    3013   3393   2061    197    408   -216       N
ATOM   3891  CA  LEU B  42      25.241  40.494 100.292  1.00 23.85          C
ANISOU 3891  CA  LEU B  42    3184   3669   2210    290    385   -212       C
ATOM   3893  CB  LEU B  42      25.685  39.527  99.172  1.00 24.81          C
ANISOU 3893  CB  LEU B  42    3363   3753   2310    343    443   -174       C
ATOM   3896  CG  LEU B  42      24.604  38.665  98.542  1.00 24.63          C
ANISOU 3896  CG  LEU B  42    3490   3631   2236    345    446   -128       C
ATOM   3898  CD1 LEU B  42      25.106  38.215  97.167  1.00 24.92          C
ANISOU 3898  CD1 LEU B  42    3590   3629   2249    354    524   -128       C
ATOM   3902  CD2 LEU B  42      24.254  37.472  99.495  1.00 24.51          C
ANISOU 3902  CD2 LEU B  42    3521   3608   2182    421    408    -97       C
ATOM   3906  C   LEU B  42      26.459  40.870 101.148  1.00 24.94          C
ANISOU 3906  C   LEU B  42    3174   3935   2366    296    360   -272       C
ATOM   3907  O   LEU B  42      26.626  40.414 102.313  1.00 25.35          O
ANISOU 3907  O   LEU B  42    3181   4084   2368    353    297   -278       O
ATOM   3909  N   GLU B  43      27.303  41.735 100.590  1.00 26.12          N
ANISOU 3909  N   GLU B  43    3241   4103   2579    225    404   -312       N
ATOM   3910  CA  GLU B  43      28.505  42.137 101.284  1.00 29.48          C
ANISOU 3910  CA  GLU B  43    3505   4669   3029    200    377   -376       C
ATOM   3912  CB  GLU B  43      29.411  42.989 100.409  1.00 32.32          C
ANISOU 3912  CB  GLU B  43    3780   5030   3471    104    452   -402       C
ATOM   3915  CG  GLU B  43      30.680  43.340 101.172  1.00 36.01          C
ANISOU 3915  CG  GLU B  43    4049   5670   3962     59    411   -475       C
ATOM   3918  CD  GLU B  43      31.837  43.781 100.311  1.00 38.91          C
ANISOU 3918  CD  GLU B  43    4291   6085   4408    -10    496   -479       C
ATOM   3919  OE1 GLU B  43      32.981  43.738 100.798  1.00 43.95          O
ANISOU 3919  OE1 GLU B  43    4736   6901   5060    -18    462   -515       O
ATOM   3920  OE2 GLU B  43      31.612  44.203  99.167  1.00 41.61          O
ANISOU 3920  OE2 GLU B  43    4714   6304   4790    -63    594   -439       O
ATOM   3921  C   GLU B  43      28.230  42.883 102.586  1.00 27.69          C
ANISOU 3921  C   GLU B  43    3240   4496   2784    136    303   -461       C
ATOM   3922  O   GLU B  43      28.881  42.607 103.606  1.00 26.60          O
ANISOU 3922  O   GLU B  43    2997   4516   2594    166    230   -495       O
ATOM   3924  N   VAL B  44      27.271  43.801 102.554  1.00 27.27          N
ANISOU 3924  N   VAL B  44    3272   4321   2767     58    325   -493       N
ATOM   3925  CA  VAL B  44      26.817  44.491 103.772  1.00 26.34          C
ANISOU 3925  CA  VAL B  44    3155   4228   2625      8    280   -588       C
ATOM   3927  CB  VAL B  44      25.792  45.611 103.447  1.00 26.31          C
ANISOU 3927  CB  VAL B  44    3248   4050   2699    -58    340   -611       C
ATOM   3929  CG1 VAL B  44      25.160  46.169 104.700  1.00 27.05          C
ANISOU 3929  CG1 VAL B  44    3365   4155   2757    -79    317   -713       C
ATOM   3933  CG2 VAL B  44      26.501  46.737 102.639  1.00 25.52          C
ANISOU 3933  CG2 VAL B  44    3113   3864   2718   -177    410   -646       C
ATOM   3937  C   VAL B  44      26.316  43.494 104.850  1.00 26.50          C
ANISOU 3937  C   VAL B  44    3200   4345   2524    109    210   -558       C
ATOM   3938  O   VAL B  44      26.734  43.601 105.997  1.00 27.73          O
```

FIG. 18 (continued)

```
ANISOU 3938  O   VAL B  44    3286   4641   2608     96    145   -631    O
ATOM   3940  N   CYS B  45     25.469  42.534 104.482  1.00 24.68        N
ANISOU 3940  N   CYS B  45    3067   4048   2261    196    222   -450    N
ATOM   3941  CA  CYS B  45     24.944  41.532 105.429  1.00 25.23        C
ANISOU 3941  CA  CYS B  45    3176   4186   2225    283    175   -396    C
ATOM   3943  CB  CYS B  45     23.918  40.606 104.745  1.00 23.40        C
ANISOU 3943  CB  CYS B  45    3063   3836   1992    333    208   -285    C
ATOM   3946  SG  CYS B  45     22.450  41.442 104.280  1.00 23.77        S
ANISOU 3946  SG  CYS B  45    3183   3753   2094    265    252   -289    S
ATOM   3948  C   CYS B  45     26.053  40.720 106.105  1.00 26.80        C
ANISOU 3948  C   CYS B  45    3283   4549   2351    364    112   -370    C
ATOM   3949  O   CYS B  45     26.032  40.491 107.330  1.00 27.96        O
ANISOU 3949  O   CYS B  45    3407   4823   2392    395     50   -375    O
ATOM   3951  N   PHE B  46     27.051  40.338 105.321  1.00 28.92        N
ANISOU 3951  N   PHE B  46    3490   4830   2669    403    130   -338    N
ATOM   3952  CA  PHE B  46     28.196  39.589 105.816  1.00 31.01        C
ANISOU 3952  CA  PHE B  46    3640   5255   2888    505     77   -296    C
ATOM   3954  CB  PHE B  46     29.016  38.983 104.664  1.00 33.37        C
ANISOU 3954  CB  PHE B  46    3906   5513   3260    579    142   -241    C
ATOM   3957  CG  PHE B  46     28.272  37.984 103.857  1.00 32.96        C
ANISOU 3957  CG  PHE B  46    4019   5288   3217    651    209   -157    C
ATOM   3958  CD1 PHE B  46     27.389  37.089 104.455  1.00 35.96        C
ANISOU 3958  CD1 PHE B  46    4518   5614   3533    715    188    -81    C
ATOM   3960  CE1 PHE B  46     26.685  36.153 103.694  1.00 35.91        C
ANISOU 3960  CE1 PHE B  46    4667   5437   3539    750    250    -20    C
ATOM   3962  CZ  PHE B  46     26.871  36.104 102.325  1.00 33.96        C
ANISOU 3962  CZ  PHE B  46    4465   5088   3349    732    329    -43    C
ATOM   3964  CE2 PHE B  46     27.758  36.987 101.724  1.00 33.75        C
ANISOU 3964  CE2 PHE B  46    4324   5128   3374    686    357   -105    C
ATOM   3966  CD2 PHE B  46     28.441  37.924 102.489  1.00 32.82        C
ANISOU 3966  CD2 PHE B  46    4044   5164   3264    640    300   -158    C
ATOM   3968  C   PHE B  46     29.095  40.417 106.695  1.00 32.25        C
ANISOU 3968  C   PHE B  46    3635   5606   3013    433     -1   -396    C
ATOM   3969  O   PHE B  46     29.625  39.892 107.688  1.00 34.68        O
ANISOU 3969  O   PHE B  46    3859   6096   3223    510    -88   -361    O
ATOM   3971  N   MET B  47     29.297  41.687 106.346  1.00 31.64        N
ANISOU 3971  N   MET B  47    3512   5498   3012    280     27   -515    N
ATOM   3972  CA  MET B  47     30.099  42.581 107.194  1.00 34.75        C
ANISOU 3972  CA  MET B  47    3762   6063   3379    166    -47   -644    C
ATOM   3974  CB  MET B  47     30.363  43.935 106.538  1.00 36.29        C
ANISOU 3974  CB  MET B  47    3928   6162   3699    -13     17   -760    C
ATOM   3977  CG  MET B  47     31.330  43.964 105.357  1.00 38.47        C
ANISOU 3977  CG  MET B  47    4104   6426   4088    -32     84   -721    C
ATOM   3980  SD  MET B  47     31.556  45.695 104.812  1.00 39.73        S
ANISOU 3980  SD  MET B  47    4248   6459   4387   -272    163   -853    S
ATOM   3981  CE  MET B  47     32.534  46.256 106.199  1.00 39.22        C
ANISOU 3981  CE  MET B  47    3998   6644   4260   -406     36  -1014    C
ATOM   3985  C   MET B  47     29.343  42.864 108.500  1.00 34.90        C
ANISOU 3985  C   MET B  47    3845   6141   3273    135   -108   -715    C
ATOM   3986  O   MET B  47     29.933  42.859 109.568  1.00 34.54        O
ANISOU 3986  O   MET B  47    3698   6311   3114    124   -210   -764    O
ATOM   3988  N   TYR B  48     28.041  43.132 108.392  1.00 31.59        N
ANISOU 3988  N   TYR B  48    3587   5547   2869    123    -43   -719    N
ATOM   3989  CA  TYR B  48     27.202  43.382 109.581  1.00 32.21        C
ANISOU 3989  CA  TYR B  48    3738   5671   2830    107    -69   -785    C
ATOM   3991  CB  TYR B  48     25.766  43.625 109.109  1.00 28.63        C
ANISOU 3991  CB  TYR B  48    3434   5003   2440    113     28   -759    C
ATOM   3994  CG  TYR B  48     24.832  44.342 110.046  1.00 30.09        C
ANISOU 3994  CG  TYR B  48    3692   5178   2564     70     55   -865    C
ATOM   3995  CD1 TYR B  48     24.364  45.635 109.750  1.00 30.52        C
ANISOU 3995  CD1 TYR B  48    3795   5073   2729    -22    135   -983    C
ATOM   3997  CE1 TYR B  48     23.461  46.285 110.601  1.00 30.00        C
ANISOU 3997  CE1 TYR B  48    3802   4983   2615    -39    183  -1087    C
ATOM   3999  CZ  TYR B  48     22.993  45.618 111.733  1.00 30.27        C
ANISOU 3999  CZ  TYR B  48    3858   5169   2473     26    153  -1067    C
ATOM   4000  OH  TYR B  48     22.076  46.211 112.569  1.00 29.68        O
ANISOU 4000  OH  TYR B  48    3853   5083   2339     21    221  -1170    O
ATOM   4002  CE2 TYR B  48     23.403  44.329 112.004  1.00 29.42        C
ANISOU 4002  CE2 TYR B  48    3711   5216   2252    108     71   -931    C
ATOM   4004  CD2 TYR B  48     24.316  43.702 111.171  1.00 29.28        C
ANISOU 4004  CD2 TYR B  48    3624   5204   2298    136     22   -832    C
ATOM   4006  C   TYR B  48     27.235  42.205 110.581  1.00 32.87        C
ANISOU 4006  C   TYR B  48    3812   5933   2745    234   -150   -679    C
ATOM   4007  O   TYR B  48     27.314  42.420 111.803  1.00 29.07        O
ANISOU 4007  O   TYR B  48    3304   5625   2116    207   -219   -753    O
ATOM   4009  N   SER B  49     27.151  40.982 110.063  1.00 31.27        N
ANISOU 4009  N   SER B  49    3645   5679   2558    369   -134   -508    N
ATOM   4010  CA  SER B  49     27.164  39.775 110.895  1.00 36.06        C
ANISOU 4010  CA  SER B  49    4263   6409   3029    506   -191   -370    C
```

FIG. 18 (continued)

| | | | | | | | | | | | | | | | |
|---|---|---|---|---|---|---|---|---|---|---|---|---|---|---|---|
| ATOM | 4012 | CB | SER | B | 49 | | 26.385 | 38.666 | 110.210 | 1.00 | 34.87 | | | | C |
| ANISOU | 4012 | CB | SER | B | 49 | 4244 | 6076 | 2931 | 605 | -118 | -216 | | | | C |
| ATOM | 4015 | OG | SER | B | 49 | | 27.043 | 38.297 | 109.023 | 1.00 | 36.13 | | | | O |
| ANISOU | 4015 | OG | SER | B | 49 | 4373 | 6142 | 3212 | 649 | -80 | -174 | | | | O |
| ATOM | 4017 | C | SER | B | 49 | | 28.558 | 39.231 | 111.254 | 1.00 | 37.15 | | | | C |
| ANISOU | 4017 | C | SER | B | 49 | 4243 | 6760 | 3113 | 593 | -290 | -312 | | | | C |
| ATOM | 4018 | O | SER | B | 49 | | 28.651 | 38.196 | 111.906 | 1.00 | 39.73 | | | | O |
| ANISOU | 4018 | O | SER | B | 49 | 4578 | 7184 | 3334 | 730 | -337 | -169 | | | | O |
| ATOM | 4020 | N | ASP | B | 50 | | 29.617 | 39.933 | 110.845 | 1.00 | 39.83 | | | | N |
| ANISOU | 4020 | N | ASP | B | 50 | 4430 | 7176 | 3527 | 516 | -316 | -409 | | | | N |
| ATOM | 4021 | CA | ASP | B | 50 | | 31.005 | 39.514 | 111.078 | 1.00 | 43.28 | | | | C |
| ANISOU | 4021 | CA | ASP | B | 50 | 4670 | 7838 | 3935 | 594 | -409 | -357 | | | | C |
| ATOM | 4023 | CB | ASP | B | 50 | | 31.381 | 39.660 | 112.568 | 1.00 | 46.67 | | | | C |
| ANISOU | 4023 | CB | ASP | B | 50 | 5005 | 8562 | 4165 | 577 | -554 | -393 | | | | C |
| ATOM | 4026 | CG | ASP | B | 50 | | 32.881 | 39.532 | 112.818 | 1.00 | 49.34 | | | | C |
| ANISOU | 4026 | CG | ASP | B | 50 | 5090 | 9181 | 4478 | 616 | -672 | -371 | | | | C |
| ATOM | 4027 | OD1 | ASP | B | 50 | | 33.694 | 39.771 | 111.892 | 1.00 | 47.13 | | | | O |
| ANISOU | 4027 | OD1 | ASP | B | 50 | 4680 | 8878 | 4350 | 588 | -634 | -396 | | | | O |
| ATOM | 4028 | OD2 | ASP | B | 50 | | 33.240 | 39.181 | 113.968 | 1.00 | 51.65 | | | | O |
| ANISOU | 4028 | OD2 | ASP | B | 50 | 5302 | 9737 | 4587 | 677 | -805 | -317 | | | | O |
| ATOM | 4029 | C | ASP | B | 50 | | 31.249 | 38.089 | 110.581 | 1.00 | 44.85 | | | | C |
| ANISOU | 4029 | C | ASP | B | 50 | 4889 | 7977 | 4173 | 811 | -373 | -155 | | | | C |
| ATOM | 4030 | O | ASP | B | 50 | | 31.951 | 37.289 | 111.208 | 1.00 | 43.12 | | | | O |
| ANISOU | 4030 | O | ASP | B | 50 | 4572 | 7938 | 3873 | 960 | -454 | -32 | | | | O |
| ATOM | 4032 | N | PHE | B | 51 | | 30.683 | 37.799 | 109.410 | 1.00 | 44.63 | | | | N |
| ANISOU | 4032 | N | PHE | B | 51 | 4993 | 7691 | 4273 | 828 | -249 | -123 | | | | N |
| ATOM | 4033 | CA | PHE | B | 51 | | 30.847 | 36.508 | 108.791 | 1.00 | 45.00 | | | | C |
| ANISOU | 4033 | CA | PHE | B | 51 | 5094 | 7629 | 4374 | 1011 | -187 | 32 | | | | C |
| ATOM | 4035 | CB | PHE | B | 51 | | 29.888 | 36.379 | 107.603 | 1.00 | 45.25 | | | | C |
| ANISOU | 4035 | CB | PHE | B | 51 | 5311 | 7375 | 4506 | 967 | -61 | 22 | | | | C |
| ATOM | 4038 | CG | PHE | B | 51 | | 29.946 | 35.053 | 106.959 | 1.00 | 45.85 | | | | C |
| ANISOU | 4038 | CG | PHE | B | 51 | 5483 | 7308 | 4632 | 1130 | 15 | 149 | | | | C |
| ATOM | 4039 | CD1 | PHE | B | 51 | | 29.601 | 33.927 | 107.679 | 1.00 | 47.06 | | | | C |
| ANISOU | 4039 | CD1 | PHE | B | 51 | 5730 | 7436 | 4717 | 1264 | -1 | 291 | | | | C |
| ATOM | 4041 | CE1 | PHE | B | 51 | | 29.666 | 32.689 | 107.107 | 1.00 | 48.15 | | | | C |
| ANISOU | 4041 | CE1 | PHE | B | 51 | 5975 | 7407 | 4912 | 1412 | 82 | 399 | | | | C |
| ATOM | 4043 | CZ | PHE | B | 51 | | 30.075 | 32.551 | 105.788 | 1.00 | 48.07 | | | | C |
| ANISOU | 4043 | CZ | PHE | B | 51 | 5980 | 7271 | 5013 | 1431 | 184 | 351 | | | | C |
| ATOM | 4045 | CE2 | PHE | B | 51 | | 30.441 | 33.670 | 105.048 | 1.00 | 47.64 | | | | C |
| ANISOU | 4045 | CE2 | PHE | B | 51 | 5822 | 7269 | 5010 | 1301 | 200 | 219 | | | | C |
| ATOM | 4047 | CD2 | PHE | B | 51 | | 30.391 | 34.914 | 105.643 | 1.00 | 46.70 | | | | C |
| ANISOU | 4047 | CD2 | PHE | B | 51 | 5593 | 7301 | 4849 | 1151 | 115 | 127 | | | | C |
| ATOM | 4049 | C | PHE | B | 51 | | 32.293 | 36.312 | 108.317 | 1.00 | 46.48 | | | | C |
| ANISOU | 4049 | C | PHE | B | 51 | 5083 | 7942 | 4635 | 1103 | -191 | 58 | | | | C |
| ATOM | 4050 | O | PHE | B | 51 | | 32.946 | 37.249 | 107.821 | 1.00 | 46.16 | | | | O |
| ANISOU | 4050 | O | PHE | B | 51 | 4908 | 7965 | 4668 | 981 | -182 | -57 | | | | O |
| ATOM | 4052 | N | HIS | B | 52 | | 32.787 | 35.091 | 108.460 | 1.00 | 46.77 | | | | N |
| ANISOU | 4052 | N | HIS | B | 52 | 5101 | 8007 | 4664 | 1322 | -192 | 217 | | | | N |
| ATOM | 4053 | CA | HIS | B | 52 | | 34.153 | 34.786 | 108.050 | 1.00 | 48.08 | | | | C |
| ANISOU | 4053 | CA | HIS | B | 52 | 5061 | 8301 | 4904 | 1452 | -183 | 263 | | | | C |
| ATOM | 4055 | CB | HIS | B | 52 | | 34.937 | 34.229 | 109.221 | 1.00 | 50.74 | | | | C |
| ANISOU | 4055 | CB | HIS | B | 52 | 5234 | 8907 | 5138 | 1615 | -316 | 394 | | | | C |
| ATOM | 4058 | CG | HIS | B | 52 | | 35.348 | 35.279 | 110.199 | 1.00 | 52.83 | | | | C |
| ANISOU | 4058 | CG | HIS | B | 52 | 5314 | 9468 | 5290 | 1457 | -473 | 288 | | | | C |
| ATOM | 4059 | ND1 | HIS | B | 52 | | 36.471 | 36.059 | 110.024 | 1.00 | 55.70 | | | | N |
| ANISOU | 4059 | ND1 | HIS | B | 52 | 5414 | 10046 | 5704 | 1365 | -522 | 192 | | | | N |
| ATOM | 4061 | CE1 | HIS | B | 52 | | 36.584 | 36.898 | 111.037 | 1.00 | 56.42 | | | | C |
| ANISOU | 4061 | CE1 | HIS | B | 52 | 5403 | 10368 | 5666 | 1206 | -666 | 88 | | | | C |
| ATOM | 4063 | NE2 | HIS | B | 52 | | 35.569 | 36.695 | 111.857 | 1.00 | 56.19 | | | | N |
| ANISOU | 4063 | NE2 | HIS | B | 52 | 5566 | 10287 | 5498 | 1206 | -704 | 115 | | | | N |
| ATOM | 4065 | CD2 | HIS | B | 52 | | 34.782 | 35.686 | 111.358 | 1.00 | 53.30 | | | | C |
| ANISOU | 4065 | CD2 | HIS | B | 52 | 5421 | 9647 | 5184 | 1359 | -584 | 249 | | | | C |
| ATOM | 4067 | C | HIS | B | 52 | | 34.185 | 33.847 | 106.839 | 1.00 | 46.07 | | | | C |
| ANISOU | 4067 | C | HIS | B | 52 | 4920 | 7812 | 4770 | 1595 | -26 | 330 | | | | C |
| ATOM | 4068 | O | HIS | B | 52 | | 33.668 | 32.724 | 106.880 | 1.00 | 43.63 | | | | O |
| ANISOU | 4068 | O | HIS | B | 52 | 4785 | 7337 | 4453 | 1740 | 23 | 449 | | | | O |
| ATOM | 4070 | N | PHE | B | 53 | | 34.808 | 34.342 | 105.771 | 1.00 | 44.86 | | | | N |
| ANISOU | 4070 | N | PHE | B | 53 | 4673 | 7648 | 4724 | 1538 | 61 | 245 | | | | N |
| ATOM | 4071 | CA | PHE | B | 53 | | 34.852 | 33.648 | 104.485 | 1.00 | 43.72 | | | | C |
| ANISOU | 4071 | CA | PHE | B | 53 | 4641 | 7293 | 4679 | 1637 | 227 | 262 | | | | C |
| ATOM | 4073 | CB | PHE | B | 53 | | 35.270 | 34.663 | 103.414 | 1.00 | 44.31 | | | | C |
| ANISOU | 4073 | CB | PHE | B | 53 | 4626 | 7379 | 4830 | 1477 | 307 | 136 | | | | C |
| ATOM | 4076 | CG | PHE | B | 53 | | 34.264 | 35.775 | 103.204 | 1.00 | 42.26 | | | | C |
| ANISOU | 4076 | CG | PHE | B | 53 | 4487 | 7018 | 4550 | 1226 | 294 | 20 | | | | C |
| ATOM | 4082 | C | PHE | B | 53 | | 35.772 | 32.390 | 104.458 | 1.00 | 47.45 | | | | C |
| ANISOU | 4082 | C | PHE | B | 53 | 5040 | 7791 | 5198 | 1930 | 281 | 403 | | | | C |
| ATOM | 4083 | O | PHE | B | 53 | | 35.770 | 31.630 | 103.471 | 1.00 | 46.83 | | | | O |
| ANISOU | 4083 | O | PHE | B | 53 | 5089 | 7511 | 5191 | 2041 | 433 | 415 | | | | O |
| ATOM | 4085 | N | ILE | B | 54 | | 36.560 | 32.171 | 105.521 | 1.00 | 48.19 | | | | N |

FIG. 18 (continued)

| | | | | | | | | | | | | | |
|---|---|---|---|---|---|---|---|---|---|---|---|---|---|
| ANISOU | 4085 | N | ILE | B | 54 | 4929 | 8132 | 5247 | 2064 | 160 | 507 | | N |
| ATOM | 4086 | CA | ILE | B | 54 | 37.402 | 30.960 | 105.654 | 1.00 | 49.38 | | | C |
| ANISOU | 4086 | CA | ILE | B | 54 | 5001 | 8317 | 5445 | 2379 | 198 | 674 | | C |
| ATOM | 4088 | CB | ILE | B | 54 | 38.908 | 31.260 | 105.434 | 1.00 | 51.56 | | | C |
| ANISOU | 4088 | CB | ILE | B | 54 | 4929 | 8868 | 5795 | 2467 | 198 | 678 | | C |
| ATOM | 4090 | CG1 | ILE | B | 54 | 39.164 | 31.784 | 104.017 | 1.00 | 50.05 | | | C |
| ANISOU | 4090 | CG1 | ILE | B | 54 | 4727 | 8581 | 5709 | 2355 | 364 | 538 | | C |
| ATOM | 4093 | CD1 | ILE | B | 54 | 40.550 | 32.357 | 103.863 | 1.00 | 52.59 | | | C |
| ANISOU | 4093 | CD1 | ILE | B | 54 | 4682 | 9204 | 6097 | 2360 | 356 | 519 | | C |
| ATOM | 4097 | CG2 | ILE | B | 54 | 39.794 | 30.018 | 105.738 | 1.00 | 51.38 | | | C |
| ANISOU | 4097 | CG2 | ILE | B | 54 | 4791 | 8912 | 5820 | 2832 | 222 | 878 | | C |
| ATOM | 4101 | C | ILE | B | 54 | 37.202 | 30.389 | 107.057 | 1.00 | 50.51 | | | C |
| ANISOU | 4101 | C | ILE | B | 54 | 5154 | 8566 | 5473 | 2501 | 54 | 834 | | C |
| ATOM | 4102 | O | ILE | B | 54 | 37.094 | 31.135 | 108.030 | 1.00 | 52.87 | | | O |
| ANISOU | 4102 | O | ILE | B | 54 | 5353 | 9083 | 5652 | 2362 | -107 | 804 | | O |
| ATOM | 4104 | N | ASN | B | 55 | 37.156 | 29.070 | 107.156 | 1.00 | 50.54 | | | N |
| ANISOU | 4104 | N | ASN | B | 55 | 5289 | 8408 | 5507 | 2757 | 122 | 1004 | | N |
| ATOM | 4105 | CA | ASN | B | 55 | 36.907 | 28.414 | 108.422 | 1.00 | 50.76 | | | C |
| ANISOU | 4105 | CA | ASN | B | 55 | 5363 | 8501 | 5424 | 2888 | 9 | 1190 | | C |
| ATOM | 4107 | CB | ASN | B | 55 | 36.137 | 27.084 | 108.209 | 1.00 | 51.76 | | | C |
| ANISOU | 4107 | CB | ASN | B | 55 | 5809 | 8257 | 5599 | 3040 | 144 | 1314 | | C |
| ATOM | 4110 | CG | ASN | B | 55 | 36.997 | 25.952 | 107.633 | 1.00 | 55.76 | | | C |
| ANISOU | 4110 | CG | ASN | B | 55 | 6303 | 8634 | 6251 | 3362 | 286 | 1437 | | C |
| ATOM | 4111 | OD1 | ASN | B | 55 | 38.159 | 26.139 | 107.290 | 1.00 | 56.74 | | | O |
| ANISOU | 4111 | OD1 | ASN | B | 55 | 6169 | 8944 | 6445 | 3485 | 299 | 1430 | | O |
| ATOM | 4112 | ND2 | ASN | B | 55 | 36.418 | 24.749 | 107.565 | 1.00 | 57.44 | | | N |
| ANISOU | 4112 | ND2 | ASN | B | 55 | 6796 | 8518 | 6512 | 3504 | 401 | 1554 | | N |
| ATOM | 4115 | C | ASN | B | 55 | 38.201 | 28.250 | 109.237 | 1.00 | 51.28 | | | C |
| ANISOU | 4115 | C | ASN | B | 55 | 5109 | 8922 | 5454 | 3102 | -120 | 1343 | | C |
| ATOM | 4116 | O | ASN | B | 55 | 39.325 | 28.594 | 108.782 | 1.00 | 49.85 | | | O |
| ANISOU | 4116 | O | ASN | B | 55 | 4654 | 8931 | 5355 | 3155 | -111 | 1302 | | O |
| ATOM | 4118 | N | GLU | B | 56 | 38.058 | 27.719 | 110.440 | 1.00 | 50.28 | | | N |
| ANISOU | 4118 | N | GLU | B | 56 | 5001 | 8904 | 5199 | 3225 | -240 | 1531 | | N |
| ATOM | 4119 | CA | GLU | B | 56 | 39.224 | 27.562 | 111.292 | 1.00 | 52.93 | | | C |
| ANISOU | 4119 | CA | GLU | B | 56 | 5028 | 9611 | 5472 | 3428 | -391 | 1696 | | C |
| ATOM | 4121 | CB | GLU | B | 56 | 38.815 | 27.363 | 112.766 | 1.00 | 56.23 | | | C |
| ANISOU | 4121 | CB | GLU | B | 56 | 5488 | 10206 | 5672 | 3452 | -565 | 1857 | | C |
| ATOM | 4124 | CG | GLU | B | 56 | 38.173 | 28.628 | 113.412 | 1.00 | 56.41 | | | C |
| ANISOU | 4124 | CG | GLU | B | 56 | 5508 | 10409 | 5515 | 3102 | -704 | 1662 | | C |
| ATOM | 4127 | CD | GLU | B | 56 | 39.157 | 29.818 | 113.667 | 1.00 | 59.35 | | | C |
| ANISOU | 4127 | CD | GLU | B | 56 | 5523 | 11196 | 5830 | 2943 | -867 | 1510 | | C |
| ATOM | 4128 | OE1 | GLU | B | 56 | 40.400 | 29.641 | 113.685 | 1.00 | 61.99 | | | O |
| ANISOU | 4128 | OE1 | GLU | B | 56 | 5555 | 11789 | 6209 | 3116 | -932 | 1603 | | O |
| ATOM | 4129 | OE2 | GLU | B | 56 | 38.659 | 30.954 | 113.872 | 1.00 | 60.51 | | | O |
| ANISOU | 4129 | OE2 | GLU | B | 56 | 5691 | 11411 | 5890 | 2635 | -928 | 1292 | | O |
| ATOM | 4130 | C | GLU | B | 56 | 40.160 | 26.442 | 110.778 | 1.00 | 52.13 | | | C |
| ANISOU | 4130 | C | GLU | B | 56 | 4844 | 9430 | 5533 | 3799 | -269 | 1875 | | C |
| ATOM | 4131 | O | GLU | B | 56 | 41.328 | 26.386 | 111.142 | 1.00 | 51.84 | | | O |
| ANISOU | 4131 | O | GLU | B | 56 | 4486 | 9712 | 5500 | 3984 | -363 | 1990 | | O |
| ATOM | 4133 | N | GLN | B | 57 | 39.651 | 25.564 | 109.920 | 1.00 | 48.47 | | | N |
| ANISOU | 4133 | N | GLN | B | 57 | 4664 | 8546 | 5207 | 3907 | -55 | 1889 | | N |
| ATOM | 4134 | CA | GLN | B | 57 | 40.466 | 24.495 | 109.357 | 1.00 | 49.92 | | | C |
| ANISOU | 4134 | CA | GLN | B | 57 | 4811 | 8598 | 5559 | 4262 | 98 | 2031 | | C |
| ATOM | 4136 | CB | GLN | B | 57 | 39.612 | 23.251 | 109.149 | 1.00 | 51.22 | | | C |
| ANISOU | 4136 | CB | GLN | B | 57 | 5370 | 8301 | 5791 | 4399 | 264 | 2138 | | C |
| ATOM | 4139 | CG | GLN | B | 57 | 39.048 | 22.666 | 110.451 | 1.00 | 54.11 | | | C |
| ANISOU | 4139 | CG | GLN | B | 57 | 5867 | 8673 | 6018 | 4478 | 146 | 2375 | | C |
| ATOM | 4142 | CD | GLN | B | 57 | 37.719 | 23.251 | 110.886 | 1.00 | 50.52 | | | C |
| ANISOU | 4142 | CD | GLN | B | 57 | 5621 | 8161 | 5414 | 4137 | 72 | 2265 | | C |
| ATOM | 4143 | OE1 | GLN | B | 57 | 37.100 | 24.078 | 110.209 | 1.00 | 52.78 | | | O |
| ANISOU | 4143 | OE1 | GLN | B | 57 | 5979 | 8370 | 5707 | 3839 | 107 | 2013 | | O |
| ATOM | 4144 | NE2 | GLN | B | 57 | 37.280 | 22.832 | 112.051 | 1.00 | 55.51 | | | N |
| ANISOU | 4144 | NE2 | GLN | B | 57 | 6340 | 8846 | 5905 | 4191 | -28 | 2468 | | N |
| ATOM | 4147 | C | GLN | B | 57 | 41.155 | 24.919 | 108.052 | 1.00 | 47.25 | | | C |
| ANISOU | 4147 | C | GLN | B | 57 | 4331 | 8248 | 5373 | 4232 | 246 | 1845 | | C |
| ATOM | 4148 | O | GLN | B | 57 | 41.773 | 24.103 | 107.384 | 1.00 | 49.15 | | | O |
| ANISOU | 4148 | O | GLN | B | 57 | 4565 | 8345 | 5766 | 4506 | 417 | 1912 | | O |
| ATOM | 4150 | N | GLY | B | 58 | 41.029 | 26.198 | 107.718 | 1.00 | 47.25 | | | N |
| ANISOU | 4150 | N | GLY | B | 58 | 4231 | 8392 | 5329 | 3902 | 190 | 1619 | | N |
| ATOM | 4151 | CA | GLY | B | 58 | 41.736 | 26.821 | 106.619 | 1.00 | 48.48 | | | C |
| ANISOU | 4151 | CA | GLY | B | 58 | 4209 | 8615 | 5597 | 3827 | 301 | 1453 | | C |
| ATOM | 4154 | C | GLY | B | 58 | 41.100 | 26.640 | 105.256 | 1.00 | 47.34 | | | C |
| ANISOU | 4154 | C | GLY | B | 58 | 4355 | 8087 | 5547 | 3741 | 532 | 1294 | | C |
| ATOM | 4155 | O | GLY | B | 58 | 41.795 | 26.732 | 104.254 | 1.00 | 47.90 | | | O |
| ANISOU | 4155 | O | GLY | B | 58 | 4313 | 8161 | 5725 | 3791 | 682 | 1212 | | O |
| ATOM | 4157 | N | GLU | B | 59 | 39.790 | 26.392 | 105.224 | 1.00 | 48.54 | | | N |
| ANISOU | 4157 | N | GLU | B | 59 | 4863 | 7933 | 5646 | 3605 | 558 | 1251 | | N |
| ATOM | 4158 | CA | GLU | B | 59 | 39.046 | 26.171 | 103.981 | 1.00 | 50.56 | | | C |
| ANISOU | 4158 | CA | GLU | B | 59 | 5418 | 7831 | 5962 | 3502 | 751 | 1100 | | C |

FIG. 18 (continued)

```
ATOM   4160  CB  GLU B  59      38.381  24.804 103.980  1.00 51.10          C
ANISOU 4160  CB  GLU B  59    5816   7531   6068   3675    863   1204       C
ATOM   4163  CG  GLU B  59      39.263  23.653 104.251  1.00 55.45          C
ANISOU 4163  CG  GLU B  59    6302   8051   6716   4070    939   1403       C
ATOM   4166  CD  GLU B  59      38.662  22.354 103.780  1.00 56.51          C
ANISOU 4166  CD  GLU B  59    6805   7734   6932   4209   1127   1436       C
ATOM   4167  OE1 GLU B  59      38.838  21.301 104.441  1.00 57.39          O
ANISOU 4167  OE1 GLU B  59    6985   7733   7089   4487   1146   1652       O
ATOM   4168  OE2 GLU B  59      38.024  22.401 102.716  1.00 56.70          O
ANISOU 4168  OE2 GLU B  59    7055   7515   6973   4032   1260   1242       O
ATOM   4169  C   GLU B  59      37.935  27.164 103.754  1.00 50.90          C
ANISOU 4169  C   GLU B  59    5607   7815   5919   3133    695    927       C
ATOM   4170  O   GLU B  59      37.332  27.698 104.699  1.00 50.93          O
ANISOU 4170  O   GLU B  59    5610   7928   5812   2977    529    942       O
ATOM   4172  N   SER B  60      37.615  27.388 102.488  1.00 54.45          N
ANISOU 4172  N   SER B  60    6195   8083   6410   3002    842    765       N
ATOM   4173  CA  SER B  60      36.305  27.976 102.134  1.00 55.07          C
ANISOU 4173  CA  SER B  60    6501   8004   6419   2703    822    632       C
ATOM   4175  CB  SER B  60      36.214  28.258 100.641  1.00 54.14          C
ANISOU 4175  CB  SER B  60    6483   7751   6337   2589    982    469       C
ATOM   4178  OG  SER B  60      36.515  27.089  99.884  1.00 57.54          O
ANISOU 4178  OG  SER B  60    7059   7964   6841   2803   1171    479       O
ATOM   4180  C   SER B  60      35.166  27.027 102.563  1.00 56.79          C
ANISOU 4180  C   SER B  60    7021   7952   6604   2722    821    707       C
ATOM   4181  O   SER B  60      35.277  25.799 102.436  1.00 59.14          O
ANISOU 4181  O   SER B  60    7464   8041   6965   2938    933    794       O
ATOM   4183  N   ILE B  61      34.082  27.602 103.087  1.00 57.68          N
ANISOU 4183  N   ILE B  61    7225   8065   6627   2497    706    675       N
ATOM   4184  CA  ILE B  61      32.922  26.831 103.561  1.00 58.00          C
ANISOU 4184  CA  ILE B  61    7526   7883   6630   2469    699    748       C
ATOM   4186  CB  ILE B  61      32.813  26.891 105.104  1.00 59.32          C
ANISOU 4186  CB  ILE B  61    7603   8232   6705   2505    538    896       C
ATOM   4188  CG1 ILE B  61      33.040  28.339 105.593  1.00 58.58          C
ANISOU 4188  CG1 ILE B  61    7273   8454   6531   2333    391    809       C
ATOM   4191  CD1 ILE B  61      32.517  28.601 106.991  1.00 58.25          C
ANISOU 4191  CD1 ILE B  61    7211   8564   6357   2273    241    889       C
ATOM   4195  CG2 ILE B  61      33.772  25.912 105.736  1.00 61.56          C
ANISOU 4195  CG2 ILE B  61    7802   8566   7022   2821    543   1094       C
ATOM   4199  C   ILE B  61      31.574  27.301 102.960  1.00 56.45          C
ANISOU 4199  C   ILE B  61    7524   7531   6394   2187    709    611       C
ATOM   4200  O   ILE B  61      30.516  26.955 103.489  1.00 55.75          O
ANISOU 4200  O   ILE B  61    7598   7324   6260   2104    674    660       O
ATOM   4202  N   VAL B  62      31.625  28.052 101.855  1.00 55.33          N
ANISOU 4202  N   VAL B  62    7358   7398   6267   2050    762    457       N
ATOM   4203  CA  VAL B  62      30.434  28.627 101.176  1.00 54.73          C
ANISOU 4203  CA  VAL B  62    7429   7216   6150   1793    760    336       C
ATOM   4205  CB  VAL B  62      30.808  29.129  99.716  1.00 54.39          C
ANISOU 4205  CB  VAL B  62    7378   7160   6129   1722    865    198       C
ATOM   4207  CG1 VAL B  62      29.557  29.396  98.870  1.00 51.54          C
ANISOU 4207  CG1 VAL B  62    7206   6658   5718   1499    876     99       C
ATOM   4211  CG2 VAL B  62      31.707  30.395  99.770  1.00 53.58          C
ANISOU 4211  CG2 VAL B  62    7004   7319   6033   1679    815    162       C
ATOM   4215  C   VAL B  62      29.158  27.726 101.103  1.00 55.20          C
ANISOU 4215  C   VAL B  62    7765   7014   6194   1719    793    352       C
ATOM   4216  O   VAL B  62      28.047  28.246 101.057  1.00 52.37          O
ANISOU 4216  O   VAL B  62    7474   6636   5788   1514    737    303       O
ATOM   4218  N   VAL B  63      29.310  26.397 101.079  1.00 58.13          N
ANISOU 4218  N   VAL B  63    8289   7182   6616   1881    890    420       N
ATOM   4219  CA  VAL B  63      28.137  25.480 101.040  1.00 59.00          C
ANISOU 4219  CA  VAL B  63    8664   7028   6725   1789    928    435       C
ATOM   4221  CB  VAL B  63      28.440  24.166 100.258  1.00 61.81          C
ANISOU 4221  CB  VAL B  63    9230   7097   7157   1924   1098    409       C
ATOM   4223  CG1 VAL B  63      27.189  23.282 100.106  1.00 61.42          C
ANISOU 4223  CG1 VAL B  63    9461   6765   7110   1773   1140    393       C
ATOM   4227  CG2 VAL B  63      28.974  24.520  98.890  1.00 62.15          C
ANISOU 4227  CG2 VAL B  63    9261   7151   7202   1905   1193    244       C
ATOM   4231  C   VAL B  63      27.541  25.182 102.440  1.00 58.62          C
ANISOU 4231  C   VAL B  63    8630   6999   6644   1795    839    594       C
ATOM   4232  O   VAL B  63      26.523  24.504 102.541  1.00 57.30          O
ANISOU 4232  O   VAL B  63    8657   6637   6476   1693    865    622       O
ATOM   4234  N   GLU B  64      28.139  25.717 103.503  1.00 59.48          N
ANISOU 4234  N   GLU B  64    8534   7356   6712   1890    735    692       N
ATOM   4235  CA  GLU B  64      27.464  25.734 104.809  1.00 61.04          C
ANISOU 4235  CA  GLU B  64    8728   7631   6832   1848    638    817       C
ATOM   4237  CB  GLU B  64      28.368  26.319 105.881  1.00 62.22          C
ANISOU 4237  CB  GLU B  64    8638   8085   6918   1971    522    903       C
ATOM   4240  CG  GLU B  64      29.440  25.345 106.325  1.00 65.67          C
ANISOU 4240  CG  GLU B  64    9038   8518   7394   2265    551   1071       C
ATOM   4243  CD  GLU B  64      30.084  25.744 107.625  1.00 67.47          C
```

FIG. 18 (continued)

```
ANISOU 4243  CD  GLU B  64    9055   9060   7521   2369    409   1194        C
ATOM   4244  OE1 GLU B  64     29.346  26.162 108.551  1.00 69.21           O
ANISOU 4244  OE1 GLU B  64    9279   9393   7624   2244    317   1225        O
ATOM   4245  OE2 GLU B  64     31.322  25.621 107.738  1.00 70.50           O
ANISOU 4245  OE2 GLU B  64    9262   9592   7933   2576    388   1260        O
ATOM   4246  C   GLU B  64     26.147  26.500 104.770  1.00 59.40           C
ANISOU 4246  C   GLU B  64    8560   7442   6567   1578    585    727        C
ATOM   4247  O   GLU B  64     25.245  26.239 105.554  1.00 60.15           O
ANISOU 4247  O   GLU B  64    8732   7509   6616   1505    559    812        O
ATOM   4249  N   LEU B  65     26.046  27.440 103.844  1.00 57.94           N
ANISOU 4249  N   LEU B  65    8317   7309   6389   1441    579    569        N
ATOM   4250  CA  LEU B  65     24.883  28.281 103.731  1.00 58.05           C
ANISOU 4250  CA  LEU B  65    8337   7359   6360   1215    528    491        C
ATOM   4252  CB  LEU B  65     25.287  29.601 103.030  1.00 57.54           C
ANISOU 4252  CB  LEU B  65    8127   7439   6298   1138    498    359        C
ATOM   4255  CG  LEU B  65     26.193  30.512 103.902  1.00 57.38           C
ANISOU 4255  CG  LEU B  65    7887   7671   6246   1204    414    369        C
ATOM   4257  CD1 LEU B  65     27.502  30.917 103.190  1.00 58.51           C
ANISOU 4257  CD1 LEU B  65    7894   7899   6439   1282    445    306        C
ATOM   4261  CD2 LEU B  65     25.443  31.740 104.392  1.00 54.74           C
ANISOU 4261  CD2 LEU B  65    7478   7460   5861   1045    336    310        C
ATOM   4265  C   LEU B  65     23.682  27.567 103.051  1.00 57.91           C
ANISOU 4265  C   LEU B  65    8528   7110   6363   1068    589    462        C
ATOM   4266  O   LEU B  65     22.535  27.878 103.349  1.00 53.99           O
ANISOU 4266  O   LEU B  65    8050   6632   5833    910    547    464        O
ATOM   4268  N   ASP B  66     23.932  26.601 102.166  1.00 60.65           N
ANISOU 4268  N   ASP B  66    9029   7248   6765   1115    689    429        N
ATOM   4269  CA  ASP B  66     22.831  25.817 101.547  1.00 62.08           C
ANISOU 4269  CA  ASP B  66    9420   7206   6962    955    742    388        C
ATOM   4271  CB  ASP B  66     23.014  25.674 100.025  1.00 62.50           C
ANISOU 4271  CB  ASP B  66    9574   7146   7028    902    815    234        C
ATOM   4274  CG  ASP B  66     22.462  26.869  99.260  1.00 60.91           C
ANISOU 4274  CG  ASP B  66    9283   7090   6769    724    745    126        C
ATOM   4275  OD1 ASP B  66     22.224  27.904  99.925  1.00 56.07           O
ANISOU 4275  OD1 ASP B  66    8507   6667   6131    688    654    165        O
ATOM   4276  OD2 ASP B  66     22.273  26.767  98.012  1.00 61.24           O
ANISOU 4276  OD2 ASP B  66    9426   7057   6785    626    786      7        O
ATOM   4277  C   ASP B  66     22.675  24.434 102.159  1.00 65.38           C
ANISOU 4277  C   ASP B  66   10009   7409   7425   1030    812    511        C
ATOM   4278  O   ASP B  66     21.699  23.736 101.864  1.00 67.46           O
ANISOU 4278  O   ASP B  66   10444   7484   7706    873    852    492        O
ATOM   4280  N   ASP B  67     23.620  24.049 103.015  1.00 66.80           N
ANISOU 4280  N   ASP B  67   10138   7621   7623   1261    824    646        N
ATOM   4281  CA  ASP B  67     23.653  22.714 103.595  1.00 69.19           C
ANISOU 4281  CA  ASP B  67   10607   7704   7978   1380    905    795        C
ATOM   4283  CB  ASP B  67     24.459  21.787 102.658  1.00 71.61           C
ANISOU 4283  CB  ASP B  67   11060   7771   8379   1531   1043    737        C
ATOM   4286  CG  ASP B  67     24.070  20.315 102.775  1.00 74.64           C
ANISOU 4286  CG  ASP B  67   11713   7804   8844   1554   1164    821        C
ATOM   4287  OD1 ASP B  67     23.354  19.941 103.738  1.00 75.68           O
ANISOU 4287  OD1 ASP B  67   11899   7895   8962   1493   1141    971        O
ATOM   4288  OD2 ASP B  67     24.495  19.529 101.889  1.00 76.89           O
ANISOU 4288  OD2 ASP B  67   12163   7843   9208   1631   1296    732        O
ATOM   4289  C   ASP B  67     24.289  22.830 104.989  1.00 70.12           C
ANISOU 4289  C   ASP B  67   10581   8011   8050   1572    836    986        C
ATOM   4290  O   ASP B  67     25.330  22.224 105.263  1.00 71.65           O
ANISOU 4290  O   ASP B  67   10765   8172   8286   1824    878   1094        O
ATOM   4292  N   PRO B  68     23.662  23.620 105.882  1.00 69.81           N
ANISOU 4292  N   PRO B  68   10425   8187   7914   1460    732   1027        N
ATOM   4293  CA  PRO B  68     24.272  23.953 107.175  1.00 71.20           C
ANISOU 4293  CA  PRO B  68   10443   8607   8003   1611    643   1171        C
ATOM   4295  CB  PRO B  68     23.243  24.893 107.835  1.00 69.68           C
ANISOU 4295  CB  PRO B  68   10170   8599   7706   1412    560   1142        C
ATOM   4298  CG  PRO B  68     21.951  24.585 107.170  1.00 69.29           C
ANISOU 4298  CG  PRO B  68   10273   8348   7705   1189    623   1074        C
ATOM   4301  CD  PRO B  68     22.327  24.224 105.740  1.00 68.95           C
ANISOU 4301  CD  PRO B  68   10323   8110   7764   1191    694    941        C
ATOM   4304  C   PRO B  68     24.537  22.753 108.082  1.00 74.71           C
ANISOU 4304  C   PRO B  68   10995   8938   8452   1798    689   1408        C
ATOM   4305  O   PRO B  68     23.866  21.719 107.981  1.00 75.25           O
ANISOU 4305  O   PRO B  68   11282   8728   8583   1749    788   1478        O
ATOM   4306  N   ASN B  69     25.540  22.917 108.940  1.00 76.79           N
ANISOU 4306  N   ASN B  69   11103   9425   8651   2007    612   1531        N
ATOM   4307  CA  ASN B  69     25.799  22.019 110.069  1.00 80.02           C
ANISOU 4307  CA  ASN B  69   11566   9823   9015   2197    615   1795        C
ATOM   4309  CB  ASN B  69     27.314  21.958 110.358  1.00 82.66           C
ANISOU 4309  CB  ASN B  69   11727  10333   9348   2494    560   1894        C
ATOM   4312  CG  ASN B  69     28.010  23.312 110.167  1.00 81.51           C
ANISOU 4312  CG  ASN B  69   11309  10514   9148   2452    441   1721        C
```

FIG. 18 (continued)

```
ATOM   4313  OD1 ASN B  69      28.846  23.460 109.272  1.00 81.67          O
ANISOU 4313  OD1 ASN B  69   11243  10524   9265   2534    474   1615       O
ATOM   4314  ND2 ASN B  69      27.645  24.306 110.988  1.00 79.62          N
ANISOU 4314  ND2 ASN B  69   10945  10552   8757   2313    318   1683       N
ATOM   4317  C   ASN B  69      24.985  22.568 111.244  1.00 78.84          C
ANISOU 4317  C   ASN B  69   11368   9889   8700   2061    529   1864       C
ATOM   4318  O   ASN B  69      23.934  23.173 111.010  1.00 77.42          O
ANISOU 4318  O   ASN B  69   11207   9711   8499   1815    529   1728       O
ATOM   4320  N   ALA B  70      25.436  22.365 112.486  1.00 79.88          N
ANISOU 4320  N   ALA B  70   11436  10210   8705   2222    460   2073       N
ATOM   4321  CA  ALA B  70      24.869  23.087 113.638  1.00 78.65          C
ANISOU 4321  CA  ALA B  70   11197  10334   8352   2109    367   2105       C
ATOM   4323  CB  ALA B  70      25.785  22.957 114.847  1.00 80.90          C
ANISOU 4323  CB  ALA B  70   11365  10892   8481   2332    261   2311       C
ATOM   4327  C   ALA B  70      24.614  24.578 113.306  1.00 75.70          C
ANISOU 4327  C   ALA B  70   10661  10165   7936   1911    290   1838       C
ATOM   4328  O   ALA B  70      25.434  25.230 112.636  1.00 74.53          O
ANISOU 4328  O   ALA B  70   10371  10103   7844   1943    241   1687       O
ATOM   4330  N   LEU B  71      23.478  25.109 113.759  1.00 73.85          N
ANISOU 4330  N   LEU B  71   10450   9998   7613   1712    293   1787       N
ATOM   4331  CA  LEU B  71      23.069  26.475 113.376  1.00 70.57          C
ANISOU 4331  CA  LEU B  71    9914   9714   7185   1526    248   1542       C
ATOM   4333  CB  LEU B  71      21.548  26.551 113.107  1.00 69.02          C
ANISOU 4333  CB  LEU B  71    9823   9378   7024   1303    332   1484       C
ATOM   4336  CG  LEU B  71      21.153  26.202 111.663  1.00 67.43          C
ANISOU 4336  CG  LEU B  71    9720   8893   7007   1206    410   1381       C
ATOM   4338  CD1 LEU B  71      19.717  25.739 111.581  1.00 67.12          C
ANISOU 4338  CD1 LEU B  71    9809   8693   7002   1020    497   1414       C
ATOM   4342  CD2 LEU B  71      21.401  27.385 110.725  1.00 64.97          C
ANISOU 4342  CD2 LEU B  71    9281   8654   6750   1130    361   1153       C
ATOM   4346  C   LEU B  71      23.510  27.557 114.379  1.00 69.92          C
ANISOU 4346  C   LEU B  71    9654   9989   6922   1533    125   1484       C
ATOM   4347  O   LEU B  71      24.238  28.486 113.998  1.00 69.86          O
ANISOU 4347  O   LEU B  71    9495  10114   6934   1525     52   1321       O
ATOM   4349  N   LEU B  72      23.093  27.421 115.638  1.00 69.38          N
ANISOU 4349  N   LEU B  72    9611  10074   6674   1538    109   1614       N
ATOM   4350  CA  LEU B  72      23.277  28.466 116.655  1.00 69.10          C
ANISOU 4350  CA  LEU B  72    9440  10375   6438   1503      7   1530       C
ATOM   4352  CB  LEU B  72      22.355  28.230 117.876  1.00 70.15          C
ANISOU 4352  CB  LEU B  72    9659  10613   6380   1458     48   1661       C
ATOM   4355  CG  LEU B  72      20.927  27.673 117.739  1.00 69.69          C
ANISOU 4355  CG  LEU B  72    9757  10336   6385   1329    195   1732       C
ATOM   4357  CD1 LEU B  72      20.314  27.486 119.137  1.00 70.96          C
ANISOU 4357  CD1 LEU B  72    9968  10679   6315   1318    226   1883       C
ATOM   4361  CD2 LEU B  72      20.007  28.534 116.869  1.00 66.94          C
ANISOU 4361  CD2 LEU B  72    9382   9885   6166   1136    250   1506       C
ATOM   4365  C   LEU B  72      24.736  28.540 117.124  1.00 69.61          C
ANISOU 4365  C   LEU B  72    9356  10682   6411   1674   -130   1578       C
ATOM   4366  O   LEU B  72      25.078  28.083 118.225  1.00 71.28          O
ANISOU 4366  O   LEU B  72    9561  11081   6441   1794   -191   1761       O
ATOM   4368  N   LYS B  73      25.593  29.129 116.291  1.00 66.79          N
ANISOU 4368  N   LYS B  73    8865  10339   6171   1681   -180   1421       N
ATOM   4369  CA  LYS B  73      27.027  29.203 116.570  1.00 66.88          C
ANISOU 4369  CA  LYS B  73    8698  10582   6131   1833   -308   1456       C
ATOM   4371  CB  LYS B  73      27.824  28.859 115.307  1.00 66.45          C
ANISOU 4371  CB  LYS B  73    8599  10349   6298   1931   -268   1432       C
ATOM   4374  CG  LYS B  73      27.549  27.473 114.714  1.00 66.74          C
ANISOU 4374  CG  LYS B  73    8823  10055   6479   2057   -137   1607       C
ATOM   4377  CD  LYS B  73      28.340  26.387 115.382  1.00 69.96          C
ANISOU 4377  CD  LYS B  73    9225  10520   6837   2322   -170   1878       C
ATOM   4380  CE  LYS B  73      28.325  25.100 114.562  1.00 70.69          C
ANISOU 4380  CE  LYS B  73    9492  10244   7121   2463    -25   2006       C
ATOM   4383  NZ  LYS B  73      28.640  23.897 115.411  1.00 74.43          N
ANISOU 4383  NZ  LYS B  73   10044  10699   7538   2704    -21   2324       N
ATOM   4387  C   LYS B  73      27.467  30.587 117.085  1.00 64.84          C
ANISOU 4387  C   LYS B  73    8258  10637   5741   1712   -434   1248       C
ATOM   4388  O   LYS B  73      28.325  30.681 117.971  1.00 65.17          O
ANISOU 4388  O   LYS B  73    8164  10981   5617   1796   -569   1305       O
ATOM   4390  N   HIS B  74      26.892  31.649 116.519  1.00 59.12          N
ANISOU 4390  N   HIS B  74    7534   9837   5092   1516   -390   1011       N
ATOM   4391  CA  HIS B  74      27.396  33.009 116.740  1.00 56.19          C
ANISOU 4391  CA  HIS B  74    7004   9687   4658   1387   -484    782       C
ATOM   4393  CB  HIS B  74      28.065  33.519 115.445  1.00 55.89          C
ANISOU 4393  CB  HIS B  74    6865   9535   4834   1347   -466    643       C
ATOM   4396  CG  HIS B  74      28.983  32.523 114.783  1.00 56.90          C
ANISOU 4396  CG  HIS B  74    6945   9589   5085   1538   -458    795       C
ATOM   4397  ND1 HIS B  74      30.004  31.879 115.454  1.00 60.03          N
ANISOU 4397  ND1 HIS B  74    7222  10196   5389   1723   -560    960       N
ATOM   4399  CE1 HIS B  74      30.646  31.080 114.618  1.00 60.63          C
```

FIG. 18 (continued)

```
ANISOU 4399  CE1 HIS B  74    7279  10133   5625   1886   -505   1063    C
ATOM   4401  NE2 HIS B  74     30.092  31.193 113.423  1.00 58.32        N
ANISOU 4401  NE2 HIS B  74    7096   9556   5507   1795   -376    957    N
ATOM   4403  CD2 HIS B  74     29.053  32.092 113.498  1.00 57.11        C
ANISOU 4403  CD2 HIS B  74    7022   9361   5315   1579   -354    800    C
ATOM   4405  C   HIS B  74     26.265  33.947 117.197  1.00 53.91        C
ANISOU 4405  C   HIS B  74    6792   9408   4283   1203   -437    619    C
ATOM   4406  O   HIS B  74     25.120  33.514 117.278  1.00 56.23        O
ANISOU 4406  O   HIS B  74    7236   9553   4575   1182   -334    695    O
ATOM   4408  N   ARG B  75     26.566  35.217 117.491  1.00 50.06        N
ANISOU 4408  N   ARG B  75    6201   9086   3734   1069   -501    394    N
ATOM   4409  CA  ARG B  75     25.518  36.201 117.841  1.00 47.87        C
ANISOU 4409  CA  ARG B  75    5998   8788   3403    910   -434    216    C
ATOM   4411  CB  ARG B  75     26.106  37.580 118.133  1.00 48.18        C
ANISOU 4411  CB  ARG B  75    5922   8993   3389    769   -509    -43    C
ATOM   4414  CG  ARG B  75     25.055  38.694 117.966  1.00 46.43        C
ANISOU 4414  CG  ARG B  75    5785   8627   3230    620   -396   -248    C
ATOM   4417  CD  ARG B  75     25.462  39.994 118.570  1.00 47.49        C
ANISOU 4417  CD  ARG B  75    5855   8921   3268    477   -452   -506    C
ATOM   4420  NE  ARG B  75     24.409  41.000 118.419  1.00 45.25        N
ANISOU 4420  NE  ARG B  75    5667   8468   3059    370   -321   -682    N
ATOM   4422  CZ  ARG B  75     24.546  42.266 118.793  1.00 45.70        C
ANISOU 4422  CZ  ARG B  75    5711   8572   3081    232   -322   -939    C
ATOM   4423  NH1 ARG B  75     25.679  42.674 119.344  1.00 49.27        N
ANISOU 4423  NH1 ARG B  75    6055   9252   3414    155   -457  -1060    N
ATOM   4426  NH2 ARG B  75     23.554  43.124 118.631  1.00 43.74        N
ANISOU 4426  NH2 ARG B  75    5555   8145   2920    169   -186  -1076    N
ATOM   4429  C   ARG B  75     24.428  36.435 116.776  1.00 42.11        C
ANISOU 4429  C   ARG B  75    5371   7750   2880    834   -290    160    C
ATOM   4430  O   ARG B  75     23.306  36.795 117.118  1.00 38.43        O
ANISOU 4430  O   ARG B  75    4990   7239   2371    763   -205    108    O
ATOM   4432  N   PHE B  76     24.807  36.361 115.504  1.00 38.98        N
ANISOU 4432  N   PHE B  76    4946   7172   2692    843   -266    153    N
ATOM   4433  CA  PHE B  76     23.886  36.475 114.393  1.00 37.35        C
ANISOU 4433  CA  PHE B  76    4825   6697   2669    782   -153    125    C
ATOM   4435  CB  PHE B  76     24.377  37.535 113.387  1.00 37.26        C
ANISOU 4435  CB  PHE B  76    4736   6610   2813    692   -151    -46    C
ATOM   4438  CG  PHE B  76     24.342  38.944 113.927  1.00 37.60        C
ANISOU 4438  CG  PHE B  76    4730   6751   2805    566   -167   -255    C
ATOM   4439  CD1 PHE B  76     23.126  39.614 114.070  1.00 37.76        C
ANISOU 4439  CD1 PHE B  76    4831   6681   2834    491    -79   -338    C
ATOM   4441  CE1 PHE B  76     23.074  40.916 114.603  1.00 37.63        C
ANISOU 4441  CE1 PHE B  76    4793   6727   2778    387    -72   -544    C
ATOM   4443  CZ  PHE B  76     24.266  41.569 114.985  1.00 39.10        C
ANISOU 4443  CZ  PHE B  76    4875   7071   2909    323   -167   -681    C
ATOM   4445  CE2 PHE B  76     25.495  40.917 114.817  1.00 39.93        C
ANISOU 4445  CE2 PHE B  76    4871   7294   3005    381   -270   -592    C
ATOM   4447  CD2 PHE B  76     25.524  39.600 114.302  1.00 39.05        C
ANISOU 4447  CD2 PHE B  76    4783   7116   2937    519   -264   -374    C
ATOM   4449  C   PHE B  76     23.795  35.129 113.697  1.00 37.37        C
ANISOU 4449  C   PHE B  76    4910   6525   2765    886   -108    315    C
ATOM   4450  O   PHE B  76     24.806  34.458 113.536  1.00 39.81        O
ANISOU 4450  O   PHE B  76    5169   6867   3090   1002   -156    407    O
ATOM   4452  N   GLU B  77     22.583  34.733 113.301  1.00 37.63        N
ANISOU 4452  N   GLU B  77    5062   6375   2861    843    -11    368    N
ATOM   4453  CA  GLU B  77     22.369  33.693 112.286  1.00 35.36        C
ANISOU 4453  CA  GLU B  77    4868   5861   2706    881     49    478    C
ATOM   4455  CB  GLU B  77     21.067  32.902 112.549  1.00 37.09        C
ANISOU 4455  CB  GLU B  77    5217   5969   2908    845    130    599    C
ATOM   4458  CG  GLU B  77     21.069  31.461 112.001  1.00 38.39        C
ANISOU 4458  CG  GLU B  77    5502   5932   3150    911    179    756    C
ATOM   4461  CD  GLU B  77     22.079  30.535 112.737  1.00 41.58        C
ANISOU 4461  CD  GLU B  77    5914   6410   3474   1088    137    920    C
ATOM   4462  OE1 GLU B  77     22.060  30.482 113.994  1.00 41.91        O
ANISOU 4462  OE1 GLU B  77    5941   6630   3352   1130    103   1007    O
ATOM   4463  OE2 GLU B  77     22.893  29.858 112.064  1.00 42.31        O
ANISOU 4463  OE2 GLU B  77    6025   6390   3659   1197    143    968    O
ATOM   4464  C   GLU B  77     22.242  34.442 110.974  1.00 32.33        C
ANISOU 4464  C   GLU B  77    4463   5343   2477    791     80    342    C
ATOM   4465  O   GLU B  77     21.543  35.442 110.918  1.00 27.76        O
ANISOU 4465  O   GLU B  77    3864   4767   1915    686    101    230    O
ATOM   4467  N   ILE B  78     22.914  33.977 109.927  1.00 31.10        N
ANISOU 4467  N   ILE B  78    4315   5073   2429    840     92    358    N
ATOM   4468  CA  ILE B  78     22.853  34.671 108.634  1.00 31.78        C
ANISOU 4468  CA  ILE B  78    4387   5047   2639    756    123    245    C
ATOM   4470  CB  ILE B  78     24.206  34.667 107.852  1.00 35.29        C
ANISOU 4470  CB  ILE B  78    4756   5499   3154    823    112    213    C
ATOM   4472  CG1 ILE B  78     25.361  34.908 108.809  1.00 38.71        C
ANISOU 4472  CG1 ILE B  78    5049   6151   3508    899     30    210    C
```

FIG. 18 (continued)

```
ATOM    4475  CD1 ILE B  78      26.674  35.168 108.116  1.00 40.34           C
ANISOU 4475  CD1 ILE B  78     5131   6408   3789    939     19    161   C
ATOM    4479  CG2 ILE B  78      24.181  35.757 106.725  1.00 33.14           C
ANISOU 4479  CG2 ILE B  78     4448   5166   2978    713    140     86   C
ATOM    4483  C   ILE B  78      21.787  33.923 107.872  1.00 29.58           C
ANISOU 4483  C   ILE B  78     4242   4574   2422    706    191    302   C
ATOM    4484  O   ILE B  78      21.746  32.688 107.905  1.00 27.81           O
ANISOU 4484  O   ILE B  78     4116   4255   2197    769    220    416   O
ATOM    4486  N   ILE B  79      20.875  34.670 107.262  1.00 27.98           N
ANISOU 4486  N   ILE B  79     4045   4316   2271    590    214    230   N
ATOM    4487  CA  ILE B  79      19.798  34.091 106.462  1.00 26.94           C
ANISOU 4487  CA  ILE B  79     4013   4033   2191    512    259    268   C
ATOM    4489  CB  ILE B  79      18.376  34.604 106.919  1.00 25.79           C
ANISOU 4489  CB  ILE B  79     3849   3921   2027    416    275    268   C
ATOM    4491  CG1 ILE B  79      18.045  34.180 108.361  1.00 26.42           C
ANISOU 4491  CG1 ILE B  79     3937   4096   2006    449    285    348   C
ATOM    4494  CD1 ILE B  79      16.999  35.127 109.046  1.00 25.22           C
ANISOU 4494  CD1 ILE B  79     3719   4043   1820    390    310    305   C
ATOM    4498  CG2 ILE B  79      17.290  34.108 105.939  1.00 26.51           C
ANISOU 4498  CG2 ILE B  79     4008   3885   2178    312    301    298   C
ATOM    4502  C   ILE B  79      20.023  34.426 104.994  1.00 27.33           C
ANISOU 4502  C   ILE B  79     4071   3992   2321    468    270    198   C
ATOM    4503  O   ILE B  79      19.865  33.560 104.100  1.00 26.19           O
ANISOU 4503  O   ILE B  79     4027   3717   2208    447    301    221   O
ATOM    4505  N   GLU B  80      20.406  35.675 104.742  1.00 29.29           N
ANISOU 4505  N   GLU B  80     4227   4307   2597    447    253    109   N
ATOM    4506  CA  GLU B  80      20.898  36.096 103.409  1.00 28.85           C
ANISOU 4506  CA  GLU B  80     4167   4193   2602    420    269     55   C
ATOM    4508  CB  GLU B  80      21.287  37.588 103.422  1.00 30.90           C
ANISOU 4508  CB  GLU B  80     4322   4524   2896    388    258    -29   C
ATOM    4511  CG  GLU B  80      21.491  38.175 102.037  1.00 32.87           C
ANISOU 4511  CG  GLU B  80     4576   4710   3202    339    286    -59   C
ATOM    4514  CD  GLU B  80      20.292  37.922 101.133  1.00 35.53           C
ANISOU 4514  CD  GLU B  80     4995   4963   3540    272    292    -17   C
ATOM    4515  OE1 GLU B  80      19.274  38.611 101.272  1.00 37.27           O
ANISOU 4515  OE1 GLU B  80     5192   5190   3779    225    279     -7   O
ATOM    4516  OE2 GLU B  80      20.327  36.984 100.301  1.00 39.98           O
ANISOU 4516  OE2 GLU B  80     5647   5461   4084    267    309      4   O
ATOM    4517  C   GLU B  80      22.088  35.277 102.879  1.00 29.42           C
ANISOU 4517  C   GLU B  80     4266   4229   2684    507    295     64   C
ATOM    4518  O   GLU B  80      22.987  34.856 103.622  1.00 28.81           O
ANISOU 4518  O   GLU B  80     4145   4220   2584    611    282     92   O
ATOM    4520  N   GLY B  81      22.114  35.085 101.565  1.00 27.54           N
ANISOU 4520  N   GLY B  81     4092   3898   2473    474    334     42   N
ATOM    4521  CA  GLY B  81      23.166  34.335 100.950  1.00 30.59           C
ANISOU 4521  CA  GLY B  81     4511   4239   2871    562    385     37   C
ATOM    4524  C   GLY B  81      22.833  32.850 100.752  1.00 32.68           C
ANISOU 4524  C   GLY B  81     4931   4360   3125    595    426     82   C
ATOM    4525  O   GLY B  81      23.604  32.156 100.131  1.00 34.42           O
ANISOU 4525  O   GLY B  81     5205   4511   3361    676    489     68   O
ATOM    4527  N   ARG B  82      21.706  32.359 101.288  1.00 32.98           N
ANISOU 4527  N   ARG B  82     5042   4345   3143    533    404    133   N
ATOM    4528  CA  ARG B  82      21.338  30.943 101.143  1.00 32.42           C
ANISOU 4528  CA  ARG B  82     5133   4110   3074    536    451    174   C
ATOM    4530  CB  ARG B  82      20.702  30.414 102.404  1.00 29.87           C
ANISOU 4530  CB  ARG B  82     4830   3785   2733    541    433    275   C
ATOM    4533  CG  ARG B  82      21.498  30.675 103.639  1.00 29.18           C
ANISOU 4533  CG  ARG B  82     4633   3836   2618    675    400    336   C
ATOM    4536  CD  ARG B  82      20.807  30.116 104.832  1.00 28.35           C
ANISOU 4536  CD  ARG B  82     4567   3736   2471    673    393    448   C
ATOM    4539  NE  ARG B  82      21.564  30.347 106.070  1.00 29.38           N
ANISOU 4539  NE  ARG B  82     4594   4029   2539    799    349    511   N
ATOM    4541  CZ  ARG B  82      22.390  29.455 106.632  1.00 30.89           C
ANISOU 4541  CZ  ARG B  82     4812   4206   2716    961    360    620   C
ATOM    4542  NH1 ARG B  82      22.567  28.244 106.114  1.00 30.04           N
ANISOU 4542  NH1 ARG B  82     4848   3895   2670   1027    433    676   N
ATOM    4545  NH2 ARG B  82      23.006  29.763 107.750  1.00 30.51           N
ANISOU 4545  NH2 ARG B  82     4655   4350   2589   1058    297    675   N
ATOM    4548  C   ARG B  82      20.357  30.764  99.979  1.00 33.27           C
ANISOU 4548  C   ARG B  82     5347   4121   3172    378    460    117   C
ATOM    4549  O   ARG B  82      19.676  31.671  99.603  1.00 35.45           O
ANISOU 4549  O   ARG B  82     5560   4474   3434    273    413     89   O
ATOM    4551  N   ASP B  83      20.264  29.573  99.435  1.00 35.12           N
ANISOU 4551  N   ASP B  83     5745   4186   3411    361    518    101   N
ATOM    4552  CA  ASP B  83      19.245  29.316  98.448  1.00 37.88           C
ANISOU 4552  CA  ASP B  83     6197   4465   3733    183    509     41   C
ATOM    4554  CB  ASP B  83      19.463  27.989  97.671  1.00 42.20           C
ANISOU 4554  CB  ASP B  83     6951   4802   4281    173    595    -22   C
ATOM    4557  CG  ASP B  83      19.028  26.734  98.406  1.00 47.54           C
```

FIG. 18 (continued)

| | | | | | | | | | | | | | |
|---|---|---|---|---|---|---|---|---|---|---|---|---|---|
| ANISOU | 4557 | CG | ASP | B | 83 | 7759 | 5304 | 5000 | 160 | 637 | 44 | | C |
| ATOM | 4558 | OD1 | ASP | B | 83 | 18.333 | 26.787 | 99.441 | 1.00 | 51.95 | | | O |
| ANISOU | 4558 | OD1 | ASP | B | 83 | 8258 | 5910 | 5572 | 120 | 596 | 144 | | O |
| ATOM | 4559 | OD2 | ASP | B | 83 | 19.373 | 25.628 | 97.893 | 1.00 | 54.28 | | | O |
| ANISOU | 4559 | OD2 | ASP | B | 83 | 8796 | 5951 | 5875 | 185 | 729 | -8 | | O |
| ATOM | 4560 | C | ASP | B | 83 | 17.922 | 29.473 | 99.156 | 1.00 | 35.51 | | | C |
| ANISOU | 4560 | C | ASP | B | 83 | 5847 | 4213 | 3431 | 57 | 447 | 106 | | C |
| ATOM | 4561 | O | ASP | B | 83 | 17.814 | 29.259 | 100.354 | 1.00 | 35.66 | | | O |
| ANISOU | 4561 | O | ASP | B | 83 | 5834 | 4247 | 3468 | 109 | 449 | 194 | | O |
| ATOM | 4563 | N | ARG | B | 84 | 16.925 | 29.916 | 98.418 | 1.00 | 33.93 | | | N |
| ANISOU | 4563 | N | ARG | B | 84 | 5624 | 4067 | 3201 | -102 | 392 | 69 | | N |
| ATOM | 4564 | CA | ARG | B | 84 | 15.655 | 30.245 | 99.005 | 1.00 | 32.89 | | | C |
| ANISOU | 4564 | CA | ARG | B | 84 | 5401 | 4019 | 3075 | -213 | 337 | 131 | | C |
| ATOM | 4566 | CB | ARG | B | 84 | 14.625 | 30.539 | 97.920 | 1.00 | 31.07 | | | C |
| ANISOU | 4566 | CB | ARG | B | 84 | 5153 | 3844 | 2807 | -386 | 271 | 90 | | C |
| ATOM | 4569 | CG | ARG | B | 84 | 13.327 | 31.114 | 98.496 | 1.00 | 31.11 | | | C |
| ANISOU | 4569 | CG | ARG | B | 84 | 5010 | 3979 | 2832 | -472 | 215 | 164 | | C |
| ATOM | 4572 | CD | ARG | B | 84 | 12.359 | 31.694 | 97.449 | 1.00 | 30.12 | | | C |
| ANISOU | 4572 | CD | ARG | B | 84 | 4808 | 3967 | 2670 | -604 | 128 | 151 | | C |
| ATOM | 4575 | NE | ARG | B | 84 | 11.197 | 32.154 | 98.204 | 1.00 | 28.49 | | | N |
| ANISOU | 4575 | NE | ARG | B | 84 | 4442 | 3880 | 2504 | -648 | 98 | 235 | | N |
| ATOM | 4577 | CZ | ARG | B | 84 | 11.056 | 33.372 | 98.705 | 1.00 | 27.45 | | | C |
| ANISOU | 4577 | CZ | ARG | B | 84 | 4160 | 3864 | 2407 | -545 | 91 | 281 | | C |
| ATOM | 4578 | NH1 | ARG | B | 84 | 11.969 | 34.330 | 98.466 | 1.00 | 26.51 | | | N |
| ANISOU | 4578 | NH1 | ARG | B | 84 | 4026 | 3758 | 2290 | -417 | 98 | 254 | | N |
| ATOM | 4581 | NH2 | ARG | B | 84 | 9.974 | 33.649 | 99.421 | 1.00 | 27.10 | | | N |
| ANISOU | 4581 | NH2 | ARG | B | 84 | 3979 | 3918 | 2399 | -578 | 87 | 351 | | N |
| ATOM | 4584 | C | ARG | B | 84 | 15.118 | 29.173 | 99.942 | 1.00 | 33.03 | | | C |
| ANISOU | 4584 | C | ARG | B | 84 | 5489 | 3941 | 3119 | -255 | 373 | 206 | | C |
| ATOM | 4585 | O | ARG | B | 84 | 14.567 | 29.488 | 100.994 | 1.00 | 33.41 | | | O |
| ANISOU | 4585 | O | ARG | B | 84 | 5440 | 4079 | 3177 | -251 | 363 | 286 | | O |
| ATOM | 4587 | N | THR | B | 85 | 15.231 | 27.910 | 99.533 | 1.00 | 34.44 | | | N |
| ANISOU | 4587 | N | THR | B | 85 | 5848 | 3930 | 3309 | -303 | 428 | 176 | | N |
| ATOM | 4588 | CA | THR | B | 85 | 14.681 | 26.809 | 100.322 | 1.00 | 36.80 | | | C |
| ANISOU | 4588 | CA | THR | B | 85 | 6241 | 4100 | 3643 | -367 | 477 | 257 | | C |
| ATOM | 4590 | CB | THR | B | 85 | 14.588 | 25.466 | 99.524 | 1.00 | 40.03 | | | C |
| ANISOU | 4590 | CB | THR | B | 85 | 6875 | 4264 | 4071 | -482 | 537 | 185 | | C |
| ATOM | 4592 | OG1 | THR | B | 85 | 15.904 | 24.963 | 99.253 | 1.00 | 43.43 | | | O |
| ANISOU | 4592 | OG1 | THR | B | 85 | 7430 | 4553 | 4519 | -300 | 616 | 147 | | O |
| ATOM | 4594 | CG2 | THR | B | 85 | 13.845 | 25.686 | 98.193 | 1.00 | 38.84 | | | C |
| ANISOU | 4594 | CG2 | THR | B | 85 | 6729 | 4161 | 3868 | -687 | 470 | 60 | | C |
| ATOM | 4598 | C | THR | B | 85 | 15.454 | 26.648 | 101.624 | 1.00 | 34.91 | | | C |
| ANISOU | 4598 | C | THR | B | 85 | 5986 | 3858 | 3419 | -173 | 522 | 371 | | C |
| ATOM | 4599 | O | THR | B | 85 | 14.851 | 26.478 | 102.674 | 1.00 | 36.90 | | | O |
| ANISOU | 4599 | O | THR | B | 85 | 6204 | 4144 | 3672 | -200 | 533 | 480 | | O |
| ATOM | 4601 | N | MET | B | 86 | 16.778 | 26.734 | 101.561 | 1.00 | 34.77 | | | N |
| ANISOU | 4601 | N | MET | B | 86 | 5980 | 3827 | 3403 | 20 | 547 | 353 | | N |
| ATOM | 4602 | CA | MET | B | 86 | 17.594 | 26.614 | 102.764 | 1.00 | 35.89 | | | C |
| ANISOU | 4602 | CA | MET | B | 86 | 6087 | 4006 | 3544 | 213 | 568 | 465 | | C |
| ATOM | 4604 | CB | MET | B | 86 | 19.083 | 26.520 | 102.430 | 1.00 | 39.13 | | | C |
| ANISOU | 4604 | CB | MET | B | 86 | 6511 | 4387 | 3971 | 414 | 600 | 433 | | C |
| ATOM | 4607 | CG | MET | B | 86 | 19.947 | 26.245 | 103.653 | 1.00 | 43.95 | | | C |
| ANISOU | 4607 | CG | MET | B | 86 | 7080 | 5046 | 4573 | 618 | 608 | 566 | | C |
| ATOM | 4610 | SD | MET | B | 86 | 19.321 | 24.991 | 104.829 | 1.00 | 50.11 | | | S |
| ANISOU | 4610 | SD | MET | B | 86 | 7995 | 5686 | 5357 | 619 | 662 | 755 | | S |
| ATOM | 4611 | CE | MET | B | 86 | 19.063 | 23.557 | 103.764 | 1.00 | 49.12 | | | C |
| ANISOU | 4611 | CE | MET | B | 86 | 8134 | 5204 | 5324 | 537 | 774 | 705 | | C |
| ATOM | 4615 | C | MET | B | 86 | 17.308 | 27.783 | 103.716 | 1.00 | 33.62 | | | C |
| ANISOU | 4615 | C | MET | B | 86 | 5611 | 3956 | 3207 | 227 | 501 | 506 | | C |
| ATOM | 4616 | O | MET | B | 86 | 17.219 | 27.589 | 104.952 | 1.00 | 33.60 | | | O |
| ANISOU | 4616 | O | MET | B | 86 | 5586 | 4008 | 3172 | 284 | 510 | 622 | | O |
| ATOM | 4618 | N | ALA | B | 87 | 17.084 | 28.962 | 103.135 | 1.00 | 30.25 | | | N |
| ANISOU | 4618 | N | ALA | B | 87 | 5064 | 3659 | 2769 | 169 | 445 | 414 | | N |
| ATOM | 4619 | CA | ALA | B | 87 | 16.747 | 30.186 | 103.905 | 1.00 | 29.42 | | | C |
| ANISOU | 4619 | CA | ALA | B | 87 | 4794 | 3754 | 2631 | 174 | 397 | 421 | | C |
| ATOM | 4621 | CB | ALA | B | 87 | 16.707 | 31.447 | 102.939 | 1.00 | 26.57 | | | C |
| ANISOU | 4621 | CB | ALA | B | 87 | 4335 | 3477 | 2284 | 130 | 351 | 317 | | C |
| ATOM | 4625 | C | ALA | B | 87 | 15.458 | 30.028 | 104.713 | 1.00 | 28.92 | | | C |
| ANISOU | 4625 | C | ALA | B | 87 | 4706 | 3731 | 2551 | 69 | 408 | 500 | | C |
| ATOM | 4626 | O | ALA | B | 87 | 15.420 | 30.313 | 105.933 | 1.00 | 29.55 | | | O |
| ANISOU | 4626 | O | ALA | B | 87 | 4722 | 3925 | 2581 | 129 | 414 | 562 | | O |
| ATOM | 4628 | N | TRP | B | 88 | 14.410 | 29.493 | 104.082 | 1.00 | 29.89 | | | N |
| ANISOU | 4628 | N | TRP | B | 88 | 4881 | 3771 | 2705 | -97 | 416 | 500 | | N |
| ATOM | 4629 | CA | TRP | B | 88 | 13.180 | 29.156 | 104.828 | 1.00 | 31.52 | | | C |
| ANISOU | 4629 | CA | TRP | B | 88 | 5061 | 4009 | 2907 | -213 | 444 | 588 | | C |
| ATOM | 4631 | CB | TRP | B | 88 | 12.016 | 28.782 | 103.886 | 1.00 | 33.07 | | | C |
| ANISOU | 4631 | CB | TRP | B | 88 | 5269 | 4152 | 3143 | -426 | 428 | 559 | | C |
| ATOM | 4634 | CG | TRP | B | 88 | 11.305 | 29.958 | 103.345 | 1.00 | 31.23 | | | C |
| ANISOU | 4634 | CG | TRP | B | 88 | 4873 | 4078 | 2915 | -480 | 364 | 507 | | C |

FIG. 18 (continued)

```
ATOM   4635  CD1 TRP B  88      11.203  30.317 102.040  1.00 31.79          C
ANISOU 4635  CD1 TRP B  88    4933   4153   2992   -546    301    424       C
ATOM   4637  NE1 TRP B  88      10.483  31.485 101.928  1.00 30.87          N
ANISOU 4637  NE1 TRP B  88    4642   4202   2885   -553    254    426       N
ATOM   4639  CE2 TRP B  88      10.122  31.916 103.174  1.00 29.62          C
ANISOU 4639  CE2 TRP B  88    4383   4142   2730   -490    299    490       C
ATOM   4640  CD2 TRP B  88      10.610  30.966 104.098  1.00 30.74          C
ANISOU 4640  CD2 TRP B  88    4637   4193   2848   -453    364    543       C
ATOM   4641  CE3 TRP B  88      10.382  31.175 105.467  1.00 31.54          C
ANISOU 4641  CE3 TRP B  88    4675   4390   2919   -390    421    613       C
ATOM   4643  CZ3 TRP B  88       9.651  32.314 105.868  1.00 31.24          C
ANISOU 4643  CZ3 TRP B  88    4466   4517   2885   -365    426    608       C
ATOM   4645  CH2 TRP B  88       9.172  33.241 104.914  1.00 30.90          C
ANISOU 4645  CH2 TRP B  88    4314   4537   2892   -389    368    557       C
ATOM   4647  CZ2 TRP B  88       9.385  33.056 103.569  1.00 30.84          C
ANISOU 4647  CZ2 TRP B  88    4361   4454   2904   -454    298    509       C
ATOM   4649  C   TRP B  88      13.411  28.062 105.895  1.00 32.62          C
ANISOU 4649  C   TRP B  88    5309   4060   3025   -161    513    716       C
ATOM   4650  O   TRP B  88      12.891  28.124 107.018  1.00 35.27          O
ANISOU 4650  O   TRP B  88    5590   4495   3316   -162    545    810       O
ATOM   4652  N   THR B  89      14.217  27.068 105.566  1.00 34.28          N
ANISOU 4652  N   THR B  89    5677   4085   3262    -99    546    729       N
ATOM   4653  CA  THR B  89      14.559  26.035 106.571  1.00 34.23          C
ANISOU 4653  CA  THR B  89    5784   3981   3242    -13    613    878       C
ATOM   4655  CB  THR B  89      15.435  24.923 105.962  1.00 35.76          C
ANISOU 4655  CB  THR B  89    6164   3927   3495     68    663    877       C
ATOM   4657  OG1 THR B  89      14.742  24.340 104.848  1.00 34.28          O
ANISOU 4657  OG1 THR B  89    6087   3566   3373   -127    685    786       O
ATOM   4659  CG2 THR B  89      15.787  23.836 107.031  1.00 38.02          C
ANISOU 4659  CG2 THR B  89    6575   4096   3776    183    737   1067       C
ATOM   4663  C   THR B  89      15.246  26.634 107.810  1.00 31.71          C
ANISOU 4663  C   THR B  89    5366   3851   2831    167    590    952       C
ATOM   4664  O   THR B  89      14.988  26.217 108.937  1.00 32.49          O
ANISOU 4664  O   THR B  89    5486   3987   2871    190    630   1093       O
ATOM   4666  N   VAL B  90      16.119  27.604 107.591  1.00 32.15          N
ANISOU 4666  N   VAL B  90    5318   4034   2865    280    527    854       N
ATOM   4667  CA  VAL B  90      16.844  28.269 108.673  1.00 31.40          C
ANISOU 4667  CA  VAL B  90    5118   4137   2674    426    487    886       C
ATOM   4669  CB  VAL B  90      18.082  28.979 108.112  1.00 28.96          C
ANISOU 4669  CB  VAL B  90    4733   3889   2382    540    428    775       C
ATOM   4671  CG1 VAL B  90      18.789  29.790 109.171  1.00 27.31          C
ANISOU 4671  CG1 VAL B  90    4399   3907   2072    649    371    775       C
ATOM   4675  CG2 VAL B  90      19.011  27.948 107.524  1.00 31.86          C
ANISOU 4675  CG2 VAL B  90    5213   4082   2809    649    461    810       C
ATOM   4679  C   VAL B  90      15.938  29.189 109.492  1.00 29.72          C
ANISOU 4679  C   VAL B  90    4788   4116   2389    352    480    875       C
ATOM   4680  O   VAL B  90      15.960  29.165 110.725  1.00 32.97          O
ANISOU 4680  O   VAL B  90    5182   4653   2693    412    491    966       O
ATOM   4682  N   VAL B  91      15.070  29.930 108.823  1.00 28.85          N
ANISOU 4682  N   VAL B  91    4605   4027   2330    226    472    777       N
ATOM   4683  CA  VAL B  91      14.053  30.710 109.511  1.00 28.32          C
ANISOU 4683  CA  VAL B  91    4429   4113   2217    161    493    770       C
ATOM   4685  CB  VAL B  91      13.181  31.537 108.515  1.00 28.61          C
ANISOU 4685  CB  VAL B  91    4375   4158   2339     49    475    669       C
ATOM   4687  CG1 VAL B  91      11.966  32.158 109.253  1.00 29.19          C
ANISOU 4687  CG1 VAL B  91    4333   4373   2384     -8    523    687       C
ATOM   4691  CG2 VAL B  91      14.019  32.589 107.815  1.00 25.34          C
ANISOU 4691  CG2 VAL B  91    3904   3770   1955    118    414    541       C
ATOM   4695  C   VAL B  91      13.152  29.842 110.388  1.00 29.16          C
ANISOU 4695  C   VAL B  91    4584   4215   2279     91    571    917       C
ATOM   4696  O   VAL B  91      12.870  30.187 111.525  1.00 27.75          O
ANISOU 4696  O   VAL B  91    4353   4191   1998    122    604    960       O
ATOM   4698  N   ASN B  92      12.689  28.714 109.853  1.00 30.01          N
ANISOU 4698  N   ASN B  92    4801   4143   2459    -16    608    987       N
ATOM   4699  CA  ASN B  92      11.834  27.831 110.613  1.00 31.12          C
ANISOU 4699  CA  ASN B  92    4996   4254   2576   -108    694   1137       C
ATOM   4701  CB  ASN B  92      11.203  26.738 109.759  1.00 33.49          C
ANISOU 4701  CB  ASN B  92    5404   4334   2985   -282    729   1166       C
ATOM   4704  CG  ASN B  92      10.053  27.245 108.942  1.00 34.91          C
ANISOU 4704  CG  ASN B  92    5465   4567   3235   -461    706   1076       C
ATOM   4705  OD1 ASN B  92       8.991  27.571 109.484  1.00 36.63          O
ANISOU 4705  OD1 ASN B  92    5560   4923   3436   -550    749   1121       O
ATOM   4706  ND2 ASN B  92      10.237  27.294 107.627  1.00 33.92          N
ANISOU 4706  ND2 ASN B  92    5365   4345   3179   -513    642    958       N
ATOM   4709  C   ASN B  92      12.582  27.191 111.765  1.00 31.50          C
ANISOU 4709  C   ASN B  92    5136   4313   2519     31    726   1284       C
ATOM   4710  O   ASN B  92      12.002  26.953 112.788  1.00 31.76          O
ANISOU 4710  O   ASN B  92    5168   4431   2470      3    794   1406       O
ATOM   4712  N   SER B  93      13.867  26.928 111.584  1.00 31.54          N
```

FIG. 18 (continued)

```
ANISOU 4712  N   SER B  93     5211   4249   2522    187    678   1282        N
ATOM   4713  CA  SER B  93      14.696  26.383 112.664  1.00 33.94           C
ANISOU 4713  CA  SER B  93     5580   4597   2718    352    685   1436        C
ATOM   4715  CB  SER B  93      16.050  25.936 112.113  1.00 34.40           C
ANISOU 4715  CB  SER B  93     5706   4533   2829    514    639   1430        C
ATOM   4718  OG  SER B  93      16.634  25.105 113.079  1.00 42.61           O
ANISOU 4718  OG  SER B  93     6831   5569   3788    661    660   1630        O
ATOM   4720  C   SER B  93      14.894  27.384 113.811  1.00 31.81           C
ANISOU 4720  C   SER B  93     5185   4621   2279    434    646   1420        C
ATOM   4721  O   SER B  93      14.842  27.026 115.004  1.00 31.82           O
ANISOU 4721  O   SER B  93     5219   4730   2143    486    682   1572        O
ATOM   4723  N   ILE B  94      15.097  28.647 113.441  1.00 30.37           N
ANISOU 4723  N   ILE B  94     4872   4565   2103    438    581   1232        N
ATOM   4724  CA  ILE B  94      15.211  29.724 114.420  1.00 30.77           C
ANISOU 4724  CA  ILE B  94     4812   4874   2006    486    552   1164        C
ATOM   4726  CB  ILE B  94      15.569  31.105 113.758  1.00 28.69           C
ANISOU 4726  CB  ILE B  94     4427   4677   1796    483    484    942        C
ATOM   4728  CG1 ILE B  94      17.001  31.071 113.219  1.00 29.20           C
ANISOU 4728  CG1 ILE B  94     4490   4705   1898    596    396    899        C
ATOM   4731  CD1 ILE B  94      17.262  32.064 112.118  1.00 27.32           C
ANISOU 4731  CD1 ILE B  94     4175   4431   1776    559    355    719        C
ATOM   4735  CG2 ILE B  94      15.421  32.269 114.790  1.00 26.61           C
ANISOU 4735  CG2 ILE B  94     4069   4651   1392    496    483    843        C
ATOM   4739  C   ILE B  94      13.927  29.809 115.213  1.00 28.70           C
ANISOU 4739  C   ILE B  94     4528   4708   1669    385    648   1220        C
ATOM   4740  O   ILE B  94      13.956  29.878 116.447  1.00 30.80           O
ANISOU 4740  O   ILE B  94     4792   5152   1758    438    671   1290        O
ATOM   4742  N   CYS B  95      12.800  29.805 114.506  1.00 30.37           N
ANISOU 4742  N   CYS B  95     4713   4821   2005    240    705   1191        N
ATOM   4743  CA  CYS B  95      11.494  29.939 115.154  1.00 32.29           C
ANISOU 4743  CA  CYS B  95     4899   5167   2203    137    810   1239        C
ATOM   4745  CB  CYS B  95      10.381  30.179 114.116  1.00 33.22           C
ANISOU 4745  CB  CYS B  95     4935   5204   2484    -13    834   1170        C
ATOM   4748  SG  CYS B  95      10.551  31.735 113.210  1.00 32.78           S
ANISOU 4748  SG  CYS B  95     4745   5196   2513     24    754    943        S
ATOM   4750  C   CYS B  95      11.175  28.720 116.017  1.00 34.28           C
ANISOU 4750  C   CYS B  95     5261   5391   2373    110    898   1463        C
ATOM   4751  O   CYS B  95      10.606  28.846 117.109  1.00 31.93           O
ANISOU 4751  O   CYS B  95     4934   5261   1936    101    982   1534        O
ATOM   4753  N   ASN B  96      11.569  27.532 115.551  1.00 34.95           N
ANISOU 4753  N   ASN B  96     5484   5257   2539    104    892   1579        N
ATOM   4754  CA  ASN B  96      11.352  26.318 116.366  1.00 35.89           C
ANISOU 4754  CA  ASN B  96     5734   5310   2593     88    984   1818        C
ATOM   4756  CB  ASN B  96      11.680  25.048 115.567  1.00 37.79           C
ANISOU 4756  CB  ASN B  96     6139   5237   2981     62    991   1907        C
ATOM   4759  CG  ASN B  96      10.696  24.808 114.430  1.00 39.12           C
ANISOU 4759  CG  ASN B  96     6297   5235   3330   -156   1022   1825        C
ATOM   4760  OD1 ASN B  96       9.541  25.234 114.497  1.00 41.20           O
ANISOU 4760  OD1 ASN B  96     6442   5608   3605   -307   1071   1793        O
ATOM   4761  ND2 ASN B  96      11.143  24.122 113.393  1.00 39.06           N
ANISOU 4761  ND2 ASN B  96     6408   4975   3458   -173    994   1787        N
ATOM   4764  C   ASN B  96      12.131  26.301 117.678  1.00 36.50           C
ANISOU 4764  C   ASN B  96     5846   5570   2452    258    970   1937        C
ATOM   4765  O   ASN B  96      11.581  25.921 118.716  1.00 35.64           O
ANISOU 4765  O   ASN B  96     5772   5560   2212    230   1066   2100        O
ATOM   4767  N   THR B  97      13.400  26.684 117.636  1.00 35.03           N
ANISOU 4767  N   THR B  97     5646   5445   2217    424    850   1867        N
ATOM   4768  CA  THR B  97      14.241  26.633 118.816  1.00 40.35           C
ANISOU 4768  CA  THR B  97     6341   6315   2676    586    806   1981        C
ATOM   4770  CB  THR B  97      15.726  26.591 118.483  1.00 41.26           C
ANISOU 4770  CB  THR B  97     6456   6414   2806    763    675   1956        C
ATOM   4772  OG1 THR B  97      16.087  27.847 117.900  1.00 42.29           O
ANISOU 4772  OG1 THR B  97     6450   6639   2979    753    588   1696        O
ATOM   4774  CG2 THR B  97      16.034  25.471 117.519  1.00 42.63           C
ANISOU 4774  CG2 THR B  97     6755   6266   3178    787    696   2045        C
ATOM   4778  C   THR B  97      14.046  27.829 119.750  1.00 40.13           C
ANISOU 4778  C   THR B  97     6196   6605   2448    590    796   1859        C
ATOM   4779  O   THR B  97      14.254  27.679 120.931  1.00 43.20           O
ANISOU 4779  O   THR B  97     6614   7185   2615    663    803   1983        O
ATOM   4781  N   THR B  98      13.699  29.006 119.225  1.00 38.96           N
ANISOU 4781  N   THR B  98     5926   6508   2371    522    779   1619        N
ATOM   4782  CA  THR B  98      13.589  30.224 120.067  1.00 39.66           C
ANISOU 4782  CA  THR B  98     5918   6867   2283    535    779   1466        C
ATOM   4784  CB  THR B  98      14.147  31.534 119.348  1.00 38.40           C
ANISOU 4784  CB  THR B  98     5650   6727   2213    548    682   1191        C
ATOM   4786  OG1 THR B  98      13.373  31.854 118.170  1.00 36.81           O
ANISOU 4786  OG1 THR B  98     5397   6350   2239    447    721   1093        O
ATOM   4788  CG2 THR B  98      15.676  31.381 118.966  1.00 36.59           C
ANISOU 4788  CG2 THR B  98     5427   6473   2003    665    532   1178        C
```

FIG. 18 (continued)

```
ATOM   4792  C   THR B  98      12.162  30.509 120.496  1.00 41.48          C
ANISOU 4792  C   THR B  98    6106   7170   2486    420    930   1462       C
ATOM   4793  O   THR B  98      11.957  31.195 121.473  1.00 42.87          O
ANISOU 4793  O   THR B  98    6245   7571   2471    439    975   1395       O
ATOM   4795  N   GLY B  99      11.182  30.000 119.741  1.00 42.32          N
ANISOU 4795  N   GLY B  99    6208   7093   2778    296   1011   1520       N
ATOM   4796  CA  GLY B  99       9.795  30.405 119.871  1.00 41.49          C
ANISOU 4796  CA  GLY B  99    6009   7051   2703    181   1146   1488       C
ATOM   4799  C   GLY B  99       9.461  31.683 119.097  1.00 41.45          C
ANISOU 4799  C   GLY B  99    5866   7051   2831    165   1122   1250       C
ATOM   4800  O   GLY B  99       8.366  32.233 119.261  1.00 41.20          O
ANISOU 4800  O   GLY B  99    5729   7106   2821    108   1233   1202       O
ATOM   4802  N   ALA B 100      10.382  32.162 118.250  1.00 39.26          N
ANISOU 4802  N   ALA B 100    5585   6682   2650    221    990   1115       N
ATOM   4803  CA  ALA B 100      10.220  33.467 117.609  1.00 38.87          C
ANISOU 4803  CA  ALA B 100    5423   6637   2707    227    966    901       C
ATOM   4805  CB  ALA B 100      11.526  33.885 116.851  1.00 37.41          C
ANISOU 4805  CB  ALA B 100    5259   6368   2587    296    820    780       C
ATOM   4809  C   ALA B 100       9.039  33.418 116.638  1.00 41.43          C
ANISOU 4809  C   ALA B 100    5661   6852   3228    114   1017    916       C
ATOM   4810  O   ALA B 100       8.802  32.404 115.968  1.00 40.10          O
ANISOU 4810  O   ALA B 100    5537   6536   3163     24   1004   1033       O
ATOM   4812  N   GLU B 101       8.288  34.507 116.562  1.00 42.61          N
ANISOU 4812  N   GLU B 101    5684   7075   3429    119   1075    795       N
ATOM   4813  CA  GLU B 101       7.174  34.558 115.621  1.00 44.07          C
ANISOU 4813  CA  GLU B 101    5754   7193   3796     26   1104    814       C
ATOM   4815  CB  GLU B 101       6.358  35.827 115.824  1.00 46.02          C
ANISOU 4815  CB  GLU B 101    5856   7554   4076     80   1193    699       C
ATOM   4818  CG  GLU B 101       5.471  36.168 114.626  1.00 47.19          C
ANISOU 4818  CG  GLU B 101    5863   7638   4427     26   1173    695       C
ATOM   4821  CD  GLU B 101       4.348  37.119 114.972  1.00 50.01          C
ANISOU 4821  CD  GLU B 101    6052   8123   4825     80   1302    651       C
ATOM   4822  OE1 GLU B 101       4.357  37.703 116.097  1.00 53.18          O
ANISOU 4822  OE1 GLU B 101    6464   8643   5099    171   1413    576       O
ATOM   4823  OE2 GLU B 101       3.461  37.270 114.097  1.00 52.27          O
ANISOU 4823  OE2 GLU B 101    6195   8398   5267     35   1291    690       O
ATOM   4824  C   GLU B 101       7.739  34.491 114.193  1.00 40.05          C
ANISOU 4824  C   GLU B 101    5272   6507   3440      2    968    770       C
ATOM   4825  O   GLU B 101       8.711  35.171 113.888  1.00 37.15          O
ANISOU 4825  O   GLU B 101    4934   6103   3076     86    887    650       O
ATOM   4827  N   LYS B 102       7.120  33.663 113.357  1.00 38.96          N
ANISOU 4827  N   LYS B 102    5122   6267   3415   -127    952    862       N
ATOM   4828  CA  LYS B 102       7.575  33.402 111.997  1.00 39.68          C
ANISOU 4828  CA  LYS B 102    5258   6194   3623   -171    836    830       C
ATOM   4830  CB  LYS B 102       6.956  32.093 111.516  1.00 40.34          C
ANISOU 4830  CB  LYS B 102    5386   6173   3769   -339    844    952       C
ATOM   4833  CG  LYS B 102       7.490  31.579 110.188  1.00 41.36          C
ANISOU 4833  CG  LYS B 102    5605   6122   3986   -396    740    915       C
ATOM   4836  CD  LYS B 102       6.772  30.316 109.826  1.00 43.75          C
ANISOU 4836  CD  LYS B 102    5960   6320   4344   -586    763   1013       C
ATOM   4839  CE  LYS B 102       7.200  29.754 108.478  1.00 44.40          C
ANISOU 4839  CE  LYS B 102    6147   6223   4501   -663    673    955       C
ATOM   4842  NZ  LYS B 102       6.676  28.337 108.436  1.00 47.10          N
ANISOU 4842  NZ  LYS B 102    6594   6424   4878   -849    722   1052       N
ATOM   4846  C   LYS B 102       7.212  34.543 111.044  1.00 36.73          C
ANISOU 4846  C   LYS B 102    4759   5833   3363   -151    791    723       C
ATOM   4847  O   LYS B 102       6.055  34.889 110.912  1.00 37.83          O
ANISOU 4847  O   LYS B 102    4753   6053   3566   -198    837    746       O
ATOM   4849  N   PRO B 103       8.208  35.146 110.381  1.00 36.85          N
ANISOU 4849  N   PRO B 103    4819   5776   3407    -75    704    620       N
ATOM   4850  CA  PRO B 103       7.892  36.200 109.415  1.00 34.11          C
ANISOU 4850  CA  PRO B 103    4371   5422   3168    -53    662    547       C
ATOM   4852  CB  PRO B 103       9.228  36.900 109.240  1.00 32.94          C
ANISOU 4852  CB  PRO B 103    4295   5216   3004     49    607    435       C
ATOM   4855  CG  PRO B 103      10.192  35.808 109.340  1.00 33.92          C
ANISOU 4855  CG  PRO B 103    4555   5269   3063     35    567    473       C
ATOM   4858  CD  PRO B 103       9.669  34.918 110.440  1.00 36.48          C
ANISOU 4858  CD  PRO B 103    4903   5656   3300     -1    642    579       C
ATOM   4861  C   PRO B 103       7.370  35.653 108.077  1.00 31.43          C
ANISOU 4861  C   PRO B 103    4010   5012   2920   -178    588    595       C
ATOM   4862  O   PRO B 103       7.572  34.475 107.735  1.00 31.19          O
ANISOU 4862  O   PRO B 103    4083   4890   2877   -277    557    645       O
ATOM   4863  N   LYS B 104       6.659  36.519 107.371  1.00 31.56          N
ANISOU 4863  N   LYS B 104    3893   5076   3021   -168    566    582       N
ATOM   4864  CA  LYS B 104       6.061  36.231 106.075  1.00 31.39          C
ANISOU 4864  CA  LYS B 104    3821   5038   3068   -282    480    621       C
ATOM   4866  CB  LYS B 104       4.820  37.102 105.865  1.00 33.93          C
ANISOU 4866  CB  LYS B 104    3932   5492   3469   -258    495    663       C
ATOM   4869  CG  LYS B 104       3.733  36.963 106.893  1.00 37.31          C
```

FIG. 18 (continued)

```
ANISOU 4869  CG   LYS B 104    4225   6052   3898   -277    606    729        C
ATOM   4872  CD   LYS B 104      3.037  35.655 106.840  1.00 39.14            C
ANISOU 4872  CD   LYS B 104    4442   6308   4121   -477    600    816        C
ATOM   4875  CE   LYS B 104      1.709  35.751 107.602  1.00 42.70            C
ANISOU 4875  CE   LYS B 104    4688   6933   4603   -501    709    898        C
ATOM   4878  NZ   LYS B 104      1.585  34.618 108.507  1.00 45.38            N
ANISOU 4878  NZ   LYS B 104    5100   7265   4877   -618    795    962        N
ATOM   4882  C    LYS B 104      7.031  36.533 104.923  1.00 29.82            C
ANISOU 4882  C    LYS B 104    3714   4734   2881   -254    385    556        C
ATOM   4883  O    LYS B 104      6.681  36.423 103.766  1.00 32.79            O
ANISOU 4883  O    LYS B 104    4066   5107   3287   -335    304    574        O
ATOM   4885  N    PHE B 105      8.241  36.937 105.249  1.00 26.43            N
ANISOU 4885  N    PHE B 105    3382   4241   2419   -146    396    481        N
ATOM   4886  CA   PHE B 105      9.270  37.214 104.277  1.00 28.05            C
ANISOU 4886  CA   PHE B 105    3672   4355   2632   -117    330    422        C
ATOM   4888  CB   PHE B 105      9.344  38.732 103.986  1.00 28.42            C
ANISOU 4888  CB   PHE B 105    3640   4417   2739    -12    333    381        C
ATOM   4891  CG   PHE B 105      9.686  39.533 105.201  1.00 29.60            C
ANISOU 4891  CG   PHE B 105    3774   4591   2879     97    412    314        C
ATOM   4892  CD1  PHE B 105     11.016  39.848 105.497  1.00 28.34            C
ANISOU 4892  CD1  PHE B 105    3701   4380   2688    153    411    225        C
ATOM   4894  CE1  PHE B 105     11.339  40.536 106.605  1.00 27.89            C
ANISOU 4894  CE1  PHE B 105    3636   4359   2602    225    470    145        C
ATOM   4896  CZ   PHE B 105     10.353  40.933 107.492  1.00 30.47            C
ANISOU 4896  CZ   PHE B 105    3885   4766   2926    261    552    147        C
ATOM   4898  CE2  PHE B 105      9.017  40.615 107.235  1.00 32.38            C
ANISOU 4898  CE2  PHE B 105    4031   5062   3211    224    571    248        C
ATOM   4900  CD2  PHE B 105      8.695  39.906 106.082  1.00 30.21            C
ANISOU 4900  CD2  PHE B 105    3750   4760   2970    133    490    334        C
ATOM   4902  C    PHE B 105     10.557  36.718 104.893  1.00 25.42            C
ANISOU 4902  C    PHE B 105    3466   3956   2235    -65    347    377        C
ATOM   4903  O    PHE B 105     10.595  36.330 106.086  1.00 26.06            O
ANISOU 4903  O    PHE B 105    3564   4076   2261    -39    401    397        O
ATOM   4905  N    LEU B 106     11.610  36.761 104.097  1.00 24.82            N
ANISOU 4905  N    LEU B 106    3468   3801   2161    -42    303    327        N
ATOM   4906  CA   LEU B 106     12.932  36.319 104.522  1.00 23.93            C
ANISOU 4906  CA   LEU B 106    3450   3640   2001     22    309    291        C
ATOM   4908  CB   LEU B 106     13.656  35.605 103.366  1.00 24.11            C
ANISOU 4908  CB   LEU B 106    3577   3558   2027     -9    273    276        C
ATOM   4911  CG   LEU B 106     13.090  34.248 102.935  1.00 24.95            C
ANISOU 4911  CG   LEU B 106    3772   3587   2122   -118    270    326        C
ATOM   4913  CD1  LEU B 106     13.804  33.799 101.633  1.00 24.23            C
ANISOU 4913  CD1  LEU B 106    3785   3393   2027   -141    247    275        C
ATOM   4917  CD2  LEU B 106     13.209  33.139 104.023  1.00 21.33            C
ANISOU 4917  CD2  LEU B 106    3388   3088   1628   -103    317    389        C
ATOM   4921  C    LEU B 106     13.733  37.534 104.979  1.00 24.42            C
ANISOU 4921  C    LEU B 106    3466   3744   2068    119    318    209        C
ATOM   4922  O    LEU B 106     14.134  38.346 104.151  1.00 23.19            O
ANISOU 4922  O    LEU B 106    3293   3556   1961    131    298    164        O
ATOM   4924  N    PRO B 107     13.990  37.652 106.301  1.00 24.07            N
ANISOU 4924  N    PRO B 107    3409   3775   1963    175    350    190        N
ATOM   4925  CA   PRO B 107     14.884  38.704 106.754  1.00 23.53            C
ANISOU 4925  CA   PRO B 107    3309   3743   1886    239    351     88        C
ATOM   4927  CB   PRO B 107     14.618  38.780 108.300  1.00 23.20            C
ANISOU 4927  CB   PRO B 107    3249   3818   1750    274    394     74        C
ATOM   4930  CG   PRO B 107     13.402  37.888 108.535  1.00 24.16            C
ANISOU 4930  CG   PRO B 107    3372   3955   1853    227    432    187        C
ATOM   4933  CD   PRO B 107     13.510  36.859 107.439  1.00 24.61            C
ANISOU 4933  CD   PRO B 107    3493   3903   1953    171    389    257        C
ATOM   4936  C    PRO B 107     16.324  38.292 106.423  1.00 23.84            C
ANISOU 4936  C    PRO B 107    3396   3752   1908    270    307     65        C
ATOM   4937  O    PRO B 107     16.574  37.228 105.810  1.00 22.24            O
ANISOU 4937  O    PRO B 107    3261   3484   1706    260    291    124        O
ATOM   4938  N    ASP B 108     17.259  39.146 106.791  1.00 23.41            N
ANISOU 4938  N    ASP B 108    3304   3744   1848    303    296    -29        N
ATOM   4939  CA   ASP B 108     18.654  38.927 106.446  1.00 23.73            C
ANISOU 4939  CA   ASP B 108    3347   3783   1887    333    259    -55        C
ATOM   4941  CB   ASP B 108     19.305  40.261 106.107  1.00 23.50            C
ANISOU 4941  CB   ASP B 108    3260   3747   1921    310    261   -163        C
ATOM   4944  CG   ASP B 108     18.761  40.831 104.816  1.00 22.33            C
ANISOU 4944  CG   ASP B 108    3124   3488   1872    267    286   -147        C
ATOM   4945  OD1  ASP B 108     18.598  40.044 103.853  1.00 22.59            O
ANISOU 4945  OD1  ASP B 108    3206   3464   1914    256    278    -76        O
ATOM   4946  OD2  ASP B 108     18.493  42.057 104.765  1.00 24.59            O
ANISOU 4946  OD2  ASP B 108    3379   3742   2221    246    314   -204        O
ATOM   4947  C    ASP B 108     19.419  38.193 107.524  1.00 22.89            C
ANISOU 4947  C    ASP B 108    3240   3779   1677    398    229    -29        C
ATOM   4948  O    ASP B 108     20.264  37.354 107.193  1.00 22.23            O
ANISOU 4948  O    ASP B 108    3178   3677   1591    449    208     19        O
```

FIG. 18 (continued)

| | | | | | | | | | | | | | | |
|---|---|---|---|---|---|---|---|---|---|---|---|---|---|---|
| ATOM | 4950 | N | LEU | B | 109 | 19.133 | 38.533 | 108.789 | 1.00 | 24.03 | | | | N |
| ANISOU | 4950 | N | LEU | B | 109 | 3360 | 4038 | 1733 | 406 | 231 | -59 | | | N |
| ATOM | 4951 | CA | LEU | B | 109 | 19.839 | 37.976 | 109.961 | 1.00 | 25.45 | | | | C |
| ANISOU | 4951 | CA | LEU | B | 109 | 3531 | 4359 | 1781 | 469 | 189 | -28 | | | C |
| ATOM | 4953 | CB | LEU | B | 109 | 20.920 | 38.933 | 110.480 | 1.00 | 28.20 | | | | C |
| ANISOU | 4953 | CB | LEU | B | 109 | 3793 | 4833 | 2088 | 463 | 137 | -160 | | | C |
| ATOM | 4956 | CG | LEU | B | 109 | 21.951 | 39.535 | 109.513 | 1.00 | 29.76 | | | | C |
| ANISOU | 4956 | CG | LEU | B | 109 | 3929 | 4985 | 2394 | 436 | 114 | -237 | | | C |
| ATOM | 4958 | CD1 | LEU | B | 109 | 22.678 | 40.691 | 110.241 | 1.00 | 30.45 | | | | C |
| ANISOU | 4958 | CD1 | LEU | B | 109 | 3933 | 5199 | 2438 | 379 | 75 | -395 | | | C |
| ATOM | 4962 | CD2 | LEU | B | 109 | 22.933 | 38.442 | 108.956 | 1.00 | 28.59 | | | | C |
| ANISOU | 4962 | CD2 | LEU | B | 109 | 3770 | 4829 | 2263 | 518 | 82 | -137 | | | C |
| ATOM | 4966 | C | LEU | B | 109 | 18.864 | 37.720 | 111.094 | 1.00 | 26.78 | | | | C |
| ANISOU | 4966 | C | LEU | B | 109 | 3730 | 4605 | 1838 | 470 | 225 | 21 | | | C |
| ATOM | 4967 | O | LEU | B | 109 | 17.742 | 38.194 | 111.072 | 1.00 | 26.00 | | | | O |
| ANISOU | 4967 | O | LEU | B | 109 | 3633 | 4471 | 1773 | 422 | 287 | -2 | | | O |
| ATOM | 4969 | N | TYR | B | 110 | 19.282 | 36.927 | 112.060 | 1.00 | 27.25 | | | | N |
| ANISOU | 4969 | N | TYR | B | 110 | 3808 | 4779 | 1766 | 533 | 194 | 106 | | | N |
| ATOM | 4970 | CA | TYR | B | 110 | 18.623 | 36.895 | 113.351 | 1.00 | 29.97 | | | | C |
| ANISOU | 4970 | CA | TYR | B | 110 | 4171 | 5255 | 1961 | 535 | 227 | 132 | | | C |
| ATOM | 4972 | CB | TYR | B | 110 | 18.016 | 35.514 | 113.632 | 1.00 | 28.42 | | | | C |
| ANISOU | 4972 | CB | TYR | B | 110 | 4058 | 5017 | 1721 | 562 | 267 | 328 | | | C |
| ATOM | 4975 | CG | TYR | B | 110 | 17.261 | 35.469 | 114.918 | 1.00 | 28.40 | | | | C |
| ANISOU | 4975 | CG | TYR | B | 110 | 4075 | 5156 | 1559 | 556 | 322 | 372 | | | C |
| ATOM | 4976 | CD1 | TYR | B | 110 | 15.990 | 35.975 | 114.974 | 1.00 | 28.64 | | | | C |
| ANISOU | 4976 | CD1 | TYR | B | 110 | 4092 | 5171 | 1620 | 487 | 416 | 331 | | | C |
| ATOM | 4978 | CE1 | TYR | B | 110 | 15.271 | 35.965 | 116.108 | 1.00 | 29.68 | | | | C |
| ANISOU | 4978 | CE1 | TYR | B | 110 | 4234 | 5437 | 1606 | 481 | 488 | 364 | | | C |
| ATOM | 4980 | CZ | TYR | B | 110 | 15.804 | 35.474 | 117.261 | 1.00 | 31.76 | | | | C |
| ANISOU | 4980 | CZ | TYR | B | 110 | 4536 | 5866 | 1667 | 539 | 460 | 443 | | | C |
| ATOM | 4981 | OH | TYR | B | 110 | 14.989 | 35.518 | 118.346 | 1.00 | 33.82 | | | | O |
| ANISOU | 4981 | OH | TYR | B | 110 | 4811 | 6266 | 1771 | 524 | 552 | 472 | | | O |
| ATOM | 4983 | CE2 | TYR | B | 110 | 17.075 | 34.949 | 117.284 | 1.00 | 31.59 | | | | C |
| ANISOU | 4983 | CE2 | TYR | B | 110 | 4527 | 5876 | 1599 | 615 | 349 | 501 | | | C |
| ATOM | 4985 | CD2 | TYR | B | 110 | 17.819 | 34.947 | 116.084 | 1.00 | 30.78 | | | | C |
| ANISOU | 4985 | CD2 | TYR | B | 110 | 4400 | 5626 | 1670 | 627 | 283 | 462 | | | C |
| ATOM | 4987 | C | TYR | B | 110 | 19.676 | 37.260 | 114.399 | 1.00 | 30.61 | | | | C |
| ANISOU | 4987 | C | TYR | B | 110 | 4202 | 5545 | 1885 | 575 | 148 | 66 | | | C |
| ATOM | 4988 | O | TYR | B | 110 | 20.781 | 36.755 | 114.331 | 1.00 | 31.62 | | | | O |
| ANISOU | 4988 | O | TYR | B | 110 | 4300 | 5719 | 1995 | 640 | 69 | 118 | | | O |
| ATOM | 4990 | N | ASP | B | 111 | 19.305 | 38.140 | 115.336 | 1.00 | 32.96 | | | | N |
| ANISOU | 4990 | N | ASP | B | 111 | 4483 | 5971 | 2068 | 535 | 173 | -56 | | | N |
| ATOM | 4991 | CA | ASP | B | 111 | 20.162 | 38.629 | 116.418 | 1.00 | 35.65 | | | | C |
| ANISOU | 4991 | CA | ASP | B | 111 | 4780 | 6537 | 2228 | 538 | 96 | -156 | | | C |
| ATOM | 4993 | CB | ASP | B | 111 | 19.941 | 40.145 | 116.533 | 1.00 | 35.48 | | | | C |
| ANISOU | 4993 | CB | ASP | B | 111 | 4735 | 6514 | 2233 | 448 | 136 | -398 | | | C |
| ATOM | 4996 | CG | ASP | B | 111 | 20.863 | 40.811 | 117.512 | 1.00 | 37.03 | | | | C |
| ANISOU | 4996 | CG | ASP | B | 111 | 4886 | 6926 | 2258 | 408 | 52 | -555 | | | C |
| ATOM | 4997 | OD1 | ASP | B | 111 | 21.407 | 40.128 | 118.391 | 1.00 | 37.87 | | | | O |
| ANISOU | 4997 | OD1 | ASP | B | 111 | 4980 | 7239 | 2168 | 459 | -31 | -467 | | | O |
| ATOM | 4998 | OD2 | ASP | B | 111 | 21.019 | 42.027 | 117.379 | 1.00 | 36.70 | | | | O |
| ANISOU | 4998 | OD2 | ASP | B | 111 | 4825 | 6841 | 2280 | 322 | 69 | -764 | | | O |
| ATOM | 4999 | C | ASP | B | 111 | 19.793 | 37.917 | 117.717 | 1.00 | 38.07 | | | | C |
| ANISOU | 4999 | C | ASP | B | 111 | 5138 | 7020 | 2307 | 586 | 107 | -37 | | | C |
| ATOM | 5000 | O | ASP | B | 111 | 18.738 | 38.202 | 118.300 | 1.00 | 39.03 | | | | O |
| ANISOU | 5000 | O | ASP | B | 111 | 5302 | 7169 | 2357 | 554 | 207 | -67 | | | O |
| ATOM | 5002 | N | TYR | B | 112 | 20.666 | 37.026 | 118.207 | 1.00 | 41.35 | | | | N |
| ANISOU | 5002 | N | TYR | B | 112 | 5543 | 7568 | 2600 | 671 | 12 | 105 | | | N |
| ATOM | 5003 | CA | TYR | B | 112 | 20.414 | 36.329 | 119.476 | 1.00 | 43.80 | | | | C |
| ANISOU | 5003 | CA | TYR | B | 112 | 5909 | 8065 | 2670 | 725 | 15 | 248 | | | C |
| ATOM | 5005 | CB | TYR | B | 112 | 21.327 | 35.106 | 119.630 | 1.00 | 46.97 | | | | C |
| ANISOU | 5005 | CB | TYR | B | 112 | 6307 | 8525 | 3014 | 855 | -79 | 475 | | | C |
| ATOM | 5008 | CG | TYR | B | 112 | 21.067 | 34.049 | 118.594 | 1.00 | 45.85 | | | | C |
| ANISOU | 5008 | CG | TYR | B | 112 | 6229 | 8113 | 3078 | 906 | -20 | 645 | | | C |
| ATOM | 5009 | CD1 | TYR | B | 112 | 19.988 | 33.187 | 118.710 | 1.00 | 45.91 | | | | C |
| ANISOU | 5009 | CD1 | TYR | B | 112 | 6350 | 8000 | 3093 | 901 | 92 | 812 | | | C |
| ATOM | 5011 | CE1 | TYR | B | 112 | 19.753 | 32.195 | 117.757 | 1.00 | 45.21 | | | | C |
| ANISOU | 5011 | CE1 | TYR | B | 112 | 6336 | 7653 | 3190 | 923 | 145 | 947 | | | C |
| ATOM | 5013 | CZ | TYR | B | 112 | 20.602 | 32.068 | 116.678 | 1.00 | 44.02 | | | | C |
| ANISOU | 5013 | CZ | TYR | B | 112 | 6150 | 7370 | 3207 | 970 | 95 | 913 | | | C |
| ATOM | 5014 | OH | TYR | B | 112 | 20.337 | 31.094 | 115.728 | 1.00 | 43.76 | | | | O |
| ANISOU | 5014 | OH | TYR | B | 112 | 6209 | 7075 | 3343 | 981 | 158 | 1018 | | | O |
| ATOM | 5016 | CE2 | TYR | B | 112 | 21.683 | 32.922 | 116.550 | 1.00 | 43.91 | | | | C |
| ANISOU | 5016 | CE2 | TYR | B | 112 | 6010 | 7486 | 3186 | 989 | -8 | 763 | | | C |
| ATOM | 5018 | CD2 | TYR | B | 112 | 21.902 | 33.902 | 117.505 | 1.00 | 44.91 | | | | C |
| ANISOU | 5018 | CD2 | TYR | B | 112 | 6059 | 7864 | 3140 | 947 | -69 | 632 | | | C |
| ATOM | 5020 | C | TYR | B | 112 | 20.537 | 37.206 | 120.715 | 1.00 | 45.65 | | | | C |
| ANISOU | 5020 | C | TYR | B | 112 | 6123 | 8563 | 2659 | 678 | -15 | 86 | | | C |
| ATOM | 5021 | O | TYR | B | 112 | 19.981 | 36.851 | 121.757 | 1.00 | 47.71 | | | | O |

FIG. 18 (continued)

| | | | | | | | | | | | | | |
|---|---|---|---|---|---|---|---|---|---|---|---|---|---|
| ANISOU | 5021 | O | TYR | B | 112 | 6446 | 8969 | 2711 | 697 | 32 | 172 | | O |
| ATOM | 5023 | N | LYS | B | 113 | 21.257 | 38.328 | 120.617 | 1.00 | 45.89 | | | N |
| ANISOU | 5023 | N | LYS | B | 113 | 6075 | 8655 | 2706 | 605 | -86 | -148 | | N |
| ATOM | 5024 | CA | LYS | B | 113 | 21.423 | 39.237 | 121.762 | 1.00 | 48.68 | | | C |
| ANISOU | 5024 | CA | LYS | B | 113 | 6422 | 9250 | 2824 | 534 | -116 | -348 | | C |
| ATOM | 5026 | CB | LYS | B | 113 | 22.627 | 40.183 | 121.570 | 1.00 | 49.74 | | | C |
| ANISOU | 5026 | CB | LYS | B | 113 | 6448 | 9462 | 2988 | 450 | -242 | -564 | | C |
| ATOM | 5029 | CG | LYS | B | 113 | 22.909 | 41.103 | 122.759 | 1.00 | 52.97 | | | C |
| ANISOU | 5029 | CG | LYS | B | 113 | 6857 | 10129 | 3142 | 350 | -291 | -797 | | C |
| ATOM | 5032 | CD | LYS | B | 113 | 24.375 | 41.515 | 122.809 | 1.00 | 55.20 | | | C |
| ANISOU | 5032 | CD | LYS | B | 113 | 7002 | 10590 | 3383 | 282 | -474 | -914 | | C |
| ATOM | 5035 | CE | LYS | B | 113 | 24.710 | 42.296 | 124.074 | 1.00 | 58.77 | | | C |
| ANISOU | 5035 | CE | LYS | B | 113 | 7455 | 11336 | 3538 | 166 | -548 | -1144 | | C |
| ATOM | 5038 | NZ | LYS | B | 113 | 24.455 | 43.741 | 123.838 | 1.00 | 60.74 | | | N |
| ANISOU | 5038 | NZ | LYS | B | 113 | 7747 | 11424 | 3907 | 4 | -456 | -1474 | | N |
| ATOM | 5042 | C | LYS | B | 113 | 20.142 | 40.029 | 121.964 | 1.00 | 46.60 | | | C |
| ANISOU | 5042 | C | LYS | B | 113 | 6235 | 8898 | 2575 | 469 | 52 | -494 | | C |
| ATOM | 5043 | O | LYS | B | 113 | 19.602 | 40.057 | 123.045 | 1.00 | 47.40 | | | O |
| ANISOU | 5043 | O | LYS | B | 113 | 6395 | 9166 | 2450 | 468 | 111 | -511 | | O |
| ATOM | 5045 | N | GLU | B | 114 | 19.645 | 40.641 | 120.895 | 1.00 | 44.13 | | | N |
| ANISOU | 5045 | N | GLU | B | 114 | 5915 | 8325 | 2526 | 430 | 137 | -583 | | N |
| ATOM | 5046 | CA | GLU | B | 114 | 18.406 | 41.423 | 120.958 | 1.00 | 43.45 | | | C |
| ANISOU | 5046 | CA | GLU | B | 114 | 5880 | 8133 | 2495 | 396 | 305 | -707 | | C |
| ATOM | 5048 | CB | GLU | B | 114 | 18.458 | 42.558 | 119.945 | 1.00 | 42.62 | | | C |
| ANISOU | 5048 | CB | GLU | B | 114 | 5746 | 7808 | 2641 | 336 | 336 | -887 | | C |
| ATOM | 5051 | CG | GLU | B | 114 | 19.626 | 43.499 | 120.101 | 1.00 | 44.92 | | | C |
| ANISOU | 5051 | CG | GLU | B | 114 | 6000 | 8168 | 2901 | 247 | 235 | -1111 | | C |
| ATOM | 5054 | CD | GLU | B | 114 | 19.587 | 44.333 | 121.368 | 1.00 | 48.42 | | | C |
| ANISOU | 5054 | CD | GLU | B | 114 | 6494 | 8788 | 3116 | 184 | 267 | -1343 | | C |
| ATOM | 5055 | OE1 | GLU | B | 114 | 18.515 | 44.479 | 122.000 | 1.00 | 51.06 | | | O |
| ANISOU | 5055 | OE1 | GLU | B | 114 | 6898 | 9143 | 3359 | 215 | 408 | -1373 | | O |
| ATOM | 5056 | OE2 | GLU | B | 114 | 20.652 | 44.871 | 121.711 | 1.00 | 51.61 | | | O |
| ANISOU | 5056 | OE2 | GLU | B | 114 | 6861 | 9315 | 3432 | 93 | 153 | -1509 | | O |
| ATOM | 5057 | C | GLU | B | 114 | 17.141 | 40.597 | 120.683 | 1.00 | 41.31 | | | C |
| ANISOU | 5057 | C | GLU | B | 114 | 5643 | 7751 | 2301 | 448 | 429 | -501 | | C |
| ATOM | 5058 | O | GLU | B | 114 | 16.024 | 41.119 | 120.722 | 1.00 | 40.36 | | | O |
| ANISOU | 5058 | O | GLU | B | 114 | 5539 | 7561 | 2235 | 439 | 575 | -565 | | O |
| ATOM | 5060 | N | ASN | B | 115 | 17.318 | 39.320 | 120.385 | 1.00 | 39.83 | | | N |
| ANISOU | 5060 | N | ASN | B | 115 | 5462 | 7540 | 2131 | 501 | 377 | -258 | | N |
| ATOM | 5061 | CA | ASN | B | 115 | 16.193 | 38.408 | 120.148 | 1.00 | 39.45 | | | C |
| ANISOU | 5061 | CA | ASN | B | 115 | 5448 | 7389 | 2150 | 521 | 483 | -55 | | C |
| ATOM | 5063 | CB | ASN | B | 115 | 15.436 | 38.114 | 121.457 | 1.00 | 43.79 | | | C |
| ANISOU | 5063 | CB | ASN | B | 115 | 6050 | 8130 | 2461 | 531 | 585 | 11 | | C |
| ATOM | 5066 | CG | ASN | B | 115 | 16.355 | 37.626 | 122.552 | 1.00 | 46.27 | | | C |
| ANISOU | 5066 | CG | ASN | B | 115 | 6397 | 8690 | 2494 | 575 | 481 | 81 | | C |
| ATOM | 5067 | OD1 | ASN | B | 115 | 16.377 | 38.180 | 123.655 | 1.00 | 51.08 | | | O |
| ANISOU | 5067 | OD1 | ASN | B | 115 | 7027 | 9519 | 2863 | 561 | 499 | -41 | | O |
| ATOM | 5068 | ND2 | ASN | B | 115 | 17.132 | 36.591 | 122.249 | 1.00 | 47.02 | | | N |
| ANISOU | 5068 | ND2 | ASN | B | 115 | 6497 | 8756 | 2612 | 635 | 372 | 275 | | N |
| ATOM | 5071 | C | ASN | B | 115 | 15.255 | 38.881 | 119.037 | 1.00 | 36.84 | | | C |
| ANISOU | 5071 | C | ASN | B | 115 | 5085 | 6834 | 2077 | 484 | 575 | -100 | | C |
| ATOM | 5072 | O | ASN | B | 115 | 14.030 | 38.944 | 119.179 | 1.00 | 35.43 | | | O |
| ANISOU | 5072 | O | ASN | B | 115 | 4902 | 6636 | 1923 | 471 | 707 | -73 | | O |
| ATOM | 5074 | N | ARG | B | 116 | 15.823 | 39.220 | 117.891 | 1.00 | 34.46 | | | N |
| ANISOU | 5074 | N | ARG | B | 116 | 4749 | 6375 | 1969 | 470 | 505 | -158 | | N |
| ATOM | 5075 | CA | ARG | B | 116 | 14.969 | 39.711 | 116.819 | 1.00 | 31.97 | | | C |
| ANISOU | 5075 | CA | ARG | B | 116 | 4399 | 5869 | 1877 | 442 | 576 | -187 | | C |
| ATOM | 5077 | CB | ARG | B | 116 | 14.730 | 41.205 | 116.994 | 1.00 | 32.93 | | | C |
| ANISOU | 5077 | CB | ARG | B | 116 | 4498 | 5982 | 2034 | 428 | 642 | -410 | | C |
| ATOM | 5080 | CG | ARG | B | 116 | 15.954 | 42.103 | 116.855 | 1.00 | 32.17 | | | C |
| ANISOU | 5080 | CG | ARG | B | 116 | 4394 | 5878 | 1953 | 399 | 554 | -590 | | C |
| ATOM | 5083 | CD | ARG | B | 116 | 15.744 | 43.430 | 117.541 | 1.00 | 34.50 | | | C |
| ANISOU | 5083 | CD | ARG | B | 116 | 4705 | 6202 | 2202 | 379 | 636 | -822 | | C |
| ATOM | 5086 | NE | ARG | B | 116 | 16.915 | 44.293 | 117.370 | 1.00 | 34.39 | | | N |
| ANISOU | 5086 | NE | ARG | B | 116 | 4684 | 6163 | 2219 | 317 | 554 | -1000 | | N |
| ATOM | 5088 | CZ | ARG | B | 116 | 17.213 | 45.338 | 118.147 | 1.00 | 36.72 | | | C |
| ANISOU | 5088 | CZ | ARG | B | 116 | 5011 | 6517 | 2423 | 266 | 581 | -1235 | | C |
| ATOM | 5089 | NH1 | ARG | B | 116 | 16.420 | 45.702 | 119.148 | 1.00 | 37.90 | | | N |
| ANISOU | 5089 | NH1 | ARG | B | 116 | 5210 | 6753 | 2439 | 287 | 699 | -1332 | | N |
| ATOM | 5092 | NH2 | ARG | B | 116 | 18.317 | 46.048 | 117.900 | 1.00 | 36.51 | | | N |
| ANISOU | 5092 | NH2 | ARG | B | 116 | 4967 | 6459 | 2444 | 182 | 499 | -1385 | | N |
| ATOM | 5095 | C | ARG | B | 116 | 15.539 | 39.433 | 115.434 | 1.00 | 29.24 | | | C |
| ANISOU | 5095 | C | ARG | B | 116 | 4039 | 5352 | 1718 | 432 | 494 | -139 | | C |
| ATOM | 5096 | O | ARG | B | 116 | 16.745 | 39.347 | 115.294 | 1.00 | 29.15 | | | O |
| ANISOU | 5096 | O | ARG | B | 116 | 4025 | 5363 | 1689 | 445 | 393 | -164 | | O |
| ATOM | 5098 | N | PHE | B | 117 | 14.668 | 39.348 | 114.411 | 1.00 | 27.53 | | | N |
| ANISOU | 5098 | N | PHE | B | 117 | 3804 | 4984 | 1673 | 406 | 540 | -79 | | N |
| ATOM | 5099 | CA | PHE | B | 117 | 15.077 | 39.320 | 113.010 | 1.00 | 28.89 | | | C |
| ANISOU | 5099 | CA | PHE | B | 117 | 3967 | 4997 | 2013 | 388 | 481 | -66 | | C |

FIG. 18 (continued)

| | | | | | | | | | | | | | | |
|---|---|---|---|---|---|---|---|---|---|---|---|---|---|---|
| ATOM | 5101 | CB | PHE | B | 117 | 13.959 | 38.802 | 112.082 | 1.00 | 27.78 | | | | C |
| ANISOU | 5101 | CB | PHE | B | 117 | 3816 | 4742 | 1997 | 348 | 519 | 48 | | | C |
| ATOM | 5104 | CG | PHE | B | 117 | 13.680 | 37.319 | 112.212 | 1.00 | 27.80 | | | | C |
| ANISOU | 5104 | CG | PHE | B | 117 | 3874 | 4737 | 1952 | 326 | 520 | 217 | | | C |
| ATOM | 5105 | CD1 | PHE | B | 117 | 14.522 | 36.376 | 111.587 | 1.00 | 25.30 | | | | C |
| ANISOU | 5105 | CD1 | PHE | B | 117 | 3622 | 4331 | 1660 | 334 | 452 | 288 | | | C |
| ATOM | 5107 | CE1 | PHE | B | 117 | 14.281 | 35.014 | 111.698 | 1.00 | 28.03 | | | | C |
| ANISOU | 5107 | CE1 | PHE | B | 117 | 4042 | 4628 | 1979 | 315 | 467 | 439 | | | C |
| ATOM | 5109 | CZ | PHE | B | 117 | 13.163 | 34.563 | 112.439 | 1.00 | 29.12 | | | | C |
| ANISOU | 5109 | CZ | PHE | B | 117 | 4182 | 4821 | 2063 | 267 | 549 | 535 | | | C |
| ATOM | 5111 | CE2 | PHE | B | 117 | 12.309 | 35.498 | 113.053 | 1.00 | 28.99 | | | | C |
| ANISOU | 5111 | CE2 | PHE | B | 117 | 4080 | 4921 | 2014 | 258 | 619 | 470 | | | C |
| ATOM | 5113 | CD2 | PHE | B | 117 | 12.564 | 36.865 | 112.931 | 1.00 | 27.36 | | | | C |
| ANISOU | 5113 | CD2 | PHE | B | 117 | 3809 | 4748 | 1838 | 297 | 606 | 307 | | | C |
| ATOM | 5115 | C | PHE | B | 117 | 15.494 | 40.728 | 112.573 | 1.00 | 30.17 | | | | C |
| ANISOU | 5115 | C | PHE | B | 117 | 4093 | 5104 | 2268 | 379 | 475 | -237 | | | C |
| ATOM | 5116 | O | PHE | B | 117 | 14.955 | 41.728 | 113.081 | 1.00 | 29.70 | | | | O |
| ANISOU | 5116 | O | PHE | B | 117 | 4013 | 5066 | 2204 | 384 | 550 | -349 | | | O |
| ATOM | 5118 | N | ILE | B | 118 | 16.501 | 40.806 | 111.694 | 1.00 | 29.93 | | | | N |
| ANISOU | 5118 | N | ILE | B | 118 | 4058 | 4998 | 2317 | 368 | 402 | -259 | | | N |
| ATOM | 5119 | CA | ILE | B | 118 | 16.957 | 42.098 | 111.124 | 1.00 | 30.71 | | | | C |
| ANISOU | 5119 | CA | ILE | B | 118 | 4129 | 5015 | 2524 | 341 | 403 | -397 | | | C |
| ATOM | 5121 | CB | ILE | B | 118 | 18.425 | 42.465 | 111.482 | 1.00 | 33.30 | | | | C |
| ANISOU | 5121 | CB | ILE | B | 118 | 4436 | 5418 | 2796 | 319 | 330 | -509 | | | C |
| ATOM | 5123 | CG1 | ILE | B | 118 | 18.722 | 42.210 | 112.968 | 1.00 | 37.85 | | | | C |
| ANISOU | 5123 | CG1 | ILE | B | 118 | 5017 | 6193 | 3172 | 334 | 303 | -550 | | | C |
| ATOM | 5126 | CD1 | ILE | B | 118 | 20.183 | 42.510 | 113.374 | 1.00 | 37.19 | | | | C |
| ANISOU | 5126 | CD1 | ILE | B | 118 | 4884 | 6231 | 3015 | 302 | 207 | -656 | | | C |
| ATOM | 5130 | CG2 | ILE | B | 118 | 18.661 | 43.921 | 111.127 | 1.00 | 35.15 | | | | C |
| ANISOU | 5130 | CG2 | ILE | B | 118 | 4656 | 5557 | 3142 | 267 | 364 | -665 | | | C |
| ATOM | 5134 | C | ILE | B | 118 | 16.898 | 42.055 | 109.608 | 1.00 | 30.25 | | | | C |
| ANISOU | 5134 | C | ILE | B | 118 | 4068 | 4807 | 2619 | 324 | 390 | -330 | | | C |
| ATOM | 5135 | O | ILE | B | 118 | 17.404 | 41.118 | 108.969 | 1.00 | 26.54 | | | | O |
| ANISOU | 5135 | O | ILE | B | 118 | 3617 | 4313 | 2154 | 326 | 338 | -241 | | | O |
| ATOM | 5137 | N | GLU | B | 119 | 16.300 | 43.095 | 109.034 | 1.00 | 30.61 | | | | N |
| ANISOU | 5137 | N | GLU | B | 119 | 4097 | 4751 | 2784 | 316 | 442 | -372 | | | N |
| ATOM | 5138 | CA | GLU | B | 119 | 16.299 | 43.297 | 107.592 | 1.00 | 28.52 | | | | C |
| ANISOU | 5138 | CA | GLU | B | 119 | 3830 | 4361 | 2647 | 298 | 428 | -316 | | | C |
| ATOM | 5140 | CB | GLU | B | 119 | 14.867 | 43.611 | 107.183 | 1.00 | 31.75 | | | | C |
| ANISOU | 5140 | CB | GLU | B | 119 | 4211 | 4720 | 3134 | 320 | 481 | -247 | | | C |
| ATOM | 5143 | CG | GLU | B | 119 | 14.397 | 42.963 | 105.949 | 1.00 | 33.38 | | | | C |
| ANISOU | 5143 | CG | GLU | B | 119 | 4414 | 4881 | 3386 | 296 | 440 | -119 | | | C |
| ATOM | 5146 | CD | GLU | B | 119 | 13.039 | 43.499 | 105.558 | 1.00 | 33.31 | | | | C |
| ANISOU | 5146 | CD | GLU | B | 119 | 4344 | 4853 | 3460 | 323 | 479 | -53 | | | C |
| ATOM | 5147 | OE1 | GLU | B | 119 | 12.231 | 43.810 | 106.478 | 1.00 | 40.58 | | | | O |
| ANISOU | 5147 | OE1 | GLU | B | 119 | 5219 | 5825 | 4373 | 366 | 548 | -75 | | | O |
| ATOM | 5148 | OE2 | GLU | B | 119 | 12.786 | 43.647 | 104.347 | 1.00 | 36.34 | | | | O |
| ANISOU | 5148 | OE2 | GLU | B | 119 | 4717 | 5183 | 3909 | 310 | 445 | 22 | | | O |
| ATOM | 5149 | C | GLU | B | 119 | 17.215 | 44.471 | 107.282 | 1.00 | 27.37 | | | | C |
| ANISOU | 5149 | C | GLU | B | 119 | 3680 | 4143 | 2576 | 270 | 434 | -430 | | | C |
| ATOM | 5150 | O | GLU | B | 119 | 16.982 | 45.571 | 107.765 | 1.00 | 28.77 | | | | O |
| ANISOU | 5150 | O | GLU | B | 119 | 3856 | 4281 | 2794 | 273 | 494 | -533 | | | O |
| ATOM | 5152 | N | ILE | B | 120 | 18.281 | 44.228 | 106.516 | 1.00 | 25.83 | | | | N |
| ANISOU | 5152 | N | ILE | B | 120 | 3486 | 3926 | 2402 | 239 | 386 | -416 | | | N |
| ATOM | 5153 | CA | ILE | B | 120 | 19.241 | 45.239 | 106.186 | 1.00 | 26.63 | | | | C |
| ANISOU | 5153 | CA | ILE | B | 120 | 3573 | 3969 | 2577 | 188 | 396 | -510 | | | C |
| ATOM | 5155 | CB | ILE | B | 120 | 20.683 | 44.709 | 106.242 | 1.00 | 25.81 | | | | C |
| ANISOU | 5155 | CB | ILE | B | 120 | 3431 | 3955 | 2420 | 161 | 334 | -538 | | | C |
| ATOM | 5157 | CG1 | ILE | B | 120 | 21.080 | 44.293 | 107.671 | 1.00 | 27.39 | | | | C |
| ANISOU | 5157 | CG1 | ILE | B | 120 | 3605 | 4320 | 2483 | 175 | 287 | -604 | | | C |
| ATOM | 5160 | CD1 | ILE | B | 120 | 21.999 | 43.061 | 107.779 | 1.00 | 25.76 | | | | C |
| ANISOU | 5160 | CD1 | ILE | B | 120 | 3364 | 4233 | 2192 | 219 | 214 | -532 | | | C |
| ATOM | 5164 | CG2 | ILE | B | 120 | 21.631 | 45.804 | 105.757 | 1.00 | 30.56 | | | | C |
| ANISOU | 5164 | CG2 | ILE | B | 120 | 4004 | 4491 | 3118 | 81 | 356 | -625 | | | C |
| ATOM | 5168 | C | ILE | B | 120 | 18.954 | 45.733 | 104.762 | 1.00 | 28.15 | | | | C |
| ANISOU | 5168 | C | ILE | B | 120 | 3783 | 4022 | 2890 | 178 | 426 | -430 | | | C |
| ATOM | 5169 | O | ILE | B | 120 | 18.853 | 44.937 | 103.824 | 1.00 | 34.03 | | | | O |
| ANISOU | 5169 | O | ILE | B | 120 | 4543 | 4763 | 3625 | 187 | 397 | -321 | | | O |
| ATOM | 5171 | N | GLY | B | 121 | 18.829 | 47.041 | 104.601 | 1.00 | 26.16 | | | | N |
| ANISOU | 5171 | N | GLY | B | 121 | 3541 | 3654 | 2744 | 160 | 487 | -485 | | | N |
| ATOM | 5172 | CA | GLY | B | 121 | 18.627 | 47.625 | 103.294 | 1.00 | 24.56 | | | | C |
| ANISOU | 5172 | CA | GLY | B | 121 | 3360 | 3325 | 2648 | 157 | 518 | -392 | | | C |
| ATOM | 5175 | C | GLY | B | 121 | 19.725 | 48.585 | 102.926 | 1.00 | 23.50 | | | | C |
| ANISOU | 5175 | C | GLY | B | 121 | 3231 | 3101 | 2597 | 79 | 554 | -460 | | | C |
| ATOM | 5176 | O | GLY | B | 121 | 20.291 | 49.268 | 103.800 | 1.00 | 24.73 | | | | O |
| ANISOU | 5176 | O | GLY | B | 121 | 3381 | 3246 | 2771 | 24 | 579 | -609 | | | O |
| ATOM | 5178 | N | VAL | B | 122 | 20.033 | 48.611 | 101.626 | 1.00 | 23.48 | | | | N |
| ANISOU | 5178 | N | VAL | B | 122 | 3243 | 3046 | 2634 | 58 | 560 | -354 | | | N |
| ATOM | 5179 | CA | VAL | B | 122 | 21.055 | 49.485 | 101.064 | 1.00 | 23.51 | | | | C |

FIG. 18 (continued)

```
ANISOU 5179  CA  VAL B 122    3250   2960   2723    -29    610   -382      C
ATOM   5181  CB  VAL B 122     22.313  48.741 100.523  1.00 22.63         C
ANISOU 5181  CB  VAL B 122    3093   2950   2554    -83    580   -374      C
ATOM   5183  CG1 VAL B 122     23.374  49.765 100.100  1.00 24.40         C
ANISOU 5183  CG1 VAL B 122    3300   3091   2879   -195    648   -415      C
ATOM   5187  CG2 VAL B 122     22.930  47.782 101.580  1.00 22.86         C
ANISOU 5187  CG2 VAL B 122    3058   3147   2481    -76    510   -467      C
ATOM   5191  C   VAL B 122     20.431  50.309  99.932  1.00 24.61         C
ANISOU 5191  C   VAL B 122    3444   2948   2959     -4    668   -247      C
ATOM   5192  O   VAL B 122     19.817  49.756  99.005  1.00 23.82         O
ANISOU 5192  O   VAL B 122    3358   2881   2810     48    635   -103      O
ATOM   5194  N   THR B 123     20.635  51.627  99.985  1.00 26.51         N
ANISOU 5194  N   THR B 123    3719   3023   3330    -48    752   -290      N
ATOM   5195  CA  THR B 123     19.968  52.547  99.070  1.00 27.15         C
ANISOU 5195  CA  THR B 123    3859   2938   3518      1    818   -146      C
ATOM   5197  CB  THR B 123     18.691  53.188  99.704  1.00 28.31         C
ANISOU 5197  CB  THR B 123    4030   2984   3744    116    859   -149      C
ATOM   5199  OG1 THR B 123     18.003  53.988  98.720  1.00 29.11         O
ANISOU 5199  OG1 THR B 123    4175   2940   3945    195    911     33      O
ATOM   5201  CG2 THR B 123     19.026  54.036 100.978  1.00 28.44         C
ANISOU 5201  CG2 THR B 123    4074   2895   3838     66    932   -365      C
ATOM   5205  C   THR B 123     20.896  53.628  98.528  1.00 29.22         C
ANISOU 5205  C   THR B 123    4164   3041   3899   -106    909   -145      C
ATOM   5206  O   THR B 123     21.870  54.041  99.179  1.00 29.71         O
ANISOU 5206  O   THR B 123    4209   3075   4005   -226    941   -306      O
ATOM   5208  N   ARG B 124     20.626  54.026  97.290  1.00 29.03         N
ANISOU 5208  N   ARG B 124    4186   2932   3911    -75    945     46      N
ATOM   5209  CA  ARG B 124     21.316  55.133  96.635  1.00 33.29         C
ANISOU 5209  CA  ARG B 124    4783   3291   4574   -164   1053    100      C
ATOM   5211  CB  ARG B 124     21.523  54.828  95.164  1.00 33.45         C
ANISOU 5211  CB  ARG B 124    4820   3372   4519   -168   1049    301      C
ATOM   5214  CG  ARG B 124     22.419  53.619  94.884  1.00 32.75         C
ANISOU 5214  CG  ARG B 124    4663   3501   4279   -234    991    255      C
ATOM   5217  CD  ARG B 124     21.925  52.892  93.670  1.00 33.78         C
ANISOU 5217  CD  ARG B 124    4819   3746   4270   -167    941    431      C
ATOM   5220  NE  ARG B 124     21.325  51.694  94.070  1.00 32.39         N
ANISOU 5220  NE  ARG B 124    4605   3726   3975    -97    832    382      N
ATOM   5222  CZ  ARG B 124     20.676  50.824  93.309  1.00 30.71         C
ANISOU 5222  CZ  ARG B 124    4409   3635   3625    -42    759    483      C
ATOM   5223  NH1 ARG B 124     20.452  50.988  92.011  1.00 31.86         N
ANISOU 5223  NH1 ARG B 124    4609   3794   3704    -35    767    654      N
ATOM   5226  NH2 ARG B 124     20.195  49.762  93.927  1.00 28.26         N
ANISOU 5226  NH2 ARG B 124    4063   3437   3236     -2    672    407      N
ATOM   5229  C   ARG B 124     20.510  56.423  96.721  1.00 34.80         C
ANISOU 5229  C   ARG B 124    5060   3229   4933    -88   1147    157      C
ATOM   5230  O   ARG B 124     20.951  57.461  96.253  1.00 36.40         O
ANISOU 5230  O   ARG B 124    5334   3233   5265   -154   1254    213      O
ATOM   5232  N   ARG B 125     19.322  56.340  97.298  1.00 35.92         N
ANISOU 5232  N   ARG B 125    5194   3377   5079     57   1120    156      N
ATOM   5233  CA  ARG B 125     18.441  57.494  97.475  1.00 40.20         C
ANISOU 5233  CA  ARG B 125    5805   3684   5786    174   1218    207      C
ATOM   5235  CB  ARG B 125     17.054  57.161  96.938  1.00 40.11         C
ANISOU 5235  CB  ARG B 125    5751   3755   5732    367   1158    413      C
ATOM   5238  CG  ARG B 125     17.029  56.724  95.481  1.00 42.08         C
ANISOU 5238  CG  ARG B 125    5992   4117   5880    374   1089    652      C
ATOM   5246  C   ARG B 125     18.365  57.851  98.961  1.00 40.83         C
ANISOU 5246  C   ARG B 125    5896   3692   5925    163   1268    -46      C
ATOM   5247  O   ARG B 125     18.981  57.181  99.784  1.00 40.54         O
ANISOU 5247  O   ARG B 125    5808   3811   5784     64   1208   -234      O
ATOM   5249  N   GLU B 126     17.600  58.884  99.306  1.00 43.17         N
ANISOU 5249  N   GLU B 126    6262   3762   6377    277   1379    -48      N
ATOM   5250  CA  GLU B 126     17.427  59.303 100.709  1.00 45.03         C
ANISOU 5250  CA  GLU B 126    6530   3918   6661    279   1449   -301      C
ATOM   5252  CB  GLU B 126     16.500  60.524 100.806  1.00 49.72         C
ANISOU 5252  CB  GLU B 126    7216   4220   7454    444   1601   -255      C
ATOM   5255  CG  GLU B 126     17.169  61.843 100.333  1.00 54.11         C
ANISOU 5255  CG  GLU B 126    7916   4432   8212    353   1742   -241      C
ATOM   5258  CD  GLU B 126     16.278  63.059 100.529  1.00 58.36         C
ANISOU 5258  CD  GLU B 126    8563   4645   8965    534   1912   -212      C
ATOM   5259  OE1 GLU B 126     15.063  62.942 100.237  1.00 61.32         O
ANISOU 5259  OE1 GLU B 126    8878   5065   9355    775   1904    -20      O
ATOM   5260  OE2 GLU B 126     16.783  64.131 100.953  1.00 63.10         O
ANISOU 5260  OE2 GLU B 126    9305   4942   9727    435   2058   -376      O
ATOM   5261  C   GLU B 126     16.881  58.144 101.542  1.00 41.97         C
ANISOU 5261  C   GLU B 126    6039   3808   6099    337   1346   -383      C
ATOM   5262  O   GLU B 126     15.891  57.517 101.147  1.00 40.15         O
ANISOU 5262  O   GLU B 126    5734   3709   5811    480   1284   -214      O
ATOM   5264  N   VAL B 127     17.514  57.876 102.693  1.00 40.78         N
ANISOU 5264  N   VAL B 127    5882   3749   5862    219   1327   -635      N
```

FIG. 18 (continued)

```
ATOM    5265  CA  VAL B 127      17.296  56.626 103.450  1.00 37.97          C
ANISOU 5265  CA  VAL B 127     5432   3680   5313    235   1217   -700       C
ATOM    5267  CB  VAL B 127      18.233  56.487 104.714  1.00 38.76          C
ANISOU 5267  CB  VAL B 127     5537   3880   5312     83   1193   -977       C
ATOM    5269  CG1 VAL B 127      19.626  56.006 104.327  1.00 38.37          C
ANISOU 5269  CG1 VAL B 127     5439   3944   5197    -90   1102   -993       C
ATOM    5273  CG2 VAL B 127      18.280  57.788 105.540  1.00 39.52          C
ANISOU 5273  CG2 VAL B 127     5743   3748   5525     42   1332  -1197       C
ATOM    5277  C   VAL B 127      15.859  56.383 103.923  1.00 37.80          C
ANISOU 5277  C   VAL B 127     5370   3719   5272    422   1241   -650       C
ATOM    5278  O   VAL B 127      15.461  55.242 104.121  1.00 33.26          O
ANISOU 5278  O   VAL B 127     4709   3374   4554    454   1147   -601       O
ATOM    5280  N   HIS B 128      15.106  57.444 104.204  1.00 39.84          N
ANISOU 5280  N   HIS B 128     5689   3770   5678    541   1380   -677       N
ATOM    5281  CA  HIS B 128      13.753  57.265 104.737  1.00 41.47          C
ANISOU 5281  CA  HIS B 128     5834   4047   5874    725   1423   -642       C
ATOM    5283  CB  HIS B 128      13.203  58.581 105.288  1.00 46.86          C
ANISOU 5283  CB  HIS B 128     6609   4467   6728    841   1612   -750       C
ATOM    5286  CG  HIS B 128      13.054  59.641 104.251  1.00 49.99          C
ANISOU 5286  CG  HIS B 128     7071   4584   7338    926   1695   -582       C
ATOM    5287  ND1 HIS B 128      14.113  60.409 103.809  1.00 52.26          N
ANISOU 5287  ND1 HIS B 128     7477   4652   7726    782   1734   -627       N
ATOM    5289  CE1 HIS B 128      13.682  61.252 102.886  1.00 53.80          C
ANISOU 5289  CE1 HIS B 128     7719   4619   8103    909   1814   -421       C
ATOM    5291  NE2 HIS B 128      12.386  61.053 102.709  1.00 54.20          N
ANISOU 5291  NE2 HIS B 128     7670   4753   8172   1137   1815   -246       N
ATOM    5293  CD2 HIS B 128      11.970  60.044 103.544  1.00 52.12          C
ANISOU 5293  CD2 HIS B 128     7296   4770   7737   1142   1743   -347       C
ATOM    5295  C   HIS B 128      12.792  56.629 103.705  1.00 40.15          C
ANISOU 5295  C   HIS B 128     5554   4003   5699    852   1341   -354       C
ATOM    5296  O   HIS B 128      11.885  55.895 104.087  1.00 39.23          O
ANISOU 5296  O   HIS B 128     5335   4070   5500    936   1309   -311       O
ATOM    5298  N   ILE B 129      13.049  56.848 102.410  1.00 40.15          N
ANISOU 5298  N   ILE B 129     5569   3925   5763    842   1301   -163       N
ATOM    5299  CA  ILE B 129      12.220  56.287 101.342  1.00 38.48          C
ANISOU 5299  CA  ILE B 129     5256   3844   5521    938   1206    102       C
ATOM    5301  CB  ILE B 129      12.678  56.759  99.940  1.00 39.44          C
ANISOU 5301  CB  ILE B 129     5430   3850   5704    913   1185    293       C
ATOM    5303  CG1 ILE B 129      12.497  58.266  99.777  1.00 42.03          C
ANISOU 5303  CG1 ILE B 129     5853   3867   6251   1023   1338    343       C
ATOM    5306  CD1 ILE B 129      13.257  58.825  98.572  1.00 43.86          C
ANISOU 5306  CD1 ILE B 129     6173   3954   6539    953   1345    496       C
ATOM    5310  CG2 ILE B 129      11.893  56.015  98.849  1.00 38.32          C
ANISOU 5310  CG2 ILE B 129     5183   3902   5475    979   1056    545       C
ATOM    5314  C   ILE B 129      12.202  54.750 101.390  1.00 35.69          C
ANISOU 5314  C   ILE B 129     4809   3783   4967    856   1058    111       C
ATOM    5315  O   ILE B 129      11.131  54.138 101.491  1.00 34.65          O
ANISOU 5315  O   ILE B 129     4568   3809   4789    942   1017    198       O
ATOM    5317  N   TYR B 130      13.384  54.122 101.356  1.00 33.27          N
ANISOU 5317  N   TYR B 130     4543   3545   4553    690    989     21       N
ATOM    5318  CA  TYR B 130      13.461  52.670 101.386  1.00 30.93          C
ANISOU 5318  CA  TYR B 130     4184   3483   4083    620    865     29       C
ATOM    5320  CB  TYR B 130      14.856  52.180 100.919  1.00 30.28          C
ANISOU 5320  CB  TYR B 130     4149   3433   3923    469    803    -13       C
ATOM    5323  CG  TYR B 130      14.950  50.668 100.615  1.00 28.81          C
ANISOU 5323  CG  TYR B 130     3920   3451   3577    415    684     34       C
ATOM    5324  CD1 TYR B 130      13.886  49.991 100.032  1.00 28.65          C
ANISOU 5324  CD1 TYR B 130     3840   3538   3507    466    617    183       C
ATOM    5326  CE1 TYR B 130      13.965  48.622  99.733  1.00 27.06          C
ANISOU 5326  CE1 TYR B 130     3624   3486   3171    401    521    210       C
ATOM    5328  CZ  TYR B 130      15.131  47.939 100.017  1.00 25.29          C
ANISOU 5328  CZ  TYR B 130     3441   3300   2869    316    500    106       C
ATOM    5329  OH  TYR B 130      15.222  46.606  99.722  1.00 25.40          O
ANISOU 5329  OH  TYR B 130     3460   3425   2768    268    425    131       O
ATOM    5331  CE2 TYR B 130      16.198  48.589 100.588  1.00 25.01          C
ANISOU 5331  CE2 TYR B 130     3437   3189   2876    279    554    -24       C
ATOM    5333  CD2 TYR B 130      16.122  49.950 100.867  1.00 26.52          C
ANISOU 5333  CD2 TYR B 130     3647   3234   3194    311    642    -68       C
ATOM    5335  C   TYR B 130      13.104  52.105 102.772  1.00 30.27          C
ANISOU 5335  C   TYR B 130     4062   3521   3918    630    878   -115       C
ATOM    5336  O   TYR B 130      12.593  50.973 102.896  1.00 27.74          O
ANISOU 5336  O   TYR B 130     3673   3382   3487    625    804    -62       O
ATOM    5338  N   TYR B 131      13.360  52.891 103.828  1.00 31.84          N
ANISOU 5338  N   TYR B 131     4314   3620   4163    633    980   -299       N
ATOM    5339  CA  TYR B 131      12.924  52.507 105.169  1.00 33.32          C
ANISOU 5339  CA  TYR B 131     4474   3925   4261    658   1014   -429       C
ATOM    5341  CB  TYR B 131      13.377  53.512 106.238  1.00 35.70          C
ANISOU 5341  CB  TYR B 131     4863   4101   4601    638   1129   -663       C
ATOM    5344  CG  TYR B 131      12.967  53.079 107.634  1.00 35.91          C
```

FIG. 18 (continued)

```
ANISOU 5344  CG  TYR B 131    4870   4278   4495    658   1165   -799        C
ATOM   5345  CD1 TYR B 131     13.838  52.369 108.443  1.00 34.91          C
ANISOU 5345  CD1 TYR B 131    4761   4308   4197    540   1092   -925        C
ATOM   5347  CE1 TYR B 131     13.485  51.971 109.698  1.00 36.50          C
ANISOU 5347  CE1 TYR B 131    4953   4660   4254    557   1125  -1029        C
ATOM   5349  CZ  TYR B 131     12.222  52.258 110.182  1.00 38.41          C
ANISOU 5349  CZ  TYR B 131    5164   4902   4527    690   1247  -1021        C
ATOM   5350  OH  TYR B 131     11.855  51.845 111.454  1.00 39.45          O
ANISOU 5350  OH  TYR B 131    5292   5202   4498    704   1296  -1120        O
ATOM   5352  CE2 TYR B 131     11.329  52.969 109.401  1.00 39.11          C
ANISOU 5352  CE2 TYR B 131    5219   4837   4804    819   1326   -902        C
ATOM   5354  CD2 TYR B 131     11.712  53.373 108.130  1.00 38.22          C
ANISOU 5354  CD2 TYR B 131    5121   4573   4830    804   1276   -786        C
ATOM   5356  C   TYR B 131     11.394  52.381 105.254  1.00 34.72          C
ANISOU 5356  C   TYR B 131    4553   4168   4470    806   1055   -311        C
ATOM   5357  O   TYR B 131     10.851  51.400 105.792  1.00 33.31          O
ANISOU 5357  O   TYR B 131    4304   4176   4177    804   1020   -293        O
ATOM   5359  N   LEU B 132     10.698  53.398 104.772  1.00 36.49          N
ANISOU 5359  N   LEU B 132    4767   4241   4857    936   1140   -224        N
ATOM   5360  CA  LEU B 132      9.248  53.364 104.779  1.00 39.65          C
ANISOU 5360  CA  LEU B 132    5043   4717   5307   1091   1180    -95        C
ATOM   5362  CB  LEU B 132      8.678  54.730 104.372  1.00 42.59          C
ANISOU 5362  CB  LEU B 132    5425   4873   5884   1263   1300    -21        C
ATOM   5365  CG  LEU B 132      8.919  55.778 105.459  1.00 45.46          C
ANISOU 5365  CG  LEU B 132    5901   5046   6326   1307   1476   -251        C
ATOM   5367  CD1 LEU B 132      8.571  57.164 104.958  1.00 48.05          C
ANISOU 5367  CD1 LEU B 132    6280   5097   6879   1467   1603   -179        C
ATOM   5371  CD2 LEU B 132      8.131  55.406 106.752  1.00 46.26          C
ANISOU 5371  CD2 LEU B 132    5934   5301   6343   1372   1561   -370        C
ATOM   5375  C   LEU B 132      8.688  52.204 103.939  1.00 39.12          C
ANISOU 5375  C   LEU B 132    4855   4851   5156   1058   1035    104        C
ATOM   5376  O   LEU B 132      7.728  51.551 104.344  1.00 38.27          O
ANISOU 5376  O   LEU B 132    4629   4911   5001   1094   1031    153        O
ATOM   5378  N   GLU B 133      9.308  51.909 102.800  1.00 39.49          N
ANISOU 5378  N   GLU B 133    4937   4890   5177    972    922    204        N
ATOM   5379  CA  GLU B 133      8.903  50.776 101.963  1.00 39.16          C
ANISOU 5379  CA  GLU B 133    4812   5029   5037    909    780    357        C
ATOM   5381  CB  GLU B 133      9.764  50.780 100.711  1.00 40.59          C
ANISOU 5381  CB  GLU B 133    5071   5152   5198    829    697    433        C
ATOM   5384  CG  GLU B 133      9.376  49.803  99.641  1.00 41.89          C
ANISOU 5384  CG  GLU B 133    5178   5475   5263    765    557    583        C
ATOM   5387  CD  GLU B 133     10.324  49.905  98.446  1.00 42.10          C
ANISOU 5387  CD  GLU B 133    5301   5440   5254    692    503    639        C
ATOM   5388  OE1 GLU B 133     10.627  51.040  98.003  1.00 45.11          O
ANISOU 5388  OE1 GLU B 133    5735   5665   5739    754    565    690        O
ATOM   5389  OE2 GLU B 133     10.797  48.859  97.984  1.00 44.40          O
ANISOU 5389  OE2 GLU B 133    5626   5827   5418    574    417    627        O
ATOM   5390  C   GLU B 133      9.024  49.411 102.686  1.00 37.84          C
ANISOU 5390  C   GLU B 133    4631   5031   4716    795    725    277        C
ATOM   5391  O   GLU B 133      8.085  48.599 102.672  1.00 37.77          O
ANISOU 5391  O   GLU B 133    4513   5178   4660    786    678    366        O
ATOM   5393  N   LYS B 134     10.173  49.148 103.310  1.00 34.52          N
ANISOU 5393  N   LYS B 134    4313   4582   4220    704    730    122        N
ATOM   5394  CA  LYS B 134     10.330  47.933 104.126  1.00 34.02          C
ANISOU 5394  CA  LYS B 134    4250   4660   4017    622    693     59        C
ATOM   5396  CB  LYS B 134     11.748  47.795 104.664  1.00 32.35          C
ANISOU 5396  CB  LYS B 134    4143   4419   3732    541    683    -90        C
ATOM   5399  CG  LYS B 134     12.685  47.120 103.728  1.00 31.93          C
ANISOU 5399  CG  LYS B 134    4137   4366   3630    451    586    -47        C
ATOM   5402  CD  LYS B 134     14.052  46.891 104.362  1.00 29.57          C
ANISOU 5402  CD  LYS B 134    3902   4076   3257    384    572   -182        C
ATOM   5405  CE  LYS B 134     15.030  46.238 103.364  1.00 26.66          C
ANISOU 5405  CE  LYS B 134    3570   3706   2853    315    496   -138        C
ATOM   5408  NZ  LYS B 134     14.369  45.100 102.694  1.00 24.96          N
ANISOU 5408  NZ  LYS B 134    3341   3560   2582    297    432    -15        N
ATOM   5412  C   LYS B 134      9.357  47.841 105.309  1.00 34.77          C
ANISOU 5412  C   LYS B 134    4270   4848   4092    685    779     23        C
ATOM   5413  O   LYS B 134      8.911  46.738 105.675  1.00 34.76          O
ANISOU 5413  O   LYS B 134    4223   4988   3996    633    746     66        O
ATOM   5415  N   ALA B 135      9.065  48.983 105.927  1.00 34.43          N
ANISOU 5415  N   ALA B 135    4229   4718   4136    792    904    -60        N
ATOM   5416  CA  ALA B 135      8.217  49.035 107.096  1.00 36.31          C
ANISOU 5416  CA  ALA B 135    4408   5040   4350    864   1016   -118        C
ATOM   5418  CB  ALA B 135      8.348  50.400 107.783  1.00 37.26          C
ANISOU 5418  CB  ALA B 135    4594   5010   4554    962   1163   -277        C
ATOM   5422  C   ALA B 135      6.728  48.744 106.787  1.00 36.42          C
ANISOU 5422  C   ALA B 135    4251   5171   4417    939   1029     51        C
ATOM   5423  O   ALA B 135      5.993  48.368 107.672  1.00 32.65          O
ANISOU 5423  O   ALA B 135    3699   4819   3887    962   1103     39        O
```

FIG. 18 (continued)

```
ATOM   5425  N   ASN B 136      6.295  48.917 105.532  1.00 38.44          N
ANISOU 5425  N   ASN B 136   4434   5404   4767    970    955    213       N
ATOM   5426  CA  ASN B 136      4.889  48.656 105.148  1.00 40.73          C
ANISOU 5426  CA  ASN B 136   4532   5836   5109   1029    941    383       C
ATOM   5428  CB  ASN B 136      4.673  48.961 103.652  1.00 43.65          C
ANISOU 5428  CB  ASN B 136   4849   6178   5556   1055    831    556       C
ATOM   5431  CG  ASN B 136      3.499  48.182 103.044  1.00 47.44          C
ANISOU 5431  CG  ASN B 136   5137   6868   6021   1017    733    732       C
ATOM   5432  OD1 ASN B 136      2.442  48.754 102.744  1.00 51.26          O
ANISOU 5432  OD1 ASN B 136   5452   7413   6611   1153    757    863       O
ATOM   5433  ND2 ASN B 136      3.682  46.864 102.869  1.00 49.39          N
ANISOU 5433  ND2 ASN B 136   5404   7225   6139    830    624    734       N
ATOM   5436  C   ASN B 136      4.432  47.231 105.466  1.00 39.31          C
ANISOU 5436  C   ASN B 136   4278   5851   4806    896    883    427       C
ATOM   5437  O   ASN B 136      3.274  47.020 105.785  1.00 41.19          O
ANISOU 5437  O   ASN B 136   4351   6229   5069    935    931    504       O
ATOM   5439  N   LYS B 137      5.340  46.265 105.390  1.00 37.61          N
ANISOU 5439  N   LYS B 137   4181   5639   4470    743    790    384       N
ATOM   5440  CA  LYS B 137      4.985  44.866 105.589  1.00 39.29          C
ANISOU 5440  CA  LYS B 137   4355   5992   4579    605    736    435       C
ATOM   5442  CB  LYS B 137      5.777  43.971 104.656  1.00 39.07          C
ANISOU 5442  CB  LYS B 137   4431   5930   4482    464    594    460       C
ATOM   5445  CG  LYS B 137      7.250  44.086 104.859  1.00 38.83          C
ANISOU 5445  CG  LYS B 137   4575   5779   4399    452    588    336       C
ATOM   5448  CD  LYS B 137      7.954  42.787 104.575  1.00 37.67          C
ANISOU 5448  CD  LYS B 137   4526   5637   4149    318    499    339       C
ATOM   5451  CE  LYS B 137      9.284  43.012 103.919  1.00 34.76          C
ANISOU 5451  CE  LYS B 137   4280   5156   3771    307    448    280       C
ATOM   5454  NZ  LYS B 137     10.167  44.007 104.553  1.00 33.21          N
ANISOU 5454  NZ  LYS B 137   4141   4881   3597    380    512    158       N
ATOM   5458  C   LYS B 137      5.221  44.399 107.019  1.00 41.07          C
ANISOU 5458  C   LYS B 137   4639   6267   4700    582    829    334       C
ATOM   5459  O   LYS B 137      5.072  43.216 107.301  1.00 39.79          O
ANISOU 5459  O   LYS B 137   4479   6192   4449    467    800    378       O
ATOM   5461  N   ILE B 138      5.601  45.322 107.910  1.00 42.52          N
ANISOU 5461  N   ILE B 138   4881   6389   4885    685    942    200       N
ATOM   5462  CA  ILE B 138      5.822  44.990 109.306  1.00 44.47          C
ANISOU 5462  CA  ILE B 138   5186   6707   5004    672   1030     99       C
ATOM   5464  CB  ILE B 138      6.415  46.168 110.133  1.00 46.56          C
ANISOU 5464  CB  ILE B 138   5542   6885   5263    768   1136    -88       C
ATOM   5466  CG1 ILE B 138      7.918  46.327 109.869  1.00 45.04          C
ANISOU 5466  CG1 ILE B 138   5501   6579   5036    706   1044   -190       C
ATOM   5469  CD1 ILE B 138      8.626  47.252 110.939  1.00 46.42          C
ANISOU 5469  CD1 ILE B 138   5778   6705   5154    743   1134   -406       C
ATOM   5473  CG2 ILE B 138      6.166  45.927 111.612  1.00 48.52          C
ANISOU 5473  CG2 ILE B 138   5802   7262   5369    779   1255   -170       C
ATOM   5477  C   ILE B 138      4.514  44.597 109.947  1.00 45.77          C
ANISOU 5477  C   ILE B 138   5204   7029   5155    688   1130    178       C
ATOM   5478  O   ILE B 138      3.567  45.389 110.006  1.00 46.79          O
ANISOU 5478  O   ILE B 138   5206   7184   5389    810   1232    197       O
ATOM   5480  N   LYS B 139      4.475  43.362 110.423  1.00 46.03          N
ANISOU 5480  N   LYS B 139   5255   7166   5069    570   1110    233       N
ATOM   5481  CA  LYS B 139      3.311  42.819 111.079  1.00 49.72          C
ANISOU 5481  CA  LYS B 139   5590   7793   5508    548   1210    320       C
ATOM   5483  CB  LYS B 139      2.897  41.509 110.396  1.00 50.73          C
ANISOU 5483  CB  LYS B 139   5667   7972   5637    381   1105    473       C
ATOM   5486  CG  LYS B 139      1.775  41.612 109.373  1.00 51.77          C
ANISOU 5486  CG  LYS B 139   5599   8165   5908    365   1058    595       C
ATOM   5489  CD  LYS B 139      1.844  42.834 108.496  1.00 51.60          C
ANISOU 5489  CD  LYS B 139   5537   8055   6011    500   1018    573       C
ATOM   5492  CE  LYS B 139      1.067  42.604 107.214  1.00 52.08          C
ANISOU 5492  CE  LYS B 139   5446   8180   6164    437    895    715       C
ATOM   5495  NZ  LYS B 139      0.727  43.884 106.554  1.00 53.34          N
ANISOU 5495  NZ  LYS B 139   5505   8304   6456    609    897    746       N
ATOM   5499  C   LYS B 139      3.582  42.568 112.556  1.00 51.05          C
ANISOU 5499  C   LYS B 139   5845   8044   5508    552   1323    241       C
ATOM   5500  O   LYS B 139      2.669  42.683 113.367  1.00 54.66          O
ANISOU 5500  O   LYS B 139   6201   8628   5940    599   1472    254       O
ATOM   5502  N   SER B 140      4.835  42.259 112.898  1.00 49.73          N
ANISOU 5502  N   SER B 140   5854   7823   5218    511   1256    163       N
ATOM   5503  CA  SER B 140      5.197  41.776 114.230  1.00 49.24          C
ANISOU 5503  CA  SER B 140   5885   7866   4960    492   1323    124       C
ATOM   5505  CB  SER B 140      5.706  40.323 114.134  1.00 49.20          C
ANISOU 5505  CB  SER B 140   5964   7862   4868    365   1219    247       C
ATOM   5508  OG  SER B 140      6.574  40.129 113.024  1.00 48.91          O
ANISOU 5508  OG  SER B 140   5995   7683   4906    326   1065    249       O
ATOM   5510  C   SER B 140      6.217  42.669 114.943  1.00 46.89          C
ANISOU 5510  C   SER B 140   5711   7540   4566    565   1341    -73       C
ATOM   5511  O   SER B 140      6.758  43.613 114.367  1.00 44.75          O
```

FIG. 18 (continued)

```
ANISOU 5511  O   SER B 140    5469   7140   4394    613   1299   -181    O
ATOM   5513  N   GLU B 141      6.457  42.354 116.212  1.00 45.24        N
ANISOU 5513  N   GLU B 141    5574   7463   4153    559   1405   -115    N
ATOM   5514  CA  GLU B 141      7.351  43.118 117.077  1.00 44.45        C
ANISOU 5514  CA  GLU B 141    5586   7387   3916    602   1423   -314    C
ATOM   5516  CB  GLU B 141      6.954  42.907 118.547  1.00 47.39        C
ANISOU 5516  CB  GLU B 141    5983   7958   4063    617   1560   -339    C
ATOM   5519  CG  GLU B 141      5.539  43.282 118.878  1.00 49.82        C
ANISOU 5519  CG  GLU B 141    6169   8337   4423    685   1756   -322    C
ATOM   5522  CD  GLU B 141      5.211  43.105 120.362  1.00 52.12        C
ANISOU 5522  CD  GLU B 141    6500   8840   4465    699   1909   -358    C
ATOM   5523  OE1 GLU B 141      4.135  42.523 120.646  1.00 52.85        O
ANISOU 5523  OE1 GLU B 141    6487   9046   4546    687   2030   -212    O
ATOM   5524  OE2 GLU B 141      6.024  43.556 121.216  1.00 52.51        O
ANISOU 5524  OE2 GLU B 141    6677   8951   4325    711   1907   -533    O
ATOM   5525  C   GLU B 141      8.807  42.699 116.961  1.00 42.41        C
ANISOU 5525  C   GLU B 141    5441   7098   3574    543   1256   -338    C
ATOM   5526  O   GLU B 141      9.699  43.443 117.350  1.00 45.02        O
ANISOU 5526  O   GLU B 141    5846   7423   3838    556   1228   -513    O
ATOM   5528  N   ASN B 142      9.058  41.501 116.453  1.00 38.14        N
ANISOU 5528  N   ASN B 142    4913   6541   3039    477   1151   -167    N
ATOM   5529  CA  ASN B 142     10.400  40.941 116.530  1.00 39.18        C
ANISOU 5529  CA  ASN B 142    5139   6677   3069    447   1014   -163    C
ATOM   5531  CB  ASN B 142     10.330  39.465 116.952  1.00 40.43        C
ANISOU 5531  CB  ASN B 142    5337   6914   3110    406    996     33    C
ATOM   5534  CG  ASN B 142      9.835  38.550 115.827  1.00 38.96        C
ANISOU 5534  CG  ASN B 142    5120   6600   3084    343    958    199    C
ATOM   5535  OD1 ASN B 142      9.072  38.972 114.944  1.00 39.47        O
ANISOU 5535  OD1 ASN B 142    5098   6582   3317    328    980    196    O
ATOM   5536  ND2 ASN B 142     10.287  37.296 115.849  1.00 39.38        N
ANISOU 5536  ND2 ASN B 142    5248   6634   3080    307    898    343    N
ATOM   5539  C   ASN B 142     11.194  41.093 115.237  1.00 35.75        C
ANISOU 5539  C   ASN B 142    4710   6078   2794    428    887   -178    C
ATOM   5540  O   ASN B 142     12.121  40.342 115.004  1.00 34.63        O
ANISOU 5540  O   ASN B 142    4620   5922   2617    405    779   -117    O
ATOM   5542  N   THR B 143     10.814  42.062 114.404  1.00 35.91        N
ANISOU 5542  N   THR B 143    4676   5978   2989    449    913   -246    N
ATOM   5543  CA  THR B 143     11.590  42.457 113.238  1.00 36.09        C
ANISOU 5543  CA  THR B 143    4710   5855   3148    435    816   -280    C
ATOM   5545  CB  THR B 143     10.760  42.347 111.941  1.00 36.28        C
ANISOU 5545  CB  THR B 143    4665   5773   3348    423    806   -164    C
ATOM   5547  OG1 THR B 143      9.557  43.141 112.062  1.00 37.16        O
ANISOU 5547  OG1 THR B 143    4689   5891   3539    482    921   -178    O
ATOM   5549  CG2 THR B 143     10.423  40.878 111.669  1.00 34.47        C
ANISOU 5549  CG2 THR B 143    4439   5572   3088    357    762      7    C
ATOM   5553  C   THR B 143     12.131  43.876 113.399  1.00 35.29        C
ANISOU 5553  C   THR B 143    4629   5696   3085    463    843   -478    C
ATOM   5554  O   THR B 143     11.484  44.774 113.968  1.00 39.62        O
ANISOU 5554  O   THR B 143    5163   6250   3642    513    961   -581    O
ATOM   5556  N   HIS B 144     13.374  44.036 113.009  1.00 32.78        N
ANISOU 5556  N   HIS B 144    4350   5328   2778    426    746   -540    N
ATOM   5557  CA  HIS B 144     14.073  45.297 113.095  1.00 31.81        C
ANISOU 5557  CA  HIS B 144    4254   5135   2696    415    757   -728    C
ATOM   5559  CB  HIS B 144     15.235  45.119 114.062  1.00 34.13        C
ANISOU 5559  CB  HIS B 144    4587   5572   2811    369    686   -833    C
ATOM   5562  CG  HIS B 144     15.665  46.377 114.762  1.00 35.18        C
ANISOU 5562  CG  HIS B 144    4758   5700   2911    336    730  -1071    C
ATOM   5563  ND1 HIS B 144     15.032  46.851 115.883  1.00 36.63        N
ANISOU 5563  ND1 HIS B 144    4976   5963   2980    362    839  -1194    N
ATOM   5565  CE1 HIS B 144     15.643  47.949 116.303  1.00 37.37        C
ANISOU 5565  CE1 HIS B 144    5117   6019   3061    305    858  -1424    C
ATOM   5567  NE2 HIS B 144     16.646  48.204 115.482  1.00 35.13        N
ANISOU 5567  NE2 HIS B 144    4819   5639   2891    236    765  -1440    N
ATOM   5569  CD2 HIS B 144     16.694  47.223 114.522  1.00 34.27        C
ANISOU 5569  CD2 HIS B 144    4657   5512   2854    262    686  -1220    C
ATOM   5571  C   HIS B 144     14.560  45.640 111.681  1.00 29.97        C
ANISOU 5571  C   HIS B 144    4011   4737   2640    391    700   -692    C
ATOM   5572  O   HIS B 144     14.920  44.757 110.906  1.00 28.16        O
ANISOU 5572  O   HIS B 144    3774   4501   2427    368    616   -567    O
ATOM   5574  N   ILE B 145     14.517  46.912 111.330  1.00 29.52        N
ANISOU 5574  N   ILE B 145    3965   4538   2714    400    762   -794    N
ATOM   5575  CA  ILE B 145     14.994  47.375 110.035  1.00 28.22        C
ANISOU 5575  CA  ILE B 145    3800   4217   2705    375    725   -757    C
ATOM   5577  CB  ILE B 145     13.930  48.222 109.277  1.00 28.85        C
ANISOU 5577  CB  ILE B 145    3858   4146   2959    449    812   -697    C
ATOM   5579  CG1 ILE B 145     12.664  47.420 108.946  1.00 29.62        C
ANISOU 5579  CG1 ILE B 145    3884   4311   3061    506    814   -520    C
ATOM   5582  CD1 ILE B 145     11.467  48.415 108.819  1.00 30.22        C
ANISOU 5582  CD1 ILE B 145    3912   4297   3272    616    931   -502    C
```

FIG. 18 (continued)

```
ATOM   5586  CG2 ILE B 145      14.476  48.748 107.975  1.00 28.67          C
ANISOU 5586  CG2 ILE B 145    3849   3971   3074    421    778   -646       C
ATOM   5590  C   ILE B 145      16.198  48.279 110.215  1.00 28.46          C
ANISOU 5590  C   ILE B 145    3871   4190   2754    299    714   -929       C
ATOM   5591  O   ILE B 145      16.204  49.125 111.096  1.00 28.82          O
ANISOU 5591  O   ILE B 145    3954   4222   2775    289    784  -1101       O
ATOM   5593  N   HIS B 146      17.202  48.105 109.366  1.00 26.00          N
ANISOU 5593  N   HIS B 146    3548   3843   2486    238    635   -891       N
ATOM   5594  CA  HIS B 146      18.395  48.956 109.376  1.00 27.37          C
ANISOU 5594  CA  HIS B 146    3736   3962   2700    140    622  -1038       C
ATOM   5596  CB  HIS B 146      19.537  48.249 110.114  1.00 27.91          C
ANISOU 5596  CB  HIS B 146    3768   4227   2610     78    517  -1098       C
ATOM   5599  CG  HIS B 146      20.691  49.133 110.477  1.00 28.45          C
ANISOU 5599  CG  HIS B 146    3827   4297   2685    -45    498  -1286       C
ATOM   5600  ND1 HIS B 146      21.494  48.884 111.567  1.00 29.91          N
ANISOU 5600  ND1 HIS B 146    3977   4685   2703   -104    418  -1402       N
ATOM   5602  CE1 HIS B 146      22.417  49.818 111.657  1.00 31.27          C
ANISOU 5602  CE1 HIS B 146    4135   4825   2922   -237    410  -1569       C
ATOM   5604  NE2 HIS B 146      22.263  50.653 110.646  1.00 32.75          N
ANISOU 5604  NE2 HIS B 146    4358   4773   3310   -263    494  -1554       N
ATOM   5606  CD2 HIS B 146      21.183  50.258 109.900  1.00 30.46          C
ANISOU 5606  CD2 HIS B 146    4100   4383   3092   -134    546  -1373       C
ATOM   5608  C   HIS B 146      18.772  49.283 107.935  1.00 27.87          C
ANISOU 5608  C   HIS B 146    3796   3876   2918    114    619   -944       C
ATOM   5609  O   HIS B 146      19.142  48.405 107.153  1.00 25.87          O
ANISOU 5609  O   HIS B 146    3512   3671   2648    114    550   -816       O
ATOM   5611  N   ILE B 147      18.638  50.550 107.569  1.00 28.39          N
ANISOU 5611  N   ILE B 147    3905   3750   3131     97    706  -1000       N
ATOM   5612  CA  ILE B 147      18.956  50.983 106.212  1.00 28.67          C
ANISOU 5612  CA  ILE B 147    3948   3639   3305     72    719   -897       C
ATOM   5614  CB  ILE B 147      17.824  51.920 105.627  1.00 28.68          C
ANISOU 5614  CB  ILE B 147    3994   3442   3461    166    822   -815       C
ATOM   5616  CG1 ILE B 147      16.434  51.220 105.664  1.00 27.43          C
ANISOU 5616  CG1 ILE B 147    3797   3366   3258    296    816   -685       C
ATOM   5619  CD1 ILE B 147      16.285  49.920 105.003  1.00 25.21          C
ANISOU 5619  CD1 ILE B 147    3468   3220   2892    304    718   -528       C
ATOM   5623  CG2 ILE B 147      18.225  52.447 104.205  1.00 27.76          C
ANISOU 5623  CG2 ILE B 147    3899   3176   3472    134    837   -690       C
ATOM   5627  C   ILE B 147      20.293  51.753 106.205  1.00 29.55          C
ANISOU 5627  C   ILE B 147    4065   3691   3470    -72    724  -1031       C
ATOM   5628  O   ILE B 147      20.546  52.566 107.101  1.00 31.50          O
ANISOU 5628  O   ILE B 147    4347   3895   3726   -139    769  -1222       O
ATOM   5630  N   PHE B 148      21.121  51.468 105.206  1.00 28.40          N
ANISOU 5630  N   PHE B 148    3885   3553   3355   -127    685   -939       N
ATOM   5631  CA  PHE B 148      22.310  52.204 104.889  1.00 30.25          C
ANISOU 5631  CA  PHE B 148    4105   3718   3670   -268    706  -1018       C
ATOM   5633  CB  PHE B 148      23.517  51.266 104.837  1.00 29.84          C
ANISOU 5633  CB  PHE B 148    3950   3869   3521   -327    610  -1014       C
ATOM   5636  CG  PHE B 148      23.837  50.577 106.156  1.00 29.46          C
ANISOU 5636  CG  PHE B 148    3843   4038   3312   -327    519  -1127       C
ATOM   5637  CD1 PHE B 148      24.755  51.125 107.027  1.00 31.40          C
ANISOU 5637  CD1 PHE B 148    4041   4359   3530   -460    491  -1316       C
ATOM   5639  CE1 PHE B 148      25.089  50.477 108.225  1.00 31.21          C
ANISOU 5639  CE1 PHE B 148    3958   4569   3333   -456    392  -1401       C
ATOM   5641  CZ  PHE B 148      24.497  49.250 108.526  1.00 31.34          C
ANISOU 5641  CZ  PHE B 148    3973   4714   3219   -312    339  -1280       C
ATOM   5643  CE2 PHE B 148      23.587  48.675 107.639  1.00 27.71          C
ANISOU 5643  CE2 PHE B 148    3565   4157   2806   -195    377  -1100       C
ATOM   5645  CD2 PHE B 148      23.255  49.345 106.473  1.00 28.17          C
ANISOU 5645  CD2 PHE B 148    3672   4012   3021   -205    459  -1031       C
ATOM   5647  C   PHE B 148      22.208  52.857 103.507  1.00 30.69          C
ANISOU 5647  C   PHE B 148    4206   3581   3872   -270    780   -874       C
ATOM   5648  O   PHE B 148      21.756  52.229 102.547  1.00 28.53          O
ANISOU 5648  O   PHE B 148    3931   3330   3579   -187    758   -693       O
ATOM   5650  N   SER B 149      22.654  54.106 103.393  1.00 33.71          N
ANISOU 5650  N   SER B 149    4636   3777   4394   -376    868   -954       N
ATOM   5651  CA  SER B 149      22.897  54.712 102.076  1.00 34.74          C
ANISOU 5651  CA  SER B 149    4803   3746   4652   -411    939   -809       C
ATOM   5653  CB  SER B 149      22.351  56.141 102.000  1.00 37.78          C
ANISOU 5653  CB  SER B 149    5305   3836   5215   -407   1071   -822       C
ATOM   5656  OG  SER B 149      23.274  57.061 102.552  1.00 40.74          O
ANISOU 5656  OG  SER B 149    5701   4102   5677   -590   1128  -1016       O
ATOM   5658  C   SER B 149      24.392  54.717 101.696  1.00 35.67          C
ANISOU 5658  C   SER B 149    4846   3929   4780   -580    930   -847       C
ATOM   5659  O   SER B 149      25.258  54.574 102.532  1.00 36.35          O
ANISOU 5659  O   SER B 149    4853   4144   4814   -689    879  -1012       O
ATOM   5661  N   PHE B 150      24.674  54.889 100.414  1.00 36.28          N
ANISOU 5661  N   PHE B 150    4935   3933   4916   -600    982   -683       N
ATOM   5662  CA  PHE B 150      26.061  54.958  99.940  1.00 37.32          C
```

FIG. 18 (continued)

```
ANISOU 5662  CA  PHE B 150    4985   4123   5073   -759   1002   -698        C
ATOM   5664  CB  PHE B 150     26.131  54.850  98.400  1.00 35.70            C
ANISOU 5664  CB  PHE B 150    4804   3882   4877   -731   1057   -474        C
ATOM   5667  CG  PHE B 150     25.944  53.462  97.892  1.00 33.57            C
ANISOU 5667  CG  PHE B 150    4491   3814   4449   -608    975   -369        C
ATOM   5668  CD1 PHE B 150     27.043  52.673  97.577  1.00 32.67            C
ANISOU 5668  CD1 PHE B 150    4268   3882   4262   -655    954   -375        C
ATOM   5670  CE1 PHE B 150     26.861  51.359  97.098  1.00 31.68            C
ANISOU 5670  CE1 PHE B 150    4128   3913   3997   -536    895   -292        C
ATOM   5672  CZ  PHE B 150     25.587  50.860  96.946  1.00 30.18            C
ANISOU 5672  CZ  PHE B 150    4023   3705   3738   -402    845   -207        C
ATOM   5674  CE2 PHE B 150     24.488  51.648  97.233  1.00 29.47            C
ANISOU 5674  CE2 PHE B 150    4015   3464   3719   -360    856   -187        C
ATOM   5676  CD2 PHE B 150     24.668  52.942  97.702  1.00 31.36            C
ANISOU 5676  CD2 PHE B 150    4278   3538   4101   -449    927   -265        C
ATOM   5678  C   PHE B 150     26.828  56.208 100.415  1.00 40.66            C
ANISOU 5678  C   PHE B 150    5417   4395   5637   -961   1080   -860        C
ATOM   5679  O   PHE B 150     28.053  56.200 100.448  1.00 41.57            O
ANISOU 5679  O   PHE B 150    5420   4617   5760  -1121   1071   -936        O
ATOM   5681  N   THR B 151     26.120  57.273 100.769  1.00 41.59            N
ANISOU 5681  N   THR B 151    5663   4265   5876   -958   1162   -916        N
ATOM   5682  CA  THR B 151     26.764  58.499 101.207  1.00 44.08            C
ANISOU 5682  CA  THR B 151    6020   4392   6338  -1163   1251  -1086        C
ATOM   5684  CB  THR B 151     26.054  59.729 100.616  1.00 46.69            C
ANISOU 5684  CB  THR B 151    6523   4358   6858  -1129   1405   -982        C
ATOM   5686  OG1 THR B 151     24.646  59.639 100.860  1.00 45.83            O
ANISOU 5686  OG1 THR B 151    6499   4184   6730   -900   1403   -924        O
ATOM   5688  CG2 THR B 151     26.310  59.815  99.107  1.00 46.72            C
ANISOU 5688  CG2 THR B 151    6538   4301   6914  -1129   1470   -718        C
ATOM   5692  C   THR B 151     26.868  58.629 102.740  1.00 45.70            C
ANISOU 5692  C   THR B 151    6209   4666   6488  -1239   1195  -1371        C
ATOM   5693  O   THR B 151     27.183  59.719 103.246  1.00 47.53            O
ANISOU 5693  O   THR B 151    6510   4709   6839  -1406   1273  -1552        O
ATOM   5695  N   GLY B 152     26.626  57.539 103.477  1.00 43.25            N
ANISOU 5695  N   GLY B 152    5821   4620   5994  -1130   1066  -1416        N
ATOM   5696  CA  GLY B 152     26.812  57.547 104.950  1.00 43.00            C
ANISOU 5696  CA  GLY B 152    5764   4714   5862  -1206    997  -1677        C
ATOM   5699  C   GLY B 152     25.588  57.710 105.844  1.00 41.82            C
ANISOU 5699  C   GLY B 152    5731   4491   5669  -1067   1023  -1767        C
ATOM   5700  O   GLY B 152     25.706  57.667 107.059  1.00 39.73            O
ANISOU 5700  O   GLY B 152    5454   4353   5289  -1122    970  -1978        O
ATOM   5702  N   GLU B 153     24.402  57.882 105.272  1.00 41.58            N
ANISOU 5702  N   GLU B 153    5802   4282   5716   -882   1106  -1605        N
ATOM   5703  CA  GLU B 153     23.189  57.972 106.089  1.00 42.27            C
ANISOU 5703  CA  GLU B 153    5973   4324   5765   -728   1144  -1672        C
ATOM   5705  CB  GLU B 153     22.093  58.719 105.316  1.00 43.41            C
ANISOU 5705  CB  GLU B 153    6233   4177   6084   -574   1279  -1512        C
ATOM   5708  CG  GLU B 153     22.377  60.205 105.125  1.00 46.42            C
ANISOU 5708  CG  GLU B 153    6745   4211   6683   -690   1431  -1600        C
ATOM   5711  CD  GLU B 153     23.591  60.516 104.240  1.00 49.30            C
ANISOU 5711  CD  GLU B 153    7076   4519   7137   -888   1437  -1540        C
ATOM   5712  OE1 GLU B 153     24.538  61.203 104.734  1.00 53.07            O
ANISOU 5712  OE1 GLU B 153    7571   4923   7670  -1122   1467  -1756        O
ATOM   5713  OE2 GLU B 153     23.604  60.086 103.054  1.00 47.86            O
ANISOU 5713  OE2 GLU B 153    6848   4373   6962   -824   1415  -1285        O
ATOM   5714  C   GLU B 153     22.700  56.587 106.545  1.00 40.04            C
ANISOU 5714  C   GLU B 153    5603   4336   5276   -587   1022  -1605        C
ATOM   5715  O   GLU B 153     22.869  55.585 105.831  1.00 38.28            O
ANISOU 5715  O   GLU B 153    5292   4265   4987   -533    938  -1424        O
ATOM   5717  N   GLU B 154     22.103  56.528 107.730  1.00 40.66            N
ANISOU 5717  N   GLU B 154    5714   4485   5250   -532   1026  -1753        N
ATOM   5718  CA  GLU B 154     21.452  55.326 108.244  1.00 38.96            C
ANISOU 5718  CA  GLU B 154    5439   4509   4853   -393    943  -1680        C
ATOM   5720  CB  GLU B 154     22.224  54.705 109.403  1.00 40.09            C
ANISOU 5720  CB  GLU B 154    5515   4929   4791   -487    828  -1841        C
ATOM   5723  CG  GLU B 154     23.517  54.048 109.069  1.00 40.74            C
ANISOU 5723  CG  GLU B 154    5473   5190   4815   -594    703  -1799        C
ATOM   5726  CD  GLU B 154     24.294  53.748 110.328  1.00 41.67            C
ANISOU 5726  CD  GLU B 154    5526   5563   4745   -696    596  -1983        C
ATOM   5727  OE1 GLU B 154     24.928  54.675 110.850  1.00 45.17            O
ANISOU 5727  OE1 GLU B 154    5989   5964   5210   -869    613  -2203        O
ATOM   5728  OE2 GLU B 154     24.240  52.611 110.814  1.00 40.71            O
ANISOU 5728  OE2 GLU B 154    5340   5679   4448   -607    498  -1907        O
ATOM   5729  C   GLU B 154     20.110  55.678 108.820  1.00 39.28            C
ANISOU 5729  C   GLU B 154    5559   4459   4906   -245   1047  -1713        C
ATOM   5730  O   GLU B 154     19.926  56.769 109.387  1.00 38.12            O
ANISOU 5730  O   GLU B 154    5514   4134   4837   -277   1163  -1897        O
ATOM   5732  N   MET B 155     19.188  54.732 108.751  1.00 38.02            N
ANISOU 5732  N   MET B 155    5351   4428   4665    -89   1013  -1551        N
```

FIG. 18 (continued)

```
ATOM    5733  CA  MET B 155      17.954  54.832 109.520  1.00 38.96          C
ANISOU  5733  CA  MET B 155    5506   4546   4751     48   1101  -1589        C
ATOM    5735  CB  MET B 155      16.829  55.342 108.614  1.00 40.50          C
ANISOU  5735  CB  MET B 155    5720   4539   5129    206   1202  -1414        C
ATOM    5738  CG  MET B 155      15.546  55.679 109.322  1.00 42.84          C
ANISOU  5738  CG  MET B 155    6039   4800   5439    362   1326  -1455        C
ATOM    5741  SD  MET B 155      14.456  56.644 108.251  1.00 45.46          S
ANISOU  5741  SD  MET B 155    6391   4852   6030    544   1456  -1269        S
ATOM    5742  CE  MET B 155      13.074  56.901 109.344  1.00 45.70          C
ANISOU  5742  CE  MET B 155    6416   4902   6046    728   1608  -1355        C
ATOM    5746  C   MET B 155      17.658  53.443 110.065  1.00 36.30          C
ANISOU  5746  C   MET B 155    5089   4494   4209    102   1002  -1512        C
ATOM    5747  O   MET B 155      17.813  52.467 109.354  1.00 30.81          O
ANISOU  5747  O   MET B 155    4325   3900   3481    115    903  -1332        O
ATOM    5749  N   ALA B 156      17.243  53.352 111.328  1.00 33.98          N
ANISOU  5749  N   ALA B 156    4817   4320   3773    129   1039  -1648        N
ATOM    5750  CA  ALA B 156      16.903  52.058 111.908  1.00 33.83          C
ANISOU  5750  CA  ALA B 156    4736   4558   3561    179    965  -1558        C
ATOM    5752  CB  ALA B 156      18.102  51.453 112.670  1.00 33.38          C
ANISOU  5752  CB  ALA B 156    4653   4720   3308     59    835  -1656        C
ATOM    5756  C   ALA B 156      15.735  52.199 112.828  1.00 35.57          C
ANISOU  5756  C   ALA B 156    4980   4815   3718    287   1084  -1615        C
ATOM    5757  O   ALA B 156      15.522  53.263 113.408  1.00 38.51          O
ANISOU  5757  O   ALA B 156    5433   5070   4130    292   1208  -1806        O
ATOM    5759  N   THR B 157      15.005  51.106 112.976  1.00 35.18          N
ANISOU  5759  N   THR B 157    4868   4929   3570    365   1057  -1455        N
ATOM    5760  CA  THR B 157      13.911  51.007 113.933  1.00 36.93          C
ANISOU  5760  CA  THR B 157    5089   5247   3696    459   1170  -1483        C
ATOM    5762  CB  THR B 157      13.395  49.553 114.000  1.00 35.89          C
ANISOU  5762  CB  THR B 157    4879   5313   3444    492   1104  -1277        C
ATOM    5764  OG1 THR B 157      13.139  49.098 112.663  1.00 32.62          O
ANISOU  5764  OG1 THR B 157    4401   4816   3177    515   1041  -1066        O
ATOM    5766  CG2 THR B 157      12.111  49.469 114.868  1.00 36.53          C
ANISOU  5766  CG2 THR B 157    4936   5490   3452    592   1245  -1274        C
ATOM    5770  C   THR B 157      14.304  51.503 115.322  1.00 39.92          C
ANISOU  5770  C   THR B 157    5548   5717   3901    402   1221  -1744        C
ATOM    5771  O   THR B 157      15.314  51.065 115.890  1.00 40.20          O
ANISOU  5771  O   THR B 157    5596   5917   3762    294   1105  -1818        O
ATOM    5773  N   LYS B 158      13.511  52.449 115.830  1.00 43.66          N
ANISOU  5773  N   LYS B 158    6078   6087   4426    481   1398  -1884        N
ATOM    5774  CA  LYS B 158      13.674  53.017 117.182  1.00 47.22          C
ANISOU  5774  CA  LYS B 158    6627   6614   4702    438   1483  -2160        C
ATOM    5776  CB  LYS B 158      13.557  51.931 118.257  1.00 49.19          C
ANISOU  5776  CB  LYS B 158    6850   7183   4657    431   1439  -2125        C
ATOM    5779  CG  LYS B 158      12.183  51.303 118.394  1.00 51.07          C
ANISOU  5779  CG  LYS B 158    7015   7508   4883    574   1547  -1946        C
ATOM    5782  CD  LYS B 158      12.268  50.092 119.315  1.00 51.76          C
ANISOU  5782  CD  LYS B 158    7083   7900   4685    541   1477  -1864        C
ATOM    5785  CE  LYS B 158      10.970  49.835 120.031  1.00 54.82          C
ANISOU  5785  CE  LYS B 158    7438   8405   4984    650   1648  -1814        C
ATOM    5788  NZ  LYS B 158      11.202  49.129 121.335  1.00 57.28          N
ANISOU  5788  NZ  LYS B 158    7795   9008   4961    601   1630  -1846        N
ATOM    5792  C   LYS B 158      15.008  53.713 117.356  1.00 46.43          C
ANISOU  5792  C   LYS B 158    6607   6456   4578    265   1408  -2387        C
ATOM    5793  O   LYS B 158      15.459  53.884 118.476  1.00 46.16          O
ANISOU  5793  O   LYS B 158    6640   6566   4335    177   1404  -2606        O
ATOM    5795  N   ALA B 159      15.644  54.093 116.243  1.00 43.84          N
ANISOU  5795  N   ALA B 159    6267   5937   4454    206   1345  -2329        N
ATOM    5796  CA  ALA B 159      16.978  54.698 116.282  1.00 44.79          C
ANISOU  5796  CA  ALA B 159    6434   6009   4576     15   1265  -2519        C
ATOM    5798  CB  ALA B 159      16.926  56.077 116.967  1.00 46.00          C
ANISOU  5798  CB  ALA B 159    6733   5979   4768    -39   1422  -2836        C
ATOM    5802  C   ALA B 159      17.986  53.788 116.986  1.00 44.27          C
ANISOU  5802  C   ALA B 159    6311   6263   4248   -104   1082  -2546        C
ATOM    5803  O   ALA B 159      18.904  54.263 117.660  1.00 44.97          O
ANISOU  5803  O   ALA B 159    6437   6423   4224   -264   1029  -2779        O
ATOM    5805  N   ASP B 160      17.777  52.483 116.839  1.00 41.44          N
ANISOU  5805  N   ASP B 160    5858   6094   3792    -24    988  -2305        N
ATOM    5806  CA  ASP B 160      18.585  51.470 117.490  1.00 41.87          C
ANISOU  5806  CA  ASP B 160    5854   6453   3603    -85    823  -2269        C
ATOM    5808  CB  ASP B 160      17.688  50.460 118.225  1.00 42.20          C
ANISOU  5808  CB  ASP B 160    5886   6695   3455     34    850  -2135        C
ATOM    5811  CG  ASP B 160      18.474  49.341 118.879  1.00 42.75          C
ANISOU  5811  CG  ASP B 160    5901   7067   3275      0    685  -2051        C
ATOM    5812  OD1 ASP B 160      19.699  49.244 118.669  1.00 42.17          O
ANISOU  5812  OD1 ASP B 160    5771   7062   3189    -96    538  -2072        O
ATOM    5813  OD2 ASP B 160      17.867  48.559 119.625  1.00 44.37          O
ANISOU  5813  OD2 ASP B 160    6114   7448   3297     75    707  -1954        O
ATOM    5814  C   ASP B 160      19.366  50.808 116.359  1.00 39.68          C
```

FIG. 18 (continued)

| | | | | | | | | | | | | | |
|---|---|---|---|---|---|---|---|---|---|---|---|---|---|
| ANISOU | 5814 | C | ASP | B | 160 | 5479 | 6158 | 3440 | -107 | 688 | -2072 | | C |
| ATOM | 5815 | O | ASP | B | 160 | 18.824 | 50.032 | 115.580 | 1.00 | 34.48 | | | O |
| ANISOU | 5815 | O | ASP | B | 160 | 4777 | 5461 | 2864 | -4 | 684 | -1836 | | O |
| ATOM | 5817 | N | TYR | B | 161 | 20.648 | 51.143 | 116.292 | 1.00 | 40.72 | | | N |
| ANISOU | 5817 | N | TYR | B | 161 | 5574 | 6327 | 3570 | -252 | 584 | -2185 | | N |
| ATOM | 5818 | CA | TYR | B | 161 | 21.514 | 50.750 | 115.210 | 1.00 | 40.58 | | | C |
| ANISOU | 5818 | CA | TYR | B | 161 | 5464 | 6278 | 3677 | -288 | 484 | -2042 | | C |
| ATOM | 5820 | CB | TYR | B | 161 | 22.536 | 51.863 | 114.976 | 1.00 | 43.56 | | | C |
| ANISOU | 5820 | CB | TYR | B | 161 | 5837 | 6549 | 4166 | -467 | 474 | -2237 | | C |
| ATOM | 5823 | CG | TYR | B | 161 | 21.844 | 53.152 | 114.638 | 1.00 | 44.67 | | | C |
| ANISOU | 5823 | CG | TYR | B | 161 | 6095 | 6374 | 4502 | -477 | 645 | -2354 | | C |
| ATOM | 5824 | CD1 | TYR | B | 161 | 21.214 | 53.313 | 113.405 | 1.00 | 44.25 | | | C |
| ANISOU | 5824 | CD1 | TYR | B | 161 | 6059 | 6080 | 4674 | -381 | 730 | -2176 | | C |
| ATOM | 5826 | CE1 | TYR | B | 161 | 20.540 | 54.470 | 113.114 | 1.00 | 45.65 | | | C |
| ANISOU | 5826 | CE1 | TYR | B | 161 | 6341 | 5969 | 5033 | -357 | 889 | -2252 | | C |
| ATOM | 5828 | CZ | TYR | B | 161 | 20.476 | 55.470 | 114.077 | 1.00 | 47.49 | | | C |
| ANISOU | 5828 | CZ | TYR | B | 161 | 6681 | 6129 | 5235 | -432 | 982 | -2530 | | C |
| ATOM | 5829 | OH | TYR | B | 161 | 19.856 | 56.656 | 113.855 | 1.00 | 48.53 | | | O |
| ANISOU | 5829 | OH | TYR | B | 161 | 6932 | 5949 | 5560 | -398 | 1156 | -2619 | | O |
| ATOM | 5831 | CE2 | TYR | B | 161 | 21.074 | 55.325 | 115.288 | 1.00 | 49.22 | | | C |
| ANISOU | 5831 | CE2 | TYR | B | 161 | 6896 | 6583 | 5223 | -545 | 903 | -2732 | | C |
| ATOM | 5833 | CD2 | TYR | B | 161 | 21.736 | 54.164 | 115.570 | 1.00 | 48.42 | | | C |
| ANISOU | 5833 | CD2 | TYR | B | 161 | 6674 | 6795 | 4928 | -563 | 728 | -2632 | | C |
| ATOM | 5835 | C | TYR | B | 161 | 22.205 | 49.413 | 115.428 | 1.00 | 39.62 | | | C |
| ANISOU | 5835 | C | TYR | B | 161 | 5240 | 6422 | 3391 | -257 | 326 | -1889 | | C |
| ATOM | 5836 | O | TYR | B | 161 | 23.024 | 49.000 | 114.589 | 1.00 | 38.36 | | | O |
| ANISOU | 5836 | O | TYR | B | 161 | 4994 | 6263 | 3317 | -275 | 246 | -1777 | | O |
| ATOM | 5838 | N | THR | B | 162 | 21.868 | 48.747 | 116.535 | 1.00 | 39.66 | | | N |
| ANISOU | 5838 | N | THR | B | 162 | 5260 | 6645 | 3163 | -200 | 297 | -1875 | | N |
| ATOM | 5839 | CA | THR | B | 162 | 22.286 | 47.369 | 116.842 | 1.00 | 38.45 | | | C |
| ANISOU | 5839 | CA | THR | B | 162 | 5035 | 6727 | 2846 | -127 | 171 | -1686 | | C |
| ATOM | 5841 | CB | THR | B | 162 | 21.885 | 46.363 | 115.707 | 1.00 | 35.07 | | | C |
| ANISOU | 5841 | CB | THR | B | 162 | 4585 | 6179 | 2561 | -10 | 181 | -1416 | | C |
| ATOM | 5843 | OG1 | THR | B | 162 | 20.456 | 46.332 | 115.508 | 1.00 | 32.20 | | | O |
| ANISOU | 5843 | OG1 | THR | B | 162 | 4295 | 5675 | 2264 | 73 | 312 | -1342 | | O |
| ATOM | 5845 | CG2 | THR | B | 162 | 22.406 | 44.947 | 115.973 | 1.00 | 34.90 | | | C |
| ANISOU | 5845 | CG2 | THR | B | 162 | 4506 | 6355 | 2400 | 71 | 66 | -1224 | | C |
| ATOM | 5849 | C | THR | B | 162 | 23.801 | 47.276 | 117.131 | 1.00 | 39.97 | | | C |
| ANISOU | 5849 | C | THR | B | 162 | 5115 | 7129 | 2944 | -223 | 6 | -1748 | | C |
| ATOM | 5850 | O | THR | B | 162 | 24.199 | 46.948 | 118.248 | 1.00 | 37.97 | | | O |
| ANISOU | 5850 | O | THR | B | 162 | 4836 | 7143 | 2446 | -237 | -88 | -1790 | | O |
| ATOM | 5852 | N | LEU | B | 163 | 24.619 | 47.575 | 116.119 | 1.00 | 39.01 | | | N |
| ANISOU | 5852 | N | LEU | B | 163 | 4915 | 6898 | 3007 | -289 | -25 | -1744 | | N |
| ATOM | 5853 | CA | LEU | B | 163 | 26.076 | 47.468 | 116.193 | 1.00 | 40.90 | | | C |
| ANISOU | 5853 | CA | LEU | B | 163 | 5009 | 7331 | 3202 | -376 | -173 | -1777 | | C |
| ATOM | 5855 | CB | LEU | B | 163 | 26.652 | 47.320 | 114.768 | 1.00 | 38.43 | | | C |
| ANISOU | 5855 | CB | LEU | B | 163 | 4615 | 6868 | 3117 | -368 | -165 | -1653 | | C |
| ATOM | 5858 | CG | LEU | B | 163 | 26.127 | 46.169 | 113.907 | 1.00 | 35.85 | | | C |
| ANISOU | 5858 | CG | LEU | B | 163 | 4311 | 6446 | 2865 | -195 | -131 | -1391 | | C |
| ATOM | 5860 | CD1 | LEU | B | 163 | 26.623 | 46.329 | 112.417 | 1.00 | 33.49 | | | C |
| ANISOU | 5860 | CD1 | LEU | B | 163 | 3963 | 5970 | 2793 | -217 | -90 | -1323 | | C |
| ATOM | 5864 | CD2 | LEU | B | 163 | 26.553 | 44.838 | 114.487 | 1.00 | 37.31 | | | C |
| ANISOU | 5864 | CD2 | LEU | B | 163 | 4428 | 6868 | 2878 | -72 | -243 | -1229 | | C |
| ATOM | 5868 | C | LEU | B | 163 | 26.737 | 48.700 | 116.836 | 1.00 | 44.29 | | | C |
| ANISOU | 5868 | C | LEU | B | 163 | 5420 | 7824 | 3584 | -584 | -204 | -2071 | | C |
| ATOM | 5869 | O | LEU | B | 163 | 26.114 | 49.753 | 116.965 | 1.00 | 43.89 | | | O |
| ANISOU | 5869 | O | LEU | B | 163 | 5490 | 7589 | 3598 | -661 | -85 | -2255 | | O |
| ATOM | 5871 | N | ASP | B | 164 | 28.015 | 48.574 | 117.183 | 1.00 | 46.99 | | | N |
| ANISOU | 5871 | N | ASP | B | 164 | 5605 | 8417 | 3831 | -676 | -360 | -2116 | | N |
| ATOM | 5872 | CA | ASP | B | 164 | 28.804 | 49.709 | 117.647 | 1.00 | 51.52 | | | C |
| ANISOU | 5872 | CA | ASP | B | 164 | 6136 | 9058 | 4382 | -914 | -408 | -2398 | | C |
| ATOM | 5874 | CB | ASP | B | 164 | 30.030 | 49.262 | 118.478 | 1.00 | 55.80 | | | C |
| ANISOU | 5874 | CB | ASP | B | 164 | 6489 | 10008 | 4704 | -979 | -622 | -2421 | | C |
| ATOM | 5877 | CG | ASP | B | 164 | 31.084 | 48.488 | 117.669 | 1.00 | 56.57 | | | C |
| ANISOU | 5877 | CG | ASP | B | 164 | 6375 | 10213 | 4908 | -915 | -719 | -2213 | | C |
| ATOM | 5878 | OD1 | ASP | B | 164 | 31.079 | 48.507 | 116.418 | 1.00 | 55.08 | | | O |
| ANISOU | 5878 | OD1 | ASP | B | 164 | 6179 | 9781 | 4967 | -881 | -621 | -2107 | | O |
| ATOM | 5879 | OD2 | ASP | B | 164 | 31.955 | 47.860 | 118.312 | 1.00 | 58.24 | | | O |
| ANISOU | 5879 | OD2 | ASP | B | 164 | 6419 | 10772 | 4939 | -892 | -894 | -2154 | | O |
| ATOM | 5880 | C | ASP | B | 164 | 29.199 | 50.657 | 116.510 | 1.00 | 51.75 | | | C |
| ANISOU | 5880 | C | ASP | B | 164 | 6147 | 8815 | 4701 | -1052 | -321 | -2472 | | C |
| ATOM | 5881 | O | ASP | B | 164 | 29.041 | 50.356 | 115.312 | 1.00 | 47.44 | | | O |
| ANISOU | 5881 | O | ASP | B | 164 | 5595 | 8077 | 4355 | -958 | -249 | -2286 | | O |
| ATOM | 5883 | N | GLU | B | 165 | 29.714 | 51.813 | 116.906 | 1.00 | 55.79 | | | N |
| ANISOU | 5883 | N | GLU | B | 165 | 6662 | 9312 | 5223 | -1290 | -326 | -2749 | | N |
| ATOM | 5884 | CA | GLU | B | 165 | 29.998 | 52.901 | 115.982 | 1.00 | 57.45 | | | C |
| ANISOU | 5884 | CA | GLU | B | 165 | 6894 | 9231 | 5704 | -1452 | -217 | -2848 | | C |
| ATOM | 5886 | CB | GLU | B | 165 | 30.410 | 54.171 | 116.741 | 1.00 | 62.43 | | | C |
| ANISOU | 5886 | CB | GLU | B | 165 | 7572 | 9848 | 6301 | -1730 | -216 | -3200 | | C |

FIG. 18 (continued)

```
ATOM   5889  CG  GLU B 165      29.368  54.694 117.752  1.00 64.91          C
ANISOU 5889  CG  GLU B 165    8101  10085   6477  -1715   -125  -3403       C
ATOM   5892  CD  GLU B 165      29.409  53.990 119.132  1.00 67.97          C
ANISOU 5892  CD  GLU B 165    8455  10871   6501  -1674   -274  -3454       C
ATOM   5893  OE1 GLU B 165      28.582  53.075 119.336  1.00 66.97          O
ANISOU 5893  OE1 GLU B 165    8375  10810   6261  -1440   -256  -3261       O
ATOM   5894  OE2 GLU B 165      30.240  54.349 120.016  1.00 71.12          O
ANISOU 5894  OE2 GLU B 165    8782  11523   6718  -1882   -406  -3682       O
ATOM   5895  C   GLU B 165      31.073  52.478 114.976  1.00 56.90          C
ANISOU 5895  C   GLU B 165    6623   9225   5772  -1472   -280  -2682       C
ATOM   5896  O   GLU B 165      30.958  52.776 113.786  1.00 53.99          O
ANISOU 5896  O   GLU B 165    6285   8592   5639  -1462   -162  -2583       O
ATOM   5898  N   GLU B 166      32.082  51.748 115.452  1.00 58.56          N
ANISOU 5898  N   GLU B 166    6625   9799   5827  -1479   -461  -2636       N
ATOM   5899  CA  GLU B 166      33.196  51.308 114.597  1.00 59.73          C
ANISOU 5899  CA  GLU B 166    6550  10052   6091  -1487   -519  -2488       C
ATOM   5901  CB  GLU B 166      34.394  50.807 115.440  1.00 63.46          C
ANISOU 5901  CB  GLU B 166    6772  10970   6370  -1543   -737  -2512       C
ATOM   5904  CG  GLU B 166      34.340  49.347 115.957  1.00 63.89          C
ANISOU 5904  CG  GLU B 166    6758  11298   6220  -1276   -858  -2283       C
ATOM   5907  CD  GLU B 166      35.595  48.964 116.784  1.00 68.09          C
ANISOU 5907  CD  GLU B 166    7019  12288   6565  -1332  -1084  -2298       C
ATOM   5908  OE1 GLU B 166      36.520  48.339 116.202  1.00 69.71          O
ANISOU 5908  OE1 GLU B 166    7001  12634   6853  -1252  -1140  -2129       O
ATOM   5909  OE2 GLU B 166      35.663  49.287 118.008  1.00 70.78          O
ANISOU 5909  OE2 GLU B 166    7363  12860   6670  -1450  -1205  -2476       O
ATOM   5910  C   GLU B 166      32.774  50.274 113.539  1.00 54.41          C
ANISOU 5910  C   GLU B 166    5894   9260   5520  -1230   -449  -2186       C
ATOM   5911  O   GLU B 166      33.238  50.332 112.391  1.00 51.56          O
ANISOU 5911  O   GLU B 166    5461   8780   5350  -1245   -381  -2089       O
ATOM   5913  N   SER B 167      31.901  49.338 113.906  1.00 51.52          N
ANISOU 5913  N   SER B 167    5628   8924   5023  -1010   -456  -2045       N
ATOM   5914  CA  SER B 167      31.442  48.326 112.944  1.00 47.79          C
ANISOU 5914  CA  SER B 167    5191   8329   4636   -787   -391  -1782       C
ATOM   5916  CB  SER B 167      30.677  47.198 113.631  1.00 46.99          C
ANISOU 5916  CB  SER B 167    5168   8333   4353   -578   -433  -1640       C
ATOM   5919  OG  SER B 167      31.364  46.757 114.798  1.00 52.14          O
ANISOU 5919  OG  SER B 167    5696   9332   4782   -575   -597  -1664       O
ATOM   5921  C   SER B 167      30.606  48.986 111.841  1.00 46.27          C
ANISOU 5921  C   SER B 167    5157   7766   4657   -799   -215  -1767       C
ATOM   5922  O   SER B 167      30.775  48.680 110.671  1.00 44.02          O
ANISOU 5922  O   SER B 167    4846   7367   4513   -740   -154  -1621       O
ATOM   5924  N   ARG B 168      29.737  49.921 112.219  1.00 47.08          N
ANISOU 5924  N   ARG B 168    5421   7690   4775   -873   -131  -1919       N
ATOM   5925  CA  ARG B 168      29.002  50.734 111.252  1.00 46.90          C
ANISOU 5925  CA  ARG B 168    5537   7323   4959   -893     30  -1912       C
ATOM   5927  CB  ARG B 168      28.022  51.656 111.987  1.00 47.81          C
ANISOU 5927  CB  ARG B 168    5823   7288   5056   -935    114  -2089       C
ATOM   5930  CG  ARG B 168      26.837  50.900 112.587  1.00 47.54          C
ANISOU 5930  CG  ARG B 168    5883   7299   4879   -746    123  -2003       C
ATOM   5933  CD  ARG B 168      25.725  51.841 113.014  1.00 47.54          C
ANISOU 5933  CD  ARG B 168    6052   7098   4913   -749    254  -2144       C
ATOM   5936  NE  ARG B 168      25.940  52.341 114.341  1.00 50.46          N
ANISOU 5936  NE  ARG B 168    6448   7610   5116   -863    217  -2391       N
ATOM   5938  CZ  ARG B 168      25.539  53.527 114.805  1.00 50.93          C
ANISOU 5938  CZ  ARG B 168    6634   7498   5217   -958    326  -2622       C
ATOM   5939  NH1 ARG B 168      24.901  54.426 114.050  1.00 49.18          N
ANISOU 5939  NH1 ARG B 168    6526   6936   5225   -945    486  -2627       N
ATOM   5942  NH2 ARG B 168      25.820  53.812 116.054  1.00 53.53          N
ANISOU 5942  NH2 ARG B 168    6982   8008   5348  -1067    273  -2852       N
ATOM   5945  C   ARG B 168      29.906  51.563 110.339  1.00 47.68          C
ANISOU 5945  C   ARG B 168    5562   7304   5249  -1064     80  -1953       C
ATOM   5946  O   ARG B 168      29.628  51.699 109.145  1.00 46.54          O
ANISOU 5946  O   ARG B 168    5470   6947   5267  -1023    185  -1823       O
ATOM   5948  N   ALA B 169      30.972  52.124 110.909  1.00 49.85          N
ANISOU 5948  N   ALA B 169    5716   7728   5497  -1268      6  -2132       N
ATOM   5949  CA  ALA B 169      31.959  52.882 110.143  1.00 51.31          C
ANISOU 5949  CA  ALA B 169    5801   7837   5857  -1464     49  -2177       C
ATOM   5951  CB  ALA B 169      33.058  53.466 111.099  1.00 53.21          C
ANISOU 5951  CB  ALA B 169    5896   8299   6023  -1717    -64  -2417       C
ATOM   5955  C   ALA B 169      32.606  52.045 109.042  1.00 49.69          C
ANISOU 5955  C   ALA B 169    5453   7707   5719  -1366     48  -1952       C
ATOM   5956  O   ALA B 169      32.819  52.523 107.934  1.00 48.36          O
ANISOU 5956  O   ALA B 169    5292   7355   5726  -1429    161  -1886       O
ATOM   5958  N   ARG B 170      32.933  50.800 109.355  1.00 49.74          N
ANISOU 5958  N   ARG B 170    5337   7979   5583  -1207    -68  -1834       N
ATOM   5959  CA  ARG B 170      33.519  49.901 108.367  1.00 50.55          C
ANISOU 5959  CA  ARG B 170    5317   8152   5739  -1083    -56  -1631       C
ATOM   5961  CB  ARG B 170      33.931  48.575 109.016  1.00 52.22          C
```

FIG. 18 (continued)

```
ANISOU 5961  CB  ARG B 170    5394   8667   5780   -906   -196  -1528    C
ATOM   5964  CG  ARG B 170     35.236  48.685 109.788  1.00 57.06      C
ANISOU 5964  CG  ARG B 170    5754   9605   6320  -1035   -338  -1631    C
ATOM   5967  CD  ARG B 170     35.730  47.337 110.296  1.00 59.09      C
ANISOU 5967  CD  ARG B 170    5861  10160   6428   -825   -469  -1483    C
ATOM   5970  NE  ARG B 170     35.447  47.166 111.729  1.00 62.79      N
ANISOU 5970  NE  ARG B 170    6355  10826   6677   -811   -610  -1560    N
ATOM   5972  CZ  ARG B 170     34.596  46.281 112.254  1.00 61.85      C
ANISOU 5972  CZ  ARG B 170    6369  10713   6418   -610   -635  -1447    C
ATOM   5973  NH1 ARG B 170     33.924  45.430 111.479  1.00 60.70      N
ANISOU 5973  NH1 ARG B 170    6346  10382   6336   -410   -538  -1259    N
ATOM   5976  NH2 ARG B 170     34.426  46.238 113.575  1.00 62.78      N
ANISOU 5976  NH2 ARG B 170    6500  11034   6320   -624   -756  -1525    N
ATOM   5979  C   ARG B 170     32.578  49.650 107.181  1.00 46.18      C
ANISOU 5979  C   ARG B 170    4933   7331   5284   -941     79  -1463    C
ATOM   5980  O   ARG B 170     33.031  49.627 106.021  1.00 44.24      O
ANISOU 5980  O   ARG B 170    4640   7016   5155   -946    162  -1360    O
ATOM   5982  N   ILE B 171     31.288  49.469 107.476  1.00 42.62      N
ANISOU 5982  N   ILE B 171    4666   6753   4775   -823    100  -1438    N
ATOM   5983  CA  ILE B 171     30.268  49.329 106.432  1.00 40.08      C
ANISOU 5983  CA  ILE B 171    4503   6193   4535   -709    210  -1294    C
ATOM   5985  CB  ILE B 171     28.859  48.950 106.992  1.00 37.31      C
ANISOU 5985  CB  ILE B 171    4308   5775   4094   -572    207  -1265    C
ATOM   5987  CG1 ILE B 171     28.894  47.545 107.615  1.00 36.48      C
ANISOU 5987  CG1 ILE B 171    4152   5884   3826   -417    104  -1173    C
ATOM   5990  CD1 ILE B 171     27.735  47.197 108.502  1.00 35.65      C
ANISOU 5990  CD1 ILE B 171    4161   5782   3603   -323     87  -1173    C
ATOM   5994  CG2 ILE B 171     27.806  48.993 105.873  1.00 36.51      C
ANISOU 5994  CG2 ILE B 171    4346   5438   4088   -488    312  -1129    C
ATOM   5998  C   ILE B 171     30.193  50.622 105.624  1.00 40.69      C
ANISOU 5998  C   ILE B 171    4652   6020   4788   -854    336  -1335    C
ATOM   5999  O   ILE B 171     30.303  50.589 104.407  1.00 38.70      O
ANISOU 5999  O   ILE B 171    4410   5666   4628   -835    416  -1206    O
ATOM   6001  N   LYS B 172     30.040  51.760 106.299  1.00 42.92      N
ANISOU 6001  N   LYS B 172    4993   6202   5112   -999    359  -1514    N
ATOM   6002  CA  LYS B 172     29.890  53.049 105.591  1.00 43.78      C
ANISOU 6002  CA  LYS B 172    5200   6028   5405  -1128    494  -1544    C
ATOM   6004  CB  LYS B 172     29.584  54.179 106.576  1.00 45.19      C
ANISOU 6004  CB  LYS B 172    5474   6085   5610  -1261    521  -1770    C
ATOM   6007  CG  LYS B 172     28.206  54.012 107.199  1.00 43.39      C
ANISOU 6007  CG  LYS B 172    5393   5790   5304  -1097    532  -1777    C
ATOM   6010  CD  LYS B 172     27.836  55.154 108.140  1.00 45.75      C
ANISOU 6010  CD  LYS B 172    5809   5946   5630  -1207    589  -2013    C
ATOM   6013  CE  LYS B 172     28.344  54.921 109.562  1.00 46.99      C
ANISOU 6013  CE  LYS B 172    5891   6370   5594  -1292    465  -2218    C
ATOM   6016  NZ  LYS B 172     27.818  55.948 110.523  1.00 48.44      N
ANISOU 6016  NZ  LYS B 172    6219   6415   5772  -1377    534  -2466    N
ATOM   6020  C   LYS B 172     31.087  53.390 104.680  1.00 45.75      C
ANISOU 6020  C   LYS B 172    5327   6284   5772  -1277    543  -1505    C
ATOM   6021  O   LYS B 172     30.914  53.934 103.571  1.00 45.69      O
ANISOU 6021  O   LYS B 172    5398   6064   5899  -1299    665  -1396    O
ATOM   6023  N   THR B 173     32.286  53.038 105.142  1.00 47.39      N
ANISOU 6023  N   THR B 173    5332   6753   5921  -1369    448  -1577    N
ATOM   6024  CA  THR B 173     33.522  53.227 104.379  1.00 48.24      C
ANISOU 6024  CA  THR B 173    5273   6929   6126  -1507    489  -1540    C
ATOM   6026  CB  THR B 173     34.791  52.971 105.259  1.00 50.47      C
ANISOU 6026  CB  THR B 173    5302   7541   6331  -1626    353  -1666    C
ATOM   6028  OG1 THR B 173     34.865  53.953 106.302  1.00 51.56      O
ANISOU 6028  OG1 THR B 173    5464   7657   6467  -1837    311  -1907    O
ATOM   6030  CG2 THR B 173     36.090  53.017 104.426  1.00 50.74      C
ANISOU 6030  CG2 THR B 173    5124   7689   6468  -1744    403  -1604    C
ATOM   6034  C   THR B 173     33.552  52.341 103.130  1.00 45.08      C
ANISOU 6034  C   THR B 173    4855   6543   5730  -1339    548  -1312    C
ATOM   6035  O   THR B 173     33.925  52.819 102.062  1.00 45.13      O
ANISOU 6035  O   THR B 173    4858   6435   5855  -1422    667  -1231    O
ATOM   6037  N   ARG B 174     33.139  51.074 103.260  1.00 42.37      N
ANISOU 6037  N   ARG B 174    4516   6326   5255  -1114    474  -1213    N
ATOM   6038  CA  ARG B 174     33.062  50.159 102.132  1.00 40.37      C
ANISOU 6038  CA  ARG B 174    4279   6073   4988   -951    530  -1024    C
ATOM   6040  CB  ARG B 174     32.702  48.724 102.603  1.00 40.18      C
ANISOU 6040  CB  ARG B 174    4253   6199   4815   -728    431   -957    C
ATOM   6043  CG  ARG B 174     32.532  47.667 101.508  1.00 38.82      C
ANISOU 6043  CG  ARG B 174    4127   6008   4615   -556    489   -789    C
ATOM   6046  CD  ARG B 174     33.770  47.508 100.617  1.00 41.27      C
ANISOU 6046  CD  ARG B 174    4279   6420   4980   -585    565   -736    C
ATOM   6049  NE  ARG B 174     33.483  46.561  99.552  1.00 40.16      N
ANISOU 6049  NE  ARG B 174    4226   6234   4799   -427    636   -602    N
ATOM   6051  CZ  ARG B 174     34.073  46.509  98.366  1.00 42.33      C
ANISOU 6051  CZ  ARG B 174    4466   6506   5110   -434    757   -529    C
```

FIG. 18 (continued)

```
ATOM   6052  NH1 ARG B 174      35.037  47.366  98.024  1.00 43.81          N
ANISOU 6052  NH1 ARG B 174    4517   6734   5394   -598    833   -556       N
ATOM   6055  NH2 ARG B 174      33.673  45.584  97.487  1.00 41.77          N
ANISOU 6055  NH2 ARG B 174    4509   6389   4974   -287    813   -433       N
ATOM   6058  C   ARG B 174      32.076  50.677 101.073  1.00 38.23          C
ANISOU 6058  C   ARG B 174    4209   5526   4790   -929    651   -918       C
ATOM   6059  O   ARG B 174      32.380  50.628  99.877  1.00 36.58          O
ANISOU 6059  O   ARG B 174    3999   5275   4625   -927    748   -799       O
ATOM   6061  N   LEU B 175      30.909  51.149 101.515  1.00 35.78          N
ANISOU 6061  N   LEU B 175    4061   5052   4482   -903    646   -954       N
ATOM   6062  CA  LEU B 175      29.898  51.731 100.606  1.00 36.05          C
ANISOU 6062  CA  LEU B 175    4273   4835   4589   -869    746   -843       C
ATOM   6064  CB  LEU B 175      28.590  52.039 101.363  1.00 33.65          C
ANISOU 6064  CB  LEU B 175    4107   4407   4270   -796    721   -893       C
ATOM   6067  CG  LEU B 175      27.780  50.793 101.813  1.00 31.65          C
ANISOU 6067  CG  LEU B 175    3878   4276   3873   -612    629   -844       C
ATOM   6069  CD1 LEU B 175      26.544  51.185 102.575  1.00 30.04          C
ANISOU 6069  CD1 LEU B 175    3785   3966   3663   -554    626   -896       C
ATOM   6073  CD2 LEU B 175      27.406  49.938 100.620  1.00 28.03          C
ANISOU 6073  CD2 LEU B 175    3462   3815   3374   -492    648   -661       C
ATOM   6077  C   LEU B 175      30.434  52.983  99.877  1.00 38.24          C
ANISOU 6077  C   LEU B 175    4564   4944   5023  -1047    871   -835       C
ATOM   6078  O   LEU B 175      30.199  53.178  98.676  1.00 36.03          O
ANISOU 6078  O   LEU B 175    4361   4545   4784  -1022    965   -678       O
ATOM   6080  N   PHE B 176      31.162  53.816 100.618  1.00 40.52          N
ANISOU 6080  N   PHE B 176    4779   5230   5387  -1237    871  -1002       N
ATOM   6081  CA  PHE B 176      31.776  55.013 100.073  1.00 42.97          C
ANISOU 6081  CA  PHE B 176    5094   5376   5859  -1443    993  -1013       C
ATOM   6083  CB  PHE B 176      32.451  55.808 101.205  1.00 47.42          C
ANISOU 6083  CB  PHE B 176    5581   5957   6479  -1663    957  -1253       C
ATOM   6086  CG  PHE B 176      33.078  57.096 100.752  1.00 50.36          C
ANISOU 6086  CG  PHE B 176    5968   6130   7036  -1911   1090  -1287       C
ATOM   6087  CD1 PHE B 176      32.408  58.300 100.909  1.00 52.94          C
ANISOU 6087  CD1 PHE B 176    6488   6131   7496  -1987   1185  -1350       C
ATOM   6089  CE1 PHE B 176      32.973  59.496 100.488  1.00 55.42          C
ANISOU 6089  CE1 PHE B 176    6837   6224   7995  -2223   1321  -1373       C
ATOM   6091  CZ  PHE B 176      34.224  59.494  99.897  1.00 56.76          C
ANISOU 6091  CZ  PHE B 176    6829   6524   8212  -2401   1363  -1330       C
ATOM   6093  CE2 PHE B 176      34.906  58.295  99.724  1.00 55.59          C
ANISOU 6093  CE2 PHE B 176    6468   6726   7928  -2316   1271  -1268       C
ATOM   6095  CD2 PHE B 176      34.327  57.104 100.160  1.00 52.96          C
ANISOU 6095  CD2 PHE B 176    6120   6587   7417  -2065   1135  -1249       C
ATOM   6097  C   PHE B 176      32.803  54.647  99.001  1.00 42.26          C
ANISOU 6097  C   PHE B 176    4872   5406   5779  -1486   1056   -889       C
ATOM   6098  O   PHE B 176      32.866  55.284  97.949  1.00 41.47          O
ANISOU 6098  O   PHE B 176    4839   5145   5772  -1551   1189   -766       O
ATOM   6100  N   THR B 177      33.615  53.634  99.287  1.00 41.44          N
ANISOU 6100  N   THR B 177    4579   5588   5578  -1441    970   -915       N
ATOM   6101  CA  THR B 177      34.590  53.142  98.341  1.00 42.55          C
ANISOU 6101  CA  THR B 177    4577   5873   5715  -1446   1038   -807       C
ATOM   6103  CB  THR B 177      35.450  52.027  98.938  1.00 43.95          C
ANISOU 6103  CB  THR B 177    4533   6370   5795  -1367    927   -857       C
ATOM   6105  OG1 THR B 177      36.084  52.512 100.120  1.00 46.28          O
ANISOU 6105  OG1 THR B 177    4685   6781   6117  -1533    832  -1040       O
ATOM   6107  CG2 THR B 177      36.510  51.583  97.933  1.00 46.22          C
ANISOU 6107  CG2 THR B 177    4661   6803   6098  -1365   1025   -752       C
ATOM   6111  C   THR B 177      33.916  52.632  97.055  1.00 40.98          C
ANISOU 6111  C   THR B 177    4521   5588   5461  -1280   1119   -607       C
ATOM   6112  O   THR B 177      34.399  52.950  95.958  1.00 41.72          O
ANISOU 6112  O   THR B 177    4605   5645   5602  -1349   1251   -497       O
ATOM   6114  N   ILE B 178      32.817  51.871  97.182  1.00 36.70          N
ANISOU 6114  N   ILE B 178    4108   5026   4812  -1082   1045   -563       N
ATOM   6115  CA  ILE B 178      32.114  51.352  96.008  1.00 36.13          C
ANISOU 6115  CA  ILE B 178    4171   4893   4666   -942   1099   -393       C
ATOM   6117  CB  ILE B 178      30.931  50.403  96.369  1.00 33.67          C
ANISOU 6117  CB  ILE B 178    3968   4590   4235   -749    992   -375       C
ATOM   6119  CG1 ILE B 178      31.453  49.111  97.001  1.00 33.22          C
ANISOU 6119  CG1 ILE B 178    3789   4752   4083   -641    901   -432       C
ATOM   6122  CD1 ILE B 178      30.428  48.379  97.749  1.00 30.56          C
ANISOU 6122  CD1 ILE B 178    3534   4417   3658   -506    793   -449       C
ATOM   6126  CG2 ILE B 178      30.055  50.087  95.130  1.00 31.14          C
ANISOU 6126  CG2 ILE B 178    3803   4186   3843   -646   1038   -211       C
ATOM   6130  C   ILE B 178      31.616  52.490  95.107  1.00 36.64          C
ANISOU 6130  C   ILE B 178    4383   4724   4817  -1021   1215   -279       C
ATOM   6131  O   ILE B 178      31.865  52.494  93.901  1.00 35.84          O
ANISOU 6131  O   ILE B 178    4310   4616   4693  -1028   1319   -143       O
ATOM   6133  N   ARG B 179      30.919  53.440  95.720  1.00 37.29          N
ANISOU 6133  N   ARG B 179    4562   4617   4991  -1071   1203   -333       N
ATOM   6134  CA  ARG B 179      30.386  54.601  95.042  1.00 39.65          C
```

FIG. 18 (continued)

```
ANISOU 6134  CA  ARG B 179    5007   4663   5395  -1126   1310   -221    C
ATOM   6136  CB  ARG B 179     29.674  55.501  96.053  1.00 40.37        C
ANISOU 6136  CB  ARG B 179    5186   4561   5593  -1154   1288   -335    C
ATOM   6139  CG  ARG B 179     29.329  56.914  95.534  1.00 42.95        C
ANISOU 6139  CG  ARG B 179    5657   4582   6082  -1234   1421   -243    C
ATOM   6142  CD  ARG B 179     28.359  57.594  96.467  1.00 44.08        C
ANISOU 6142  CD  ARG B 179    5910   4531   6307  -1186   1403   -343    C
ATOM   6145  NE  ARG B 179     27.977  58.934  96.022  1.00 47.18        N
ANISOU 6145  NE  ARG B 179    6453   4600   6872  -1232   1539   -249    N
ATOM   6147  CZ  ARG B 179     28.661  60.045  96.269  1.00 51.03        C
ANISOU 6147  CZ  ARG B 179    6966   4893   7529  -1440   1645   -347    C
ATOM   6148  NH1 ARG B 179     29.808  60.010  96.946  1.00 52.60        N
ANISOU 6148  NH1 ARG B 179    7027   5219   7741  -1644   1620   -550    N
ATOM   6151  NH2 ARG B 179     28.206  61.213  95.814  1.00 53.12        N
ANISOU 6151  NH2 ARG B 179    7393   4832   7957  -1449   1780   -233    N
ATOM   6154  C   ARG B 179     31.480  55.404  94.334  1.00 42.41        C
ANISOU 6154  C   ARG B 179    5301   4962   5851  -1320   1453   -173    C
ATOM   6155  O   ARG B 179     31.304  55.811  93.207  1.00 41.10        O
ANISOU 6155  O   ARG B 179    5231   4689   5696  -1321   1559      7    O
ATOM   6157  N   GLN B 180     32.590  55.616  95.037  1.00 45.53        N
ANISOU 6157  N   GLN B 180    5533   5451   6317  -1489   1449   -332    N
ATOM   6158  CA  GLN B 180     33.767  56.311  94.521  1.00 49.32        C
ANISOU 6158  CA  GLN B 180    5911   5922   6906  -1708   1579   -313    C
ATOM   6160  CB  GLN B 180     34.828  56.321  95.627  1.00 52.68        C
ANISOU 6160  CB  GLN B 180    6123   6515   7379  -1872   1508   -531    C
ATOM   6163  CG  GLN B 180     36.221  56.687  95.201  1.00 57.74        C
ANISOU 6163  CG  GLN B 180    6574   7257   8108  -2091   1614   -531    C
ATOM   6166  CD  GLN B 180     36.534  58.123  95.497  1.00 62.80        C
ANISOU 6166  CD  GLN B 180    7251   7671   8941  -2372   1699   -620    C
ATOM   6167  OE1 GLN B 180     37.273  58.422  96.442  1.00 66.84        O
ANISOU 6167  OE1 GLN B 180    7608   8275   9513  -2562   1636   -819    O
ATOM   6168  NE2 GLN B 180     35.949  59.037  94.713  1.00 65.13        N
ANISOU 6168  NE2 GLN B 180    7757   7658   9332  -2402   1840   -473    N
ATOM   6171  C   GLN B 180     34.328  55.654  93.260  1.00 48.49        C
ANISOU 6171  C   GLN B 180    5745   5968   6709  -1657   1669   -148    C
ATOM   6172  O   GLN B 180     34.546  56.315  92.248  1.00 48.10        O
ANISOU 6172  O   GLN B 180    5755   5807   6712  -1748   1819      0    O
ATOM   6174  N   GLU B 181     34.568  54.354  93.345  1.00 47.49        N
ANISOU 6174  N   GLU B 181    5509   6091   6443  -1509   1588   -175    N
ATOM   6175  CA  GLU B 181     35.088  53.582  92.230  1.00 47.94        C
ANISOU 6175  CA  GLU B 181    5514   6306   6395  -1434   1676    -52    C
ATOM   6177  CB  GLU B 181     35.462  52.165  92.678  1.00 49.26        C
ANISOU 6177  CB  GLU B 181    5541   6728   6446  -1275   1576   -133    C
ATOM   6180  CG  GLU B 181     36.627  52.112  93.680  1.00 52.79        C
ANISOU 6180  CG  GLU B 181    5726   7363   6968  -1379   1521   -286    C
ATOM   6183  CD  GLU B 181     37.917  52.691  93.108  1.00 57.41        C
ANISOU 6183  CD  GLU B 181    6129   8031   7652  -1574   1671   -259    C
ATOM   6184  OE1 GLU B 181     38.141  52.575  91.875  1.00 59.43        O
ANISOU 6184  OE1 GLU B 181    6420   8296   7865  -1551   1823   -118    O
ATOM   6185  OE2 GLU B 181     38.691  53.281  93.891  1.00 60.77        O
ANISOU 6185  OE2 GLU B 181    6379   8519   8191  -1763   1639   -381    O
ATOM   6186  C   GLU B 181     34.102  53.518  91.075  1.00 45.61        C
ANISOU 6186  C   GLU B 181    5437   5894   5999  -1314   1730    135    C
ATOM   6187  O   GLU B 181     34.499  53.551  89.918  1.00 44.98        O
ANISOU 6187  O   GLU B 181    5373   5848   5869  -1338   1866    269    O
ATOM   6189  N   MET B 182     32.811  53.410  91.377  1.00 42.40        N
ANISOU 6189  N   MET B 182    5189   5374   5547  -1184   1624    147    N
ATOM   6190  CA  MET B 182     31.811  53.466  90.307  1.00 41.07        C
ANISOU 6190  CA  MET B 182    5213   5107   5284  -1085   1655    333    C
ATOM   6192  CB  MET B 182     30.393  53.268  90.844  1.00 37.93        C
ANISOU 6192  CB  MET B 182    4938   4621   4851   -941   1517    324    C
ATOM   6195  CG  MET B 182     29.954  51.825  90.950  1.00 35.72        C
ANISOU 6195  CG  MET B 182    4656   4509   4408   -776   1403    281    C
ATOM   6198  SD  MET B 182     28.243  51.715  91.547  1.00 33.98        S
ANISOU 6198  SD  MET B 182    4561   4187   4163   -638   1260    289    S
ATOM   6199  CE  MET B 182     28.071  49.981  91.894  1.00 30.91        C
ANISOU 6199  CE  MET B 182    4134   3993   3616   -502   1145    201    C
ATOM   6203  C   MET B 182     31.904  54.811  89.562  1.00 42.81        C
ANISOU 6203  C   MET B 182    5521   5133   5613  -1222   1801    483    C
ATOM   6204  O   MET B 182     31.949  54.842  88.334  1.00 43.82        O
ANISOU 6204  O   MET B 182    5720   5279   5649  -1214   1902    656    O
ATOM   6206  N   ALA B 183     31.927  55.901  90.324  1.00 43.77        N
ANISOU 6206  N   ALA B 183    5648   5061   5920  -1349   1815    412    N
ATOM   6207  CA  ALA B 183     32.023  57.267  89.763  1.00 47.57        C
ANISOU 6207  CA  ALA B 183    6227   5303   6543  -1492   1965    547    C
ATOM   6209  CB  ALA B 183     31.952  58.334  90.886  1.00 47.21        C
ANISOU 6209  CB  ALA B 183    6201   5027   6709  -1619   1959    401    C
ATOM   6213  C   ALA B 183     33.278  57.448  88.926  1.00 49.22        C
ANISOU 6213  C   ALA B 183    6337   5601   6763  -1655   2128    623    C
```

FIG. 18 (continued)

```
ATOM   6214  O   ALA B 183      33.232  58.074  87.853  1.00 51.40          O
ANISOU 6214  O   ALA B 183    6723   5769   7036  -1696   2264    835       O
ATOM   6216  N   ASN B 184      34.393  56.892  89.391  1.00 49.93          N
ANISOU 6216  N   ASN B 184    6210   5904   6857  -1739   2119    467       N
ATOM   6217  CA  ASN B 184      35.648  56.919  88.626  1.00 52.77          C
ANISOU 6217  CA  ASN B 184    6430   6400   7219  -1880   2279    529       C
ATOM   6219  CB  ASN B 184      36.779  56.214  89.394  1.00 53.96          C
ANISOU 6219  CB  ASN B 184    6305   6812   7386  -1934   2228    334       C
ATOM   6222  CG  ASN B 184      37.275  57.019  90.576  1.00 56.22          C
ANISOU 6222  CG  ASN B 184    6476   7022   7865  -2145   2182    151       C
ATOM   6223  OD1 ASN B 184      36.949  58.201  90.725  1.00 57.54          O
ANISOU 6223  OD1 ASN B 184    6770   6914   8178  -2289   2234    164       O
ATOM   6224  ND2 ASN B 184      38.069  56.381  91.426  1.00 56.36          N
ANISOU 6224  ND2 ASN B 184    6256   7281   7879  -2164   2086    -23       N
ATOM   6227  C   ASN B 184      35.501  56.284  87.245  1.00 52.20          C
ANISOU 6227  C   ASN B 184    6440   6448   6948  -1750   2364    720       C
ATOM   6228  O   ASN B 184      36.098  56.744  86.275  1.00 52.81          O
ANISOU 6228  O   ASN B 184    6517   6525   7022  -1862   2543    868       O
ATOM   6230  N   ARG B 185      34.699  55.225  87.162  1.00 49.05          N
ANISOU 6230  N   ARG B 185    6114   6149   6372  -1527   2241    712       N
ATOM   6231  CA  ARG B 185      34.480  54.535  85.896  1.00 49.50          C
ANISOU 6231  CA  ARG B 185    6267   6330   6211  -1405   2302    857       C
ATOM   6233  CB  ARG B 185      34.275  53.056  86.135  1.00 48.12          C
ANISOU 6233  CB  ARG B 185    6054   6348   5881  -1217   2182    736       C
ATOM   6236  CG  ARG B 185      35.443  52.382  86.773  1.00 50.45          C
ANISOU 6236  CG  ARG B 185    6111   6832   6225  -1234   2191    570       C
ATOM   6239  CD  ARG B 185      35.172  50.913  86.790  1.00 51.58          C
ANISOU 6239  CD  ARG B 185    6266   7127   6205  -1029   2103    492       C
ATOM   6242  NE  ARG B 185      36.176  50.148  87.532  1.00 53.16          N
ANISOU 6242  NE  ARG B 185    6238   7505   6453   -992   2085    343       N
ATOM   6244  CZ  ARG B 185      36.584  48.916  87.196  1.00 53.39          C
ANISOU 6244  CZ  ARG B 185    6220   7703   6364   -842   2120    302       C
ATOM   6245  NH1 ARG B 185      36.107  48.283  86.105  1.00 51.67          N
ANISOU 6245  NH1 ARG B 185    6174   7502   5957   -736   2181    371       N
ATOM   6248  NH2 ARG B 185      37.484  48.310  87.971  1.00 54.22          N
ANISOU 6248  NH2 ARG B 185    6104   7962   6537   -794   2093    186       N
ATOM   6251  C   ARG B 185      33.304  55.072  85.086  1.00 48.61          C
ANISOU 6251  C   ARG B 185    6393   6058   6018  -1339   2299   1067       C
ATOM   6252  O   ARG B 185      32.987  54.531  84.026  1.00 48.73          O
ANISOU 6252  O   ARG B 185    6509   6184   5824  -1243   2328   1187       O
ATOM   6254  N   GLY B 186      32.659  56.123  85.575  1.00 47.86          N
ANISOU 6254  N   GLY B 186    6388   5715   6082  -1382   2266   1108       N
ATOM   6255  CA  GLY B 186      31.490  56.679  84.912  1.00 47.47          C
ANISOU 6255  CA  GLY B 186    6545   5512   5979  -1292   2249   1322       C
ATOM   6258  C   GLY B 186      30.222  55.848  85.023  1.00 45.21          C
ANISOU 6258  C   GLY B 186    6340   5292   5545  -1084   2064   1309       C
ATOM   6259  O   GLY B 186      29.344  55.943  84.141  1.00 45.00          O
ANISOU 6259  O   GLY B 186    6456   5257   5386   -988   2042   1505       O
ATOM   6261  N   LEU B 187      30.115  55.046  86.095  1.00 42.13          N
ANISOU 6261  N   LEU B 187    5855   4980   5172  -1021   1929   1090       N
ATOM   6262  CA  LEU B 187      29.008  54.108  86.282  1.00 39.58          C
ANISOU 6262  CA  LEU B 187    5585   4740   4713   -847   1760   1054       C
ATOM   6264  CB  LEU B 187      29.537  52.715  86.663  1.00 38.53          C
ANISOU 6264  CB  LEU B 187    5341   4821   4479   -798   1702    869       C
ATOM   6267  CG  LEU B 187      30.501  52.012  85.695  1.00 40.12          C
ANISOU 6267  CG  LEU B 187    5502   5209   4532   -818   1819    884       C
ATOM   6269  CD1 LEU B 187      31.185  50.802  86.351  1.00 37.59          C
ANISOU 6269  CD1 LEU B 187    5044   5050   4187   -764   1779    687       C
ATOM   6273  CD2 LEU B 187      29.760  51.582  84.448  1.00 41.09          C
ANISOU 6273  CD2 LEU B 187    5781   5408   4424   -737   1811   1029       C
ATOM   6277  C   LEU B 187      27.995  54.543  87.357  1.00 37.88          C
ANISOU 6277  C   LEU B 187    5399   4363   4631   -782   1642    995       C
ATOM   6278  O   LEU B 187      26.882  54.064  87.358  1.00 34.34          O
ANISOU 6278  O   LEU B 187    5011   3948   4090   -649   1520   1028       O
ATOM   6280  N   TRP B 188      28.380  55.443  88.257  1.00 39.04          N
ANISOU 6280  N   TRP B 188    5500   4343   4988   -885   1684    902       N
ATOM   6281  CA  TRP B 188      27.535  55.819  89.396  1.00 38.51          C
ANISOU 6281  CA  TRP B 188    5455   4133   5044   -827   1592    804       C
ATOM   6283  CB  TRP B 188      28.284  56.783  90.333  1.00 40.60          C
ANISOU 6283  CB  TRP B 188    5665   4235   5524   -990   1664    657       C
ATOM   6286  CG  TRP B 188      27.397  57.258  91.432  1.00 40.19          C
ANISOU 6286  CG  TRP B 188    5662   4023   5586   -927   1597    555       C
ATOM   6287  CD1 TRP B 188      26.814  58.489  91.544  1.00 41.98          C
ANISOU 6287  CD1 TRP B 188    6007   3966   5978   -926   1669    622       C
ATOM   6289  NE1 TRP B 188      26.026  58.533  92.666  1.00 40.96          N
ANISOU 6289  NE1 TRP B 188    5889   3772   5901   -839   1591    480       N
ATOM   6291  CE2 TRP B 188      26.088  57.321  93.305  1.00 38.68          C
ANISOU 6291  CE2 TRP B 188    5491   3731   5475   -792   1462    332       C
ATOM   6292  CD2 TRP B 188      26.943  56.489  92.552  1.00 38.34          C
```

FIG. 18 (continued)

```
ANISOU 6292  CD2 TRP B 188     5367   3899   5301   -839   1461    376        C
ATOM   6293  CE3 TRP B 188      27.176  55.170  92.995  1.00 36.40            C
ANISOU 6293  CE3 TRP B 188     5015   3902   4915   -788   1349    258        C
ATOM   6295  CZ3 TRP B 188      26.556  54.738  94.169  1.00 35.07            C
ANISOU 6295  CZ3 TRP B 188     4823   3772   4729   -707   1239    115        C
ATOM   6297  CH2 TRP B 188      25.712  55.591  94.890  1.00 35.90            C
ANISOU 6297  CH2 TRP B 188     5004   3687   4950   -673   1245     72        C
ATOM   6299  CZ2 TRP B 188      25.476  56.890  94.484  1.00 38.23            C
ANISOU 6299  CZ2 TRP B 188     5404   3725   5396   -709   1358    170        C
ATOM   6301  C   TRP B 188      26.158  56.414  89.036  1.00 38.39            C
ANISOU 6301  C   TRP B 188     5578   3966   5042   -695   1562    985        C
ATOM   6302  O   TRP B 188      25.137  55.975  89.580  1.00 35.46            O
ANISOU 6302  O   TRP B 188     5213   3624   4638   -562   1439    943        O
ATOM   6304  N   ASP B 189      26.121  57.400  88.135  1.00 41.18            N
ANISOU 6304  N   ASP B 189     6032   4167   5448   -724   1675   1200        N
ATOM   6305  CA  ASP B 189      24.864  58.082  87.784  1.00 43.01            C
ANISOU 6305  CA  ASP B 189     6382   4247   5714   -582   1654   1402        C
ATOM   6307  CB  ASP B 189      25.080  59.189  86.735  1.00 47.25            C
ANISOU 6307  CB  ASP B 189     7031   4612   6309   -632   1803   1663        C
ATOM   6310  CG  ASP B 189      25.783  60.429  87.295  1.00 51.30            C
ANISOU 6310  CG  ASP B 189     7574   4830   7087   -788   1956   1601        C
ATOM   6311  OD1 ASP B 189      26.152  60.464  88.489  1.00 52.79            O
ANISOU 6311  OD1 ASP B 189     7692   4963   7402   -869   1942   1342        O
ATOM   6312  OD2 ASP B 189      25.986  61.388  86.510  1.00 55.23            O
ANISOU 6312  OD2 ASP B 189     8175   5150   7659   -842   2097   1818        O
ATOM   6313  C   ASP B 189      23.786  57.091  87.298  1.00 41.52            C
ANISOU 6313  C   ASP B 189     6198   4266   5312   -415   1501   1489        C
ATOM   6314  O   ASP B 189      22.634  57.169  87.714  1.00 40.82            O
ANISOU 6314  O   ASP B 189     6121   4131   5256   -276   1410   1515        O
ATOM   6316  N   SER B 190      24.169  56.164  86.424  1.00 40.35            N
ANISOU 6316  N   SER B 190     6036   4347   4946   -437   1480   1522        N
ATOM   6317  CA  SER B 190      23.247  55.140  85.928  1.00 40.02            C
ANISOU 6317  CA  SER B 190     6005   4515   4688   -320   1335   1571        C
ATOM   6319  CB  SER B 190      23.906  54.317  84.806  1.00 40.83            C
ANISOU 6319  CB  SER B 190     6127   4831   4555   -376   1366   1605        C
ATOM   6322  OG  SER B 190      23.132  53.182  84.460  1.00 40.01            O
ANISOU 6322  OG  SER B 190     6033   4927   4241   -298   1224   1586        O
ATOM   6324  C   SER B 190      22.800  54.205  87.057  1.00 37.67            C
ANISOU 6324  C   SER B 190     5623   4296   4393   -265   1205   1353        C
ATOM   6325  O   SER B 190      21.611  53.885  87.165  1.00 36.79            O
ANISOU 6325  O   SER B 190     5513   4236   4231   -152   1083   1396        O
ATOM   6327  N   PHE B 191      23.755  53.799  87.896  1.00 35.36            N
ANISOU 6327  N   PHE B 191     5250   4023   4162   -348   1234   1135        N
ATOM   6328  CA  PHE B 191      23.470  52.985  89.079  1.00 34.53            C
ANISOU 6328  CA  PHE B 191     5069   3980   4070   -304   1129    936        C
ATOM   6330  CB  PHE B 191      24.782  52.581  89.783  1.00 32.20            C
ANISOU 6330  CB  PHE B 191     4677   3739   3818   -404   1174    736        C
ATOM   6333  CG  PHE B 191      24.595  51.665  90.965  1.00 30.28            C
ANISOU 6333  CG  PHE B 191     4362   3580   3563   -355   1068    553        C
ATOM   6334  CD1 PHE B 191      24.059  50.401  90.803  1.00 28.44            C
ANISOU 6334  CD1 PHE B 191     4138   3493   3174   -276    971    538        C
ATOM   6336  CE1 PHE B 191      23.897  49.550  91.910  1.00 27.90            C
ANISOU 6336  CE1 PHE B 191     4013   3490   3098   -233    886    391        C
ATOM   6338  CZ  PHE B 191      24.286  49.960  93.174  1.00 27.62            C
ANISOU 6338  CZ  PHE B 191     3907   3404   3185   -264    887    256        C
ATOM   6340  CE2 PHE B 191      24.822  51.202  93.351  1.00 28.36            C
ANISOU 6340  CE2 PHE B 191     3988   3366   3421   -353    972    243        C
ATOM   6342  CD2 PHE B 191      24.966  52.068  92.253  1.00 30.57            C
ANISOU 6342  CD2 PHE B 191     4331   3550   3736   -401   1068    393        C
ATOM   6344  C   PHE B 191      22.510  53.695  90.057  1.00 36.00            C
ANISOU 6344  C   PHE B 191     5257   4011   4411   -230   1090    915        C
ATOM   6345  O   PHE B 191      21.556  53.078  90.548  1.00 34.20            O
ANISOU 6345  O   PHE B 191     5005   3854   4136   -136    979    877        O
ATOM   6347  N   ARG B 192      22.743  54.970  90.331  1.00 39.21            N
ANISOU 6347  N   ARG B 192     5695   4202   5002   -274   1192    937        N
ATOM   6348  CA  ARG B 192      21.776  55.735  91.127  1.00 41.86            C
ANISOU 6348  CA  ARG B 192     6053   4366   5485   -181   1183    930        C
ATOM   6350  CB  ARG B 192      22.325  57.103  91.490  1.00 44.67            C
ANISOU 6350  CB  ARG B 192     6461   4456   6057   -269   1323    902        C
ATOM   6353  CG  ARG B 192      21.481  57.806  92.540  1.00 47.84            C
ANISOU 6353  CG  ARG B 192     6887   4675   6616   -179   1333    822        C
ATOM   6356  CD  ARG B 192      21.853  59.260  92.744  1.00 51.88            C
ANISOU 6356  CD  ARG B 192     7489   4871   7352   -254   1487    815        C
ATOM   6359  NE  ARG B 192      21.268  59.753  94.004  1.00 55.31            N
ANISOU 6359  NE  ARG B 192     7940   5156   7919   -194   1505    644        N
ATOM   6361  CZ  ARG B 192      20.075  60.345  94.139  1.00 57.75            C
ANISOU 6361  CZ  ARG B 192     8304   5314   8325    -11   1530    741        C
ATOM   6362  NH1 ARG B 192      19.289  60.559  93.084  1.00 60.18            N
ANISOU 6362  NH1 ARG B 192     8645   5602   8616    137   1524   1030        N
```

FIG. 18 (continued)

```
ATOM   6365  NH2 ARG B 192      19.658  60.727  95.347  1.00 57.61          N
ANISOU 6365  NH2 ARG B 192    8299   5178   8411     33   1564    549      N
ATOM   6368  C   ARG B 192      20.363  55.813  90.460  1.00 41.98          C
ANISOU 6368  C   ARG B 192    6107   4398   5445    -16   1114   1149      C
ATOM   6369  O   ARG B 192      19.349  55.537  91.128  1.00 40.94          O
ANISOU 6369  O   ARG B 192    5933   4298   5323     95   1033   1108      O
ATOM   6371  N   GLN B 193      20.311  56.092  89.152  1.00 41.26          N
ANISOU 6371  N   GLN B 193    6078   4323   5275     -4   1139   1380      N
ATOM   6372  CA  GLN B 193      19.061  56.222  88.388  1.00 43.90          C
ANISOU 6372  CA  GLN B 193    6435   4706   5539    144   1062   1618      C
ATOM   6374  CB  GLN B 193      19.342  56.645  86.931  1.00 47.86          C
ANISOU 6374  CB  GLN B 193    7020   5224   5939    122   1114   1871      C
ATOM   6377  CG  GLN B 193      19.669  58.122  86.697  1.00 52.49          C
ANISOU 6377  CG  GLN B 193    7700   5527   6717    115   1273   2027      C
ATOM   6380  CD  GLN B 193      20.090  58.430  85.228  1.00 55.14          C
ANISOU 6380  CD  GLN B 193    8124   5909   6919     71   1336   2285      C
ATOM   6381  OE1 GLN B 193      20.728  57.607  84.553  1.00 56.51          O
ANISOU 6381  OE1 GLN B 193    8293   6293   6887    -25   1322   2255      O
ATOM   6382  NE2 GLN B 193      19.729  59.620  84.746  1.00 58.85          N
ANISOU 6382  NE2 GLN B 193    8682   6175   7502    152   1418   2542      N
ATOM   6385  C   GLN B 193      18.204  54.956  88.333  1.00 41.06          C
ANISOU 6385  C   GLN B 193    6005   4602   4996    205    894   1588      C
ATOM   6386  O   GLN B 193      16.980  55.044  88.342  1.00 38.97          O
ANISOU 6386  O   GLN B 193    5701   4370   4735    336    811   1699      O
ATOM   6388  N   SER B 194      18.826  53.780  88.256  1.00 38.71          N
ANISOU 6388  N   SER B 194    5685   4481   4543    110    850   1446      N
ATOM   6389  CA  SER B 194      18.053  52.565  88.108  1.00 39.26          C
ANISOU 6389  CA  SER B 194    5711   4767   4439    141    704   1418      C
ATOM   6391  CB  SER B 194      18.936  51.383  87.701  1.00 39.54          C
ANISOU 6391  CB  SER B 194    5766   4957   4300     35    697   1295      C
ATOM   6394  OG  SER B 194      19.829  51.066  88.744  1.00 43.46          O
ANISOU 6394  OG  SER B 194    6220   5404   4888    -20    748   1081      O
ATOM   6396  C   SER B 194      17.217  52.263  89.376  1.00 37.06          C
ANISOU 6396  C   SER B 194    5348   4481   4254    211    637   1293      C
ATOM   6397  O   SER B 194      16.247  51.512  89.296  1.00 39.41          O
ANISOU 6397  O   SER B 194    5596   4927   4450    252    516   1317      O
ATOM   6399  N   GLU B 195      17.554  52.885  90.511  1.00 35.96          N
ANISOU 6399  N   GLU B 195    5191   4174   4298    214    717   1166      N
ATOM   6400  CA  GLU B 195      16.692  52.831  91.716  1.00 36.46          C
ANISOU 6400  CA  GLU B 195    5183   4215   4453    296    681   1069      C
ATOM   6402  CB  GLU B 195      17.508  53.029  92.998  1.00 32.41          C
ANISOU 6402  CB  GLU B 195    4664   3595   4055    236    757    844      C
ATOM   6405  CG  GLU B 195      16.637  52.924  94.304  1.00 33.95          C
ANISOU 6405  CG  GLU B 195    4796   3788   4315    317    733    731      C
ATOM   6408  CD  GLU B 195      17.440  52.879  95.605  1.00 31.11          C
ANISOU 6408  CD  GLU B 195    4427   3388   4005    245    777    493      C
ATOM   6409  OE1 GLU B 195      16.841  52.722  96.684  1.00 31.91          O
ANISOU 6409  OE1 GLU B 195    4487   3509   4127    298    766    391      O
ATOM   6410  OE2 GLU B 195      18.665  52.989  95.561  1.00 28.82          O
ANISOU 6410  OE2 GLU B 195    4160   3066   3722    132    821    410      O
ATOM   6411  C   GLU B 195      15.541  53.881  91.644  1.00 40.17          C
ANISOU 6411  C   GLU B 195    5640   4575   5048    446    697   1242      C
ATOM   6412  O   GLU B 195      15.766  55.081  91.425  1.00 42.13          O
ANISOU 6412  O   GLU B 195    5952   4624   5434    479    803   1335      O
ATOM   6414  N   ARG B 196      14.321  53.419  91.873  1.00 43.23          N
ANISOU 6414  N   ARG B 196    5938   5085   5401    540    602   1283      N
ATOM   6415  CA  ARG B 196      13.114  54.258  91.783  1.00 45.62          C
ANISOU 6415  CA  ARG B 196    6190   5332   5812    711    604   1462      C
ATOM   6417  CB  ARG B 196      13.423  55.766  91.881  1.00 49.26          C
ANISOU 6417  CB  ARG B 196    6735   5502   6480    782    757   1524      C
ATOM   6426  C   ARG B 196      12.449  53.952  90.459  1.00 49.58          C
ANISOU 6426  C   ARG B 196    6660   6018   6160    743    482   1694      C
ATOM   6427  O   ARG B 196      13.125  53.533  89.514  1.00 51.44          O
ANISOU 6427  O   ARG B 196    6964   6339   6242    636    451   1731      O
ATOM   6429 MN    MN B 301      16.649  40.458 102.484  0.50 51.43         MN
ANISOU 6429 MN    MN B 301    6868   7037   5638    187    285     15     MN
ATOM   6430  OH2 HOH B 302      13.347  41.525 103.018  1.00 30.86          O
ANISOU 6430  OH2 HOH B 302    4113   4496   3116    191    326    122      O
ATOM   6433  OH2 HOH B 303      17.517  37.286 103.215  1.00 27.83          O
ANISOU 6433  OH2 HOH B 303    4025   4041   2509    221    266     86      O
ATOM   6436  OH2 HOH B 304      16.758  39.411  99.992  1.00 33.53          O
ANISOU 6436  OH2 HOH B 304    4712   4685   3342    106    247     85      O
ATOM   6439  OH2 HOH B 305      13.909  39.097 101.109  1.00 28.56          O
ANISOU 6439  OH2 HOH B 305    3984   4147   2722     49    225    192      O
ATOM   6442  OH2 HOH B 306      18.617  34.143 101.068  1.00 57.23          O
ANISOU 6442  OH2 HOH B 306    8039   7503   6203    221    309    122      O
ATOM   6445  S   SO4 B 401      10.564  37.397 100.300  1.00 24.15          S
ANISOU 6445  S   SO4 B 401    3334   3706   2136   -209    131    366      S
ATOM   6446  O1  SO4 B 401      11.589  37.577 101.318  1.00 24.57          O
```

FIG. 18 (continued)

```
ANISOU 6446  O1  SO4 B 401    3431   3717   2189   -107    193    313      O
ATOM   6447  O2  SO4 B 401      9.790  36.265 100.734  1.00 26.79          O
ANISOU 6447  O2  SO4 B 401    3673   4054   2450   -317    135    402      O
ATOM   6448  O3  SO4 B 401     11.186  37.208  98.996  1.00 22.13          O
ANISOU 6448  O3  SO4 B 401    3171   3399   1838   -249     84    337      O
ATOM   6449  O4  SO4 B 401      9.774  38.664 100.295  1.00 25.26          O
ANISOU 6449  O4  SO4 B 401    3330   3928   2340   -146    130    413      O
ATOM   6450  S   SO4 B 402     24.619  61.060  94.938  0.60 44.14          S
ANISOU 6450  S   SO4 B 402    6512   3512   6748   -800   1721    214      S
ATOM   6451  O1  SO4 B 402     25.210  59.857  95.475  0.60 42.42          O
ANISOU 6451  O1  SO4 B 402    6143   3610   6364   -851   1593     49      O
ATOM   6452  O2  SO4 B 402     24.383  60.960  93.510  0.60 46.39          O
ANISOU 6452  O2  SO4 B 402    6835   3824   6968   -718   1742    517      O
ATOM   6453  O3  SO4 B 402     25.507  62.188  95.175  0.60 48.46          O
ANISOU 6453  O3  SO4 B 402    7114   3815   7483  -1020   1858    107      O
ATOM   6454  O4  SO4 B 402     23.339  61.299  95.581  0.60 46.77          O
ANISOU 6454  O4  SO4 B 402    6910   3733   7128   -608   1704    192      O
ATOM   6455  S   SO4 B 403     18.619  60.631  89.162  0.40 66.06          S
ANISOU 6455  S   SO4 B 403    9481   6537   9081    305   1467   1882      S
ATOM   6456  O1  SO4 B 403     17.740  59.472  89.051  0.40 63.64          O
ANISOU 6456  O1  SO4 B 403    9068   6534   8578    407   1287   1894      O
ATOM   6457  O2  SO4 B 403     20.016  60.204  89.050  0.40 64.73          O
ANISOU 6457  O2  SO4 B 403    9305   6447   8841     80   1508   1739      O
ATOM   6458  O3  SO4 B 403     18.393  61.289  90.445  0.40 65.76          O
ANISOU 6458  O3  SO4 B 403    9457   6265   9263    340   1542   1692      O
ATOM   6459  O4  SO4 B 403     18.287  61.568  88.091  0.40 67.77          O
ANISOU 6459  O4  SO4 B 403    9796   6610   9345    399   1537   2214      O
ATOM   6460  N   ALA D   0    -12.871  35.450 116.896  1.00 72.26          N
ANISOU 6460  N   ALA D   0    9799  10248   7407  -2399  -2711   -297      N
ATOM   6461  CA  ALA D   0    -11.930  35.094 115.786  1.00 71.39          C
ANISOU 6461  CA  ALA D   0    9399  10231   7494  -2537  -2656    -21      C
ATOM   6463  CB  ALA D   0    -10.493  35.112 116.285  1.00 75.56          C
ANISOU 6463  CB  ALA D   0    9642  11171   7898  -2845  -2846    154      C
ATOM   6467  C   ALA D   0    -12.259  33.729 115.180  1.00 68.28          C
ANISOU 6467  C   ALA D   0    8751   9916   7275  -2198  -2362    178      C
ATOM   6468  O   ALA D   0    -11.366  33.012 114.719  1.00 68.80          O
ANISOU 6468  O   ALA D   0    8489  10223   7429  -2204  -2296    443      O
ATOM   6472  N   MET D   1    -13.542  33.371 115.194  1.00 64.88          N
ANISOU 6472  N   MET D   1    8475   9302   6874  -1908  -2185     34      N
ATOM   6473  CA  MET D   1    -14.058  32.266 114.366  1.00 61.29          C
ANISOU 6473  CA  MET D   1    7883   8804   6602  -1650  -1899    159      C
ATOM   6475  CB  MET D   1    -15.550  32.065 114.639  1.00 58.20          C
ANISOU 6475  CB  MET D   1    7669   8277   6169  -1411  -1745    -64      C
ATOM   6478  CG  MET D   1    -16.275  31.067 113.696  1.00 55.15          C
ANISOU 6478  CG  MET D   1    7193   7806   5955  -1208  -1458     -2      C
ATOM   6481  SD  MET D   1    -15.804  29.345 113.912  1.00 51.46          S
ANISOU 6481  SD  MET D   1    6497   7552   5503  -1077  -1239    314      S
ATOM   6482  CE  MET D   1    -16.771  28.875 115.336  1.00 51.45          C
ANISOU 6482  CE  MET D   1    6615   7679   5257   -977  -1151    194      C
ATOM   6486  C   MET D   1    -13.807  32.607 112.898  1.00 61.22          C
ANISOU 6486  C   MET D   1    7858   8602   6803  -1740  -1865    218      C
ATOM   6487  O   MET D   1    -13.529  31.732 112.072  1.00 59.78          O
ANISOU 6487  O   MET D   1    7467   8476   6770  -1639  -1687    413      O
ATOM   6489  N   GLU D   2    -13.879  33.899 112.596  1.00 63.66          N
ANISOU 6489  N   GLU D   2    8425   8666   7095  -1932  -2039     50      N
ATOM   6490  CA  GLU D   2    -13.621  34.419 111.255  1.00 63.22          C
ANISOU 6490  CA  GLU D   2    8427   8403   7191  -2067  -2038    104      C
ATOM   6492  CB  GLU D   2    -13.827  35.928 111.254  1.00 65.42          C
ANISOU 6492  CB  GLU D   2    9123   8354   7380  -2265  -2261   -113      C
ATOM   6495  CG  GLU D   2    -14.412  36.460 109.980  1.00 64.77          C
ANISOU 6495  CG  GLU D   2    9275   7920   7416  -2198  -2216   -172      C
ATOM   6498  CD  GLU D   2    -13.920  37.847 109.634  1.00 67.35          C
ANISOU 6498  CD  GLU D   2    9966   7950   7675  -2544  -2438   -219      C
ATOM   6499  OE1 GLU D   2    -13.597  38.628 110.550  1.00 69.54          O
ANISOU 6499  OE1 GLU D   2   10458   8178   7784  -2767  -2649   -340      O
ATOM   6500  OE2 GLU D   2    -13.848  38.150 108.431  1.00 67.55          O
ANISOU 6500  OE2 GLU D   2   10091   7778   7798  -2614  -2399   -132      O
ATOM   6501  C   GLU D   2    -12.214  34.099 110.729  1.00 64.72          C
ANISOU 6501  C   GLU D   2    8290   8854   7447  -2295  -2041    390      C
ATOM   6502  O   GLU D   2    -12.033  33.874 109.536  1.00 63.59          O
ANISOU 6502  O   GLU D   2    8051   8657   7452  -2289  -1914    511      O
ATOM   6504  N   ASP D   3    -11.224  34.063 111.622  1.00 68.75          N
ANISOU 6504  N   ASP D   3    8604   9694   7823  -2479  -2184    489      N
ATOM   6505  CA  ASP D   3     -9.843  33.793 111.222  1.00 70.68          C
ANISOU 6505  CA  ASP D   3    8473  10294   8089  -2683  -2203    744      C
ATOM   6507  CB  ASP D   3     -8.874  34.476 112.185  1.00 76.54          C
ANISOU 6507  CB  ASP D   3    9139  11317   8627  -3051  -2475    736      C
ATOM   6510  CG  ASP D   3     -9.291  35.901 112.494  1.00 79.37          C
ANISOU 6510  CG  ASP D   3    9968  11312   8877  -3351  -2687    473      C
```

FIG. 18 (continued)

| | | | | | | | | | | | | | |
|---|---|---|---|---|---|---|---|---|---|---|---|---|---|
| ATOM | 6511 | OD1 | ASP | D | 3 | -8.753 | 36.834 | 111.855 | 1.00 | 81.17 | | | O |
| ANISOU | 6511 | OD1 | ASP | D | 3 | 10318 | 11418 | 9103 | -3755 | -2796 | 476 | | O |
| ATOM | 6512 | OD2 | ASP | D | 3 | -10.203 | 36.066 | 113.340 | 1.00 | 79.98 | | | O |
| ANISOU | 6512 | OD2 | ASP | D | 3 | 10321 | 11206 | 8861 | -3167 | -2728 | 260 | | O |
| ATOM | 6513 | C | ASP | D | 3 | -9.569 | 32.292 | 111.127 | 1.00 | 67.86 | | | C |
| ANISOU | 6513 | C | ASP | D | 3 | 7756 | 10225 | 7803 | -2336 | -1990 | 968 | | C |
| ATOM | 6514 | O | ASP | D | 3 | -8.827 | 31.843 | 110.248 | 1.00 | 67.73 | | | O |
| ANISOU | 6514 | O | ASP | D | 3 | 7461 | 10391 | 7883 | -2330 | -1883 | 1161 | | O |
| ATOM | 6516 | N | PHE | D | 4 | -10.168 | 31.528 | 112.035 | 1.00 | 65.16 | | | N |
| ANISOU | 6516 | N | PHE | D | 4 | 7451 | 9914 | 7392 | -2046 | -1922 | 941 | | N |
| ATOM | 6517 | CA | PHE | D | 4 | -10.170 | 30.072 | 111.947 | 1.00 | 63.44 | | | C |
| ANISOU | 6517 | CA | PHE | D | 4 | 7044 | 9827 | 7232 | -1681 | -1696 | 1129 | | C |
| ATOM | 6519 | CB | PHE | D | 4 | -10.997 | 29.479 | 113.100 | 1.00 | 63.78 | | | C |
| ANISOU | 6519 | CB | PHE | D | 4 | 7247 | 9838 | 7148 | -1460 | -1647 | 1059 | | C |
| ATOM | 6522 | CG | PHE | D | 4 | -11.434 | 28.066 | 112.859 | 1.00 | 62.34 | | | C |
| ANISOU | 6522 | CG | PHE | D | 4 | 7053 | 9595 | 7037 | -1118 | -1372 | 1190 | | C |
| ATOM | 6523 | CD1 | PHE | D | 4 | -10.546 | 27.015 | 113.024 | 1.00 | 64.02 | | | C |
| ANISOU | 6523 | CD1 | PHE | D | 4 | 7045 | 10071 | 7210 | -901 | -1314 | 1459 | | C |
| ATOM | 6525 | CE1 | PHE | D | 4 | -10.941 | 25.706 | 112.785 | 1.00 | 63.18 | | | C |
| ANISOU | 6525 | CE1 | PHE | D | 4 | 7016 | 9836 | 7153 | -593 | -1058 | 1578 | | C |
| ATOM | 6527 | CZ | PHE | D | 4 | -12.232 | 25.444 | 112.379 | 1.00 | 60.76 | | | C |
| ANISOU | 6527 | CZ | PHE | D | 4 | 6963 | 9187 | 6938 | -563 | -859 | 1420 | | C |
| ATOM | 6529 | CE2 | PHE | D | 4 | -13.130 | 26.494 | 112.210 | 1.00 | 58.86 | | | C |
| ANISOU | 6529 | CE2 | PHE | D | 4 | 6867 | 8761 | 6735 | -769 | -921 | 1147 | | C |
| ATOM | 6531 | CD2 | PHE | D | 4 | -12.729 | 27.789 | 112.449 | 1.00 | 59.54 | | | C |
| ANISOU | 6531 | CD2 | PHE | D | 4 | 6923 | 8928 | 6772 | -1012 | -1176 | 1038 | | C |
| ATOM | 6533 | C | PHE | D | 4 | -10.747 | 29.602 | 110.598 | 1.00 | 58.78 | | | C |
| ANISOU | 6533 | C | PHE | D | 4 | 6505 | 8976 | 6854 | -1523 | -1449 | 1138 | | C |
| ATOM | 6534 | O | PHE | D | 4 | -10.168 | 28.753 | 109.912 | 1.00 | 56.52 | | | O |
| ANISOU | 6534 | O | PHE | D | 4 | 5998 | 8825 | 6654 | -1364 | -1299 | 1331 | | O |
| ATOM | 6536 | N | VAL | D | 5 | -11.895 | 30.164 | 110.233 | 1.00 | 56.50 | | | N |
| ANISOU | 6536 | N | VAL | D | 5 | 6509 | 8334 | 6625 | -1542 | -1417 | 915 | | N |
| ATOM | 6537 | CA | VAL | D | 5 | -12.548 | 29.850 | 108.957 | 1.00 | 53.12 | | | C |
| ANISOU | 6537 | CA | VAL | D | 5 | 6147 | 7668 | 6368 | -1419 | -1215 | 885 | | C |
| ATOM | 6539 | CB | VAL | D | 5 | -13.901 | 30.629 | 108.810 | 1.00 | 51.27 | | | C |
| ANISOU | 6539 | CB | VAL | D | 5 | 6234 | 7107 | 6139 | -1413 | -1239 | 600 | | C |
| ATOM | 6541 | CG1 | VAL | D | 5 | -14.499 | 30.541 | 107.370 | 1.00 | 47.90 | | | C |
| ANISOU | 6541 | CG1 | VAL | D | 5 | 5869 | 6466 | 5866 | -1329 | -1085 | 560 | | C |
| ATOM | 6545 | CG2 | VAL | D | 5 | -14.911 | 30.090 | 109.813 | 1.00 | 49.08 | | | C |
| ANISOU | 6545 | CG2 | VAL | D | 5 | 6052 | 6831 | 5763 | -1228 | -1160 | 467 | | C |
| ATOM | 6549 | C | VAL | D | 5 | -11.564 | 30.095 | 107.807 | 1.00 | 54.47 | | | C |
| ANISOU | 6549 | C | VAL | D | 5 | 6139 | 7923 | 6635 | -1571 | -1211 | 1039 | | C |
| ATOM | 6550 | O | VAL | D | 5 | -11.373 | 29.236 | 106.935 | 1.00 | 51.43 | | | O |
| ANISOU | 6550 | O | VAL | D | 5 | 5610 | 7575 | 6355 | -1405 | -1012 | 1167 | | O |
| ATOM | 6552 | N | ARG | D | 6 | -10.861 | 31.223 | 107.863 | 1.00 | 58.72 | | | N |
| ANISOU | 6552 | N | ARG | D | 6 | 6683 | 8521 | 7108 | -1908 | -1426 | 1032 | | N |
| ATOM | 6553 | CA | ARG | D | 6 | -9.903 | 31.574 | 106.817 | 1.00 | 60.47 | | | C |
| ANISOU | 6553 | CA | ARG | D | 6 | 6733 | 8862 | 7381 | -2134 | -1425 | 1176 | | C |
| ATOM | 6555 | CB | ARG | D | 6 | -9.534 | 33.035 | 106.951 | 1.00 | 64.29 | | | C |
| ANISOU | 6555 | CB | ARG | D | 6 | 7398 | 9261 | 7768 | -2577 | -1672 | 1094 | | C |
| ATOM | 6558 | CG | ARG | D | 6 | -10.709 | 33.907 | 106.606 | 1.00 | 64.55 | | | C |
| ANISOU | 6558 | CG | ARG | D | 6 | 7898 | 8803 | 7825 | -2576 | -1718 | 870 | | C |
| ATOM | 6561 | CD | ARG | D | 6 | -10.603 | 35.302 | 107.167 | 1.00 | 68.18 | | | C |
| ANISOU | 6561 | CD | ARG | D | 6 | 8682 | 9078 | 8146 | -2929 | -1987 | 728 | | C |
| ATOM | 6564 | NE | ARG | D | 6 | -11.926 | 35.914 | 107.155 | 1.00 | 67.47 | | | N |
| ANISOU | 6564 | NE | ARG | D | 6 | 9041 | 8544 | 8051 | -2744 | -2026 | 480 | | N |
| ATOM | 6566 | CZ | ARG | D | 6 | -12.517 | 36.420 | 106.076 | 1.00 | 66.79 | | | C |
| ANISOU | 6566 | CZ | ARG | D | 6 | 9226 | 8124 | 8027 | -2696 | -1990 | 428 | | C |
| ATOM | 6567 | NH1 | ARG | D | 6 | -11.911 | 36.419 | 104.884 | 1.00 | 67.00 | | | N |
| ANISOU | 6567 | NH1 | ARG | D | 6 | 9152 | 8178 | 8126 | -2863 | -1905 | 611 | | N |
| ATOM | 6570 | NH2 | ARG | D | 6 | -13.729 | 36.936 | 106.195 | 1.00 | 66.16 | | | N |
| ANISOU | 6570 | NH2 | ARG | D | 6 | 9515 | 7712 | 7913 | -2456 | -2041 | 189 | | N |
| ATOM | 6573 | C | ARG | D | 6 | -8.651 | 30.700 | 106.813 | 1.00 | 62.21 | | | C |
| ANISOU | 6573 | C | ARG | D | 6 | 6504 | 9551 | 7583 | -2060 | -1355 | 1425 | | C |
| ATOM | 6574 | O | ARG | D | 6 | -8.162 | 30.303 | 105.753 | 1.00 | 62.78 | | | O |
| ANISOU | 6574 | O | ARG | D | 6 | 6383 | 9735 | 7736 | -2011 | -1203 | 1556 | | O |
| ATOM | 6576 | N | GLN | D | 7 | -8.142 | 30.400 | 108.000 | 1.00 | 63.08 | | | N |
| ANISOU | 6576 | N | GLN | D | 7 | 6447 | 9957 | 7564 | -2017 | -1470 | 1484 | | N |
| ATOM | 6577 | CA | GLN | D | 7 | -6.952 | 29.566 | 108.142 | 1.00 | 64.69 | | | C |
| ANISOU | 6577 | CA | GLN | D | 7 | 6212 | 10657 | 7711 | -1870 | -1436 | 1716 | | C |
| ATOM | 6579 | CB | GLN | D | 7 | -6.422 | 29.640 | 109.592 | 1.00 | 67.69 | | | C |
| ANISOU | 6579 | CB | GLN | D | 7 | 6462 | 11364 | 7894 | -1922 | -1656 | 1742 | | C |
| ATOM | 6582 | CG | GLN | D | 7 | -5.768 | 31.002 | 109.923 | 1.00 | 71.35 | | | C |
| ANISOU | 6582 | CG | GLN | D | 7 | 6887 | 11992 | 8229 | -2468 | -1933 | 1665 | | C |
| ATOM | 6585 | CD | GLN | D | 7 | -5.131 | 31.085 | 111.328 | 1.00 | 74.57 | | | C |
| ANISOU | 6585 | CD | GLN | D | 7 | 7122 | 12800 | 8411 | -2552 | -2172 | 1685 | | C |
| ATOM | 6586 | OE1 | GLN | D | 7 | -5.780 | 30.821 | 112.343 | 1.00 | 73.57 | | | O |
| ANISOU | 6586 | OE1 | GLN | D | 7 | 7200 | 12552 | 8203 | -2362 | -2214 | 1604 | | O |
| ATOM | 6587 | NE2 | GLN | D | 7 | -3.863 | 31.479 | 111.376 | 1.00 | 78.24 | | | N |

FIG. 18 (continued)

```
ANISOU 6587  NE2 GLN D   7     7197  13779   8750  -2867  -2329   1786        N
ATOM   6590  C   GLN D   7      -7.170  28.103 107.727  1.00 62.88           C
ANISOU 6590  C   GLN D   7     5918  10400   7574  -1377  -1166   1835        C
ATOM   6591  O   GLN D   7      -6.220  27.448 107.306  1.00 65.16           O
ANISOU 6591  O   GLN D   7     5872  11031   7856  -1205  -1079   2020        O
ATOM   6593  N   CYS D   8      -8.408  27.599 107.805  1.00 58.66           N
ANISOU 6593  N   CYS D   8     5709   9472   7110  -1160  -1027   1719        N
ATOM   6594  CA ACYS D   8      -8.652  26.166 107.652  0.50 56.58           C
ANISOU 6594  CA ACYS D   8     5465   9142   6890   -736   -788   1821        C
ATOM   6595  CA BCYS D   8      -8.664  26.162 107.654  0.50 57.50           C
ANISOU 6595  CA BCYS D   8     5585   9255   7008   -735   -787   1820        C
ATOM   6598  CB ACYS D   8      -9.117  25.592 108.992  0.50 57.64           C
ANISOU 6598  CB ACYS D   8     5755   9246   6900   -563   -817   1821        C
ATOM   6599  CB BCYS D   8      -9.230  25.605 108.950  0.50 58.69           C
ANISOU 6599  CB BCYS D   8     5916   9342   7043   -568   -806   1804        C
ATOM   6604  SG ACYS D   8      -7.832  25.731 110.300  0.50 61.79           S
ANISOU 6604  SG ACYS D   8     5973  10305   7200   -576  -1080   1987        S
ATOM   6605  SG BCYS D   8     -10.983  25.836 109.083  0.50 57.39           S
ANISOU 6605  SG BCYS D   8     6165   8715   6924   -641   -726   1534        S
ATOM   6608  C   CYS D   8      -9.606  25.771 106.521  1.00 52.98           C
ANISOU 6608  C   CYS D   8     5227   8310   6592   -635   -554   1721        C
ATOM   6609  O   CYS D   8      -9.687  24.593 106.179  1.00 51.17           O
ANISOU 6609  O   CYS D   8     5029   8011   6401   -327   -341   1804        O
ATOM   6611  N   PHE D   9     -10.333  26.731 105.946  1.00 48.58           N
ANISOU 6611  N   PHE D   9     4848   7505   6105   -878   -598   1539        N
ATOM   6612  CA  PHE D   9     -11.104  26.453 104.740  1.00 44.56           C
ANISOU 6612  CA  PHE D   9     4486   6721   5723   -803   -404   1450        C
ATOM   6614  CB  PHE D   9     -12.542  26.994 104.865  1.00 41.70           C
ANISOU 6614  CB  PHE D   9     4431   6039   5376   -880   -433   1198        C
ATOM   6617  CG  PHE D   9     -13.400  26.176 105.773  1.00 41.20           C
ANISOU 6617  CG  PHE D   9     4507   5889   5258   -713   -340   1129        C
ATOM   6618  CD1 PHE D   9     -13.910  24.964 105.341  1.00 38.60           C
ANISOU 6618  CD1 PHE D   9     4255   5433   4977   -517    -93   1141        C
ATOM   6620  CE1 PHE D   9     -14.679  24.188 106.173  1.00 39.08           C
ANISOU 6620  CE1 PHE D   9     4470   5414   4963   -427      9   1094        C
ATOM   6622  CZ  PHE D   9     -14.930  24.596 107.477  1.00 39.46           C
ANISOU 6622  CZ  PHE D   9     4568   5542   4882   -496   -131   1040        C
ATOM   6624  CE2 PHE D   9     -14.438  25.780 107.933  1.00 41.44           C
ANISOU 6624  CE2 PHE D   9     4739   5921   5084   -651   -381   1011        C
ATOM   6626  CD2 PHE D   9     -13.654  26.583 107.078  1.00 42.05           C
ANISOU 6626  CD2 PHE D   9     4686   6048   5241   -778   -491   1057        C
ATOM   6628  C   PHE D   9     -10.406  27.034 103.508  1.00 43.83           C
ANISOU 6628  C   PHE D   9     4248   6718   5687   -967   -401   1513        C
ATOM   6629  O   PHE D   9      -9.859  28.130 103.561  1.00 41.92           O
ANISOU 6629  O   PHE D   9     3945   6586   5398  -1271   -587   1522        O
ATOM   6631  N   ASN D  10     -10.468  26.299 102.395  1.00 44.09           N
ANISOU 6631  N   ASN D  10     4263   6688   5801   -792   -181   1548        N
ATOM   6632  CA  ASN D  10      -9.848  26.735 101.144  1.00 45.16           C
ANISOU 6632  CA  ASN D  10     4265   6925   5967   -928   -137   1614        C
ATOM   6634  CB  ASN D  10      -9.787  25.589 100.075  1.00 45.92           C
ANISOU 6634  CB  ASN D  10     4315   7010   6122   -637    139   1664        C
ATOM   6637  CG  ASN D  10     -10.790  25.723  98.914  1.00 43.77           C
ANISOU 6637  CG  ASN D  10     4281   6432   5916   -670    246   1510        C
ATOM   6638  OD1 ASN D  10     -10.938  26.772  98.303  1.00 45.18           O
ANISOU 6638  OD1 ASN D  10     4535   6540   6090   -917    148   1463        O
ATOM   6639  ND2 ASN D  10     -11.424  24.615  98.571  1.00 45.26           N
ANISOU 6639  ND2 ASN D  10     4603   6448   6145   -418    449   1442        N
ATOM   6642  C   ASN D  10     -10.471  28.049 100.647  1.00 44.01           C
ANISOU 6642  C   ASN D  10     4349   6540   5832  -1232   -272   1475        C
ATOM   6643  O   ASN D  10     -11.633  28.343 100.956  1.00 42.16           O
ANISOU 6643  O   ASN D  10     4389   6018   5611  -1217   -326   1291        O
ATOM   6645  N   PRO D  11      -9.671  28.861  99.935  1.00 45.50           N
ANISOU 6645  N   PRO D  11     4431   6869   5988  -1508   -331   1569        N
ATOM   6646  CA  PRO D  11     -10.049  30.207  99.500  1.00 45.84           C
ANISOU 6646  CA  PRO D  11     4741   6673   6003  -1822   -484   1483        C
ATOM   6648  CB  PRO D  11      -8.858  30.641  98.626  1.00 48.03           C
ANISOU 6648  CB  PRO D  11     4802   7221   6225  -2103   -458   1663        C
ATOM   6651  CG  PRO D  11      -7.730  29.867  99.137  1.00 49.84           C
ANISOU 6651  CG  PRO D  11     4598   7916   6422  -2007   -402   1818        C
ATOM   6654  CD  PRO D  11      -8.278  28.546  99.548  1.00 47.27           C
ANISOU 6654  CD  PRO D  11     4265   7527   6169  -1541   -255   1775        C
ATOM   6657  C   PRO D  11     -11.344  30.308  98.715  1.00 42.29           C
ANISOU 6657  C   PRO D  11     4609   5854   5605  -1689   -423   1317        C
ATOM   6658  O   PRO D  11     -12.100  31.250  98.930  1.00 41.78           O
ANISOU 6658  O   PRO D  11     4847   5517   5509  -1784   -587   1175        O
ATOM   6659  N   MET D  12     -11.564  29.350  97.815  1.00 41.26           N
ANISOU 6659  N   MET D  12     4408   5736   5533  -1456   -196   1328        N
ATOM   6660  CA  MET D  12     -12.766  29.282  97.002  1.00 40.67           C
ANISOU 6660  CA  MET D  12     4573   5392   5489  -1318   -125   1167        C
```

FIG. 18 (continued)

```
ATOM   6662  CB  MET D  12     -12.709  28.116  95.999  1.00 43.61          C
ANISOU 6662  CB  MET D  12     4827   5842   5903  -1106    138   1202      C
ATOM   6665  CG  MET D  12     -11.553  28.141  95.021  1.00 48.73          C
ANISOU 6665  CG  MET D  12     5275   6725   6514  -1207    239   1386      C
ATOM   6668  SD  MET D  12     -11.395  29.694  94.107  1.00 55.34          S
ANISOU 6668  SD  MET D  12     6297   7470   7261  -1571     91   1438      S
ATOM   6669  CE  MET D  12     -12.963  29.784  93.227  1.00 50.82          C
ANISOU 6669  CE  MET D  12     6070   6552   6689  -1398    102   1227      C
ATOM   6673  C   MET D  12     -14.020  29.089  97.845  1.00 35.73          C
ANISOU 6673  C   MET D  12     4116   4579   4879  -1156   -171    959      C
ATOM   6674  O   MET D  12     -15.031  29.719  97.567  1.00 32.07          O
ANISOU 6674  O   MET D  12     3883   3909   4391  -1138   -257    794      O
ATOM   6676  N   ILE D  13     -13.940  28.203  98.839  1.00 34.49          N
ANISOU 6676  N   ILE D  13     3839   4526   4740  -1024   -107    975      N
ATOM   6677  CA  ILE D  13     -15.038  27.944  99.780  1.00 33.57          C
ANISOU 6677  CA  ILE D  13     3849   4298   4609   -910   -126    797      C
ATOM   6679  CB  ILE D  13     -14.717  26.697 100.676  1.00 34.38          C
ANISOU 6679  CB  ILE D  13     3825   4524   4712   -761      4    888      C
ATOM   6681  CG1 ILE D  13     -14.704  25.440  99.803  1.00 35.18          C
ANISOU 6681  CG1 ILE D  13     3893   4607   4866   -585    263    933      C
ATOM   6684  CD1 ILE D  13     -14.268  24.157 100.551  1.00 36.25          C
ANISOU 6684  CD1 ILE D  13     3979   4808   4985   -396    402   1059      C
ATOM   6688  CG2 ILE D  13     -15.714  26.513 101.846  1.00 32.57          C
ANISOU 6688  CG2 ILE D  13     3716   4229   4429   -712    -23    735      C
ATOM   6692  C   ILE D  13     -15.342  29.219 100.602  1.00 34.17          C
ANISOU 6692  C   ILE D  13     4081   4287   4615  -1049   -381    688      C
ATOM   6693  O   ILE D  13     -16.502  29.616 100.695  1.00 33.02          O
ANISOU 6693  O   ILE D  13     4113   3994   4437   -974   -436    479      O
ATOM   6695  N   VAL D  14     -14.315  29.885 101.144  1.00 35.18          N
ANISOU 6695  N   VAL D  14     4145   4521   4700  -1247   -538    812      N
ATOM   6696  CA  VAL D  14     -14.520  31.094 101.968  1.00 36.85          C
ANISOU 6696  CA  VAL D  14     4558   4618   4824  -1398   -785    698      C
ATOM   6698  CB  VAL D  14     -13.188  31.657 102.554  1.00 40.82          C
ANISOU 6698  CB  VAL D  14     4943   5302   5266  -1685   -942    855      C
ATOM   6700  CG1 VAL D  14     -13.407  33.018 103.239  1.00 41.60          C
ANISOU 6700  CG1 VAL D  14     5339   5208   5258  -1883  -1205    712      C
ATOM   6704  CG2 VAL D  14     -12.590  30.655 103.554  1.00 42.40          C
ANISOU 6704  CG2 VAL D  14     4867   5796   5449  -1582   -883    969      C
ATOM   6708  C   VAL D  14     -15.221  32.160 101.147  1.00 38.75          C
ANISOU 6708  C   VAL D  14     5097   4583   5043  -1431   -888    567      C
ATOM   6709  O   VAL D  14     -16.195  32.778 101.588  1.00 40.22          O
ANISOU 6709  O   VAL D  14     5517   4595   5168  -1330  -1005    359      O
ATOM   6711  N   GLU D  15     -14.740  32.340  99.925  1.00 39.91          N
ANISOU 6711  N   GLU D  15     5238   4708   5218  -1536   -836    692      N
ATOM   6712  CA  GLU D  15     -15.279  33.339  99.024  1.00 40.91          C
ANISOU 6712  CA  GLU D  15     5677   4567   5298  -1563   -935    619      C
ATOM   6714  CB  GLU D  15     -14.379  33.386  97.797  1.00 42.96          C
ANISOU 6714  CB  GLU D  15     5860   4896   5568  -1753   -849    828      C
ATOM   6717  CG  GLU D  15     -14.630  34.477  96.821  1.00 44.81          C
ANISOU 6717  CG  GLU D  15     6444   4861   5722  -1854   -957    829      C
ATOM   6720  CD  GLU D  15     -13.657  34.369  95.682  1.00 46.56          C
ANISOU 6720  CD  GLU D  15     6531   5226   5932  -2068   -831   1053      C
ATOM   6721  OE1 GLU D  15     -12.448  34.620  95.909  1.00 47.83          O
ANISOU 6721  OE1 GLU D  15     6542   5568   6062  -2402   -854   1224      O
ATOM   6722  OE2 GLU D  15     -14.103  34.005  94.574  1.00 47.99          O
ANISOU 6722  OE2 GLU D  15     6729   5386   6118  -1907   -704   1048      O
ATOM   6723  C   GLU D  15     -16.723  33.038  98.652  1.00 38.44          C
ANISOU 6723  C   GLU D  15     5467   4146   4993  -1240   -873    407      C
ATOM   6724  O   GLU D  15     -17.543  33.950  98.609  1.00 40.00          O
ANISOU 6724  O   GLU D  15     5958   4127   5112  -1140  -1028    247      O
ATOM   6726  N   LEU D  16     -17.041  31.768  98.381  1.00 35.74          N
ANISOU 6726  N   LEU D  16     4893   3962   4723  -1075   -652    395      N
ATOM   6727  CA  LEU D  16     -18.424  31.357  98.148  1.00 34.36          C
ANISOU 6727  CA  LEU D  16     4752   3766   4537   -825   -582    175      C
ATOM   6729  CB  LEU D  16     -18.532  29.901  97.715  1.00 32.39          C
ANISOU 6729  CB  LEU D  16     4282   3665   4358   -743   -320    198      C
ATOM   6732  CG  LEU D  16     -17.979  29.560  96.334  1.00 34.99          C
ANISOU 6732  CG  LEU D  16     4560   4013   4721   -778   -192    333      C
ATOM   6734  CD1 LEU D  16     -17.748  28.047  96.236  1.00 33.02          C
ANISOU 6734  CD1 LEU D  16     4122   3886   4537   -709     66    385      C
ATOM   6738  CD2 LEU D  16     -18.910  30.084  95.209  1.00 34.00          C
ANISOU 6738  CD2 LEU D  16     4599   3791   4529   -679   -244    198      C
ATOM   6742  C   LEU D  16     -19.321  31.585  99.357  1.00 34.08          C
ANISOU 6742  C   LEU D  16     4779   3732   4440   -704   -677    -37      C
ATOM   6743  O   LEU D  16     -20.462  32.031  99.191  1.00 32.95          O
ANISOU 6743  O   LEU D  16     4759   3536   4224   -518   -747   -250      O
ATOM   6745  N   ALA D  17     -18.833  31.251 100.553  1.00 33.79          N
ANISOU 6745  N   ALA D  17     4636   3794   4407   -781   -674     16      N
ATOM   6746  CA  ALA D  17     -19.585  31.508 101.780  1.00 35.91          C
```

FIG. 18 (continued)

| | | | | | | | | | | | | | |
|---|---|---|---|---|---|---|---|---|---|---|---|---|---|
| ANISOU | 6746 | CA | ALA | D | 17 | 4966 | 4090 | 4587 | -688 | -759 | -176 | | C |
| ATOM | 6748 | CB | ALA | D | 17 | -18.893 | 30.878 | 102.997 | 1.00 | 35.27 | | | C |
| ANISOU | 6748 | CB | ALA | D | 17 | 4739 | 4159 | 4503 | -785 | -718 | -63 | | C |
| ATOM | 6752 | C | ALA | D | 17 | -19.814 | 33.002 | 102.005 | 1.00 | 38.49 | | | C |
| ANISOU | 6752 | C | ALA | D | 17 | 5592 | 4217 | 4814 | -671 | -1017 | -303 | | C |
| ATOM | 6753 | O | ALA | D | 17 | -20.942 | 33.407 | 102.254 | 1.00 | 37.06 | | | O |
| ANISOU | 6753 | O | ALA | D | 17 | 5521 | 4018 | 4543 | -453 | -1079 | -544 | | O |
| ATOM | 6755 | N | GLU | D | 18 | -18.740 | 33.801 | 101.913 | 1.00 | 44.31 | | | N |
| ANISOU | 6755 | N | GLU | D | 18 | 6469 | 4819 | 5549 | -902 | -1162 | -146 | | N |
| ATOM | 6756 | CA | GLU | D | 18 | -18.781 | 35.280 | 102.039 | 1.00 | 46.87 | | | C |
| ANISOU | 6756 | CA | GLU | D | 18 | 7180 | 4863 | 5764 | -947 | -1416 | -236 | | C |
| ATOM | 6758 | CB | GLU | D | 18 | -17.387 | 35.880 | 101.846 | 1.00 | 50.13 | | | C |
| ANISOU | 6758 | CB | GLU | D | 18 | 7678 | 5188 | 6181 | -1332 | -1518 | -9 | | C |
| ATOM | 6761 | CG | GLU | D | 18 | -16.429 | 35.683 | 102.995 | 1.00 | 52.03 | | | C |
| ANISOU | 6761 | CG | GLU | D | 18 | 7747 | 5616 | 6406 | -1569 | -1560 | 82 | | C |
| ATOM | 6764 | CD | GLU | D | 18 | -15.194 | 36.554 | 102.863 | 1.00 | 54.42 | | | C |
| ANISOU | 6764 | CD | GLU | D | 18 | 8174 | 5842 | 6660 | -1993 | -1709 | 246 | | C |
| ATOM | 6765 | OE1 | GLU | D | 18 | -14.510 | 36.510 | 101.806 | 1.00 | 55.08 | | | O |
| ANISOU | 6765 | OE1 | GLU | D | 18 | 8176 | 5959 | 6793 | -2175 | -1635 | 441 | | O |
| ATOM | 6766 | OE2 | GLU | D | 18 | -14.913 | 37.289 | 103.826 | 1.00 | 58.31 | | | O |
| ANISOU | 6766 | OE2 | GLU | D | 18 | 8848 | 6260 | 7045 | -2169 | -1897 | 169 | | O |
| ATOM | 6767 | C | GLU | D | 18 | -19.668 | 35.963 | 101.009 | 1.00 | 51.16 | | | C |
| ANISOU | 6767 | C | GLU | D | 18 | 7989 | 5192 | 6257 | -727 | -1484 | -354 | | C |
| ATOM | 6768 | O | GLU | D | 18 | -20.261 | 37.001 | 101.291 | 1.00 | 53.25 | | | O |
| ANISOU | 6768 | O | GLU | D | 18 | 8594 | 5236 | 6401 | -571 | -1671 | -531 | | O |
| ATOM | 6770 | N | LYS | D | 19 | -19.664 | 35.418 | 99.795 | 1.00 | 53.24 | | | N |
| ANISOU | 6770 | N | LYS | D | 19 | 8124 | 5512 | 6594 | -707 | -1344 | -246 | | N |
| ATOM | 6771 | CA | LYS | D | 19 | -20.532 | 35.841 | 98.690 | 1.00 | 55.48 | | | C |
| ANISOU | 6771 | CA | LYS | D | 19 | 8593 | 5669 | 6819 | -469 | -1384 | -339 | | C |
| ATOM | 6773 | CB | LYS | D | 19 | -20.126 | 35.080 | 97.412 | 1.00 | 54.75 | | | C |
| ANISOU | 6773 | CB | LYS | D | 19 | 8309 | 5683 | 6810 | -561 | -1203 | -159 | | C |
| ATOM | 6776 | CG | LYS | D | 19 | -21.051 | 35.181 | 96.183 | 1.00 | 55.78 | | | C |
| ANISOU | 6776 | CG | LYS | D | 19 | 8532 | 5787 | 6876 | -310 | -1202 | -249 | | C |
| ATOM | 6779 | CD | LYS | D | 19 | -20.713 | 34.035 | 95.171 | 1.00 | 54.99 | | | C |
| ANISOU | 6779 | CD | LYS | D | 19 | 8148 | 5883 | 6864 | -398 | -962 | -120 | | C |
| ATOM | 6782 | CE | LYS | D | 19 | -21.906 | 33.635 | 94.269 | 1.00 | 55.12 | | | C |
| ANISOU | 6782 | CE | LYS | D | 19 | 8098 | 6025 | 6819 | -127 | -908 | -294 | | C |
| ATOM | 6785 | NZ | LYS | D | 19 | -21.870 | 32.185 | 93.817 | 1.00 | 53.48 | | | N |
| ANISOU | 6785 | NZ | LYS | D | 19 | 7565 | 6054 | 6699 | -187 | -643 | -280 | | N |
| ATOM | 6789 | C | LYS | D | 19 | -21.984 | 35.553 | 99.044 | 1.00 | 54.85 | | | C |
| ANISOU | 6789 | C | LYS | D | 19 | 8415 | 5747 | 6677 | -99 | -1362 | -629 | | C |
| ATOM | 6790 | O | LYS | D | 19 | -22.831 | 36.438 | 98.962 | 1.00 | 57.01 | | | O |
| ANISOU | 6790 | O | LYS | D | 19 | 8949 | 5889 | 6825 | 180 | -1525 | -811 | | O |
| ATOM | 6792 | N | ALA | D | 20 | -22.259 | 34.309 | 99.425 | 1.00 | 53.07 | | | N |
| ANISOU | 6792 | N | ALA | D | 20 | 7826 | 5817 | 6523 | -98 | -1155 | -669 | | N |
| ATOM | 6793 | CA | ALA | D | 20 | -23.591 | 33.875 | 99.844 | 1.00 | 53.78 | | | C |
| ANISOU | 6793 | CA | ALA | D | 20 | 7749 | 6145 | 6541 | 160 | -1090 | -938 | | C |
| ATOM | 6795 | CB | ALA | D | 20 | -23.559 | 32.419 | 100.202 | 1.00 | 50.70 | | | C |
| ANISOU | 6795 | CB | ALA | D | 20 | 7020 | 6010 | 6235 | 23 | -837 | -897 | | C |
| ATOM | 6799 | C | ALA | D | 20 | -24.184 | 34.676 | 101.017 | 1.00 | 57.66 | | | C |
| ANISOU | 6799 | C | ALA | D | 20 | 8387 | 6624 | 6900 | 344 | -1247 | -1158 | | C |
| ATOM | 6800 | O | ALA | D | 20 | -25.393 | 34.824 | 101.109 | 1.00 | 61.06 | | | O |
| ANISOU | 6800 | O | ALA | D | 20 | 8766 | 7220 | 7212 | 643 | -1269 | -1415 | | O |
| ATOM | 6802 | N | MET | D | 21 | -23.341 | 35.185 | 101.906 | 1.00 | 59.89 | | | N |
| ANISOU | 6802 | N | MET | D | 21 | 8831 | 6747 | 7178 | 171 | -1355 | -1074 | | N |
| ATOM | 6803 | CA | MET | D | 21 | -23.816 | 35.940 | 103.072 | 1.00 | 62.76 | | | C |
| ANISOU | 6803 | CA | MET | D | 21 | 9366 | 7084 | 7398 | 333 | -1500 | -1292 | | C |
| ATOM | 6805 | CB | MET | D | 21 | -22.819 | 35.818 | 104.222 | 1.00 | 62.20 | | | C |
| ANISOU | 6805 | CB | MET | D | 21 | 9279 | 7009 | 7345 | 45 | -1514 | -1172 | | C |
| ATOM | 6808 | CG | MET | D | 21 | -22.683 | 34.414 | 104.795 | 1.00 | 59.62 | | | C |
| ANISOU | 6808 | CG | MET | D | 21 | 8567 | 6998 | 7088 | -89 | -1281 | -1085 | | C |
| ATOM | 6811 | SD | MET | D | 21 | -21.871 | 34.468 | 106.398 | 1.00 | 59.54 | | | S |
| ANISOU | 6811 | SD | MET | D | 21 | 8574 | 7043 | 7006 | -290 | -1354 | -1032 | | S |
| ATOM | 6812 | CE | MET | D | 21 | -23.340 | 34.449 | 107.429 | 1.00 | 60.15 | | | C |
| ANISOU | 6812 | CE | MET | D | 21 | 8601 | 7357 | 6894 | 8 | -1310 | -1378 | | C |
| ATOM | 6816 | C | MET | D | 21 | -24.043 | 37.421 | 102.760 | 1.00 | 67.67 | | | C |
| ANISOU | 6816 | C | MET | D | 21 | 10455 | 7359 | 7896 | 542 | -1759 | -1399 | | C |
| ATOM | 6817 | O | MET | D | 21 | -24.955 | 38.042 | 103.311 | 1.00 | 70.72 | | | O |
| ANISOU | 6817 | O | MET | D | 21 | 10984 | 7759 | 8126 | 877 | -1866 | -1668 | | O |
| ATOM | 6819 | N | LYS | D | 22 | -23.195 | 37.993 | 101.901 | 1.00 | 69.68 | | | N |
| ANISOU | 6819 | N | LYS | D | 22 | 10976 | 7299 | 8199 | 347 | -1855 | -1188 | | N |
| ATOM | 6820 | CA | LYS | D | 22 | -23.376 | 39.371 | 101.435 | 1.00 | 72.94 | | | C |
| ANISOU | 6820 | CA | LYS | D | 22 | 11922 | 7311 | 8483 | 523 | -2094 | -1247 | | C |
| ATOM | 6822 | CB | LYS | D | 22 | -22.102 | 39.903 | 100.769 | 1.00 | 73.99 | | | C |
| ANISOU | 6822 | CB | LYS | D | 22 | 12334 | 7113 | 8665 | 112 | -2168 | -955 | | C |
| ATOM | 6825 | CG | LYS | D | 22 | -22.085 | 41.426 | 100.596 | 1.00 | 78.41 | | | C |
| ANISOU | 6825 | CG | LYS | D | 22 | 13572 | 7159 | 9063 | 180 | -2433 | -995 | | C |
| ATOM | 6828 | CD | LYS | D | 22 | -20.662 | 41.991 | 100.554 | 1.00 | 80.14 | | | C |
| ANISOU | 6828 | CD | LYS | D | 22 | 14059 | 7093 | 9297 | -388 | -2512 | -744 | | C |

FIG. 18 (continued)

```
ATOM   6831  CE   LYS D  22     -20.655  43.500 100.686  1.00 84.66          C
ANISOU 6831  CE   LYS D  22    15378   7108   9682   -375  -2780   -821      C
ATOM   6834  NZ   LYS D  22     -20.995  43.937 102.072  1.00 86.88          N
ANISOU 6834  NZ   LYS D  22    15826   7327   9858   -229  -2904  -1090      N
ATOM   6838  C    LYS D  22     -24.558  39.442 100.470  1.00 73.52          C
ANISOU 6838  C    LYS D  22    11994   7461   8481    964  -2102  -1389      C
ATOM   6839  O    LYS D  22     -25.188  40.493 100.337  1.00 78.15          O
ANISOU 6839  O    LYS D  22    12980   7808   8904   1322  -2300  -1544      O
ATOM   6841  N    GLU D  23     -24.855  38.325  99.814  1.00 70.77          N
ANISOU 6841  N    GLU D  23    11214   7447   8230    953  -1898  -1344      N
ATOM   6842  CA   GLU D  23     -26.030  38.204  98.932  1.00 72.29          C
ANISOU 6842  CA   GLU D  23    11294   7836   8338   1341  -1890  -1500      C
ATOM   6844  CB   GLU D  23     -26.023  36.848  98.213  1.00 70.14          C
ANISOU 6844  CB   GLU D  23    10569   7888   8195   1157  -1642  -1402      C
ATOM   6847  CG   GLU D  23     -26.673  36.814  96.833  1.00 71.98          C
ANISOU 6847  CG   GLU D  23    10779   8209   8363   1377  -1655  -1426      C
ATOM   6850  CD   GLU D  23     -26.251  35.580  96.003  1.00 70.58          C
ANISOU 6850  CD   GLU D  23    10283   8212   8323   1085  -1419  -1265      C
ATOM   6851  OE1  GLU D  23     -27.135  34.861  95.489  1.00 72.46          O
ANISOU 6851  OE1  GLU D  23    10229   8781   8520   1209  -1316  -1412      O
ATOM   6852  OE2  GLU D  23     -25.030  35.320  95.855  1.00 71.61          O
ANISOU 6852  OE2  GLU D  23    10450   8173   8584    732  -1335  -1002      O
ATOM   6853  C    GLU D  23     -27.343  38.343  99.699  1.00 72.16          C
ANISOU 6853  C    GLU D  23    11151   8099   8166   1774  -1930  -1851      C
ATOM   6854  O    GLU D  23     -28.294  38.935  99.186  1.00 74.37          O
ANISOU 6854  O    GLU D  23    11551   8418   8290   2221  -2062  -2026      O
ATOM   6856  N    TYR D  24     -27.379  37.810 100.924  1.00 70.25          N
ANISOU 6856  N    TYR D  24    10665   8082   7944   1657  -1819  -1948      N
ATOM   6857  CA   TYR D  24     -28.629  37.653 101.700  1.00 70.67          C
ANISOU 6857  CA   TYR D  24    10463   8542   7848   1992  -1779  -2278      C
ATOM   6859  CB   TYR D  24     -28.961  36.153 101.831  1.00 67.72          C
ANISOU 6859  CB   TYR D  24     9539   8637   7555   1759  -1491  -2286      C
ATOM   6862  CG   TYR D  24     -28.866  35.375 100.518  1.00 63.37          C
ANISOU 6862  CG   TYR D  24     8806   8154   7118   1603  -1370  -2134      C
ATOM   6869  C    TYR D  24     -28.599  38.351 103.081  1.00 72.88          C
ANISOU 6869  C    TYR D  24    10957   8722   8011   2090  -1886  -2434      C
ATOM   6870  O    TYR D  24     -29.258  37.926 104.048  1.00 73.90          O
ANISOU 6870  O    TYR D  24    10803   9225   8049   2176  -1778  -2639      O
ATOM   6872  N    GLY D  25     -27.831  39.436 103.161  1.00 74.30          N
ANISOU 6872  N    GLY D  25    11662   8397   8173   2050  -2096  -2342      N
ATOM   6873  CA   GLY D  25     -27.836  40.314 104.325  1.00 75.78          C
ANISOU 6873  CA   GLY D  25    12173   8409   8213   2189  -2246  -2522      C
ATOM   6876  C    GLY D  25     -27.374  39.710 105.638  1.00 74.02          C
ANISOU 6876  C    GLY D  25    11729   8378   8018   1875  -2126  -2516      C
ATOM   6877  O    GLY D  25     -27.685  40.248 106.712  1.00 77.23          O
ANISOU 6877  O    GLY D  25    12289   8796   8259   2057  -2207  -2741      O
ATOM   6879  N    GLU D  26     -26.623  38.613 105.576  1.00 68.91          N
ANISOU 6879  N    GLU D  26    10753   7875   7555   1435  -1940  -2262      N
ATOM   6880  CA   GLU D  26     -26.077  38.018 106.779  1.00 67.73          C
ANISOU 6880  CA   GLU D  26    10428   7887   7420   1142  -1842  -2209      C
ATOM   6882  CB   GLU D  26     -25.915  36.492 106.623  1.00 64.00          C
ANISOU 6882  CB   GLU D  26     9476   7745   7097    875  -1568  -2027      C
ATOM   6885  CG   GLU D  26     -27.187  35.691 106.198  1.00 62.57          C
ANISOU 6885  CG   GLU D  26     8923   7970   6879   1085  -1378  -2193      C
ATOM   6888  CD   GLU D  26     -28.166  35.348 107.345  1.00 63.45          C
ANISOU 6888  CD   GLU D  26     8799   8500   6809   1226  -1262  -2452      C
ATOM   6889  OE1  GLU D  26     -27.922  35.719 108.516  1.00 64.85          O
ANISOU 6889  OE1  GLU D  26     9108   8656   6877   1207  -1326  -2519      O
ATOM   6890  OE2  GLU D  26     -29.191  34.687 107.065  1.00 62.59          O
ANISOU 6890  OE2  GLU D  26     8360   8774   6646   1327  -1099  -2596      O
ATOM   6891  C    GLU D  26     -24.733  38.721 107.054  1.00 68.84          C
ANISOU 6891  C    GLU D  26    10931   7625   7600    806  -2017  -2021      C
ATOM   6892  O    GLU D  26     -23.819  38.681 106.224  1.00 68.03          O
ANISOU 6892  O    GLU D  26    10885   7322   7641    523  -2030  -1756      O
ATOM   6894  N    ASP D  27     -24.637  39.382 108.202  1.00 71.54          N
ANISOU 6894  N    ASP D  27    11511   7882   7790    825  -2148  -2177      N
ATOM   6895  CA   ASP D  27     -23.450  40.164 108.583  1.00 73.96          C
ANISOU 6895  CA   ASP D  27    12188   7831   8081    483  -2341  -2059      C
ATOM   6897  CB   ASP D  27     -23.872  41.296 109.546  1.00 77.74          C
ANISOU 6897  CB   ASP D  27    13105   8111   8320    720  -2539  -2370      C
ATOM   6900  CG   ASP D  27     -22.729  42.276 109.896  1.00 81.02          C
ANISOU 6900  CG   ASP D  27    14002   8100   8681    341  -2771  -2295      C
ATOM   6901  OD1  ASP D  27     -21.546  41.871 109.974  1.00 80.92          O
ANISOU 6901  OD1  ASP D  27    13826   8142   8779   -155  -2755  -2031      O
ATOM   6902  OD2  ASP D  27     -23.030  43.472 110.131  1.00 84.77          O
ANISOU 6902  OD2  ASP D  27    15033   8198   8977    546  -2976  -2520      O
ATOM   6903  C    ASP D  27     -22.413  39.220 109.217  1.00 72.69          C
ANISOU 6903  C    ASP D  27    11689   7914   8018     50  -2229  -1822      C
ATOM   6904  O    ASP D  27     -22.495  38.906 110.405  1.00 74.12          O
```

FIG. 18 (continued)

| | | | | | | | | | | | | | |
|---|---|---|---|---|---|---|---|---|---|---|---|---|---|
| ANISOU | 6904 | O | ASP | D | 27 | 11742 | 8328 | 8092 | 38 | -2195 | -1918 | | O |
| ATOM | 6906 | N | LEU | D | 28 | -21.428 | 38.779 | 108.431 | 1.00 | 70.88 | | | N |
| ANISOU | 6906 | N | LEU | D | 28 | 11317 | 7648 | 7967 | -279 | -2177 | -1511 | | N |
| ATOM | 6907 | CA | LEU | D | 28 | -20.463 | 37.766 | 108.904 | 1.00 | 68.53 | | | C |
| ANISOU | 6907 | CA | LEU | D | 28 | 10654 | 7626 | 7759 | -603 | -2059 | -1269 | | C |
| ATOM | 6909 | CB | LEU | D | 28 | -19.585 | 37.217 | 107.747 | 1.00 | 67.02 | | | C |
| ANISOU | 6909 | CB | LEU | D | 28 | 10268 | 7434 | 7764 | -841 | -1962 | -955 | | C |
| ATOM | 6912 | CG | LEU | D | 28 | -18.184 | 37.769 | 107.433 | 1.00 | 68.37 | | | C |
| ANISOU | 6912 | CG | LEU | D | 28 | 10553 | 7454 | 7969 | -1263 | -2097 | -730 | | C |
| ATOM | 6914 | CD1 | LEU | D | 28 | -17.180 | 37.344 | 108.455 | 1.00 | 68.90 | | | C |
| ANISOU | 6914 | CD1 | LEU | D | 28 | 10394 | 7781 | 8003 | -1536 | -2121 | -602 | | C |
| ATOM | 6918 | CD2 | LEU | D | 28 | -17.698 | 37.286 | 106.083 | 1.00 | 67.05 | | | C |
| ANISOU | 6918 | CD2 | LEU | D | 28 | 10208 | 7303 | 7966 | -1368 | -1966 | -487 | | C |
| ATOM | 6922 | C | LEU | D | 28 | -19.601 | 38.199 | 110.113 | 1.00 | 69.85 | | | C |
| ANISOU | 6922 | C | LEU | D | 28 | 10939 | 7798 | 7802 | -876 | -2221 | -1267 | | C |
| ATOM | 6923 | O | LEU | D | 28 | -18.856 | 37.381 | 110.659 | 1.00 | 67.89 | | | O |
| ANISOU | 6923 | O | LEU | D | 28 | 10387 | 7824 | 7584 | -1081 | -2147 | -1085 | | O |
| ATOM | 6925 | N | LYS | D | 29 | -19.693 | 39.465 | 110.530 | 1.00 | 72.47 | | | N |
| ANISOU | 6925 | N | LYS | D | 29 | 11729 | 7831 | 7975 | -867 | -2448 | -1470 | | N |
| ATOM | 6926 | CA | LYS | D | 29 | -19.145 | 39.881 | 111.832 | 1.00 | 74.70 | | | C |
| ANISOU | 6926 | CA | LYS | D | 29 | 12144 | 8151 | 8087 | -1074 | -2604 | -1555 | | C |
| ATOM | 6928 | CB | LYS | D | 29 | -18.802 | 41.377 | 111.828 | 1.00 | 79.26 | | | C |
| ANISOU | 6928 | CB | LYS | D | 29 | 13316 | 8263 | 8537 | -1242 | -2878 | -1683 | | C |
| ATOM | 6931 | CG | LYS | D | 29 | -17.496 | 41.708 | 111.095 | 1.00 | 80.41 | | | C |
| ANISOU | 6931 | CG | LYS | D | 29 | 13525 | 8248 | 8777 | -1755 | -2972 | -1408 | | C |
| ATOM | 6934 | CD | LYS | D | 29 | -16.283 | 41.507 | 112.005 | 1.00 | 81.76 | | | C |
| ANISOU | 6934 | CD | LYS | D | 29 | 13491 | 8692 | 8883 | -2212 | -3058 | -1283 | | C |
| ATOM | 6937 | CE | LYS | D | 29 | -14.989 | 41.346 | 111.217 | 1.00 | 81.84 | | | C |
| ANISOU | 6937 | CE | LYS | D | 29 | 13284 | 8795 | 9018 | -2685 | -3055 | -957 | | C |
| ATOM | 6940 | NZ | LYS | D | 29 | -13.799 | 41.158 | 112.128 | 1.00 | 83.80 | | | N |
| ANISOU | 6940 | NZ | LYS | D | 29 | 13275 | 9394 | 9173 | -3106 | -3160 | -846 | | N |
| ATOM | 6944 | C | LYS | D | 29 | -20.112 | 39.528 | 112.981 | 1.00 | 73.80 | | | C |
| ANISOU | 6944 | C | LYS | D | 29 | 11929 | 8301 | 7810 | -757 | -2524 | -1802 | | C |
| ATOM | 6945 | O | LYS | D | 29 | -19.675 | 39.162 | 114.076 | 1.00 | 72.96 | | | O |
| ANISOU | 6945 | O | LYS | D | 29 | 11681 | 8443 | 7598 | -909 | -2534 | -1780 | | O |
| ATOM | 6947 | N | ILE | D | 30 | -21.418 | 39.621 | 112.709 | 1.00 | 73.09 | | | N |
| ANISOU | 6947 | N | ILE | D | 30 | 11887 | 8203 | 7680 | -318 | -2442 | -2031 | | N |
| ATOM | 6948 | CA | ILE | D | 30 | -22.462 | 39.214 | 113.659 | 1.00 | 73.23 | | | C |
| ANISOU | 6948 | CA | ILE | D | 30 | 11742 | 8546 | 7534 | -9 | -2319 | -2270 | | C |
| ATOM | 6950 | CB | ILE | D | 30 | -23.817 | 39.915 | 113.354 | 1.00 | 74.83 | | | C |
| ANISOU | 6950 | CB | ILE | D | 30 | 12152 | 8657 | 7622 | 498 | -2340 | -2604 | | C |
| ATOM | 6952 | CG1 | ILE | D | 30 | -23.682 | 41.429 | 113.561 | 1.00 | 79.05 | | | C |
| ANISOU | 6952 | CG1 | ILE | D | 30 | 13307 | 8730 | 7999 | 583 | -2624 | -2813 | | C |
| ATOM | 6955 | CD1 | ILE | D | 30 | -24.974 | 42.200 | 113.393 | 1.00 | 81.58 | | | C |
| ANISOU | 6955 | CD1 | ILE | D | 30 | 13881 | 8956 | 8159 | 1169 | -2674 | -3162 | | C |
| ATOM | 6959 | CG2 | ILE | D | 30 | -24.934 | 39.355 | 114.239 | 1.00 | 74.66 | | | C |
| ANISOU | 6959 | CG2 | ILE | D | 30 | 11852 | 9089 | 7427 | 790 | -2163 | -2839 | | C |
| ATOM | 6963 | C | ILE | D | 30 | -22.687 | 37.706 | 113.638 | 1.00 | 68.97 | | | C |
| ANISOU | 6963 | C | ILE | D | 30 | 10682 | 8424 | 7100 | -34 | -2035 | -2097 | | C |
| ATOM | 6964 | O | ILE | D | 30 | -22.839 | 37.078 | 114.680 | 1.00 | 69.34 | | | O |
| ANISOU | 6964 | O | ILE | D | 30 | 10541 | 8782 | 7022 | -52 | -1932 | -2124 | | O |
| ATOM | 6966 | N | GLU | D | 31 | -22.699 | 37.133 | 112.442 | 1.00 | 65.47 | | | N |
| ANISOU | 6966 | N | GLU | D | 31 | 10049 | 7960 | 6865 | -46 | -1910 | -1919 | | N |
| ATOM | 6967 | CA | GLU | D | 31 | -23.092 | 35.744 | 112.257 | 1.00 | 61.47 | | | C |
| ANISOU | 6967 | CA | GLU | D | 31 | 9128 | 7779 | 6449 | -39 | -1633 | -1798 | | C |
| ATOM | 6969 | CB | GLU | D | 31 | -24.120 | 35.688 | 111.148 | 1.00 | 61.96 | | | C |
| ANISOU | 6969 | CB | GLU | D | 31 | 9116 | 7845 | 6580 | 222 | -1536 | -1915 | | C |
| ATOM | 6972 | CG | GLU | D | 31 | -25.437 | 36.296 | 111.552 | 1.00 | 64.52 | | | C |
| ANISOU | 6972 | CG | GLU | D | 31 | 9515 | 8300 | 6700 | 607 | -1560 | -2287 | | C |
| ATOM | 6975 | CD | GLU | D | 31 | -26.290 | 35.290 | 112.272 | 1.00 | 64.57 | | | C |
| ANISOU | 6975 | CD | GLU | D | 31 | 9172 | 8768 | 6592 | 648 | -1316 | -2386 | | C |
| ATOM | 6976 | OE1 | GLU | D | 31 | -25.944 | 34.966 | 113.412 | 1.00 | 65.51 | | | O |
| ANISOU | 6976 | OE1 | GLU | D | 31 | 9262 | 9029 | 6602 | 494 | -1281 | -2347 | | O |
| ATOM | 6977 | OE2 | GLU | D | 31 | -27.288 | 34.811 | 111.693 | 1.00 | 63.95 | | | O |
| ANISOU | 6977 | OE2 | GLU | D | 31 | 8853 | 8928 | 6517 | 803 | -1159 | -2496 | | O |
| ATOM | 6978 | C | GLU | D | 31 | -21.880 | 34.860 | 111.959 | 1.00 | 56.70 | | | C |
| ANISOU | 6978 | C | GLU | D | 31 | 8325 | 7198 | 6018 | -361 | -1560 | -1429 | | C |
| ATOM | 6979 | O | GLU | D | 31 | -21.760 | 34.262 | 110.894 | 1.00 | 53.62 | | | O |
| ANISOU | 6979 | O | GLU | D | 31 | 7784 | 6781 | 5808 | -394 | -1437 | -1265 | | O |
| ATOM | 6981 | N | THR | D | 32 | -20.990 | 34.800 | 112.944 | 1.00 | 54.62 | | | N |
| ANISOU | 6981 | N | THR | D | 32 | 8064 | 7016 | 5675 | -568 | -1644 | -1317 | | N |
| ATOM | 6982 | CA | THR | D | 32 | -19.691 | 34.145 | 112.821 | 1.00 | 51.36 | | | C |
| ANISOU | 6982 | CA | THR | D | 32 | 7473 | 6664 | 5378 | -834 | -1631 | -981 | | C |
| ATOM | 6984 | CB | THR | D | 32 | -18.775 | 34.573 | 114.003 | 1.00 | 54.32 | | | C |
| ANISOU | 6984 | CB | THR | D | 32 | 7926 | 7121 | 5593 | -1040 | -1828 | -949 | | C |
| ATOM | 6986 | OG1 | THR | D | 32 | -19.417 | 34.299 | 115.260 | 1.00 | 54.04 | | | O |
| ANISOU | 6986 | OG1 | THR | D | 32 | 7885 | 7303 | 5345 | -919 | -1777 | -1100 | | O |
| ATOM | 6988 | CG2 | THR | D | 32 | -18.493 | 36.049 | 113.926 | 1.00 | 57.25 | | | C |
| ANISOU | 6988 | CG2 | THR | D | 32 | 8651 | 7201 | 5901 | -1158 | -2096 | -1106 | | C |

FIG. 18 (continued)

```
ATOM   6992  C   THR D  32      -19.801  32.613 112.752  1.00 46.86          C
ANISOU 6992  C   THR D  32      6599   6321   4884   -799  -1360   -791      C
ATOM   6993  O   THR D  32      -19.109  31.962 111.968  1.00 44.49          O
ANISOU 6993  O   THR D  32      6146   6007   4749   -882  -1275   -546      O
ATOM   6995  N   ASN D  33      -20.685  32.044 113.566  1.00 43.99          N
ANISOU 6995  N   ASN D  33      6178   6159   4379   -680  -1216   -912      N
ATOM   6996  CA  ASN D  33      -20.896  30.605 113.562  1.00 41.34          C
ANISOU 6996  CA  ASN D  33      5643   5985   4078   -678   -951   -748      C
ATOM   6998  CB  ASN D  33      -21.743  30.158 114.751  1.00 41.65          C
ANISOU 6998  CB  ASN D  33      5669   6269   3888   -627   -827   -878      C
ATOM   7001  CG  ASN D  33      -20.960  30.118 116.057  1.00 43.37          C
ANISOU 7001  CG  ASN D  33      5931   6622   3926   -720   -939   -761      C
ATOM   7002  OD1 ASN D  33      -19.741  29.889 116.081  1.00 42.81          O
ANISOU 7002  OD1 ASN D  33      5816   6534   3917   -825  -1034   -502      O
ATOM   7003  ND2 ASN D  33      -21.669  30.324 117.145  1.00 40.73          N
ANISOU 7003  ND2 ASN D  33      5658   6471   3346   -668   -926   -960      N
ATOM   7006  C   ASN D  33      -21.576  30.113 112.286  1.00 38.14          C
ANISOU 7006  C   ASN D  33      5148   5505   3837   -603   -770   -770      C
ATOM   7007  O   ASN D  33      -21.226  29.056 111.779  1.00 35.03          O
ANISOU 7007  O   ASN D  33      4643   5106   3560   -658   -604   -555      O
ATOM   7009  N   LYS D  34      -22.554  30.872 111.796  1.00 39.26          N
ANISOU 7009  N   LYS D  34      5354   5599   3965   -455   -809  -1039      N
ATOM   7010  CA  LYS D  34      -23.234  30.530 110.536  1.00 38.31          C
ANISOU 7010  CA  LYS D  34      5142   5441   3974   -378   -674  -1088      C
ATOM   7012  CB  LYS D  34      -24.435  31.466 110.277  1.00 39.42          C
ANISOU 7012  CB  LYS D  34      5342   5614   4020   -140   -752  -1426      C
ATOM   7015  CG  LYS D  34      -25.443  30.892 109.264  1.00 40.18          C
ANISOU 7015  CG  LYS D  34      5264   5832   4170    -58   -576  -1528      C
ATOM   7018  CD  LYS D  34      -26.655  31.815 108.944  1.00 41.49          C
ANISOU 7018  CD  LYS D  34      5446   6099   4219    248   -669  -1866      C
ATOM   7021  CE  LYS D  34      -27.666  31.930 110.107  1.00 44.47          C
ANISOU 7021  CE  LYS D  34      5731   6817   4350    383   -616  -2142      C
ATOM   7024  NZ  LYS D  34      -28.551  33.157 109.967  1.00 46.19          N
ANISOU 7024  NZ  LYS D  34      6044   7077   4428    776   -789  -2467      N
ATOM   7028  C   LYS D  34      -22.258  30.508 109.348  1.00 36.05          C
ANISOU 7028  C   LYS D  34      4863   4935   3901   -465   -715   -859      C
ATOM   7029  O   LYS D  34      -22.354  29.625 108.494  1.00 34.29          O
ANISOU 7029  O   LYS D  34      4523   4712   3794   -488   -536   -761      O
ATOM   7031  N   PHE D  35      -21.333  31.470 109.325  1.00 36.77          N
ANISOU 7031  N   PHE D  35      5099   4856   4018   -539   -940   -787      N
ATOM   7032  CA  PHE D  35      -20.214  31.542 108.360  1.00 36.84          C
ANISOU 7032  CA  PHE D  35      5097   4713   4188   -678   -989   -550      C
ATOM   7034  CB  PHE D  35      -19.302  32.732 108.723  1.00 38.26          C
ANISOU 7034  CB  PHE D  35      5459   4760   4317   -835  -1255   -522      C
ATOM   7037  CG  PHE D  35      -18.163  32.998 107.750  1.00 39.64          C
ANISOU 7037  CG  PHE D  35      5620   4822   4619  -1031  -1317   -298      C
ATOM   7038  CD1 PHE D  35      -18.319  32.840 106.354  1.00 37.90          C
ANISOU 7038  CD1 PHE D  35      5377   4496   4529   -984  -1217   -242      C
ATOM   7040  CE1 PHE D  35      -17.268  33.110 105.490  1.00 37.90          C
ANISOU 7040  CE1 PHE D  35      5357   4431   4612  -1183  -1258    -38      C
ATOM   7042  CZ  PHE D  35      -16.061  33.584 105.976  1.00 40.22          C
ANISOU 7042  CZ  PHE D  35      5635   4784   4864  -1457  -1408    102      C
ATOM   7044  CE2 PHE D  35      -15.886  33.772 107.355  1.00 42.35          C
ANISOU 7044  CE2 PHE D  35      5924   5160   5006  -1516  -1531     38      C
ATOM   7046  CD2 PHE D  35      -16.941  33.490 108.230  1.00 41.91          C
ANISOU 7046  CD2 PHE D  35      5916   5143   4865  -1291  -1486   -161      C
ATOM   7048  C   PHE D  35      -19.416  30.230 108.345  1.00 34.29          C
ANISOU 7048  C   PHE D  35      4564   4515   3951   -764   -813   -273      C
ATOM   7049  O   PHE D  35      -19.164  29.683 107.293  1.00 32.82          O
ANISOU 7049  O   PHE D  35      4292   4281   3899   -765   -692   -147      O
ATOM   7051  N   ALA D  36      -19.028  29.744 109.521  1.00 34.18          N
ANISOU 7051  N   ALA D  36      4495   4657   3834   -805   -805   -185      N
ATOM   7052  CA  ALA D  36      -18.343  28.461 109.635  1.00 34.14          C
ANISOU 7052  CA  ALA D  36      4343   4758   3869   -810   -645     75      C
ATOM   7054  CB  ALA D  36      -17.856  28.245 111.117  1.00 34.21          C
ANISOU 7054  CB  ALA D  36      4343   4949   3708   -839   -719    163      C
ATOM   7058  C   ALA D  36      -19.215  27.277 109.135  1.00 31.75          C
ANISOU 7058  C   ALA D  36      4013   4436   3613   -725   -365     54      C
ATOM   7059  O   ALA D  36      -18.706  26.342 108.519  1.00 32.43          O
ANISOU 7059  O   ALA D  36      4038   4484   3798   -699   -218    243      O
ATOM   7061  N   ALA D  37      -20.518  27.335 109.406  1.00 31.05          N
ANISOU 7061  N   ALA D  37      3973   4393   3433   -689   -292   -190      N
ATOM   7062  CA  ALA D  37      -21.475  26.306 108.971  1.00 31.71          C
ANISOU 7062  CA  ALA D  37      4028   4496   3524   -686    -35   -256      C
ATOM   7064  CB  ALA D  37      -22.845  26.480 109.665  1.00 31.94          C
ANISOU 7064  CB  ALA D  37      4052   4704   3379   -679     20   -535      C
ATOM   7068  C   ALA D  37      -21.676  26.266 107.469  1.00 29.13          C
ANISOU 7068  C   ALA D  37      3666   4050   3353   -661     26   -292      C
ATOM   7069  O   ALA D  37      -21.831  25.198 106.897  1.00 29.01          O
```

FIG. 18 (continued)

```
ANISOU 7069  O   ALA D  37    3640   3992   3391   -694    233   -227        O
ATOM   7071  N   ILE D  38    -21.705  27.435 106.844  1.00 30.57          N
ANISOU 7071  N   ILE D  38    3872   4163   3582   -605   -156   -402        N
ATOM   7072  CA  ILE D  38    -21.807  27.524 105.376  1.00 30.46          C
ANISOU 7072  CA  ILE D  38    3842   4039   3691   -572   -129   -418        C
ATOM   7074  CB  ILE D  38    -22.001  28.989 104.897  1.00 30.19          C
ANISOU 7074  CB  ILE D  38    3912   3910   3648   -488   -361   -559        C
ATOM   7076  CG1 ILE D  38    -23.295  29.576 105.468  1.00 31.08          C
ANISOU 7076  CG1 ILE D  38    4052   4146   3610   -347   -421   -865        C
ATOM   7079  CD1 ILE D  38    -23.238  31.076 105.595  1.00 30.88          C
ANISOU 7079  CD1 ILE D  38    4229   3980   3525   -239   -689   -976        C
ATOM   7083  CG2 ILE D  38    -21.997  29.089 103.377  1.00 27.14          C
ANISOU 7083  CG2 ILE D  38    3533   3414   3364   -458   -342   -535        C
ATOM   7087  C   ILE D  38    -20.546  26.950 104.741  1.00 29.47          C
ANISOU 7087  C   ILE D  38    3681   3819   3698   -624    -68   -136        C
ATOM   7088  O   ILE D  38    -20.626  26.188 103.778  1.00 28.35          O
ANISOU 7088  O   ILE D  38    3510   3630   3633   -616     96    -98        O
ATOM   7090  N   CYS D  39    -19.390  27.312 105.290  1.00 29.15          N
ANISOU 7090  N   CYS D  39    3629   3787   3661   -674   -202     44        N
ATOM   7091  CA  CYS D  39    -18.117  26.785 104.797  1.00 29.77          C
ANISOU 7091  CA  CYS D  39    3612   3867   3832   -691   -150    309        C
ATOM   7093  CB  CYS D  39    -16.940  27.440 105.517  1.00 30.68          C
ANISOU 7093  CB  CYS D  39    3670   4079   3909   -781   -348    458        C
ATOM   7096  SG  CYS D  39    -16.621  29.120 104.969  1.00 32.35          S
ANISOU 7096  SG  CYS D  39    3973   4189   4130   -942   -603    392        S
ATOM   7098  C   CYS D  39    -18.071  25.264 104.896  1.00 28.46          C
ANISOU 7098  C   CYS D  39    3425   3713   3675   -613     93    429        C
ATOM   7099  O   CYS D  39    -17.740  24.575 103.934  1.00 27.47          O
ANISOU 7099  O   CYS D  39    3274   3527   3635   -558    239    522        O
ATOM   7101  N   THR D  40    -18.513  24.745 106.032  1.00 29.92          N
ANISOU 7101  N   THR D  40    3667   3951   3748   -608    147    405        N
ATOM   7102  CA  THR D  40    -18.548  23.307 106.271  1.00 30.84          C
ANISOU 7102  CA  THR D  40    3860   4022   3834   -553    374    523        C
ATOM   7104  CB  THR D  40    -18.981  22.976 107.757  1.00 32.62          C
ANISOU 7104  CB  THR D  40    4175   4332   3886   -588    390    516        C
ATOM   7106  OG1 THR D  40    -18.155  23.679 108.690  1.00 31.71          O
ANISOU 7106  OG1 THR D  40    3989   4357   3701   -571    171    613        O
ATOM   7108  CG2 THR D  40    -18.900  21.492 108.034  1.00 32.39          C
ANISOU 7108  CG2 THR D  40    4305   4201   3801   -538    616    683        C
ATOM   7112  C   THR D  40    -19.502  22.615 105.292  1.00 30.64          C
ANISOU 7112  C   THR D  40    3911   3876   3856   -589    586    384        C
ATOM   7113  O   THR D  40    -19.167  21.601 104.705  1.00 29.87          O
ANISOU 7113  O   THR D  40    3886   3657   3807   -530    759    498        O
ATOM   7115  N   HIS D  41    -20.708  23.157 105.129  1.00 30.89          N
ANISOU 7115  N   HIS D  41    3928   3959   3850   -675    567    119        N
ATOM   7116  CA  HIS D  41    -21.684  22.534 104.228  1.00 29.28          C
ANISOU 7116  CA  HIS D  41    3756   3710   3659   -747    749    -42        C
ATOM   7118  CB  HIS D  41    -23.012  23.271 104.250  1.00 29.30          C
ANISOU 7118  CB  HIS D  41    3676   3878   3579   -800    687   -345        C
ATOM   7121  CG  HIS D  41    -24.009  22.699 103.293  1.00 28.62          C
ANISOU 7121  CG  HIS D  41    3568   3823   3483   -894    846   -528        C
ATOM   7122  ND1 HIS D  41    -24.292  23.285 102.080  1.00 27.87          N
ANISOU 7122  ND1 HIS D  41    3400   3742   3447   -827    767   -650        N
ATOM   7124  CE1 HIS D  41    -25.187  22.551 101.441  1.00 30.08          C
ANISOU 7124  CE1 HIS D  41    3659   4089   3681   -954    931   -810        C
ATOM   7126  NE2 HIS D  41    -25.467  21.493 102.181  1.00 31.70          N
ANISOU 7126  NE2 HIS D  41    3950   4290   3806  -1133   1126   -788        N
ATOM   7128  CD2 HIS D  41    -24.738  21.561 103.345  1.00 28.80          C
ANISOU 7128  CD2 HIS D  41    3652   3864   3427  -1079   1078   -601        C
ATOM   7130  C   HIS D  41    -21.138  22.496 102.783  1.00 29.10          C
ANISOU 7130  C   HIS D  41    3712   3573   3771   -681    772     17        C
ATOM   7131  O   HIS D  41    -21.182  21.456 102.113  1.00 28.13          O
ANISOU 7131  O   HIS D  41    3678   3335   3674   -700    970     43        O
ATOM   7133  N   LEU D  42    -20.619  23.630 102.335  1.00 28.99          N
ANISOU 7133  N   LEU D  42    3612   3582   3819   -623    575     38        N
ATOM   7134  CA  LEU D  42    -19.946  23.731 101.036  1.00 30.04          C
ANISOU 7134  CA  LEU D  42    3716   3645   4055   -574    583    127        C
ATOM   7136  CB  LEU D  42    -19.371  25.142 100.844  1.00 28.25          C
ANISOU 7136  CB  LEU D  42    3436   3443   3854   -577    341    167        C
ATOM   7139  CG  LEU D  42    -20.387  26.258 100.568  1.00 28.21          C
ANISOU 7139  CG  LEU D  42    3479   3440   3800   -574    186    -64        C
ATOM   7141  CD1 LEU D  42    -19.742  27.613 100.616  1.00 26.79          C
ANISOU 7141  CD1 LEU D  42    3350   3212   3620   -605    -56     -2        C
ATOM   7145  CD2 LEU D  42    -21.089  26.051  99.233  1.00 28.62          C
ANISOU 7145  CD2 LEU D  42    3539   3473   3863   -543    274   -190        C
ATOM   7149  C   LEU D  42    -18.849  22.677 100.886  1.00 30.91          C
ANISOU 7149  C   LEU D  42    3840   3692   4214   -490    735    364        C
ATOM   7150  O   LEU D  42    -18.826  21.943  99.889  1.00 32.03          O
ANISOU 7150  O   LEU D  42    4032   3746   4393   -451    899    364        O
```

FIG. 18 (continued)

```
ATOM   7152  N   GLU D  43      -17.953  22.595 101.862  1.00 32.69          N
ANISOU 7152  N   GLU D  43      4026   3977   4417   -433    674    553      N
ATOM   7153  CA  GLU D  43      -16.834  21.641 101.789  1.00 36.01          C
ANISOU 7153  CA  GLU D  43      4440   4385   4859   -270    793    788      C
ATOM   7155  CB  GLU D  43      -15.791  21.852 102.906  1.00 38.63          C
ANISOU 7155  CB  GLU D  43      4658   4879   5141   -198    651    990      C
ATOM   7158  CG  GLU D  43      -14.629  20.828 102.796  1.00 42.13          C
ANISOU 7158  CG  GLU D  43      5067   5359   5581     54    769   1231      C
ATOM   7161  CD  GLU D  43      -13.287  21.242 103.398  1.00 45.42          C
ANISOU 7161  CD  GLU D  43      5237   6061   5958    142    600   1441      C
ATOM   7162  OE1 GLU D  43      -12.336  20.431 103.337  1.00 47.67          O
ANISOU 7162  OE1 GLU D  43      5457   6438   6218    407    683   1631      O
ATOM   7163  OE2 GLU D  43      -13.171  22.337 103.960  1.00 49.51          O
ANISOU 7163  OE2 GLU D  43      5633   6728   6451    -38    382   1410      O
ATOM   7164  C   GLU D  43      -17.301  20.180 101.746  1.00 34.98          C
ANISOU 7164  C   GLU D  43      4532   4066   4693   -208   1047    779      C
ATOM   7165  O   GLU D  43      -16.746  19.378 101.002  1.00 33.46          O
ANISOU 7165  O   GLU D  43      4399   3780   4533    -59   1197    870      O
ATOM   7167  N   VAL D  44      -18.325  19.838 102.521  1.00 35.28          N
ANISOU 7167  N   VAL D  44      4713   4046   4646   -337   1105    660      N
ATOM   7168  CA  VAL D  44      -18.887  18.490 102.460  1.00 35.40          C
ANISOU 7168  CA  VAL D  44      4996   3850   4603   -372   1353    632      C
ATOM   7170  CB  VAL D  44      -19.953  18.217 103.538  1.00 37.66          C
ANISOU 7170  CB  VAL D  44      5409   4142   4757   -575   1407    527      C
ATOM   7172  CG1 VAL D  44      -20.490  16.772 103.396  1.00 38.76          C
ANISOU 7172  CG1 VAL D  44      5883   4024   4819   -684   1681    511      C
ATOM   7176  CG2 VAL D  44      -19.370  18.431 104.922  1.00 38.42          C
ANISOU 7176  CG2 VAL D  44      5485   4342   4771   -489   1283    704      C
ATOM   7180  C   VAL D  44      -19.454  18.179 101.061  1.00 35.12          C
ANISOU 7180  C   VAL D  44      5015   3709   4620   -448   1487    459      C
ATOM   7181  O   VAL D  44      -19.112  17.147 100.478  1.00 37.20          O
ANISOU 7181  O   VAL D  44      5472   3775   4889   -350   1668    522      O
ATOM   7183  N   CYS D  45      -20.262  19.075 100.503  1.00 33.04          N
ANISOU 7183  N   CYS D  45      4599   3577   4378   -586   1389    243      N
ATOM   7184  CA  CYS D  45      -20.805  18.881  99.157  1.00 33.06          C
ANISOU 7184  CA  CYS D  45      4624   3534   4404   -654   1483     72      C
ATOM   7186  CB  CYS D  45      -21.671  20.061  98.762  1.00 32.95          C
ANISOU 7186  CB  CYS D  45      4422   3715   4383   -743   1314   -143      C
ATOM   7189  SG  CYS D  45      -23.240  20.184  99.672  1.00 34.12          S
ANISOU 7189  SG  CYS D  45      4526   4041   4398   -957   1309   -400      S
ATOM   7191  C   CYS D  45      -19.731  18.687  98.075  1.00 34.06          C
ANISOU 7191  C   CYS D  45      4747   3584   4610   -465   1530    206      C
ATOM   7192  O   CYS D  45      -19.876  17.815  97.199  1.00 35.15          O
ANISOU 7192  O   CYS D  45      5045   3575   4735   -469   1711    139      O
ATOM   7194  N   PHE D  46      -18.673  19.496  98.135  1.00 33.49          N
ANISOU 7194  N   PHE D  46      4493   3633   4599   -324   1376    380      N
ATOM   7195  CA  PHE D  46      -17.547  19.345  97.207  1.00 35.57          C
ANISOU 7195  CA  PHE D  46      4697   3907   4913   -144   1430    525      C
ATOM   7197  CB  PHE D  46      -16.571  20.503  97.308  1.00 36.65          C
ANISOU 7197  CB  PHE D  46      4583   4252   5089   -110   1229    678      C
ATOM   7200  CG  PHE D  46      -17.162  21.823  96.958  1.00 36.50          C
ANISOU 7200  CG  PHE D  46      4482   4309   5079   -278   1042    548      C
ATOM   7201  CD1 PHE D  46      -17.926  21.979  95.810  1.00 38.14          C
ANISOU 7201  CD1 PHE D  46      4742   4475   5273   -339   1078    376      C
ATOM   7203  CE1 PHE D  46      -18.481  23.221  95.496  1.00 38.74          C
ANISOU 7203  CE1 PHE D  46      4783   4605   5332   -433    887    268      C
ATOM   7205  CZ  PHE D  46      -18.267  24.297  96.332  1.00 35.61          C
ANISOU 7205  CZ  PHE D  46      4335   4260   4935   -485    672    319      C
ATOM   7207  CE2 PHE D  46      -17.504  24.135  97.471  1.00 36.18          C
ANISOU 7207  CE2 PHE D  46      4345   4379   5022   -469    641    473      C
ATOM   7209  CD2 PHE D  46      -16.953  22.918  97.775  1.00 34.93          C
ANISOU 7209  CD2 PHE D  46      4185   4210   4876   -357    819    593      C
ATOM   7211  C   PHE D  46      -16.766  18.059  97.417  1.00 36.75          C
ANISOU 7211  C   PHE D  46      5004   3920   5041     79   1614    688      C
ATOM   7212  O   PHE D  46      -16.371  17.424  96.454  1.00 37.83          O
ANISOU 7212  O   PHE D  46      5219   3976   5179    218   1767    695      O
ATOM   7214  N   MET D  47      -16.470  17.728  98.662  1.00 37.82          N
ANISOU 7214  N   MET D  47      5192   4041   5137    155   1588    827      N
ATOM   7215  CA  MET D  47      -15.923  16.412  99.004  1.00 43.26          C
ANISOU 7215  CA  MET D  47      6125   4543   5771    398   1760    976      C
ATOM   7217  CB  MET D  47      -15.784  16.285 100.513  1.00 45.26          C
ANISOU 7217  CB  MET D  47      6427   4816   5952    435   1679   1122      C
ATOM   7220  CG  MET D  47      -14.550  16.894 101.080  1.00 47.36          C
ANISOU 7220  CG  MET D  47      6399   5374   6223    629   1497   1337      C
ATOM   7223  SD  MET D  47      -14.527  16.553 102.836  1.00 50.76          S
ANISOU 7223  SD  MET D  47      6960   5802   6524    676   1422   1491      S
ATOM   7224  CE  MET D  47      -13.001  15.602 103.042  1.00 54.28          C
ANISOU 7224  CE  MET D  47      7422   6304   6897   1195   1468   1798      C
ATOM   7228  C   MET D  47      -16.788  15.232  98.532  1.00 43.39          C
```

FIG. 18 (continued)

| | | | | | | | | | | | | | |
|---|---|---|---|---|---|---|---|---|---|---|---|---|---|
| ANISOU | 7228 | C | MET | D | 47 | 6529 | 4223 | 5734 | 311 | 1999 | 824 | | C |
| ATOM | 7229 | O | MET | D | 47 | -16.288 | 14.262 | 97.977 | 1.00 | 43.57 | | | O |
| ANISOU | 7229 | O | MET | D | 47 | 6769 | 4052 | 5731 | 537 | 2171 | 877 | | O |
| ATOM | 7231 | N | TYR | D | 48 | -18.082 | 15.303 | 98.806 | 1.00 | 43.24 | | | N |
| ANISOU | 7231 | N | TYR | D | 48 | 6603 | 4149 | 5677 | -21 | 2010 | 628 | | N |
| ATOM | 7232 | CA | TYR | D | 48 | -19.024 | 14.254 | 98.393 | 1.00 | 44.47 | | | C |
| ANISOU | 7232 | CA | TYR | D | 48 | 7109 | 4028 | 5759 | -219 | 2227 | 453 | | C |
| ATOM | 7234 | CB | TYR | D | 48 | -20.456 | 14.704 | 98.691 | 1.00 | 43.73 | | | C |
| ANISOU | 7234 | CB | TYR | D | 48 | 6938 | 4062 | 5617 | -616 | 2184 | 215 | | C |
| ATOM | 7237 | CG | TYR | D | 48 | -21.494 | 13.598 | 98.896 | 1.00 | 46.29 | | | C |
| ANISOU | 7237 | CG | TYR | D | 48 | 7616 | 4161 | 5812 | -930 | 2395 | 73 | | C |
| ATOM | 7238 | CD1 | TYR | D | 48 | -21.966 | 13.303 | 100.173 | 1.00 | 46.83 | | | C |
| ANISOU | 7238 | CD1 | TYR | D | 48 | 7815 | 4205 | 5772 | -1106 | 2429 | 124 | | C |
| ATOM | 7240 | CE1 | TYR | D | 48 | -22.938 | 12.322 | 100.378 | 1.00 | 50.04 | | | C |
| ANISOU | 7240 | CE1 | TYR | D | 48 | 8550 | 4427 | 6035 | -1472 | 2633 | 0 | | C |
| ATOM | 7242 | CZ | TYR | D | 48 | -23.464 | 11.636 | 99.289 | 1.00 | 51.37 | | | C |
| ANISOU | 7242 | CZ | TYR | D | 48 | 8917 | 4431 | 6171 | -1677 | 2792 | -200 | | C |
| ATOM | 7243 | OH | TYR | D | 48 | -24.430 | 10.679 | 99.498 | 1.00 | 53.38 | | | O |
| ANISOU | 7243 | OH | TYR | D | 48 | 9504 | 4514 | 6263 | -2116 | 2994 | -333 | | O |
| ATOM | 7245 | CE2 | TYR | D | 48 | -23.019 | 11.919 | 98.003 | 1.00 | 49.33 | | | C |
| ANISOU | 7245 | CE2 | TYR | D | 48 | 8531 | 4195 | 6019 | -1477 | 2749 | -269 | | C |
| ATOM | 7247 | CD2 | TYR | D | 48 | -22.041 | 12.898 | 97.810 | 1.00 | 46.59 | | | C |
| ANISOU | 7247 | CD2 | TYR | D | 48 | 7853 | 4037 | 5811 | -1102 | 2558 | -124 | | C |
| ATOM | 7249 | C | TYR | D | 48 | -18.859 | 13.968 | 96.892 | 1.00 | 44.45 | | | C |
| ANISOU | 7249 | C | TYR | D | 48 | 7154 | 3948 | 5789 | -146 | 2336 | 342 | | C |
| ATOM | 7250 | O | TYR | D | 48 | -18.758 | 12.816 | 96.493 | 1.00 | 45.06 | | | O |
| ANISOU | 7250 | O | TYR | D | 48 | 7590 | 3723 | 5808 | -70 | 2538 | 331 | | O |
| ATOM | 7252 | N | SER | D | 49 | -18.824 | 15.035 | 96.091 | 1.00 | 41.38 | | | N |
| ANISOU | 7252 | N | SER | D | 49 | 6437 | 3814 | 5470 | -164 | 2198 | 265 | | N |
| ATOM | 7253 | CA | SER | D | 49 | -18.667 | 14.959 | 94.625 | 1.00 | 42.89 | | | C |
| ANISOU | 7253 | CA | SER | D | 49 | 6624 | 4001 | 5672 | -105 | 2275 | 162 | | C |
| ATOM | 7255 | CB | SER | D | 49 | -19.314 | 16.194 | 93.987 | 1.00 | 41.38 | | | C |
| ANISOU | 7255 | CB | SER | D | 49 | 6145 | 4072 | 5506 | -287 | 2102 | 5 | | C |
| ATOM | 7258 | OG | SER | D | 49 | -18.789 | 17.376 | 94.549 | 1.00 | 40.56 | | | O |
| ANISOU | 7258 | OG | SER | D | 49 | 5755 | 4187 | 5467 | -223 | 1886 | 150 | | O |
| ATOM | 7260 | C | SER | D | 49 | -17.220 | 14.832 | 94.088 | 1.00 | 43.84 | | | C |
| ANISOU | 7260 | C | SER | D | 49 | 6670 | 4163 | 5825 | 272 | 2319 | 359 | | C |
| ATOM | 7261 | O | SER | D | 49 | -17.019 | 14.758 | 92.881 | 1.00 | 41.79 | | | O |
| ANISOU | 7261 | O | SER | D | 49 | 6405 | 3923 | 5552 | 338 | 2398 | 282 | | O |
| ATOM | 7263 | N | ASP | D | 50 | -16.228 | 14.793 | 94.972 | 1.00 | 45.40 | | | N |
| ANISOU | 7263 | N | ASP | D | 50 | 6790 | 4419 | 6041 | 520 | 2270 | 603 | | N |
| ATOM | 7264 | CA | ASP | D | 50 | -14.818 | 14.735 | 94.581 | 1.00 | 47.83 | | | C |
| ANISOU | 7264 | CA | ASP | D | 50 | 6936 | 4879 | 6358 | 889 | 2297 | 794 | | C |
| ATOM | 7266 | CB | ASP | D | 50 | -14.451 | 13.341 | 94.044 | 1.00 | 53.41 | | | C |
| ANISOU | 7266 | CB | ASP | D | 50 | 8001 | 5302 | 6989 | 1188 | 2548 | 787 | | C |
| ATOM | 7269 | CG | ASP | D | 50 | -12.932 | 13.107 | 93.984 | 1.00 | 57.22 | | | C |
| ANISOU | 7269 | CG | ASP | D | 50 | 8313 | 5981 | 7448 | 1671 | 2583 | 1010 | | C |
| ATOM | 7270 | OD1 | ASP | D | 50 | -12.219 | 13.540 | 94.916 | 1.00 | 57.52 | | | O |
| ANISOU | 7270 | OD1 | ASP | D | 50 | 8093 | 6261 | 7500 | 1796 | 2435 | 1215 | | O |
| ATOM | 7271 | OD2 | ASP | D | 50 | -12.446 | 12.477 | 93.007 | 1.00 | 61.41 | | | O |
| ANISOU | 7271 | OD2 | ASP | D | 50 | 8952 | 6457 | 7924 | 1938 | 2758 | 968 | | O |
| ATOM | 7272 | C | ASP | D | 50 | -14.496 | 15.860 | 93.576 | 1.00 | 44.90 | | | C |
| ANISOU | 7272 | C | ASP | D | 50 | 6216 | 4814 | 6029 | 812 | 2196 | 770 | | C |
| ATOM | 7273 | O | ASP | D | 50 | -13.902 | 15.646 | 92.506 | 1.00 | 44.16 | | | O |
| ANISOU | 7273 | O | ASP | D | 50 | 6083 | 4789 | 5906 | 981 | 2312 | 769 | | O |
| ATOM | 7275 | N | PHE | D | 51 | -14.921 | 17.064 | 93.944 | 1.00 | 42.09 | | | N |
| ANISOU | 7275 | N | PHE | D | 51 | 5646 | 4626 | 5721 | 553 | 1982 | 748 | | N |
| ATOM | 7276 | CA | PHE | D | 51 | -14.664 | 18.249 | 93.161 | 1.00 | 43.43 | | | C |
| ANISOU | 7276 | CA | PHE | D | 51 | 5550 | 5038 | 5912 | 439 | 1855 | 753 | | C |
| ATOM | 7278 | CB | PHE | D | 51 | -15.650 | 19.349 | 93.508 | 1.00 | 43.36 | | | C |
| ANISOU | 7278 | CB | PHE | D | 51 | 5491 | 5055 | 5928 | 148 | 1648 | 635 | | C |
| ATOM | 7281 | CG | PHE | D | 51 | -15.510 | 20.567 | 92.644 | 1.00 | 44.90 | | | C |
| ANISOU | 7281 | CG | PHE | D | 51 | 5521 | 5418 | 6120 | 25 | 1515 | 636 | | C |
| ATOM | 7282 | CD1 | PHE | D | 51 | -16.052 | 20.588 | 91.361 | 1.00 | 45.54 | | | C |
| ANISOU | 7282 | CD1 | PHE | D | 51 | 5683 | 5469 | 6153 | -27 | 1580 | 490 | | C |
| ATOM | 7284 | CE1 | PHE | D | 51 | -15.915 | 21.702 | 90.559 | 1.00 | 44.12 | | | C |
| ANISOU | 7284 | CE1 | PHE | D | 51 | 5405 | 5419 | 5941 | -132 | 1458 | 518 | | C |
| ATOM | 7286 | CZ | PHE | D | 51 | -15.221 | 22.811 | 91.033 | 1.00 | 44.41 | | | C |
| ANISOU | 7286 | CZ | PHE | D | 51 | 5283 | 5591 | 6000 | -224 | 1276 | 686 | | C |
| ATOM | 7288 | CE2 | PHE | D | 51 | -14.678 | 22.799 | 92.305 | 1.00 | 43.70 | | | C |
| ANISOU | 7288 | CE2 | PHE | D | 51 | 5093 | 5547 | 5963 | -200 | 1207 | 809 | | C |
| ATOM | 7290 | CD2 | PHE | D | 51 | -14.816 | 21.688 | 93.098 | 1.00 | 44.28 | | | C |
| ANISOU | 7290 | CD2 | PHE | D | 51 | 5242 | 5520 | 6063 | -57 | 1322 | 789 | | C |
| ATOM | 7292 | C | PHE | D | 51 | -13.225 | 18.733 | 93.383 | 1.00 | 43.97 | | | C |
| ANISOU | 7292 | C | PHE | D | 51 | 5311 | 5406 | 5988 | 590 | 1781 | 998 | | C |
| ATOM | 7293 | O | PHE | D | 51 | -12.748 | 18.803 | 94.515 | 1.00 | 45.05 | | | O |
| ANISOU | 7293 | O | PHE | D | 51 | 5349 | 5631 | 6136 | 651 | 1682 | 1139 | | O |
| ATOM | 7295 | N | HIS | D | 52 | -12.544 | 19.051 | 92.291 | 1.00 | 43.65 | | | N |
| ANISOU | 7295 | N | HIS | D | 52 | 5106 | 5561 | 5918 | 630 | 1833 | 1042 | | N |

FIG. 18 (continued)

```
ATOM   7296  CA  HIS D  52     -11.188  19.606  92.334  1.00 44.65          C
ANISOU 7296  CA  HIS D  52     4882   6059   6025    697   1773   1257      C
ATOM   7298  CB  HIS D  52     -10.267  18.836  91.395  1.00 47.79          C
ANISOU 7298  CB  HIS D  52     5194   6615   6348   1003   1996   1312      C
ATOM   7301  CG  HIS D  52     -10.039  17.434  91.829  1.00 50.58          C
ANISOU 7301  CG  HIS D  52     5736   6804   6677   1400   2162   1329      C
ATOM   7302  ND1 HIS D  52      -8.920  17.046  92.530  1.00 52.02          N
ANISOU 7302  ND1 HIS D  52     5714   7230   6821   1721   2164   1522      N
ATOM   7304  CE1 HIS D  52      -8.993  15.754  92.784  1.00 56.13          C
ANISOU 7304  CE1 HIS D  52     6548   7474   7306   2075   2320   1502      C
ATOM   7306  NE2 HIS D  52     -10.140  15.299  92.311  1.00 55.50          N
ANISOU 7306  NE2 HIS D  52     6866   6977   7244   1928   2422   1294      N
ATOM   7308  CD2 HIS D  52     -10.811  16.330  91.706  1.00 52.41          C
ANISOU 7308  CD2 HIS D  52     6379   6636   6897   1521   2322   1179      C
ATOM   7310  C   HIS D  52     -11.199  21.081  91.969  1.00 40.57          C
ANISOU 7310  C   HIS D  52     4204   5703   5510    357   1587   1278      C
ATOM   7311  O   HIS D  52     -11.778  21.494  90.962  1.00 40.38          O
ANISOU 7311  O   HIS D  52     4283   5601   5461    213   1600   1166      O
ATOM   7313  N   PHE D  53     -10.551  21.875  92.801  1.00 39.85          N
ANISOU 7313  N   PHE D  53     3891   5823   5426    227   1406   1422      N
ATOM   7314  CA  PHE D  53     -10.556  23.324  92.630  1.00 39.81          C
ANISOU 7314  CA  PHE D  53     3815   5900   5409   -128   1208   1449      C
ATOM   7316  CB  PHE D  53     -10.438  23.996  93.986  1.00 42.57          C
ANISOU 7316  CB  PHE D  53     4100   6293   5784   -281    979   1508      C
ATOM   7319  CG  PHE D  53     -11.613  23.736  94.856  1.00 41.97          C
ANISOU 7319  CG  PHE D  53     4271   5916   5760   -246    918   1355      C
ATOM   7320  CD1 PHE D  53     -11.650  22.610  95.661  1.00 43.19          C
ANISOU 7320  CD1 PHE D  53     4472   6011   5927      0   1014   1367      C
ATOM   7322  CE1 PHE D  53     -12.758  22.354  96.475  1.00 43.25          C
ANISOU 7322  CE1 PHE D  53     4705   5774   5955    -17    980   1229      C
ATOM   7324  CZ  PHE D  53     -13.834  23.237  96.454  1.00 39.90          C
ANISOU 7324  CZ  PHE D  53     4414   5206   5542   -232    846   1058      C
ATOM   7326  CE2 PHE D  53     -13.816  24.333  95.639  1.00 39.56          C
ANISOU 7326  CE2 PHE D  53     4346   5197   5489   -408    738   1039      C
ATOM   7328  CD2 PHE D  53     -12.705  24.585  94.833  1.00 40.86          C
ANISOU 7328  CD2 PHE D  53     4330   5563   5630   -439    777   1197      C
ATOM   7330  C   PHE D  53      -9.498  23.831  91.681  1.00 37.52          C
ANISOU 7330  C   PHE D  53     3283   5936   5038   -237   1259   1588      C
ATOM   7331  O   PHE D  53      -9.552  24.965  91.230  1.00 38.39          O
ANISOU 7331  O   PHE D  53     3421   6057   5109   -547   1138   1610      O
ATOM   7333  N   ILE D  54      -8.547  22.970  91.368  1.00 37.96          N
ANISOU 7333  N   ILE D  54     3120   6258   5046     34   1449   1682      N
ATOM   7334  CA  ILE D  54      -7.516  23.278  90.399  1.00 38.84          C
ANISOU 7334  CA  ILE D  54     2955   6752   5049    -34   1552   1803      C
ATOM   7336  CB  ILE D  54      -6.072  23.224  91.030  1.00 41.99          C
ANISOU 7336  CB  ILE D  54     2897   7669   5386     41   1538   1999      C
ATOM   7338  CG1 ILE D  54      -6.004  24.075  92.315  1.00 40.22          C
ANISOU 7338  CG1 ILE D  54     2607   7474   5202   -241   1260   2063      C
ATOM   7341  CD1 ILE D  54      -4.610  24.243  92.923  1.00 43.12          C
ANISOU 7341  CD1 ILE D  54     2489   8415   5478   -274   1197   2246      C
ATOM   7345  CG2 ILE D  54      -5.033  23.676  89.993  1.00 43.28          C
ANISOU 7345  CG2 ILE D  54     2732   8301   5410   -115   1649   2118      C
ATOM   7349  C   ILE D  54      -7.629  22.263  89.271  1.00 39.43          C
ANISOU 7349  C   ILE D  54     3132   6774   5075    271   1821   1709      C
ATOM   7350  O   ILE D  54      -7.771  21.057  89.515  1.00 39.56          O
ANISOU 7350  O   ILE D  54     3266   6645   5118    646   1958   1641      O
ATOM   7352  N   ASN D  55      -7.521  22.747  88.036  1.00 40.43          N
ANISOU 7352  N   ASN D  55     3242   7013   5105    105   1901   1711      N
ATOM   7353  CA  ASN D  55      -7.639  21.893  86.870  1.00 39.88          C
ANISOU 7353  CA  ASN D  55     3284   6910   4958    358   2150   1603      C
ATOM   7355  CB  ASN D  55      -8.389  22.630  85.740  1.00 38.81          C
ANISOU 7355  CB  ASN D  55     3369   6624   4753     79   2125   1521      C
ATOM   7358  CG  ASN D  55      -7.636  23.836  85.206  1.00 38.88          C
ANISOU 7358  CG  ASN D  55     3172   6957   4645   -283   2066   1701      C
ATOM   7359  OD1 ASN D  55      -6.435  23.952  85.342  1.00 40.75          O
ANISOU 7359  OD1 ASN D  55     3040   7628   4816   -312   2122   1865      O
ATOM   7360  ND2 ASN D  55      -8.365  24.731  84.562  1.00 38.23          N
ANISOU 7360  ND2 ASN D  55     3341   6675   4510   -565   1955   1669      N
ATOM   7363  C   ASN D  55      -6.333  21.278  86.396  1.00 43.15          C
ANISOU 7363  C   ASN D  55     3357   7785   5251    645   2372   1707      C
ATOM   7364  O   ASN D  55      -5.231  21.529  86.940  1.00 44.50          O
ANISOU 7364  O   ASN D  55     3132   8390   5387    641   2334   1880      O
ATOM   7366  N   GLU D  56      -6.426  20.493  85.330  1.00 44.10          N
ANISOU 7366  N   GLU D  56     3608   7868   5282    896   2607   1588      N
ATOM   7367  CA  GLU D  56      -5.246  19.843  84.812  1.00 46.44          C
ANISOU 7367  CA  GLU D  56     3600   8606   5439   1241   2841   1653      C
ATOM   7369  CB  GLU D  56      -5.623  18.706  83.864  1.00 50.11          C
ANISOU 7369  CB  GLU D  56     4364   8848   5827   1606   3093   1454      C
ATOM   7372  CG  GLU D  56      -6.355  17.547  84.584  1.00 52.23          C
```

FIG. 18 (continued)

| | | | | | | | | | | | | | |
|---|---|---|---|---|---|---|---|---|---|---|---|---|---|
| ANISOU | 7372 | CG | GLU | D | 56 | 5026 | 8608 | 6210 | 1926 | 3111 | 1308 | | C |
| ATOM | 7375 | CD | GLU | D | 56 | -5.482 | 16.801 | 85.622 | 1.00 | 56.03 | | | C |
| ANISOU | 7375 | CD | GLU | D | 56 | 5335 | 9243 | 6713 | 2365 | 3136 | 1429 | | C |
| ATOM | 7376 | OE1 | GLU | D | 56 | -4.238 | 16.730 | 85.482 | 1.00 | 60.40 | | | O |
| ANISOU | 7376 | OE1 | GLU | D | 56 | 5472 | 10327 | 7150 | 2621 | 3235 | 1558 | | O |
| ATOM | 7377 | OE2 | GLU | D | 56 | -6.063 | 16.271 | 86.579 | 1.00 | 57.82 | | | O |
| ANISOU | 7377 | OE2 | GLU | D | 56 | 5840 | 9078 | 7050 | 2461 | 3055 | 1394 | | O |
| ATOM | 7378 | C | GLU | D | 56 | -4.272 | 20.841 | 84.191 | 1.00 | 47.06 | | | C |
| ANISOU | 7378 | C | GLU | D | 56 | 3268 | 9244 | 5370 | 931 | 2858 | 1823 | | C |
| ATOM | 7379 | O | GLU | D | 56 | -3.090 | 20.544 | 84.116 | 1.00 | 48.25 | | | O |
| ANISOU | 7379 | O | GLU | D | 56 | 3005 | 9922 | 5405 | 1153 | 2996 | 1927 | | O |
| ATOM | 7381 | N | GLN | D | 57 | -4.763 | 22.024 | 83.806 | 1.00 | 43.02 | | | N |
| ANISOU | 7381 | N | GLN | D | 57 | 2874 | 8626 | 4846 | 421 | 2712 | 1859 | | N |
| ATOM | 7382 | CA | GLN | D | 57 | -3.923 | 23.081 | 83.212 | 1.00 | 47.68 | | | C |
| ANISOU | 7382 | CA | GLN | D | 57 | 3161 | 9680 | 5275 | 15 | 2719 | 2038 | | C |
| ATOM | 7384 | CB | GLN | D | 57 | -4.784 | 23.980 | 82.314 | 1.00 | 45.09 | | | C |
| ANISOU | 7384 | CB | GLN | D | 57 | 3191 | 9057 | 4887 | -373 | 2642 | 2007 | | C |
| ATOM | 7387 | CG | GLN | D | 57 | -5.353 | 23.270 | 81.076 | 1.00 | 44.73 | | | C |
| ANISOU | 7387 | CG | GLN | D | 57 | 3402 | 8856 | 4736 | -127 | 2848 | 1834 | | C |
| ATOM | 7390 | CD | GLN | D | 57 | -6.631 | 22.494 | 81.330 | 1.00 | 40.30 | | | C |
| ANISOU | 7390 | CD | GLN | D | 57 | 3252 | 7740 | 4322 | 128 | 2800 | 1598 | | C |
| ATOM | 7391 | OE1 | GLN | D | 57 | -7.256 | 22.581 | 82.393 | 1.00 | 39.08 | | | O |
| ANISOU | 7391 | OE1 | GLN | D | 57 | 3230 | 7271 | 4347 | 93 | 2603 | 1561 | | O |
| ATOM | 7392 | NE2 | GLN | D | 57 | -7.032 | 21.728 | 80.343 | 1.00 | 40.23 | | | N |
| ANISOU | 7392 | NE2 | GLN | D | 57 | 3443 | 7628 | 4213 | 357 | 2987 | 1425 | | N |
| ATOM | 7395 | C | GLN | D | 57 | -3.159 | 23.939 | 84.269 | 1.00 | 48.25 | | | C |
| ANISOU | 7395 | C | GLN | D | 57 | 2896 | 10058 | 5380 | -315 | 2517 | 2228 | | C |
| ATOM | 7396 | O | GLN | D | 57 | -2.356 | 24.842 | 83.918 | 1.00 | 50.98 | | | O |
| ANISOU | 7396 | O | GLN | D | 57 | 2964 | 10826 | 5579 | -730 | 2514 | 2392 | | O |
| ATOM | 7398 | N | GLY | D | 58 | -3.413 | 23.650 | 85.549 | 1.00 | 47.51 | | | N |
| ANISOU | 7398 | N | GLY | D | 58 | 2840 | 9758 | 5453 | -165 | 2354 | 2203 | | N |
| ATOM | 7399 | CA | GLY | D | 58 | -2.669 | 24.239 | 86.660 | 1.00 | 50.99 | | | C |
| ANISOU | 7399 | CA | GLY | D | 58 | 2950 | 10508 | 5914 | -391 | 2166 | 2352 | | C |
| ATOM | 7402 | C | GLY | D | 58 | -3.337 | 25.500 | 87.207 | 1.00 | 49.33 | | | C |
| ANISOU | 7402 | C | GLY | D | 58 | 3012 | 9947 | 5782 | -918 | 1875 | 2372 | | C |
| ATOM | 7403 | O | GLY | D | 58 | -2.608 | 26.377 | 87.731 | 1.00 | 52.46 | | | O |
| ANISOU | 7403 | O | GLY | D | 58 | 3155 | 10653 | 6123 | -1318 | 1729 | 2512 | | O |
| ATOM | 7405 | N | GLU | D | 59 | -4.715 | 25.625 | 87.035 | 1.00 | 46.18 | | | N |
| ANISOU | 7405 | N | GLU | D | 59 | 3130 | 8929 | 5487 | -928 | 1792 | 2220 | | N |
| ATOM | 7406 | CA | GLU | D | 59 | -5.345 | 26.879 | 87.405 | 1.00 | 46.15 | | | C |
| ANISOU | 7406 | CA | GLU | D | 59 | 3412 | 8602 | 5522 | -1372 | 1529 | 2229 | | C |
| ATOM | 7408 | CB | GLU | D | 59 | -5.592 | 27.715 | 86.141 | 1.00 | 48.14 | | | C |
| ANISOU | 7408 | CB | GLU | D | 59 | 3890 | 8764 | 5639 | -1688 | 1558 | 2264 | | C |
| ATOM | 7411 | CG | GLU | D | 59 | -5.988 | 29.136 | 86.429 | 1.00 | 47.61 | | | C |
| ANISOU | 7411 | CG | GLU | D | 59 | 4124 | 8410 | 5557 | -2160 | 1292 | 2315 | | C |
| ATOM | 7414 | CD | GLU | D | 59 | -5.956 | 30.033 | 85.216 | 1.00 | 49.48 | | | C |
| ANISOU | 7414 | CD | GLU | D | 59 | 4569 | 8621 | 5609 | -2509 | 1321 | 2416 | | C |
| ATOM | 7415 | OE1 | GLU | D | 59 | -5.981 | 29.567 | 84.049 | 1.00 | 49.81 | | | O |
| ANISOU | 7415 | OE1 | GLU | D | 59 | 4610 | 8769 | 5545 | -2357 | 1531 | 2403 | | O |
| ATOM | 7416 | OE2 | GLU | D | 59 | -5.892 | 31.252 | 85.439 | 1.00 | 51.47 | | | O |
| ANISOU | 7416 | OE2 | GLU | D | 59 | 5027 | 8729 | 5800 | -2956 | 1126 | 2515 | | O |
| ATOM | 7417 | C | GLU | D | 59 | -6.611 | 26.632 | 88.220 | 1.00 | 44.16 | | | C |
| ANISOU | 7417 | C | GLU | D | 59 | 3514 | 7826 | 5438 | -1192 | 1381 | 2057 | | C |
| ATOM | 7418 | O | GLU | D | 59 | -7.273 | 25.615 | 88.056 | 1.00 | 38.88 | | | O |
| ANISOU | 7418 | O | GLU | D | 59 | 2991 | 6948 | 4835 | -824 | 1505 | 1912 | | O |
| ATOM | 7420 | N | SER | D | 60 | -6.892 | 27.543 | 89.153 | 1.00 | 46.30 | | | N |
| ANISOU | 7420 | N | SER | D | 60 | 3911 | 7917 | 5762 | -1469 | 1123 | 2067 | | N |
| ATOM | 7421 | CA | SER | D | 60 | -8.095 | 27.497 | 90.006 | 1.00 | 44.65 | | | C |
| ANISOU | 7421 | CA | SER | D | 60 | 4016 | 7265 | 5684 | -1351 | 966 | 1902 | | C |
| ATOM | 7423 | CB | SER | D | 60 | -8.079 | 28.657 | 91.024 | 1.00 | 44.73 | | | C |
| ANISOU | 7423 | CB | SER | D | 60 | 4110 | 7183 | 5704 | -1696 | 685 | 1938 | | C |
| ATOM | 7426 | OG | SER | D | 60 | -8.175 | 29.928 | 90.357 | 1.00 | 44.24 | | | O |
| ANISOU | 7426 | OG | SER | D | 60 | 4285 | 6981 | 5543 | -2081 | 570 | 1989 | | O |
| ATOM | 7428 | C | SER | D | 60 | -9.374 | 27.632 | 89.174 | 1.00 | 45.78 | | | C |
| ANISOU | 7428 | C | SER | D | 60 | 4545 | 7019 | 5829 | -1300 | 968 | 1743 | | C |
| ATOM | 7429 | O | SER | D | 60 | -9.406 | 28.401 | 88.232 | 1.00 | 46.68 | | | O |
| ANISOU | 7429 | O | SER | D | 60 | 4797 | 7102 | 5839 | -1518 | 951 | 1790 | | O |
| ATOM | 7431 | N | ILE | D | 61 | -10.430 | 26.903 | 89.527 | 1.00 | 46.58 | | | N |
| ANISOU | 7431 | N | ILE | D | 61 | 4822 | 6851 | 6026 | -1032 | 983 | 1558 | | N |
| ATOM | 7432 | CA | ILE | D | 61 | -11.701 | 27.090 | 88.837 | 1.00 | 48.21 | | | C |
| ANISOU | 7432 | CA | ILE | D | 61 | 5347 | 6756 | 6215 | -999 | 949 | 1387 | | C |
| ATOM | 7434 | CB | ILE | D | 61 | -12.035 | 25.914 | 87.875 | 1.00 | 48.02 | | | C |
| ANISOU | 7434 | CB | ILE | D | 61 | 5346 | 6732 | 6167 | -736 | 1193 | 1271 | | C |
| ATOM | 7436 | CG1 | ILE | D | 61 | -11.968 | 24.560 | 88.587 | 1.00 | 47.37 | | | C |
| ANISOU | 7436 | CG1 | ILE | D | 61 | 5175 | 6649 | 6175 | -452 | 1340 | 1211 | | C |
| ATOM | 7439 | CD1 | ILE | D | 61 | -13.003 | 23.585 | 88.051 | 1.00 | 45.44 | | | C |
| ANISOU | 7439 | CD1 | ILE | D | 61 | 5141 | 6195 | 5929 | -271 | 1477 | 992 | | C |
| ATOM | 7443 | CG2 | ILE | D | 61 | -11.126 | 25.921 | 86.640 | 1.00 | 49.39 | | | C |
| ANISOU | 7443 | CG2 | ILE | D | 61 | 5387 | 7170 | 6210 | -781 | 1362 | 1399 | | C |

FIG. 18 (continued)

```
ATOM    7447  C    ILE D  61     -12.847  27.262  89.818  1.00 49.48          C
ANISOU  7447  C    ILE D  61     5703   6639   6460   -951    776   1219      C
ATOM    7448  O    ILE D  61     -12.762  26.849  90.990  1.00 47.77          O
ANISOU  7448  O    ILE D  61     5394   6431   6325   -876    747   1211      O
ATOM    7450  N    VAL D  62     -13.922  27.868  89.317  1.00 52.95          N
ANISOU  7450  N    VAL D  62     6403   6864   6852   -974    663   1086      N
ATOM    7451  CA   VAL D  62     -15.209  27.916  90.029  1.00 53.39          C
ANISOU  7451  CA   VAL D  62     6619   6714   6953   -871    536    876      C
ATOM    7453  CB   VAL D  62     -16.138  29.047  89.510  1.00 54.20          C
ANISOU  7453  CB   VAL D  62     6994   6637   6961   -907    337    783      C
ATOM    7455  CG1  VAL D  62     -17.139  29.461  90.593  1.00 53.87          C
ANISOU  7455  CG1  VAL D  62     7064   6451   6951   -831    153    610      C
ATOM    7459  CG2  VAL D  62     -15.349  30.255  89.050  1.00 55.30          C
ANISOU  7459  CG2  VAL D  62     7254   6750   7009  -1147    220    982      C
ATOM    7463  C    VAL D  62     -15.923  26.565  89.840  1.00 53.38          C
ANISOU  7463  C    VAL D  62     6594   6703   6987   -661    727    703      C
ATOM    7464  O    VAL D  62     -17.086  26.383  90.244  1.00 54.52          O
ANISOU  7464  O    VAL D  62     6831   6742   7144   -589    676    502      O
ATOM    7466  N    HIS D  74     -18.331  12.796  84.863  1.00 70.02          N
ANISOU  7466  N    HIS D  74    10702   7335   8568    189   3091   -832      N
ATOM    7467  CA   HIS D  74     -18.374  12.574  86.308  1.00 69.55          C
ANISOU  7467  CA   HIS D  74    10695   7115   8616    173   3056   -702      C
ATOM    7469  CB   HIS D  74     -17.855  13.804  87.060  1.00 68.97          C
ANISOU  7469  CB   HIS D  74    10205   7328   8672    242   2843   -452      C
ATOM    7472  CG   HIS D  74     -18.087  15.098  86.342  1.00 68.68          C
ANISOU  7472  CG   HIS D  74     9851   7619   8627    116   2660   -470      C
ATOM    7473  ND1  HIS D  74     -17.256  15.550  85.336  1.00 70.40          N
ANISOU  7473  ND1  HIS D  74     9915   8038   8794    280   2684   -383      N
ATOM    7475  CE1  HIS D  74     -17.700  16.716  84.891  1.00 69.09          C
ANISOU  7475  CE1  HIS D  74     9547   8096   8609    112   2494   -400      C
ATOM    7477  NE2  HIS D  74     -18.784  17.039  85.579  1.00 67.91          N
ANISOU  7477  NE2  HIS D  74     9389   7917   8497   -109   2344   -510      N
ATOM    7479  CD2  HIS D  74     -19.048  16.044  86.491  1.00 67.57          C
ANISOU  7479  CD2  HIS D  74     9543   7634   8496   -136   2452   -558      C
ATOM    7481  C    HIS D  74     -19.779  12.195  86.787  1.00 66.64          C
ANISOU  7481  C    HIS D  74    10514   6596   8210   -241   3038   -921      C
ATOM    7482  O    HIS D  74     -20.781  12.545  86.159  1.00 67.03          O
ANISOU  7482  O    HIS D  74    10480   6804   8183   -531   2960  -1145      O
ATOM    7484  N    ARG D  75     -19.825  11.484  87.910  1.00 63.49          N
ANISOU  7484  N    ARG D  75    10354   5927   7841   -262   3109   -846      N
ATOM    7485  CA   ARG D  75     -21.053  10.896  88.434  1.00 60.24          C
ANISOU  7485  CA   ARG D  75    10180   5345   7363   -680   3152  -1038      C
ATOM    7487  CB   ARG D  75     -20.722   9.954  89.590  1.00 61.46          C
ANISOU  7487  CB   ARG D  75    10700   5126   7525   -597   3278   -880      C
ATOM    7490  CG   ARG D  75     -21.940   9.452  90.362  1.00 61.47          C
ANISOU  7490  CG   ARG D  75    10917   4991   7449  -1078   3321  -1024      C
ATOM    7493  CD   ARG D  75     -21.547   8.411  91.368  1.00 63.23          C
ANISOU  7493  CD   ARG D  75    11609   4777   7640   -980   3471   -851      C
ATOM    7496  NE   ARG D  75     -22.690   7.953  92.156  1.00 63.98          N
ANISOU  7496  NE   ARG D  75    11911   4763   7637  -1492   3529   -965      N
ATOM    7498  CZ   ARG D  75     -22.663   6.921  92.998  1.00 65.92          C
ANISOU  7498  CZ   ARG D  75    12674   4576   7796  -1560   3684   -858      C
ATOM    7499  NH1  ARG D  75     -21.541   6.231  93.196  1.00 67.40          N
ANISOU  7499  NH1  ARG D  75    13233   4388   7987  -1082   3782   -630      N
ATOM    7502  NH2  ARG D  75     -23.760   6.590  93.667  1.00 66.92          N
ANISOU  7502  NH2  ARG D  75    12943   4671   7811  -2098   3743   -970      N
ATOM    7505  C    ARG D  75     -22.059  11.933  88.915  1.00 55.55          C
ANISOU  7505  C    ARG D  75     9212   5095   6800   -985   2939  -1113      C
ATOM    7506  O    ARG D  75     -23.264  11.751  88.753  1.00 54.39          O
ANISOU  7506  O    ARG D  75     9096   5016   6552  -1374   2941  -1369      O
ATOM    7508  N    PHE D  76     -21.558  13.006  89.525  1.00 51.85          N
ANISOU  7508  N    PHE D  76     8393   4857   6452   -803   2755   -903      N
ATOM    7509  CA   PHE D  76     -22.410  13.991  90.187  1.00 47.93          C
ANISOU  7509  CA   PHE D  76     7587   4645   5981  -1009   2553   -953      C
ATOM    7511  CB   PHE D  76     -21.929  14.232  91.612  1.00 45.64          C
ANISOU  7511  CB   PHE D  76     7234   4325   5783   -897   2487   -717      C
ATOM    7514  CG   PHE D  76     -21.980  13.008  92.486  1.00 47.25          C
ANISOU  7514  CG   PHE D  76     7815   4199   5940   -979   2671   -671      C
ATOM    7515  CD1  PHE D  76     -23.202  12.512  92.933  1.00 48.61          C
ANISOU  7515  CD1  PHE D  76     8123   4337   6007  -1386   2741   -865      C
ATOM    7517  CE1  PHE D  76     -23.261  11.403  93.747  1.00 50.38          C
ANISOU  7517  CE1  PHE D  76     8751   4228   6162  -1505   2917   -802      C
ATOM    7519  CZ   PHE D  76     -22.085  10.746  94.109  1.00 52.53          C
ANISOU  7519  CZ   PHE D  76     9313   4178   6469  -1145   3011   -543      C
ATOM    7521  CE2  PHE D  76     -20.856  11.226  93.664  1.00 50.84          C
ANISOU  7521  CE2  PHE D  76     8908   4049   6360   -694   2935   -365      C
ATOM    7523  CD2  PHE D  76     -20.811  12.355  92.863  1.00 47.96          C
ANISOU  7523  CD2  PHE D  76     8125   4033   6063   -650   2773   -429      C
ATOM    7525  C    PHE D  76     -22.450  15.319  89.443  1.00 46.78          C
```

FIG. 18 (continued)

| | | | | | | | | | | | | | |
|---|---|---|---|---|---|---|---|---|---|---|---|---|---|
| ANISOU | 7525 | C | PHE | D | 76 | 7086 | 4832 | 5855 | -932 | 2342 | -972 | | C |
| ATOM | 7526 | O | PHE | D | 76 | -21.429 | 15.799 | 88.975 | 1.00 | 47.95 | | | O |
| ANISOU | 7526 | O | PHE | D | 76 | 7134 | 5026 | 6059 | -675 | 2305 | -797 | | O |
| ATOM | 7528 | N | GLU | D | 77 | -23.642 | 15.898 | 89.342 | 1.00 | 46.18 | | | N |
| ANISOU | 7528 | N | GLU | D | 77 | 6831 | 5005 | 5712 | -1156 | 2209 | -1182 | | N |
| ATOM | 7529 | CA | GLU | D | 77 | -23.795 | 17.289 | 88.977 | 1.00 | 44.41 | | | C |
| ANISOU | 7529 | CA | GLU | D | 77 | 6308 | 5070 | 5497 | -1058 | 1968 | -1173 | | C |
| ATOM | 7531 | CB | GLU | D | 77 | -25.095 | 17.507 | 88.204 | 1.00 | 47.00 | | | C |
| ANISOU | 7531 | CB | GLU | D | 77 | 6526 | 5657 | 5676 | -1247 | 1886 | -1473 | | C |
| ATOM | 7534 | CG | GLU | D | 77 | -25.121 | 18.821 | 87.440 | 1.00 | 48.05 | | | C |
| ANISOU | 7534 | CG | GLU | D | 77 | 6456 | 6022 | 5777 | -1073 | 1656 | -1451 | | C |
| ATOM | 7537 | CD | GLU | D | 77 | -24.299 | 18.761 | 86.181 | 1.00 | 50.42 | | | C |
| ANISOU | 7537 | CD | GLU | D | 77 | 6857 | 6255 | 6045 | -938 | 1720 | -1366 | | C |
| ATOM | 7538 | OE1 | GLU | D | 77 | -24.733 | 18.070 | 85.233 | 1.00 | 52.56 | | | O |
| ANISOU | 7538 | OE1 | GLU | D | 77 | 7232 | 6551 | 6186 | -1053 | 1824 | -1563 | | O |
| ATOM | 7539 | OE2 | GLU | D | 77 | -23.221 | 19.391 | 86.148 | 1.00 | 52.34 | | | O |
| ANISOU | 7539 | OE2 | GLU | D | 77 | 7070 | 6444 | 6374 | -743 | 1673 | -1113 | | O |
| ATOM | 7540 | C | GLU | D | 77 | -23.816 | 18.072 | 90.279 | 1.00 | 42.67 | | | C |
| ANISOU | 7540 | C | GLU | D | 77 | 5924 | 4929 | 5360 | -1019 | 1814 | -1053 | | C |
| ATOM | 7541 | O | GLU | D | 77 | -24.551 | 17.705 | 91.207 | 1.00 | 39.54 | | | O |
| ANISOU | 7541 | O | GLU | D | 77 | 5540 | 4549 | 4935 | -1200 | 1848 | -1149 | | O |
| ATOM | 7543 | N | ILE | D | 78 | -22.994 | 19.121 | 90.376 | 1.00 | 39.55 | | | N |
| ANISOU | 7543 | N | ILE | D | 78 | 5395 | 4582 | 5049 | -815 | 1656 | -847 | | N |
| ATOM | 7544 | CA | ILE | D | 78 | -22.959 | 19.940 | 91.580 | 1.00 | 40.65 | | | C |
| ANISOU | 7544 | CA | ILE | D | 78 | 5407 | 4786 | 5252 | -778 | 1493 | -748 | | C |
| ATOM | 7546 | CB | ILE | D | 78 | -21.553 | 20.531 | 91.872 | 1.00 | 41.07 | | | C |
| ANISOU | 7546 | CB | ILE | D | 78 | 5413 | 4780 | 5411 | -597 | 1421 | -451 | | C |
| ATOM | 7548 | CG1 | ILE | D | 78 | -20.511 | 19.422 | 91.884 | 1.00 | 44.03 | | | C |
| ANISOU | 7548 | CG1 | ILE | D | 78 | 5918 | 4982 | 5830 | -496 | 1632 | -289 | | C |
| ATOM | 7551 | CD1 | ILE | D | 78 | -19.117 | 19.898 | 92.209 | 1.00 | 45.16 | | | C |
| ANISOU | 7551 | CD1 | ILE | D | 78 | 5948 | 5161 | 6051 | -329 | 1571 | -10 | | C |
| ATOM | 7555 | CG2 | ILE | D | 78 | -21.548 | 21.274 | 93.239 | 1.00 | 40.75 | | | C |
| ANISOU | 7555 | CG2 | ILE | D | 78 | 5280 | 4788 | 5415 | -595 | 1257 | -375 | | C |
| ATOM | 7559 | C | ILE | D | 78 | -23.966 | 21.067 | 91.405 | 1.00 | 38.28 | | | C |
| ANISOU | 7559 | C | ILE | D | 78 | 4945 | 4722 | 4880 | -789 | 1273 | -918 | | C |
| ATOM | 7560 | O | ILE | D | 78 | -23.883 | 21.810 | 90.443 | 1.00 | 38.69 | | | O |
| ANISOU | 7560 | O | ILE | D | 78 | 4961 | 4843 | 4895 | -693 | 1157 | -914 | | O |
| ATOM | 7562 | N | ILE | D | 79 | -24.907 | 21.190 | 92.335 | 1.00 | 35.79 | | | N |
| ANISOU | 7562 | N | ILE | D | 79 | 4542 | 4537 | 4519 | -881 | 1218 | -1062 | | N |
| ATOM | 7563 | CA | ILE | D | 79 | -25.910 | 22.249 | 92.298 | 1.00 | 36.79 | | | C |
| ANISOU | 7563 | CA | ILE | D | 79 | 4504 | 4919 | 4556 | -818 | 1005 | -1242 | | C |
| ATOM | 7565 | CB | ILE | D | 79 | -27.364 | 21.658 | 92.559 | 1.00 | 37.74 | | | C |
| ANISOU | 7565 | CB | ILE | D | 79 | 4501 | 5301 | 4538 | -1021 | 1078 | -1548 | | C |
| ATOM | 7567 | CG1 | ILE | D | 79 | -27.686 | 20.558 | 91.541 | 1.00 | 39.45 | | | C |
| ANISOU | 7567 | CG1 | ILE | D | 79 | 4794 | 5514 | 4680 | -1222 | 1260 | -1685 | | C |
| ATOM | 7570 | CD1 | ILE | D | 79 | -29.061 | 19.841 | 91.818 | 1.00 | 41.28 | | | C |
| ANISOU | 7570 | CD1 | ILE | D | 79 | 4904 | 6024 | 4756 | -1531 | 1361 | -1986 | | C |
| ATOM | 7574 | CG2 | ILE | D | 79 | -28.417 | 22.743 | 92.502 | 1.00 | 37.68 | | | C |
| ANISOU | 7574 | CG2 | ILE | D | 79 | 4282 | 5625 | 4409 | -877 | 853 | -1750 | | C |
| ATOM | 7578 | C | ILE | D | 79 | -25.572 | 23.357 | 93.317 | 1.00 | 36.77 | | | C |
| ANISOU | 7578 | C | ILE | D | 79 | 4462 | 4900 | 4607 | -673 | 814 | -1123 | | C |
| ATOM | 7579 | O | ILE | D | 79 | -25.632 | 24.558 | 93.002 | 1.00 | 35.70 | | | O |
| ANISOU | 7579 | O | ILE | D | 79 | 4311 | 4810 | 4444 | -505 | 598 | -1121 | | O |
| ATOM | 7581 | N | GLU | D | 80 | -25.219 | 22.937 | 94.529 | 1.00 | 37.98 | | | N |
| ANISOU | 7581 | N | GLU | D | 80 | 4643 | 4970 | 4818 | -742 | 891 | -1025 | | N |
| ATOM | 7582 | CA | GLU | D | 80 | -24.729 | 23.823 | 95.571 | 1.00 | 39.85 | | | C |
| ANISOU | 7582 | CA | GLU | D | 80 | 4871 | 5168 | 5101 | -641 | 733 | -899 | | C |
| ATOM | 7584 | CB | GLU | D | 80 | -24.489 | 23.014 | 96.845 | 1.00 | 41.83 | | | C |
| ANISOU | 7584 | CB | GLU | D | 80 | 5159 | 5363 | 5373 | -749 | 867 | -816 | | C |
| ATOM | 7587 | CG | GLU | D | 80 | -24.126 | 23.827 | 98.097 | 1.00 | 42.35 | | | C |
| ANISOU | 7587 | CG | GLU | D | 80 | 5207 | 5437 | 5448 | -678 | 710 | -728 | | C |
| ATOM | 7590 | CD | GLU | D | 80 | -25.056 | 24.978 | 98.359 | 1.00 | 43.56 | | | C |
| ANISOU | 7590 | CD | GLU | D | 80 | 5277 | 5765 | 5508 | -575 | 511 | -935 | | C |
| ATOM | 7591 | OE1 | GLU | D | 80 | -25.926 | 24.835 | 99.225 | 1.00 | 46.11 | | | O |
| ANISOU | 7591 | OE1 | GLU | D | 80 | 5521 | 6267 | 5731 | -623 | 543 | -1098 | | O |
| ATOM | 7592 | OE2 | GLU | D | 80 | -24.905 | 26.054 | 97.736 | 1.00 | 44.05 | | | O |
| ANISOU | 7592 | OE2 | GLU | D | 80 | 5374 | 5786 | 5577 | -433 | 322 | -932 | | O |
| ATOM | 7593 | C | GLU | D | 80 | -23.425 | 24.522 | 95.161 | 1.00 | 40.81 | | | C |
| ANISOU | 7593 | C | GLU | D | 80 | 5064 | 5127 | 5316 | -539 | 628 | -650 | | C |
| ATOM | 7594 | O | GLU | D | 80 | -22.625 | 23.972 | 94.408 | 1.00 | 40.47 | | | O |
| ANISOU | 7594 | O | GLU | D | 80 | 5065 | 4984 | 5326 | -550 | 749 | -511 | | O |
| ATOM | 7596 | N | GLY | D | 81 | -23.202 | 25.729 | 95.666 | 1.00 | 41.02 | | | N |
| ANISOU | 7596 | N | GLY | D | 81 | 5106 | 5138 | 5343 | -457 | 412 | -602 | | N |
| ATOM | 7597 | CA | GLY | D | 81 | -22.007 | 26.492 | 95.275 | 1.00 | 41.57 | | | C |
| ANISOU | 7597 | CA | GLY | D | 81 | 5244 | 5078 | 5471 | -439 | 304 | -374 | | C |
| ATOM | 7600 | C | GLY | D | 81 | -22.207 | 27.427 | 94.089 | 1.00 | 42.52 | | | C |
| ANISOU | 7600 | C | GLY | D | 81 | 5453 | 5173 | 5532 | -364 | 166 | -403 | | C |
| ATOM | 7601 | O | GLY | D | 81 | -21.321 | 28.198 | 93.772 | 1.00 | 43.69 | | | O |
| ANISOU | 7601 | O | GLY | D | 81 | 5688 | 5215 | 5696 | -396 | 65 | -224 | | O |

FIG. 18 (continued)

```
ATOM   7603  N   ARG D  82     -23.355  27.339  93.418  1.00 43.47          N
ANISOU 7603  N   ARG D  82     5550   5408   5558   -284    163   -620      N
ATOM   7604  CA  ARG D  82     -23.736  28.295  92.376  1.00 44.79          C
ANISOU 7604  CA  ARG D  82     5825   5569   5626   -155     -3   -666      C
ATOM   7606  CB  ARG D  82     -24.396  27.584  91.201  1.00 44.63          C
ANISOU 7606  CB  ARG D  82     5736   5693   5527   -145    110   -802      C
ATOM   7609  CG  ARG D  82     -23.701  26.324  90.717  1.00 43.96          C
ANISOU 7609  CG  ARG D  82     5611   5576   5516   -296    369   -706      C
ATOM   7612  CD  ARG D  82     -24.552  25.704  89.630  1.00 44.11          C
ANISOU 7612  CD  ARG D  82     5588   5750   5423   -302    450   -903      C
ATOM   7615  NE  ARG D  82     -24.022  24.436  89.143  1.00 44.12          N
ANISOU 7615  NE  ARG D  82     5603   5693   5466   -428    706   -862      N
ATOM   7617  CZ  ARG D  82     -23.302  24.289  88.033  1.00 44.64          C
ANISOU 7617  CZ  ARG D  82     5742   5707   5512   -418    786   -747      C
ATOM   7618  NH1 ARG D  82     -22.996  25.335  87.258  1.00 44.93          N
ANISOU 7618  NH1 ARG D  82     5847   5741   5481   -331    635   -635      N
ATOM   7621  NH2 ARG D  82     -22.879  23.076  87.693  1.00 44.50          N
ANISOU 7621  NH2 ARG D  82     5762   5627   5519   -490   1027   -743      N
ATOM   7624  C   ARG D  82     -24.751  29.268  92.960  1.00 46.30          C
ANISOU 7624  C   ARG D  82     6055   5824   5715     34   -219   -858      C
ATOM   7625  O   ARG D  82     -25.277  29.017  94.024  1.00 47.29          O
ANISOU 7625  O   ARG D  82     6071   6059   5838     38   -196   -989      O
ATOM   7627  N   ASP D  83     -25.029  30.370  92.277  1.00 49.55          N
ANISOU 7627  N   ASP D  83     6640   6167   6018    213   -423   -873      N
ATOM   7628  CA  ASP D  83     -26.149  31.213  92.693  1.00 52.80          C
ANISOU 7628  CA  ASP D  83     7089   6675   6297    488   -624  -1097      C
ATOM   7630  CB  ASP D  83     -25.971  32.677  92.258  1.00 57.35          C
ANISOU 7630  CB  ASP D  83     8016   6998   6777    680   -884  -1010      C
ATOM   7633  CG  ASP D  83     -26.332  32.919  90.805  1.00 60.26          C
ANISOU 7633  CG  ASP D  83     8479   7402   7015    825   -950  -1006      C
ATOM   7634  OD1 ASP D  83     -25.566  32.463  89.929  1.00 60.58          O
ANISOU 7634  OD1 ASP D  83     8531   7385   7104    623   -822   -823      O
ATOM   7635  OD2 ASP D  83     -27.371  33.593  90.549  1.00 63.76          O
ANISOU 7635  OD2 ASP D  83     8989   7950   7285   1170  -1137  -1187      O
ATOM   7636  C   ASP D  83     -27.448  30.595  92.165  1.00 52.15          C
ANISOU 7636  C   ASP D  83     6766   6951   6096    602   -569  -1365      C
ATOM   7637  O   ASP D  83     -27.451  29.936  91.110  1.00 50.65          O
ANISOU 7637  O   ASP D  83     6510   6845   5890    512   -458  -1353      O
ATOM   7639  N   ARG D  84     -28.539  30.814  92.908  1.00 51.43          N
ANISOU 7639  N   ARG D  84     6532   7107   5902    788   -645  -1618      N
ATOM   7640  CA  ARG D  84     -29.801  30.087  92.703  1.00 49.80          C
ANISOU 7640  CA  ARG D  84     6003   7345   5573    812   -561  -1902      C
ATOM   7642  CB  ARG D  84     -30.905  30.648  93.598  1.00 51.05          C
ANISOU 7642  CB  ARG D  84     6012   7795   5589   1081   -684  -2168      C
ATOM   7645  CG  ARG D  84     -30.703  30.361  95.063  1.00 48.64          C
ANISOU 7645  CG  ARG D  84     5648   7472   5361    926   -576  -2170      C
ATOM   7648  CD  ARG D  84     -31.836  30.904  95.886  1.00 49.78          C
ANISOU 7648  CD  ARG D  84     5622   7962   5332   1210   -678  -2456      C
ATOM   7651  NE  ARG D  84     -33.079  30.141  95.751  1.00 50.51          N
ANISOU 7651  NE  ARG D  84     5302   8613   5275   1153   -561  -2737      N
ATOM   7653  CZ  ARG D  84     -33.415  29.083  96.496  1.00 49.70          C
ANISOU 7653  CZ  ARG D  84     4950   8762   5172    816   -323  -2827      C
ATOM   7654  NH1 ARG D  84     -32.608  28.626  97.452  1.00 48.65          N
ANISOU 7654  NH1 ARG D  84     4942   8366   5178    555   -183  -2649      N
ATOM   7657  NH2 ARG D  84     -34.566  28.472  96.286  1.00 51.18          N
ANISOU 7657  NH2 ARG D  84     4767   9482   5195    721   -229  -3092      N
ATOM   7660  C   ARG D  84     -30.285  30.070  91.276  1.00 51.03          C
ANISOU 7660  C   ARG D  84     6128   7660   5603    920   -617  -1970      C
ATOM   7661  O   ARG D  84     -30.816  29.065  90.815  1.00 51.86          O
ANISOU 7661  O   ARG D  84     5999   8042   5664    742   -465  -2110      O
ATOM   7663  N   THR D  85     -30.111  31.180  90.574  1.00 52.97          N
ANISOU 7663  N   THR D  85     6639   7721   5767   1194   -840  -1871      N
ATOM   7664  CA  THR D  85     -30.645  31.324  89.224  1.00 55.08          C
ANISOU 7664  CA  THR D  85     6903   8160   5864   1366   -938  -1935      C
ATOM   7666  CB  THR D  85     -30.584  32.812  88.797  1.00 58.65          C
ANISOU 7666  CB  THR D  85     7730   8366   6188   1756  -1232  -1831      C
ATOM   7668  OG1 THR D  85     -30.557  33.639  89.976  1.00 61.41          O
ANISOU 7668  OG1 THR D  85     8230   8538   6566   1925  -1354  -1849      O
ATOM   7670  CG2 THR D  85     -31.805  33.202  87.994  1.00 61.58          C
ANISOU 7670  CG2 THR D  85     7999   9106   6295   2155  -1424  -2047      C
ATOM   7674  C   THR D  85     -29.931  30.372  88.233  1.00 54.65          C
ANISOU 7674  C   THR D  85     6852   8026   5886   1043   -737  -1789      C
ATOM   7675  O   THR D  85     -30.566  29.754  87.359  1.00 52.89          O
ANISOU 7675  O   THR D  85     6452   8101   5542   1007   -688  -1942      O
ATOM   7677  N   MET D  86     -28.618  30.217  88.397  1.00 53.31          N
ANISOU 7677  N   MET D  86     6864   7493   5899    807   -616  -1514      N
ATOM   7678  CA  MET D  86     -27.869  29.266  87.573  1.00 52.88          C
ANISOU 7678  CA  MET D  86     6805   7374   5915    538   -400  -1386      C
ATOM   7680  CB  MET D  86     -26.365  29.578  87.614  1.00 54.44          C
```

FIG. 18 (continued)

| | | | | | | | | | | | | | |
|---|---|---|---|---|---|---|---|---|---|---|---|---|---|
| ANISOU | 7680 | CB | MET | D | 86 | 7229 | 7201 | 6254 | 398 | -351 | -1052 | | C |
| ATOM | 7683 | CG | MET | D | 86 | -25.491 | 28.587 | 86.842 | 1.00 | 54.78 | | | C |
| ANISOU | 7683 | CG | MET | D | 86 | 7252 | 7200 | 6363 | 170 | -109 | -919 | | C |
| ATOM | 7686 | SD | MET | D | 86 | -26.080 | 28.172 | 85.184 | 1.00 | 61.01 | | | S |
| ANISOU | 7686 | SD | MET | D | 86 | 8025 | 8203 | 6952 | 213 | -79 | -1045 | | S |
| ATOM | 7687 | CE | MET | D | 86 | -24.670 | 27.269 | 84.515 | 1.00 | 58.20 | | | C |
| ANISOU | 7687 | CE | MET | D | 86 | 7721 | 7701 | 6692 | -15 | 204 | -826 | | C |
| ATOM | 7691 | C | MET | D | 86 | -28.149 | 27.821 | 88.024 | 1.00 | 48.24 | | | C |
| ANISOU | 7691 | C | MET | D | 86 | 5967 | 6958 | 5403 | 274 | -144 | -1537 | | C |
| ATOM | 7692 | O | MET | D | 86 | -28.166 | 26.902 | 87.214 | 1.00 | 48.14 | | | O |
| ANISOU | 7692 | O | MET | D | 86 | 5902 | 7030 | 5360 | 116 | 14 | -1589 | | O |
| ATOM | 7694 | N | ALA | D | 87 | -28.371 | 27.654 | 89.318 | 1.00 | 44.13 | | | N |
| ANISOU | 7694 | N | ALA | D | 87 | 5338 | 6469 | 4961 | 222 | -106 | -1606 | | N |
| ATOM | 7695 | CA | ALA | D | 87 | -28.652 | 26.355 | 89.923 | 1.00 | 40.96 | | | C |
| ANISOU | 7695 | CA | ALA | D | 87 | 4764 | 6187 | 4613 | -48 | 131 | -1726 | | C |
| ATOM | 7697 | CB | ALA | D | 87 | -28.523 | 26.449 | 91.439 | 1.00 | 34.15 | | | C |
| ANISOU | 7697 | CB | ALA | D | 87 | 3872 | 5259 | 3843 | -79 | 145 | -1694 | | C |
| ATOM | 7701 | C | ALA | D | 87 | -30.033 | 25.822 | 89.509 | 1.00 | 42.25 | | | C |
| ANISOU | 7701 | C | ALA | D | 87 | 4683 | 6774 | 4598 | -101 | 153 | -2052 | | C |
| ATOM | 7702 | O | ALA | D | 87 | -30.160 | 24.650 | 89.131 | 1.00 | 41.89 | | | O |
| ANISOU | 7702 | O | ALA | D | 87 | 4589 | 6785 | 4540 | -376 | 358 | -2138 | | O |
| ATOM | 7704 | N | TRP | D | 88 | -31.063 | 26.673 | 89.535 | 1.00 | 41.62 | | | N |
| ANISOU | 7704 | N | TRP | D | 88 | 4455 | 7003 | 4355 | 164 | -61 | -2245 | | N |
| ATOM | 7705 | CA | TRP | D | 88 | -32.356 | 26.262 | 88.991 | 1.00 | 42.59 | | | C |
| ANISOU | 7705 | CA | TRP | D | 88 | 4293 | 7619 | 4272 | 131 | -71 | -2560 | | C |
| ATOM | 7707 | CB | TRP | D | 88 | -33.445 | 27.303 | 89.265 | 1.00 | 43.43 | | | C |
| ANISOU | 7707 | CB | TRP | D | 88 | 4204 | 8104 | 4194 | 515 | -322 | -2766 | | C |
| ATOM | 7710 | CG | TRP | D | 88 | -33.980 | 27.219 | 90.637 | 1.00 | 42.51 | | | C |
| ANISOU | 7710 | CG | TRP | D | 88 | 3886 | 8189 | 4079 | 469 | -264 | -2905 | | C |
| ATOM | 7711 | CD1 | TRP | D | 88 | -33.877 | 28.166 | 91.607 | 1.00 | 42.60 | | | C |
| ANISOU | 7711 | CD1 | TRP | D | 88 | 3979 | 8089 | 4119 | 747 | -397 | -2861 | | C |
| ATOM | 7713 | NE1 | TRP | D | 88 | -34.509 | 27.746 | 92.743 | 1.00 | 42.60 | | | N |
| ANISOU | 7713 | NE1 | TRP | D | 88 | 3725 | 8383 | 4078 | 605 | -278 | -3035 | | N |
| ATOM | 7715 | CE2 | TRP | D | 88 | -35.021 | 26.494 | 92.548 | 1.00 | 42.90 | | | C |
| ANISOU | 7715 | CE2 | TRP | D | 88 | 3530 | 8706 | 4064 | 186 | -57 | -3182 | | C |
| ATOM | 7716 | CD2 | TRP | D | 88 | -34.711 | 26.122 | 91.224 | 1.00 | 43.35 | | | C |
| ANISOU | 7716 | CD2 | TRP | D | 88 | 3696 | 8645 | 4129 | 93 | -47 | -3117 | | C |
| ATOM | 7717 | CE3 | TRP | D | 88 | -35.124 | 24.872 | 90.763 | 1.00 | 44.29 | | | C |
| ANISOU | 7717 | CE3 | TRP | D | 88 | 3669 | 8972 | 4187 | -339 | 158 | -3261 | | C |
| ATOM | 7719 | CZ3 | TRP | D | 88 | -35.837 | 24.037 | 91.628 | 1.00 | 46.66 | | | C |
| ANISOU | 7719 | CZ3 | TRP | D | 88 | 3730 | 9583 | 4417 | -700 | 351 | -3447 | | C |
| ATOM | 7721 | CH2 | TRP | D | 88 | -36.132 | 24.434 | 92.943 | 1.00 | 46.20 | | | C |
| ANISOU | 7721 | CH2 | TRP | D | 88 | 3546 | 9663 | 4345 | -606 | 347 | -3488 | | C |
| ATOM | 7723 | CZ2 | TRP | D | 88 | -35.729 | 25.658 | 93.423 | 1.00 | 45.50 | | | C |
| ANISOU | 7723 | CZ2 | TRP | D | 88 | 3588 | 9381 | 4318 | -147 | 142 | -3366 | | C |
| ATOM | 7725 | C | TRP | D | 88 | -32.309 | 25.928 | 87.500 | 1.00 | 43.15 | | | C |
| ANISOU | 7725 | C | TRP | D | 88 | 4419 | 7729 | 4248 | 83 | -65 | -2571 | | C |
| ATOM | 7726 | O | TRP | D | 88 | -33.005 | 25.019 | 87.062 | 1.00 | 43.48 | | | O |
| ANISOU | 7726 | O | TRP | D | 88 | 4275 | 8071 | 4176 | -163 | 48 | -2791 | | O |
| ATOM | 7728 | N | THR | D | 89 | -31.509 | 26.669 | 86.732 | 1.00 | 43.19 | | | N |
| ANISOU | 7728 | N | THR | D | 89 | 4686 | 7447 | 4275 | 287 | -184 | -2342 | | N |
| ATOM | 7729 | CA | THR | D | 89 | -31.292 | 26.368 | 85.325 | 1.00 | 45.62 | | | C |
| ANISOU | 7729 | CA | THR | D | 89 | 5089 | 7755 | 4489 | 240 | -160 | -2313 | | C |
| ATOM | 7731 | CB | THR | D | 89 | -30.334 | 27.378 | 84.632 | 1.00 | 45.50 | | | C |
| ANISOU | 7731 | CB | THR | D | 89 | 5393 | 7408 | 4486 | 464 | -296 | -2015 | | C |
| ATOM | 7733 | OG1 | THR | D | 89 | -30.865 | 28.707 | 84.734 | 1.00 | 47.50 | | | O |
| ANISOU | 7733 | OG1 | THR | D | 89 | 5703 | 7730 | 4615 | 858 | -592 | -2027 | | O |
| ATOM | 7735 | CG2 | THR | D | 89 | -30.138 | 27.018 | 83.144 | 1.00 | 46.90 | | | C |
| ANISOU | 7735 | CG2 | THR | D | 89 | 5660 | 7631 | 4531 | 407 | -252 | -1994 | | C |
| ATOM | 7739 | C | THR | D | 89 | -30.714 | 24.969 | 85.181 | 1.00 | 44.72 | | | C |
| ANISOU | 7739 | C | THR | D | 89 | 5022 | 7485 | 4487 | -154 | 148 | -2291 | | C |
| ATOM | 7740 | O | THR | D | 89 | -31.091 | 24.233 | 84.277 | 1.00 | 47.56 | | | O |
| ANISOU | 7740 | O | THR | D | 89 | 5332 | 8020 | 4720 | -315 | 229 | -2449 | | O |
| ATOM | 7742 | N | VAL | D | 90 | -29.803 | 24.610 | 86.081 | 1.00 | 43.34 | | | N |
| ANISOU | 7742 | N | VAL | D | 90 | 4962 | 6977 | 4529 | -289 | 307 | -2104 | | N |
| ATOM | 7743 | CA | VAL | D | 90 | -29.212 | 23.275 | 86.073 | 1.00 | 43.48 | | | C |
| ANISOU | 7743 | CA | VAL | D | 90 | 5074 | 6798 | 4647 | -594 | 598 | -2069 | | C |
| ATOM | 7745 | CB | VAL | D | 90 | -27.959 | 23.239 | 86.949 | 1.00 | 42.28 | | | C |
| ANISOU | 7745 | CB | VAL | D | 90 | 5076 | 6268 | 4719 | -597 | 700 | -1780 | | C |
| ATOM | 7747 | CG1 | VAL | D | 90 | -27.461 | 21.792 | 87.132 | 1.00 | 42.64 | | | C |
| ANISOU | 7747 | CG1 | VAL | D | 90 | 5237 | 6113 | 4850 | -851 | 997 | -1762 | | C |
| ATOM | 7751 | CG2 | VAL | D | 90 | -26.880 | 24.114 | 86.290 | 1.00 | 41.74 | | | C |
| ANISOU | 7751 | CG2 | VAL | D | 90 | 5168 | 6001 | 4691 | -407 | 603 | -1508 | | C |
| ATOM | 7755 | C | VAL | D | 90 | -30.203 | 22.163 | 86.461 | 1.00 | 44.20 | | | C |
| ANISOU | 7755 | C | VAL | D | 90 | 5012 | 7118 | 4664 | -908 | 751 | -2353 | | C |
| ATOM | 7756 | O | VAL | D | 90 | -30.291 | 21.145 | 85.782 | 1.00 | 43.65 | | | O |
| ANISOU | 7756 | O | VAL | D | 90 | 5013 | 7042 | 4529 | -1146 | 919 | -2470 | | O |
| ATOM | 7758 | N | VAL | D | 91 | -30.931 | 22.378 | 87.555 | 1.00 | 45.31 | | | N |
| ANISOU | 7758 | N | VAL | D | 91 | 4963 | 7458 | 4796 | -926 | 700 | -2467 | | N |

FIG. 18 (continued)

| | | | | | | | | | | | | |
|---|---|---|---|---|---|---|---|---|---|---|---|---|
| ATOM | 7759 | CA | VAL | D | 91 | -32.007 | 21.479 | 87.991 | 1.00 | 46.87 | | C |
| ANISOU | 7759 | CA | VAL | D | 91 | 4970 | 7958 | 4879 | -1261 | 829 | -2747 | C |
| ATOM | 7761 | CB | VAL | D | 91 | -32.648 | 22.009 | 89.334 | 1.00 | 46.44 | | C |
| ANISOU | 7761 | CB | VAL | D | 91 | 4695 | 8135 | 4817 | -1194 | 752 | -2820 | C |
| ATOM | 7763 | CG1 | VAL | D | 91 | -33.911 | 21.238 | 89.719 | 1.00 | 48.30 | | C |
| ANISOU | 7763 | CG1 | VAL | D | 91 | 4659 | 8815 | 4879 | -1553 | 867 | -3135 | C |
| ATOM | 7767 | CG2 | VAL | D | 91 | -31.641 | 21.917 | 90.449 | 1.00 | 43.18 | | C |
| ANISOU | 7767 | CG2 | VAL | D | 91 | 4485 | 7310 | 4612 | -1199 | 854 | -2553 | C |
| ATOM | 7771 | C | VAL | D | 91 | -33.067 | 21.270 | 86.892 | 1.00 | 50.17 | | C |
| ANISOU | 7771 | C | VAL | D | 91 | 5191 | 8815 | 5056 | -1361 | 765 | -3048 | C |
| ATOM | 7772 | O | VAL | D | 91 | -33.450 | 20.130 | 86.592 | 1.00 | 51.38 | | O |
| ANISOU | 7772 | O | VAL | D | 91 | 5362 | 9036 | 5124 | -1756 | 951 | -3226 | O |
| ATOM | 7774 | N | ASN | D | 92 | -33.540 | 22.356 | 86.283 | 1.00 | 51.32 | | N |
| ANISOU | 7774 | N | ASN | D | 92 | 5178 | 9251 | 5068 | -1010 | 497 | -3109 | N |
| ATOM | 7775 | CA | ASN | D | 92 | -34.564 | 22.235 | 85.234 | 1.00 | 54.31 | | C |
| ANISOU | 7775 | CA | ASN | D | 92 | 5333 | 10116 | 5184 | -1057 | 397 | -3395 | C |
| ATOM | 7777 | CB | ASN | D | 92 | -35.175 | 23.594 | 84.897 | 1.00 | 55.72 | | C |
| ANISOU | 7777 | CB | ASN | D | 92 | 5325 | 10642 | 5205 | -562 | 65 | -3445 | C |
| ATOM | 7780 | CG | ASN | D | 92 | -36.050 | 24.103 | 86.000 | 1.00 | 56.70 | | C |
| ANISOU | 7780 | CG | ASN | D | 92 | 5138 | 11131 | 5273 | -422 | -32 | -3598 | C |
| ATOM | 7781 | OD1 | ASN | D | 92 | -36.973 | 23.423 | 86.408 | 1.00 | 60.67 | | O |
| ANISOU | 7781 | OD1 | ASN | D | 92 | 5331 | 12062 | 5658 | -728 | 70 | -3866 | O |
| ATOM | 7782 | ND2 | ASN | D | 92 | -35.750 | 25.282 | 86.515 | 1.00 | 55.10 | | N |
| ANISOU | 7782 | ND2 | ASN | D | 92 | 5033 | 10763 | 5141 | 15 | -216 | -3437 | N |
| ATOM | 7785 | C | ASN | D | 92 | -34.035 | 21.573 | 83.985 | 1.00 | 54.47 | | C |
| ANISOU | 7785 | C | ASN | D | 92 | 5585 | 9942 | 5169 | -1209 | 500 | -3366 | C |
| ATOM | 7786 | O | ASN | D | 92 | -34.768 | 20.848 | 83.302 | 1.00 | 57.70 | | O |
| ANISOU | 7786 | O | ASN | D | 92 | 5873 | 10664 | 5387 | -1489 | 548 | -3634 | O |
| ATOM | 7788 | N | SER | D | 93 | -32.758 | 21.810 | 83.689 | 1.00 | 51.95 | | N |
| ANISOU | 7788 | N | SER | D | 93 | 5588 | 9137 | 5015 | -1044 | 539 | -3057 | N |
| ATOM | 7789 | CA | SER | D | 93 | -32.102 | 21.123 | 82.584 | 1.00 | 51.70 | | C |
| ANISOU | 7789 | CA | SER | D | 93 | 5799 | 8887 | 4958 | -1171 | 680 | -3012 | C |
| ATOM | 7791 | CB | SER | D | 93 | -30.678 | 21.654 | 82.373 | 1.00 | 49.98 | | C |
| ANISOU | 7791 | CB | SER | D | 93 | 5858 | 8225 | 4907 | -925 | 694 | -2645 | C |
| ATOM | 7794 | OG | SER | D | 93 | -30.116 | 21.038 | 81.221 | 1.00 | 54.87 | | O |
| ANISOU | 7794 | OG | SER | D | 93 | 6677 | 8713 | 5457 | -1007 | 828 | -2630 | O |
| ATOM | 7796 | C | SER | D | 93 | -32.096 | 19.603 | 82.825 | 1.00 | 50.94 | | C |
| ANISOU | 7796 | C | SER | D | 93 | 5827 | 8632 | 4895 | -1630 | 981 | -3146 | C |
| ATOM | 7797 | O | SER | D | 93 | -32.497 | 18.848 | 81.964 | 1.00 | 53.25 | | O |
| ANISOU | 7797 | O | SER | D | 93 | 6156 | 9055 | 5023 | -1873 | 1058 | -3362 | O |
| ATOM | 7799 | N | ILE | D | 94 | -31.660 | 19.174 | 84.005 | 1.00 | 49.01 | | N |
| ANISOU | 7799 | N | ILE | D | 94 | 5681 | 8097 | 4843 | -1749 | 1141 | -3022 | N |
| ATOM | 7800 | CA | ILE | D | 94 | -31.666 | 17.757 | 84.401 | 1.00 | 50.26 | | C |
| ANISOU | 7800 | CA | ILE | D | 94 | 6031 | 8039 | 5026 | -2169 | 1425 | -3119 | C |
| ATOM | 7802 | CB | ILE | D | 94 | -31.079 | 17.596 | 85.828 | 1.00 | 49.08 | | C |
| ANISOU | 7802 | CB | ILE | D | 94 | 5990 | 7571 | 5089 | -2171 | 1541 | -2902 | C |
| ATOM | 7804 | CG1 | ILE | D | 94 | -29.553 | 17.715 | 85.773 | 1.00 | 46.49 | | C |
| ANISOU | 7804 | CG1 | ILE | D | 94 | 5928 | 6779 | 4958 | -1889 | 1604 | -2559 | C |
| ATOM | 7807 | CD1 | ILE | D | 94 | -28.917 | 17.752 | 87.130 | 1.00 | 45.81 | | C |
| ANISOU | 7807 | CD1 | ILE | D | 94 | 5904 | 6441 | 5060 | -1820 | 1660 | -2327 | C |
| ATOM | 7811 | CG2 | ILE | D | 94 | -31.542 | 16.279 | 86.480 | 1.00 | 51.45 | | C |
| ANISOU | 7811 | CG2 | ILE | D | 94 | 6433 | 7768 | 5347 | -2645 | 1787 | -3051 | C |
| ATOM | 7815 | C | ILE | D | 94 | -33.077 | 17.137 | 84.349 | 1.00 | 52.66 | | C |
| ANISOU | 7815 | C | ILE | D | 94 | 6122 | 8782 | 5105 | -2591 | 1448 | -3499 | C |
| ATOM | 7816 | O | ILE | D | 94 | -33.280 | 16.060 | 83.767 | 1.00 | 54.60 | | O |
| ANISOU | 7816 | O | ILE | D | 94 | 6549 | 8961 | 5235 | -2955 | 1615 | -3684 | O |
| ATOM | 7818 | N | CYS | D | 95 | -34.045 | 17.816 | 84.956 | 1.00 | 52.45 | | N |
| ANISOU | 7818 | N | CYS | D | 95 | 5710 | 9222 | 4997 | -2550 | 1284 | -3629 | N |
| ATOM | 7819 | CA | CYS | D | 95 | -35.457 | 17.395 | 84.903 | 1.00 | 55.87 | | C |
| ANISOU | 7819 | CA | CYS | D | 95 | 5822 | 10225 | 5180 | -2932 | 1275 | -4004 | C |
| ATOM | 7821 | CB | CYS | D | 95 | -36.302 | 18.361 | 85.729 | 1.00 | 55.84 | | C |
| ANISOU | 7821 | CB | CYS | D | 95 | 5376 | 10722 | 5118 | -2724 | 1084 | -4083 | C |
| ATOM | 7824 | SG | CYS | D | 95 | -35.969 | 18.213 | 87.494 | 1.00 | 52.67 | | S |
| ANISOU | 7824 | SG | CYS | D | 95 | 5053 | 10045 | 4915 | -2815 | 1245 | -3899 | S |
| ATOM | 7826 | C | CYS | D | 95 | -36.031 | 17.310 | 83.487 | 1.00 | 59.35 | | C |
| ANISOU | 7826 | C | CYS | D | 95 | 6152 | 11024 | 5376 | -2997 | 1165 | -4251 | C |
| ATOM | 7827 | O | CYS | D | 95 | -36.822 | 16.386 | 83.166 | 1.00 | 61.86 | | O |
| ANISOU | 7827 | O | CYS | D | 95 | 6407 | 11602 | 5496 | -3499 | 1272 | -4554 | O |
| ATOM | 7829 | N | ASN | D | 96 | -35.663 | 18.270 | 82.637 | 1.00 | 57.99 | | N |
| ANISOU | 7829 | N | ASN | D | 96 | 5967 | 10880 | 5186 | -2526 | 948 | -4128 | N |
| ATOM | 7830 | CA | ASN | D | 96 | -36.150 | 18.266 | 81.238 | 1.00 | 62.05 | | C |
| ANISOU | 7830 | CA | ASN | D | 96 | 6394 | 11742 | 5442 | -2533 | 820 | -4336 | C |
| ATOM | 7832 | CB | ASN | D | 96 | -35.910 | 19.623 | 80.540 | 1.00 | 63.27 | | C |
| ANISOU | 7832 | CB | ASN | D | 96 | 6487 | 12002 | 5550 | -1935 | 527 | -4168 | C |
| ATOM | 7835 | CG | ASN | D | 96 | -36.929 | 20.700 | 80.948 | 1.00 | 66.35 | | C |
| ANISOU | 7835 | CG | ASN | D | 96 | 6440 | 12963 | 5807 | -1610 | 241 | -4280 | C |
| ATOM | 7836 | OD1 | ASN | D | 96 | -38.140 | 20.513 | 80.820 | 1.00 | 72.75 | | O |
| ANISOU | 7836 | OD1 | ASN | D | 96 | 6863 | 14409 | 6371 | -1781 | 156 | -4611 | O |
| ATOM | 7837 | ND2 | ASN | D | 96 | -36.433 | 21.838 | 81.410 | 1.00 | 64.66 | | N |

FIG. 18 (continued)

| | | | | | | | | | | | | | |
|---|---|---|---|---|---|---|---|---|---|---|---|---|---|
| ANISOU | 7837 | ND2 | ASN | D | 96 | 6294 | 12540 | 5734 | -1131 | 90 | -4016 | | N |
| ATOM | 7840 | C | ASN | D | 96 | -35.519 | 17.155 | 80.415 | 1.00 | 61.65 | | | C |
| ANISOU | 7840 | C | ASN | D | 96 | 6746 | 11298 | 5380 | -2833 | 1045 | -4361 | | C |
| ATOM | 7841 | O | ASN | D | 96 | -36.153 | 16.624 | 79.501 | 1.00 | 65.44 | | | O |
| ANISOU | 7841 | O | ASN | D | 96 | 7171 | 12082 | 5611 | -3107 | 1034 | -4646 | | O |
| ATOM | 7843 | N | THR | D | 97 | -34.269 | 16.810 | 80.719 | 1.00 | 57.92 | | | N |
| ANISOU | 7843 | N | THR | D | 97 | 6675 | 10178 | 5154 | -2760 | 1242 | -4078 | | N |
| ATOM | 7844 | CA | THR | D | 97 | -33.548 | 15.802 | 79.940 | 1.00 | 58.57 | | | C |
| ANISOU | 7844 | CA | THR | D | 97 | 7177 | 9850 | 5225 | -2937 | 1462 | -4085 | | C |
| ATOM | 7846 | CB | THR | D | 97 | -32.030 | 15.998 | 80.000 | 1.00 | 55.52 | | | C |
| ANISOU | 7846 | CB | THR | D | 97 | 7110 | 8904 | 5081 | -2580 | 1565 | -3706 | | C |
| ATOM | 7848 | OG1 | THR | D | 97 | -31.617 | 16.133 | 81.356 | 1.00 | 52.95 | | | O |
| ANISOU | 7848 | OG1 | THR | D | 97 | 6792 | 8329 | 4998 | -2511 | 1626 | -3488 | | O |
| ATOM | 7850 | CG2 | THR | D | 97 | -31.616 | 17.233 | 79.225 | 1.00 | 55.16 | | | C |
| ANISOU | 7850 | CG2 | THR | D | 97 | 6960 | 8995 | 5005 | -2120 | 1340 | -3522 | | C |
| ATOM | 7854 | C | THR | D | 97 | -33.875 | 14.390 | 80.408 | 1.00 | 60.33 | | | C |
| ANISOU | 7854 | C | THR | D | 97 | 7624 | 9877 | 5421 | -3503 | 1730 | -4285 | | C |
| ATOM | 7855 | O | THR | D | 97 | -34.199 | 13.533 | 79.596 | 1.00 | 61.61 | | | O |
| ANISOU | 7855 | O | THR | D | 97 | 7955 | 10062 | 5391 | -3844 | 1827 | -4540 | | O |
| ATOM | 7857 | N | THR | D | 98 | -33.801 | 14.166 | 81.720 | 1.00 | 59.00 | | | N |
| ANISOU | 7857 | N | THR | D | 98 | 7487 | 9507 | 5423 | -3617 | 1845 | -4168 | | N |
| ATOM | 7858 | CA | THR | D | 98 | -34.068 | 12.844 | 82.302 | 1.00 | 60.57 | | | C |
| ANISOU | 7858 | CA | THR | D | 98 | 7971 | 9450 | 5593 | -4164 | 2111 | -4307 | | C |
| ATOM | 7860 | CB | THR | D | 98 | -33.309 | 12.656 | 83.634 | 1.00 | 57.57 | | | C |
| ANISOU | 7860 | CB | THR | D | 98 | 7812 | 8596 | 5468 | -4069 | 2262 | -4006 | | C |
| ATOM | 7862 | OG1 | THR | D | 98 | -33.773 | 13.609 | 84.594 | 1.00 | 55.01 | | | O |
| ANISOU | 7862 | OG1 | THR | D | 98 | 7065 | 8630 | 5205 | -3919 | 2098 | -3933 | | O |
| ATOM | 7864 | CG2 | THR | D | 98 | -31.806 | 12.830 | 83.435 | 1.00 | 52.30 | | | C |
| ANISOU | 7864 | CG2 | THR | D | 98 | 7446 | 7413 | 5013 | -3582 | 2313 | -3665 | | C |
| ATOM | 7868 | C | THR | D | 98 | -35.551 | 12.577 | 82.547 | 1.00 | 65.54 | | | C |
| ANISOU | 7868 | C | THR | D | 98 | 8259 | 10655 | 5988 | -4690 | 2075 | -4662 | | C |
| ATOM | 7869 | O | THR | D | 98 | -35.988 | 11.411 | 82.556 | 1.00 | 67.79 | | | O |
| ANISOU | 7869 | O | THR | D | 98 | 8791 | 10828 | 6138 | -5276 | 2276 | -4881 | | O |
| ATOM | 7871 | N | GLY | D | 99 | -36.329 | 13.642 | 82.757 | 1.00 | 66.23 | | | N |
| ANISOU | 7871 | N | GLY | D | 99 | 7791 | 11367 | 6007 | -4493 | 1825 | -4727 | | N |
| ATOM | 7872 | CA | GLY | D | 99 | -37.756 | 13.469 | 83.025 | 1.00 | 70.82 | | | C |
| ANISOU | 7872 | CA | GLY | D | 99 | 7945 | 12619 | 6343 | -4952 | 1783 | -5071 | | C |
| ATOM | 7875 | C | GLY | D | 99 | -38.016 | 13.182 | 84.490 | 1.00 | 71.81 | | | C |
| ANISOU | 7875 | C | GLY | D | 99 | 8031 | 12703 | 6552 | -5223 | 1935 | -5013 | | C |
| ATOM | 7876 | O | GLY | D | 99 | -39.127 | 12.803 | 84.862 | 1.00 | 76.81 | | | O |
| ANISOU | 7876 | O | GLY | D | 99 | 8372 | 13835 | 6978 | -5727 | 1981 | -5288 | | O |
| ATOM | 7878 | N | ALA | D | 100 | -36.984 | 13.349 | 85.318 | 1.00 | 69.02 | | | N |
| ANISOU | 7878 | N | ALA | D | 100 | 7960 | 11788 | 6475 | -4910 | 2018 | -4657 | | N |
| ATOM | 7879 | CA | ALA | D | 100 | -37.116 | 13.259 | 86.761 | 1.00 | 69.24 | | | C |
| ANISOU | 7879 | CA | ALA | D | 100 | 7948 | 11771 | 6587 | -5055 | 2132 | -4549 | | C |
| ATOM | 7881 | CB | ALA | D | 100 | -35.729 | 13.352 | 87.428 | 1.00 | 66.28 | | | C |
| ANISOU | 7881 | CB | ALA | D | 100 | 7975 | 10693 | 6515 | -4665 | 2213 | -4135 | | C |
| ATOM | 7885 | C | ALA | D | 100 | -38.006 | 14.413 | 87.209 | 1.00 | 70.18 | | | C |
| ANISOU | 7885 | C | ALA | D | 100 | 7431 | 12616 | 6619 | -4809 | 1896 | -4656 | | C |
| ATOM | 7886 | O | ALA | D | 100 | -37.931 | 15.505 | 86.639 | 1.00 | 67.02 | | | O |
| ANISOU | 7886 | O | ALA | D | 100 | 6790 | 12441 | 6234 | -4276 | 1635 | -4619 | | O |
| ATOM | 7888 | N | GLU | D | 101 | -38.867 | 14.170 | 88.200 | 1.00 | 74.36 | | | N |
| ANISOU | 7888 | N | GLU | D | 101 | 7706 | 13518 | 7030 | -5189 | 1990 | -4796 | | N |
| ATOM | 7889 | CA | GLU | D | 101 | -39.698 | 15.245 | 88.749 | 1.00 | 76.22 | | | C |
| ANISOU | 7889 | CA | GLU | D | 101 | 7338 | 14452 | 7170 | -4907 | 1788 | -4906 | | C |
| ATOM | 7891 | CB | GLU | D | 101 | -40.742 | 14.700 | 89.743 | 1.00 | 80.85 | | | C |
| ANISOU | 7891 | CB | GLU | D | 101 | 7643 | 15516 | 7560 | -5485 | 1960 | -5116 | | C |
| ATOM | 7894 | CG | GLU | D | 101 | -40.142 | 14.040 | 90.989 | 1.00 | 80.88 | | | C |
| ANISOU | 7894 | CG | GLU | D | 101 | 8065 | 14954 | 7711 | -5736 | 2224 | -4866 | | C |
| ATOM | 7897 | CD | GLU | D | 101 | -41.067 | 14.082 | 92.184 | 1.00 | 83.53 | | | C |
| ANISOU | 7897 | CD | GLU | D | 101 | 8016 | 15844 | 7879 | -6028 | 2314 | -4994 | | C |
| ATOM | 7898 | OE1 | GLU | D | 101 | -42.234 | 13.650 | 92.055 | 1.00 | 89.92 | | | O |
| ANISOU | 7898 | OE1 | GLU | D | 101 | 8456 | 17309 | 8398 | -6572 | 2380 | -5328 | | O |
| ATOM | 7899 | OE2 | GLU | D | 101 | -40.617 | 14.543 | 93.258 | 1.00 | 83.16 | | | O |
| ANISOU | 7899 | OE2 | GLU | D | 101 | 8023 | 15603 | 7971 | -5732 | 2322 | -4766 | | O |
| ATOM | 7900 | C | GLU | D | 101 | -38.864 | 16.399 | 89.391 | 1.00 | 70.90 | | | C |
| ANISOU | 7900 | C | GLU | D | 101 | 6699 | 13498 | 6743 | -4207 | 1634 | -4585 | | C |
| ATOM | 7901 | O | GLU | D | 101 | -37.850 | 16.177 | 90.077 | 1.00 | 66.39 | | | O |
| ANISOU | 7901 | O | GLU | D | 101 | 6530 | 12298 | 6398 | -4134 | 1763 | -4282 | | O |
| ATOM | 7903 | N | LYS | D | 102 | -39.327 | 17.620 | 89.125 | 1.00 | 70.93 | | | N |
| ANISOU | 7903 | N | LYS | D | 102 | 6288 | 13990 | 6671 | -3702 | 1346 | -4668 | | N |
| ATOM | 7904 | CA | LYS | D | 102 | -38.757 | 18.875 | 89.627 | 1.00 | 67.82 | | | C |
| ANISOU | 7904 | CA | LYS | D | 102 | 5887 | 13435 | 6446 | -3046 | 1150 | -4435 | | C |
| ATOM | 7906 | CB | LYS | D | 102 | -39.548 | 20.037 | 89.001 | 1.00 | 70.79 | | | C |
| ANISOU | 7906 | CB | LYS | D | 102 | 5829 | 14429 | 6639 | -2560 | 828 | -4621 | | C |
| ATOM | 7909 | CG | LYS | D | 102 | -39.383 | 21.411 | 89.636 | 1.00 | 71.26 | | | C |
| ANISOU | 7909 | CG | LYS | D | 102 | 5802 | 14498 | 6775 | -1914 | 605 | -4489 | | C |
| ATOM | 7912 | CD | LYS | D | 102 | -38.294 | 22.262 | 88.975 | 1.00 | 69.44 | | | C |
| ANISOU | 7912 | CD | LYS | D | 102 | 5935 | 13727 | 6723 | -1410 | 424 | -4195 | | C |

FIG. 18 (continued)

```
ATOM    7915  CE  LYS D 102      -38.772  23.712  88.817  1.00 70.85          C
ANISOU  7915  CE  LYS D 102      5902  14238   6780   -753     90  -4252       C
ATOM    7918  NZ  LYS D 102      -39.856  23.794  87.760  1.00 75.08          N
ANISOU  7918  NZ  LYS D 102      6068  15442   7016   -676    -76  -4551       N
ATOM    7922  C   LYS D 102      -38.802  18.961  91.158  1.00 65.69          C
ANISOU  7922  C   LYS D 102      5561  13160   6237  -3091   1256  -4354       C
ATOM    7923  O   LYS D 102      -39.868  18.886  91.753  1.00 65.60          O
ANISOU  7923  O   LYS D 102      5152  13748   6024  -3312   1297  -4598       O
ATOM    7925  N   PRO D 103      -37.637  19.145  91.804  1.00 62.09          N
ANISOU  7925  N   PRO D 103      5481  12073   6036  -2877   1297  -4016       N
ATOM    7926  CA  PRO D 103      -37.677  19.282  93.254  1.00 60.56          C
ANISOU  7926  CA  PRO D 103      5238  11898   5874  -2895   1377  -3942       C
ATOM    7928  CB  PRO D 103      -36.202  19.300  93.655  1.00 56.78          C
ANISOU  7928  CB  PRO D 103      5235  10661   5678  -2702   1419  -3552       C
ATOM    7931  CG  PRO D 103      -35.467  19.741  92.422  1.00 55.57          C
ANISOU  7931  CG  PRO D 103      5256  10222   5637  -2375   1265  -3431       C
ATOM    7934  CD  PRO D 103      -36.267  19.249  91.264  1.00 57.91          C
ANISOU  7934  CD  PRO D 103      5392  10865   5747  -2619   1272  -3702       C
ATOM    7937  C   PRO D 103      -38.387  20.575  93.648  1.00 61.20          C
ANISOU  7937  C   PRO D 103      4898  12513   5841  -2423   1135  -4086       C
ATOM    7938  O   PRO D 103      -38.380  21.538  92.873  1.00 59.22          O
ANISOU  7938  O   PRO D 103      4567  12350   5583  -1943    876  -4103       O
ATOM    7939  N   LYS D 104      -39.018  20.578  94.820  1.00 62.67          N
ANISOU  7939  N   LYS D 104      4844  13054   5913  -2550   1223  -4195       N
ATOM    7940  CA  LYS D 104      -39.721  21.767  95.322  1.00 65.18          C
ANISOU  7940  CA  LYS D 104      4775  13894   6099  -2070   1016  -4358       C
ATOM    7942  CB  LYS D 104      -40.776  21.393  96.386  1.00 68.73          C
ANISOU  7942  CB  LYS D 104      4832  14967   6315  -2408   1189  -4593       C
ATOM    7945  CG  LYS D 104      -41.714  20.222  96.000  1.00 73.78          C
ANISOU  7945  CG  LYS D 104      5213  16087   6733  -3105   1399  -4850       C
ATOM    7948  CD  LYS D 104      -42.972  20.661  95.270  1.00 77.72          C
ANISOU  7948  CD  LYS D 104      5108  17473   6948  -2961   1229  -5228       C
ATOM    7951  CE  LYS D 104      -43.707  19.464  94.647  1.00 81.82          C
ANISOU  7951  CE  LYS D 104      5448  18370   7270  -3709   1413  -5461       C
ATOM    7954  NZ  LYS D 104      -45.101  19.802  94.196  1.00 86.76          N
ANISOU  7954  NZ  LYS D 104      5355  20060   7551  -3659   1278  -5873       N
ATOM    7958  C   LYS D 104      -38.693  22.750  95.901  1.00 62.59          C
ANISOU  7958  C   LYS D 104      4758  13039   5985  -1561    867  -4077       C
ATOM    7959  O   LYS D 104      -38.922  23.959  95.935  1.00 63.14          O
ANISOU  7959  O   LYS D 104      4695  13292   6003  -1007    619  -4144       O
ATOM    7961  N   PHE D 105      -37.554  22.199  96.326  1.00 61.13          N
ANISOU  7961  N   PHE D 105      5007  12200   6022  -1758   1015  -3770       N
ATOM    7962  CA  PHE D 105      -36.449  22.929  96.946  1.00 57.62          C
ANISOU  7962  CA  PHE D 105      4873  11239   5779  -1410    909  -3484       C
ATOM    7964  CB  PHE D 105      -36.215  22.409  98.383  1.00 61.02          C
ANISOU  7964  CB  PHE D 105      5406  11553   6226  -1673   1107  -3374       C
ATOM    7967  CG  PHE D 105      -35.821  20.950  98.446  1.00 62.64          C
ANISOU  7967  CG  PHE D 105      5870  11446   6485  -2222   1397  -3237       C
ATOM    7968  CD1 PHE D 105      -34.476  20.569  98.495  1.00 60.74          C
ANISOU  7968  CD1 PHE D 105      6064  10545   6468  -2217   1453  -2899       C
ATOM    7970  CE1 PHE D 105      -34.118  19.224  98.524  1.00 61.45          C
ANISOU  7970  CE1 PHE D 105      6447  10314   6588  -2647   1711  -2777       C
ATOM    7972  CZ  PHE D 105      -35.097  18.239  98.500  1.00 64.14          C
ANISOU  7972  CZ  PHE D 105      6690  10945   6737  -3162   1923  -2987       C
ATOM    7974  CE2 PHE D 105      -36.446  18.596  98.455  1.00 67.92          C
ANISOU  7974  CE2 PHE D 105      6693  12126   6987  -3251   1878  -3329       C
ATOM    7976  CD2 PHE D 105      -36.801  19.946  98.421  1.00 67.45          C
ANISOU  7976  CD2 PHE D 105      6301  12430   6899  -2745   1612  -3454       C
ATOM    7978  C   PHE D 105      -35.203  22.688  96.121  1.00 52.72          C
ANISOU  7978  C   PHE D 105      4651   9992   5386  -1396    906  -3198       C
ATOM    7979  O   PHE D 105      -35.114  21.666  95.467  1.00 50.81          O
ANISOU  7979  O   PHE D 105      4515   9634   5158  -1745   1070  -3193       O
ATOM    7981  N   LEU D 106      -34.244  23.617  96.183  1.00 49.55          N
ANISOU  7981  N   LEU D 106      4476   9206   5144  -1015    729  -2973       N
ATOM    7982  CA  LEU D 106      -32.907  23.428  95.623  1.00 45.17          C
ANISOU  7982  CA  LEU D 106      4277   8082   4803  -1006    745  -2669       C
ATOM    7984  CB  LEU D 106      -32.066  24.702  95.672  1.00 41.90          C
ANISOU  7984  CB  LEU D 106      4035   7381   4504   -595    508  -2478       C
ATOM    7987  CG  LEU D 106      -31.884  25.574  94.458  1.00 40.07          C
ANISOU  7987  CG  LEU D 106      3878   7076   4272   -293    296  -2448       C
ATOM    7989  CD1 LEU D 106      -30.743  26.518  94.771  1.00 36.41          C
ANISOU  7989  CD1 LEU D 106      3684   6200   3950    -75    147  -2183       C
ATOM    7993  CD2 LEU D 106      -31.613  24.757  93.196  1.00 37.64          C
ANISOU  7993  CD2 LEU D 106      3642   6668   3990   -486    412  -2407       C
ATOM    7997  C   LEU D 106      -32.136  22.363  96.380  1.00 43.31          C
ANISOU  7997  C   LEU D 106      4271   7501   4683  -1324    986  -2463       C
ATOM    7998  O   LEU D 106      -31.887  22.502  97.561  1.00 45.61          O
ANISOU  7998  O   LEU D 106      4604   7729   4998  -1311   1004  -2371       O
ATOM    8000  N   PRO D 107      -31.776  21.274  95.698  1.00 42.32          N
```

FIG. 18 (continued)

| | | | | | | | | | | | | | |
|---|---|---|---|---|---|---|---|---|---|---|---|---|---|
| ANISOU | 8000 | N | PRO | D | 107 | 4321 | 7153 | 4606 | -1591 | 1168 | -2397 | | N |
| ATOM | 8001 | CA | PRO | D | 107 | -30.930 | 20.265 | 96.314 | 1.00 | 40.43 | | | C |
| ANISOU | 8001 | CA | PRO | D | 107 | 4371 | 6521 | 4471 | -1805 | 1380 | -2172 | | C |
| ATOM | 8003 | CB | PRO | D | 107 | -31.381 | 18.969 | 95.619 | 1.00 | 42.47 | | | C |
| ANISOU | 8003 | CB | PRO | D | 107 | 4725 | 6767 | 4644 | -2198 | 1604 | -2303 | | C |
| ATOM | 8006 | CG | PRO | D | 107 | -32.005 | 19.407 | 94.348 | 1.00 | 44.07 | | | C |
| ANISOU | 8006 | CG | PRO | D | 107 | 4727 | 7253 | 4764 | -2114 | 1472 | -2516 | | C |
| ATOM | 8009 | CD | PRO | D | 107 | -32.173 | 20.891 | 94.336 | 1.00 | 42.61 | | | C |
| ANISOU | 8009 | CD | PRO | D | 107 | 4318 | 7297 | 4575 | -1690 | 1186 | -2545 | | C |
| ATOM | 8012 | C | PRO | D | 107 | -29.442 | 20.587 | 96.087 | 1.00 | 37.45 | | | C |
| ANISOU | 8012 | C | PRO | D | 107 | 4229 | 5705 | 4294 | -1545 | 1310 | -1855 | | C |
| ATOM | 8013 | O | PRO | D | 107 | -29.103 | 21.639 | 95.554 | 1.00 | 33.89 | | | O |
| ANISOU | 8013 | O | PRO | D | 107 | 3730 | 5251 | 3897 | -1255 | 1103 | -1808 | | O |
| ATOM | 8014 | N | ASP | D | 108 | -28.583 | 19.691 | 96.534 | 1.00 | 38.05 | | | N |
| ANISOU | 8014 | N | ASP | D | 108 | 4562 | 5441 | 4455 | -1651 | 1481 | -1639 | | N |
| ATOM | 8015 | CA | ASP | D | 108 | -27.157 | 19.902 | 96.503 | 1.00 | 37.41 | | | C |
| ANISOU | 8015 | CA | ASP | D | 108 | 4645 | 5031 | 4537 | -1421 | 1433 | -1340 | | C |
| ATOM | 8017 | CB | ASP | D | 108 | -26.545 | 19.373 | 97.791 | 1.00 | 37.53 | | | C |
| ANISOU | 8017 | CB | ASP | D | 108 | 4814 | 4862 | 4583 | -1461 | 1530 | -1137 | | C |
| ATOM | 8020 | CG | ASP | D | 108 | -26.952 | 20.193 | 98.997 | 1.00 | 38.20 | | | C |
| ANISOU | 8020 | CG | ASP | D | 108 | 4742 | 5161 | 4610 | -1415 | 1396 | -1179 | | C |
| ATOM | 8021 | OD1 | ASP | D | 108 | -26.967 | 21.454 | 98.914 | 1.00 | 38.15 | | | O |
| ANISOU | 8021 | OD1 | ASP | D | 108 | 4583 | 5287 | 4625 | -1200 | 1168 | -1222 | | O |
| ATOM | 8022 | OD2 | ASP | D | 108 | -27.265 | 19.557 | 100.023 | 1.00 | 37.93 | | | O |
| ANISOU | 8022 | OD2 | ASP | D | 108 | 4776 | 5148 | 4490 | -1597 | 1527 | -1171 | | O |
| ATOM | 8023 | C | ASP | D | 108 | -26.432 | 19.291 | 95.312 | 1.00 | 37.19 | | | C |
| ANISOU | 8023 | C | ASP | D | 108 | 4789 | 4765 | 4578 | -1391 | 1534 | -1250 | | C |
| ATOM | 8024 | O | ASP | D | 108 | -25.500 | 19.937 | 94.777 | 1.00 | 34.36 | | | O |
| ANISOU | 8024 | O | ASP | D | 108 | 4430 | 4308 | 4319 | -1159 | 1422 | -1087 | | O |
| ATOM | 8026 | N | LEU | D | 109 | -26.830 | 18.058 | 94.951 | 1.00 | 37.80 | | | N |
| ANISOU | 8026 | N | LEU | D | 109 | 5032 | 4747 | 4584 | -1642 | 1754 | -1356 | | N |
| ATOM | 8027 | CA | LEU | D | 109 | -26.279 | 17.297 | 93.819 | 1.00 | 38.03 | | | C |
| ANISOU | 8027 | CA | LEU | D | 109 | 5269 | 4542 | 4638 | -1632 | 1887 | -1325 | | C |
| ATOM | 8029 | CB | LEU | D | 109 | -25.259 | 16.245 | 94.300 | 1.00 | 39.50 | | | C |
| ANISOU | 8029 | CB | LEU | D | 109 | 5784 | 4339 | 4888 | -1583 | 2077 | -1091 | | C |
| ATOM | 8032 | CG | LEU | D | 109 | -24.155 | 16.598 | 95.303 | 1.00 | 38.65 | | | C |
| ANISOU | 8032 | CG | LEU | D | 109 | 5676 | 4122 | 4888 | -1331 | 2005 | -792 | | C |
| ATOM | 8034 | CD1 | LEU | D | 109 | -23.362 | 15.371 | 95.683 | 1.00 | 40.84 | | | C |
| ANISOU | 8034 | CD1 | LEU | D | 109 | 6300 | 4045 | 5173 | -1269 | 2206 | -606 | | C |
| ATOM | 8038 | CD2 | LEU | D | 109 | -23.228 | 17.638 | 94.764 | 1.00 | 37.19 | | | C |
| ANISOU | 8038 | CD2 | LEU | D | 109 | 5312 | 4010 | 4810 | -1047 | 1831 | -649 | | C |
| ATOM | 8042 | C | LEU | D | 109 | -27.343 | 16.523 | 93.034 | 1.00 | 40.12 | | | C |
| ANISOU | 8042 | C | LEU | D | 109 | 5579 | 4907 | 4756 | -1949 | 2014 | -1614 | | C |
| ATOM | 8043 | O | LEU | D | 109 | -28.428 | 16.262 | 93.527 | 1.00 | 38.89 | | | O |
| ANISOU | 8043 | O | LEU | D | 109 | 5337 | 4963 | 4478 | -2244 | 2059 | -1810 | | O |
| ATOM | 8045 | N | TYR | D | 110 | -27.003 | 16.118 | 91.808 | 1.00 | 40.82 | | | N |
| ANISOU | 8045 | N | TYR | D | 110 | 5806 | 4867 | 4838 | -1913 | 2081 | -1649 | | N |
| ATOM | 8046 | CA | TYR | D | 110 | -27.742 | 15.071 | 91.119 | 1.00 | 42.93 | | | C |
| ANISOU | 8046 | CA | TYR | D | 110 | 6242 | 5108 | 4964 | -2249 | 2251 | -1893 | | C |
| ATOM | 8048 | CB | TYR | D | 110 | -28.388 | 15.554 | 89.814 | 1.00 | 42.92 | | | C |
| ANISOU | 8048 | CB | TYR | D | 110 | 6035 | 5417 | 4856 | -2264 | 2130 | -2125 | | C |
| ATOM | 8051 | CG | TYR | D | 110 | -29.291 | 14.509 | 89.125 | 1.00 | 45.84 | | | C |
| ANISOU | 8051 | CG | TYR | D | 110 | 6539 | 5835 | 5042 | -2683 | 2283 | -2427 | | C |
| ATOM | 8052 | CD1 | TYR | D | 110 | -30.556 | 14.224 | 89.624 | 1.00 | 47.60 | | | C |
| ANISOU | 8052 | CD1 | TYR | D | 110 | 6612 | 6360 | 5115 | -3091 | 2313 | -2671 | | C |
| ATOM | 8054 | CE1 | TYR | D | 110 | -31.389 | 13.292 | 89.030 | 1.00 | 50.95 | | | C |
| ANISOU | 8054 | CE1 | TYR | D | 110 | 7145 | 6862 | 5351 | -3545 | 2446 | -2958 | | C |
| ATOM | 8056 | CZ | TYR | D | 110 | -30.968 | 12.632 | 87.876 | 1.00 | 53.15 | | | C |
| ANISOU | 8056 | CZ | TYR | D | 110 | 7725 | 6881 | 5590 | -3562 | 2544 | -3019 | | C |
| ATOM | 8057 | OH | TYR | D | 110 | -31.804 | 11.707 | 87.276 | 1.00 | 56.48 | | | O |
| ANISOU | 8057 | OH | TYR | D | 110 | 8285 | 7371 | 5804 | -4054 | 2668 | -3328 | | O |
| ATOM | 8059 | CE2 | TYR | D | 110 | -29.709 | 12.910 | 87.337 | 1.00 | 50.85 | | | C |
| ANISOU | 8059 | CE2 | TYR | D | 110 | 7586 | 6290 | 5444 | -3106 | 2523 | -2781 | | C |
| ATOM | 8061 | CD2 | TYR | D | 110 | -28.883 | 13.853 | 87.960 | 1.00 | 46.70 | | | C |
| ANISOU | 8061 | CD2 | TYR | D | 110 | 6909 | 5731 | 5106 | -2685 | 2393 | -2484 | | C |
| ATOM | 8063 | C | TYR | D | 110 | -26.752 | 13.954 | 90.841 | 1.00 | 45.09 | | | C |
| ANISOU | 8063 | C | TYR | D | 110 | 6946 | 4905 | 5281 | -2186 | 2467 | -1749 | | C |
| ATOM | 8064 | O | TYR | D | 110 | -25.594 | 14.200 | 90.460 | 1.00 | 45.32 | | | O |
| ANISOU | 8064 | O | TYR | D | 110 | 7021 | 4778 | 5420 | -1833 | 2445 | -1540 | | O |
| ATOM | 8066 | N | ASP | D | 111 | -27.227 | 12.736 | 91.057 | 1.00 | 48.02 | | | N |
| ANISOU | 8066 | N | ASP | D | 111 | 7639 | 5061 | 5545 | -2533 | 2679 | -1867 | | N |
| ATOM | 8067 | CA | ASP | D | 111 | -26.451 | 11.526 | 90.952 | 1.00 | 50.55 | | | C |
| ANISOU | 8067 | CA | ASP | D | 111 | 8465 | 4874 | 5869 | -2486 | 2904 | -1758 | | C |
| ATOM | 8069 | CB | ASP | D | 111 | -26.753 | 10.654 | 92.172 | 1.00 | 53.77 | | | C |
| ANISOU | 8069 | CB | ASP | D | 111 | 9178 | 5036 | 6215 | -2763 | 3061 | -1700 | | C |
| ATOM | 8072 | CG | ASP | D | 111 | -25.918 | 9.392 | 92.243 | 1.00 | 59.00 | | | C |
| ANISOU | 8072 | CG | ASP | D | 111 | 10442 | 5109 | 6865 | -2650 | 3285 | -1550 | | C |
| ATOM | 8073 | OD1 | ASP | D | 111 | -25.451 | 8.870 | 91.201 | 1.00 | 60.53 | | | O |
| ANISOU | 8073 | OD1 | ASP | D | 111 | 10888 | 5072 | 7040 | -2511 | 3379 | -1611 | | O |

FIG. 18 (continued)

```
ATOM   8074  OD2 ASP D 111    -25.759   8.890  93.372  1.00 61.90          O
ANISOU 8074  OD2 ASP D 111   11065   5238   7218  -2688   3372  -1376       O
ATOM   8075  C   ASP D 111    -26.923  10.889  89.668  1.00 52.17          C
ANISOU 8075  C   ASP D 111    8846   5039   5937  -2711   3004  -2032       C
ATOM   8076  O   ASP D 111    -27.996  10.295  89.626  1.00 53.19          O
ANISOU 8076  O   ASP D 111    9067   5235   5908  -3193   3090  -2287       O
ATOM   8078  N   TYR D 112    -26.143  11.026  88.601  1.00 52.79          N
ANISOU 8078  N   TYR D 112    8955   5049   6052  -2395   2993  -1994       N
ATOM   8079  CA  TYR D 112    -26.490  10.338  87.329  1.00 56.82          C
ANISOU 8079  CA  TYR D 112    9691   5487   6410  -2584   3101  -2259       C
ATOM   8081  CB  TYR D 112    -25.584  10.798  86.202  1.00 58.28          C
ANISOU 8081  CB  TYR D 112    9796   5713   6635  -2175   3053  -2184       C
ATOM   8084  CG  TYR D 112    -25.797  12.222  85.816  1.00 55.98          C
ANISOU 8084  CG  TYR D 112    8993   5900   6377  -2040   2794  -2169       C
ATOM   8085  CD1 TYR D 112    -26.991  12.642  85.234  1.00 57.17          C
ANISOU 8085  CD1 TYR D 112    8893   6446   6384  -2312   2660  -2445       C
ATOM   8087  CE1 TYR D 112    -27.170  13.989  84.860  1.00 55.51          C
ANISOU 8087  CE1 TYR D 112    8271   6638   6183  -2120   2406  -2413       C
ATOM   8089  CZ  TYR D 112    -26.138  14.889  85.062  1.00 52.58          C
ANISOU 8089  CZ  TYR D 112    7772   6237   5967  -1730   2304  -2110       C
ATOM   8090  OH  TYR D 112    -26.246  16.224  84.721  1.00 52.17          O
ANISOU 8090  OH  TYR D 112    7411   6498   5915  -1547   2059  -2053       O
ATOM   8092  CE2 TYR D 112    -24.952  14.476  85.628  1.00 52.66          C
ANISOU 8092  CE2 TYR D 112    7980   5909   6120  -1517   2440  -1851       C
ATOM   8094  CD2 TYR D 112    -24.790  13.157  86.003  1.00 54.22          C
ANISOU 8094  CD2 TYR D 112    8555   5740   6305  -1635   2676  -1879       C
ATOM   8096  C   TYR D 112    -26.455   8.815  87.377  1.00 60.26          C
ANISOU 8096  C   TYR D 112   10750   5403   6742  -2810   3372  -2340       C
ATOM   8097  O   TYR D 112    -26.968   8.159  86.469  1.00 62.67          O
ANISOU 8097  O   TYR D 112   11284   5642   6886  -3094   3467  -2614       O
ATOM   8099  N   LYS D 113    -25.845   8.249  88.414  1.00 60.05          N
ANISOU 8099  N   LYS D 113   11037   4992   6786  -2679   3488  -2104       N
ATOM   8100  CA  LYS D 113    -25.760   6.805  88.562  1.00 63.90          C
ANISOU 8100  CA  LYS D 113   12210   4905   7163  -2848   3742  -2141       C
ATOM   8102  CB  LYS D 113    -24.560   6.450  89.450  1.00 65.12          C
ANISOU 8102  CB  LYS D 113   12647   4667   7429  -2376   3816  -1783       C
ATOM   8105  CG  LYS D 113    -23.931   5.101  89.154  1.00 70.79          C
ANISOU 8105  CG  LYS D 113   14099   4745   8052  -2208   4057  -1771       C
ATOM   8108  CD  LYS D 113    -23.374   4.449  90.424  1.00 72.99          C
ANISOU 8108  CD  LYS D 113   14789   4598   8345  -2016   4152  -1478       C
ATOM   8111  CE  LYS D 113    -22.686   3.117  90.122  1.00 77.95          C
ANISOU 8111  CE  LYS D 113   16205   4549   8863  -1742   4381  -1454       C
ATOM   8114  NZ  LYS D 113    -22.381   2.377  91.388  1.00 81.02          N
ANISOU 8114  NZ  LYS D 113   17091   4484   9209  -1643   4476  -1190       N
ATOM   8118  C   LYS D 113    -27.078   6.234  89.142  1.00 66.58          C
ANISOU 8118  C   LYS D 113   12703   5251   7344  -3547   3824  -2349       C
ATOM   8119  O   LYS D 113    -27.599   5.199  88.662  1.00 69.14          O
ANISOU 8119  O   LYS D 113   13495   5287   7490  -3962   3996  -2586       O
ATOM   8121  N   GLU D 114    -27.612   6.906  90.164  1.00 62.87          N
ANISOU 8121  N   GLU D 114   11848   5124   6918  -3699   3708  -2273       N
ATOM   8122  CA  GLU D 114    -28.892   6.540  90.760  1.00 66.67          C
ANISOU 8122  CA  GLU D 114   12337   5761   7234  -4366   3775  -2466       C
ATOM   8124  CB  GLU D 114    -28.821   6.646  92.280  1.00 66.50          C
ANISOU 8124  CB  GLU D 114   12305   5702   7258  -4362   3784  -2214       C
ATOM   8127  CG  GLU D 114    -27.749   5.750  92.900  1.00 69.36          C
ANISOU 8127  CG  GLU D 114   13302   5393   7658  -4063   3944  -1908       C
ATOM   8130  CD  GLU D 114    -28.288   4.471  93.528  1.00 75.92          C
ANISOU 8130  CD  GLU D 114   14781   5776   8288  -4600   4188  -1937       C
ATOM   8131  OE1 GLU D 114    -29.222   3.831  92.984  1.00 79.30          O
ANISOU 8131  OE1 GLU D 114   15417   6183   8533  -5204   4310  -2241       O
ATOM   8132  OE2 GLU D 114    -27.759   4.104  94.598  1.00 79.10          O
ANISOU 8132  OE2 GLU D 114   15508   5848   8700  -4433   4256  -1645       O
ATOM   8133  C   GLU D 114    -30.075   7.354  90.223  1.00 65.49          C
ANISOU 8133  C   GLU D 114   11578   6307   6997  -4684   3608  -2774       C
ATOM   8134  O   GLU D 114    -31.233   6.991  90.449  1.00 69.74          O
ANISOU 8134  O   GLU D 114   12071   7074   7353  -5293   3674  -3010       O
ATOM   8136  N   ASN D 115    -29.784   8.423  89.492  1.00 61.81          N
ANISOU 8136  N   ASN D 115   10662   6187   6636  -4276   3397  -2771       N
ATOM   8137  CA  ASN D 115    -30.808   9.280  88.879  1.00 60.27          C
ANISOU 8137  CA  ASN D 115    9900   6651   6348  -4440   3204  -3040       C
ATOM   8139  CB  ASN D 115    -31.514   8.575  87.708  1.00 64.82          C
ANISOU 8139  CB  ASN D 115   10629   7289   6711  -4864   3280  -3395       C
ATOM   8142  CG  ASN D 115    -30.789   8.780  86.385  1.00 63.31          C
ANISOU 8142  CG  ASN D 115   10496   7005   6553  -4473   3221  -3402       C
ATOM   8143  OD1 ASN D 115    -30.465   7.815  85.689  1.00 67.18          O
ANISOU 8143  OD1 ASN D 115   11474   7090   6960  -4569   3391  -3497       O
ATOM   8144  ND2 ASN D 115    -30.536  10.040  86.028  1.00 57.85          N
ANISOU 8144  ND2 ASN D 115    9341   6679   5961  -4037   2986  -3305       N
ATOM   8147  C   ASN D 115    -31.776   9.812  89.918  1.00 59.31          C
```

FIG. 18 (continued)

```
ANISOU 8147  C   ASN D 115     9364   6996   6175  -4695   3123  -3097      C
ATOM   8148  O   ASN D 115     -33.008   9.625  89.866  1.00 59.72         O
ANISOU 8148  O   ASN D 115     9209   7456   6028  -5209   3137  -3394      O
ATOM   8150  N   ARG D 116     -31.156  10.473  90.886  1.00 55.21         N
ANISOU 8150  N   ARG D 116     8719   6434   5824  -4321   3041  -2811      N
ATOM   8151  CA  ARG D 116     -31.861  11.178  91.909  1.00 54.92         C
ANISOU 8151  CA  ARG D 116     8272   6832   5762  -4406   2939  -2825      C
ATOM   8153  CB  ARG D 116     -32.158  10.247  93.089  1.00 57.46         C
ANISOU 8153  CB  ARG D 116     8906   6937   5991  -4832   3160  -2768      C
ATOM   8156  CG  ARG D 116     -30.933   9.769  93.872  1.00 56.88         C
ANISOU 8156  CG  ARG D 116     9304   6251   6057  -4542   3269  -2398      C
ATOM   8159  CD  ARG D 116     -31.259   8.495  94.619  1.00 61.09         C
ANISOU 8159  CD  ARG D 116    10347   6431   6434  -5048   3534  -2380      C
ATOM   8162  NE  ARG D 116     -30.146   7.972  95.408  1.00 61.14         N
ANISOU 8162  NE  ARG D 116    10837   5861   6533  -4747   3632  -2022      N
ATOM   8164  CZ  ARG D 116     -30.107   6.742  95.933  1.00 66.38         C
ANISOU 8164  CZ  ARG D 116    12131   6021   7071  -5055   3870  -1931      C
ATOM   8165  NH1 ARG D 116     -31.106   5.871  95.736  1.00 70.70         N
ANISOU 8165  NH1 ARG D 116    12933   6534   7395  -5745   4054  -2179      N
ATOM   8168  NH2 ARG D 116     -29.053   6.362  96.645  1.00 66.98         N
ANISOU 8168  NH2 ARG D 116    12611   5617   7221  -4679   3922  -1589      N
ATOM   8171  C   ARG D 116     -31.038  12.393  92.346  1.00 50.03         C
ANISOU 8171  C   ARG D 116     7397   6266   5347  -3812   2731  -2561      C
ATOM   8172  O   ARG D 116     -29.788  12.420  92.276  1.00 45.53         O
ANISOU 8172  O   ARG D 116     7054   5304   4944  -3416   2731  -2291      O
ATOM   8174  N   PHE D 117     -31.767  13.412  92.772  1.00 50.90         N
ANISOU 8174  N   PHE D 117     7023   6895   5421  -3760   2551  -2660      N
ATOM   8175  CA  PHE D 117     -31.178  14.538  93.462  1.00 48.16         C
ANISOU 8175  CA  PHE D 117     6469   6604   5225  -3307   2366  -2442      C
ATOM   8177  CB  PHE D 117     -32.169  15.701  93.498  1.00 48.26         C
ANISOU 8177  CB  PHE D 117     5958   7230   5150  -3216   2144  -2648      C
ATOM   8180  CG  PHE D 117     -32.494  16.241  92.140  1.00 48.56         C
ANISOU 8180  CG  PHE D 117     5792   7524   5135  -3070   1983  -2823      C
ATOM   8181  CD1 PHE D 117     -31.664  17.166  91.539  1.00 46.45         C
ANISOU 8181  CD1 PHE D 117     5514   7133   5003  -2605   1797  -2655      C
ATOM   8183  CE1 PHE D 117     -31.954  17.652  90.264  1.00 47.46         C
ANISOU 8183  CE1 PHE D 117     5497   7483   5053  -2468   1650  -2794      C
ATOM   8185  CZ  PHE D 117     -33.094  17.233  89.608  1.00 48.88         C
ANISOU 8185  CZ  PHE D 117     5499   8052   5019  -2774   1668  -3120      C
ATOM   8187  CE2 PHE D 117     -33.919  16.324  90.194  1.00 52.04         C
ANISOU 8187  CE2 PHE D 117     5874   8610   5290  -3262   1847  -3306      C
ATOM   8189  CD2 PHE D 117     -33.627  15.829  91.463  1.00 51.81         C
ANISOU 8189  CD2 PHE D 117     6026   8322   5337  -3422   2013  -3152      C
ATOM   8191  C   PHE D 117     -30.787  14.099  94.875  1.00 48.89         C
ANISOU 8191  C   PHE D 117     6781   6442   5354  -3374   2492  -2225      C
ATOM   8192  O   PHE D 117     -31.400  13.201  95.434  1.00 49.97         O
ANISOU 8192  O   PHE D 117     7081   6555   5351  -3815   2685  -2307      O
ATOM   8194  N   ILE D 118     -29.740  14.720  95.420  1.00 47.32         N
ANISOU 8194  N   ILE D 118     6603   6054   5323  -2959   2383  -1942      N
ATOM   8195  CA  ILE D 118     -29.320  14.505  96.797  1.00 47.01         C
ANISOU 8195  CA  ILE D 118     6718   5840   5306  -2946   2448  -1722      C
ATOM   8197  CB  ILE D 118     -27.891  13.939  96.918  1.00 47.31         C
ANISOU 8197  CB  ILE D 118     7144   5353   5478  -2679   2525  -1397      C
ATOM   8199  CG1 ILE D 118     -27.701  12.691  96.062  1.00 49.81         C
ANISOU 8199  CG1 ILE D 118     7877   5292   5755  -2835   2737  -1432      C
ATOM   8202  CD1 ILE D 118     -26.232  12.244  95.913  1.00 49.39         C
ANISOU 8202  CD1 ILE D 118     8150   4788   5829  -2442   2789  -1142      C
ATOM   8206  CG2 ILE D 118     -27.608  13.585  98.364  1.00 48.45         C
ANISOU 8206  CG2 ILE D 118     7471   5348   5590  -2709   2599  -1189      C
ATOM   8210  C   ILE D 118     -29.368  15.860  97.532  1.00 45.04         C
ANISOU 8210  C   ILE D 118     6099   5913   5100  -2672   2216  -1689      C
ATOM   8211  O   ILE D 118     -28.919  16.885  97.006  1.00 41.39         O
ANISOU 8211  O   ILE D 118     5455   5521   4748  -2326   2008  -1649      O
ATOM   8213  N   GLU D 119     -29.987  15.830  98.707  1.00 46.06         N
ANISOU 8213  N   GLU D 119     6148   6239   5113  -2865   2264  -1727      N
ATOM   8214  CA  GLU D 119     -30.020  16.926  99.676  1.00 44.99         C
ANISOU 8214  CA  GLU D 119     5755   6355   4983  -2636   2087  -1692      C
ATOM   8216  CB  GLU D 119     -31.459  17.139 100.187  1.00 46.74         C
ANISOU 8216  CB  GLU D 119     5655   7110   4994  -2899   2111  -1985      C
ATOM   8219  CG  GLU D 119     -31.664  18.288 101.215  1.00 47.51         C
ANISOU 8219  CG  GLU D 119     5485   7514   5052  -2649   1938  -2011      C
ATOM   8222  CD  GLU D 119     -31.211  19.650 100.693  1.00 46.09         C
ANISOU 8222  CD  GLU D 119     5150   7355   5007  -2170   1645  -1999      C
ATOM   8223  OE1 GLU D 119     -31.295  19.881  99.476  1.00 49.40         O
ANISOU 8223  OE1 GLU D 119     5500   7794   5474  -2073   1563  -2090      O
ATOM   8224  OE2 GLU D 119     -30.751  20.493 101.483  1.00 42.99         O
ANISOU 8224  OE2 GLU D 119     4739   6940   4656  -1909   1496  -1895      O
ATOM   8225  C   GLU D 119     -29.097  16.502 100.811  1.00 43.12         C
ANISOU 8225  C   GLU D 119     5805   5792   4788  -2574   2159  -1388      C
```

FIG. 18 (continued)

```
ATOM   8226  O   GLU D 119     -29.379  15.517 101.488  1.00 47.17          O
ANISOU 8226  O   GLU D 119     6547   6199   5176  -2887   2366  -1349       O
ATOM   8228  N   ILE D 120     -27.994  17.237 100.974  1.00 39.74          N
ANISOU 8228  N   ILE D 120     5372   5214   4512  -2187   1983  -1171       N
ATOM   8229  CA  ILE D 120     -26.963  16.959 101.960  1.00 40.48          C
ANISOU 8229  CA  ILE D 120     5688   5045   4646  -2051   1999   -869       C
ATOM   8231  CB  ILE D 120     -25.551  17.135 101.358  1.00 39.47          C
ANISOU 8231  CB  ILE D 120     5650   4644   4704  -1708   1904   -632       C
ATOM   8233  CG1 ILE D 120     -25.238  16.006 100.375  1.00 41.46          C
ANISOU 8233  CG1 ILE D 120     6181   4585   4987  -1761   2093   -596       C
ATOM   8236  CD1 ILE D 120     -24.019  16.294  99.514  1.00 39.46          C
ANISOU 8236  CD1 ILE D 120     5919   4184   4892  -1427   2007   -433       C
ATOM   8240  CG2 ILE D 120     -24.495  17.197 102.472  1.00 39.17          C
ANISOU 8240  CG2 ILE D 120     5708   4484   4689  -1507   1839   -343       C
ATOM   8244  C   ILE D 120     -27.122  17.910 103.162  1.00 40.12          C
ANISOU 8244  C   ILE D 120     5443   5261   4540  -1954   1845   -872       C
ATOM   8245  O   ILE D 120     -27.431  19.085 102.974  1.00 40.55          O
ANISOU 8245  O   ILE D 120     5223   5566   4619  -1794   1646  -1020       O
ATOM   8247  N   GLY D 121     -26.976  17.384 104.382  1.00 41.10          N
ANISOU 8247  N   GLY D 121     5739   5318   4557  -2051   1940   -724       N
ATOM   8248  CA  GLY D 121     -26.952  18.209 105.577  1.00 39.08          C
ANISOU 8248  CA  GLY D 121     5345   5273   4229  -1940   1798   -700       C
ATOM   8251  C   GLY D 121     -25.801  17.889 106.502  1.00 37.78          C
ANISOU 8251  C   GLY D 121     5407   4876   4071  -1790   1778   -376       C
ATOM   8252  O   GLY D 121     -25.329  16.757 106.544  1.00 39.35          O
ANISOU 8252  O   GLY D 121     5921   4775   4254  -1843   1942   -179       O
ATOM   8254  N   VAL D 122     -25.368  18.894 107.262  1.00 36.46          N
ANISOU 8254  N   VAL D 122     5098   4851   3904  -1591   1566   -331       N
ATOM   8255  CA  VAL D 122     -24.340  18.724 108.269  1.00 36.50          C
ANISOU 8255  CA  VAL D 122     5255   4740   3874  -1450   1508    -49       C
ATOM   8257  CB  VAL D 122     -22.981  19.424 107.880  1.00 34.26          C
ANISOU 8257  CB  VAL D 122     4887   4361   3770  -1144   1283    125       C
ATOM   8259  CG1 VAL D 122     -21.909  19.099 108.889  1.00 32.92          C
ANISOU 8259  CG1 VAL D 122     4846   4125   3537  -1000   1228    418       C
ATOM   8263  CG2 VAL D 122     -22.493  19.057 106.416  1.00 32.44          C
ANISOU 8263  CG2 VAL D 122     4683   3921   3722  -1056   1338    170       C
ATOM   8267  C   VAL D 122     -24.884  19.324 109.576  1.00 37.96          C
ANISOU 8267  C   VAL D 122     5341   5211   3870  -1511   1439   -145       C
ATOM   8268  O   VAL D 122     -25.423  20.435 109.575  1.00 36.80          O
ANISOU 8268  O   VAL D 122     4957   5311   3716  -1456   1291   -377       O
ATOM   8270  N   THR D 123     -24.723  18.596 110.679  1.00 40.96          N
ANISOU 8270  N   THR D 123     5935   5550   4080  -1594   1544     35       N
ATOM   8271  CA  THR D 123     -25.297  18.980 111.974  1.00 42.18          C
ANISOU 8271  CA  THR D 123     6032   5990   4005  -1688   1528    -51       C
ATOM   8273  CB  THR D 123     -26.639  18.195 112.279  1.00 45.16          C
ANISOU 8273  CB  THR D 123     6466   6527   4165  -2073   1811   -204       C
ATOM   8275  OG1 THR D 123     -27.230  18.695 113.484  1.00 44.01          O
ANISOU 8275  OG1 THR D 123     6209   6731   3783  -2140   1796   -321       O
ATOM   8277  CG2 THR D 123     -26.427  16.668 112.426  1.00 47.48          C
ANISOU 8277  CG2 THR D 123     7177   6491   4371  -2275   2061     52       C
ATOM   8281  C   THR D 123     -24.298  18.780 113.115  1.00 43.69          C
ANISOU 8281  C   THR D 123     6403   6107   4089  -1552   1446    243       C
ATOM   8282  O   THR D 123     -23.466  17.885 113.058  1.00 44.42          O
ANISOU 8282  O   THR D 123     6742   5923   4212  -1466   1507    526       O
ATOM   8284  N   ARG D 124     -24.386  19.634 114.135  1.00 43.73          N
ANISOU 8284  N   ARG D 124     6288   6376   3952  -1501   1297    162       N
ATOM   8285  CA  ARG D 124     -23.655  19.460 115.397  1.00 47.85          C
ANISOU 8285  CA  ARG D 124     6965   6921   4295  -1419   1223    400       C
ATOM   8287  CB  ARG D 124     -23.190  20.797 115.950  1.00 46.96          C
ANISOU 8287  CB  ARG D 124     6661   7011   4171  -1244    925    307       C
ATOM   8290  CG  ARG D 124     -22.295  21.561 115.039  1.00 45.42          C
ANISOU 8290  CG  ARG D 124     6321   6700   4236  -1053    702    322       C
ATOM   8293  CD  ARG D 124     -22.711  23.015 115.063  1.00 45.07          C
ANISOU 8293  CD  ARG D 124     6091   6835   4201  -1011    501     21       C
ATOM   8296  NE  ARG D 124     -23.282  23.388 113.807  1.00 42.93          N
ANISOU 8296  NE  ARG D 124     5700   6498   4114  -1006    523   -177       N
ATOM   8298  CZ  ARG D 124     -23.889  24.541 113.569  1.00 42.45          C
ANISOU 8298  CZ  ARG D 124     5518   6549   4064   -938    390   -464       C
ATOM   8299  NH1 ARG D 124     -24.047  25.461 114.516  1.00 41.94          N
ANISOU 8299  NH1 ARG D 124     5448   6652   3837   -876    234   -619       N
ATOM   8302  NH2 ARG D 124     -24.357  24.758 112.356  1.00 41.22          N
ANISOU 8302  NH2 ARG D 124     5271   6326   4063   -909    412   -604       N
ATOM   8305  C   ARG D 124     -24.516  18.810 116.486  1.00 50.53          C
ANISOU 8305  C   ARG D 124     7465   7413   4321  -1672   1436    396       C
ATOM   8306  O   ARG D 124     -24.027  18.622 117.598  1.00 51.97          O
ANISOU 8306  O   ARG D 124     7802   7638   4306  -1620   1390    592       O
ATOM   8308  N   ARG D 125     -25.777  18.495 116.172  1.00 52.62          N
ANISOU 8308  N   ARG D 125     7678   7800   4517  -1958   1662    174       N
ATOM   8309  CA  ARG D 125     -26.701  17.844 117.113  1.00 58.19          C
```

FIG. 18 (continued)

| | | | | | | | | | | | | | |
|---|---|---|---|---|---|---|---|---|---|---|---|---|---|
| ANISOU | 8309 | CA | ARG | D | 125 | 8512 | 8694 | 4902 | -2284 | 1906 | 152 | | C |
| ATOM | 8311 | CB | ARG | D | 125 | -28.020 | 18.617 | 117.170 | 1.00 | 58.97 | | | C |
| ANISOU | 8311 | CB | ARG | D | 125 | 8260 | 9258 | 4890 | -2426 | 1951 | -253 | | C |
| ATOM | 8314 | CG | ARG | D | 125 | -27.839 | 20.088 | 117.451 | 1.00 | 59.01 | | | C |
| ANISOU | 8314 | CG | ARG | D | 125 | 7999 | 9492 | 4932 | -2112 | 1663 | -451 | | C |
| ATOM | 8317 | CD | ARG | D | 125 | -29.128 | 20.808 | 117.750 | 1.00 | 62.38 | | | C |
| ANISOU | 8317 | CD | ARG | D | 125 | 8120 | 10407 | 5175 | -2175 | 1714 | -840 | | C |
| ATOM | 8320 | NE | ARG | D | 125 | -29.306 | 20.988 | 119.197 | 1.00 | 68.16 | | | N |
| ANISOU | 8320 | NE | ARG | D | 125 | 8893 | 11425 | 5581 | -2209 | 1737 | -849 | | N |
| ATOM | 8322 | CZ | ARG | D | 125 | -30.239 | 20.409 | 119.963 | 1.00 | 72.14 | | | C |
| ANISOU | 8322 | CZ | ARG | D | 125 | 9391 | 12255 | 5765 | -2524 | 2003 | -911 | | C |
| ATOM | 8323 | NH1 | ARG | D | 125 | -31.151 | 19.570 | 119.462 | 1.00 | 73.89 | | | N |
| ANISOU | 8323 | NH1 | ARG | D | 125 | 9561 | 12581 | 5933 | -2889 | 2284 | -982 | | N |
| ATOM | 8326 | NH2 | ARG | D | 125 | -30.260 | 20.686 | 121.269 | 1.00 | 74.96 | | | N |
| ANISOU | 8326 | NH2 | ARG | D | 125 | 9794 | 12865 | 5824 | -2504 | 1991 | -911 | | N |
| ATOM | 8329 | C | ARG | D | 125 | -26.944 | 16.392 | 116.675 | 1.00 | 60.39 | | | C |
| ANISOU | 8329 | C | ARG | D | 125 | 9127 | 8666 | 5152 | -2575 | 2197 | 314 | | C |
| ATOM | 8330 | O | ARG | D | 125 | -26.346 | 15.931 | 115.705 | 1.00 | 59.45 | | | O |
| ANISOU | 8330 | O | ARG | D | 125 | 9140 | 8192 | 5257 | -2464 | 2192 | 435 | | O |
| ATOM | 8332 | N | GLU | D | 126 | -27.808 | 15.683 | 117.398 | 1.00 | 63.77 | | | N |
| ANISOU | 8332 | N | GLU | D | 126 | 9718 | 9228 | 5284 | -2959 | 2455 | 310 | | N |
| ATOM | 8333 | CA | GLU | D | 126 | -28.166 | 14.294 | 117.070 | 1.00 | 67.01 | | | C |
| ANISOU | 8333 | CA | GLU | D | 126 | 10515 | 9331 | 5613 | -3330 | 2754 | 442 | | C |
| ATOM | 8335 | CB | GLU | D | 126 | -29.205 | 13.790 | 118.077 | 1.00 | 73.10 | | | C |
| ANISOU | 8335 | CB | GLU | D | 126 | 11394 | 10381 | 5999 | -3806 | 3020 | 402 | | C |
| ATOM | 8338 | CG | GLU | D | 126 | -28.770 | 13.855 | 119.527 | 1.00 | 75.82 | | | C |
| ANISOU | 8338 | CG | GLU | D | 126 | 11916 | 10819 | 6072 | -3699 | 2967 | 627 | | C |
| ATOM | 8341 | CD | GLU | D | 126 | -28.207 | 12.547 | 120.028 | 1.00 | 80.87 | | | C |
| ANISOU | 8341 | CD | GLU | D | 126 | 13203 | 10986 | 6537 | -3798 | 3118 | 1048 | | C |
| ATOM | 8342 | OE1 | GLU | D | 126 | -27.401 | 11.942 | 119.282 | 1.00 | 80.61 | | | O |
| ANISOU | 8342 | OE1 | GLU | D | 126 | 13462 | 10452 | 6713 | -3593 | 3082 | 1251 | | O |
| ATOM | 8343 | OE2 | GLU | D | 126 | -28.571 | 12.134 | 121.165 | 1.00 | 84.10 | | | O |
| ANISOU | 8343 | OE2 | GLU | D | 126 | 13846 | 11529 | 6581 | -4057 | 3273 | 1176 | | O |
| ATOM | 8344 | C | GLU | D | 126 | -28.759 | 14.233 | 115.675 | 1.00 | 64.87 | | | C |
| ANISOU | 8344 | C | GLU | D | 126 | 10063 | 9031 | 5553 | -3482 | 2827 | 193 | | C |
| ATOM | 8345 | O | GLU | D | 126 | -29.687 | 14.991 | 115.397 | 1.00 | 63.19 | | | O |
| ANISOU | 8345 | O | GLU | D | 126 | 9415 | 9255 | 5338 | -3579 | 2810 | -154 | | O |
| ATOM | 8347 | N | VAL | D | 127 | -28.237 | 13.347 | 114.810 | 1.00 | 64.37 | | | N |
| ANISOU | 8347 | N | VAL | D | 127 | 10334 | 8479 | 5646 | -3472 | 2902 | 357 | | N |
| ATOM | 8348 | CA | VAL | D | 127 | -28.546 | 13.371 | 113.350 | 1.00 | 61.22 | | | C |
| ANISOU | 8348 | CA | VAL | D | 127 | 9767 | 8011 | 5482 | -3521 | 2915 | 139 | | C |
| ATOM | 8350 | CB | VAL | D | 127 | -27.917 | 12.188 | 112.525 | 1.00 | 61.96 | | | C |
| ANISOU | 8350 | CB | VAL | D | 127 | 10349 | 7504 | 5690 | -3519 | 3039 | 348 | | C |
| ATOM | 8352 | CG1 | VAL | D | 127 | -26.514 | 12.526 | 112.045 | 1.00 | 59.50 | | | C |
| ANISOU | 8352 | CG1 | VAL | D | 127 | 10041 | 6924 | 5640 | -2951 | 2805 | 544 | | C |
| ATOM | 8356 | CG2 | VAL | D | 127 | -27.971 | 10.865 | 113.276 | 1.00 | 65.94 | | | C |
| ANISOU | 8356 | CG2 | VAL | D | 127 | 11460 | 7663 | 5930 | -3824 | 3292 | 605 | | C |
| ATOM | 8360 | C | VAL | D | 127 | -30.023 | 13.348 | 112.984 | 1.00 | 62.62 | | | C |
| ANISOU | 8360 | C | VAL | D | 127 | 9679 | 8578 | 5536 | -3998 | 3096 | -216 | | C |
| ATOM | 8361 | O | VAL | D | 127 | -30.410 | 13.962 | 111.980 | 1.00 | 57.35 | | | O |
| ANISOU | 8361 | O | VAL | D | 127 | 8647 | 8106 | 5037 | -3929 | 3001 | -484 | | O |
| ATOM | 8363 | N | HIS | D | 128 | -30.835 | 12.626 | 113.772 | 1.00 | 66.21 | | | N |
| ANISOU | 8363 | N | HIS | D | 128 | 10312 | 9167 | 5679 | -4490 | 3355 | -213 | | N |
| ATOM | 8364 | CA | HIS | D | 128 | -32.239 | 12.434 | 113.432 | 1.00 | 69.81 | | | C |
| ANISOU | 8364 | CA | HIS | D | 128 | 10516 | 10033 | 5977 | -5023 | 3560 | -540 | | C |
| ATOM | 8366 | CB | HIS | D | 128 | -32.916 | 11.422 | 114.382 | 1.00 | 76.38 | | | C |
| ANISOU | 8366 | CB | HIS | D | 128 | 11680 | 10906 | 6434 | -5628 | 3881 | -443 | | C |
| ATOM | 8369 | CG | HIS | D | 128 | -32.972 | 11.867 | 115.817 | 1.00 | 78.46 | | | C |
| ANISOU | 8369 | CG | HIS | D | 128 | 11862 | 11499 | 6450 | -5567 | 3868 | -360 | | C |
| ATOM | 8370 | ND1 | HIS | D | 128 | -31.957 | 11.612 | 116.717 | 1.00 | 79.36 | | | N |
| ANISOU | 8370 | ND1 | HIS | D | 128 | 12401 | 11245 | 6507 | -5303 | 3803 | 19 | | N |
| ATOM | 8372 | CE1 | HIS | D | 128 | -32.276 | 12.121 | 117.895 | 1.00 | 79.89 | | | C |
| ANISOU | 8372 | CE1 | HIS | D | 128 | 12287 | 11748 | 6321 | -5317 | 3803 | -9 | | C |
| ATOM | 8374 | NE2 | HIS | D | 128 | -33.454 | 12.709 | 117.789 | 1.00 | 79.60 | | | N |
| ANISOU | 8374 | NE2 | HIS | D | 128 | 11712 | 12351 | 6180 | -5549 | 3871 | -397 | | N |
| ATOM | 8376 | CD2 | HIS | D | 128 | -33.919 | 12.552 | 116.506 | 1.00 | 79.55 | | | C |
| ANISOU | 8376 | CD2 | HIS | D | 128 | 11535 | 12331 | 6360 | -5711 | 3908 | -618 | | C |
| ATOM | 8378 | C | HIS | D | 128 | -32.999 | 13.757 | 113.414 | 1.00 | 67.86 | | | C |
| ANISOU | 8378 | C | HIS | D | 128 | 9585 | 10468 | 5730 | -4862 | 3405 | -905 | | C |
| ATOM | 8379 | O | HIS | D | 128 | -33.941 | 13.938 | 112.643 | 1.00 | 68.24 | | | O |
| ANISOU | 8379 | O | HIS | D | 128 | 9273 | 10878 | 5776 | -5065 | 3449 | -1227 | | O |
| ATOM | 8381 | N | ILE | D | 129 | -32.575 | 14.689 | 114.254 | 1.00 | 66.39 | | | N |
| ANISOU | 8381 | N | ILE | D | 129 | 9238 | 10455 | 5530 | -4469 | 3210 | -863 | | N |
| ATOM | 8382 | CA | ILE | D | 129 | -33.272 | 15.963 | 114.394 | 1.00 | 64.79 | | | C |
| ANISOU | 8382 | CA | ILE | D | 129 | 8471 | 10860 | 5286 | -4260 | 3062 | -1202 | | C |
| ATOM | 8384 | CB | ILE | D | 129 | -32.654 | 16.850 | 115.527 | 1.00 | 63.63 | | | C |
| ANISOU | 8384 | CB | ILE | D | 129 | 8299 | 10796 | 5080 | -3863 | 2863 | -1106 | | C |
| ATOM | 8386 | CG1 | ILE | D | 129 | -32.864 | 16.198 | 116.900 | 1.00 | 67.65 | | | C |
| ANISOU | 8386 | CG1 | ILE | D | 129 | 9048 | 11418 | 5238 | -4182 | 3076 | -943 | | C |

FIG. 18 (continued)

| | | | | | | | | | | | | | |
|---|---|---|---|---|---|---|---|---|---|---|---|---|---|
| ATOM | 8389 | CD1 | ILE | D | 129 | -31.874 | 16.671 | 117.989 | 1.00 | 66.81 | | | C |
| ANISOU | 8389 | CD1 | ILE | D | 129 | 9119 | 11183 | 5084 | -3823 | 2887 | -712 | | C |
| ATOM | 8393 | CG2 | ILE | D | 129 | -33.257 | 18.242 | 115.508 | 1.00 | 61.97 | | | C |
| ANISOU | 8393 | CG2 | ILE | D | 129 | 7581 | 11101 | 4864 | -3550 | 2675 | -1468 | | C |
| ATOM | 8397 | C | ILE | D | 129 | -33.271 | 16.715 | 113.071 | 1.00 | 60.60 | | | C |
| ANISOU | 8397 | C | ILE | D | 129 | 7636 | 10348 | 5039 | -3955 | 2856 | -1414 | | C |
| ATOM | 8398 | O | ILE | D | 129 | -34.322 | 17.117 | 112.579 | 1.00 | 60.51 | | | O |
| ANISOU | 8398 | O | ILE | D | 129 | 7211 | 10816 | 4965 | -4045 | 2875 | -1754 | | O |
| ATOM | 8400 | N | TYR | D | 130 | -32.083 | 16.911 | 112.501 | 1.00 | 56.79 | | | N |
| ANISOU | 8400 | N | TYR | D | 130 | 7350 | 9381 | 4847 | -3583 | 2658 | -1208 | | N |
| ATOM | 8401 | CA | TYR | D | 130 | -31.967 | 17.649 | 111.258 | 1.00 | 53.65 | | | C |
| ANISOU | 8401 | CA | TYR | D | 130 | 6717 | 8962 | 4706 | -3287 | 2457 | -1365 | | C |
| ATOM | 8403 | CB | TYR | D | 130 | -30.525 | 18.155 | 111.054 | 1.00 | 50.34 | | | C |
| ANISOU | 8403 | CB | TYR | D | 130 | 6469 | 8111 | 4547 | -2835 | 2207 | -1115 | | C |
| ATOM | 8406 | CG | TYR | D | 130 | -30.397 | 19.168 | 109.961 | 1.00 | 47.56 | | | C |
| ANISOU | 8406 | CG | TYR | D | 130 | 5872 | 7784 | 4416 | -2508 | 1974 | -1273 | | C |
| ATOM | 8407 | CD1 | TYR | D | 130 | -31.306 | 20.212 | 109.863 | 1.00 | 48.14 | | | C |
| ANISOU | 8407 | CD1 | TYR | D | 130 | 5568 | 8304 | 4417 | -2370 | 1857 | -1602 | | C |
| ATOM | 8409 | CE1 | TYR | D | 130 | -31.204 | 21.150 | 108.889 | 1.00 | 45.80 | | | C |
| ANISOU | 8409 | CE1 | TYR | D | 130 | 5111 | 7999 | 4292 | -2058 | 1638 | -1725 | | C |
| ATOM | 8411 | CZ | TYR | D | 130 | -30.164 | 21.084 | 107.994 | 1.00 | 43.18 | | | C |
| ANISOU | 8411 | CZ | TYR | D | 130 | 4960 | 7237 | 4208 | -1914 | 1541 | -1522 | | C |
| ATOM | 8412 | OH | TYR | D | 130 | -30.109 | 22.044 | 107.037 | 1.00 | 42.25 | | | O |
| ANISOU | 8412 | OH | TYR | D | 130 | 4705 | 7122 | 4227 | -1634 | 1331 | -1638 | | O |
| ATOM | 8414 | CE2 | TYR | D | 130 | -29.217 | 20.080 | 108.071 | 1.00 | 42.50 | | | C |
| ANISOU | 8414 | CE2 | TYR | D | 130 | 5196 | 6748 | 4204 | -2029 | 1656 | -1210 | | C |
| ATOM | 8416 | CD2 | TYR | D | 130 | -29.337 | 19.126 | 109.060 | 1.00 | 45.24 | | | C |
| ANISOU | 8416 | CD2 | TYR | D | 130 | 5735 | 7075 | 4378 | -2301 | 1864 | -1085 | | C |
| ATOM | 8418 | C | TYR | D | 130 | -32.458 | 16.825 | 110.062 | 1.00 | 53.65 | | | C |
| ANISOU | 8418 | C | TYR | D | 130 | 6748 | 8872 | 4762 | -3600 | 2615 | -1465 | | C |
| ATOM | 8419 | O | TYR | D | 130 | -32.981 | 17.381 | 109.113 | 1.00 | 51.75 | | | O |
| ANISOU | 8419 | O | TYR | D | 130 | 6192 | 8867 | 4603 | -3504 | 2517 | -1717 | | O |
| ATOM | 8421 | N | TYR | D | 131 | -32.309 | 15.507 | 110.123 | 1.00 | 56.24 | | | N |
| ANISOU | 8421 | N | TYR | D | 131 | 7486 | 8858 | 5024 | -3971 | 2853 | -1273 | | N |
| ATOM | 8422 | CA | TYR | D | 131 | -32.912 | 14.620 | 109.120 | 1.00 | 59.83 | | | C |
| ANISOU | 8422 | CA | TYR | D | 131 | 8018 | 9247 | 5467 | -4376 | 3039 | -1401 | | C |
| ATOM | 8424 | CB | TYR | D | 131 | -32.595 | 13.152 | 109.412 | 1.00 | 63.40 | | | C |
| ANISOU | 8424 | CB | TYR | D | 131 | 9070 | 9202 | 5818 | -4756 | 3300 | -1139 | | C |
| ATOM | 8427 | CG | TYR | D | 131 | -33.205 | 12.214 | 108.404 | 1.00 | 66.13 | | | C |
| ANISOU | 8427 | CG | TYR | D | 131 | 9560 | 9437 | 6130 | -5220 | 3494 | -1288 | | C |
| ATOM | 8428 | CD1 | TYR | D | 131 | -32.579 | 11.959 | 107.194 | 1.00 | 65.06 | | | C |
| ANISOU | 8428 | CD1 | TYR | D | 131 | 9605 | 8890 | 6224 | -5032 | 3431 | -1252 | | C |
| ATOM | 8430 | CE1 | TYR | D | 131 | -33.145 | 11.097 | 106.263 | 1.00 | 67.20 | | | C |
| ANISOU | 8430 | CE1 | TYR | D | 131 | 10035 | 9055 | 6443 | -5473 | 3603 | -1414 | | C |
| ATOM | 8432 | CZ | TYR | D | 131 | -34.349 | 10.486 | 106.538 | 1.00 | 71.35 | | | C |
| ANISOU | 8432 | CZ | TYR | D | 131 | 10522 | 9902 | 6686 | -6151 | 3838 | -1610 | | C |
| ATOM | 8433 | OH | TYR | D | 131 | -34.912 | 9.633 | 105.617 | 1.00 | 74.43 | | | O |
| ANISOU | 8433 | OH | TYR | D | 131 | 11081 | 10196 | 7005 | -6643 | 4001 | -1789 | | O |
| ATOM | 8435 | CE2 | TYR | D | 131 | -34.993 | 10.728 | 107.721 | 1.00 | 73.18 | | | C |
| ANISOU | 8435 | CE2 | TYR | D | 131 | 10541 | 10580 | 6685 | -6365 | 3916 | -1641 | | C |
| ATOM | 8437 | CD2 | TYR | D | 131 | -34.421 | 11.586 | 108.653 | 1.00 | 70.61 | | | C |
| ANISOU | 8437 | CD2 | TYR | D | 131 | 10074 | 10342 | 6411 | -5880 | 3746 | -1481 | | C |
| ATOM | 8439 | C | TYR | D | 131 | -34.428 | 14.788 | 109.005 | 1.00 | 63.10 | | | C |
| ANISOU | 8439 | C | TYR | D | 131 | 7978 | 10332 | 5664 | -4747 | 3147 | -1787 | | C |
| ATOM | 8440 | O | TYR | D | 131 | -34.931 | 14.967 | 107.887 | 1.00 | 62.00 | | | O |
| ANISOU | 8440 | O | TYR | D | 131 | 7581 | 10378 | 5596 | -4772 | 3096 | -2026 | | O |
| ATOM | 8442 | N | LEU | D | 132 | -35.144 | 14.703 | 110.133 | 1.00 | 66.43 | | | N |
| ANISOU | 8442 | N | LEU | D | 132 | 8289 | 11152 | 5799 | -5035 | 3297 | -1847 | | N |
| ATOM | 8443 | CA | LEU | D | 132 | -36.606 | 14.843 | 110.131 | 1.00 | 71.49 | | | C |
| ANISOU | 8443 | CA | LEU | D | 132 | 8438 | 12539 | 6187 | -5399 | 3419 | -2222 | | C |
| ATOM | 8445 | CB | LEU | D | 132 | -37.205 | 14.471 | 111.493 | 1.00 | 75.74 | | | C |
| ANISOU | 8445 | CB | LEU | D | 132 | 8985 | 13416 | 6377 | -5798 | 3652 | -2201 | | C |
| ATOM | 8448 | CG | LEU | D | 132 | -37.033 | 13.000 | 111.897 | 1.00 | 78.80 | | | C |
| ANISOU | 8448 | CG | LEU | D | 132 | 9979 | 13346 | 6615 | -6394 | 3954 | -1929 | | C |
| ATOM | 8450 | CD1 | LEU | D | 132 | -37.310 | 12.829 | 113.383 | 1.00 | 82.30 | | | C |
| ANISOU | 8450 | CD1 | LEU | D | 132 | 10503 | 14033 | 6734 | -6637 | 4128 | -1819 | | C |
| ATOM | 8454 | CD2 | LEU | D | 132 | -37.927 | 12.062 | 111.016 | 1.00 | 82.90 | | | C |
| ANISOU | 8454 | CD2 | LEU | D | 132 | 10500 | 13977 | 7022 | -7067 | 4180 | -2129 | | C |
| ATOM | 8458 | C | LEU | D | 132 | -37.068 | 16.239 | 109.680 | 1.00 | 70.65 | | | C |
| ANISOU | 8458 | C | LEU | D | 132 | 7737 | 12958 | 6150 | -4913 | 3156 | -2535 | | C |
| ATOM | 8459 | O | LEU | D | 132 | -38.091 | 16.361 | 109.000 | 1.00 | 71.56 | | | O |
| ANISOU | 8459 | O | LEU | D | 132 | 7433 | 13589 | 6166 | -5077 | 3178 | -2860 | | O |
| ATOM | 8461 | N | GLU | D | 133 | -36.305 | 17.281 | 110.017 | 1.00 | 68.71 | | | N |
| ANISOU | 8461 | N | GLU | D | 133 | 7480 | 12569 | 6059 | -4316 | 2898 | -2440 | | N |
| ATOM | 8462 | CA | GLU | D | 133 | -36.576 | 18.623 | 109.489 | 1.00 | 68.04 | | | C |
| ANISOU | 8462 | CA | GLU | D | 133 | 6973 | 12816 | 6063 | -3795 | 2621 | -2695 | | C |
| ATOM | 8464 | CB | GLU | D | 133 | -35.521 | 19.607 | 109.986 | 1.00 | 65.89 | | | C |
| ANISOU | 8464 | CB | GLU | D | 133 | 6856 | 12223 | 5955 | -3239 | 2362 | -2519 | | C |
| ATOM | 8467 | CG | GLU | D | 133 | -35.885 | 21.068 | 109.756 | 1.00 | 66.64 | | | C |

FIG. 18 (continued)

```
ANISOU 8467  CG  GLU D 133     6593  12661   6068  -2709   2091  -2786      C
ATOM   8470  CD  GLU D 133    -35.023  22.042 110.573  1.00 65.17          C
ANISOU 8470  CD  GLU D 133     6569  12244   5947  -2271   1871  -2659      C
ATOM   8471  OE1 GLU D 133    -34.954  21.887 111.819  1.00 66.34          O
ANISOU 8471  OE1 GLU D 133     6810  12476   5922  -2378   1967  -2579      O
ATOM   8472  OE2 GLU D 133    -34.425  22.962 109.959  1.00 63.90          O
ANISOU 8472  OE2 GLU D 133     6459  11828   5991  -1851   1603  -2641      O
ATOM   8473  C   GLU D 133    -36.619  18.600 107.951  1.00 66.32          C
ANISOU 8473  C   GLU D 133     6679  12487   6033  -3738   2525  -2796      C
ATOM   8474  O   GLU D 133    -37.523  19.176 107.325  1.00 67.01          O
ANISOU 8474  O   GLU D 133     6328  13086   6045  -3623   2436  -3115      O
ATOM   8476  N   LYS D 134    -35.670  17.876 107.366  1.00 64.48          N
ANISOU 8476  N   LYS D 134     6875  11616   6009  -3817   2556  -2529      N
ATOM   8477  CA  LYS D 134    -35.569  17.741 105.923  1.00 64.59          C
ANISOU 8477  CA  LYS D 134     6893  11457   6192  -3781   2486  -2588      C
ATOM   8479  CB  LYS D 134    -34.152  17.310 105.523  1.00 61.79          C
ANISOU 8479  CB  LYS D 134     7026  10352   6100  -3628   2450  -2239      C
ATOM   8482  CG  LYS D 134    -33.103  18.426 105.626  1.00 58.32          C
ANISOU 8482  CG  LYS D 134     6614   9677   5868  -3045   2169  -2075      C
ATOM   8485  CD  LYS D 134    -31.801  18.028 104.917  1.00 56.18          C
ANISOU 8485  CD  LYS D 134     6707   8795   5844  -2892   2131  -1788      C
ATOM   8488  CE  LYS D 134    -30.840  19.209 104.668  1.00 52.41          C
ANISOU 8488  CE  LYS D 134     6190   8154   5570  -2380   1841  -1674      C
ATOM   8491  NZ  LYS D 134    -31.500  20.449 104.149  1.00 51.19          N
ANISOU 8491  NZ  LYS D 134     5683   8363   5405  -2115   1626  -1938      N
ATOM   8495  C   LYS D 134    -36.627  16.754 105.384  1.00 68.56          C
ANISOU 8495  C   LYS D 134     7283  12257   6509  -4379   2720  -2806      C
ATOM   8496  O   LYS D 134    -37.406  17.107 104.503  1.00 68.01          O
ANISOU 8496  O   LYS D 134     6838  12609   6394  -4358   2638  -3092      O
ATOM   8498  N   ALA D 135    -36.659  15.543 105.949  1.00 72.07          N
ANISOU 8498  N   ALA D 135     8069  12493   6823  -4917   3001  -2670      N
ATOM   8499  CA  ALA D 135    -37.582  14.463 105.536  1.00 77.24          C
ANISOU 8499  CA  ALA D 135     8727  13344   7277  -5608   3256  -2847      C
ATOM   8501  CB  ALA D 135    -37.301  13.192 106.333  1.00 79.63          C
ANISOU 8501  CB  ALA D 135     9591  13207   7458  -6116   3547  -2592      C
ATOM   8505  C   ALA D 135    -39.085  14.805 105.599  1.00 83.22          C
ANISOU 8505  C   ALA D 135     8843  15028   7750  -5877   3303  -3252      C
ATOM   8506  O   ALA D 135    -39.870  14.323 104.776  1.00 83.68          O
ANISOU 8506  O   ALA D 135     8718  15382   7694  -6287   3387  -3493      O
ATOM   8508  N   ASN D 136    -39.485  15.649 106.545  1.00 86.51          N
ANISOU 8508  N   ASN D 136     8898  15937   8033  -5629   3241  -3346      N
ATOM   8509  CA  ASN D 136    -40.858  16.158 106.561  1.00 93.52          C
ANISOU 8509  CA  ASN D 136     9101  17779   8654  -5718   3244  -3751      C
ATOM   8511  CB  ASN D 136    -41.110  16.956 107.838  1.00 94.43          C
ANISOU 8511  CB  ASN D 136     8958  18313   8608  -5433   3220  -3796      C
ATOM   8514  CG  ASN D 136    -41.122  16.079 109.075  1.00 97.17          C
ANISOU 8514  CG  ASN D 136     9595  18582   8744  -5971   3523  -3612      C
ATOM   8515  OD1 ASN D 136    -41.337  14.865 108.992  1.00 98.97          O
ANISOU 8515  OD1 ASN D 136    10091  18657   8856  -6668   3788  -3544      O
ATOM   8516  ND2 ASN D 136    -40.880  16.688 110.230  1.00 96.68          N
ANISOU 8516  ND2 ASN D 136     9526  18599   8611  -5659   3484  -3527      N
ATOM   8519  C   ASN D 136    -41.208  17.009 105.335  1.00 95.72          C
ANISOU 8519  C   ASN D 136     8965  18375   9029  -5281   2975  -4009      C
ATOM   8520  O   ASN D 136    -42.308  17.565 105.261  1.00 97.76          O
ANISOU 8520  O   ASN D 136     8616  19457   9069  -5210   2925  -4355      O
ATOM   8522  N   LYS D 137    -40.275  17.092 104.384  1.00 96.51          N
ANISOU 8522  N   LYS D 137     9392  17850   9428  -4980   2809  -3837      N
ATOM   8523  CA  LYS D 137    -40.450  17.843 103.141  1.00 99.29          C
ANISOU 8523  CA  LYS D 137     9465  18382   9879  -4565   2549  -4021      C
ATOM   8525  CB  LYS D 137    -39.456  19.027 103.100  1.00 95.62          C
ANISOU 8525  CB  LYS D 137     9153  17505   9673  -3794   2251  -3837      C
ATOM   8528  CG  LYS D 137    -38.278  18.896 102.098  1.00 92.84          C
ANISOU 8528  CG  LYS D 137     9235  16412   9627  -3607   2141  -3584      C
ATOM   8531  CD  LYS D 137    -37.217  19.988 102.277  1.00 88.99          C
ANISOU 8531  CD  LYS D 137     8934  15511   9367  -2972   1888  -3367      C
ATOM   8534  CE  LYS D 137    -35.839  19.415 102.624  1.00 87.10          C
ANISOU 8534  CE  LYS D 137     9234  14519   9342  -3022   1965  -2974      C
ATOM   8537  NZ  LYS D 137    -35.386  18.361 101.666  1.00 86.63          N
ANISOU 8537  NZ  LYS D 137     9482  14042   9390  -3311   2095  -2862      N
ATOM   8541  C   LYS D 137    -40.316  16.985 101.869  1.00100.57          C
ANISOU 8541  C   LYS D 137     9842  18247  10123  -4902   2604  -4024      C
ATOM   8542  O   LYS D 137    -40.365  17.528 100.762  1.00100.78          O
ANISOU 8542  O   LYS D 137     9700  18363  10230  -4574   2392  -4142      O
ATOM   8544  N   ILE D 138    -40.160  15.663 102.010  1.00103.74          N
ANISOU 8544  N   ILE D 138    10646  18286  10483  -5541   2882  -3901      N
ATOM   8545  CA  ILE D 138    -40.045  14.773 100.838  1.00104.42          C
ANISOU 8545  CA  ILE D 138    10999  18057  10619  -5892   2955  -3929      C
ATOM   8547  CB  ILE D 138    -39.441  13.369 101.157  1.00105.66          C
ANISOU 8547  CB  ILE D 138    11844  17506  10796  -6428   3243  -3676      C
```

FIG. 18 (continued)

```
ATOM   8549  CG1 ILE D 138    -38.190  13.452 102.029  1.00101.78          C
ANISOU 8549  CG1 ILE D 138   11813  16352  10506  -6056   3233  -3271       C
ATOM   8552  CD1 ILE D 138    -37.895  12.159 102.778  1.00104.09          C
ANISOU 8552  CD1 ILE D 138   12700  16144  10705  -6581   3533  -3044       C
ATOM   8556  CG2 ILE D 138    -39.088  12.632  99.849  1.00105.25          C
ANISOU 8556  CG2 ILE D 138   12138  17009  10843  -6600   3266  -3689       C
ATOM   8560  C   ILE D 138    -41.426  14.537 100.221  1.00110.58          C
ANISOU 8560  C   ILE D 138   11270  19628  11117  -6351   3004  -4340       C
ATOM   8561  O   ILE D 138    -42.424  14.386 100.942  1.00115.13          O
ANISOU 8561  O   ILE D 138   11481  20848  11413  -6751   3151  -4535       O
ATOM   8563  N   LYS D 139    -41.474  14.495  98.889  1.00111.30          N
ANISOU 8563  N   LYS D 139   11321  19709  11259  -6308   2883  -4474       N
ATOM   8564  CA  LYS D 139    -42.725  14.280  98.161  1.00116.81          C
ANISOU 8564  CA  LYS D 139   11523  21175  11683  -6724   2891  -4873       C
ATOM   8566  CB  LYS D 139    -43.319  15.621  97.709  1.00116.87          C
ANISOU 8566  CB  LYS D 139   10872  21899  11636  -6079   2573  -5107       C
ATOM   8569  CG  LYS D 139    -43.552  16.627  98.833  1.00116.56          C
ANISOU 8569  CG  LYS D 139   10490  22250  11549  -5614   2489  -5108       C
ATOM   8572  CD  LYS D 139    -44.397  17.814  98.368  1.00117.96          C
ANISOU 8572  CD  LYS D 139    9997  23243  11581  -5045   2202  -5409       C
ATOM   8575  CE  LYS D 139    -44.421  18.940  99.409  1.00117.01          C
ANISOU 8575  CE  LYS D 139    9664  23342  11453  -4430   2081  -5386       C
ATOM   8578  NZ  LYS D 139    -45.422  20.009  99.089  1.00119.34          N
ANISOU 8578  NZ  LYS D 139    9291  24520  11534  -3890   1835  -5721       N
ATOM   8582  C   LYS D 139    -42.492  13.381  96.949  1.00117.47          C
ANISOU 8582  C   LYS D 139   11969  20859  11804  -7091   2947  -4910       C
ATOM   8583  O   LYS D 139    -43.222  12.413  96.729  1.00121.82          O
ANISOU 8583  O   LYS D 139   12515  21646  12125  -7853   3144  -5118       O
ATOM   8585  N   THR D 143    -35.983  13.286  95.625  1.00 67.95          N
ANISOU 8585  N   THR D 143    8148  10773   6896  -5147   2739  -3365       N
ATOM   8586  CA  THR D 143    -34.757  13.710  96.290  1.00 64.59          C
ANISOU 8586  CA  THR D 143    7958   9883   6700  -4661   2676  -3004       C
ATOM   8588  CB  THR D 143    -34.794  15.201  96.741  1.00 63.39          C
ANISOU 8588  CB  THR D 143    7364  10106   6614  -4145   2412  -2987       C
ATOM   8590  OG1 THR D 143    -35.230  16.041  95.663  1.00 63.43          O
ANISOU 8590  OG1 THR D 143    7014  10487   6598  -3887   2191  -3190       O
ATOM   8592  CG2 THR D 143    -33.397  15.667  97.183  1.00 59.77          C
ANISOU 8592  CG2 THR D 143    7161   9151   6397  -3662   2319  -2625       C
ATOM   8596  C   THR D 143    -34.451  12.830  97.500  1.00 63.92          C
ANISOU 8596  C   THR D 143    8271   9431   6583  -4943   2907  -2796       C
ATOM   8597  O   THR D 143    -35.338  12.499  98.278  1.00 66.11          O
ANISOU 8597  O   THR D 143    8431  10026   6660  -5380   3042  -2918       O
ATOM   8599  N   HIS D 144    -33.165  12.514  97.644  1.00 58.83          N
ANISOU 8599  N   HIS D 144    8076   8155   6120  -4654   2940  -2471       N
ATOM   8600  CA  HIS D 144    -32.615  11.588  98.628  1.00 58.54          C
ANISOU 8600  CA  HIS D 144    8539   7637   6066  -4808   3142  -2213       C
ATOM   8602  CB  HIS D 144    -31.630  10.642  97.903  1.00 58.76          C
ANISOU 8602  CB  HIS D 144    9140   6993   6195  -4713   3257  -2051       C
ATOM   8605  CG  HIS D 144    -31.249   9.416  98.679  1.00 61.32          C
ANISOU 8605  CG  HIS D 144   10091   6772   6438  -4944   3499  -1837       C
ATOM   8606  ND1 HIS D 144    -31.852   8.195  98.483  1.00 66.43          N
ANISOU 8606  ND1 HIS D 144   11162   7184   6893  -5534   3745  -1968       N
ATOM   8608  CE1 HIS D 144    -31.307   7.298  99.284  1.00 68.06          C
ANISOU 8608  CE1 HIS D 144   11960   6853   7049  -5582   3916  -1703       C
ATOM   8610  NE2 HIS D 144    -30.373   7.894 100.001  1.00 63.87          N
ANISOU 8610  NE2 HIS D 144   11351   6251   6666  -5033   3780  -1411       N
ATOM   8612  CD2 HIS D 144    -30.308   9.217  99.633  1.00 61.02          C
ANISOU 8612  CD2 HIS D 144   10364   6359   6462  -4655   3523  -1495       C
ATOM   8614  C   HIS D 144    -31.917  12.495  99.651  1.00 54.65          C
ANISOU 8614  C   HIS D 144    7902   7165   5696  -4341   2984  -1966       C
ATOM   8615  O   HIS D 144    -31.317  13.503  99.275  1.00 50.95          O
ANISOU 8615  O   HIS D 144    7206   6753   5399  -3852   2758  -1903       O
ATOM   8617  N   ILE D 145    -32.035  12.162 100.938  1.00 55.82          N
ANISOU 8617  N   ILE D 145    8189   7289   5730  -4530   3102  -1839       N
ATOM   8618  CA  ILE D 145    -31.449  12.954 102.009  1.00 52.16          C
ANISOU 8618  CA  ILE D 145    7608   6875   5337  -4151   2962  -1629       C
ATOM   8620  CB  ILE D 145    -32.472  13.236 103.114  1.00 53.91          C
ANISOU 8620  CB  ILE D 145    7546   7594   5343  -4432   3010  -1765       C
ATOM   8622  CG1 ILE D 145    -33.714  13.943 102.531  1.00 54.22          C
ANISOU 8622  CG1 ILE D 145    7019   8299   5283  -4553   2922  -2154       C
ATOM   8625  CD1 ILE D 145    -34.905  14.022 103.488  1.00 57.42          C
ANISOU 8625  CD1 ILE D 145    7110   9287   5419  -4915   3027  -2350       C
ATOM   8629  CG2 ILE D 145    -31.810  14.062 104.206  1.00 50.65          C
ANISOU 8629  CG2 ILE D 145    7051   7203   4992  -4028   2855  -1559       C
ATOM   8633  C   ILE D 145    -30.267  12.213 102.628  1.00 52.42          C
ANISOU 8633  C   ILE D 145    8170   6316   5431  -3988   3051  -1258       C
ATOM   8634  O   ILE D 145    -30.382  11.007 102.902  1.00 54.52          O
ANISOU 8634  O   ILE D 145    8899   6255   5563  -4346   3289  -1181       O
ATOM   8636  N   HIS D 146    -29.158  12.937 102.858  1.00 47.52          N
```

FIG. 18 (continued)

| | | | | | | | | | | | | | |
|---|---|---|---|---|---|---|---|---|---|---|---|---|---|
| ANISOU | 8636 | N | HIS | D | 146 | 7490 | 5577 | 4987 | -3460 | 2857 | -1032 | | N |
| ATOM | 8637 | CA | HIS | D | 146 | -27.985 | 12.399 | 103.542 | 1.00 | 48.39 | | | C |
| ANISOU | 8637 | CA | HIS | D | 146 | 8004 | 5244 | 5140 | -3215 | 2892 | -675 | | C |
| ATOM | 8639 | CB | HIS | D | 146 | -26.903 | 12.055 | 102.514 | 1.00 | 49.14 | | | C |
| ANISOU | 8639 | CB | HIS | D | 146 | 8321 | 4940 | 5411 | -2882 | 2876 | -541 | | C |
| ATOM | 8642 | CG | HIS | D | 146 | -25.851 | 11.122 | 103.030 | 1.00 | 51.20 | | | C |
| ANISOU | 8642 | CG | HIS | D | 146 | 9081 | 4711 | 5659 | -2672 | 2976 | -211 | | C |
| ATOM | 8643 | ND1 | HIS | D | 146 | -25.124 | 10.292 | 102.202 | 1.00 | 52.13 | | | N |
| ANISOU | 8643 | ND1 | HIS | D | 146 | 9570 | 4397 | 5840 | -2489 | 3077 | -119 | | N |
| ATOM | 8645 | CE1 | HIS | D | 146 | -24.272 | 9.590 | 102.930 | 1.00 | 54.89 | | | C |
| ANISOU | 8645 | CE1 | HIS | D | 146 | 10322 | 4392 | 6140 | -2252 | 3138 | 183 | | C |
| ATOM | 8647 | NE2 | HIS | D | 146 | -24.437 | 9.916 | 104.200 | 1.00 | 54.87 | | | N |
| ANISOU | 8647 | NE2 | HIS | D | 146 | 10231 | 4578 | 6041 | -2315 | 3081 | 294 | | N |
| ATOM | 8649 | CD2 | HIS | D | 146 | -25.413 | 10.878 | 104.288 | 1.00 | 52.23 | | | C |
| ANISOU | 8649 | CD2 | HIS | D | 146 | 9414 | 4733 | 5698 | -2578 | 2986 | 44 | | C |
| ATOM | 8651 | C | HIS | D | 146 | -27.453 | 13.409 | 104.586 | 1.00 | 47.34 | | | C |
| ANISOU | 8651 | C | HIS | D | 146 | 7627 | 5315 | 5046 | -2884 | 2686 | -522 | | C |
| ATOM | 8652 | O | HIS | D | 146 | -26.921 | 14.471 | 104.225 | 1.00 | 43.74 | | | O |
| ANISOU | 8652 | O | HIS | D | 146 | 6871 | 4997 | 4753 | -2529 | 2457 | -521 | | O |
| ATOM | 8654 | N | ILE | D | 147 | -27.589 | 13.070 | 105.872 | 1.00 | 48.63 | | | N |
| ANISOU | 8654 | N | ILE | D | 147 | 7953 | 5484 | 5039 | -3030 | 2770 | -392 | | N |
| ATOM | 8655 | CA | ILE | D | 147 | -27.094 | 13.927 | 106.960 | 1.00 | 47.70 | | | C |
| ANISOU | 8655 | CA | ILE | D | 147 | 7655 | 5552 | 4916 | -2754 | 2586 | -253 | | C |
| ATOM | 8657 | CB | ILE | D | 147 | -28.152 | 14.076 | 108.126 | 1.00 | 49.54 | | | C |
| ANISOU | 8657 | CB | ILE | D | 147 | 7760 | 6162 | 4900 | -3080 | 2665 | -378 | | C |
| ATOM | 8659 | CG1 | ILE | D | 147 | -29.539 | 14.449 | 107.591 | 1.00 | 49.33 | | | C |
| ANISOU | 8659 | CG1 | ILE | D | 147 | 7362 | 6581 | 4798 | -3390 | 2710 | -764 | | C |
| ATOM | 8662 | CD1 | ILE | D | 147 | -29.551 | 15.720 | 106.692 | 1.00 | 46.13 | | | C |
| ANISOU | 8662 | CD1 | ILE | D | 147 | 6524 | 6424 | 4578 | -3062 | 2457 | -963 | | C |
| ATOM | 8666 | CG2 | ILE | D | 147 | -27.714 | 15.153 | 109.087 | 1.00 | 46.62 | | | C |
| ANISOU | 8666 | CG2 | ILE | D | 147 | 7158 | 6027 | 4528 | -2774 | 2442 | -308 | | C |
| ATOM | 8670 | C | ILE | D | 147 | -25.783 | 13.387 | 107.545 | 1.00 | 47.97 | | | C |
| ANISOU | 8670 | C | ILE | D | 147 | 8048 | 5205 | 4972 | -2451 | 2570 | 125 | | C |
| ATOM | 8671 | O | ILE | D | 147 | -25.666 | 12.194 | 107.810 | 1.00 | 52.11 | | | O |
| ANISOU | 8671 | O | ILE | D | 147 | 9042 | 5378 | 5381 | -2586 | 2768 | 291 | | O |
| ATOM | 8673 | N | PHE | D | 148 | -24.817 | 14.284 | 107.754 | 1.00 | 45.97 | | | N |
| ANISOU | 8673 | N | PHE | D | 148 | 7581 | 5038 | 4847 | -2046 | 2327 | 254 | | N |
| ATOM | 8674 | CA | PHE | D | 148 | -23.586 | 14.002 | 108.511 | 1.00 | 47.49 | | | C |
| ANISOU | 8674 | CA | PHE | D | 148 | 7985 | 5036 | 5025 | -1725 | 2255 | 597 | | C |
| ATOM | 8676 | CB | PHE | D | 148 | -22.343 | 14.392 | 107.701 | 1.00 | 45.84 | | | C |
| ANISOU | 8676 | CB | PHE | D | 148 | 7644 | 4738 | 5035 | -1311 | 2091 | 719 | | C |
| ATOM | 8679 | CG | PHE | D | 148 | -22.117 | 13.576 | 106.463 | 1.00 | 45.84 | | | C |
| ANISOU | 8679 | CG | PHE | D | 148 | 7857 | 4422 | 5137 | -1261 | 2238 | 716 | | C |
| ATOM | 8680 | CD1 | PHE | D | 148 | -21.353 | 12.411 | 106.507 | 1.00 | 48.95 | | | C |
| ANISOU | 8680 | CD1 | PHE | D | 148 | 8682 | 4433 | 5485 | -1060 | 2369 | 963 | | C |
| ATOM | 8682 | CE1 | PHE | D | 148 | -21.109 | 11.662 | 105.340 | 1.00 | 50.53 | | | C |
| ANISOU | 8682 | CE1 | PHE | D | 148 | 9109 | 4326 | 5765 | -974 | 2508 | 939 | | C |
| ATOM | 8684 | CZ | PHE | D | 148 | -21.614 | 12.092 | 104.126 | 1.00 | 48.08 | | | C |
| ANISOU | 8684 | CZ | PHE | D | 148 | 8570 | 4121 | 5579 | -1115 | 2509 | 676 | | C |
| ATOM | 8686 | CE2 | PHE | D | 148 | -22.381 | 13.256 | 104.066 | 1.00 | 45.04 | | | C |
| ANISOU | 8686 | CE2 | PHE | D | 148 | 7747 | 4129 | 5238 | -1312 | 2367 | 447 | | C |
| ATOM | 8688 | CD2 | PHE | D | 148 | -22.622 | 14.000 | 105.242 | 1.00 | 44.41 | | | C |
| ANISOU | 8688 | CD2 | PHE | D | 148 | 7462 | 4330 | 5082 | -1366 | 2233 | 465 | | C |
| ATOM | 8690 | C | PHE | D | 148 | -23.546 | 14.820 | 109.806 | 1.00 | 47.07 | | | C |
| ANISOU | 8690 | C | PHE | D | 148 | 7739 | 5290 | 4857 | -1672 | 2092 | 638 | | C |
| ATOM | 8691 | O | PHE | D | 148 | -23.874 | 16.004 | 109.789 | 1.00 | 43.72 | | | O |
| ANISOU | 8691 | O | PHE | D | 148 | 6938 | 5187 | 4486 | -1654 | 1921 | 440 | | O |
| ATOM | 8693 | N | SER | D | 149 | -23.147 | 14.191 | 110.920 | 1.00 | 51.07 | | | N |
| ANISOU | 8693 | N | SER | D | 149 | 8538 | 5682 | 5183 | -1631 | 2139 | 892 | | N |
| ATOM | 8694 | CA | SER | D | 149 | -22.830 | 14.921 | 112.166 | 1.00 | 51.75 | | | C |
| ANISOU | 8694 | CA | SER | D | 149 | 8475 | 6038 | 5148 | -1512 | 1957 | 976 | | C |
| ATOM | 8696 | CB | SER | D | 149 | -23.522 | 14.284 | 113.361 | 1.00 | 55.73 | | | C |
| ANISOU | 8696 | CB | SER | D | 149 | 9247 | 6576 | 5351 | -1792 | 2127 | 1039 | | C |
| ATOM | 8699 | OG | SER | D | 149 | -22.706 | 13.299 | 113.967 | 1.00 | 60.66 | | | O |
| ANISOU | 8699 | OG | SER | D | 149 | 10302 | 6899 | 5847 | -1620 | 2181 | 1396 | | O |
| ATOM | 8701 | C | SER | D | 149 | -21.313 | 15.017 | 112.397 | 1.00 | 51.91 | | | C |
| ANISOU | 8701 | C | SER | D | 149 | 8505 | 5983 | 5236 | -1078 | 1759 | 1270 | | C |
| ATOM | 8702 | O | SER | D | 149 | -20.558 | 14.216 | 111.859 | 1.00 | 53.49 | | | O |
| ANISOU | 8702 | O | SER | D | 149 | 8929 | 5888 | 5508 | -862 | 1822 | 1463 | | O |
| ATOM | 8704 | N | PHE | D | 150 | -20.878 | 16.013 | 113.178 | 1.00 | 51.86 | | | N |
| ANISOU | 8704 | N | PHE | D | 150 | 8243 | 6271 | 5192 | -948 | 1518 | 1282 | | N |
| ATOM | 8705 | CA | PHE | D | 150 | -19.451 | 16.229 | 113.478 | 1.00 | 52.19 | | | C |
| ANISOU | 8705 | CA | PHE | D | 150 | 8208 | 6357 | 5266 | -583 | 1301 | 1534 | | C |
| ATOM | 8707 | CB | PHE | D | 150 | -19.224 | 17.586 | 114.182 | 1.00 | 49.51 | | | C |
| ANISOU | 8707 | CB | PHE | D | 150 | 7538 | 6379 | 4894 | -565 | 1022 | 1433 | | C |
| ATOM | 8710 | CG | PHE | D | 150 | -19.318 | 18.768 | 113.257 | 1.00 | 46.96 | | | C |
| ANISOU | 8710 | CG | PHE | D | 150 | 6883 | 6169 | 4791 | -598 | 878 | 1189 | | C |
| ATOM | 8711 | CD1 | PHE | D | 150 | -18.171 | 19.338 | 112.702 | 1.00 | 46.31 | | | C |
| ANISOU | 8711 | CD1 | PHE | D | 150 | 6589 | 6139 | 4869 | -399 | 683 | 1280 | | C |

FIG. 18 (continued)

```
ATOM   8713  CE1 PHE D 150    -18.271  20.436 111.802  1.00 43.32          C
ANISOU 8713  CE1 PHE D 150    5968   5819   4672   -458    559   1073       C
ATOM   8715  CZ  PHE D 150    -19.503  20.944 111.474  1.00 41.05          C
ANISOU 8715  CZ  PHE D 150    5647   5546   4404   -643    613    778       C
ATOM   8717  CE2 PHE D 150    -20.643  20.378 112.005  1.00 42.92          C
ANISOU 8717  CE2 PHE D 150    6030   5792   4487   -812    802    667       C
ATOM   8719  CD2 PHE D 150    -20.551  19.290 112.891  1.00 45.31          C
ANISOU 8719  CD2 PHE D 150    6578   6027   4608   -824    945    874       C
ATOM   8721  C   PHE D 150    -18.839  15.073 114.304  1.00 56.58          C
ANISOU 8721  C   PHE D 150    9149   6731   5619   -399   1377   1877       C
ATOM   8722  O   PHE D 150    -17.614  14.889 114.303  1.00 57.88          O
ANISOU 8722  O   PHE D 150    9295   6887   5811    -35   1249   2115       O
ATOM   8724  N   THR D 151    -19.697  14.310 114.986  1.00 59.44          N
ANISOU 8724  N   THR D 151    9855   6969   5759   -648   1585   1902       N
ATOM   8725  CA  THR D 151    -19.278  13.146 115.785  1.00 63.80          C
ANISOU 8725  CA  THR D 151   10881   7282   6076   -506   1684   2236       C
ATOM   8727  CB  THR D 151    -20.057  13.052 117.122  1.00 66.29          C
ANISOU 8727  CB  THR D 151   11375   7741   6073   -792   1760   2251       C
ATOM   8729  OG1 THR D 151    -21.413  12.618 116.894  1.00 67.41          O
ANISOU 8729  OG1 THR D 151   11684   7781   6150  -1269   2043   2052       O
ATOM   8731  CG2 THR D 151    -20.038  14.390 117.833  1.00 64.70          C
ANISOU 8731  CG2 THR D 151   10737   8010   5835   -799   1512   2096       C
ATOM   8735  C   THR D 151    -19.377  11.792 115.056  1.00 66.07          C
ANISOU 8735  C   THR D 151   11655   7069   6379   -503   1948   2349       C
ATOM   8736  O   THR D 151    -19.053  10.761 115.645  1.00 69.54          O
ANISOU 8736  O   THR D 151   12582   7229   6613   -364   2043   2635       O
ATOM   8738  N   GLY D 152    -19.801  11.788 113.788  1.00 63.53          N
ANISOU 8738  N   GLY D 152   11246   6615   6277   -641   2057   2130       N
ATOM   8739  CA  GLY D 152    -19.724  10.584 112.960  1.00 64.70          C
ANISOU 8739  CA  GLY D 152   11845   6276   6461   -587   2275   2213       C
ATOM   8742  C   GLY D 152    -21.021   9.906 112.537  1.00 65.83          C
ANISOU 8742  C   GLY D 152   12289   6181   6543  -1111   2567   2016       C
ATOM   8743  O   GLY D 152    -21.001   9.068 111.636  1.00 64.94          O
ANISOU 8743  O   GLY D 152   12503   5676   6495  -1104   2731   2010       O
ATOM   8745  N   GLU D 153    -22.150  10.237 113.161  1.00 66.86          N
ANISOU 8745  N   GLU D 153   12311   6564   6528  -1575   2641   1842       N
ATOM   8746  CA  GLU D 153    -23.411   9.576 112.794  1.00 69.33          C
ANISOU 8746  CA  GLU D 153   12864   6732   6748  -2134   2924   1645       C
ATOM   8748  CB  GLU D 153    -24.564   9.830 113.794  1.00 72.04          C
ANISOU 8748  CB  GLU D 153   13106   7425   6843  -2619   3022   1514       C
ATOM   8751  CG  GLU D 153    -24.221  10.350 115.206  1.00 73.82          C
ANISOU 8751  CG  GLU D 153   13234   7935   6881  -2457   2871   1684       C
ATOM   8754  CD  GLU D 153    -23.378   9.397 116.027  1.00 78.26          C
ANISOU 8754  CD  GLU D 153   14368   8127   7239  -2210   2898   2104       C
ATOM   8755  OE1 GLU D 153    -22.281   9.011 115.576  1.00 80.55          O
ANISOU 8755  OE1 GLU D 153   14843   8105   7657  -1746   2807   2314       O
ATOM   8756  OE2 GLU D 153    -23.800   9.059 117.143  1.00 80.32          O
ANISOU 8756  OE2 GLU D 153   14884   8442   7191  -2452   3004   2227       O
ATOM   8757  C   GLU D 153    -23.840  10.022 111.388  1.00 65.21          C
ANISOU 8757  C   GLU D 153   11999   6300   6478  -2240   2923   1321       C
ATOM   8758  O   GLU D 153    -23.475  11.106 110.936  1.00 62.13          O
ANISOU 8758  O   GLU D 153   11112   6199   6295  -1989   2701   1203       O
ATOM   8760  N   GLU D 154    -24.595   9.168 110.698  1.00 66.44          N
ANISOU 8760  N   GLU D 154   12458   6194   6593  -2627   3166   1187       N
ATOM   8761  CA  GLU D 154    -25.217   9.515 109.423  1.00 62.90          C
ANISOU 8761  CA  GLU D 154   11702   5878   6319  -2815   3185    854       C
ATOM   8763  CB  GLU D 154    -24.517   8.807 108.270  1.00 63.93          C
ANISOU 8763  CB  GLU D 154   12141   5550   6600  -2571   3241    913       C
ATOM   8766  CG  GLU D 154    -23.062   9.140 108.069  1.00 61.60          C
ANISOU 8766  CG  GLU D 154   11748   5177   6482  -1912   3039   1135       C
ATOM   8769  CD  GLU D 154    -22.489   8.374 106.889  1.00 62.25          C
ANISOU 8769  CD  GLU D 154   12139   4839   6675  -1689   3135   1154       C
ATOM   8770  OE1 GLU D 154    -21.866   7.322 107.125  1.00 66.11          O
ANISOU 8770  OE1 GLU D 154   13190   4868   7058  -1463   3244   1400       O
ATOM   8771  OE2 GLU D 154    -22.699   8.803 105.736  1.00 59.39          O
ANISOU 8771  OE2 GLU D 154   11488   4601   6478  -1729   3107    917       O
ATOM   8772  C   GLU D 154    -26.675   9.082 109.392  1.00 65.53          C
ANISOU 8772  C   GLU D 154   12097   6332   6470  -3494   3420    601       C
ATOM   8773  O   GLU D 154    -27.028   8.069 109.974  1.00 64.81          O
ANISOU 8773  O   GLU D 154   12511   5969   6143  -3838   3642    722       O
ATOM   8775  N   MET D 155    -27.515   9.843 108.693  1.00 64.78          N
ANISOU 8775  N   MET D 155   11493   6657   6462  -3691   3369    253       N
ATOM   8776  CA  MET D 155    -28.885   9.402 108.422  1.00 68.62          C
ANISOU 8776  CA  MET D 155   11967   7322   6783  -4337   3586    -28       C
ATOM   8778  CB  MET D 155    -29.881  10.021 109.426  1.00 70.17          C
ANISOU 8778  CB  MET D 155   11779   8108   6775  -4639   3600   -180       C
ATOM   8781  CG  MET D 155    -31.150   9.189 109.647  1.00 74.98          C
ANISOU 8781  CG  MET D 155   12547   8847   7094  -5392   3898   -340       C
ATOM   8784  SD  MET D 155    -32.032   9.591 111.165  1.00 78.83          S
```

FIG. 18 (continued)

```
ANISOU 8784  SD  MET D 155    12767   9925   7261  -5709   3979   -386        S
ATOM   8785  CE  MET D 155     -33.279   8.315 111.208  1.00 84.87            C
ANISOU 8785  CE  MET D 155    13864  10696   7688  -6656   4373   -510        C
ATOM   8789  C   MET D 155     -29.249   9.721 106.963  1.00 65.49            C
ANISOU 8789  C   MET D 155    11268   7052   6563  -4365   3535   -329        C
ATOM   8790  O   MET D 155     -29.103  10.855 106.505  1.00 64.15            O
ANISOU 8790  O   MET D 155    10596   7205   6574  -4035   3306   -456        O
ATOM   8792  N   ALA D 156     -29.674   8.696 106.230  1.00 66.37            N
ANISOU 8792  N   ALA D 156    11743   6871   6605  -4758   3744   -429        N
ATOM   8793  CA  ALA D 156     -30.014   8.828 104.818  1.00 64.96            C
ANISOU 8793  CA  ALA D 156    11354   6776   6551  -4820   3714   -708        C
ATOM   8795  CB  ALA D 156     -28.935   8.165 103.957  1.00 63.75            C
ANISOU 8795  CB  ALA D 156    11656   6013   6553  -4478   3730   -546        C
ATOM   8799  C   ALA D 156     -31.373   8.218 104.499  1.00 67.94            C
ANISOU 8799  C   ALA D 156    11742   7360   6714  -5558   3927  -1009        C
ATOM   8800  O   ALA D 156     -31.834   7.324 105.203  1.00 68.88            O
ANISOU 8800  O   ALA D 156    12256   7319   6595  -6051   4157   -944        O
ATOM   8802  N   THR D 157     -31.995   8.699 103.423  1.00 67.73            N
ANISOU 8802  N   THR D 157    11286   7699   6750  -5645   3846  -1333        N
ATOM   8803  CA  THR D 157     -33.206   8.080 102.886  1.00 73.82            C
ANISOU 8803  CA  THR D 157    12042   8686   7322  -6340   4026  -1649        C
ATOM   8805  CB  THR D 157     -33.583   8.666 101.496  1.00 71.04            C
ANISOU 8805  CB  THR D 157    11242   8671   7081  -6248   3874  -1963        C
ATOM   8807  OG1 THR D 157     -33.904  10.059 101.626  1.00 67.32            O
ANISOU 8807  OG1 THR D 157    10062   8838   6677  -5909   3633  -2091        O
ATOM   8809  CG2 THR D 157     -34.786   7.911 100.880  1.00 75.31            C
ANISOU 8809  CG2 THR D 157    11793   9433   7391  -7006   4058  -2299        C
ATOM   8813  C   THR D 157     -33.045   6.546 102.779  1.00 79.01            C
ANISOU 8813  C   THR D 157    13521   8653   7848  -6761   4300  -1536        C
ATOM   8814  O   THR D 157     -32.121   6.058 102.132  1.00 78.53            O
ANISOU 8814  O   THR D 157    13906   8007   7926  -6439   4299  -1397        O
ATOM   8816  N   LYS D 158     -33.930   5.816 103.454  1.00 86.04            N
ANISOU 8816  N   LYS D 158    14625   9616   8449  -7468   4537  -1591        N
ATOM   8817  CA  LYS D 158     -33.984   4.338 103.430  1.00 91.90            C
ANISOU 8817  CA  LYS D 158    16208   9709   9002  -8007   4822  -1513        C
ATOM   8819  CB  LYS D 158     -34.446   3.872 102.036  1.00 94.53            C
ANISOU 8819  CB  LYS D 158    16608   9984   9325  -8357   4874  -1836        C
ATOM   8822  CG  LYS D 158     -35.869   4.316 101.655  1.00 95.93            C
ANISOU 8822  CG  LYS D 158    16082  11023   9344  -8939   4868  -2266        C
ATOM   8825  CD  LYS D 158     -36.237   3.838 100.240  1.00 97.97            C
ANISOU 8825  CD  LYS D 158    16432  11213   9581  -9257   4895  -2580        C
ATOM   8828  CE  LYS D 158     -37.644   3.224 100.180  1.00104.59            C
ANISOU 8828  CE  LYS D 158    17184  12478  10079 -10286   5100  -2913        C
ATOM   8831  NZ  LYS D 158     -37.942   2.664  98.828  1.00107.44            N
ANISOU 8831  NZ  LYS D 158    17718  12714  10392 -10630   5127  -3215        N
ATOM   8835  C   LYS D 158     -32.673   3.606 103.845  1.00 92.52            C
ANISOU 8835  C   LYS D 158    17091   8911   9151  -7553   4869  -1087        C
ATOM   8836  O   LYS D 158     -32.459   2.390 103.469  1.00 97.92            O
ANISOU 8836  O   LYS D 158    18576   8892   9739  -7794   5062  -1026        O
ATOM   8838  N   ALA D 159     -31.826   4.328 104.638  1.00 88.88            N
ANISOU 8838  N   ALA D 159    16437   8506   8829  -6903   4692   -807        N
ATOM   8839  CA  ALA D 159     -30.526   3.810 105.110  1.00 88.45            C
ANISOU 8839  CA  ALA D 159    17001   7769   8836  -6356   4685   -395        C
ATOM   8841  CB  ALA D 159     -30.702   2.505 105.863  1.00 94.02            C
ANISOU 8841  CB  ALA D 159    18564   7913   9248  -6829   4962   -194        C
ATOM   8845  C   ALA D 159     -29.498   3.646 103.987  1.00 86.01            C
ANISOU 8845  C   ALA D 159    16901   7018   8762  -5786   4594   -356        C
ATOM   8846  O   ALA D 159     -28.532   2.873 104.113  1.00 87.93            O
ANISOU 8846  O   ALA D 159    17798   6608   9005  -5418   4650    -73        O
ATOM   8848  N   ASP D 160     -29.682   4.425 102.917  1.00 81.59            N
ANISOU 8848  N   ASP D 160    15763   6853   8384  -5663   4443   -632        N
ATOM   8849  CA  ASP D 160     -28.925   4.251 101.695  1.00 78.97            C
ANISOU 8849  CA  ASP D 160    15585   6189   8229  -5256   4393   -669        C
ATOM   8851  CB  ASP D 160     -29.923   4.128 100.547  1.00 81.42            C
ANISOU 8851  CB  ASP D 160    15731   6718   8485  -5777   4457  -1077        C
ATOM   8854  CG  ASP D 160     -29.300   4.262  99.184  1.00 81.13            C
ANISOU 8854  CG  ASP D 160    15649   6546   8632  -5365   4364  -1182        C
ATOM   8855  OD1 ASP D 160     -28.046   4.278  99.024  1.00 81.16            O
ANISOU 8855  OD1 ASP D 160    15828   6215   8796  -4693   4291   -943        O
ATOM   8856  OD2 ASP D 160     -30.111   4.364  98.239  1.00 83.16            O
ANISOU 8856  OD2 ASP D 160    15655   7094   8846  -5733   4365  -1524        O
ATOM   8857  C   ASP D 160     -27.982   5.455 101.566  1.00 72.67            C
ANISOU 8857  C   ASP D 160    14222   5690   7701  -4512   4110   -549        C
ATOM   8858  O   ASP D 160     -28.416   6.588 101.276  1.00 65.26            O
ANISOU 8858  O   ASP D 160    12585   5347   6864  -4486   3932   -742        O
ATOM   8860  N   TYR D 161     -26.691   5.187 101.787  1.00 71.00            N
ANISOU 8860  N   TYR D 161    14337   5060   7579  -3912   4071   -231        N
ATOM   8861  CA  TYR D 161     -25.710   6.227 102.031  1.00 67.33            C
ANISOU 8861  CA  TYR D 161    13408   4862   7314  -3273   3822    -46        C
```

FIG. 18 (continued)

| | | | | | | | | | | | | | |
|---|---|---|---|---|---|---|---|---|---|---|---|---|---|
| ATOM | 8863 | CB | TYR | D | 161 | -24.815 | 5.836 | 103.223 | 1.00 | 69.99 | | | C |
| ANISOU | 8863 | CB | TYR | D | 161 | 14103 | 4906 | 7583 | -2915 | 3819 | 344 | | C |
| ATOM | 8866 | CG | TYR | D | 161 | -25.584 | 5.625 | 104.545 | 1.00 | 72.44 | | | C |
| ANISOU | 8866 | CG | TYR | D | 161 | 14555 | 5301 | 7669 | -3363 | 3912 | 418 | | C |
| ATOM | 8867 | CD1 | TYR | D | 161 | -26.061 | 6.712 | 105.289 | 1.00 | 69.27 | | | C |
| ANISOU | 8867 | CD1 | TYR | D | 161 | 13558 | 5492 | 7270 | -3465 | 3764 | 357 | | C |
| ATOM | 8869 | CE1 | TYR | D | 161 | -26.761 | 6.524 | 106.498 | 1.00 | 72.48 | | | C |
| ANISOU | 8869 | CE1 | TYR | D | 161 | 14075 | 6023 | 7443 | -3868 | 3865 | 416 | | C |
| ATOM | 8871 | CZ | TYR | D | 161 | -26.992 | 5.237 | 106.981 | 1.00 | 77.47 | | | C |
| ANISOU | 8871 | CZ | TYR | D | 161 | 15442 | 6161 | 7832 | -4217 | 4117 | 560 | | C |
| ATOM | 8872 | OH | TYR | D | 161 | -27.683 | 5.062 | 108.167 | 1.00 | 79.06 | | | O |
| ANISOU | 8872 | OH | TYR | D | 161 | 15751 | 6512 | 7776 | -4648 | 4231 | 629 | | O |
| ATOM | 8874 | CE2 | TYR | D | 161 | -26.523 | 4.137 | 106.263 | 1.00 | 80.49 | | | C |
| ANISOU | 8874 | CE2 | TYR | D | 161 | 16482 | 5891 | 8210 | -4127 | 4259 | 632 | | C |
| ATOM | 8876 | CD2 | TYR | D | 161 | -25.819 | 4.343 | 105.045 | 1.00 | 78.08 | | | C |
| ANISOU | 8876 | CD2 | TYR | D | 161 | 16032 | 5490 | 8145 | -3678 | 4154 | 548 | | C |
| ATOM | 8878 | C | TYR | D | 161 | -24.918 | 6.579 | 100.764 | 1.00 | 64.86 | | | C |
| ANISOU | 8878 | C | TYR | D | 161 | 12903 | 4535 | 7207 | -2814 | 3715 | -101 | | C |
| ATOM | 8879 | O | TYR | D | 161 | -23.947 | 7.334 | 100.833 | 1.00 | 61.92 | | | O |
| ANISOU | 8879 | O | TYR | D | 161 | 12205 | 4329 | 6992 | -2284 | 3528 | 68 | | O |
| ATOM | 8881 | N | THR | D | 162 | -25.363 | 6.044 | 99.619 | 1.00 | 65.77 | | | N |
| ANISOU | 8881 | N | THR | D | 162 | 13211 | 4484 | 7295 | -3063 | 3839 | -349 | | N |
| ATOM | 8882 | CA | THR | D | 162 | -24.913 | 6.447 | 98.273 | 1.00 | 62.63 | | | C |
| ANISOU | 8882 | CA | THR | D | 162 | 12571 | 4175 | 7052 | -2762 | 3754 | -482 | | C |
| ATOM | 8884 | CB | THR | D | 162 | -25.187 | 7.964 | 97.986 | 1.00 | 58.34 | | | C |
| ANISOU | 8884 | CB | THR | D | 162 | 11229 | 4285 | 6651 | -2694 | 3505 | -613 | | C |
| ATOM | 8886 | OG1 | THR | D | 162 | -26.593 | 8.211 | 98.032 | 1.00 | 58.70 | | | O |
| ANISOU | 8886 | OG1 | THR | D | 162 | 11026 | 4693 | 6584 | -3265 | 3518 | -896 | | O |
| ATOM | 8888 | CG2 | THR | D | 162 | -24.676 | 8.369 | 96.594 | 1.00 | 55.92 | | | C |
| ANISOU | 8888 | CG2 | THR | D | 162 | 10720 | 4054 | 6475 | -2393 | 3427 | -715 | | C |
| ATOM | 8892 | C | THR | D | 162 | -23.444 | 6.116 | 97.973 | 1.00 | 63.21 | | | C |
| ANISOU | 8892 | C | THR | D | 162 | 12893 | 3902 | 7222 | -2089 | 3750 | -235 | | C |
| ATOM | 8893 | O | THR | D | 162 | -23.141 | 5.390 | 97.020 | 1.00 | 62.84 | | | O |
| ANISOU | 8893 | O | THR | D | 162 | 13211 | 3512 | 7154 | -1976 | 3876 | -318 | | O |
| ATOM | 8895 | N | LEU | D | 163 | -22.537 | 6.696 | 98.752 | 1.00 | 61.36 | | | N |
| ANISOU | 8895 | N | LEU | D | 163 | 12418 | 3816 | 7079 | -1636 | 3596 | 45 | | N |
| ATOM | 8896 | CA | LEU | D | 163 | -21.103 | 6.557 | 98.516 | 1.00 | 62.04 | | | C |
| ANISOU | 8896 | CA | LEU | D | 163 | 12579 | 3741 | 7250 | -966 | 3559 | 278 | | C |
| ATOM | 8898 | CB | LEU | D | 163 | -20.370 | 7.815 | 99.007 | 1.00 | 58.11 | | | C |
| ANISOU | 8898 | CB | LEU | D | 163 | 11457 | 3724 | 6897 | -625 | 3303 | 452 | | C |
| ATOM | 8901 | CG | LEU | D | 163 | -20.760 | 9.163 | 98.387 | 1.00 | 53.09 | | | C |
| ANISOU | 8901 | CG | LEU | D | 163 | 10171 | 3602 | 6398 | -767 | 3120 | 260 | | C |
| ATOM | 8903 | CD1 | LEU | D | 163 | -19.987 | 10.248 | 99.113 | 1.00 | 50.80 | | | C |
| ANISOU | 8903 | CD1 | LEU | D | 163 | 9420 | 3672 | 6208 | -472 | 2885 | 466 | | C |
| ATOM | 8907 | CD2 | LEU | D | 163 | -20.513 | 9.244 | 96.869 | 1.00 | 50.90 | | | C |
| ANISOU | 8907 | CD2 | LEU | D | 163 | 9801 | 3345 | 6193 | -642 | 3149 | 100 | | C |
| ATOM | 8911 | C | LEU | D | 163 | -20.542 | 5.324 | 99.209 | 1.00 | 67.69 | | | C |
| ANISOU | 8911 | C | LEU | D | 163 | 13991 | 3906 | 7824 | -724 | 3711 | 524 | | C |
| ATOM | 8912 | O | LEU | D | 163 | -21.199 | 4.715 | 100.079 | 1.00 | 70.00 | | | O |
| ANISOU | 8912 | O | LEU | D | 163 | 14683 | 3957 | 7957 | -1086 | 3819 | 570 | | O |
| ATOM | 8914 | N | ASP | D | 164 | -19.333 | 4.933 | 98.818 | 1.00 | 70.45 | | | N |
| ANISOU | 8914 | N | ASP | D | 164 | 14505 | 4059 | 8204 | -103 | 3726 | 684 | | N |
| ATOM | 8915 | CA | ASP | D | 164 | -18.635 | 3.829 | 99.485 | 1.00 | 76.65 | | | C |
| ANISOU | 8915 | CA | ASP | D | 164 | 15938 | 4341 | 8845 | 289 | 3835 | 952 | | C |
| ATOM | 8917 | CB | ASP | D | 164 | -17.419 | 3.426 | 98.670 | 1.00 | 80.89 | | | C |
| ANISOU | 8917 | CB | ASP | D | 164 | 16590 | 4732 | 9413 | 984 | 3871 | 1025 | | C |
| ATOM | 8920 | CG | ASP | D | 164 | -16.449 | 4.577 | 98.491 | 1.00 | 79.25 | | | C |
| ANISOU | 8920 | CG | ASP | D | 164 | 15596 | 5138 | 9376 | 1409 | 3653 | 1126 | | C |
| ATOM | 8921 | OD1 | ASP | D | 164 | -16.866 | 5.623 | 97.925 | 1.00 | 74.64 | | | O |
| ANISOU | 8921 | OD1 | ASP | D | 164 | 14436 | 4991 | 8932 | 1109 | 3544 | 941 | | O |
| ATOM | 8922 | OD2 | ASP | D | 164 | -15.282 | 4.433 | 98.928 | 1.00 | 83.47 | | | O |
| ANISOU | 8922 | OD2 | ASP | D | 164 | 16103 | 5728 | 9886 | 2030 | 3587 | 1392 | | O |
| ATOM | 8923 | C | ASP | D | 164 | -18.158 | 4.193 | 100.887 | 1.00 | 76.63 | | | C |
| ANISOU | 8923 | C | ASP | D | 164 | 15768 | 4536 | 8812 | 511 | 3680 | 1265 | | C |
| ATOM | 8924 | O | ASP | D | 164 | -18.123 | 5.358 | 101.267 | 1.00 | 71.33 | | | O |
| ANISOU | 8924 | O | ASP | D | 164 | 14440 | 4406 | 8255 | 464 | 3476 | 1284 | | O |
| ATOM | 8926 | N | GLU | D | 165 | -17.781 | 3.166 | 101.641 | 1.00 | 83.59 | | | N |
| ANISOU | 8926 | N | GLU | D | 165 | 17299 | 4948 | 9515 | 766 | 3777 | 1509 | | N |
| ATOM | 8927 | CA | GLU | D | 165 | -17.205 | 3.309 | 102.979 | 1.00 | 85.79 | | | C |
| ANISOU | 8927 | CA | GLU | D | 165 | 17530 | 5355 | 9712 | 1064 | 3639 | 1839 | | C |
| ATOM | 8929 | CB | GLU | D | 165 | -16.673 | 1.946 | 103.453 | 1.00 | 92.44 | | | C |
| ANISOU | 8929 | CB | GLU | D | 165 | 19239 | 5552 | 10331 | 1478 | 3778 | 2097 | | C |
| ATOM | 8932 | CG | GLU | D | 165 | -15.622 | 1.971 | 104.577 | 1.00 | 95.01 | | | C |
| ANISOU | 8932 | CG | GLU | D | 165 | 19519 | 6022 | 10560 | 2093 | 3610 | 2479 | | C |
| ATOM | 8935 | CD | GLU | D | 165 | -16.162 | 2.446 | 105.920 | 1.00 | 94.02 | | | C |
| ANISOU | 8935 | CD | GLU | D | 165 | 19245 | 6137 | 10339 | 1710 | 3504 | 2610 | | C |
| ATOM | 8936 | OE1 | GLU | D | 165 | -16.259 | 1.609 | 106.850 | 1.00 | 98.97 | | | O |
| ANISOU | 8936 | OE1 | GLU | D | 165 | 20524 | 6355 | 10725 | 1726 | 3585 | 2842 | | O |
| ATOM | 8937 | OE2 | GLU | D | 165 | -16.475 | 3.651 | 106.048 | 1.00 | 89.75 | | | O |

FIG. 18 (continued)

```
ANISOU 8937  OE2 GLU D 165    17973   6181   9946   1412   3343   2484        O
ATOM   8938  C   GLU D 165     -16.088   4.347 103.029  1.00 83.74            C
ANISOU 8938  C   GLU D 165    16528   5687   9605   1582   3387   1970        C
ATOM   8939  O   GLU D 165     -16.106   5.243 103.878  1.00 82.30            O
ANISOU 8939  O   GLU D 165    15877   5940   9452   1473   3198   2055        O
ATOM   8941  N   GLU D 166     -15.132   4.230 102.110  1.00 84.21            N
ANISOU 8941  N   GLU D 166    16481   5775   9739   2114   3392   1971        N
ATOM   8942  CA  GLU D 166     -13.881   4.978 102.217  1.00 82.93            C
ANISOU 8942  CA  GLU D 166    15705   6141   9662   2665   3181   2145        C
ATOM   8944  CB  GLU D 166     -12.855   4.506 101.172  1.00 85.71            C
ANISOU 8944  CB  GLU D 166    16097   6438  10029   3285   3262   2145        C
ATOM   8947  CG  GLU D 166     -12.682   2.974 101.113  1.00 91.73            C
ANISOU 8947  CG  GLU D 166    17759   6495  10597   3666   3480   2227        C
ATOM   8950  CD  GLU D 166     -11.359   2.527 100.496  1.00 95.20            C
ANISOU 8950  CD  GLU D 166    18185   6991  10996   4513   3509   2323        C
ATOM   8951  OE1 GLU D 166     -10.875   3.170  99.534  1.00 93.82            O
ANISOU 8951  OE1 GLU D 166    17441   7251  10956   4638   3477   2192        O
ATOM   8952  OE2 GLU D 166     -10.809   1.519 100.977  1.00 99.72            O
ANISOU 8952  OE2 GLU D 166    19333   7177  11378   5069   3569   2532        O
ATOM   8953  C   GLU D 166     -14.127   6.481 102.105  1.00 77.17            C
ANISOU 8953  C   GLU D 166    14171   6031   9118   2309   2982   2012        C
ATOM   8954  O   GLU D 166     -13.611   7.246 102.919  1.00 75.72            O
ANISOU 8954  O   GLU D 166    13552   6270   8949   2427   2769   2174        O
ATOM   8956  N   SER D 167     -14.928   6.871 101.104  1.00 74.13            N
ANISOU 8956  N   SER D 167    13640   5676   8850   1879   3048   1715        N
ATOM   8957  CA  SER D 167     -15.329   8.263 100.844  1.00 68.57            C
ANISOU 8957  CA  SER D 167    12277   5470   8305   1522   2877   1554        C
ATOM   8959  CB  SER D 167     -16.250   8.320  99.617  1.00 67.23            C
ANISOU 8959  CB  SER D 167    12132   5209   8205   1129   2996   1230        C
ATOM   8962  OG  SER D 167     -15.647   7.747  98.477  1.00 69.41            O
ANISOU 8962  OG  SER D 167    12566   5319   8488   1460   3129   1180        O
ATOM   8964  C   SER D 167     -16.067   8.929 102.015  1.00 65.41            C
ANISOU 8964  C   SER D 167    11708   5266   7880   1125   2743   1567        C
ATOM   8965  O   SER D 167     -15.771  10.062 102.391  1.00 60.91            O
ANISOU 8965  O   SER D 167    10614   5141   7390   1120   2525   1606        O
ATOM   8967  N   ARG D 168     -17.052   8.222 102.559  1.00 66.25            N
ANISOU 8967  N   ARG D 168    12278   5038   7854    765   2885   1518        N
ATOM   8968  CA  ARG D 168     -17.744   8.672 103.763  1.00 65.79            C
ANISOU 8968  CA  ARG D 168    12127   5151   7719    422   2799   1544        C
ATOM   8970  CB  ARG D 168     -18.865   7.707 104.140  1.00 68.35            C
ANISOU 8970  CB  ARG D 168    13020   5080   7871    -30   3020   1469        C
ATOM   8973  CG  ARG D 168     -19.998   7.628 103.110  1.00 67.96            C
ANISOU 8973  CG  ARG D 168    12994   4965   7860   -525   3161   1124        C
ATOM   8976  CD  ARG D 168     -21.190   6.843 103.645  1.00 71.36            C
ANISOU 8976  CD  ARG D 168    13882   5137   8095  -1094   3361   1037        C
ATOM   8979  NE  ARG D 168     -20.791   5.545 104.173  1.00 75.84            N
ANISOU 8979  NE  ARG D 168    15191   5143   8481   -935   3525   1279        N
ATOM   8981  CZ  ARG D 168     -21.487   4.817 105.042  1.00 79.64            C
ANISOU 8981  CZ  ARG D 168    16157   5362   8741  -1328   3679   1348        C
ATOM   8982  NH1 ARG D 168     -22.652   5.226 105.521  1.00 78.90            N
ANISOU 8982  NH1 ARG D 168    15840   5569   8569  -1927   3706   1179        N
ATOM   8985  NH2 ARG D 168     -21.006   3.652 105.437  1.00 84.26            N
ANISOU 8985  NH2 ARG D 168    17477   5381   9156  -1106   3813   1593        N
ATOM   8988  C   ARG D 168     -16.762   8.862 104.931  1.00 66.83            C
ANISOU 8988  C   ARG D 168    12151   5460   7779    814   2628   1856        C
ATOM   8989  O   ARG D 168     -16.888   9.814 105.709  1.00 64.97            O
ANISOU 8989  O   ARG D 168    11535   5600   7552    675   2445   1866        O
ATOM   8991  N   ALA D 169     -15.766   7.986 105.027  1.00 70.22            N
ANISOU 8991  N   ALA D 169    12908   5648   8124   1334   2675   2097        N
ATOM   8992  CA  ALA D 169     -14.708   8.122 106.035  1.00 71.95            C
ANISOU 8992  CA  ALA D 169    12989   6095   8255   1783   2494   2399        C
ATOM   8994  CB  ALA D 169     -13.790   6.894 106.014  1.00 76.44            C
ANISOU 8994  CB  ALA D 169    14054   6301   8689   2390   2596   2638        C
ATOM   8998  C   ALA D 169     -13.890   9.417 105.863  1.00 68.63            C
ANISOU 8998  C   ALA D 169    11814   6276   7986   1944   2239   2397        C
ATOM   8999  O   ALA D 169     -13.565  10.075 106.851  1.00 67.33            O
ANISOU 8999  O   ALA D 169    11361   6453   7770   1966   2035   2520        O
ATOM   9001  N   ARG D 170     -13.560   9.775 104.627  1.00 67.36            N
ANISOU 9001  N   ARG D 170    11364   6241   7987   2023   2254   2258        N
ATOM   9002  CA  ARG D 170     -12.853  11.040 104.361  1.00 66.53            C
ANISOU 9002  CA  ARG D 170    10580   6683   8015   2074   2033   2244        C
ATOM   9004  CB  ARG D 170     -12.526  11.194 102.874  1.00 67.18            C
ANISOU 9004  CB  ARG D 170    10465   6823   8235   2165   2112   2105        C
ATOM   9007  CG  ARG D 170     -11.076  10.891 102.537  1.00 72.27            C
ANISOU 9007  CG  ARG D 170    10927   7681   8850   2758   2095   2292        C
ATOM   9010  CD  ARG D 170     -10.793  11.095 101.056  1.00 72.41            C
ANISOU 9010  CD  ARG D 170    10734   7797   8981   2809   2189   2144        C
ATOM   9013  NE  ARG D 170     -11.224   9.923 100.289  1.00 76.58            N
ANISOU 9013  NE  ARG D 170    11812   7816   9470   2917   2454   2033        N
```

FIG. 18 (continued)

```
ATOM    9015  CZ   ARG D 170     -12.195   9.891  99.373  1.00 75.70          C
ANISOU  9015  CZ   ARG D 170   11873   7462   9426   2546   2587   1776       C
ATOM    9016  NH1  ARG D 170     -12.883  10.988  99.044  1.00 72.65          N
ANISOU  9016  NH1  ARG D 170   11148   7299   9157   2077   2481   1602       N
ATOM    9019  NH2  ARG D 170     -12.470   8.734  98.765  1.00 78.25          N
ANISOU  9019  NH2  ARG D 170   12740   7311   9679   2665   2822   1686       N
ATOM    9022  C    ARG D 170     -13.648  12.264 104.812  1.00 61.04          C
ANISOU  9022  C    ARG D 170    9560   6249   7384   1578   1872   2090       C
ATOM    9023  O    ARG D 170     -13.075  13.219 105.348  1.00 58.84          O
ANISOU  9023  O    ARG D 170    8864   6374   7121   1601   1643   2164       O
ATOM    9025  N    ILE D 171     -14.959  12.235 104.563  1.00 57.65          N
ANISOU  9025  N    ILE D 171    9323   5605   6978   1139   1991   1860       N
ATOM    9026  CA   ILE D 171     -15.865  13.293 105.006  1.00 54.14          C
ANISOU  9026  CA   ILE D 171    8627   5381   6562    714   1864   1686       C
ATOM    9028  CB   ILE D 171     -17.270  13.147 104.358  1.00 52.89          C
ANISOU  9028  CB   ILE D 171    8630   5037   6429    290   2025   1397       C
ATOM    9030  CG1  ILE D 171     -17.173  13.347 102.836  1.00 50.79          C
ANISOU  9030  CG1  ILE D 171    8220   4769   6309    320   2071   1244       C
ATOM    9033  CD1  ILE D 171     -18.505  13.309 102.092  1.00 48.82          C
ANISOU  9033  CD1  ILE D 171    8052   4424   6074    -79   2191    944       C
ATOM    9037  CG2  ILE D 171     -18.250  14.156 104.959  1.00 51.34          C
ANISOU  9037  CG2  ILE D 171    8193   5094   6218    -75   1902   1219       C
ATOM    9041  C    ILE D 171     -15.940  13.331 106.540  1.00 55.00          C
ANISOU  9041  C    ILE D 171    8809   5577   6512    675   1766   1828       C
ATOM    9042  O    ILE D 171     -15.728  14.382 107.144  1.00 52.60          O
ANISOU  9042  O    ILE D 171    8157   5613   6216    621   1547   1829       O
ATOM    9044  N    LYS D 172     -16.184  12.177 107.162  1.00 58.79          N
ANISOU  9044  N    LYS D 172    9777   5734   6825    709   1928   1956       N
ATOM    9045  CA   LYS D 172     -16.257  12.074 108.620  1.00 60.20          C
ANISOU  9045  CA   LYS D 172   10093   5971   6810    683   1862   2117       C
ATOM    9047  CB   LYS D 172     -16.616  10.632 109.032  1.00 63.99          C
ANISOU  9047  CB   LYS D 172   11235   5980   7097    681   2098   2256       C
ATOM    9050  CG   LYS D 172     -18.059  10.212 108.695  1.00 63.56          C
ANISOU  9050  CG   LYS D 172   11464   5674   7013    147   2332   2015       C
ATOM    9053  CD   LYS D 172     -18.383   8.762 109.093  1.00 67.99          C
ANISOU  9053  CD   LYS D 172   12753   5720   7360     77   2577   2163       C
ATOM    9056  CE   LYS D 172     -18.048   7.767 107.969  1.00 70.43          C
ANISOU  9056  CE   LYS D 172   13458   5577   7726    290   2755   2163       C
ATOM    9059  NZ   LYS D 172     -18.144   6.314 108.372  1.00 74.78          N
ANISOU  9059  NZ   LYS D 172   14824   5540   8049    315   2975   2350       N
ATOM    9063  C    LYS D 172     -14.959  12.531 109.314  1.00 61.74          C
ANISOU  9063  C    LYS D 172    9999   6497   6962   1075   1616   2355       C
ATOM    9064  O    LYS D 172     -14.999  13.193 110.348  1.00 61.61          O
ANISOU  9064  O    LYS D 172    9807   6751   6851    970   1447   2385       O
ATOM    9066  N    THR D 173     -13.814  12.176 108.737  1.00 63.87          N
ANISOU  9066  N    THR D 173   10203   6784   7282   1525   1597   2508       N
ATOM    9067  CA   THR D 173     -12.505  12.591 109.262  1.00 64.89          C
ANISOU  9067  CA   THR D 173    9980   7313   7361   1902   1361   2720       C
ATOM    9069  CB   THR D 173     -11.355  11.868 108.503  1.00 68.34          C
ANISOU  9069  CB   THR D 173   10425   7725   7817   2451   1420   2878       C
ATOM    9071  OG1  THR D 173     -11.353  10.489 108.882  1.00 71.83          O
ANISOU  9071  OG1  THR D 173   11470   7740   8083   2758   1585   3064       O
ATOM    9073  CG2  THR D 173      -9.969  12.489 108.800  1.00 69.16          C
ANISOU  9073  CG2  THR D 173    9994   8392   7891   2787   1165   3044       C
ATOM    9077  C    THR D 173     -12.330  14.104 109.186  1.00 60.30          C
ANISOU  9077  C    THR D 173    8819   7189   6905   1663   1126   2578       C
ATOM    9078  O    THR D 173     -11.885  14.733 110.141  1.00 60.39          O
ANISOU  9078  O    THR D 173    8594   7532   6819   1667    905   2664       O
ATOM    9080  N    ARG D 174     -12.696  14.691 108.056  1.00 56.82          N
ANISOU  9080  N    ARG D 174    8188   6744   6658   1443   1168   2357       N
ATOM    9081  CA   ARG D 174     -12.628  16.138 107.910  1.00 53.43          C
ANISOU  9081  CA   ARG D 174    7309   6658   6336   1188    958   2215       C
ATOM    9083  CB   ARG D 174     -13.066  16.547 106.510  1.00 52.30          C
ANISOU  9083  CB   ARG D 174    7067   6424   6380   1007   1048   2002       C
ATOM    9086  CG   ARG D 174     -13.101  18.049 106.274  1.00 50.94          C
ANISOU  9086  CG   ARG D 174    6532   6519   6306    732    843   1853       C
ATOM    9089  CD   ARG D 174     -11.835  18.732 106.765  1.00 53.21          C
ANISOU  9089  CD   ARG D 174    6459   7208   6549    838    607   2015       C
ATOM    9092  NE   ARG D 174     -11.842  20.143 106.410  1.00 51.79          N
ANISOU  9092  NE   ARG D 174    6016   7207   6456    540    429   1874       N
ATOM    9094  CZ   ARG D 174     -11.051  21.064 106.953  1.00 53.37          C
ANISOU  9094  CZ   ARG D 174    5936   7738   6605    444    188   1934       C
ATOM    9095  NH1  ARG D 174     -10.171  20.744 107.912  1.00 56.01          N
ANISOU  9095  NH1  ARG D 174    6151   8333   6798    637     79   2130       N
ATOM    9098  NH2  ARG D 174     -11.164  22.322 106.552  1.00 51.70          N
ANISOU  9098  NH2  ARG D 174    5590   7591   6463    144     47   1794       N
ATOM    9101  C    ARG D 174     -13.490  16.842 108.962  1.00 50.83          C
ANISOU  9101  C    ARG D 174    6993   6397   5923    854    843   2096       C
ATOM    9102  O    ARG D 174     -13.054  17.812 109.575  1.00 49.56          O
```

FIG. 18 (continued)

```
ANISOU 9102  O   ARG D 174    6551   6552   5727    781    607   2103    O
ATOM   9104  N   LEU D 175   -14.712  16.363 109.165  1.00 49.00        N
ANISOU 9104  N   LEU D 175    7086   5893   5641    635   1013   1972    N
ATOM   9105  CA  LEU D 175   -15.590  16.974 110.166  1.00 48.70        C
ANISOU 9105  CA  LEU D 175    7052   5958   5494    344    935   1841    C
ATOM   9107  CB  LEU D 175   -17.003  16.387 110.123  1.00 48.30        C
ANISOU 9107  CB  LEU D 175    7305   5655   5393     64   1169   1671    C
ATOM   9110  CG  LEU D 175   -17.835  16.547 108.843  1.00 46.61        C
ANISOU 9110  CG  LEU D 175    7046   5324   5340   -136   1291   1413    C
ATOM   9112  CD1 LEU D 175   -19.173  15.779 109.011  1.00 46.49        C
ANISOU 9112  CD1 LEU D 175    7332   5120   5211   -440   1531   1275    C
ATOM   9116  CD2 LEU D 175   -18.046  18.041 108.476  1.00 43.98        C
ANISOU 9116  CD2 LEU D 175    6343   5244   5125   -262   1088   1198    C
ATOM   9120  C   LEU D 175   -15.007  16.837 111.574  1.00 51.52        C
ANISOU 9120  C   LEU D 175    7453   6483   5639    490    802   2056    C
ATOM   9121  O   LEU D 175   -15.145  17.753 112.386  1.00 49.81        O
ANISOU 9121  O   LEU D 175    7070   6511   5345    338    619   1975    O
ATOM   9123  N   PHE D 176   -14.370  15.696 111.864  1.00 55.13        N
ANISOU 9123  N   PHE D 176    8163   6802   5982    806    887   2323    N
ATOM   9124  CA  PHE D 176   -13.717  15.490 113.167  1.00 58.10        C
ANISOU 9124  CA  PHE D 176    8589   7358   6128   1010    745   2562    C
ATOM   9126  CB  PHE D 176   -13.159  14.069 113.301  1.00 63.99        C
ANISOU 9126  CB  PHE D 176    9722   7851   6742   1413    880   2855    C
ATOM   9129  CG  PHE D 176   -12.431  13.813 114.610  1.00 67.50        C
ANISOU 9129  CG  PHE D 176   10227   8501   6920   1688    716   3129    C
ATOM   9130  CD1 PHE D 176   -13.127  13.350 115.733  1.00 69.71        C
ANISOU 9130  CD1 PHE D 176   10893   8641   6953   1545    787   3207    C
ATOM   9132  CE1 PHE D 176   -12.456  13.103 116.943  1.00 73.64        C
ANISOU 9132  CE1 PHE D 176   11469   9338   7174   1816    626   3473    C
ATOM   9134  CZ  PHE D 176   -11.076  13.327 117.041  1.00 74.93        C
ANISOU 9134  CZ  PHE D 176   11279   9883   7308   2238    379   3647    C
ATOM   9136  CE2 PHE D 176   -10.369  13.784 115.929  1.00 73.80        C
ANISOU 9136  CE2 PHE D 176   10713   9916   7411   2360    317   3561    C
ATOM   9138  CD2 PHE D 176   -11.049  14.026 114.718  1.00 69.96        C
ANISOU 9138  CD2 PHE D 176   10192   9189   7199   2082    492   3309    C
ATOM   9140  C   PHE D 176   -12.595  16.493 113.354  1.00 56.69        C
ANISOU 9140  C   PHE D 176    7935   7632   5972   1128    444   2610    C
ATOM   9141  O   PHE D 176   -12.482  17.127 114.398  1.00 55.90        O
ANISOU 9141  O   PHE D 176    7712   7802   5726   1034    247   2615    O
ATOM   9143  N   THR D 177   -11.783  16.637 112.314  1.00 56.18        N
ANISOU 9143  N   THR D 177    7608   7663   6076   1299    419   2630    N
ATOM   9144  CA  THR D 177   -10.682  17.584 112.285  1.00 56.75        C
ANISOU 9144  CA  THR D 177    7198   8185   6178   1343    160   2664    C
ATOM   9146  CB  THR D 177    -9.954  17.515 110.897  1.00 57.80        C
ANISOU 9146  CB  THR D 177    7099   8366   6496   1513    229   2678    C
ATOM   9148  OG1 THR D 177    -9.615  16.150 110.593  1.00 60.46        O
ANISOU 9148  OG1 THR D 177    7698   8488   6787   1947    422   2862    O
ATOM   9150  CG2 THR D 177    -8.700  18.380 110.868  1.00 58.04        C
ANISOU 9150  CG2 THR D 177    6611   8920   6522   1538    -18   2745    C
ATOM   9154  C   THR D 177   -11.163  19.020 112.549  1.00 54.43        C
ANISOU 9154  C   THR D 177    6699   8055   5928    913    -23   2425    C
ATOM   9155  O   THR D 177   -10.522  19.745 113.319  1.00 55.47        O
ANISOU 9155  O   THR D 177    6591   8540   5947    859   -274   2461    O
ATOM   9157  N   ILE D 178   -12.280  19.430 111.918  1.00 49.86        N
ANISOU 9157  N   ILE D 178    6226   7228   5490    625     92   2172    N
ATOM   9158  CA  ILE D 178   -12.821  20.783 112.127  1.00 47.68        C
ANISOU 9158  CA  ILE D 178    5824   7051   5241    282    -74   1929    C
ATOM   9160  CB  ILE D 178   -14.007  21.131 111.160  1.00 44.25        C
ANISOU 9160  CB  ILE D 178    5486   6356   4972     65     67   1661    C
ATOM   9162  CG1 ILE D 178   -13.489  21.418 109.747  1.00 43.51        C
ANISOU 9162  CG1 ILE D 178    5208   6246   5079     85     85   1651    C
ATOM   9165  CD1 ILE D 178   -14.525  21.270 108.618  1.00 41.06        C
ANISOU 9165  CD1 ILE D 178    5031   5661   4910    -13    278   1459    C
ATOM   9169  CG2 ILE D 178   -14.790  22.365 111.660  1.00 41.79        C
ANISOU 9169  CG2 ILE D 178    5154   6105   4619   -204    -85   1404    C
ATOM   9173  C   ILE D 178   -13.231  20.955 113.593  1.00 48.79        C
ANISOU 9173  C   ILE D 178    6087   7295   5156    194   -175   1907    C
ATOM   9174  O   ILE D 178   -12.825  21.913 114.238  1.00 48.70        O
ANISOU 9174  O   ILE D 178    5905   7539   5061     74   -418   1858    O
ATOM   9176  N   ARG D 179   -14.028  20.030 114.112  1.00 49.37        N
ANISOU 9176  N   ARG D 179    6475   7173   5110    225     17   1940    N
ATOM   9177  CA  ARG D 179   -14.477  20.094 115.497  1.00 52.49        C
ANISOU 9177  CA  ARG D 179    7010   7675   5258    137    -40   1929    C
ATOM   9179  CB  ARG D 179   -15.331  18.872 115.819  1.00 54.09        C
ANISOU 9179  CB  ARG D 179    7596   7617   5338    143    236   2002    C
ATOM   9182  CG  ARG D 179   -15.661  18.714 117.297  1.00 57.20        C
ANISOU 9182  CG  ARG D 179    8171   8137   5426     87    208   2062    C
ATOM   9185  CD  ARG D 179   -16.846  17.806 117.511  1.00 58.77        C
ANISOU 9185  CD  ARG D 179    8731   8091   5510    -80    506   2035    C
```

FIG. 18 (continued)

```
ATOM    9188  NE   ARG D 179     -16.927  17.413 118.915  1.00 63.05          N
ANISOU  9188  NE   ARG D 179     9494   8740   5721    -80    500   2188      N
ATOM    9190  CZ   ARG D 179     -16.379  16.311 119.405  1.00 66.59          C
ANISOU  9190  CZ   ARG D 179    10247   9059   5994    150    560   2518      C
ATOM    9191  NH1  ARG D 179     -15.712  15.476 118.605  1.00 67.98          N
ANISOU  9191  NH1  ARG D 179    10543   8987   6298    426    636   2714      N
ATOM    9194  NH2  ARG D 179     -16.492  16.043 120.704  1.00 69.79          N
ANISOU  9194  NH2  ARG D 179    10863   9582   6072    133    543   2655      N
ATOM    9197  C    ARG D 179     -13.313  20.155 116.486  1.00 55.93          C
ANISOU  9197  C    ARG D 179     7319   8428   5503    316   -274   2150      C
ATOM    9198  O    ARG D 179     -13.349  20.910 117.458  1.00 55.24          O
ANISOU  9198  O    ARG D 179     7171   8566   5253    181   -461   2064      O
ATOM    9200  N    GLN D 180     -12.303  19.319 116.250  1.00 60.01          N
ANISOU  9200  N    GLN D 180     7806   8981   6015    646   -261   2425      N
ATOM    9201  CA   GLN D 180     -11.116  19.245 117.123  1.00 64.24          C
ANISOU  9201  CA   GLN D 180     8180   9881   6348    885   -489   2660      C
ATOM    9203  CB   GLN D 180     -10.182  18.117 116.669  1.00 67.83          C
ANISOU  9203  CB   GLN D 180     8652  10316   6806   1341   -408   2952      C
ATOM    9206  CG   GLN D 180      -8.983  17.861 117.574  1.00 73.08          C
ANISOU  9206  CG   GLN D 180     9154  11389   7223   1678   -633   3220      C
ATOM    9209  CD   GLN D 180      -9.361  17.175 118.874  1.00 77.15          C
ANISOU  9209  CD   GLN D 180    10052  11830   7431   1787   -617   3380      C
ATOM    9210  OE1  GLN D 180      -9.107  15.981 119.051  1.00 81.23          O
ANISOU  9210  OE1  GLN D 180    10871  12177   7814   2180   -505   3644      O
ATOM    9211  NE2  GLN D 180      -9.965  17.926 119.795  1.00 76.92          N
ANISOU  9211  NE2  GLN D 180    10046  11914   7265   1452   -725   3222      N
ATOM    9214  C    GLN D 180     -10.362  20.578 117.161  1.00 63.48          C
ANISOU  9214  C    GLN D 180     7660  10177   6283    700   -790   2547      C
ATOM    9215  O    GLN D 180     -10.011  21.067 118.232  1.00 63.96          O
ANISOU  9215  O    GLN D 180     7631  10541   6131    636  -1016   2560      O
ATOM    9217  N    GLU D 181     -10.133  21.162 115.986  1.00 62.22          N
ANISOU  9217  N    GLU D 181     7273   9999   6368    583   -789   2433      N
ATOM    9218  CA   GLU D 181      -9.487  22.482 115.880  1.00 62.57          C
ANISOU  9218  CA   GLU D 181     6975  10349   6451    318  -1051   2310      C
ATOM    9220  CB   GLU D 181      -9.170  22.823 114.412  1.00 62.48          C
ANISOU  9220  CB   GLU D 181     6763  10278   6698    246   -984   2258      C
ATOM    9223  CG   GLU D 181      -7.863  22.255 113.938  1.00 66.23          C
ANISOU  9223  CG   GLU D 181     6925  11061   7176    537   -998   2500      C
ATOM    9226  CD   GLU D 181      -6.689  22.822 114.728  1.00 70.74          C
ANISOU  9226  CD   GLU D 181     7132  12190   7557    480  -1303   2594      C
ATOM    9227  OE1  GLU D 181      -6.198  22.128 115.650  1.00 74.27          O
ANISOU  9227  OE1  GLU D 181     7559  12874   7788    782  -1378   2789      O
ATOM    9228  OE2  GLU D 181      -6.292  23.978 114.452  1.00 71.14          O
ANISOU  9228  OE2  GLU D 181     6942  12436   7653    111  -1475   2467      O
ATOM    9229  C    GLU D 181     -10.321  23.606 116.498  1.00 59.66          C
ANISOU  9229  C    GLU D 181     6725   9919   6023    -43  -1174   2031      C
ATOM    9230  O    GLU D 181      -9.782  24.489 117.164  1.00 59.47          O
ANISOU  9230  O    GLU D 181     6546  10182   5867   -227  -1438   1974      O
ATOM    9232  N    MET D 182     -11.633  23.574 116.287  1.00 55.41          N
ANISOU  9232  N    MET D 182     6461   9031   5561   -138   -987   1842      N
ATOM    9233  CA   MET D 182     -12.498  24.540 116.957  1.00 54.03          C
ANISOU  9233  CA   MET D 182     6419   8818   5291   -390  -1083   1568      C
ATOM    9235  CB   MET D 182     -13.955  24.358 116.559  1.00 51.03          C
ANISOU  9235  CB   MET D 182     6275   8116   4999   -441   -842   1368      C
ATOM    9238  CG   MET D 182     -14.297  24.861 115.149  1.00 48.55          C
ANISOU  9238  CG   MET D 182     5909   7587   4952   -531   -775   1214      C
ATOM    9241  SD   MET D 182     -16.091  24.878 115.017  1.00 45.62          S
ANISOU  9241  SD   MET D 182     5758   6983   4591   -609   -565    920      S
ATOM    9242  CE   MET D 182     -16.296  25.238 113.278  1.00 43.59          C
ANISOU  9242  CE   MET D 182     5429   6507   4626   -641   -495    814      C
ATOM    9246  C    MET D 182     -12.378  24.425 118.476  1.00 56.07          C
ANISOU  9246  C    MET D 182     6753   9311   5240   -359  -1210   1630      C
ATOM    9247  O    MET D 182     -12.249  25.436 119.149  1.00 57.21          O
ANISOU  9247  O    MET D 182     6858   9624   5256   -550  -1438   1475      O
ATOM    9249  N    ALA D 183     -12.448  23.202 119.004  1.00 57.79          N
ANISOU  9249  N    ALA D 183     7126   9513   5318   -128  -1060   1851      N
ATOM    9250  CA   ALA D 183     -12.355  22.968 120.459  1.00 61.69          C
ANISOU  9250  CA   ALA D 183     7730  10228   5480    -72  -1163   1948      C
ATOM    9252  CB   ALA D 183     -12.554  21.482 120.783  1.00 62.94          C
ANISOU  9252  CB   ALA D 183     8156  10246   5513    190   -936   2218      C
ATOM    9256  C    ALA D 183     -11.039  23.481 121.062  1.00 64.77          C
ANISOU  9256  C    ALA D 183     7844  11048   5717    -53  -1494   2057      C
ATOM    9257  O    ALA D 183     -11.029  23.981 122.182  1.00 66.59          O
ANISOU  9257  O    ALA D 183     8106  11501   5693   -162  -1675   1981      O
ATOM    9259  N    ASN D 184      -9.941  23.381 120.314  1.00 67.62          N
ANISOU  9259  N    ASN D 184     7914  11566   6214     66  -1573   2214      N
ATOM    9260  CA   ASN D 184      -8.637  23.869 120.789  1.00 72.10          C
ANISOU  9260  CA   ASN D 184     8139  12625   6631     48  -1889   2310      C
ATOM    9262  CB   ASN D 184      -7.520  23.446 119.832  1.00 74.43          C
```

FIG. 18 (continued)

| | | | | | | | | | | | | | |
|---|---|---|---|---|---|---|---|---|---|---|---|---|---|
| ANISOU | 9262 | CB | ASN | D | 184 | 8099 | 13107 | 7075 | 261 | -1887 | 2517 | | C |
| ATOM | 9265 | CG | ASN | D | 184 | -7.360 | 21.938 | 119.750 | 1.00 | 76.59 | | | C |
| ANISOU | 9265 | CG | ASN | D | 184 | 8505 | 13286 | 7310 | 757 | -1689 | 2818 | | C |
| ATOM | 9266 | OD1 | ASN | D | 184 | -7.900 | 21.192 | 120.574 | 1.00 | 76.96 | | | O |
| ANISOU | 9266 | OD1 | ASN | D | 184 | 8886 | 13187 | 7170 | 926 | -1598 | 2922 | | O |
| ATOM | 9267 | ND2 | ASN | D | 184 | -6.626 | 21.482 | 118.738 | 1.00 | 78.10 | | | N |
| ANISOU | 9267 | ND2 | ASN | D | 184 | 8471 | 13542 | 7662 | 992 | -1612 | 2957 | | N |
| ATOM | 9270 | C | ASN | D | 184 | -8.606 | 25.387 | 120.956 | 1.00 | 71.97 | | | C |
| ANISOU | 9270 | C | ASN | D | 184 | 8018 | 12721 | 6606 | -387 | -2130 | 2019 | | C |
| ATOM | 9271 | O | ASN | D | 184 | -8.077 | 25.904 | 121.953 | 1.00 | 75.38 | | | O |
| ANISOU | 9271 | O | ASN | D | 184 | 8353 | 13503 | 6785 | -511 | -2395 | 1993 | | O |
| ATOM | 9273 | N | ARG | D | 185 | -9.175 | 26.086 | 119.976 | 1.00 | 67.97 | | | N |
| ANISOU | 9273 | N | ARG | D | 185 | 7568 | 11901 | 6355 | -610 | -2043 | 1801 | | N |
| ATOM | 9274 | CA | ARG | D | 185 | -9.299 | 27.546 | 120.001 | 1.00 | 67.78 | | | C |
| ANISOU | 9274 | CA | ARG | D | 185 | 7569 | 11847 | 6339 | -1009 | -2241 | 1508 | | C |
| ATOM | 9276 | CB | ARG | D | 185 | -9.431 | 28.079 | 118.568 | 1.00 | 66.16 | | | C |
| ANISOU | 9276 | CB | ARG | D | 185 | 7329 | 11368 | 6441 | -1161 | -2152 | 1406 | | C |
| ATOM | 9279 | CG | ARG | D | 185 | -8.253 | 27.737 | 117.669 | 1.00 | 68.14 | | | C |
| ANISOU | 9279 | CG | ARG | D | 185 | 7216 | 11855 | 6820 | -1105 | -2154 | 1635 | | C |
| ATOM | 9282 | CD | ARG | D | 185 | -8.714 | 27.375 | 116.277 | 1.00 | 67.09 | | | C |
| ANISOU | 9282 | CD | ARG | D | 185 | 7130 | 11386 | 6975 | -1003 | -1894 | 1644 | | C |
| ATOM | 9285 | NE | ARG | D | 185 | -7.615 | 27.210 | 115.320 | 1.00 | 69.19 | | | N |
| ANISOU | 9285 | NE | ARG | D | 185 | 7047 | 11887 | 7357 | -982 | -1887 | 1822 | | N |
| ATOM | 9287 | CZ | ARG | D | 185 | -7.136 | 28.172 | 114.521 | 1.00 | 70.33 | | | C |
| ANISOU | 9287 | CZ | ARG | D | 185 | 7049 | 12072 | 7602 | -1314 | -1981 | 1747 | | C |
| ATOM | 9288 | NH1 | ARG | D | 185 | -7.631 | 29.411 | 114.561 | 1.00 | 69.77 | | | N |
| ANISOU | 9288 | NH1 | ARG | D | 185 | 7204 | 11771 | 7535 | -1682 | -2112 | 1501 | | N |
| ATOM | 9291 | NH2 | ARG | D | 185 | -6.138 | 27.896 | 113.673 | 1.00 | 71.26 | | | N |
| ANISOU | 9291 | NH2 | ARG | D | 185 | 6816 | 12465 | 7797 | -1271 | -1939 | 1923 | | N |
| ATOM | 9294 | C | ARG | D | 185 | -10.489 | 28.032 | 120.850 | 1.00 | 66.88 | | | C |
| ANISOU | 9294 | C | ARG | D | 185 | 7798 | 11534 | 6079 | -1105 | -2230 | 1238 | | C |
| ATOM | 9295 | O | ARG | D | 185 | -10.783 | 29.227 | 120.879 | 1.00 | 66.10 | | | O |
| ANISOU | 9295 | O | ARG | D | 185 | 7818 | 11321 | 5976 | -1377 | -2369 | 961 | | O |
| ATOM | 9297 | N | GLY | D | 186 | -11.171 | 27.113 | 121.536 | 1.00 | 66.95 | | | N |
| ANISOU | 9297 | N | GLY | D | 186 | 7988 | 11502 | 5947 | -879 | -2059 | 1317 | | N |
| ATOM | 9298 | CA | GLY | D | 186 | -12.294 | 27.467 | 122.399 | 1.00 | 66.92 | | | C |
| ANISOU | 9298 | CA | GLY | D | 186 | 8266 | 11397 | 5765 | -946 | -2019 | 1073 | | C |
| ATOM | 9301 | C | GLY | D | 186 | -13.519 | 27.974 | 121.657 | 1.00 | 64.03 | | | C |
| ANISOU | 9301 | C | GLY | D | 186 | 8074 | 10666 | 5590 | -1019 | -1850 | 788 | | C |
| ATOM | 9302 | O | GLY | D | 186 | -14.313 | 28.731 | 122.211 | 1.00 | 63.67 | | | O |
| ANISOU | 9302 | O | GLY | D | 186 | 8209 | 10570 | 5415 | -1113 | -1891 | 501 | | O |
| ATOM | 9304 | N | LEU | D | 187 | -13.672 | 27.557 | 120.402 | 1.00 | 62.78 | | | N |
| ANISOU | 9304 | N | LEU | D | 187 | 7855 | 10279 | 5718 | -947 | -1667 | 859 | | N |
| ATOM | 9305 | CA | LEU | D | 187 | -14.801 | 27.978 | 119.563 | 1.00 | 60.57 | | | C |
| ANISOU | 9305 | CA | LEU | D | 187 | 7702 | 9690 | 5623 | -984 | -1515 | 609 | | C |
| ATOM | 9307 | CB | LEU | D | 187 | -14.322 | 28.204 | 118.132 | 1.00 | 58.92 | | | C |
| ANISOU | 9307 | CB | LEU | D | 187 | 7357 | 9319 | 5710 | -1026 | -1511 | 662 | | C |
| ATOM | 9310 | CG | LEU | D | 187 | -13.158 | 29.182 | 117.947 | 1.00 | 60.44 | | | C |
| ANISOU | 9310 | CG | LEU | D | 187 | 7408 | 9631 | 5925 | -1238 | -1793 | 676 | | C |
| ATOM | 9312 | CD1 | LEU | D | 187 | -12.541 | 28.980 | 116.573 | 1.00 | 58.50 | | | C |
| ANISOU | 9312 | CD1 | LEU | D | 187 | 6978 | 9312 | 5938 | -1239 | -1722 | 832 | | C |
| ATOM | 9316 | CD2 | LEU | D | 187 | -13.612 | 30.614 | 118.145 | 1.00 | 60.26 | | | C |
| ANISOU | 9316 | CD2 | LEU | D | 187 | 7593 | 9460 | 5843 | -1445 | -1975 | 350 | | C |
| ATOM | 9320 | C | LEU | D | 187 | -15.943 | 26.962 | 119.533 | 1.00 | 59.00 | | | C |
| ANISOU | 9320 | C | LEU | D | 187 | 7629 | 9370 | 5420 | -848 | -1197 | 612 | | C |
| ATOM | 9321 | O | LEU | D | 187 | -17.090 | 27.329 | 119.284 | 1.00 | 59.62 | | | O |
| ANISOU | 9321 | O | LEU | D | 187 | 7809 | 9314 | 5531 | -872 | -1085 | 353 | | O |
| ATOM | 9323 | N | TRP | D | 188 | -15.632 | 25.694 | 119.783 | 1.00 | 58.70 | | | N |
| ANISOU | 9323 | N | TRP | D | 188 | 7594 | 9388 | 5320 | -707 | -1054 | 902 | | N |
| ATOM | 9324 | CA | TRP | D | 188 | -16.584 | 24.611 | 119.560 | 1.00 | 57.17 | | | C |
| ANISOU | 9324 | CA | TRP | D | 188 | 7546 | 9031 | 5143 | -640 | -734 | 945 | | C |
| ATOM | 9326 | CB | TRP | D | 188 | -15.935 | 23.256 | 119.860 | 1.00 | 58.38 | | | C |
| ANISOU | 9326 | CB | TRP | D | 188 | 7771 | 9202 | 5208 | -462 | -630 | 1314 | | C |
| ATOM | 9329 | CG | TRP | D | 188 | -16.934 | 22.154 | 119.808 | 1.00 | 58.08 | | | C |
| ANISOU | 9329 | CG | TRP | D | 188 | 7965 | 8973 | 5129 | -467 | -304 | 1354 | | C |
| ATOM | 9330 | CD1 | TRP | D | 188 | -17.454 | 21.472 | 120.859 | 1.00 | 59.73 | | | C |
| ANISOU | 9330 | CD1 | TRP | D | 188 | 8399 | 9239 | 5057 | -495 | -173 | 1436 | | C |
| ATOM | 9332 | NE1 | TRP | D | 188 | -18.365 | 20.549 | 120.420 | 1.00 | 59.58 | | | N |
| ANISOU | 9332 | NE1 | TRP | D | 188 | 8569 | 8995 | 5072 | -577 | 140 | 1440 | | N |
| ATOM | 9334 | CE2 | TRP | D | 188 | -18.457 | 20.628 | 119.055 | 1.00 | 57.06 | | | C |
| ANISOU | 9334 | CE2 | TRP | D | 188 | 8138 | 8480 | 5063 | -579 | 206 | 1347 | | C |
| ATOM | 9335 | CD2 | TRP | D | 188 | -17.574 | 21.641 | 118.635 | 1.00 | 56.19 | | | C |
| ANISOU | 9335 | CD2 | TRP | D | 188 | 7770 | 8466 | 5112 | -500 | -65 | 1298 | | C |
| ATOM | 9336 | CE3 | TRP | D | 188 | -17.481 | 21.935 | 117.268 | 1.00 | 53.33 | | | C |
| ANISOU | 9336 | CE3 | TRP | D | 188 | 7266 | 7947 | 5047 | -493 | -53 | 1213 | | C |
| ATOM | 9338 | CZ3 | TRP | D | 188 | -18.264 | 21.220 | 116.380 | 1.00 | 51.87 | | | C |
| ANISOU | 9338 | CZ3 | TRP | D | 188 | 7186 | 7531 | 4990 | -545 | 210 | 1162 | | C |
| ATOM | 9340 | CH2 | TRP | D | 188 | -19.137 | 20.224 | 116.828 | 1.00 | 53.48 | | | C |
| ANISOU | 9340 | CH2 | TRP | D | 188 | 7637 | 7651 | 5034 | -646 | 467 | 1193 | | C |

FIG. 18 (continued)

```
ATOM   9342  CZ2 TRP D 188     -19.250  19.916 118.162  1.00 56.23          C
ANISOU 9342  CZ2 TRP D 188     8142   8136   5088   -676    477   1292      C
ATOM   9344  C   TRP D 188     -17.906  24.727 120.348  1.00 57.09          C
ANISOU 9344  C   TRP D 188     7692   9073   4927   -731   -604    709      C
ATOM   9345  O   TRP D 188     -18.979  24.587 119.772  1.00 54.81          O
ANISOU 9345  O   TRP D 188     7437   8660   4726   -781   -399    540      O
ATOM   9347  N   ASP D 189     -17.831  24.970 121.651  1.00 59.75          N
ANISOU 9347  N   ASP D 189     8097   9638   4968   -754   -721    691      N
ATOM   9348  CA  ASP D 189     -19.033  25.030 122.490  1.00 60.37          C
ANISOU 9348  CA  ASP D 189     8302   9833   4801   -830   -581    477      C
ATOM   9350  CB  ASP D 189     -18.686  25.327 123.950  1.00 65.04          C
ANISOU 9350  CB  ASP D 189     8968  10702   5044   -840   -752    490      C
ATOM   9353  CG  ASP D 189     -17.840  24.235 124.598  1.00 68.17          C
ANISOU 9353  CG  ASP D 189     9446  11185   5271   -744   -750    890      C
ATOM   9354  OD1 ASP D 189     -18.196  23.043 124.496  1.00 68.73          O
ANISOU 9354  OD1 ASP D 189     9662  11133   5319   -714   -489   1096      O
ATOM   9355  OD2 ASP D 189     -16.824  24.578 125.243  1.00 72.02          O
ANISOU 9355  OD2 ASP D 189     9873  11870   5620   -698  -1019    996      O
ATOM   9356  C   ASP D 189     -20.025  26.075 121.974  1.00 58.18          C
ANISOU 9356  C   ASP D 189     7974   9508   4625   -878   -579     78      C
ATOM   9357  O   ASP D 189     -21.236  25.811 121.926  1.00 58.93          O
ANISOU 9357  O   ASP D 189     8090   9638   4662   -916   -346    -91      O
ATOM   9359  N   SER D 190     -19.524  27.245 121.574  1.00 55.69          N
ANISOU 9359  N   SER D 190     7598   9124   4438   -875   -835    -70      N
ATOM   9360  CA  SER D 190     -20.370  28.267 120.954  1.00 52.58          C
ANISOU 9360  CA  SER D 190     7205   8623   4148   -855   -859   -423      C
ATOM   9362  CB  SER D 190     -19.585  29.557 120.742  1.00 53.25          C
ANISOU 9362  CB  SER D 190     7323   8599   4311   -893  -1179   -531      C
ATOM   9365  OG  SER D 190     -20.421  30.565 120.182  1.00 53.74          O
ANISOU 9365  OG  SER D 190     7463   8515   4442   -823  -1214   -864      O
ATOM   9367  C   SER D 190     -20.969  27.776 119.617  1.00 49.24          C
ANISOU 9367  C   SER D 190     6700   8017   3991   -826   -649   -423      C
ATOM   9368  O   SER D 190     -22.197  27.808 119.425  1.00 46.45          O
ANISOU 9368  O   SER D 190     6328   7716   3604   -795   -483   -659      O
ATOM   9370  N   PHE D 191     -20.099  27.325 118.704  1.00 47.46          N
ANISOU 9370  N   PHE D 191     6404   7623   4004   -832   -658   -172      N
ATOM   9371  CA  PHE D 191     -20.526  26.713 117.432  1.00 45.38          C
ANISOU 9371  CA  PHE D 191     6079   7187   3975   -814   -456   -137      C
ATOM   9373  CB  PHE D 191     -19.308  26.209 116.652  1.00 42.47          C
ANISOU 9373  CB  PHE D 191     5641   6683   3814   -793   -491    168      C
ATOM   9376  CG  PHE D 191     -19.637  25.626 115.305  1.00 39.13          C
ANISOU 9376  CG  PHE D 191     5176   6071   3620   -771   -302    196      C
ATOM   9377  CD1 PHE D 191     -20.080  26.438 114.262  1.00 36.44          C
ANISOU 9377  CD1 PHE D 191     4790   5613   3443   -768   -350    -10      C
ATOM   9379  CE1 PHE D 191     -20.381  25.897 112.997  1.00 35.83          C
ANISOU 9379  CE1 PHE D 191     4672   5387   3554   -753   -183      8      C
ATOM   9381  CZ  PHE D 191     -20.242  24.537 112.762  1.00 35.49          C
ANISOU 9381  CZ  PHE D 191     4661   5278   3547   -752     40    216      C
ATOM   9383  CE2 PHE D 191     -19.779  23.706 113.784  1.00 38.49          C
ANISOU 9383  CE2 PHE D 191     5129   5725   3772   -737     93    434      C
ATOM   9385  CD2 PHE D 191     -19.484  24.261 115.072  1.00 39.49          C
ANISOU 9385  CD2 PHE D 191     5269   6038   3699   -743    -83    430      C
ATOM   9387  C   PHE D 191     -21.548  25.583 117.653  1.00 47.55          C
ANISOU 9387  C   PHE D 191     6392   7534   4142   -860   -142   -133      C
ATOM   9388  O   PHE D 191     -22.581  25.556 117.013  1.00 44.33          O
ANISOU 9388  O   PHE D 191     5933   7117   3793   -880      8   -329      O
ATOM   9390  N   ARG D 192     -21.277  24.690 118.603  1.00 53.53          N
ANISOU 9390  N   ARG D 192     7250   8383   4708   -894    -53     86      N
ATOM   9391  CA  ARG D 192     -22.194  23.591 118.906  1.00 56.82          C
ANISOU 9391  CA  ARG D 192     7763   8847   4978  -1008    253    118      C
ATOM   9393  CB  ARG D 192     -21.586  22.641 119.929  1.00 61.18          C
ANISOU 9393  CB  ARG D 192     8498   9433   5317  -1012    301    437      C
ATOM   9396  CG  ARG D 192     -22.538  21.532 120.278  1.00 64.40          C
ANISOU 9396  CG  ARG D 192     9070   9856   5542  -1191    625    481      C
ATOM   9399  CD  ARG D 192     -21.879  20.417 121.026  1.00 68.80          C
ANISOU 9399  CD  ARG D 192     9893  10329   5917  -1165    695    857      C
ATOM   9402  NE  ARG D 192     -22.799  19.686 121.898  1.00 72.92          N
ANISOU 9402  NE  ARG D 192    10615  10965   6128  -1387    950    873      N
ATOM   9404  CZ  ARG D 192     -24.043  19.286 121.594  1.00 74.19          C
ANISOU 9404  CZ  ARG D 192    10780  11163   6245  -1652   1230    697      C
ATOM   9405  NH1 ARG D 192     -24.602  19.510 120.404  1.00 72.50          N
ANISOU 9405  NH1 ARG D 192    10382  10881   6283  -1707   1293    476      N
ATOM   9408  NH2 ARG D 192     -24.743  18.629 122.511  1.00 76.84          N
ANISOU 9408  NH2 ARG D 192    11304  11638   6251  -1890   1455    747      N
ATOM   9411  C   ARG D 192     -23.553  24.058 119.429  1.00 58.47          C
ANISOU 9411  C   ARG D 192     7918   9311   4988  -1091    354   -220      C
ATOM   9412  O   ARG D 192     -24.598  23.571 118.978  1.00 58.01          O
ANISOU 9412  O   ARG D 192     7811   9299   4930  -1211    592   -346      O
ATOM   9414  N   GLN D 193     -23.539  24.983 120.386  1.00 60.65          N
```

FIG. 18 (continued)

| | | | | | | | | | | | | | |
|---|---|---|---|---|---|---|---|---|---|---|---|---|---|
| ANISOU | 9414 | N | GLN | D | 193 | 8191 | 9783 | 5070 | -1031 | 177 | -379 | | N |
| ATOM | 9415 | CA | GLN | D | 193 | -24.774 | 25.441 | 121.024 | 1.00 | 63.65 | | | C |
| ANISOU | 9415 | CA | GLN | D | 193 | 8513 | 10463 | 5210 | -1055 | 272 | -709 | | C |
| ATOM | 9417 | CB | GLN | D | 193 | -24.490 | 26.038 | 122.416 | 1.00 | 68.08 | | | C |
| ANISOU | 9417 | CB | GLN | D | 193 | 9163 | 11233 | 5472 | -1010 | 113 | -766 | | C |
| ATOM | 9420 | CG | GLN | D | 193 | -24.681 | 25.035 | 123.583 | 1.00 | 72.65 | | | C |
| ANISOU | 9420 | CG | GLN | D | 193 | 9865 | 12017 | 5723 | -1160 | 311 | -581 | | C |
| ATOM | 9423 | CD | GLN | D | 193 | -23.882 | 23.731 | 123.426 | 1.00 | 73.72 | | | C |
| ANISOU | 9423 | CD | GLN | D | 193 | 10150 | 11928 | 5930 | -1237 | 408 | -139 | | C |
| ATOM | 9424 | OE1 | GLN | D | 193 | -24.464 | 22.650 | 123.255 | 1.00 | 74.97 | | | O |
| ANISOU | 9424 | OE1 | GLN | D | 193 | 10387 | 12049 | 6048 | -1404 | 697 | -24 | | O |
| ATOM | 9425 | NE2 | GLN | D | 193 | -22.550 | 23.831 | 123.491 | 1.00 | 73.30 | | | N |
| ANISOU | 9425 | NE2 | GLN | D | 193 | 10148 | 11739 | 5964 | -1114 | 165 | 100 | | N |
| ATOM | 9428 | C | GLN | D | 193 | -25.588 | 26.415 | 120.156 | 1.00 | 62.06 | | | C |
| ANISOU | 9428 | C | GLN | D | 193 | 8156 | 10280 | 5144 | -930 | 221 | -1069 | | C |
| ATOM | 9429 | O | GLN | D | 193 | -26.803 | 26.515 | 120.326 | 1.00 | 63.28 | | | O |
| ANISOU | 9429 | O | GLN | D | 193 | 8193 | 10711 | 5140 | -935 | 377 | -1340 | | O |
| ATOM | 9431 | N | SER | D | 194 | -24.942 | 27.094 | 119.208 | 1.00 | 59.22 | | | N |
| ANISOU | 9431 | N | SER | D | 194 | 7790 | 9656 | 5054 | -815 | 14 | -1064 | | N |
| ATOM | 9432 | CA | SER | D | 194 | -25.656 | 28.021 | 118.322 | 1.00 | 57.98 | | | C |
| ANISOU | 9432 | CA | SER | D | 194 | 7543 | 9472 | 5017 | -659 | -55 | -1370 | | C |
| ATOM | 9434 | CB | SER | D | 194 | -24.679 | 28.896 | 117.520 | 1.00 | 57.70 | | | C |
| ANISOU | 9434 | CB | SER | D | 194 | 7588 | 9112 | 5223 | -569 | -329 | -1313 | | C |
| ATOM | 9437 | OG | SER | D | 194 | -24.123 | 28.200 | 116.413 | 1.00 | 56.80 | | | O |
| ANISOU | 9437 | OG | SER | D | 194 | 7426 | 8782 | 5373 | -644 | -261 | -1067 | | O |
| ATOM | 9439 | C | SER | D | 194 | -26.649 | 27.342 | 117.365 | 1.00 | 55.97 | | | C |
| ANISOU | 9439 | C | SER | D | 194 | 7121 | 9288 | 4856 | -714 | 190 | -1448 | | C |
| ATOM | 9440 | O | SER | D | 194 | -27.536 | 28.008 | 116.848 | 1.00 | 54.99 | | | O |
| ANISOU | 9440 | O | SER | D | 194 | 6882 | 9277 | 4736 | -561 | 171 | -1743 | | O |
| ATOM | 9442 | N | GLU | D | 195 | -26.531 | 26.030 | 117.162 | 1.00 | 54.46 | | | N |
| ANISOU | 9442 | N | GLU | D | 195 | 6938 | 9043 | 4714 | -923 | 412 | -1199 | | N |
| ATOM | 9443 | CA | GLU | D | 195 | -27.458 | 25.305 | 116.289 | 1.00 | 54.81 | | | C |
| ANISOU | 9443 | CA | GLU | D | 195 | 6847 | 9159 | 4821 | -1048 | 650 | -1279 | | C |
| ATOM | 9445 | CB | GLU | D | 195 | -26.941 | 23.894 | 115.961 | 1.00 | 52.14 | | | C |
| ANISOU | 9445 | CB | GLU | D | 195 | 6639 | 8593 | 4578 | -1263 | 842 | -946 | | C |
| ATOM | 9448 | CG | GLU | D | 195 | -27.878 | 23.128 | 114.996 | 1.00 | 50.61 | | | C |
| ANISOU | 9448 | CG | GLU | D | 195 | 6341 | 8446 | 4442 | -1448 | 1083 | -1046 | | C |
| ATOM | 9451 | CD | GLU | D | 195 | -27.246 | 21.927 | 114.316 | 1.00 | 48.32 | | | C |
| ANISOU | 9451 | CD | GLU | D | 195 | 6235 | 7813 | 4311 | -1589 | 1221 | -752 | | C |
| ATOM | 9452 | OE1 | GLU | D | 195 | -28.002 | 21.088 | 113.787 | 1.00 | 43.12 | | | O |
| ANISOU | 9452 | OE1 | GLU | D | 195 | 5566 | 7185 | 3633 | -1826 | 1454 | -810 | | O |
| ATOM | 9453 | OE2 | GLU | D | 195 | -25.995 | 21.834 | 114.282 | 1.00 | 45.31 | | | O |
| ANISOU | 9453 | OE2 | GLU | D | 195 | 6004 | 7149 | 4061 | -1458 | 1095 | -479 | | O |
| ATOM | 9454 | C | GLU | D | 195 | -28.886 | 25.203 | 116.849 | 1.00 | 60.40 | | | C |
| ANISOU | 9454 | C | GLU | D | 195 | 7381 | 10314 | 5255 | -1137 | 851 | -1564 | | C |
| ATOM | 9455 | O | GLU | D | 195 | -29.834 | 25.204 | 116.069 | 1.00 | 63.74 | | | O |
| ANISOU | 9455 | O | GLU | D | 195 | 7602 | 10909 | 5707 | -1146 | 949 | -1780 | | O |
| ATOM | 9457 | N | ARG | D | 196 | -29.037 | 25.097 | 118.169 | 1.00 | 62.97 | | | N |
| ANISOU | 9457 | N | ARG | D | 196 | 7760 | 10870 | 5296 | -1210 | 916 | -1565 | | N |
| ATOM | 9458 | CA | ARG | D | 196 | -30.345 | 24.826 | 118.796 | 1.00 | 67.06 | | | C |
| ANISOU | 9458 | CA | ARG | D | 196 | 8099 | 11873 | 5510 | -1359 | 1158 | -1798 | | C |
| ATOM | 9460 | CB | ARG | D | 196 | -30.172 | 24.391 | 120.256 | 1.00 | 69.57 | | | C |
| ANISOU | 9460 | CB | ARG | D | 196 | 8571 | 12343 | 5520 | -1512 | 1256 | -1657 | | C |
| ATOM | 9469 | C | ARG | D | 196 | -31.302 | 26.021 | 118.737 | 1.00 | 70.38 | | | C |
| ANISOU | 9469 | C | ARG | D | 196 | 8271 | 12643 | 5826 | -1068 | 1059 | -2234 | | C |
| ATOM | 9470 | O | ARG | D | 196 | -31.830 | 26.343 | 117.666 | 1.00 | 71.31 | | | O |
| ANISOU | 9470 | O | ARG | D | 196 | 8210 | 12793 | 6091 | -943 | 1028 | -2414 | | O |
| ATOM | 9472 | MN | MN | D | 301 | -28.199 | 23.378 | 98.969 | 0.50 | 60.19 | | | MN |
| ANISOU | 9472 | MN | MN | D | 301 | 7070 | 8507 | 7291 | -933 | 837 | -1536 | | MN |
| ATOM | 9473 | MN | MN | D | 302 | -27.840 | 20.860 | 101.908 | 0.40 | 49.24 | | | MN |
| ANISOU | 9473 | MN | MN | D | 302 | 5975 | 6942 | 5790 | -1487 | 1329 | -1259 | | MN |
| ATOM | 9474 | OH2 | HOH | D | 303 | -28.106 | 23.725 | 96.898 | 1.00 | 34.38 | | | O |
| ANISOU | 9474 | OH2 | HOH | D | 303 | 3810 | 5182 | 4071 | -798 | 743 | -1570 | | O |
| ATOM | 9477 | OH2 | HOH | D | 304 | -27.648 | 26.518 | 96.463 | 1.00 | 43.38 | | | O |
| ANISOU | 9477 | OH2 | HOH | D | 304 | 5042 | 6217 | 5222 | -248 | 225 | -1507 | | O |
| ATOM | 9480 | S | SO4 | D | 401 | -34.249 | 25.520 | 99.273 | 0.70 | 46.89 | | | S |
| ANISOU | 9480 | S | SO4 | D | 401 | 4094 | 8983 | 4739 | -474 | 518 | -2968 | | S |
| ATOM | 9481 | O1 | SO4 | D | 401 | -33.136 | 24.663 | 98.851 | 0.70 | 42.00 | | | O |
| ANISOU | 9481 | O1 | SO4 | D | 401 | 3765 | 7875 | 4320 | -743 | 652 | -2683 | | O |
| ATOM | 9482 | O2 | SO4 | D | 401 | -35.106 | 25.721 | 98.090 | 0.70 | 45.27 | | | O |
| ANISOU | 9482 | O2 | SO4 | D | 401 | 3661 | 9124 | 4414 | -341 | 419 | -3188 | | O |
| ATOM | 9483 | O3 | SO4 | D | 401 | -33.753 | 26.784 | 99.817 | 0.70 | 41.48 | | | O |
| ANISOU | 9483 | O3 | SO4 | D | 401 | 3575 | 8090 | 4096 | -68 | 291 | -2892 | | O |
| ATOM | 9484 | O4 | SO4 | D | 401 | -35.017 | 24.909 | 100.363 | 0.70 | 49.38 | | | O |
| ANISOU | 9484 | O4 | SO4 | D | 401 | 4190 | 9679 | 4894 | -745 | 712 | -3121 | | O |
| ATOM | 9485 | S | SO4 | D | 402 | -20.006 | 17.139 | 121.294 | 0.60 | 67.62 | | | S |
| ANISOU | 9485 | S | SO4 | D | 402 | 10536 | 9543 | 5615 | -850 | 926 | 1874 | | S |
| ATOM | 9486 | O1 | SO4 | D | 402 | -19.236 | 17.503 | 120.118 | 0.60 | 64.90 | | | O |
| ANISOU | 9486 | O1 | SO4 | D | 402 | 9959 | 9087 | 5611 | -649 | 787 | 1857 | | O |

FIG. 18 (continued)

| | | | | | | | | | | | | | |
|---|---|---|---|---|---|---|---|---|---|---|---|---|---|
| ATOM | 9487 | O2 | SO4 | D | 402 | -19.775 | 18.109 | 122.362 | 0.60 | 68.47 | | | O |
| ANISOU | 9487 | O2 | SO4 | D | 402 | 10468 | 10015 | 5531 | -816 | 687 | 1791 | | O |
| ATOM | 9488 | O3 | SO4 | D | 402 | -19.581 | 15.818 | 121.749 | 0.60 | 71.79 | | | O |
| ANISOU | 9488 | O3 | SO4 | D | 402 | 11494 | 9831 | 5951 | -734 | 1053 | 2254 | | O |
| ATOM | 9489 | O4 | SO4 | D | 402 | -21.427 | 17.084 | 120.968 | 0.60 | 66.61 | | | O |
| ANISOU | 9489 | O4 | SO4 | D | 402 | 10410 | 9414 | 5485 | -1201 | 1184 | 1601 | | O |
| ATOM | 9490 | S | SO4 | D | 403 | -27.976 | 17.391 | 121.040 | 0.60 | 75.73 | | | S |
| ANISOU | 9490 | S | SO4 | D | 403 | 11010 | 11694 | 6071 | -2784 | 2218 | 237 | | S |
| ATOM | 9491 | O1 | SO4 | D | 403 | -26.715 | 16.929 | 120.465 | 0.60 | 74.53 | | | O |
| ANISOU | 9491 | O1 | SO4 | D | 403 | 11100 | 11055 | 6164 | -2538 | 2088 | 552 | | O |
| ATOM | 9492 | O2 | SO4 | D | 403 | -27.870 | 18.821 | 121.305 | 0.60 | 73.88 | | | O |
| ANISOU | 9492 | O2 | SO4 | D | 403 | 10446 | 11751 | 5875 | -2486 | 1945 | -11 | | O |
| ATOM | 9493 | O3 | SO4 | D | 403 | -28.246 | 16.692 | 122.294 | 0.60 | 80.02 | | | O |
| ANISOU | 9493 | O3 | SO4 | D | 403 | 11831 | 12355 | 6218 | -3035 | 2409 | 414 | | O |
| ATOM | 9494 | O4 | SO4 | D | 403 | -29.069 | 17.148 | 120.103 | 0.60 | 74.90 | | | O |
| ANISOU | 9494 | O4 | SO4 | D | 403 | 10724 | 11691 | 6043 | -3073 | 2426 | -17 | | O |
| ATOM | 9495 | OH2 | HOH | S | 1 | 0.062 | 24.684 | 82.901 | 1.00 | 25.69 | | | O |
| ATOM | 9498 | OH2 | HOH | S | 2 | 5.041 | 26.744 | 99.774 | 1.00 | 29.91 | | | O |
| ATOM | 9501 | OH2 | HOH | S | 3 | 19.523 | 48.003 | 90.624 | 1.00 | 22.84 | | | O |
| ATOM | 9504 | OH2 | HOH | S | 5 | 7.249 | 35.813 | 101.210 | 1.00 | 28.70 | | | O |
| ATOM | 9507 | OH2 | HOH | S | 8 | 5.868 | 38.932 | 108.633 | 1.00 | 28.84 | | | O |
| ATOM | 9510 | OH2 | HOH | S | 9 | -4.974 | 17.727 | 71.021 | 1.00 | 47.03 | | | O |
| ATOM | 9513 | OH2 | HOH | S | 10 | 10.927 | 40.922 | 101.134 | 1.00 | 25.85 | | | O |
| ATOM | 9516 | OH2 | HOH | S | 11 | 1.098 | 34.251 | 97.084 | 1.00 | 31.46 | | | O |
| ATOM | 9519 | OH2 | HOH | S | 12 | -3.767 | 42.767 | 76.878 | 1.00 | 33.68 | | | O |
| ATOM | 9522 | OH2 | HOH | S | 14 | 12.299 | 37.857 | 88.546 | 1.00 | 28.93 | | | O |
| ATOM | 9525 | OH2 | HOH | S | 15 | 3.680 | 36.673 | 99.056 | 1.00 | 29.58 | | | O |
| ATOM | 9528 | OH2 | HOH | S | 19 | 27.950 | 36.385 | 114.949 | 1.00 | 37.32 | | | O |
| ATOM | 9531 | OH2 | HOH | S | 20 | -23.713 | 22.455 | 110.675 | 1.00 | 29.10 | | | O |
| ATOM | 9534 | OH2 | HOH | S | 21 | -1.009 | 22.921 | 80.906 | 1.00 | 29.12 | | | O |
| ATOM | 9537 | OH2 | HOH | S | 22 | -4.475 | 35.464 | 92.443 | 1.00 | 24.81 | | | O |
| ATOM | 9540 | OH2 | HOH | S | 23 | 8.782 | 23.580 | 111.171 | 1.00 | 36.80 | | | O |
| ATOM | 9543 | OH2 | HOH | S | 24 | 3.067 | 40.236 | 104.679 | 1.00 | 30.93 | | | O |
| ATOM | 9546 | OH2 | HOH | S | 26 | 25.608 | 54.437 | 105.241 | 1.00 | 26.93 | | | O |
| ATOM | 9549 | OH2 | HOH | S | 27 | 16.461 | 27.165 | 96.651 | 1.00 | 35.66 | | | O |
| ATOM | 9552 | OH2 | HOH | S | 28 | 29.704 | 33.968 | 85.233 | 1.00 | 43.78 | | | O |
| ATOM | 9555 | OH2 | HOH | S | 29 | 12.541 | 45.953 | 116.919 | 1.00 | 47.52 | | | O |
| ATOM | 9558 | OH2 | HOH | S | 30 | 9.690 | 41.870 | 68.637 | 1.00 | 33.34 | | | O |
| ATOM | 9561 | OH2 | HOH | S | 31 | 19.724 | 46.723 | 86.346 | 1.00 | 30.74 | | | O |
| ATOM | 9564 | OH2 | HOH | S | 32 | 13.930 | 31.423 | 93.968 | 1.00 | 30.78 | | | O |
| ATOM | 9567 | OH2 | HOH | S | 33 | -2.096 | 18.086 | 85.105 | 1.00 | 32.48 | | | O |
| ATOM | 9570 | OH2 | HOH | S | 34 | 11.121 | 28.090 | 99.161 | 1.00 | 30.81 | | | O |
| ATOM | 9573 | OH2 | HOH | S | 35 | 3.273 | 34.095 | 98.573 | 1.00 | 32.91 | | | O |
| ATOM | 9576 | OH2 | HOH | S | 37 | 19.321 | 46.250 | 99.994 | 1.00 | 22.33 | | | O |
| ATOM | 9579 | OH2 | HOH | S | 38 | -7.678 | 20.563 | 76.781 | 1.00 | 40.12 | | | O |
| ATOM | 9582 | OH2 | HOH | S | 40 | 13.780 | 23.868 | 109.878 | 1.00 | 36.26 | | | O |
| ATOM | 9585 | OH2 | HOH | S | 41 | -9.073 | 20.418 | 94.927 | 1.00 | 44.90 | | | O |
| ATOM | 9588 | OH2 | HOH | S | 42 | -4.991 | 29.737 | 89.751 | 1.00 | 35.50 | | | O |
| ATOM | 9591 | OH2 | HOH | S | 43 | 12.715 | 38.965 | 85.275 | 1.00 | 57.53 | | | O |
| ATOM | 9594 | OH2 | HOH | S | 44 | 19.802 | 53.492 | 84.952 | 1.00 | 42.01 | | | O |
| ATOM | 9597 | OH2 | HOH | S | 45 | 14.553 | 54.161 | 97.433 | 1.00 | 34.06 | | | O |
| ATOM | 9600 | OH2 | HOH | S | 48 | 4.616 | 51.945 | 105.181 | 1.00 | 58.84 | | | O |
| ATOM | 9603 | OH2 | HOH | S | 51 | 11.476 | 28.483 | 86.843 | 1.00 | 35.13 | | | O |
| ATOM | 9606 | OH2 | HOH | S | 52 | 21.205 | 49.503 | 96.599 | 1.00 | 27.24 | | | O |
| ATOM | 9609 | OH2 | HOH | S | 53 | 6.598 | 35.101 | 68.723 | 1.00 | 38.82 | | | O |
| ATOM | 9612 | OH2 | HOH | S | 54 | 12.418 | 45.152 | 100.982 | 1.00 | 32.90 | | | O |
| ATOM | 9615 | OH2 | HOH | S | 55 | 2.765 | 47.906 | 90.848 | 1.00 | 42.28 | | | O |
| ATOM | 9618 | OH2 | HOH | S | 56 | 34.091 | 49.452 | 82.599 | 1.00 | 46.87 | | | O |
| ATOM | 9621 | OH2 | HOH | S | 57 | 18.039 | 33.685 | 85.188 | 1.00 | 39.86 | | | O |
| ATOM | 9624 | OH2 | HOH | S | 58 | 34.743 | 40.618 | 83.700 | 1.00 | 48.99 | | | O |
| ATOM | 9627 | OH2 | HOH | S | 59 | 5.836 | 42.154 | 79.337 | 1.00 | 36.16 | | | O |
| ATOM | 9630 | OH2 | HOH | S | 60 | 19.672 | 48.371 | 113.647 | 1.00 | 32.80 | | | O |
| ATOM | 9633 | OH2 | HOH | S | 61 | -11.286 | 35.969 | 97.938 | 1.00 | 32.16 | | | O |
| ATOM | 9636 | OH2 | HOH | S | 63 | 21.313 | 35.851 | 85.625 | 1.00 | 32.91 | | | O |
| ATOM | 9639 | OH2 | HOH | S | 64 | 10.917 | 25.957 | 96.584 | 1.00 | 28.98 | | | O |
| ATOM | 9642 | OH2 | HOH | S | 65 | 19.332 | 32.806 | 96.412 | 1.00 | 42.40 | | | O |
| ATOM | 9645 | OH2 | HOH | S | 66 | 4.367 | 33.324 | 109.829 | 1.00 | 53.36 | | | O |
| ATOM | 9648 | OH2 | HOH | S | 67 | -1.545 | 29.274 | 91.562 | 1.00 | 44.97 | | | O |
| ATOM | 9651 | OH2 | HOH | S | 69 | 33.158 | 31.375 | 91.673 | 1.00 | 45.84 | | | O |
| ATOM | 9654 | OH2 | HOH | S | 71 | 13.049 | 24.535 | 92.838 | 1.00 | 29.36 | | | O |
| ATOM | 9657 | OH2 | HOH | S | 72 | 5.198 | 45.062 | 83.047 | 1.00 | 37.65 | | | O |
| ATOM | 9660 | OH2 | HOH | S | 74 | 33.408 | 46.948 | 94.390 | 1.00 | 31.17 | | | O |
| ATOM | 9663 | OH2 | HOH | S | 75 | 27.533 | 49.208 | 82.074 | 1.00 | 39.57 | | | O |
| ATOM | 9666 | OH2 | HOH | S | 82 | 16.239 | 24.966 | 92.440 | 1.00 | 48.38 | | | O |
| ATOM | 9669 | OH2 | HOH | S | 85 | 17.867 | 13.953 | 86.983 | 1.00 | 47.68 | | | O |
| ATOM | 9672 | OH2 | HOH | S | 88 | 20.835 | 37.732 | 97.703 | 1.00 | 37.50 | | | O |
| ATOM | 9675 | OH2 | HOH | S | 89 | 3.564 | 39.911 | 68.945 | 1.00 | 42.81 | | | O |
| ATOM | 9678 | OH2 | HOH | S | 91 | 36.527 | 48.533 | 94.837 | 1.00 | 60.18 | | | O |
| ATOM | 9681 | OH2 | HOH | S | 92 | 24.908 | 30.650 | 89.450 | 1.00 | 38.14 | | | O |

FIG. 18 (continued)

| | | | | | | | | | | | |
|---|---|---|---|---|---|---|---|---|---|---|---|
| ATOM | 9684 | OH2 | HOH | S | 94 | 11.632 | 49.466 | 93.909 | 1.00 | 33.32 | O |
| ATOM | 9687 | OH2 | HOH | S | 96 | 26.591 | 56.493 | 84.785 | 1.00 | 36.27 | O |
| ATOM | 9690 | OH2 | HOH | S | 97 | -5.487 | 31.790 | 97.868 | 1.00 | 36.30 | O |
| ATOM | 9693 | OH2 | HOH | S | 100 | 34.188 | 41.639 | 98.410 | 1.00 | 40.19 | O |
| ATOM | 9696 | OH2 | HOH | S | 101 | -0.804 | 41.114 | 68.120 | 1.00 | 44.55 | O |
| ATOM | 9699 | OH2 | HOH | S | 103 | -37.794 | 26.572 | 97.040 | 1.00 | 46.79 | O |
| ATOM | 9702 | OH2 | HOH | S | 104 | 13.549 | 40.945 | 72.882 | 1.00 | 65.75 | O |
| ATOM | 9705 | OH2 | HOH | S | 105 | -29.764 | 17.249 | 113.916 | 1.00 | 38.77 | O |
| ATOM | 9708 | OH2 | HOH | S | 106 | -8.974 | 30.410 | 103.171 | 1.00 | 59.38 | O |
| ATOM | 9711 | OH2 | HOH | S | 107 | 5.989 | 44.845 | 80.533 | 1.00 | 39.34 | O |
| ATOM | 9714 | OH2 | HOH | S | 108 | 24.144 | 31.363 | 110.307 | 1.00 | 34.68 | O |
| ATOM | 9717 | OH2 | HOH | S | 109 | 37.679 | 51.033 | 89.708 | 1.00 | 43.85 | O |
| ATOM | 9720 | OH2 | HOH | S | 111 | 5.975 | 32.614 | 106.422 | 1.00 | 43.47 | O |
| ATOM | 9723 | OH2 | HOH | S | 113 | 22.157 | 47.075 | 97.344 | 1.00 | 26.37 | O |
| ATOM | 9726 | OH2 | HOH | S | 114 | -3.099 | 38.607 | 73.976 | 1.00 | 28.74 | O |
| ATOM | 9729 | OH2 | HOH | S | 116 | 44.282 | 22.944 | 108.107 | 1.00 | 31.20 | O |
| ATOM | 9732 | OH2 | HOH | S | 117 | 33.011 | 34.445 | 91.356 | 1.00 | 31.59 | O |
| ATOM | 9735 | OH2 | HOH | S | 118 | 29.897 | 35.602 | 117.409 | 1.00 | 53.61 | O |
| ATOM | 9738 | OH2 | HOH | S | 119 | 41.255 | 21.524 | 106.323 | 1.00 | 30.67 | O |
| ATOM | 9741 | OH2 | HOH | S | 120 | 42.707 | 28.196 | 113.002 | 1.00 | 37.53 | O |
| ATOM | 9744 | OH2 | HOH | S | 121 | 15.791 | 55.030 | 99.670 | 1.00 | 35.09 | O |
| ATOM | 9747 | OH2 | HOH | S | 124 | 21.900 | 52.545 | 118.132 | 1.00 | 54.35 | O |
| ATOM | 9750 | OH2 | HOH | S | 125 | -6.232 | 22.730 | 74.247 | 1.00 | 36.81 | O |
| ATOM | 9753 | OH2 | HOH | S | 127 | 12.798 | 57.322 | 94.863 | 1.00 | 44.97 | O |
| ATOM | 9756 | OH2 | HOH | S | 128 | 24.930 | 35.392 | 78.917 | 1.00 | 57.13 | O |
| ATOM | 9759 | OH2 | HOH | S | 129 | 23.777 | 57.180 | 99.188 | 1.00 | 48.48 | O |
| ATOM | 9762 | OH2 | HOH | S | 130 | 21.212 | 47.901 | 84.571 | 1.00 | 51.00 | O |
| ATOM | 9765 | OH2 | HOH | S | 131 | 4.954 | 29.418 | 100.967 | 1.00 | 35.15 | O |
| ATOM | 9768 | OH2 | HOH | S | 132 | 29.868 | 26.486 | 110.735 | 1.00 | 55.71 | O |
| ATOM | 9771 | OH2 | HOH | S | 133 | 3.126 | 28.599 | 72.699 | 1.00 | 34.84 | O |
| ATOM | 9774 | OH2 | HOH | S | 135 | 5.645 | 47.068 | 78.246 | 1.00 | 51.58 | O |
| ATOM | 9777 | OH2 | HOH | S | 136 | -5.273 | 33.831 | 67.850 | 1.00 | 43.08 | O |
| ATOM | 9780 | OH2 | HOH | S | 137 | -14.918 | 24.947 | 122.809 | 1.00 | 44.97 | O |
| ATOM | 9783 | OH2 | HOH | S | 138 | 9.119 | 24.625 | 98.165 | 1.00 | 34.50 | O |
| ATOM | 9786 | OH2 | HOH | S | 139 | 5.104 | 40.611 | 106.505 | 1.00 | 34.38 | O |
| ATOM | 9789 | OH2 | HOH | S | 140 | -2.923 | 42.899 | 67.198 | 1.00 | 48.20 | O |
| ATOM | 9792 | OH2 | HOH | S | 141 | 22.957 | 34.693 | 87.184 | 1.00 | 35.39 | O |
| ATOM | 9795 | OH2 | HOH | S | 142 | 28.947 | 31.208 | 89.292 | 1.00 | 39.24 | O |
| ATOM | 9798 | OH2 | HOH | S | 143 | 18.605 | 56.537 | 112.175 | 1.00 | 40.47 | O |
| ATOM | 9801 | OH2 | HOH | S | 144 | 30.729 | 63.473 | 95.899 | 1.00 | 54.64 | O |
| ATOM | 9804 | OH2 | HOH | S | 146 | 26.971 | 31.036 | 91.036 | 1.00 | 35.24 | O |
| ATOM | 9807 | OH2 | HOH | S | 147 | 15.740 | 16.650 | 82.748 | 1.00 | 54.25 | O |
| ATOM | 9810 | OH2 | HOH | S | 149 | 13.573 | 33.187 | 73.056 | 1.00 | 43.92 | O |
| ATOM | 9813 | OH2 | HOH | S | 151 | 11.241 | 22.617 | 84.242 | 1.00 | 40.27 | O |
| ATOM | 9816 | OH2 | HOH | S | 152 | -10.240 | 28.122 | 82.876 | 1.00 | 50.11 | O |
| ATOM | 9819 | OH2 | HOH | S | 153 | 25.069 | 27.725 | 108.791 | 1.00 | 49.49 | O |
| ATOM | 9822 | OH2 | HOH | S | 158 | 9.398 | 38.471 | 80.725 | 1.00 | 45.92 | O |
| ATOM | 9825 | OH2 | HOH | S | 160 | -3.411 | 31.863 | 94.902 | 1.00 | 42.07 | O |
| ATOM | 9828 | OH2 | HOH | S | 161 | 1.898 | 45.841 | 107.676 | 1.00 | 38.52 | O |
| ATOM | 9831 | OH2 | HOH | S | 162 | 33.085 | 52.958 | 118.057 | 1.00 | 59.62 | O |
| ATOM | 9834 | OH2 | HOH | S | 166 | -2.729 | 34.774 | 64.059 | 1.00 | 45.98 | O |
| ATOM | 9837 | OH2 | HOH | S | 167 | 28.992 | 55.856 | 103.150 | 1.00 | 40.37 | O |
| ATOM | 9840 | OH2 | HOH | S | 168 | 14.598 | 32.835 | 75.586 | 1.00 | 47.84 | O |
| ATOM | 9843 | OH2 | HOH | S | 169 | 6.714 | 48.607 | 82.148 | 1.00 | 50.86 | O |
| ATOM | 9846 | OH2 | HOH | S | 170 | 14.765 | 27.208 | 80.401 | 1.00 | 42.36 | O |
| ATOM | 9849 | OH2 | HOH | S | 172 | 16.318 | 34.406 | 120.533 | 1.00 | 39.23 | O |
| ATOM | 9852 | OH2 | HOH | S | 174 | -1.284 | 30.830 | 93.093 | 1.00 | 41.69 | O |
| ATOM | 9855 | OH2 | HOH | S | 176 | 14.363 | 18.570 | 86.552 | 1.00 | 57.69 | O |
| ATOM | 9858 | OH2 | HOH | S | 177 | 3.188 | 25.041 | 101.342 | 1.00 | 44.26 | O |
| ATOM | 9861 | OH2 | HOH | S | 183 | 3.664 | 30.745 | 112.620 | 1.00 | 52.41 | O |
| ATOM | 9864 | OH2 | HOH | S | 185 | 5.232 | 33.369 | 104.030 | 1.00 | 43.55 | O |
| ATOM | 9867 | OH2 | HOH | S | 187 | 12.519 | 24.561 | 95.399 | 1.00 | 33.52 | O |
| ATOM | 9870 | OH2 | HOH | S | 188 | -1.326 | 43.943 | 70.814 | 1.00 | 43.18 | O |
| ATOM | 9873 | OH2 | HOH | S | 189 | 3.963 | 36.432 | 101.856 | 1.00 | 36.70 | O |
| ATOM | 9876 | OH2 | HOH | S | 190 | 13.096 | 48.395 | 92.768 | 1.00 | 32.67 | O |
| ATOM | 9879 | OH2 | HOH | S | 195 | 16.586 | 41.620 | 75.485 | 1.00 | 51.42 | O |
| ATOM | 9882 | OH2 | HOH | S | 197 | 31.672 | 57.668 | 97.534 | 1.00 | 45.87 | O |
| ATOM | 9885 | OH2 | HOH | S | 198 | 29.997 | 58.567 | 99.589 | 1.00 | 52.75 | O |
| ATOM | 9888 | OH2 | HOH | S | 200 | -11.243 | 24.518 | 83.712 | 1.00 | 45.06 | O |
| ATOM | 9891 | OH2 | HOH | S | 201 | -2.349 | 14.997 | 88.345 | 1.00 | 35.80 | O |
| ATOM | 9894 | OH2 | HOH | S | 202 | 0.205 | 29.849 | 95.949 | 1.00 | 34.75 | O |
| ATOM | 9897 | OH2 | HOH | S | 203 | 1.605 | 21.146 | 98.630 | 1.00 | 42.38 | O |
| ATOM | 9900 | OH2 | HOH | S | 204 | -11.191 | 45.278 | 98.416 | 1.00 | 52.72 | O |
| ATOM | 9903 | OH2 | HOH | S | 205 | 2.547 | 47.080 | 87.805 | 1.00 | 44.74 | O |
| ATOM | 9906 | OH2 | HOH | S | 206 | 27.768 | 45.382 | 82.105 | 1.00 | 37.85 | O |
| ATOM | 9909 | OH2 | HOH | S | 207 | 12.706 | 44.426 | 118.819 | 1.00 | 52.70 | O |
| ATOM | 9912 | OH2 | HOH | S | 208 | 13.041 | 41.258 | 120.479 | 1.00 | 44.83 | O |
| ATOM | 9915 | OH2 | HOH | S | 209 | 9.458 | 40.556 | 120.132 | 1.00 | 48.26 | O |

FIG. 18 (continued)

POLYPEPTIDE FRAGMENTS COMPRISING ENDONUCLEASE ACTIVITY AND THEIR USE

CROSS REFERENCES

This application is a continuation application to U.S. patent application Ser. No. 13/140,626, filed on Jun. 16, 2011, which is a National Stage filing of International Application Serial No. PCT/EP2009/009161, filed Dec. 18, 2009, which claims the benefit of U.S. Provisional Application Ser. No. 61/203,259 filed Dec. 19, 2008, the disclosures of which are expressly incorporated herein by reference.

TECHNICAL FIELD OF INVENTION

The present invention relates to polypeptide fragments comprising an amino-terminal fragment of the PA subunit of a viral RNA-dependent RNA polymerase or variants thereof possessing endonuclease activity, wherein said PA subunit is from a virus belonging to the Orthomyxoviridae family. This invention also relates to (i) crystals of the polypeptide fragments which are suitable for structure determination of said polypeptide fragments using X-ray crystallography and (ii) computational methods using the structural coordinates of said polypeptide to screen for and design compounds that modulate, preferably inhibit the endonucleolytically active site within the polypeptide fragment. In addition, this invention relates to methods identifying compounds that bind to the PA polypeptide fragments possessing endonuclease activity and preferably inhibit said endonucleolytic activity, preferably in a high throughput setting. This invention also relates to compounds and pharmaceutical compositions comprising the identified compounds for the treatment of disease conditions due to viral infections caused by viruses of the Orthomyxoviridae family.

STATEMENT REGARDING SEQUENCE LISTING

The Sequence Listing associated with this application is provided in text format submitted electronically via EFS-Web, and is hereby incorporated by reference into the specification.

BACKGROUND OF THE INVENTION

Influenza is responsible for much morbidity and mortality in the world and is considered by many as belonging to the most significant viral threats to humans. Annual Influenza epidemics swipe the globe and occasional new virulent strains cause pandemics of great destructive power. At present the primary means of controlling Influenza virus epidemics is vaccination. However, mutant Influenza viruses are rapidly generated which escape the effects of vaccination. In the light of the fact that it takes approximately 6 months to generate a new Influenza vaccine, alternative therapeutic means, i.e., antiviral medication, are required especially as the first line of defense against a rapidly spreading pandemic.

An excellent starting point for the development of antiviral medication is structural data of essential viral proteins. Thus, the crystal structure determination of the Influenza virus surface antigen neuraminidase (von Itzstein et al., 1993, Nature 363:418-423) led directly to the development of neuraminidase inhibitors with anti-viral activity preventing the release of virus from the cells, however, not the virus production. These and their derivatives have subsequently developed into the anti-Influenza drugs, zanamivir (Glaxo) and oseltamivir (Roche), which are currently being stockpiled by many countries as a first line of defense against an eventual pandemic. However, these medicaments provide only a reduction in the duration of the clinical disease. Alternatively, other anti-Influenza compounds such as amantadine and rimantadine target an ion channel protein, i.e., the M2 protein, in the viral membrane interfering with the uncoating of the virus inside the cell. However, they have not been extensively used due to their side effects and the rapid development of resistant virus mutants (Magden et al., 2005, Appl. Microbiol. Biotechnol. 66:612-621). In addition, more unspecific viral drugs, such as ribavirin, have been shown to work for treatment of Influenza infections (Eriksson et al., 1977, Antimicrob. Agents Chemother. 11:946-951). However, ribavirin is only approved in a few countries, probably due to severe side effects (Furuta et al., 2005, Antimicrob. Agents Chemother. 49:981-986). Clearly, new antiviral compounds are needed, preferably directed against different targets.

Influenza virus A, B, C and Isavirus as well as Thogotovirus belong to the family of Orthomyxoviridae which, as well as the family of the Bunyaviridae, including the Hantavirus, Nairovirus, Orthobunyavirus, Phlebovirus, and Tospovirus, are negative stranded RNA viruses. Their genome is segmented and comes in ribonucleoprotein particles that include the RNA dependent RNA polymerase which carries out (i) the initial copying of the single-stranded virion RNA (vRNA) into viral mRNAs and (ii) the vRNA replication. For the generation of viral mRNA the polymerase makes use of the so called "cap-snatching" mechanism (Plotch et al., 1981, Cell 23:847-858; Kukkonen et al., 2005, Arch. Virol. 150:533-556; Leahy et al., 1997, J. Virol. 71:8347-8351; Noah and Krug, 2005, Adv. Virus Res. 65:121-145). The polymerase is composed of three subunits: PB1 (polymerase basic protein), PB2, and PA. For the cap-snatching mechanism, the viral polymerase binds via its PB2 subunit to the 5' RNA cap of cellular mRNA molecules which are cleaved at nucleotide 10 to 13 by the endonucleolytic activity of the polymerase. The capped RNA fragments serve as primers for the synthesis of viral mRNAs by the nucleotidyl-transferase center in the PB1 subunit (Li et al., 2001, EMBO J. 20:2078-2086). Finally, the viral mRNAs are 3 '-end poly-adenylated by stuttering of the polymerase at an oligo-U motif at the 5'-end of the template. Recent studies have precisely defined the structural domain of PB2 responsible for cap-binding (Fechter et al., 2003, J. Biol. Chem. 278:20381-20388; Guilligay et al., 2008 Nat. Struct. Mol. Biol. 15:500-506). The endonucleolytic activity of the polymerase has hitherto been thought to reside in the PB1 subunit (Li et al, supra).

The polymerase complex seems to be an appropriate antiviral drug target since it is essential for synthesis of viral mRNA and viral replication and contains several functional active sites likely to be significantly different from those found in host cell proteins (Magden et al., supra). Thus, for example, there have been attempts to interfere with the assembly of polymerase subunits by a 25-amino-acid peptide resembling the PA-binding domain within PB1 (Ghanem et al., 2007, J. Virol. 81:7801-7804). Moreover, there have been attempts to interfere with viral transcription by nucleoside analogs, such as 2'-deoxy-2'-fluoroguanosine (Tisdale et al., 1995, Antimicrob. Agents Chemother. 39:2454-2458) and it has been shown that T-705, a substituted pyrazine compound may function as a specific inhibitor of Influenza virus RNA polymerase (Furuta et al., supra). Furthermore, the endonuclease activity of the polymerase has been targeted and a series of 4-substituted 2,4-dioxobutanoic acid compounds has been identified as selective inhibitors of this activity in Influenza viruses (Tomassini et al., 1994, Antimicrob. Agents Chemother. 38:2827-2837). In addition, flutimide, a substituted 2,6-diketopiperazine, identified in extracts of *Delitschia confertaspora*, a fungal species, has been shown to inhibit the endonuclease of Influenza virus (Tomassini et al., 1996, Antimicrob. Agents Chemother. 40:1189-1193). However, the inhibitory action of compounds on the endonucleolytic activity of the viral polymerase was hitherto only studied in the context of the entire trimeric complex of the polymerase.

The PA subunit of the polymerase is functionally the least well-characterised, although it has been implicated in both cap-binding and endonuclease activity, vRNA replication, and a controversial protease activity. PA (716 residues in influenza A) is separable by trypsination at residue 213. The recently determined crystal structure of the C-terminal two-thirds of PA bound to a PB1 N-terminal peptide provided the first structural insight into both a large part of the PA subunit, whose function, however, still remains unclear, and the exact nature of one of the critical inter-subunit interactions (He et al., 2008, Nature 454:1123-1126; Obayashi et al., 2008, Nature 454:1127-1131). Systematic mutation of conserved residues in the PA amino-terminal domain have identified residues important for protein stability, promoter binding, cap-binding and endonuclease activity of the polymerase complex (Hara et al., 2006, J. Virol. 80:7789-7798). The enzymology of the endonuclease within the context of intact viral ribonucleoprotein particles (RNPs) has been extensively studied.

However, hitherto it was not possible to study the endonuclease activity of the PA subunit in the context of a polypeptide fragment possessing the endonucleolytic activity, since it was not known which domain is responsible for said activity. The present inventors surprisingly found that, contrary to the general opinion in the field, the endonucleolytic activity resides exclusively within the amino-terminal region of the PA subunit. The inventors have achieved to structurally characterize said domain by X-ray crystallography and identified the endonucleolytic active center within the amino-terminal PA polypeptide fragment.

Thus, the present invention provides the unique opportunity to study the endonucleolytic activity of the viral polymerase in the context of a polypeptide fragment which will considerably simplify the development of new anti-viral compounds targeting the endonuclease activity of the viral polymerase as well as the optimization of previously identified compounds. The surprising achievement of the present inventors to recombinantly produce PA polypeptide fragments possessing the endonucleolytic activity of the viral polymerase allows for performing in vitro high-throughput screening for inhibitors of a functional site on the viral polymerase using easily obtainable material from a straightforward expression system. Furthermore, the structural data of the endonucleolytic PA polypeptide fragment as well as of the enzymatically active center therein allows for directed design of inhibitors and in silico screening for potentially therapeutic compounds.

It is an object of the present invention to provide (i) high resolution structural data of the endonucleolytic amino-terminal domain of the viral polymerase PA subunit by X-ray crystallography, (ii) computational as well as in vitro methods, preferably in a high-throughput setting, for identifying compounds that can modulate, preferably inhibit, the endonuclease activity of the viral polymerase, preferably by blocking the endonucleolytic active site within the PA subunit, and (iii) pharmacological compositions comprising such compounds for the treatment of infectious diseases caused by viruses using the cap snatching mechanism for synthesis of viral mRNA.

SUMMARY OF THE INVENTION

In a first aspect, the present invention relates to a polypeptide fragment comprising an amino-terminal fragment of the PA subunit of a viral RNA-dependent RNA polymerase possessing endonuclease activity, wherein said PA subunit is from a virus belonging to the Orthomyxoviridae family.

In a further aspect, the present invention relates to an isolated polynucleotide encoding an isolated polypeptide fragment according to the present invention.

In a further aspect, the present invention relates to recombinant vector comprising the isolated polynucleotide according to the present invention.

In a further aspect, the present invention relates to a recombinant host cell comprising the isolated polynucleotide according to the invention or the recombinant vector according to the present invention.

In a further aspect, the present invention relates to a method for identifying compounds which modulate the endonuclease activity of the PA subunit of a viral RNA-dependent RNA polymerise from the Orthomyxoviridae family, comprising the steps of (a) constructing a computer model of the active site defined by the structure coordinates of the polypeptide fragment according to the present invention as shown in FIG. 18; (b) selecting a potential modulating compound by a method selected from the group consisting of:

(i) assembling molecular fragments into said compound, (ii) selecting a compound from a small molecule database, and (iii) de novo ligand design of said compound;

(c) employing computational means to perform a fitting program operation between computer models of the said compound and the said active site in order to provide an energy-minimized configuration of the said compound in the active site; and (d) evaluating the results of said fitting operation to quantify the association between the said compound and the active site model, whereby evaluating the ability of said compound to associate with the said active site.

In a further aspect, the present invention relates to a compound identifiable by the method according to the present invention, wherein said compound is able to modulate, preferably inhibit the endonuclease activity of the PA subunit or variant thereof.

In a further aspect, the present invention relates to a method for identifying compounds which modulate the endonuclease activity of the PA subunit or polypeptide variants thereof, comprising the steps of (i) contacting the polypeptide fragment according to the invention or the recombinant host cell according to the invention with a test compound and (ii) analyzing the ability of said test compound to modulate the endonuclease activity of said PA subunit polypeptide fragment.

In a further aspect, the present invention relates to a pharmaceutical composition producible according to the in vitro method of the present invention.

In a further aspect, the present invention relates to a compound identifiable by the in vitro method according to the invention, wherein said compound is able to modulate, preferably inhibit the endonuclease activity of the PA subunit or variant thereof In a further aspect, the present invention relates to an antibody directed against the active site of the PA subunit or variant thereof In a father aspect, the present invention relates to the use of a compound according to the present invention, a pharmaceutical composition according to the present invention, or an antibody according to the present invention for the manufacture of a medicament for treating, ameliorating, or preventing disease conditions caused by viral infections with viruses of the Orthomyxoviridae family.

BRIEF DESCRIPTION OF THE DRAWINGS

FIG. 2: Effects of different metal ions on thermal stability of PA-Nter (SEQ ID NO: 22). Summary of the different melting points (Tm) extracted from the thermal shift assay at pH 8.0 with different metal ions. The effect of $CoCl_2$ on protein stability at pH 7.0 was investigated but not interpretable due to quenching by the metal.

FIG. 18: Refined atomic structure coordinates for PA polypeptide fragment amino acids 1 to 209 according to amino acids 1 to 209 of the amino acid sequence set forth in SEQ ID NO: 2. There are three molecules in the asymmetric unit denoted A, B, and D. The file header gives information about the structure refinement. "Atom" refers to the element whose coordinates are measured. The first letter in the column defines the element. The 3-letter code of the respective amino acid is given and the amino acid sequence position. The first 3 values in the line "Atom" define the atomic position of the element as measured. The fourth value corresponds to the occupancy and the fifth (last) value is the temperature factor (B factor). The occupancy factor refers to the fraction of the molecules in which each atom occupies the position specified by the coordinates. A value of "1" indicates that each atom has the same conformation, i.e., the same position, in all molecules of the crystal. B is a thermal factor that measures movement of the atom around its atomic center. The anisotropic temperature factors are given in the lines marked "ANISOU". This nomenclature corresponds to the PDB file format.

DETAILED DESCRIPTION OF THE INVENTION

Figure 1:
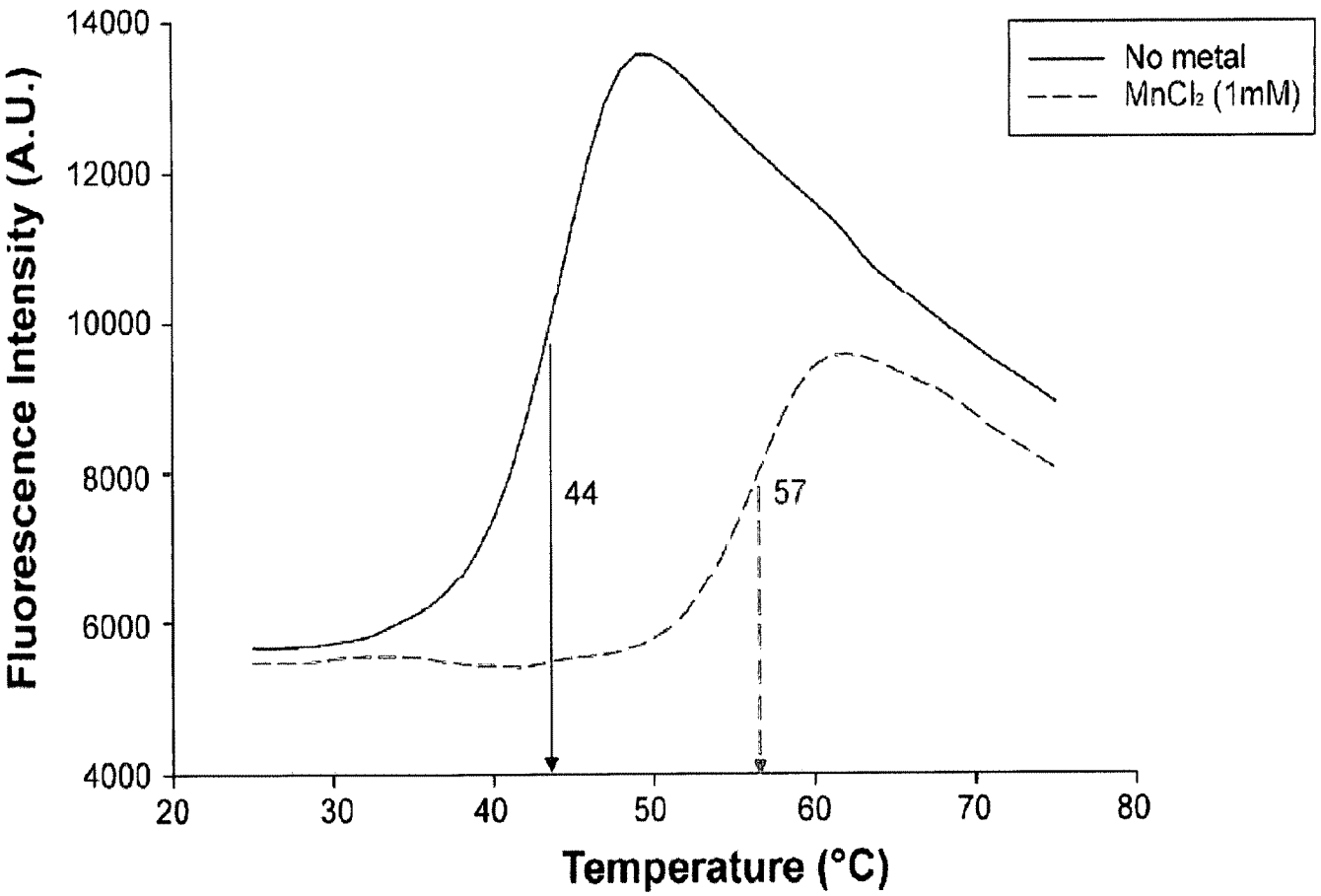
FIG. 1: Assay of thermal stability of the PA-Nter (SEQ ID NO: 22) structure using Thermofluor. The thermal shift assay was performed with different metal ions. For clarity, only the results obtained in absence of metal ion (full black line) or in presence of 1 mM $MnCl_2$ (dashed line) are shown. Arrows indicate the apparent melting temperature Tm.

Before the present invention is described in detail below, it is to be understood that this invention is not limited to the particular methodology, protocols and reagents described herein as these may vary. It is also to be understood that the terminology used herein is for the purpose of describing particular embodiments only, and is not intended to limit the scope of the present invention which will be limited only by the appended claims. Unless defined otherwise, all technical and scientific terms used herein have the same meanings as commonly understood by one of ordinary skill in the art.

In the following, the elements of the present invention will be described. These elements are listed with specific embodiments, however, it should be understood that they may be combined in any manner and in any number to create additional embodiments. The variously described examples and preferred embodiments should not be construed to limit the present invention to only the explicitly described embodiments. This description should be understood to support and encompass embodiments which combine the explicitly described embodiments with any number of the disclosed and/or preferred elements. Furthermore, any permutations and combinations of all described elements in this application should be considered disclosed by the description of the present application unless the context indicates otherwise. For example, if in a preferred embodiment the polypeptide fragment of the present invention corresponds to amino acids 1 to 209 of the amino acid sequence set forth in SEQ ID NO: 2 and in another preferred embodiment the PA polypeptide fragment according to the present invention may be tagged with a peptide-tag that is preferably cleavable from the PA polypeptide fragment, preferably using a TEV protease, it is a preferred embodiment of the invention that the polypeptide fragment corresponding to amino acids 1 to 209 of the amino acid sequence set forth in SEQ ID NO: 2 is tagged with a peptide-tag that is cleavable from the PA polypeptide using a TEV protease.

Preferably, the terms used herein are defined as described in "A multilingual glossary of biotechnological terms: (TUPAC Recommendations)", H. G. W. Leuenberger, B. Nagel, and H. Kolbl, Eds., Helvetica Chimica Acta, CH-4010 Basel, Switzerland, (1995).

To practice the present invention, unless otherwise indicated, conventional methods of chemistry, biochemistry, and recombinant DNA techniques are employed which are explained in the literature in the field (cf., e.g., *Molecular Cloning: A Laboratory Manual,* 2nd Edition, J. Sambrook et al. eds., Cold Spring Harbor Laboratory Press, Cold Spring Harbor 1989).

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps. As used in this specification and the appended claims, the singular forms "a", "an", and "the" include plural referents, unless the content clearly dictates otherwise.

Several documents are cited throughout the text of this specification. Each of the documents cited herein (including all patents, patent applications, scientific publications, manufacturer's specifications, instructions, etc.), whether supra or infra, are hereby incorporated by reference in their entirety. Nothing herein is to be construed as an admission that the invention is not entitled to antedate such disclosure by virtue of prior invention.

DEFINITIONS

The term "polypeptide fragment" refers to a part of a protein which is composed of a single amino acid chain. The term "protein" comprises polypeptide fragments that resume a secondary and tertiary structure and additionally refers to proteins that are made up of several amino acid chains, i.e., several subunits, forming quartenary structures. The term "peptide" refers to short amino acid chains of up to 50 amino acids that do not necessarily assume secondary or tertiary structures. A "peptoid" is a peptidomimetic that results from the oligomeric assembly of N-substituted glycines.

Figure 11:
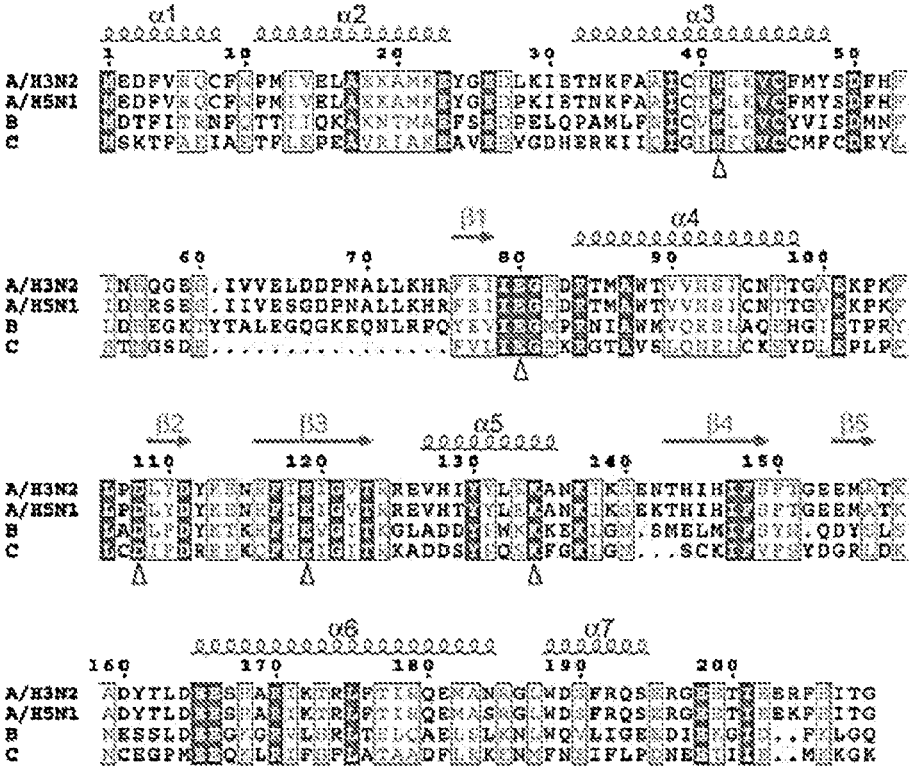
FIG. 11: Sequence alignment of polypeptide fragments derived from the PA-subunit of representative influenza strains: A/Victoria/3/1975 (human H3N2; amino acid residues 1 to 209 of SEQ ID NO: 2), A/Duck/Vietman/1/2007 (avian H5N1; amino acid residues 1 to 209 of SEQ ID NO: 8), B/Ann Arbor/1/1966 (amino acid residues 1 to 206 of SEQ ID NO: 4) and C/Johannesburg/1/1966 (amino acid residues 1 to 189 of SEQ ID NO: 6). The secondary structure of A/Victoria/3/1975 is shown over the sequence alignment. The boxed sequences indicate sequence similarity between the four sequences. Residues in a solid black background are identical between the four sequences. The triangles indicate the key active site residues.

Residues in two or more polypeptides are said to "correspond" to each other if the residues occupy an analogous position in the polypeptide structures. As is well known in the art, analogous positions in two or more polypeptides can be determined by aligning the polypeptide sequences based on amino acid sequence or structural similarities. Such alignment tools are well known to the person skilled in the art and can be, for example, obtained on the World Wide Web, e.g., ClustalW (ebi.ac.uk/clustalw) or Align (ebi.ac.uk/emboss/align/index.html) using standard settings, preferably for Align EMBOSS::needle, Matrix: Blosum62, Gap Open 10.0, Gap Extend 0.5. Those skilled in the art understand that it may be necessary to introduce gaps in either sequence to produce a satisfactory alignment. For example, residues 1 to 196 in the Influenza A virus PA subunit correspond to residues 1 to 195 and 1 to 178 in the Influenza B and C virus PA subunits, respectively. Residues in two or more PA subunits are said to "correspond" if the residues are aligned in the best sequence alignment. The "best sequence alignment" between two polypeptides is defined as the alignment that produces the largest number of aligned identical residues. The "region of best sequence alignment" ends and, thus, determines the metes and bounds of the length of the comparison sequence for the purpose of the determination of the similarity score, if the sequence similarity, preferably identity, between two aligned sequences drops to less than 30%, preferably less than 20%, more preferably less than 10% over a length of 10, 20 or 30 amino acids. A part of the best sequence alignment for the amino acid sequences of Influenza A (aa 1 to 209), B (aa 1 to 206), and C (aa 1 to 189) PA subunits is shown in FIG. 11.

For example, amino acids Tyr24, His41, Glu80, Arg84, Leu106, Asp108, Glu119, Ile120, Tyr130, Glu133, Lys134, and Lys137 of the amino acid sequence set forth in SEQ ID NO: 2 (Influenza A virus PA subunit) correspond to amino acids Phe24, His41, Glu81, Arg85, Leu107, Asp109, Glu120, Val121, Tyr131, Lys134, Lys135, and Lys138 of the amino acid sequence set forth in SEQ ID NO: 4 (Influenza B virus PA subunit) and amino acids Ala24, His41, Glu65, Arg69, Leu91, Asp93, Glu104, Ile105, Tyr115, Ser118, Lys119, and Lys122 of the amino acid sequence set forth in SEQ ID NO: 6 (Influenza C virus PA subunit), respectively.

The present invention includes Influenza virus RNA-dependent RNA polymerase PA subunit fragments possessing endonuclease activity. The term "RNA-dependent RNA polymerase subunit PA" preferably refers to the PA subunit of Influenza A, Influenza B, or Influenza C virus, preferably having an amino acid sequence as set out in SEQ ID NO: 2, 4, or 6. "RNA-dependent RNA polymerase subunit PA variants" have at least 60%, 65%, 70%, 80%, 81%, 82%, 83%, 84%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with the amino acid sequence set forth in SEQ ID NO: 2, 4, or 6. It is preferred that when a naturally occurring PA variant is aligned with a PA subunit according to SEQ ID NO: 2, 4, or 6 that the alignment will be over the entire length of the two proteins and, thus, that the alignment score will be determined on this basis. It is, however, possible that the natural variant may comprise C-terminal/N-terminal or internal deletions or additions, e.g., through N- or C-terminal fusions. In this case, only the best aligned region is used for the assessment of similarity and identity, respectively. Preferably and as set out in more detail below, fragments derived from these variants show the indicated similarity and identity, respectively, preferably within the region required for endonuclease activity. Accordingly, any alignment between SEQ ID NO: 2, 4, or 6 and a PA variant should preferably comprise the endonuclease active site. Thus, the above sequence similarity and identity, respectively, to SEQ ID NO: 2, 4, or 6 occurs at least over a length of 100, 110, 120, 130, 140, 150, 160, 165, 170, 180, 190, 200, 210, 220, 230, 240, 250, 300 or more amino acids, preferably comprising the endonuclease active site. A large number of natural PA variants of sequences according to SEQ ID NO: 2, 4, or 6 are known and have been described in the literature. All these PA variants are comprised and can be the basis for the polypeptide fragments of the present invention. Preferred examples of the Influenza A PA subunit, if SEQ ID NO: 2 is used as reference sequence, comprise mutations at one or more of positions Phe4, Ala20, Leu28, Glu31, Val44, Tyr48, Asn55, Gln57, Gly58, Val62, Leu65, Asp66, Thr85, Gly99, Ala100, Glu101, Ile118, Ile129, Asn142, Ile145, Glu154, Lys158, Asp164, Ile171, Lys172, Ile178, Asn184, and/or Arg204. In a preferred embodiment, said variant comprises one or more of the following mutations: Phe4Leu, Ala20Thr, Leu28Pro, Glu31Lys, Val44Ala, Tyr48His, Asn55Asp, Gln57Arg, Gly58Ser, Val62Ile, Leu65Ser, Asp66Gly, Thr85Ala, Gly99Lys, Ala100Val, Glu101Asp, Ile118Thr, Ile129Thr, Asn142Lys, Ile145Leu, Glu154Gly, Lys158Gln, Asp164Val, Ile171Val, Lys172Arg, Ile178Val, Asn184Ser, Asn184Arg, and/or Arg204Lys. Preferred variants of the Influenza B virus PA subunit, if SEQ ID NO: 4 is used as reference sequence, include mutations at one or more of the following amino acid positions: Thr60, Asn86, Arg105, Asn158, His160, and/or Ile196. In a preferred embodiment the Influenza B virus PA subunit variant comprises one or more of the following mutations: Thr60Ala, Asn86Thr, Arg105Lys, Asn158Asp, His160Ser, and/or Ile196Val. Preferred variants of the Influenza C virus PA subunit, if SEQ ID NO: 6 is used as reference sequence, include mutations at one or more of the following amino acid positions: Thr11, Leu53, Ser58, Gly70, and/or Ala111. In a preferred embodiment, said mutations are as follows: Thr11Ala, Leu53Met, Ser58Asn, Gly70Arg, and/or Ala111Thr.

The polypeptide fragments of the present invention are, thus, based on RNA-dependent RNA polymerase subunit PA or variants thereof as defined above. Accordingly, in the following specification the terms "polypeptide fragment(s)" and "PA polypeptide fragments" always comprise such fragments derived both from the PA proteins as set out in SEQ ID NO: 2, 4, or 6 and fragments derived from PA protein variants thereof, as set out above, possessing endonuclease activity. However, the specification also uses the term "PA polypeptide fragment variants" or "PA fragment variants" to specifically refer to PA fragments possessing endonuclease activity that are derived from RNA-dependent RNA polymerase subunit PA variants. The PA polypeptide fragments of the present invention thus preferably comprise, essentially consist or consist of sequences of naturally occurring viral PA subunits, preferably Influenza virus PA subunit. It is, however, also envisioned that the PA fragment variants further contain amino acid substitutions at 1, 2, 3, 4, 5, 6, 7, 8, 9, 10, 11, 12, 13, 14, 15 or more amino acid positions, and have at least 60%, 65%, 70%, 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with the amino acid sequence set forth in SEQ ID NO: 2, 4, or 6. It is understood that PA fragments of the present invention may comprise additional amino acids not derived from PA, like, e.g., tags, enzymes etc., such additional amino acids will not be considered in such an alignment, i.e., are excluded from the calculation of the alignment score. In a preferred embodiment, the above indicated alignment score is obtained when aligning the sequence of the fragment with SEQ ID NO: 2, 4, or 6 at least over a length of 70, 80, 90, 100, 110, 120, 130, 140, 150, 160, 165, 170, 180, or 190 amino acids, wherein the respective sequence of SEQ ID NO: 2, 4, or 6, preferably comprises the endonuclease active site.

In a preferred embodiment, the PA polypeptide fragment variants comprise at least the amino acid residues corresponding to amino acid residues 1 to 196 of Influenza A virus PA or consist of amino acid residues 1 to 196 (derived from SEQ ID NO: 2) and have at least 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with amino acid residues 1 to 196 of the sequence set forth in SEQ ID NO: 2, more preferably the PA polypeptide fragment variants comprise at least the amino acid residues corresponding to amino acid residues 1 to 209 of Influenza A virus PA or consist of amino acid residues 1 to 209 (derived from SEQ ID NO: 2) and have at least 70%, more preferably 75%, more preferably 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with the amino acid residues 1 to 209 of the amino acid sequence set forth in SEQ ID NO: 2, more preferably the PA polypeptide fragment variants comprise at least the amino acid residues corresponding to amino acid residues 1 to 213 of Influenza A virus PA or consist of amino acid residues 1 to 213 (derived from SEQ ID NO: 2) and have at least 60%, more preferably 65%, more preferably 70%, more preferably 75%, more preferably 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with amino acid residues 1 to 213 of the amino acid sequence set forth in SEQ ID NO: 2. In preferred embodiments, the Influenza A virus PA polypeptide fragment variants of the present invention comprise mutations, preferably naturally occurring mutations such as mutations in one or more of the following amino acid residues when compared to SEQ ID NO: 2: Phe4, Ala20, Leu28, Glu31, Val44, Tyr48, Asn55, Gln57, Gly58, Val62, Leu65, Asp66, Thr85, Gly99, Ala100, Glu101, Ile118, Ile129, Asn142, Ile145, Glu154, Lys158, Asp164, Ile171, Lys172, Ile178, Asn184, and/or Arg204. In a preferred embodiment, said variant comprises one or more of the following mutations: Phe4Leu, Ala20Thr, Leu28Pro, Glu31Lys, Val44Ala, Tyr48His, Asn55Asp, Gln57Arg, Gly58Ser, Val62Ile, Leu65Ser, Asp66Gly, Thr85Ala, Gly99Lys, Ala100Val, Glu101Asp, Ile118Thr, Ile129Thr, Asn142Lys, Ile145Leu, Glu154Gly, Lys158Gln, Asp164Val, Ile171Val, Lys172Arg, Ile178Val, Asn184Ser, Asn184Arg, and/or Arg204Lys.

In a preferred embodiment, the PA polypeptide fragment variants comprise at least the amino acid residues corresponding to amino acid residues 1 to 195 of Influenza B virus PA or consist of amino acid residues 1 to 195 (derived from SEQ ID NO: 4) and have at least 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with amino acid residues 1 to 195 of the amino acid sequence set forth in SEQ ID NO: 4, more preferably the PA polypeptide fragment variants comprise at least the amino acid residues corresponding to amino acid residues 1 to 206 of Influenza B virus PA or consist of amino acid residues 1 to 206 (derived from SEQ ID NO: 4) and have at least 70%, more preferably 75%, more preferably 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with the amino acid residues 1 to 206 of the sequence set forth in SEQ ID NO: 4, more preferably the PA polypeptide fragment variants comprise at least the amino acid residues corresponding to amino acid residues 1 to 210 of Influenza B virus PA or consist of amino acid residues 1 to 210 (derived from SEQ ID NO: 4) and have at least 60%, more preferably 65%, more preferably 70%, more preferably 75%, more preferably 80%, 81%, 82%, 83%, 84%, 85%, 86%, 87%, 88%, 89%, 90%, 91%, 92%, 93%, 94%, 95%, 96%, 97%, 98%, 99% sequence similarity, preferably sequence identity over the entire length of the fragment using the best sequence alignment and/or over the region of the best sequence alignment, wherein the best sequence alignment is obtainable with art known tools, e.g., Align, using standard settings, preferably EMBOSS::needle, Matrix: Blosum62, Gap Open 10.0, Gap Extend 0.5, with amino acid residues 1 to 210 of the amino acid sequence set forth in SEQ ID NO: 4. In preferred embodiments, the Influenza B virus PA polypeptide fragment variants of the present invention comprise mutations, preferably naturally occurring mutations, at one ore more of the following amino acid positions compared to SEQ ID NO: 4: Thr60, Asn86, Arg105, Asn158, His160, and/or Ile196. In a preferred embodiment the Influenza B virus PA subunit variant comprises one or more of the following mutations: Thr60Ala, Asn86Thr, Arg105Lys, Asn158Asp, His160Ser, and/or Ile196Val.

In a preferred embodiment, the PA polypeptide fragment variants comprise at least the amino acid residues corresponding to amino acid residues 1 to 178 of Influenza C virus PA or consist of amino acid residues 1 to 178 (derived from SEQ ID NO: 6) and have at least 80%, more preferably 85%, more preferably 90%, most preferably 95% sequence similarity over the entire length of the fragment with amino acid residues 1 to 178 of the amino acid sequence set forth in SEQ ID NO: 6, more preferably the PA polypeptide fragment variants comprise at least the amino acid residues corresponding to amino acid residues 1 to 189 of Influenza C virus PA or consist of amino acid residues 1 to 189 (derived from SEQ ID NO: 6) and have at least 70%, more preferably 75%, more preferably 80%, more preferably 85%, most preferably 90% sequence similarity over the entire length of the fragment with amino acid residues 1 to 189 of the amino acid sequence set forth in SEQ ID NO: 6, more preferably the PA polypeptide fragment variants comprise at least the amino acid residues corresponding to amino acid residues 1 to 193 of Influenza C virus PA or consist of amino acid residues 1 to 193 (derived from SEQ ID NO: 6) and have at least 60%, more preferably 65%, more preferably 70%, more preferably 75%, more preferably 80%, more preferably 85%, most preferably 90% sequence similarity over the entire length of the fragment with amino acid residues 1 to 193 of the amino acid sequence set forth in SEQ ID NO: 6. In preferred embodiments, the Influenza C virus PA polypeptide fragment variants of the present invention comprise mutations, preferably naturally occurring mutations such as mutations in one or more of the following amino acid residues when compared to SEQ ID NO: 6: Thr11, Leu53, Ser58, Gly70, and/or Ala111. In a preferred embodiment, said mutations are as follows: Thr1 1 Ala, Leu53Met, Ser58Asn, Gly70Arg, and/or Ala111 Thr.

In the context of the present invention, the term "PA-Nter" (SEQ ID NO: 22) refers to a polypeptide fragment which consists of amino acid residues 1 to 209 of the amino acid sequence as set forth in SEQ ID NO: 2 with an additional amino-terminal linker, i.e., GMGSGMA (SEQ ID NO: 19).

If a PA polypeptide fragment of the present invention comprises one of the above outlined amino acid residues, it is preferred that the other amino acid residues are not derived from the respective Influenza A, B, or C virus PA protein.

The term "sequence similarity" means that amino acids at the same position of the best sequence alignment are identical or similar, preferably identical. "Similar amino acids" possess similar characteristics, such as polarity, solubility, hydrophilicity, hydrophobicity, charge, or size. Similar amino acids are preferably leucine, isoleucine, and valine; phenylalanine, tryptophan, and tyrosine; lysine, arginine, and histidine; glutamic acid and aspartic acid; glycine, alanine, and serine; threonine, asparagine, glutamine, and methionine. The skilled person is well aware of sequence similarity searching tools, e.g., available on the World Wide Web (e.g., ebi.ac.uk/Tools/similarity.html).

The term "soluble", as used herein, refers to a polypeptide fragment which remains in the supernatant after centrifugation for 30 min at 100,000×g in an aqueous buffer under physiologically isotonic conditions, for example, 0.14 M sodium chloride or sucrose, at a protein concentration of at least 200 μg/ml, preferably of at least 500 μg/ml, preferably of at least 1 mg/ml, more preferably of at least 2 mg/ml, even more preferably of at least 3 mg/ml, even more preferably of at least 4 mg/ml, most preferably of at least 5 mg/ml in the absence of denaturants such as guanidine or urea in effective concentrations. A protein fragment that is tested for its solubility is preferably expressed in one of the cellular expression systems indicated below.

The term "purified" in reference to a polypeptide, does not require absolute purity such as a homogenous preparation, rather it represents an indication that the polypeptide is relatively purer than in the natural environment. Generally, a purified polypeptide is substantially free of other proteins, lipids, carbohydrates, or other materials with which it is naturally associated, preferably at a functionally significant level, for example, at least 85% pure, more preferably at least 95% pure, most preferably at least 99% pure. The expression "purified to an extent to be suitable for crystallization" refers to a protein that is 85% to 100%, preferably 90% to 100%, more preferably 95% to 100% pure and can be concentrated to higher than 3 mg/ml, preferably higher than 10 mg/ml, more preferably higher than 18 mg/ml without precipitation. A skilled artisan can purify a polypeptide using standard techniques for protein purification. A substantially pure polypeptide will yield a single major band on a non-reducing polyacrylamide gel.

The term "associate" as used in the context of identifying compounds with the methods of the present invention refers to a condition of proximity between a moiety (i.e., chemical entity or compound or portions or fragments thereof), and an endonuclease active site of the PA subunit. The association may be non-covalent, i.e., where the juxtaposition is energetically favored by, for example, hydrogen-bonding, van der Waals, electrostatic, or hydrophobic interactions, or it may be covalent.

The term "endonuclease activity" or "endonucleolytic activity" refers to an enzymatic activity which results in the cleavage of the phosphodiester bond within a polynucleotide chain. In the context of the present invention, the polypeptide fragments possess an endonucleolytic activity, which is preferably not selective for the polynucleotide type, i.e., the polypeptide fragments according to the present invention preferably exhibit endonucleolytic activity for DNA and RNA, preferably for single stranded DNA (ssDNA) or single stranded RNA (ssRNA). In this context, "Single stranded" means that a stretch of preferably at least 3 nucleotides, preferably at least 5 nucleotides, more preferably at least 10 nucleotides within the polynucleotide chain are single stranded, i.e., not base paired to another nucleotide. Preferably, the endonucleolytic activity of the polypeptide fragments according to the present invention is not dependent on recognition sites, i.e., specific nucleotide sequences, but results in unspecific cleavage of polynucleotide chains. For example, the skilled person may test for endonucleolytic activity of polypeptide fragments according to the present invention by incubating RNA or DNA substrates such as panhandle RNA or a linear or circular single stranded DNA, e.g., the circular M13mp18 DNA (MBI Fermentas), with or without the respective polypeptide fragment, for example, at 37° C. for a certain period of time such as for 5, 10, 20, 40, 60, or 80 minutes, and test for the integrity of the polynucleotides, for example, by gel electrophoresis.

The term "nucleotide" as used herein refers to a compound consisting of a purine, deazapurine, or pyrimidine nucleoside base, e.g., adenine, guanine, cytosine, uracil, thymine, deazaadenine, deazaguanosine, and the like, linked to a pentose at the 1' position, including 2'-deoxy and 2'-hydroxyl forms, e.g., as described in Komberg and Baker, DNA Replication, 2nd Ed. (Freeman, San Francisco, 1992) and further include, but are not limited to, synthetic nucleosides having modified base moieties and/or modified sugar moieties, e.g., described generally by Scheit, Nucleotide Analogs (John Wiley, N.Y., 1980).

The term "isolated polynucleotide" refers to polynucleotides that were (i) isolated from their natural environment, (ii) amplified by polymerase chain reaction, or (iii) wholly or partially synthesized, and means a single or double-stranded polymer of deoxyribonucleotide or ribonucleotide bases and includes DNA and RNA molecules, both sense and anti-sense strands. The term comprises cDNA, genomic DNA, and recombinant DNA. A polynucleotide may consist of an entire gene, or a portion thereof.

The term "recombinant vector" as used herein includes any vectors known to the skilled person including plasmid vectors, cosmid vectors, phage vectors such as lambda phage, viral vectors such as adenoviral or baculoviral vectors, or artificial chromosome vectors such as bacterial artificial chromosomes (BAC), yeast artificial chromosomes (YAC), or P1 artificial chromosomes (PAC). Said vectors include expression as well as cloning vectors. Expression vectors comprise plasmids as well as viral vectors and generally contain a desired coding sequence and appropriate DNA sequences necessary for the expression of the operably linked coding sequence in a particular host organism (e.g., bacteria, yeast, plant, insect, or mammal) or in in vitro expression systems. Cloning vectors are generally used to engineer and amplify a certain desired DNA fragment and may lack functional sequences needed for expression of the desired DNA fragments.

"Recombinant host cell", as used herein, refers to a host cell that comprises a polynucleotide that codes for a polypeptide fragment of interest, i.e., the PA polypeptide fragment or variants thereof according to the invention. This polynucleotide may be found inside the host cell (i) freely dispersed as such, (ii) incorporated in a recombinant vector, or (iii) integrated into the host cell genome or mitochondrial DNA. The recombinant cell can be used for expression of a polynucleotide of interest or for amplification of the polynucleotide or the recombinant vector of the invention. The term "recombinant host cell" includes the progeny of the original cell which has been transformed, transfected, or infected with the polynucleotide or the recombinant vector of the invention. A recombinant host cell may be a bacterial cell such as an *E. coli* cell, a yeast cell such as *Saccharomyces cerevisiae* or *Pichia pastoris*, a plant cell, an insect cell such as SF9 or Hi5 cells, or a mammalian cell. Preferred examples of mammalian cells are Chinese hamster ovary (CHO) cells, green African monkey kidney (COS) cells, human embryonic kidney (HEK293) cells, HELA cells, and the like.

As used herein, the term "crystal" or "crystalline" means a structure (such as a three-dimensional solid aggregate) in which the plane faces intersect at definite angles and in which there is a regular structure (such as internal structure) of the constituent chemical species. The term "crystal" can include any one of: a solid physical crystal form such as an experimentally prepared crystal, a crystal structure derivable from the crystal (including secondary and/or tertiary and/or quaternary structural elements), a 2D and/or 3D model based on the crystal structure, a representation thereof such as a schematic representation thereof or a diagrammatic representation thereof, or a data set thereof for a computer. In one aspect, the crystal is usable in X-ray crystallography techniques. Here, the crystals used can withstand exposure to X-ray beams and are used to produce diffraction pattern data necessary to solve the X-ray crystallographic structure. A crystal may be characterized as being capable of diffracting X-rays in a pattern defined by one of the crystal forms depicted in T. L. Blundell and L. N. Johnson, "Protein Crystallography", Academic Press, New York (1976).

The term "unit cell" refers to a basic parallelepiped shaped block. The entire volume of a crystal may be constructed by regular assembly of such blocks. Each unit cell comprises a complete representation of the unit of pattern, the repetition of which builds up the crystal.

The term "space group" refers to the arrangement of symmetry elements of a crystal. In a space group designation the capital letter indicates the lattice type and the other symbols represent symmetry operations that can be carried out on the contents of the asymmetric unit without changing its appearance.

The term "structure coordinates" refers to a set of values that define the position of one or more amino acid residues with reference to a system of axes. The term refers to a data set that defines the three-dimensional structure of a molecule or molecules (e.g., Cartesian coordinates, temperature factors, and occupancies). Structural coordinates can be slightly modified and still render nearly identical three-dimensional structures. A measure of a unique set of structural coordinates is the root mean square deviation of the resulting structure. Structural coordinates that render three-dimensional structures (in particular, a three-dimensional structure of an enzymatically active center) that deviate from one another by a root mean square deviation of less than 3 Å, 2 Å, 1.5 Å, 1.0 Å, or 0.5 Å may be viewed by a person of ordinary skill in the art as very similar.

The term "root mean square deviation" means the square root of the arithmetic mean of the squares of the deviations from the mean. It is a way to express the deviation or variation from a trend or object. For purposes of this invention, the "root mean square deviation" defines the variation in the backbone of a variant of the PA polypeptide fragment or the enzymatically active center therein from the backbone of the PA polypeptide fragment or the enzymatically active center therein as defined by the structure coordinates of the PA polypeptide fragment PA-Nter (SEQ ID NO: 22) according to FIG. 18.

As used herein, the term "constructing a computer model" includes the quantitative and qualitative analysis of molecular structure and/or function based on atomic structural information and interaction models. The term "modeling" includes conventional numeric-based molecular dynamic and energy minimization models, interactive computer graphic models, modified molecular mechanics models, distance geometry, and other structure-based constraint models.

The term "fitting program operation" refers to an operation that utilizes the structure coordinates of a chemical entity, an enzymatically active center, a binding pocket, molecule or molecular complex, or portion thereof, to associate the chemical entity with the enzymatically active center, the binding pocket, molecule or molecular complex, or portion thereof. This may be achieved by positioning, rotating or translating the chemical entity in the enzymatically active center to match the shape and electrostatic complementarity of the enzymatically active center. Covalent interactions, non-covalent interactions such as hydrogen bond, electrostatic, hydrophobic, van der Waals interactions, and non-complementary electrostatic interactions such as repulsive charge-charge, dipole-dipole and charge-dipole interactions may be optimized. Alternatively, one may minimize the deformation energy of binding of the chemical entity to the enzymatically active center.

As used herein, the term "test compound" refers to an agent comprising a compound, molecule, or complex that is being tested for its ability to inhibit the endonucleolytic activity of the polypeptide fragment of interest, i.e., the PA polypeptide fragment of the invention or variants thereof possessing endonucleolytic activity. Test compounds can be any agents including, but not restricted to, peptides, peptoids, polypeptides, proteins (including antibodies), lipids, metals, nucleotides, nucleotide analogs, nucleosides, nucleic acids, small organic or inorganic molecules, chemical compounds, elements, saccharides, isotopes, carbohydrates, imaging agents, lipoproteins, glycoproteins, enzymes, analytical probes, polyamines, and combinations and derivatives thereof. The term "small molecules" refers to molecules that have a molecular weight between 50 and about 2,500 Daltons, preferably in the range of 200-800 Daltons. In addition, a test compound according to the present invention may optionally comprise a detectable label. Such labels include, but are not limited to, enzymatic labels, radioisotope or radioactive compounds or elements, fluorescent compounds or metals, chemiluminescent compounds and bioluminescent compounds. Well known methods may be used for attaching such a detectable label to a test compound. The test compound of the invention may also comprise complex mixtures of substances, such as extracts containing natural products, or the products of mixed combinatorial syntheses. These can also be tested and the component that inhibits the endonucleolytic activity of the target polypeptide fragment can be purified from the mixture in a subsequent step. Test compounds can be derived or selected from libraries of synthetic or natural compounds. For instance, synthetic compound libraries are commercially available from Maybridge Chemical Co. (Trevillet, Cornwall, UK), ChemBridge Corporation (San Diego, Calif.), or Aldrich (Milwaukee, Wis.). A natural compound library is, for example, available from TimTec LLC (Newark, Del.). Alternatively, libraries of natural compounds in the form of bacterial, fungal, plant and animal cell and tissue extracts can be used. Additionally, test compounds can be synthetically produced using combinatorial chemistry either as individual compounds or as mixtures. A collection of compounds made using combinatorial chemistry is referred to herein as a combinatorial library.

In the context of the present invention, "a compound which modulates the endonucleolytic activity" may increase or decrease, preferably inhibit the endonucleolytic activity of the PA subunit or the viral RNA-dependent RNA polymerase or a variant thereof. Preferably, such a compound is specific for the endonucleolytic activity of the viral PA subunit or variant thereof and does not modulate, preferably decrease the endonucleolytic activity of other endonucleases, in particular mammalian endonucleases.

The term "a compound which decreases the endonucleolytic activity" means a compound which decreases the endonucleolytic activity of the PA subunit of the viral RNA-dependent RNA polymerase from the Orthomyxoviridae family or a variant thereof by 50%, more preferably by 60%, even more preferably by 70%, even more preferably by 80%, even more preferably by 90%, and most preferably by 100% compared to the endonucleolytic activity of the PA subunit or a variant thereof without said compound but with otherwise the same reaction conditions, i.e., buffer conditions, reaction time and temperature. It is most preferred that the compound which decreases the endonucleolytic activity of the PA subunit or a variant thereof inhibits said activity, i.e., decreases said activity by at least 95%, preferably by 100% compared to the activity without the compound. It is particularly preferred that the compound that decreases or inhibits the endonucleolytic activity of the PA subunit or a variant thereof specifically decreases or inhibits the endonucleolytic activity of the PA subunit or a variant thereof but does not inhibit the endonucleolytic activity of other endonucleases such as RNase H or restriction endonucleases to the same extent, preferably not at all. For example, the skilled person may set up the following samples with the same buffer and reaction conditions as well as substrate and endonuclease concentrations: (1) substrate such as panhandle RNA, endonucleolytically active PA polypeptide fragment or variant thereof, (2) substrate such as panhandle RNA, endonucleolytically active PA polypeptide fragment or variant thereof, test compound, (3) substrate such as panhandle RNA, reference endonuclease such as RNAse H, (4) substrate such as panhandle RNA, reference nucleotide such as RNAse H, test compound. After incubation of the samples, the skilled person may analyze the substrate, for example, by gel electrophoresis. Test compounds which result in cleaved substrate in sample (2) and intact substrate in sample (4) are preferred.

The term "in a high-throughput setting" refers to high-throughput screening assays and techniques of various types which are used to screen libraries of test compounds for their ability to inhibit the endonuclease activity of the polypeptide fragment of interest. Typically, the high-throughput assays are performed in a multi-well format and include cell-free as well as cell-based assays.

The term "antibody" refers to both monoclonal and polyclonal antibodies, i.e., any immunoglobulin protein or portion thereof which is capable of recognizing an antigen or hapten, i.e., the PA polypeptide fragment possessing endonucleolytic activity or a peptide thereof. In a preferred embodiment, the antibody is capable of binding to the enzymatically (endonucleolytically) active center within the PA polypeptide fragment or variant thereof Antigen-binding portions of the antibody may be produced by recombinant DNA techniques or by enzymatic or chemical cleavage of intact antibodies. In some embodiments, antigen-binding portions include Fab, Fab', $F(ab')_2$, Fd, Fv, dAb, and complementarity determining region (CDR) fragments, single-chain antibodies (scFv), chimeric antibodies such as humanized antibodies, diabodies, and polypeptides that contain at least a portion of an antibody that is sufficient to confer specific antigen binding to the polypeptide.

The term "pharmaceutically acceptable salt" refers to a salt of a compound identifiable by the methods of the present invention or a compound of the present invention. Suitable pharmaceutically acceptable salts include acid addition salts which may, for example, be formed by mixing a solution of compounds of the present invention with a solution of a pharmaceutically acceptable acid such as hydrochloric acid, sulfuric acid, fumaric acid, maleic acid, succinic acid, acetic acid, benzoic acid, citric acid, tartaric acid, carbonic acid or phosphoric acid. Furthermore, where the compound carries an acidic moiety, suitable pharmaceutically acceptable salts thereof may include alkali metal salts (e.g., sodium or potassium salts); alkaline earth metal salts (e.g., calcium or magnesium salts); and salts formed with suitable organic ligands (e.g., ammonium, quaternary ammonium and amine cations formed using counteranions such as halide, hydroxide, carboxylate, sulfate, phosphate, nitrate, alkyl sulfonate and aryl sulfonate). Illustrative examples of pharmaceutically acceptable salts include, but are not limited to, acetate, adipate, alginate, ascorbate, aspartate, benzenesulfonate, benzoate, bicarbonate, bisulfate, bitartrate, borate, bromide, butyrate, calcium edetate, camphorate, camphorsulfonate, camsylate, carbonate, chloride, citrate, clavulanate, cyclopentanepropionate, digluconate, dihydrochloride, dodecylsulfate, edetate, edisylate, estolate, esylate, ethanesulfonate, formate, fumarate, gluceptate, glucoheptonate, gluconate, glutamate, glycerophosphate, glycolylarsanilate, hemisulfate, heptanoate, hexanoate, hexylresorcinate, hydrabamine, hydrobromide, hydrochloride, hydroiodide, 2-hydroxy-ethanesulfonate, hydroxynaphthoate, iodide, isothionate, lactate, lactobionate, laurate, lauryl sulfate, malate, maleate, malonate, mandelate, mesylate, methanesulfonate, methylsulfate, mucate, 2-naphthalenesulfonate, napsylate, nicotinate, nitrate, N-methylglucamine ammonium salt, oleate, oxalate, pamoate (embonate), palmitate, pantothenate, pectinate, persulfate, 3-phenylpropionate, phosphate/diphosphate, picrate, pivalate, polygalacturonate, propionate, salicylate, stearate, sulfate, subacetate, succinate, tannate, tartrate, teoclate, tosylate, triethiodide, undecanoate, valerate, and the like (see, for example, S. M. Berge et al., "Pharmaceutical Salts", J. Pharm. Sci. 66:1-19 (1977)).

The term "excipient" when used herein is intended to indicate all substances in a pharmaceutical formulation which are not active ingredients such as, e.g., carriers, binders, lubricants, thickeners, surface active agents, preservatives, emulsifiers, buffers, flavoring agents, or colorants.

The term "pharmaceutically acceptable carrier" includes, for example, magnesium carbonate, magnesium stearate, talc, sugar, lactose, pectin, dextrin, starch, gelatin, tragacanth, methylcellulose, sodium carboxymethylcellulose, a low melting wax, cocoa butter, and the like.

DETAILED DESCRIPTION

The present invention establishes for the first time a unique role for the PA subunit of influenza virus polymerase and contradicts the widely held view that the endonuclease active site is located within the PB1 subunit. The present inventors surprisingly found that a small independently folded domain derived from the N-terminus of the PA subunit exhibits the functional properties of the endonuclease reported for the trimeric complex, although this activity was thought to be detectable only in the trimeric complex. Moreover, the inventors found that this PA polypeptide fragment can easily be produced by recombinant means and thus is suitable for in vitro studies on the endonucleolytic activity and its modulation as well as for crystallization to obtain structural information in particular on the active site.

It is one aspect of the present invention to provide a polypeptide fragment comprising an amino-terminal fragment of the PA subunit of a viral RNA-dependent RNA polymerase possessing endonuclease activity, wherein said PA subunit is from a virus belonging to the Orthomyxoviridae family. Preferably, the polypeptide fragment is soluble in an aqueous solution. The minimal length of the polypeptide fragment of the present invention is determined by its ability to cleave polynucleotide chains such as panhandle RNA or single stranded DNA, i.e., the minimal length of the polypeptide is determined by its endonucleolytic activity. Preferably, the endonuclease activity is not dependent on the polynucleotide type, and thus, may be exerted on DNA and RNA, preferably on single stranded DNA and RNA. Preferably, the endonuclease activity is not dependent on specific recognition sites within the substrate polynucleotide.

In a preferred embodiment, the polypeptide fragment is suitable for crystallization, i.e., preferably the polypeptide fragment is crystallizable. Preferably, the crystals obtainable from the polypeptide fragment according to the invention are suitable for structure determination of the polypeptide fragment using X-ray crystallography. Preferably, said crystals are greater than 25 micron cubes and preferably are radiation stable enough to permit more than 85% diffraction data completeness at resolution of preferably 3.5 Å or better to be collected upon exposure to monochromatic X-rays.

In one embodiment, the polypeptide fragment is crystallizable using (i) an aqueous protein solution, i.e., the crystallization solution, with a protein concentration of 5 to 10 mg/ml, e.g., 5, 5.5, 6, 6.5, 7, 7.5, 8, 8.5, 9, 9.5, or 10 mg/ml, preferably of 8 to 10 mg/ml in a buffer system such as Tris-HC 1 at concentrations ranging from 10 mM to 3 M, preferably 10 mM to 2 M, more preferably 20 mM to 1 M, at pH 3 to pH 9, preferably pH 4 to pH 9, more preferably pH 7 to pH 9 and (ii) a precipitant/reservoir solution comprising one or more compounds such as sodium formate, ammonium sulphate, lithium sulphate, magnesium acetate, manganese acetate, or ethylene glycol. Optionally, the protein solution may contain one or more salts such as monovalent salts, e.g., NaCl, KCl, or LiCl, preferably NaCl, at concentrations ranging from 10 mM to 1 M, preferably 20 mM to 500 mM, more preferably 50 mM to 200 mM, and/or divalent salts, e.g., $MnCl_2$, $CaCl_2$, $MgCl_2$, $ZnCl_2$, or $CoCl_2$, preferably $MnCl_2$, at concentrations ranging from 0.1 to 50 mM, preferably 0.5 to 25 mM, more preferably 1 to 10 mM. Preferably, the precipitant/reservoir solution comprises $Li_2SO_4$ at concentrations ranging from 0.5 to 2 M, preferably 1 to 1.5 M, a buffer system such as MES at concentrations ranging from 20 mM to 1 M, preferably 50 mM to 500 mM, more preferably 75 to 150 mM, at preferably pH 4 to 8, more preferably pH 5 to 7, magnesium acetate and/or manganese acetate at concentrations ranging from 1 to 100 mM, preferably from 5 to 20 mM, and/or ethylene glycol at concentrations ranging from 1% to 20%, preferably 2% to 8%, more preferably 2 to 4%. The PA polypeptide fragment or variant thereof is preferably 85% to 100% pure, more preferably 90% to 100% pure, even more preferably 95% to 100% pure in the crystallization solution. To produce crystals, the protein solution suitable for crystallization may be mixed with an equal volume of the precipitant solution. In a preferred embodiment, the crystallization medium comprises 0.05 to 2 preferably 0.8 to 1.2 of protein solution suitable for crystallization mixed with a similar, preferably equal volume of precipitant solution comprising 1.0 to 1.4 M $Li_2SO_4$, 80 to 120 mM MES pH 5.5 to pH 6.5, 5 to 15 mM magnesium acetate and/or manganese acetate, and 2 to 4% ethylene glycol. In another embodiment, the precipitant solution comprises, preferably essentially consists of or consists of 1.2 M $Li_2SO_4$, 100 mM MES pH 6.0, 10 mM magnesium acetate and/or 10 mM manganese acetate, preferably 10 mM magnesium acetate, and 3% ethylene glycol, and the crystallization/protein solution comprises, preferably essentially consists or consists of 5 to 10 mg/ml protein, 20 mM Tris pH 8.0, 100 mM NaCl, and 2.5 mM $MnCl_2$.

Crystals can be grown by any method known to the person skilled in the art including, but not limited to, hanging and sitting drop techniques, sandwich-drop, dialysis, and microbatch or microtube batch devices. It would be readily apparent to one of skill in the art to vary the crystallization conditions disclosed above to identify other crystallization conditions that would produce crystals of PA polypeptide fragments of the inventions or variants thereof alone or in complex with a compound. Such variations include, but are not limited to, adjusting pH, protein concentration and/or crystallization temperature, changing the identity or concentration of salt and/or precipitant used, using a different method for crystallization, or introducing additives such as detergents (e.g., TWEEN 20 (monolaurate), LDOA, Brij 30 (4 lauryl ether)), sugars (e.g., glucose, maltose), organic compounds (e.g., dioxane, dimethylformamide), lanthanide ions, or poly-ionic compounds that aid in crystallizations. High throughput crystallization assays may also be used to assist in finding or optimizing the crystallization condition.

Microseeding may be used to increase the size and quality of crystals. In brief, micro-crystals are crushed to yield a stock seed solution. The stock seed solution is diluted in series. Using a needle, glass rod or strand of hair, a small sample from each diluted solution is added to a set of equilibrated drops containing a protein concentration equal to or less than a concentration needed to create crystals without the presence of seeds. The aim is to end up with a single seed crystal that will act to nucleate crystal growth in the drop.

Figure 12:
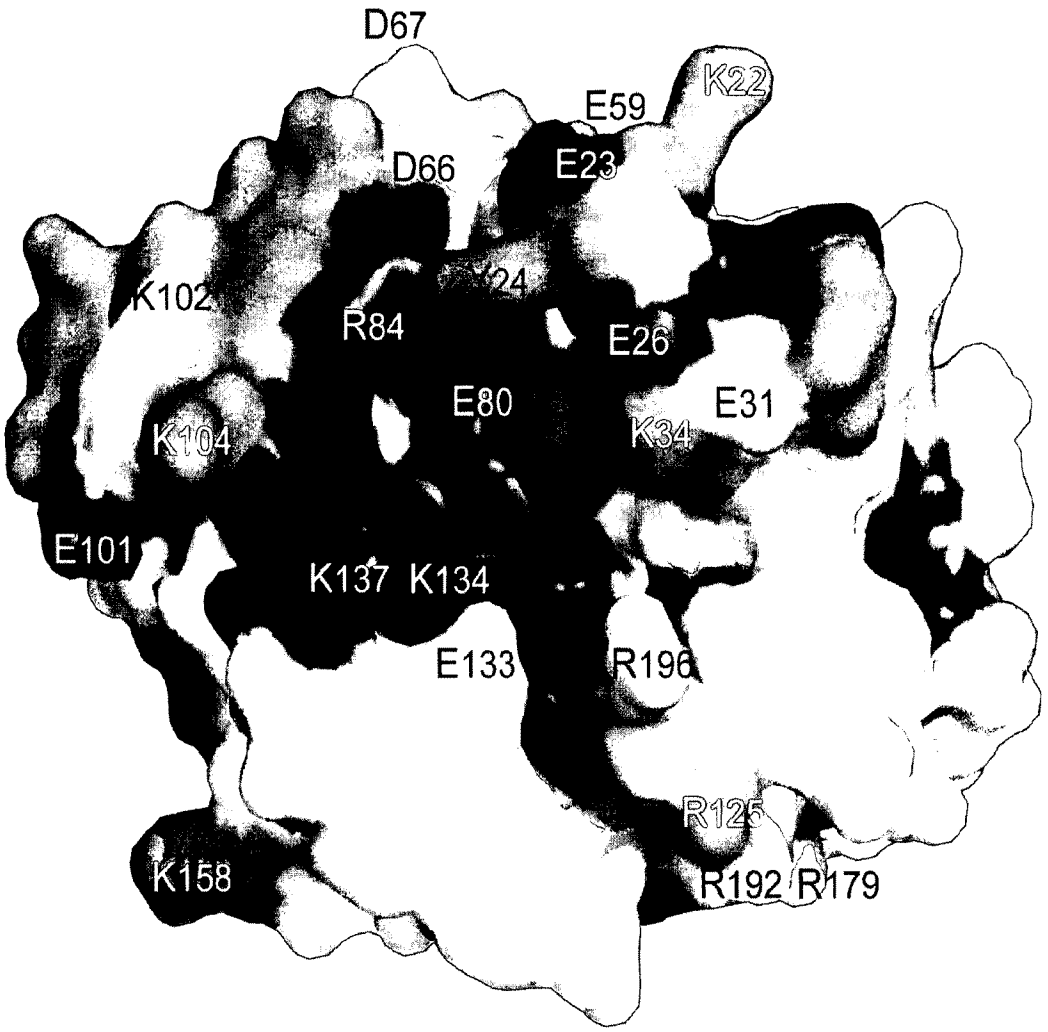
FIG. 12: Representation of PA-Nter (SEQ ID NO: 22) shaded according to residue conservation as based on the sequence alignment shown in FIG. 11, with grey (not conserved), grey (equivalent residues) and black (100% conserved).
Figure 13:
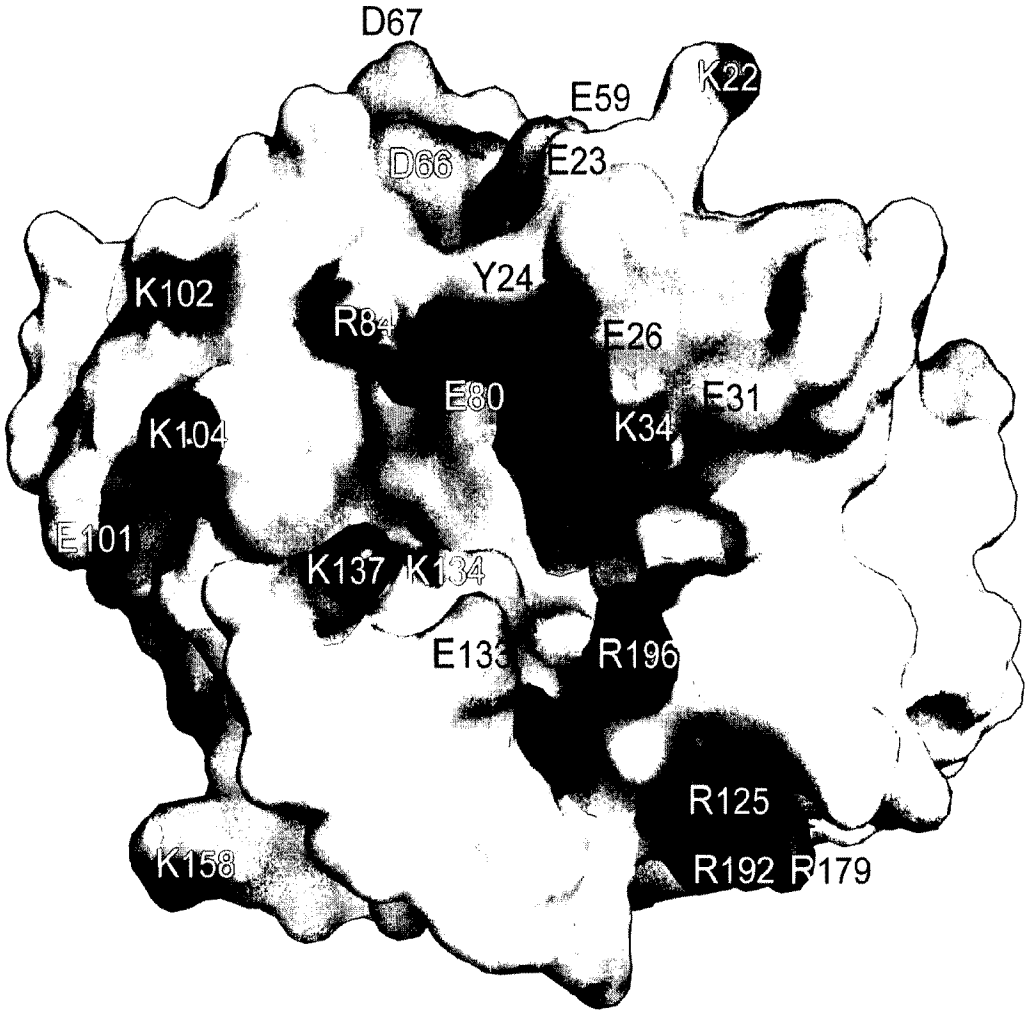
FIG. 13: Electrostatic surface potential of PA-Nter (SEQ ID NO: 22). The orientation is as in FIG. 12. Electrostatic surface potential of PA-Nter (SEQ ID NO: 22) in the absence of metal ions. The potential scale ranges from −10.0 kT/e (medium grey, acidic residues Asp(D) and Glu(E)) to 3.0 kT/e (dark grey, basic residues Lys(K) and Arg(R)).

The manner of obtaining the structure coordinates as shown in FIG. 18, interpretation of the coordinates and their utility in understanding the protein structure, as described herein, are commonly understood by the skilled person and by reference to standard texts such as J. Drenth, "Principles of protein X-ray crystallography", $2^{nd}$ Ed., Springer Advanced Texts in Chemistry, New York (1999); and G. E. Schulz and R. H. Schirmer, "Principles of Protein Structure", Springer Verlag, New York (1985). For example, X-ray diffraction data is first acquired, often using cryoprotected (e.g., with 20% to 30% glycerol) crystals frozen to 100 K, e.g., using a beamline at a synchrotron facility or a rotating anode as an X-ray source. Then, the phase problem is solved by a generally known method, e.g., multiwavelength anomalous diffraction (MAD), multiple isomorphous replacement (MIR), single wavelength anomalous diffraction (SAD), or molecular replacement (MR). The substructure may be solved using SHELXD (Schneider and Sheldrick, 2002, Acta Crystallogr. D. Biol. Crystallogr. (Pt 10 Pt 2), 1772-1779), phases calculated with SHARP (Vonrhein et al., 2006, Methods Mol. Biol. 364:215-30), and improved with solvent flattening and non-crystallographic symmetry averaging, e.g., with RESOLVE (Terwilliger, 2000, Acta Cryst. D. Biol. Crystallogr. 56:965-972). Model autobuilding can be done, e.g., with ARP/wARP (Perrakis et al., 1999, Nat. Struct. Biol. 6:458-63) and refinement with, e.g., REFMAC (Murshudov, 1997, Acta Crystallogr. D. Biol. Crystallogr. 53: 240-255). The skilled person can use the structure coordinates (FIG. 18) as input for secondary analysis, including the determination of electrostatic surface potential (see FIG. 13), which aids in the determination of side groups in test compounds, which are likely to interact with a surface area of the PA of a given electrostatic potential, preferably in the active site. In order to use the structure coordinates generated for the PA polypeptide fragment it is necessary to convert the structure coordinates into a three-dimensional shape. This is achieved through the use of commercially available software that is capable of generating three-dimensional graphical representations of molecules or portions thereof from a set of structure coordinates. An example for such a computer program is MODELER (Sali and Blundell, 1993, J. Mol. Biol. 234:779-815 as implemented in the Insight II Homology software package (Insight II (97.0), Molecular Simulations Incorporated, San Diego, Calif.)). Such a three-dimensional graphical representations can be use with suitable programs including (i) Gaussian 92, revision C (Frisch, Gaussian, Incorporated, Pittsburgh, Pa.), (ii) AMBER, version 4.0 (Kollman, University of California, San Francisco, Calif.), (iii) QUANTA/CHARMM (Molecular Simulations Incorporated, San Diego, Calif.), (iv) OPLS-AA (Jorgensen, 1998, Encyclopedia of Computational Chemistry, Schleyer, Ed., Wiley, New York, Vol. 3, pp. 1986-1989), and (v) Insight II/Discover (Biosysm Technologies Incorporated, San Diego, Calif.) to generate graphic representations of, e.g. electrostatic potential. Similarly, the structural information can be combined with information on the conservation of residues as depicted in FIG. 11 at the various amino acid positions (see FIG. 12) to highlight those residues at the surface of the PA and/or in the active site, which are particularly conserved between different virus isolates and, consequently, are likely to be also present in mutants of those[[s]] viruses or other isolates. This suitable in the skilled person is able to derive information on the relevance of the residues Furthermore, the structure coordinates (FIG. 18) of the Influenza A virus PA fragment PA-Nter (SEQ ID NO: 22) provided by the present invention are useful for the structure determination of PA polypeptides of other viruses from the Orthomyxoviridae family, or PA polypeptide variants that have amino acid substitutions, deletions, and/or insertions using the method of molecular replacement.

In a preferred embodiment of the polypeptide fragment according to the invention, the PA subunit is from Influenza A, B, or C virus or is a variant thereof, preferably from Influenza A virus or a variant thereof. Preferably, the amino terminal PA fragment comprised within the polypeptide fragment according to the present invention corresponds to, preferably essentially consists or consists of at least amino acids 1 to 196, preferably amino acids 1 to 209, preferably amino acids 1 to 213 of the PA subunit of the RNA-dependent RNA polymerase of Influenza A virus or variants thereof, i.e., amino acid residues 1 to 196, 1 to 209, or 1 to 213 of the amino acid sequence as set forth in SEQ ID NO: 2.

In a preferred embodiment, the polypeptide fragment according to the present invention is purified to an extent to be suitable for crystallization, preferably it is 85% to 100%, more preferably 90% to 100%, most preferably 95% to 100% pure.

In another embodiment, the polypeptide fragment according to the invention is capable of binding to divalent cations. Preferably, the polypeptide fragment according to the present invention is bound to one or more divalent cation(s), preferably it is bound to two divalent cations. In this context, the divalent cation is preferably selected form the group consisting of manganese, cobalt, calcium, magnesium, and zinc, and is more preferably manganese or cobalt, most preferably manganese. Thus, in a preferred embodiment, the polypeptide of the present invention is present in complex with two manganese cations. In a preferred embodiment, the divalent cations are coordinated by amino acids corresponding to amino acids Glu80 and Asp108 (first cation) and amino acids corresponding to amino acids His41, Asp108, and Glu119 (second cation) as set forth in SEQ ID NO: 2.

In a preferred embodiment of the polypeptide fragment according to the present invention, (i) the N-terminus is identical to or corresponds to amino acid position 15 or lower, e.g., at position 15, 14, 13, 12, 11, 10, 9, 8, 7, 6, 5, 4, 3, 2, or 1, and the C-terminus is identical to or corresponds to an amino acid at a position selected from positions 186 to 220, e.g., 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, or 220 of the amino acid sequence of the PA subunit according to SEQ ID NO: 2; preferably the N-terminus is identical to or corresponds to amino acid position 15 or lower, e.g., at position 15, 14, 13, 12, 11, 10, 9, 8, 7, 6, 5, 4, 3, 2, or 1 and the C-terminus is identical to or corresponds to an amino acid at a position selected from 196 to 220 of the amino acid sequence of the PA subunit according to SEQ ID NO: 2; more preferably the N-terminus is identical to or corresponds to amino acid position 15 or lower, e.g., at position 15, 14, 13, 12, 11, 10, 9, 8, 7, 6, 5, 4, 3, 2, or 1, and the C-terminus is identical to or corresponds to an amino acid at a position selected from 196 to 209 of the amino acid sequence of the PA subunit according to SEQ ID NO: 2, (ii) the N-terminus is identical to or corresponds to amino acid position 15 or lower, e.g., amino acid position 15, 14, 13, 12, 11, 10, 9, 8, 7, 6, 5, 4, 3, 2, or 1, and the C-terminus is identical to or corresponds to an amino acid at a position selected from positions 185 to 217, e.g., 135, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, or 217 of the amino acid sequence of the PA subunit according to SEQ ID NO: 4; preferably the N-terminus is identical to or corresponds to amino acid position 15 or lower, e.g., amino acid position 15, 14, 13, 12, 11, 10, 9, 8, 7, 6, 5, 4, 3, 2, or 1, and the C-terminus is identical to or corresponds to an amino acid at a position selected from positions 195 to 217 of the amino acid sequence of the PA subunit according to SEQ ID NO: 4; more preferably the N-terminus is identical to or corresponds to amino acid position 15 or lower, e.g., amino acid position 15, 14, 13, 12, 11, 10, 9, 8, 7, 6, 5, 4, 3, 2, or 1, and the C-terminus is identical to or corresponds to an amino acid at a position 195 to 206 of the amino acid sequence according to SEQ ID NO: 4, or (iii) the N-terminus is identical to or corresponds to amino acid position 15 or lower, e.g., amino acid position 15, 14, 13, 12, 11, 10, 9, 8, 7, 6, 5, 4, 3, 2, or 1, and the C-terminus is identical to or corresponds to an amino acid at a position selected from positions 168 to 200, e.g., amino acid position 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, or 200 of the amino acid sequence of the PA subunit according to SEQ ID NO: 6; preferably the N-terminus is identical to or corresponds to amino acid position 15 or lower, e.g., amino acid position 15, 14, 13, 12, 11, 10, 9, 8, 7, 6, 5, 4, 3, 2, or 1, and the C-terminus is identical to or corresponds to an amino acid at a position selected from positions 178 to 200 of the amino acid sequence according to SEQ ID NO: 6, and variants thereof, which retain the endonuclease activity; more preferably the N-terminus is identical to or corresponds to amino acid position 15 or lower, e.g., amino acid position 15, 14, 13, 12, 11, 10, 9, 8, 7, 6, 5, 4, 3, 2, or 1, and the C-terminus is identical to or corresponds to an amino acid at a position selected from positions 178 to 189 of the amino acid sequence according to SEQ ID NO: 6; and in each case variants of the amino acid sequence according to SEQ ID NO: 2, 4 or 6, which retain endonuclease activity.

In another embodiment said polypeptide fragment has or corresponds to an amino acid sequence selected from the group of amino acid sequences consisting of amino acids 5 to 196, 10 to 196, 15 to 196, 20 to 196, 5 to 209, 10 to 209, 15 to 209, 20 to 209 of the amino acid sequence set forth in SEQ ID NO: 2 and variants thereof, which retain the endonucleolytic activity. In another embodiment said PA polypeptide fragment has or corresponds to amino acids selected from the group of amino acid sequences consisting of amino acids 5 to 195, 10 to 195, 15 to 195, 20 to 195, 5 to 206, 10 to 206, 15 to 206, 20 to 206 of the amino acid sequence set forth in SEQ ID NO: 4 and variants thereof, which retain the endonucleolytic activity. In another embodiment said PA polypeptide fragment has or corresponds to amino acids selected from the group of amino acid sequences consisting of amino acids 5 to 178, 10 to 178, 15 to 178, 20 to 178, 5 to 189, 10 to 189, 15 to 189, 20 to 189 of the amino acid sequence set forth in SEQ ID NO: 6 and variants thereof, which retain the endonucleolytic activity. In preferred embodiments, said polypeptide fragments comprise amino acid substitutions, insertions, or deletions, preferably naturally occurring mutations as set forth above.

In another preferred embodiment, the polypeptide fragment according to the present invention consists of amino acids 1 to 209 of the amino acid sequence set forth in SEQ ID NO: 2 and has the structure defined by the structure coordinates as shown in FIG. 18.

In another embodiment, the polypeptide fragment according to the present invention has a crystalline form, preferably with space group $P4_32_12$, with unit cell dimensions of preferably a=b=6.71±0.2 nm, c=30.29 nm±0.4 nm. In another embodiment, the crystals according to the invention are hexagonal plates with preferred unit cell dimensions of a=b=6.79 nm, c=49.4 nm, $\alpha=\beta 90°$, and $\gamma=120°$ having preferably a trigonal or hexagonal space group. Preferably, the crystal of the polypeptide fragment diffracts X-rays to a resolution of 2.8 Å or higher, preferably 2.6 Å or higher, more preferably 2.5 Å or higher, even more preferably 2.4 Å or higher, most preferably 2.1 Å or higher.

It is another aspect of the present invention to provide an isolated polynucleotide coding for the above-mentioned PA polypeptide fragments and variants thereof. The molecular biology methods applied for obtaining such isolated nucleotide fragments are generally known to the person skilled in the art (for standard molecular biology methods see Sambrook et al., Eds., "Molecular Cloning: A Laboratory Manual", Cold Spring Harbor Laboratory Press, Cold Spring Harbor, N.Y. (1989), which is incorporated herein by reference). For example, RNA can be isolated from Influenza virus infected cells and cDNA generated applying reverse transcription polymerase chain reaction (RT-PCR) using either random primers (e.g., random hexamers of decamers) or primers specific for the generation of the fragments of interest. The fragments of interest can then be amplified by standard PCR using fragment specific primers.

In a preferred embodiment the isolated polynucleotide coding for the preferred embodiments of the PA polypeptide fragments are derived from SEQ ID NO: 1 (Influenza A), 3 (Influenza B), or 6 (Influenza C). In this context, "derived" refers to the fact that SEQ ID NO: 1, 2, and 3 encode the full-length PA polypeptides and, thus, polynucleotides coding for preferred PA polypeptide fragments may comprise deletions at the 3'- and/or 5'-ends of the polynucleotide as required by the respectively encoded PA polypeptide fragment.

In one embodiment, the present invention relates to a recombinant vector comprising said isolated polynucleotide. The person skilled in the art is well aware of techniques used for the incorporation of polynucleotide sequences of interest into vectors (also see Sambrook et al., 1989, supra). Such vectors include any vectors known to the skilled person including plasmid vectors, cosmid vectors, phage vectors such as lambda phage, viral vectors such as adenoviral or baculoviral vectors, or artificial chromosome vectors such as bacterial artificial chromosomes (BAC), yeast artificial chromosomes (YAC), or P1 artificial chromosomes (PAC). Said vectors may be expression vectors suitable for prokaryotic or eukaryotic expression. Said plasmids may include an origin of replication (ori), a multiple cloning site, and regulatory sequences such as promoter (constitutive or inducible), transcription initiation site, ribosomal binding site, transcription termination site, polyadenylation signal, and selection marker such as antibiotic resistance or auxotrophic marker based on complementation of a mutation or deletion. In one embodiment the polynucleotide sequence of interest is operably linked to the regulatory sequences.

In another embodiment, said vector includes nucleotide sequences coding for epitope-, peptide-, or protein-tags that facilitate purification of polypeptide fragments of interest. Such epitope-, peptide-, or protein-tags include, but are not limited to, hemagglutinin- (HA-), FLAG-, myc-tag, poly-His-tag, glutathione-S-transferase- (GST-), maltose-binding-protein-(MBP-), NusA-, and thioredoxin-tag, or fluorescent protein-tags such as (enhanced) green fluorescent protein ((E)GFP), (enhanced) yellow fluorescent protein ((E)YFP), red fluorescent protein (RFP) derived from Discosoma species (DsRed) or monomeric (mRFP), cyan fluorescence protein (CFP), and the like. In a preferred embodiment, the epitope-, peptide-, or protein-tags can be cleaved off the polypeptide fragment of interest, for example, using a protease such as thrombin, Factor Xa, PreScission, TEV protease, and the like. Preferably, the tag can be cleaved off with a TEV protease. The recognition sites for such proteases are well known to the person skilled in the art. For example, the seven amino acid consensus sequence of the TEV protease recognition site is Glu-X-X-Tyr-X-Gln-Gly/Ser (SEQ ID NO: 23), wherein X may be any amino acid and is in the context of the present invention preferably Glu-Asn-Leu-Tyr-Phe-Gln-Gly (SEQ ID NO: 21). In another embodiment, the vector includes functional sequences that lead to secretion of the polypeptide fragment of interest into the culture medium of the recombinant host cells or into the periplasmic space of bacteria. The signal sequence fragment usually encodes a signal peptide comprised of hydrophobic amino acids which direct the secretion of the protein from the cell. The protein is either secreted into the growth media (gram-positive bacteria) or into the periplasmic space, located between the inner and outer membrane of the cell (gram-negative bacteria). Preferably there are processing sites, which can be cleaved either in vivo or in vitro encoded between the signal peptide fragment and the foreign gene.

In another aspect, the present invention provides a recombinant host cell comprising said isolated polynucleotide or said recombinant vector. The recombinant host cells may be prokaryotic cells such as arches and bacterial cells or eukaryotic cells such as yeast, plant, insect, or mammalian cells. In a preferred embodiment the host cell is a bacterial cell such as an *E. coli* cell. The person skilled in the art is well aware of methods for introducing said isolated polynucleotide or said recombinant vector into said host cell. For example, bacterial cells can be readily transformed using, for example, chemical transformation, e.g., the calcium chloride method, or electroporation. Yeast cells may be transformed, for example, using the lithium acetate transformation method or electroporation. Other eukaryotic cells can be transfected, for example, using commercially available liposome-based transfection kits such as Lipofectamine™ (Invitrogen), commercially available lipid-based transfection kits such as Fugene (Roche Diagnostics), polyethylene glycol-based transfection, calcium phosphate precipitation, gene gun (biolistic), electroporation, or viral infection. In a preferred embodiment of the invention, the recombinant host cell expresses the polynucleotide fragment of interest. In an even more preferred embodiment, said expression leads to soluble polypeptide fragments of the invention. These polypeptide fragments may be purified using protein purification methods well known to the person skilled in the art, optionally taking advantage of the above-mentioned epitope-, peptide-, or protein-tags.

In another aspect, the present invention relates to a method for identifying compounds which modulate the endonuclease activity of the PA subunit of a viral RNA-dependent RNA polymerase from the Orthomyxoviridae family or a variant thereof, comprising the steps of (a) constructing a computer model of the active site defined by the structure coordinates of the polypeptide fragment according to the present invention shown in FIG. 18;

(b) selecting a potential activity modulating compound by a method selected from the group consisting of:

(i) assembling molecular fragments into said compound, (ii) selecting a compound from a small molecule database, and (iii) de novo ligand design of said compound;

(c) employing computational means to perform a fitting program operation between computer models of the said compound and the said active site in order to provide an energy-minimized configuration of the said compound in the active site; and (d) evaluating the results of said fitting operation to quantify the association between the said compound and the active site model, whereby evaluating the ability of said compound to associate with the said active site.

Preferably, the modulating compound binds to the endonucleolytically active site within the PA subunit or variant thereof. The modulating compound may increase or decrease, preferably decrease said endonucleolytic activity.

In a preferred embodiment of this aspect of the present invention, the compound that modulates the endonuclease activity of the PA subunit or a variant thereof decreases said activity, more preferably said compound inhibits said activity. Preferably, the compound decreases the endonucleolytic activity of the PA subunit or a variant thereof by 50%, more preferably by 60%, even more preferably by 70%, even more preferably by 80%, even more preferably by 90%, and most preferably by 100% compared to the endonucleolytic activity of the PA subunit or a variant thereof without said compound but with otherwise the same reaction conditions, i.e., buffer conditions, reaction time and temperature. It is particularly preferred that the compound specifically decreases or inhibits the endonucleolytic activity of the PA subunit or a variant thereof but does not decrease or inhibit the endonucleolytic activity of other endonucleases, in particular of mammalian endonucleases, to the same extent, preferably not at all.

For the first time, the present invention permits the use of molecular design techniques to identify, select, or design of compounds potentially modulating the endonucleolytic activity of the PA subunit or variants thereof, based on the structure coordinates of the endonucleolytically active site according to FIG. 18. Such a predictive model is valuable in light of the higher costs associated with the preparation and testing of the many diverse compounds that may possibly modulate the endonucleolytic activity. In order to use the structure coordinates generated for the PA polypeptide fragment it is necessary to convert the structure coordinates into a three-dimensional shape. This is achieved through the use of commercially available software that is capable of generating three-dimensional graphical representations of molecules or portions thereof from a set of structure coordinates.

An example for such a computer program is MODELER (Sali and Blundell, 1993, J. Mol. Biol. 234:779-815 as implemented in the Insight II Homology software package (Insight II (97.0), Molecular Simulations Incorporated, San Diego, Calif.)).

One skilled in the art may use several methods to screen chemical entities or fragments for their ability to modulate the endonucleolytic activity of the PA subunit or PA polypeptide variants. This process may begin by a visual inspection of, for example, a three-dimensional computer model of the endonucleolytically active site of PA based on the structural coordinates according to FIG. 18. Selected fragments or chemical compounds may then be positioned in a variety of orientations or docked within the active site. Docking may be accomplished using software such as Cerius, Quanta, and Sybyl (Tripos Associates, St. Louis, Mo.), followed by energy minimization and molecular dynamics with standard molecular dynamics force fields such as OPLS-AA, CHARMM, and AMBER. Additional specialized computer programs that may assist the person skilled in the art in the process of selecting suitable compounds or fragments include, for example, (i) AUTODOCK (Goodsell et al., 1990, Proteins: Struct., Funct., Genet. 8: 195-202; AUTODOCK is available from The Scripps Research Institute, La Jolla, Calif.) and (ii) DOCK (Kuntz et al., 1982, J. Mol. Biol. 161:269-288; DOCK is available from the University of California, San Francisco, Calif.).

Once suitable compounds or fragments have been selected, they can be designed or assembled into a single compound or complex. This manual model building is performed using software such as Quanta or Sybyl. Useful programs aiding the skilled person in connecting individual compounds or fragments include, for example, (i) CAVEAT (Bartlett et al., 1989, in Molecular Recognition in Chemical and Biological Problems, Special Publication, Royal Chem. Soc. 78:182-196; Lauri and Bartlett, 1994, J. Comp. Aid. Mol. Des. 8:51-66; CAVEAT is available from the University of California, Berkley, Calif.), (ii) 3D Database systems such as ISIS (MDL Information Systems, San Leandro, Calif.; reviewed in Martin, 1992, J. Med. Chem. 35:2145-2154), and (iii) HOOK (Eisen et al., 1994, Proteins: Struct., Funct., Genet. 19:199-221; HOOK is available from Molecular Simulations Incorporated, San Diego, Calif.).

Another approach enabled by this invention, is the computational screening of small molecule databases for compounds that can bind in whole or part to the endonucleolytically active site of the PA subunit or active sites of PA polypeptide variants. In this screening, the quality of fit of such compounds to the active site may be judged either by shape complementarity or by estimated interaction energy (Meng et al., 1992, J. Comp. Chem. 13:505-524).

Alternatively, a potential modulator for the endonucleolytic activity of the PA subunit or polypeptide variant thereof, preferably an inhibitor of the endonucleolytic activity, may be designed de novo on the basis of the 3D structure of the PA polypeptide fragment according to FIG. 18. There are various de novo ligand design methods available to the person skilled in the art. Such methods include (i) LUDI (Bohm, 1992, J. Comp. Aid. Mol. Des. 6:61-78; LUDI is available from Molecular Simulations Incorporated, San Diego, Calif.), (ii) LEGEND (Nishibata and Itai, Tetrahedron 47:8985-8990; LEGEND is available from Molecular Simulations Incorporated, San Diego, Calif.), (iii) LeapFrog (available from Tripos Associates, St. Louis, Mo.), (iv) SPROUT (Gillet et al., 1993, J. Comp. Aid. Mol. Des. 7:127-153; SPROUT is available from the University of Leeds, UK), (v) GROUPBUILD (Rotstein and Murcko, 1993, J. Med. Chem. 36:1700-1710), and (vi) GROW (Moon and Howe, 1991, Proteins 11:314-328).

In addition, several molecular modeling techniques (hereby incorporated by reference) that may support the person skilled in the art in de novo design and modeling of potential modulators and/or inhibitors of the endonucleolytically active site, preferably binding partners of the endonucleolytically active site, have been described and include, for example, Cohen et al., 1990, J. Med. Chem. 33:883-894; Navia and Murcko, 1992, Curr. Opin. Struct. Biol. 2:202-210; Balbes et al., 1994, Reviews in Computational Chemistry, Vol. 5, Lipkowitz and Boyd, Eds., VCH, New York, pp. 37-380; Guida, 1994, Curr. Opin. Struct. Biol. 4:777-781.

A molecule designed or selected as binding to the endonucleolytically active site of the PA subunit or variants thereof may be further computationally optimized so that in its bound state it preferably lacks repulsive electrostatic interaction with the target region. Such non-complementary (e.g., electrostatic) interactions include repulsive charge-charge, dipole-dipole and charge-dipole interactions. Specifically, the sum of all electrostatic interactions between the binding compound and the binding pocket in a bound state, preferably make a neutral or favorable contribution to the enthalpy of binding. Specific computer programs that can evaluate a compound deformation energy and electrostatic interaction are available in the art. Examples of suitable programs include (i) Gaussian 92, revision C (Frisch, Gaussian, Incorporated, Pittsburgh, Pa.), (ii) AMBER, version 4.0 (Kollman, University of California, San Francisco, Calif.), (iii) QUANTA/CHARMM (Molecular Simulations Incorporated, San Diego, Calif.), (iv) OPLS-AA (Jorgensen, 1998, Encyclopedia of Computational Chemistry, Schleyer, Ed., Wiley, New York, Vol. 3, pp. 1986-1989), and (v) Insight II/Discover (Biosysm Technologies Incorporated, San Diego, Calif.). These programs may be implemented, for instance, using a Silicon Graphics workstation, IRIS 4D/35 or IBM RISC/6000 workstation model 550. Other hardware systems and software packages are known to those skilled in the art.

Once a molecule of interest has been selected or designed, as described above, substitutions may then be made in some of its atoms or side groups in order to improve or modify its binding properties. Generally, initial substitutions are conservative, i.e., the replacement group will approximate the same size, shape, hydrophobicity and charge as the original group. It should, of course, be understood that components known in the art to alter conformation should be avoided. Such substituted chemical compounds may then be analyzed for efficiency of fit to the endonucleolytically active site of the PA subunit or variant thereof by the same computer methods described in detail above.

In one embodiment of the above-described method of the invention, the endonucleolytically active site of the PA subunit or variant thereof comprises amino acids corresponding to amino acids Asp108, Ile120, and Lys134 of the PA subunit according to SEQ ID NO: 2. In another embodiment, said active site comprises amino acids corresponding to amino acids Asp108, Ile120, Lys134, and His41 according to SEQ ID NO: 2. In another embodiment, said active site comprises amino acids corresponding to amino acids Asp108, Ile120, Lys134, and Glu80 according to SEQ ID NO: 2. In another embodiment, said active site comprises amino acids corresponding to amino acids Asp108, Ile120, Lys134, and Glu119 according to SEQ ID NO: 2. In another embodiment, said active site comprises amino acids corresponding to amino acids Asp108, Ile120, Lys134, His41, Glu80, and Glu119 according to SEQ ID NO: 2. In yet another embodiment, said active site comprises amino acids corresponding to amino acids Asp108, Ile120, Lys134, His41, Glu80, Glu119, and Tyr24 according to SEQ ID NO: 2. In yet another embodiment, said active site comprises amino acids corresponding to amino acids Asp108, Ile120, Lys134, His41, Glu80, Glu119, and Arg84 according to SEQ ID NO: 2. In yet another embodiment, said active site comprises amino acids corresponding to amino acids Asp108, Ile120, Lys134, His41, Glu80, Glu119, and Leu106 according to SEQ ID NO: 2. In yet another embodiment, said active site comprises amino acids corresponding to amino acids Asp108, Ile120, Lys134, His41, Glu80, Glu119, and Tyr130 according to SEQ ID NO: 2. In yet another embodiment, said active site comprises amino acids corresponding to amino acids Asp108, Ile120, Lys134, His41, Glu80, Glu119, and Glu133 according to SEQ ID NO: 2. In yet another embodiment, said active site comprises amino acids corresponding to amino acids Asp108, Ile120, Lys134, His41, Glu80, Glu119, and Lys137 according to SEQ ID NO: 2. In another embodiment, said active site comprises amino acids corresponding to amino acids Asp108, Ile 120, Lys134, His41, Glu80, Glu119, Tyr24, Arg84, and Leu106 according to SEQ ID NO: 2. In another embodiment, said active site comprises amino acids corresponding to amino acids Asp108, Ile 120, Lys134, His41, Glu80, Glu119, Tyr130, Glu133, and Lys137 according to SEQ ID NO: 2. In another embodiment, said active site comprises amino acids corresponding to amino acids Asp108, Ile 120, Lys134, His41, Glu80, Glu119, Tyr24, Arg84, Leu106, Tyr130, Glu133, and Lys137 according to SEQ ID NO: 2.

In a further aspect of the above-described method of the invention, the endonucleolytically active site of the PA subunit or a variant thereof is defined by the structure coordinates of the PA SEQ ID NO: 2 amino acids Asp108, Ile120, and Lys134 according to FIG. 18. In another embodiment, said active site is defined by the structure coordinates of PA SEQ ID NO: 2 amino acids Asp108, Ile120, Lys134, and His41 according to FIG. 18. In another embodiment, said active site is defined by the structure coordinates of PA SEQ ID NO: 2 amino acids Asp108, Ile120, Lys134, and Glu80 according to FIG. 18. In another embodiment, said active site is defined by the structure coordinates of PA SEQ ID NO: 2 amino acids Asp108, Ile120, Lys134, and Glu119 according to FIG. 18. In another embodiment, said active site is defined by the structure coordinates of PA SEQ ID NO: 2 amino acids Asp108, Ile120, Lys134, His41, Glu80, and Glu119 according to FIG. 18. In another embodiment, said active site is defined by the structure coordinates of PA SEQ ID NO: 2 amino acids Asp108, Ile120, Lys134, His41, Glu80, Glu119, and Tyr24 according to FIG. 18. In yet another embodiment, said active site is defined by the structure coordinates of PA SEQ ID NO: 2 amino acids Asp108, Ile120, Lys134, His41, Glu80, Glu119, and Arg84 according to FIG. 18. In another embodiment, said active site is defined by the structure coordinates of PA SEQ ID NO: 2 amino acids Asp108, Ile120, Lys134, His41, Glu80, Glu119, and Leu106 according to FIG. 18. In another embodiment, said active site is defined by the structure coordinates of PA SEQ ID NO: 2 amino acids Asp108, Ile120, Lys134, His41, Glu80, Glu119, and Tyr130 according to FIG. 18. In another embodiment, said active site is defined by the structure coordinates of PA SEQ ID NO: 2 amino acids Asp108, Ile120, Lys134, His41, Glu80, Glu119, and Glu133 according to FIG. 18. In another embodiment, said active site is defined by the structure coordinates of PA SEQ ID NO: 2 amino acids Asp108, Ile120, Lys134, His41, Glu80, Glu119, and Lys137 according to FIG. 18. In another embodiment, said active site is defined by the structure coordinates of PA SEQ ID NO: 2 amino acids Asp108, Ile120, Lys134, His41, Glu80, Glu119, Tyr24, Arg84, and Leu106 according to FIG. 18. In another embodiment, said active site is defined by the structure coordinates of PA SEQ ID NO: 2 amino acids Asp108, Ile120, Lys134, His41, Glu80, Glu119, Tyr130, Glu133, and Lys137 according to FIG. 18. In another embodiment, said active site is defined by the structure coordinates of PA SEQ ID NO: 2 amino acids Asp108, Ile120, Lys134, His41, Glu80, Glu119, Tyr24, Arg84, Leu106, Tyr130, Glu133, and Lys137 according to FIG. 18.

In one aspect, the present invention provides a method for computational screening according to the above-described method for compounds able to modulate and/or associate with an endonucleolytically active site that is a variant to the endonucleolytically active site of the PA subunit according to FIG. 18. In one embodiment, said variant of said active site has a root mean square deviation from the backbone atoms of amino acids Asp108, Ile120, and Lys134, of amino acids Asp108, Ile120, Lys134, and His41, of amino acids Asp108, Ile120, Lys134, and Glu80, of amino acids Asp108, Ile120, Lys134, and Glu119, of amino acids Asp108, Ile120, Lys134, His41, Glu80, and Glu119, of amino acids Asp108, Ile120, Lys134, His41, Glu80, Glu119, and Tyr24, of amino acids Asp108, Ile120, Lys134, His41, Glu80, Glu119, and Arg84, of amino acids Asp108, Ile120, Lys134, His41, Glu80, Glu119, and Leu106, of amino acids Asp108, Ile120, Lys134, His41, Glu80, Glu119, and Tyr130, of amino acids Asp108, Ile120, Lys134, His41, Glu80, Glu119, and Glu133, of amino acids Asp108, Ile120, Lys134, His41, Glu80, Glu119, and Lys137, of amino acids Asp108, Ile120, Lys134, His41, Glu80, Glu119, Tyr24, Arg84, and Leu106, of amino acids Asp108, Ile120, Lys134, His41, Glu80, Glu119, Tyr130, Glu133, and Lys137, of amino acids Asp108, Ile120, Lys134, His41, Glu80, Glu119, Tyr24, Arg84, Leu106, Tyr130, Glu133, and Lys137 according to FIG. 18 of not more than 3 Å. In another embodiment, the said root mean square deviation is not more than 2.5 Å. In another embodiment, the said root mean square deviation is not more than 2 Å. In another embodiment, the said root mean square deviation is not more than 1.5 Å. In another embodiment, the said root mean square deviation is not more than 1 Å. In another embodiment, the said root mean square deviation is not more than 0.5 Å.

If computer modeling according to the methods described hereinabove indicates binding of a compound to the active site of the PA subunit or a variant thereof, said compound may be synthesized and optionally said compound or a pharmaceutically acceptable salt thereof may be formulated with one or more pharmaceutically acceptable excipient(s) and/or carrier(s). Thus, the above-described method may comprise the further step of (e) synthesizing said compound and optionally formulating said compound or a pharmaceutically acceptable salt thereof with one or more pharmaceutically acceptable excipient(s) and/or carrier(s). Optionally, the ability of said compound or of a pharmaceutically acceptable salt thereof or of a formulation thereof to modulate, preferably decrease, preferably inhibit the endonucleolytic activity of the PA subunit or variant thereof may be tested in vitro or in vivo comprising the further step of (1) contacting said compound with the PA polypeptide fragment or variant thereof or the recombinant host cell of the invention and to determine the ability of said compound to (i) bind to the active site and/or (ii) to modulate, decrease, or inhibit the endonucleolytic activity of the PA subunit polypeptide fragment or variant thereof. The quality of fit of such compounds to the active site may be judged either by shape complementarity or by estimated interaction energy (Meng et al., 1992, J. Comp. Chem. 13:505-524). Methods for synthesizing said compounds are well known to the person skilled in the art or such compounds may be commercially available.

It is another aspect of the invention to provide a compound identifiable by the above-described method, wherein said compound is able to modulate the endonuclease activity of the PA subunit or variant thereof. In another aspect, the present invention refers to a compound identifiable by the above-described method, wherein said compound is able to decrease, preferably inhibit the endonuclease activity of the PA subunit or variant thereof, e.g., the PA subunit polypeptide or variant thereof according to the present invention. Compounds of the present invention can be any agents including, but not restricted to, peptides, peptoids, polypeptides, proteins (including antibodies), lipids, metals, nucleotides, nucleosides, nucleic acids, small organic or inorganic molecules, chemical compounds, elements, saccharides, isotopes, carbohydrates, imaging agents, lipoproteins, glycoproteins, enzymes, analytical probes, polyamines, and combinations and derivatives thereof. The term "small molecules" refers to molecules that have a molecular weight between 50 and about 2,500 Daltons, preferably in the range of 200-800 Daltons. In addition, a test compound according to the present invention may optionally comprise a detectable label. Such labels include, but are not limited to, enzymatic labels, radioisotope or radioactive compounds or elements, fluorescent compounds or metals, chemiluminescent compounds and bioluminescent compounds. In a preferred embodiment of the compound according to the present invention, the compound is not a 4-substituted 2-dioxobutanoic acid, a 4-substituted 4-dioxobutanoic acid, a 4-substituted 2,4-dioxobutanoic acid, a pyrazine-2,6-dione or a substituted pyrazine-2,6-dione such as flutimide, an N-hydroxamic acid, or an N-hydroxymide. In particular, the compound according to the present invention is not a compound according to Formula I:

Formula I

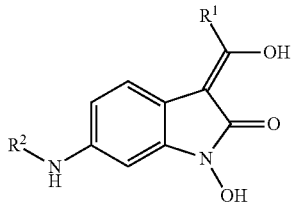

$R^1$ = Me, Et, Ph $R^2$ = acyl, carbamoyl, sulfonyl.

In a further aspect, the present invention provides a method for identifying compounds which bind to the endonucleolytically active site, preferably modulate, more preferably decrease, most preferably inhibit the endonuclease activity of the PA subunit or polypeptide variants thereof, comprising the steps of (i) contacting the PA polypeptide fragment according to the present invention or a recombinant host cell according to the present invention with a test compound and (ii) analyzing the ability of said test compound to bind to the endonucleolytically active site, to modulate, to decrease, or to inhibit the endonuclease activity of said PA subunit polypeptide fragment.

In one embodiment, the interaction between the PA polypeptide fragment or variant thereof and a test compound may be analyzed in form of a pull down assay. For example, the PA polypeptide fragment may be purified and may be immobilized on beads. In one embodiment, the PA polypeptide fragment immobilized on beads may be contacted, for example, with (i) another purified protein, polypeptide fragment, or peptide, (ii) a mixture of proteins, polypeptide fragments, or peptides, or (iii) a cell or tissue extract, and binding of proteins, polypeptide fragments, or peptides may be verified by polyacrylamide gel electrophoresis in combination with coomassie staining or Western blotting. Unknown binding partners may be identified by mass spectrometric analysis.

In another embodiment, the interaction between the PA polypeptide fragment or variant thereof and a test compound may be analyzed in form of an enzyme-linked immunosorbent assay (ELISA)-based experiment. In one embodiment, the PA polypeptide fragment or variant thereof according to the invention may be immobilized on the surface of an ELISA plate and contacted with the test compound. Binding of the test compound may be verified, for example, for proteins, polypeptides, peptides, and epitope-tagged compounds by antibodies specific for the test compound or the epitope-tag. These antibodies might be directly coupled to an enzyme or detected with a secondary antibody coupled to said enzyme that—in combination with the appropriate substrates—carries out chemiluminescent reactions (e.g., horseradish peroxidase) or colorimetric reactions (e.g., alkaline phosphatase). In another embodiment, binding of compounds that cannot be detected by antibodies might be verified by labels directly coupled to the test compounds. Such labels may include enzymatic labels, radioisotope or radioactive compounds or elements, fluorescent compounds or metals, chemiluminescent compounds and bioluminescent compounds. In another embodiment, the test compounds might be immobilized on the ELISA plate and contacted with the PA polypeptide fragment or variants thereof according to the invention. Binding of said polypeptide may be verified by a PA polypeptide fragment specific antibody and chemiluminescence or colorimetric reactions as described above.

In a further embodiment, purified PA polypeptide fragments may be incubated with a peptide array and binding of the PA polypeptide fragments to specific peptide spots corresponding to a specific peptide sequence may be analyzed, for example, by PA polypeptide specific antibodies, antibodies that are directed against an epitope-tag fused to the PA polypeptide fragment, or by a fluorescence signal emitted by a fluorescent tag coupled to the PA polypeptide fragment.

In another embodiment, the recombinant host cell according to the present invention is contacted with a test compound. This may be achieved by co-expression of test proteins or polypeptides and verification of interaction, for example, by fluorescence resonance energy transfer (FRET) or co-immunoprecipitation. In another embodiment, directly labeled test compounds may be added to the medium of the recombinant host cells. The potential of the test compound to penetrate membranes and bind to the PA polypeptide fragment may be, for example, verified by immunoprecipitation of said polypeptide and verification of the presence of the label.

In another embodiment, the ability of the test compound to modulate, preferably decrease, more preferably inhibit the endonucleolytic activity of the PA subunit polypeptide fragment or variant thereof is assessed. For example, the purified PA subunit polypeptide fragment and a substrate thereof such as panhandle RNA or single stranded DNA are contacted in presence or absence of varying amounts of the test compound and incubated for a certain period of time, for example, for 5, 10, 15, 20, 30, 40, 60, or 90 minutes. The reaction conditions are chosen such that the PA subunit polypeptide is endonucleolytically active without the test compound. The substrate is then analyzed for degradation/endonucleolytic cleavage, for example, by gel electrophoresis. Alternatively, such a test may comprise a labeled substrate molecule which provides a signal when the substrate molecule is endonucleolytically cleaved but does not provide a signal if it is intact. For example, the substrate polynucleotide chain may be labeled with fluorescent reporter molecule and a fluorescence quencher such that the fluorescent reporter is quenched as long as the substrate polynucleotide chain is intact. In case the substrate polynucleotide chain is cleaved, the fluorescent reporter and the quencher are separated, thus, the fluorescent reporter emits a signal which may be detected, for example, by an ELISA reader. This experimental setting may be applied in a multi-well plate format and is suitable for high throughput screening of compounds regarding their ability to modulate, decrease, or inhibit the endonuclease activity of the PA subunit polypeptide fragment or variants thereof.

In a preferred embodiment, the above-described method for identifying compounds which associate with the endonucleolytically active site, modulate, decrease, or inhibit the endonucleolytic activity of the PA subunit polypeptide fragment or variant thereof is performed in a high-throughput setting. In a preferred embodiment, said method is carried out in a multi-well microtiter plate as described above using PA polypeptide fragments or variants thereof according to the present invention and labeled test compounds.

In a preferred embodiment, the test compounds are derived from libraries of synthetic or natural compounds. For instance, synthetic compound libraries are commercially available from Maybridge Chemical Co. (Trevillet, Cornwall, UK), ChemBridge Corporation (San Diego, Calif.), or Aldrich (Milwaukee, Wis.). A natural compound library is, for example, available from TimTec LLC (Newark, Del.). Alternatively, libraries of natural compounds in the form of bacterial, fungal, plant, and animal extracts can be used. Additionally, test compounds can be synthetically produced using combinatorial chemistry either as individual compounds or as mixtures.

In another embodiment, the inhibitory effect of the identified compound on the Influenza virus life cycle may be tested in an in vivo setting. A cell line that is susceptible for Influenza virus infection such as 293T human embryonic kidney cells, Madin-Darby canine kidney cells, or chicken embryo fibroblasts may be infected with Influenza virus in presence or absence of the identified compound. In a preferred embodiment, the identified compound may be added to the culture medium of the cells in various concentrations. Viral plaque formation may be used as read out for the infectious capacity of the Influenza virus and may be compared between cells that have been treated with the identified compound and cells that have not been treated.

In a further embodiment of the invention, the test compound applied in any of the above described methods is a small molecule. In a preferred embodiment, said small molecule is derived from a library, e.g., a small molecule inhibitor library. In another embodiment, said test compound is a peptide or protein. In a preferred embodiment, said peptide or protein is derived from a peptide or protein library.

In another embodiment of the above-described methods for computational as well as in vitro identification of compounds that associate with the endonucleolytically active site, modulate, decrease, or inhibit the endonucleolytic activity of the PA subunit polypeptide fragment or variant thereof according to the present invention, said methods further comprise the step of formulating the identifiable compound or a pharmaceutically acceptable salt thereof with one or more pharmaceutically acceptable excipient(s) and/or carrier(s). In another aspect the present invention provides a pharmaceutical composition producible according to the afore-mentioned method. A compound according to the present invention can be administered alone but, in human therapy, will generally be administered in admixture with a suitable pharmaceutical excipient, diluent, or carrier selected with regard to the intended route of administration and standard pharmaceutical practice (see hereinafter).

In the aspect of computational modeling or screening of a binding partner for the endonucleolytically active site, a modulator, and/or inhibitor of the endonucleolytic activity of the PA subunit polypeptide fragment or variant thereof according to the present invention, it may be possible to introduce into the molecule of interest, chemical moieties that may be beneficial for a molecule that is to be administered as a pharmaceutical. For example, it may be possible to introduce into or omit from the molecule of interest, chemical moieties that may not directly affect binding of the molecule to the target area but which contribute, for example, to the overall solubility of the molecule in a pharmaceutically acceptable carrier, the bioavailability of the molecule and/or the toxicity of the molecule. Considerations and methods for optimizing the pharmacology of the molecules of interest can be found, for example, in "Goodman and Gilman's The Pharmacological Basis of Therapeutics", 8$^{th}$ Edition, Goodman, Gilman, Rall, Nies, & Taylor, Eds., Pergamon Press (1985); Jorgensen & Duffy, 2000, Bioorg. Med. Chem. Lett. 10:1155-1158. Furthermore, the computer program "Qik Prop" can be used to provide rapid predictions for physically significant descriptions and pharmaceutically-relevant properties of an organic molecule of interest. A 'Rule of Five' probability scheme can be used to estimate oral absorption of the newly synthesized compounds (Lipinski et al., 1997, Adv. Drug Deliv. Rev. 23:3-25). Programs suitable for pharmacophore selection and design include (i) DISCO (Abbot Laboratories, Abbot Park, Ill.), (ii) Catalyst (Bio-CAD Corp., Mountain View, Calif.), and (iii) Chem DBS-3D (Chemical Design Ltd., Oxford, UK).

The pharmaceutical composition contemplated by the present invention may be formulated in various ways well known to one of skill in the art. For example, the pharmaceutical composition of the present invention may be in solid form such as in the form of tablets, pills, capsules (including soft gel capsules), cachets, lozenges, ovules, powder, granules, or suppositories, or in liquid form such as in the form of elixirs, solutions, emulsions, or suspensions.

Solid administration forms may contain excipients such as microcrystalline cellulose, lactose, sodium citrate, calcium carbonate, dibasic calcium phosphate, glycine, and starch (preferably corn, potato, or tapioca starch), disintegrants such as sodium starch glycolate, croscarmellose sodium, and certain complex silicates, and granulation binders such as polyvinylpyrrolidone, hydroxypropylmethyl cellulose (HPMC), hydroxypropylcellulose HPC), sucrose, gelatin, and acacia. Additionally, lubricating agents such as magnesium stearate, stearic acid, glyceryl behenate, and talc may be included. Solid compositions of a similar type may also be employed as fillers in gelatin capsules. Preferred excipients in this regard include lactose, starch, a cellulose, milk sugar, or high molecular weight polyethylene glycols.

For aqueous suspensions, solutions, elixirs, and emulsions suitable for oral administration the compound may be combined with various sweetening or flavoring agents, coloring matter or dyes, with emulsifying and/or suspending agents and with diluents such as water, ethanol, propylene glycol, and glycerin, and combinations thereof.

The pharmaceutical composition of the present invention may contain release rate modifiers including, for example, hydroxypropylmethyl cellulose, methyl cellulose, sodium carboxymethylcellulose, ethyl cellulose, cellulose acetate, polyethylene oxide, Xanthan gum, Carbomer, ammonio methacrylate copolymer, hydrogenated castor oil, carnauba wax, paraffin wax, cellulose acetate phthalate, hydroxypropylmethyl cellulose phthalate, methacrylic acid copolymer, and mixtures thereof.

The pharmaceutical composition of the present invention may be in the form of fast dispersing or dissolving dosage formulations (FDDFs) and may contain the following ingredients: aspartame, acesulfame potassium, citric acid, croscarmellose sodium, crospovidone, diascorbic acid, ethyl acrylate, ethyl cellulose, gelatin, hydroxypropylmethyl cellulose, magnesium stearate, mannitol, methyl methacrylate, mint flavoring, polyethylene glycol, fumed silica, silicon dioxide, sodium starch glycolate, sodium stearyl fumarate, sorbitol, xylitol.

For preparing suppositories, a low melting wax, such as a mixture of fatty acid glycerides or cocoa butter, is first melted and the active component is dispersed homogeneously therein, as by stirring. The molten homogeneous mixture is then poured into convenient sized molds, allowed to cool, and thereby to solidify.

The pharmaceutical composition of the present invention suitable for parenteral administration is best used in the form of a sterile aqueous solution which may contain other substances, for example, enough salts or glucose to make the solution isotonic with blood. The aqueous solutions should be suitably buffered (preferably to a pH of from 3 to 9), if necessary.

The pharmaceutical composition suitable for intranasal administration and administration by inhalation is best delivered in the form of a dry powder inhaler or an aerosol spray from a pressurized container, pump, spray or nebulizer with the use of a suitable propellant, e.g., dichlorodifluoromethane, trichlorofluoromethane, dichlorotetrafluoroethane, a hydrofluoroalkane such as 1,1,1,2-tetrafluoroethane (HFA 134A™) or 1,1,1,2,3,3,3-25 heptafluoropropane (HFA 227EA™), carbon dioxide, or another suitable gas. The pressurized container, pump, spray or nebulizer may contain a solution or suspension of the active compound, e.g., using a mixture of ethanol and the propellant as the solvent, which may additionally contain a lubricant, e.g., sorbitan trioleate.

It is another aspect of the invention to provide a compound identifiable by the above-described method, wherein the compound is able to modulate the endonuclease activity of the PA subunit or variant thereof. In another aspect, the present invention refers to a compound identifiable by the above-described method, wherein the compound is able to decrease, preferably inhibit the endonuclease activity of the PA subunit or variant thereof, e.g., the PA subunit polypeptide or variant thereof according to the present invention. Compounds of the present invention can be any agents as described above for the in silico screening methods. In a preferred embodiment of the compound according to the present invention, the compound is not a 4-substituted 2-dioxobutanoic acid, a 4-substituted 4-dioxobutanoic acid, a 4-substituted 2,4-dioxobutanoic acid, a pyrazine-2,6-dione or a substituted pyrazine-2,6-dione such as flutimide, an N-hydroxamic acid, or an N-hydroxymide. In particular, the compound according to the present invention is not a compound according to Formula I:

Formula I

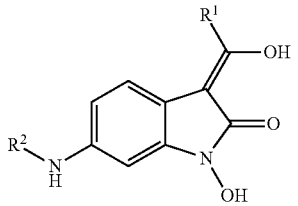

$R^1$ = Me, Et, Ph $R^2$ = acyl, carbamoyl, sulfonyl.

In another aspect, the present invention provides an antibody directed against the endonuclease domain of the PA subunit. In a preferred embodiment, said antibody recognizes the endonuclease domain by recognition of a polypeptide fragment selected from the group of polypeptides defined by SEQ ID NO: 9 to 17, i.e., amino acids 20 to 30 (SEQ ID NO: 9), 35 to 45 (SEQ ID NO: 10), 75 to 85 (SEQ ID NO: 11), 80 to 90 (SEQ ID NO: 12), 100 to 110 (SEQ ID NO: 13), 107 to 112 (SEQ ID NO: 20), 115 to 125 (SEQ ID NO: 14), 125 to 135 (SEQ ID NO: 15), 130 to 140 (SEQ ID NO: 16), and 135 to 145 (SEQ ID NO: 17) of the amino acid sequence as set forth in SEQ ID NO: 2. Preferably said antibody recognizes the amino sequence PDLYDYK (SEQ ID NO: 20). In particular, said antibody specifically binds to an epitope comprising one or more of above indicated amino acids, which define the active site. In this context, the term epitope has its art recognized meaning and preferably refers to stretches of 4 to 20 amino acids, preferably 5 to 18, 5 to 15, or 7 to 14 amino acids. Accordingly, preferred epitopes have a length of 4 to 20, 5 to 18, preferably 5 to 15, or 7 to 14 amino acids and comprise one or more of Asp108, Ile120, Lys134, His41, Glu80, Glu119, Tyr24, Arg84, Leu106, Tyr130, Glu133, and/or Lys137 of SEQ ID NO: 2 or one or more corresponding amino acid(s).

The antibody of the present invention may be a monoclonal or polyclonal antibody or portions thereof. Antigen-binding portions may be produced by recombinant DNA techniques or by enzymatic or chemical cleavage of intact antibodies. In some embodiments, antigen-binding portions include Fab, Fab', $F(ab')_2$, Fd, Fv, dAb, and complementarity determining region (CDR) fragments, single-chain antibodies (scFv), chimeric antibodies such as humanized antibodies, diabodies, and polypeptides that contain at least a portion of an antibody that is sufficient to confer specific antigen binding to the polypeptide. The antibody of the present invention is generated according to standard protocols. For example, a polyclonal antibody may be generated by immunizing an animal such as mouse, rat, rabbit, goat, sheep, pig, cattle, or horse with the antigen of interest optionally in combination with an adjuvant such as Freund's complete or incomplete adjuvant, RIBI (muramyl dipeptides), or ISCOM (immunostimulating complexes) according to standard methods well known to the person skilled in the art. The polyclonal antiserum directed against the endonuclease domain of PA or fragments thereof is obtained from the animal by bleeding or sacrificing the immunized animal. The serum (i) may be used as it is obtained from the animal, (ii) an immunoglobulin fraction may be obtained from the serum, or (iii) the antibodies specific for the endonuclease domain of PA or fragments thereof may be purified from the serum. Monoclonal antibodies may be generated by methods well known to the person skilled in the art. In brief, the animal is sacrificed after immunization and lymph node and/or splenic B cells are immortalized by any means known in the art. Methods of immortalizing cells include, but are not limited to, transfecting them with oncogenes, infecting them with an oncogenic virus and cultivating them under conditions that select for immortalized cells, subjecting them to carcinogenic or mutating compounds, fusing them with an immortalized cell, e.g., a myeloma cell, and inactivating a tumor suppressor gene. Immortalized cells are screened using the PA endonuclease domain or a fragment thereof. Cells that produce antibodies directed against the PA endonuclease domain or a fragment thereof, e.g., hybridomas, are selected, cloned, and further screened for desirable characteristics including robust growth, high antibody production, and desirable antibody characteristics. Hybridomas can be expanded (i) in vivo in syngeneic animals, (ii) in animals that lack an immune system, e.g., nude mice, or (iii) in cell culture in vitro. Methods of selecting, cloning, and expanding hybridomas are well known to those of ordinary skill in the art. The skilled person may refer to standard texts such as "Antibodies: A Laboratory Manual", Harlow and Lane, Eds., Cold Spring Harbor Laboratory Press, Cold Spring Harbor, N.Y. (1990), which is incorporated herein by reference, for support regarding generation of antibodies.

In another aspect, the present invention relates to the use of a compound identifiable by the above-described methods that is able to bind to the endonucleolytically active site of the PA subunit polypeptide fragment or variant thereof, and/or is able to modulate, preferably decrease, more preferably inhibit the endonucleolytic activity of the PA subunit polypeptide fragment or variant thereof, the pharmaceutical composition described above, or the antibody of the present invention for the manufacture of a medicament for treating, ameliorating, or preventing disease conditions caused by viral infections with negative-sense single stranded RNA viruses of the family of Orthomyxoviridae. In a preferred embodiment, said disease conditions are caused by viral infections with Influenza A virus, Influenza B virus, Influenza C virus, Isavirus, or Thogotovirus. In an even more preferred embodiment, said disease condition is caused by an infection with a virus species selected from the group consisting of Influenza A virus, Influenza B virus, Influenza C virus, most preferably Influenza A virus.

For treating, ameliorating, or preventing said disease conditions the medicament of the present invention can be administered to an animal patient, preferably a mammalian patient, preferably a human patient, orally, buccally, sublingually, intranasally, via pulmonary routes such as by inhalation, via rectal routes, or parenterally, for example, intracavemosally, intravenously, intra-arterially, intraperitoneally, intrathecally, intraventricularly, intra-urethrally intrasternally, intracranially, intramuscularly, or subcutaneously, they may be administered by infusion or needleless injection techniques.

The pharmaceutical compositions of the present invention may be formulated in various ways well known to one of skill in the art and as described above.

The pharmaceutical preparation is preferably in unit dosage form. In such form the preparation is subdivided into unit doses containing appropriate quantities of the active component. The unit dosage form can be a packaged preparation, the package containing discrete quantities of preparation, such as packeted tablets, capsules, and powders in vials or ampoules. Also, the unit dosage form can be a capsule, tablet, cachet, or lozenge itself, or it can be the appropriate number of any of these in packaged form.

The quantity of active component in a unit dose preparation administered in the use of the present invention may be varied or adjusted from about 1 mg to about 1000 mg per $m^2$, preferably about 5 mg to about 150 mg/$m^2$ according to the particular application and the potency of the active component.

The compounds employed in the medical use of the invention are administered at an initial dosage of about 0.05 mg/kg to about 20 mg/kg daily. A daily dose range of about 0.05 mg/kg to about 2 mg/kg is preferred, with a daily dose range of about 0.05 mg/kg to about 1 mg/kg being most preferred. The dosages, however, may be varied depending upon the requirements of the patient, the severity of the condition being treated, and the compound being employed. Determination of the proper dosage for a particular situation is within the skill of the practitioner. Generally, treatment is initiated with smaller dosages, which are less than the optimum dose of the compound. Thereafter, the dosage is increased by small increments until the optimum effect under circumstances is reached. For convenience, the total daily dosage may be divided and administered in portions during the day, if desired.

EXAMPLES

The Examples are designed in order to further illustrate the present invention and serve a better understanding. They are not to be construed as limiting the scope of the invention in any way.

Summary of the Examples

PA-Nter (SEQ ID NO: 22), residues 1-209 of the amino acid sequence set forth in SEQ ID NO: 2 (A/Victoria/3/1975 (H3N2)) was expressed in *E. coli* and purified by affinity and gel filtration chromatography. The influence of metal ions on thermal stability was tested by thermofluor assays (Ericsson et al., 2006, Anal. Biochem. 357:289-298). The endonuclease activity was tested by incubation at 37° C. of 13 μM PA-Nter (SEQ ID NO: 22) with 10 μM of various RNA substrates: Alu-RNA; 110 nucleotides of the Alu-domain of *P. horikoshii*, SRP RNA, *C. albicans* tRNA Asn, U-rich RNA (5'-GGCCAUCCUGU$_7$CCCU$_{11}$CU$_{19}$-3'; SEQ ID NO: 18, Saito et al., 2008, Nature 454:523-527), panhandle RNA (ph-RNA) of 81 nucleotides (Baudin et al., 1994, EMBO J. 13:3158-3165), short ph-RNA of 36 nucleotides comprising just the conserved 3'- and 5'-ends with a short linker, and circular single stranded DNA (M13mp18) (Fermentas). Crystals diffracting to 2 Å resolution were obtained at 20° C. by the hanging drop method using a protein solution of 5-10 mg/ml in 20 mM Tris pH 8.0, 100 mM NaCl, and 2.5 mM $MnCl_2$ and a reservoir composition of 1.2 M $Li_2SO_4$, 100 mM MES pH 6.0, 10 mM magnesium acetate and 3% ethylene glycol. Diffraction data were collected on beamlines ID14-4 and ID23-1 at the European Synchrotron Radiation Facility (ESRF). The structure was solved by the single-wavelength anomalous dispersion (SAD) method using a gadolinium chloride soaked crystal. Nine sites were found by SHELXD (Schneider and Sheldrick, 2002, Acta Crystallogr. D. Biol. Crystallogr. 58:1772-1779) and refined with SHARP (de La Fortelle et al., 1997, Methods in Enzymology 276:472-494). After three-fold NCS averaging with RESOLVE (Terwilliger, 2002, Acta Crystallogr. D.

Biol. Crystallogr. 58:2213-2215) an interpretable map was obtained and much of the model could be built with ARP/wARP (Perrakis et al., 1999, Nat. Struct. Biol. 6:458-463). Additionally, data were measured on a native crystal at the manganese K edge (X-ray wavelength 1.89 Å) to reveal the location and identity of bound manganese ions through anomalous difference Fourier synthesis. There are three molecules in the asymmetric unit denoted A, B, and D. The metal ion structure is best defined in molecule A. The crystallographic statistics are summarized in Table 1 and more details available in the experimental Examples below.

TABLE 1

Data collection and refinement statistics of PA-Nter (SEQ ID NO: 22)

| | PA-Nter (SEQ ID NO: 22) native | PA-Nter (SEQ ID NO: 22) Mn K-edge | PA-Nter (SEQ ID NO: 22) Gd derivative |
|---|---|---|---|
| Data collection | | | |
| Beamline (ESRF) | ID14-4 | ID23-1 | ID14-4 |
| Wavelength (A) | 0.976 | 1.892 | 1.008 |
| Space group | $P4_32_12$ | $P4_32_12$ | $P4_32_12$ |
| Cell dimensions | | | |
| a, b, c (A) | 67.1, 67.1, 302.9 | 67.9, 67.9, 300.8 | 67.8, 67.8, 300.4 |
| α, β, γ (°) | 90.0, 90.0, 90.0 | 90.0, 90.0, 90.0 | 90.0, 106.24, 90.0 |
| Resolution (A) | 50-2.05 (2.05-2.10)* | 30-2.60 (2.6-2.7)* | 30-2.5 (2.5-2.6)* |
| $R_{merge}$ | 0.056 (0.690) | 0.055 (0.484) | 0.058 (0.539) |
| //σ/ | 17.6 (2.2) | 17.8 (2.5) | 14.5 (2.1) |
| Completeness (%) | 93.2 (99.4) | 99.7 (99.8) | 97.9 (98.0) |
| Redundancy | 4.84 (5.64) | 3.66 (3.44) | 3.63 (3.15) |
| Refinement | | | |
| Resolution (A) | 30-2.05 (2.05-2.10)* | | |
| Total No. reflections/free | 39715/2118 | | |
| $R_{work}$ | 0.217 (0.278) | | |
| $R_{free}$ | 0.268 (0.320) | | |
| No. atoms | | | |
| Protein | 4742 | | |
| Water/sulphate/Mn ions | 152/8/5 | | |
| Average B-factors ($A^2$) | | | |
| All atoms | 45.8 | | |
| Chains A, B, D | 41.5, 40.0, 57.0 | | |
| R.m.s. deviations | | | |
| Bondlengths (A) | 0.014 | | |
| Bondangles (°) | 1.363 | | |
| Ramachandran Plot** | | | |
| Favoured (%) | 98.1 | | |
| Allowed (%) | 99.8 | | |

Example 1

Cloning, Expression and Purification

The DNA coding for PA residues 1-209 of the amino acid sequence set forth in SEQ ID NO: 2 (A/Victoria/3/1975 (H3N2)) was cloned into a pET-M11 expression vector (EMBL) between the NcoI and XhoI sites. A polypeptide linker having the amino acid sequence GMGSGMA (SEQ ID NO: 19) was engineered after the tobacco etch virus (TEV) cleavage site to obtain a 100% cleavage by TEV protease. This vector was used to transform the BL21(DE3)-RIL-CodonPlus *E. coli* strain (Stratagene). The protein was expressed in LB medium overnight at 15° C. after induction with 0.1 mM isopropyl-β-thiogalactopyranoside (ITPG). The protein was purified by an immobilised metal affinity column (IMAC). A second IMAC step was performed after cleavage using a His-tagged TEV protease, followed by gel filtration on a Superdex 200 column (GE Healthcare). Finally, the protein was concentrated to 5 to 10 mg/ml.

Example 2

Endonuclease Assay

All ribonucleic acid substrates for endonuclease assays were obtained by in vitro T7 transcription as described previously (Price et al., 1995, J. Mol. Biol. 249:398-408). Two structured RNAs were used: Alu-RNA; 110 nucleotides comprising the Alu-domain of *Pyrococcus horikoshii* signal recognition particle (SRP) RNA (unpublished construct) and *Candida albicans* $tRNA^{Asn}$ composed of 76 nucleotides (unpublished construct). We also used a uridine-rich unstructured RNA of 51 nucleotides (U-rich RNA; 5'-GGCCAUCCUGU$_7$CCCU$_{11}$CU$_{19}$-3'; SEQ ID NO: 18) (Saito et al., 2008, Nature 454:523-527) and two partially folded RNAs derived from influenza A virus genomic RNA segment 5: a panhandle RNA (ph-RNA) of 81 nucleotides (Baudin et al., 1994, EMBO J. 13:3158-3165) and a shorter panhandle RNA (short ph-RNA) of 36 nucleotides comprising just the conserved 3'- and 5'-ends with a short linker (unpublished construct). The endonuclease activity was also tested using a circular single stranded DNA (M13mp18) (Fermentas).

RNA cleavage was performed by incubating 13 μM PA-Nter (SEQ ID NO: 22) with various RNA substrates (all at 10 μM) at 37° C. in a final volume of 50 μL. The reaction buffer was 20 mM Tris-HCl pH 8, 100 mM NaCl, 10 mM β-mercaptoethanol, and 1 mM metal salts. Incubations were stopped by addition of EGTA at a final concentration of 20 mM. The reaction products were loaded on 8 M urea polyacrylamide gels (8% or 15%) and stained with methylene blue. The effect of divalent cations on the RNAse activity of PA-Nter (SEQ ID NO: 22) was tested at pH 8 (with β-mercaptoethanol) and pH 7 (without β-mercaptoethanol) by incubating ph-RNA with PA-Nter (SEQ ID NO: 22) in the presence of different metal salts: $MnCl_2$, $CaCl_2$, $MgCl_2$, $ZnCl_2$ (or $NiCl_2$ at pH 7) and $CoCl_2$. For DNA cleavage, circular single stranded M13mp18 DNA was used. In the 10 μL reaction volume (same buffer as for RNA), 100 ng/μL, of purified plasmid M13mp18 was incubated for 60 minutes in the presence of PA-Nter (SEQ ID NO: 22) and 1 mM $MnCl_2$. The reaction products were loaded on a 0.8% agarose gel and stained with ethidium bromide. For endonuclease inhibition by 2,4-Dioxo-4-phenylbutanoic acid (DPBA), PA-Nter (SEQ ID NO: 22) and ph-RNA or single stranded M13mp18 DNA were incubated in the presence of 1 mM $MnCl_2$ and increasing concentrations of DPBA. Because DPBA is poorly soluble in water, a stock solution of 65 mM DPBA was prepared in 50% ethanol that was further diluted so that only 1 P μL of DPBA solution had to be added to each reaction mix to obtain the required final concentration. Addition of the inhibitor in ethanol did not change the pH of the reaction mixture and the addition of the same concentration of ethanol alone had no effect on nuclease activity (not shown).

Figure 5:
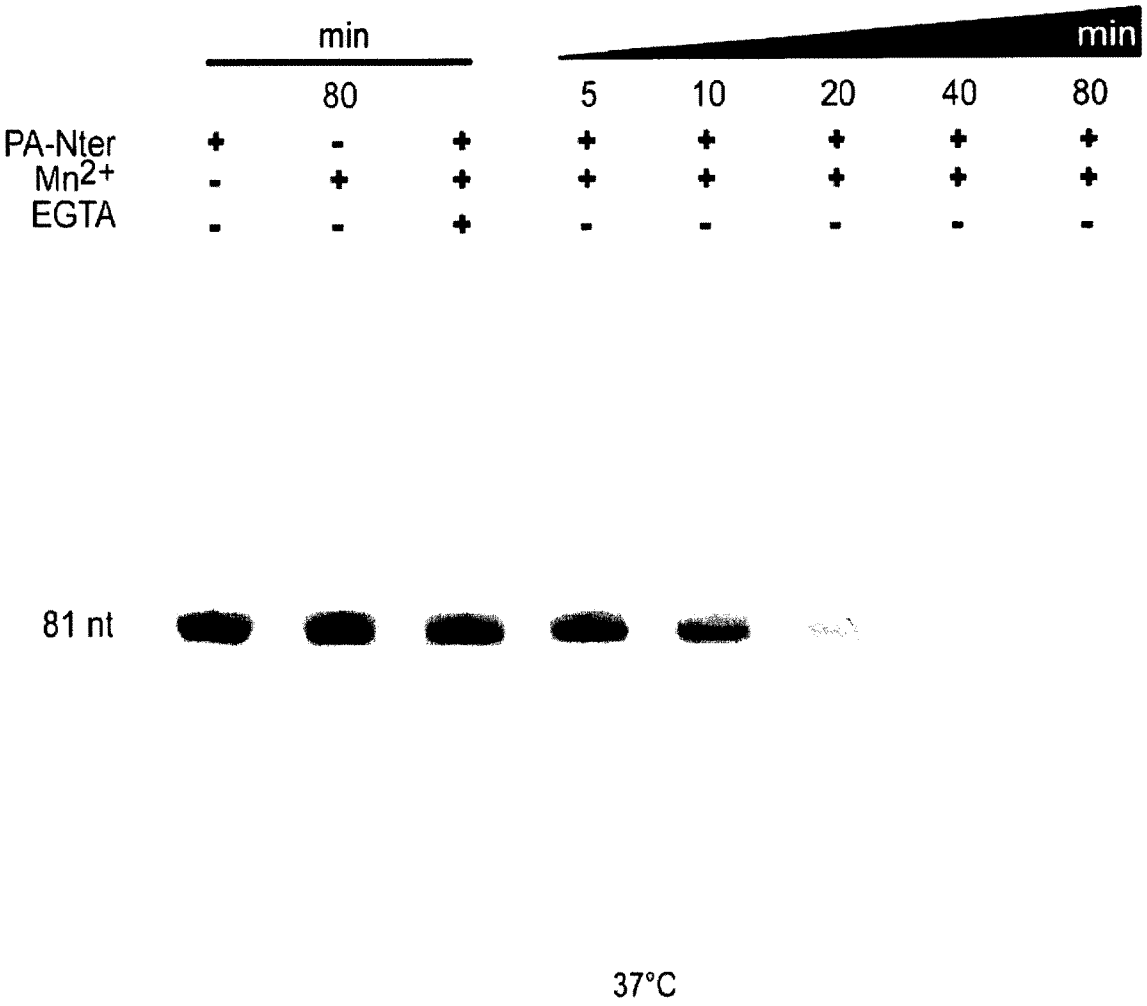
FIG. 5: Time series of the endonuclease activity of PA-Nter (SEQ ID NO: 22). 10 μM purified panhandle RNA (ph-RNA) was incubated with 13 μM PA-Nter plus 1 mM $MnCl_2$. The incubation at 37° C. was stopped by adding 20 mM EGTA after 5, 10, 20, 40, and 80 minutes (lanes 4 to 8, respectively). As controls, ph-RNA was incubated for 80 minutes at 37° C. with only PA-Nter (SEQ ID NO: 22) (lane 1) only $MnCl_2$ (lane 2) or PA-Nter (SEQ ID NO: 22) and $MnCl_2$ plus 20 mM EGTA. The reaction products were loaded on an 8% acrylamide/8 M urea gel and stained with methylene blue.
Figure 6:
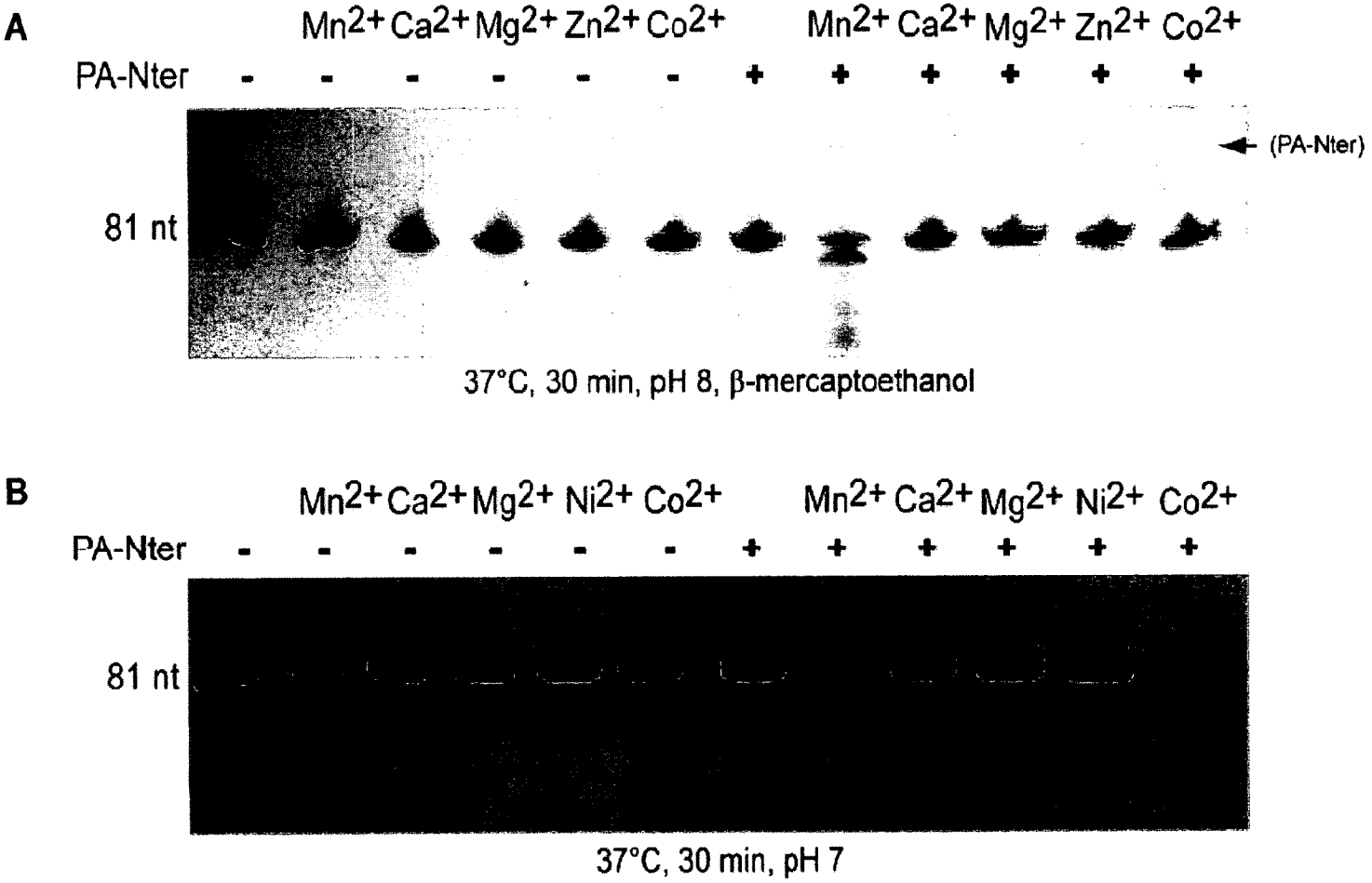
FIG. 6: Effect of divalent cations on PA-Nter (SEQ ID NO: 22) endonuclease (RNase) activity. In the top panel (A), purified ph-RNA plus PA-Nter (SEQ ID NO: 22) were incubated at pH 8 in the presence of β-mercaptoethanol and 1.5 mM $MnCl_2$, $CaCl_2$, $MgCl_2$, $ZnCl_2$, or $CoCl_2$. In the bottom panel (B), ph-RNA and PA-Nter (SEQ ID NO: 22) were incubated at pH 7 with 1.5 mM $MnCl_2$, $CaCl_2$, $MgCl_2$, $NiCl_2$, or $CoCl_2$. After 30 minutes the reactions were stopped by adding 20 mM EGTA. Controls were performed using either salts or PA-Nter (SEQ ID NO: 22) alone as indicated. The reaction products were loaded on 8% or 15% (for bottom panel) acrylamide/8 M urea and stained with methylene blue. Note that at pH 7, $CoCl_2$ stimulated the endonuclease stronger than $MnCl_2$. At pH 8, $CoCl_2$ precipitates and, thus, does not activate the endonuclease activity.
Figure 7:
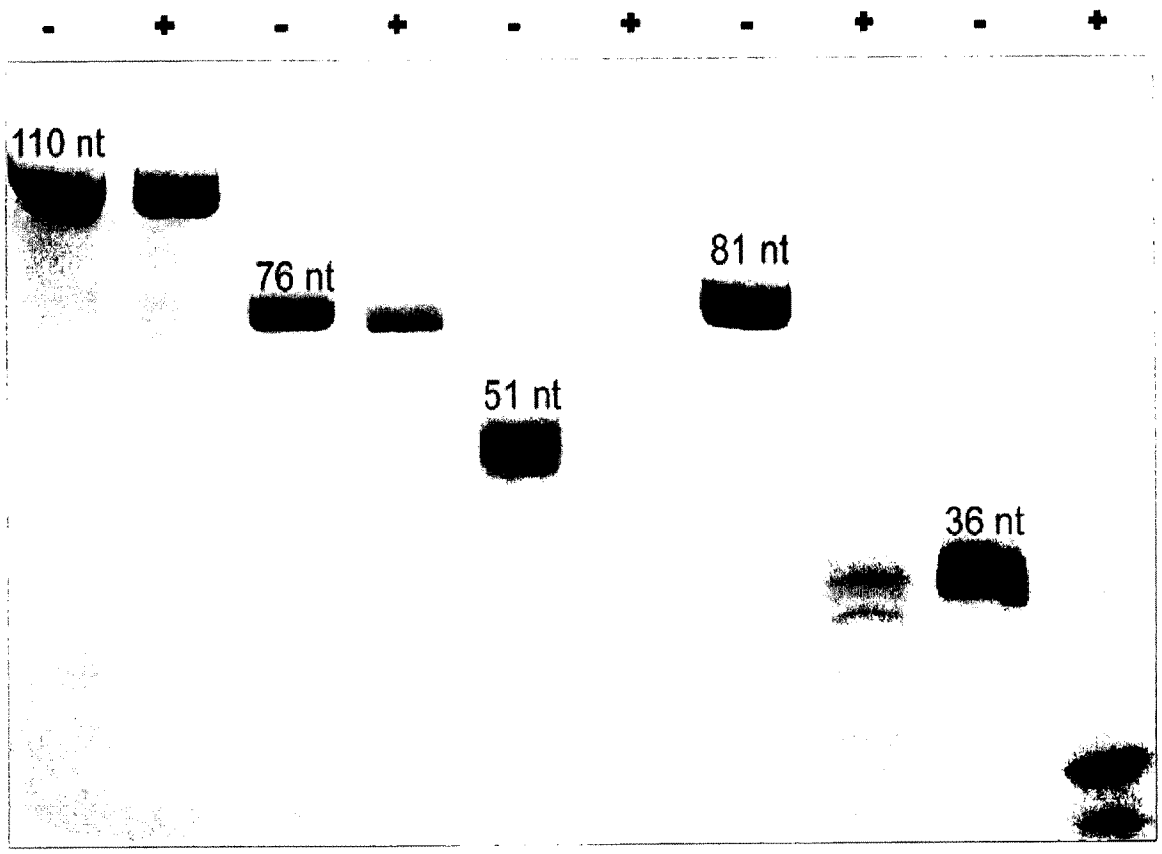
FIG. 7: PA-Nter (SEQ ID NO: 22) endonuclease (RNase) activity on different RNA substrates. SRP Alu-RNA, tRNA, U-rich RNA, ph-RNA or short ph-RNA were incubated with PA-Nter (SEQ ID NO: 22) plus 1 mM $MnCl_2$ (lanes 2, 4, 6, 8, and 10) or in the absence of PA-Nter (SEQ ID NO: 22; lanes 1, 3, 5, 7, and 9). The digestion was performed at 37° C. After 40 minutes the reaction was stopped by adding 20 mM EGTA. The reaction products were loaded on a 15% acrylamide/8 M urea gel and stained with methylene blue.
Figure 8:
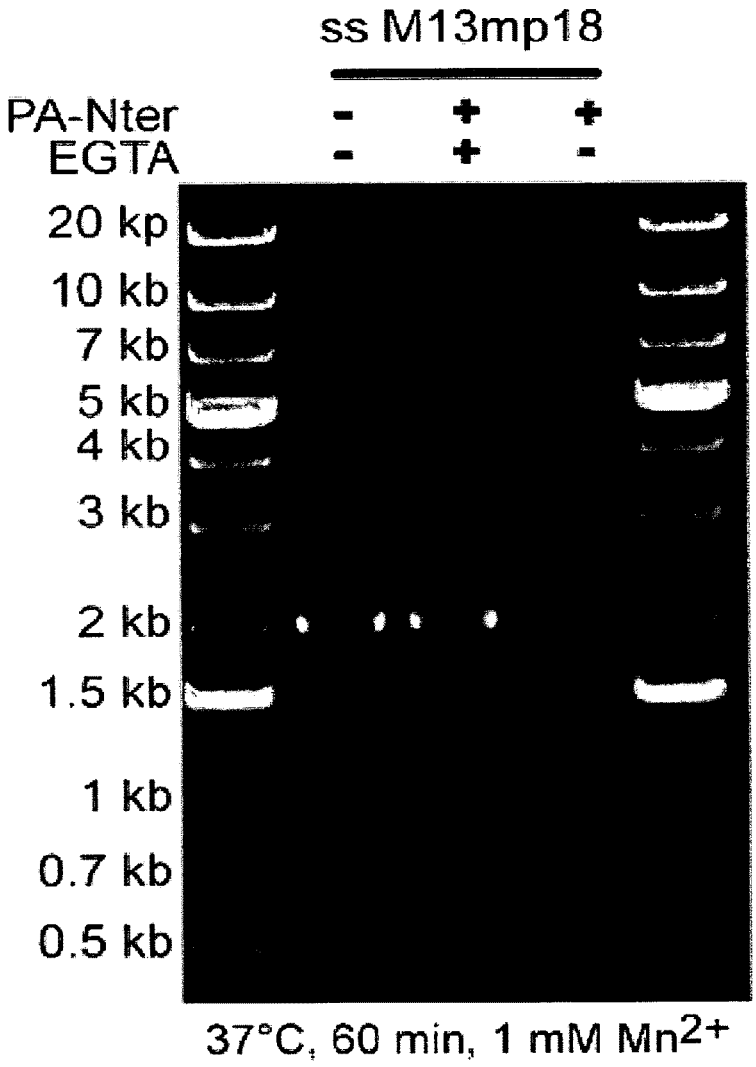
FIG. 8: Endonuclease activity of PA-Nter (SEQ ID NO: 22) on single stranded DNA. Single stranded DNA plasmid M13mp18 (100 ng/μl) (Fermentas) was incubated for 60 minutes at 37° C. in the presence of PA-Nter (SEQ ID NO: 22) plus $MnCl_2$ (lane 4). The reaction was stopped by adding 20 mM EGTA. As controls, M13mp18 was incubated with 1 mM $MnCl_2$ only (lane 2) or PA-Nter (SEQ ID NO: 22) plus $MnCl_2$ and 20 mM EGTA (lane 3). The reaction products were loaded on a 0.8% agarose gel and stained with ethidium bromide.
Figure 9:
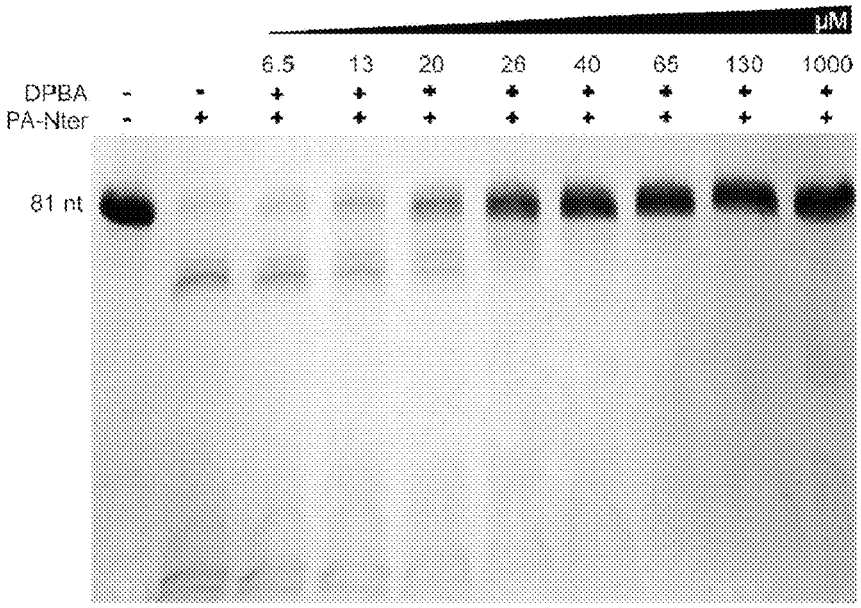
FIG. 9: Inhibition of PA-Nter (SEQ ID NO: 22) endonuclease activity by 2,4-Dioxo-4-phenylbutanoic acid (DPBA). Cleavage of ph-RNA (A) or M13mp18 ssDNA (B) by PA-Nter (SEQ ID NO: 22) was tested at 37° C. during 40 minutes in the presence of 1 mM $MnCl_2$ and increasing concentrations of DPBA (0, 6.5, 13, 20, 26, 40, 65, 130, and 1000 μM). As a control, ph-RNA or ssDNA was incubated with 1 mM $MnCl_2$ alone (lanes 1). The reaction products were loaded on 8% acrylamide/8 M urea and stained with methylene blue (A) or on a 0.8% agarose gel and stained with ethidium bromide (B).
Figure 9:
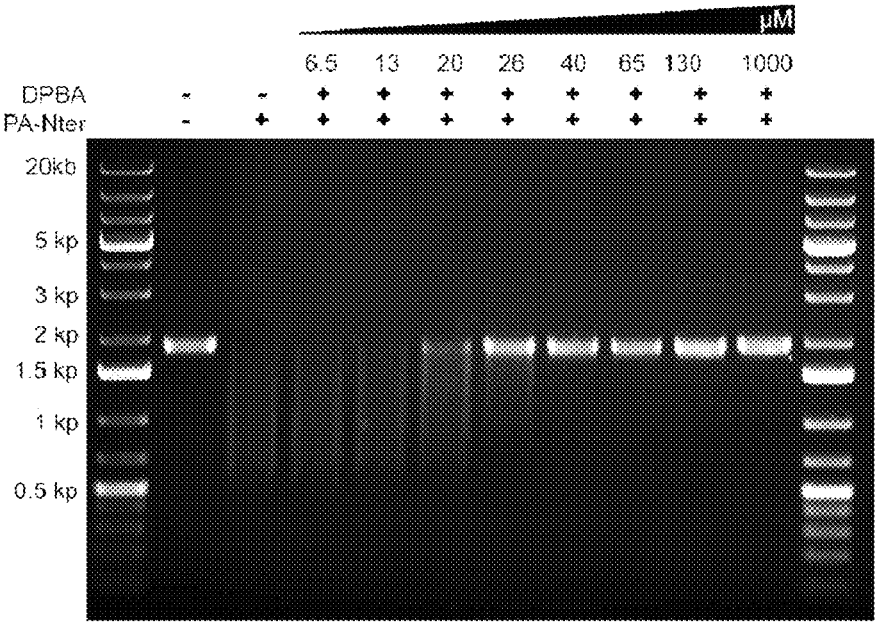

Using a partially structured 81nt ph-RNA it could be demonstrated that PA-Nter (SEQ ID NO: 22) has intrinsic RNase activity that is divalent cation dependent (FIG. 5). Consistent with the results on RNPs (Doan et al., 1999, Biochemistry 38:5612-5619, strong activity was observed at pH 8 with manganese and weaker activity with magnesium ions. At pH 7, the PA-Nter (SEQ ID NO: 22) endonuclease activity was also observed with cobalt (FIG. 6). After 40 minutes incubation highly structured RNAs such as tRNA and SRP Alu-RNA were relatively resistant to degradation, partially structured ph- and short-ph-RNAs were partially degraded and unstructured U-rich RNA was completely degraded, suggesting that the enzyme is single-strand specific (FIG. 7). The enzyme also completely degraded circular ssDNA showing that it is a nonspecific endonuclease (FIG. 8). The endonuclease activity on both RNA and DNA was inhibited in a dose dependent manner by the compound 2,4-dioxo-4-phenylbutanoic acid, a known inhibitor of influenza endonuclease (FIG. 9). The $K_i$ for this compound is estimated at 26 μM, in excellent agreement with the $IC_{50}$ reported for the same compound inhibiting cleavage of capped RNA by the intact influenza virus polymerase (Tomassini et al., 1994, Antimicrob. Agents Chemother 38:2827-2837).

Example 3

Thermal Shift Assay

Thermal shift assays were performed with 10 μM of PA-Nter (SEQ ID NO: 22) in 20 mM Tris-HCl pH 7.0 or 8.0, 100 mM NaCl and a 5× dilution of SYPRO Orange dye (Invitrogen) as described (Ericsson et al., 2006, Anal. Biochem. 357:289-298). The dye was excited at 490 nm and the emission light was recorded at 575 nm while the temperature was increased by increments of 1° C. per minute from 25 to 75° C. Control assays were carried out in the absence of protein or dye to check that no fluorescence signal was recorded.

Figure 4:
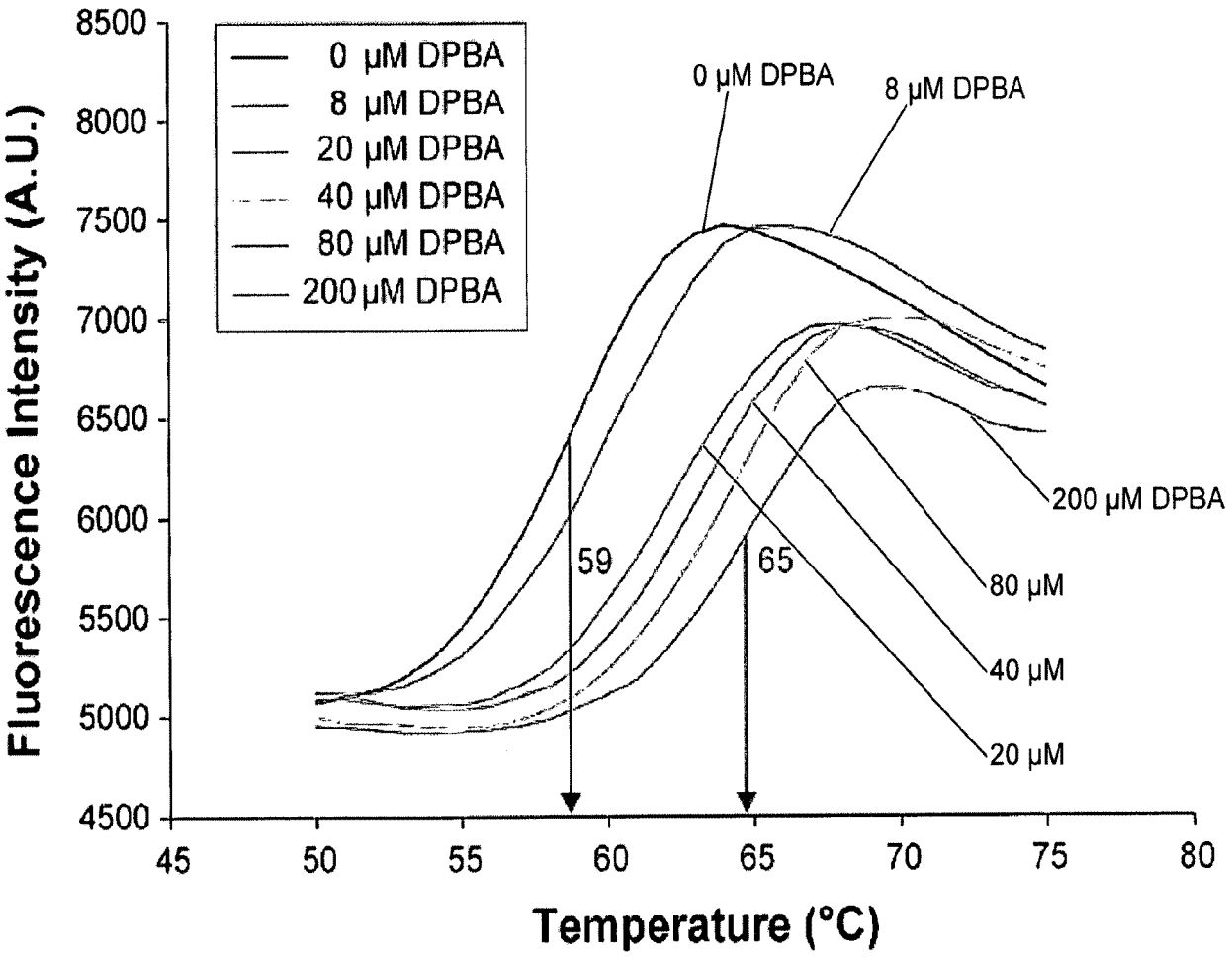
FIG. 4: Assay of thermal stability with 2,4-Dioxo-4-phenylbutanoic acid (DPBA). Thermal shift assay with different concentrations of DPBA. DPBA further stabilizes PA-Nter (SEQ ID NO: 22) in the presence of $MnCl_2$.

The thermal shift assay was performed to investigate the thermal stability of PA-Nter (SEQ ID NO: 22) in presence and absence of divalent cations. The experiments revealed a significant increase in thermal stability (apparent melting temperature shifts from 44° C. to 57° C.) upon addition of manganese ions and to a lesser extent upon addition of calcium and magnesium ions (FIGS. 1 and 2). Titrating the compound 2,4-dioxo-4-phenylbutanoic acid, a known inhibitor of influenza endonuclease, to manganese bound PA-Nter (SEQ ID NO: 22) increases the thermal stability even further (apparent melting temperature shifts from 59° C. to 65° C.) (FIG. 4), whereas the inhibitor has no effect on metal-free enzyme (data not shown).

Example 4

Far UV Circular Dichroism (CD) Spectroscopy

Far-UV CD spectra were recorded with 1 mM path length at 20° C. on a JASCO model J-810 CD spectro-polarimeter equipped with a Peltier thermostat. The PA-Nter (SEQ ID NO: 22) concentration was 10 uM in 10 mM Tris-HCl, pH 8.0, 10 mM NaCl in the presence or absence of 1 mM $MnCl_2$. Mean residue ellipticity was calculated using the number of residues (PA-Nter (SEQ ID NO: 22) is 209 residues long plus 7 additional residues before the starting methionine). Wavelength scans were recorded from 200 to 260 run and averaged over eight consecutive scans (0.5 nm increment, 1 s response, 1 nm bandwidth and 50 nm/min scanning speed).

Figure 3:
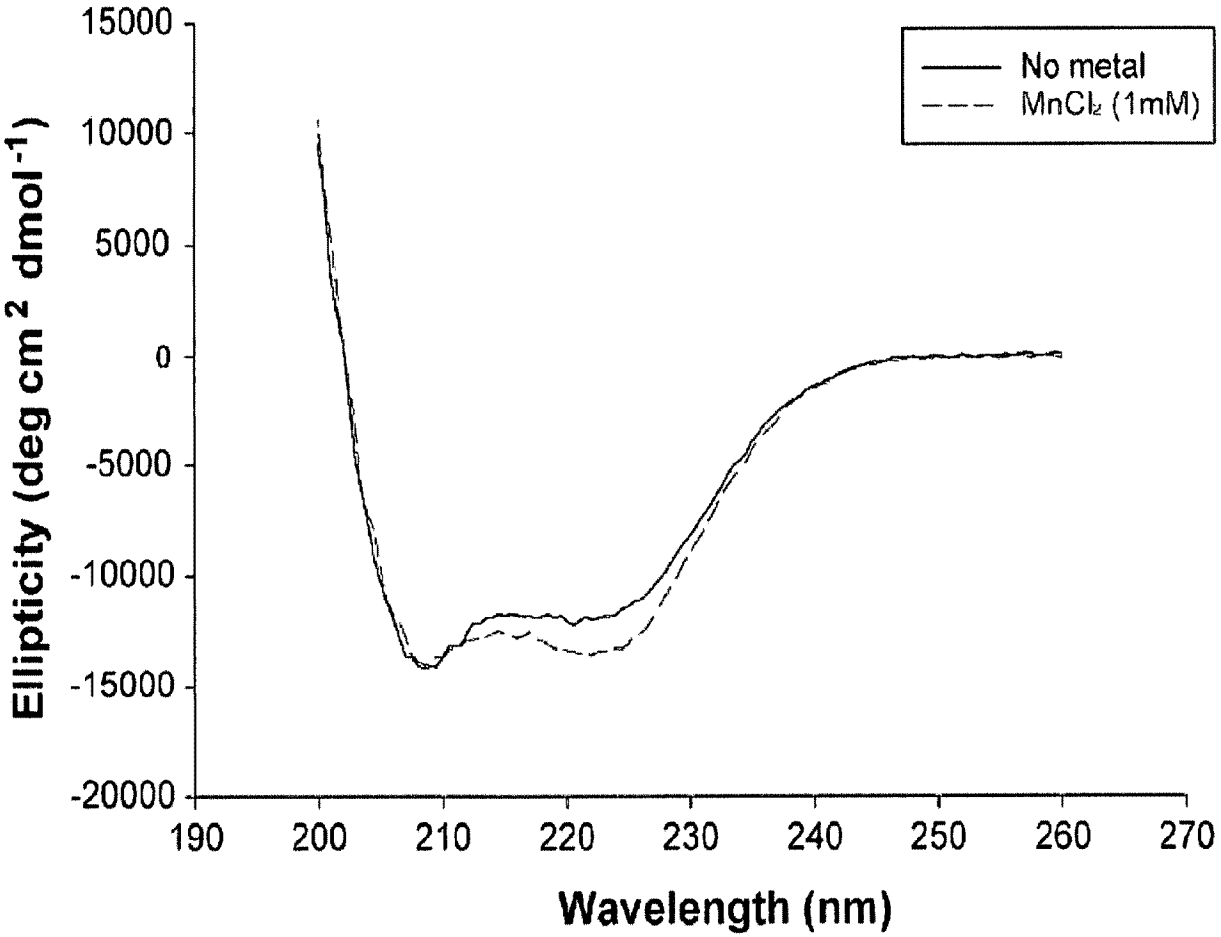
FIG. 3: Effect of manganese on the structure of PA-Nter (SEQ ID NO: 22) observed by far UV CD spectra. The secondary structure content of PA-Nter (SEQ ID NO: 22) was monitored in absence (full line) or presence of 1 mM $MnCl_2$ (dashed line).

The structural effect of manganese binding to PA-Nter (SEQ ID NO: 22), investigated by CD spectroscopy, revealed a significant increase in helical content (estimated 8 to 9 residues) upon addition of 1 mM $Mn^{2+}$ (FIG. 3).

Example 5

Crystallization and Crystallography

Initial sitting drop screening was carried out at 20° C. mixing 100 nL of protein solution (6 mg/ml) with 100 nL of well solution using a Cartesian robot. Subsequently, larger crystals were obtained at 20° C. by the hanging drop method following a ratio of 1:1 well:protein solutions. The protein solution was at 5-10 mg/ml in 20 mM Tris-HCl pH 8.0, 100 mM NaCl, 2.5 mM $MnCl_2$. The reservoir composition was 100 mM MES pH 6.0, 1.2 M $Li_2SO_4$, 10 mM magnesium acetate, 3% ethylene glycol after refinement of the crystallisation condition. Crystals appeared after 1-2 weeks and were typically of a volume of 50×50×15 $\mu m^3$.

Crystals were frozen in liquid nitrogen in the presence of 22% ethylene glycol for cryoprotection. Diffraction data were collected at 100 K on beamlines ID14-4 and ID23-1 at the European Synchrotron Radiation Facility (ESRF) and all data were integrated and scaled in the space group $P4_32_12$ using the XDS suite (Kabsch, 1993, J. Appl. Cryst. 26:795-800). The best native data were collected to 2.05 Å resolution at a wavelength of 0.976 Å, after soaking with additional 10 mM $MnCl_2$ for 2 minutes. Additionally, data was measured on native crystals at a wavelength of 1.89 Å (close to the manganese K edge) to reveal the location and identity of any bound manganese ions. The structure was solved with a highly redundant data set to 2.5 Å resolution collected at a wavelength of 1.008 Å from a crystal soaked for 6 h in mother liquor containing 5 mM $GdCl_3$. Three initial Gd sites were located on the basis of their anomalous differences using SHELXD (Schneider and Sheldrick, 2002, Acta Crystallogr. D. Biol. Crystallogr. 58:1772-1779) as implemented in HKL2MAP (Pape and Schneider, 2004, J. Appl. Cryst. 37:843-844). These initial sites were refined and experimental phases to 3.5 Å were calculated using the single anomalous dispersion (SAD) procedure in SHARP (de La Fortelle et al., 1997, Methods in Enzymology 276:472-494). After several iterative cycles a further 6 sites were identified in the residual maps and the phases were refined to 2.5 Å. These initial phases were improved with the density modification package SOLOMON in SHARP. Finally, a clearly interpretable map was obtained by using 3-fold NCS operators identified from the 9 Gd sites by RESOLVE (Terwilliger, 2002, Acta Crystallogr. D. Biol. Crystallogr. 58:2213-2215) for averaging with DM (Cowtan, 1994, Joint CCP4 and ESF-EACBM Newsletter on Protein Crystallography 31:34-38) as implemented in CCP4 (Collaborative Computational Project, 1994, Acta Crystallogr. D. Biol. Crystallogr. 50:760-763). This averaged map was of sufficient quality for RESOLVE (Terwilliger, 2003, Acta Crystallogr. D. Biol. Crystallogr. 59:45-49) to build 396 out of 648 possible amino acids, of which 85 could be sequence assigned. A manually modified model and a subsequent high resolution data set to 2.05 Å were then put into ARP/wARP (Perrakis et al., 1999, Nat. Struct. Biol. 6:458-463) resulting in a more complete model. This model was refined with Refmac (Murshudov, 1997, Acta Crystallogr. D. Biol. Crystallogr. 53:240-255) iterated with manual rebuilding cycles in 0 (Jones et al., 1991, Acta Crystallogr. A 47:110-119). Using TLS refinement and tight NCS restraints on parts of the structure, the final R-factor (R-free) is 0.233 (0.291). According to MOLPROBITY (Lovell et al., 2003, Proteins 50:437-450), 97.5%, 99.8% are respectively in the favoured and allowed region of the Ramachandran plot. The crystallographic details are summarized in Table 1. There are three molecules in the asymmetric unit denoted A, B, and D. The metal ion structure is best defined in molecule A. Different molecules have regions 69-74 and 134-143 more or less well ordered. 6 residues of the N-terminal tag and residues 204-209 are not visible. Molecule D is the least well ordered overall (Table 1). In the described structure the crystal contact between two of the molecules (B and D) exhibits multiple conformations perhaps accounting for the relatively high R-factor of the native data for the resolution. Structure figures were drawn with PyMOL (DeLano, 2002, available on the World Wide Web at pymol.sourceforge.net). The sequence alignment in FIG. 11 was drawn with ESPript (espript.ibcp.fr/ESPript/cgi-bin/ESPript.cgi) (Gouet et al., 1999, Bioinformatics 15:305-308). The electrostatic surface (FIG. 13) was calculated using DelPhi (Rocchia et al., 2002, J. Comput. Chem. 23:128-137). Structural similarity searches were performed with MSDFOLD (available on the World Wide Web at ebi.ac.uk/msdsrv/ssm/cgi-bin/ssm-server) and Dalilite (available on the World Wide Web at ebi.ac.uk/Tools/dalilite/index.html).

Figure 10:
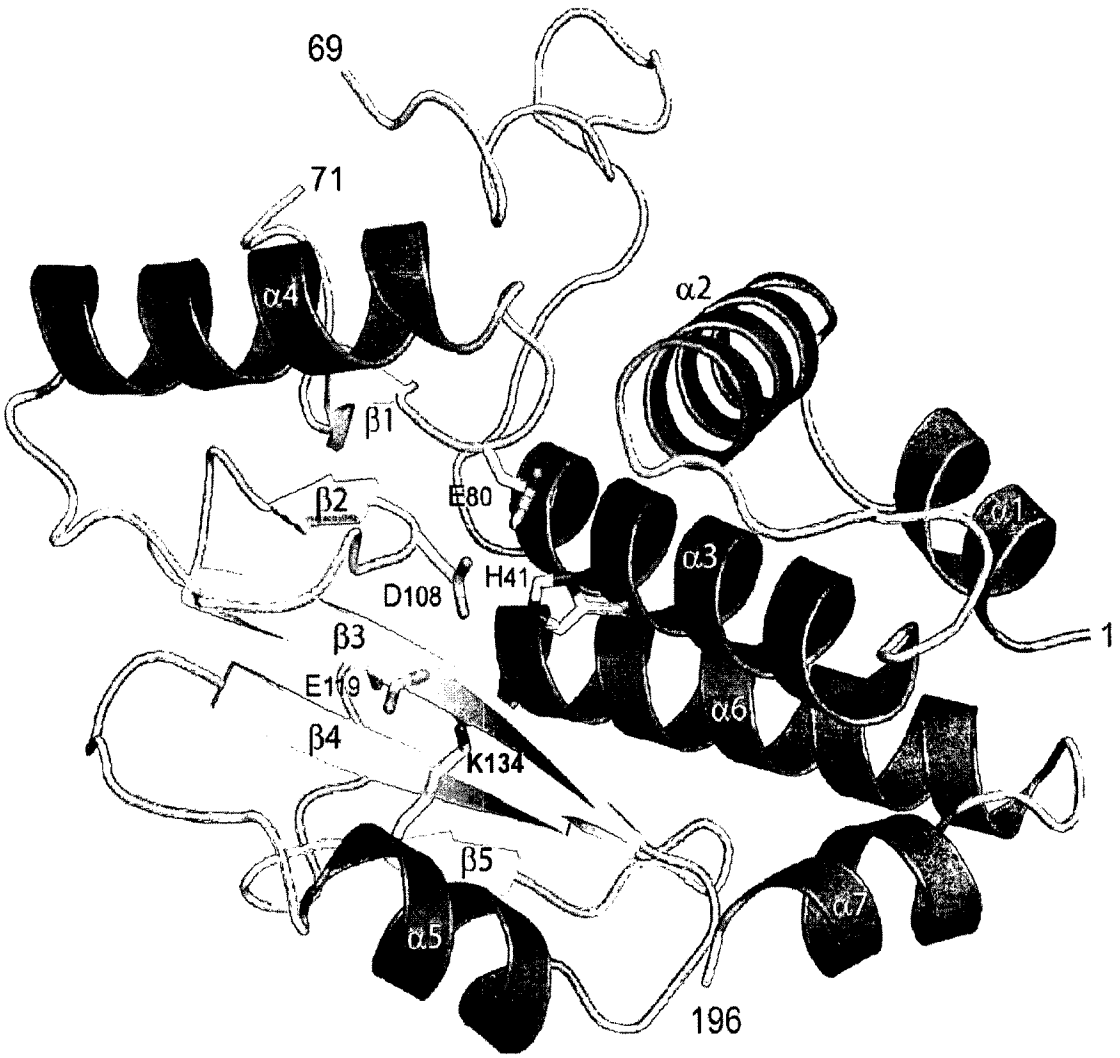
FIG. 10: Three-dimensional structure of PA-Nter (SEQ ID NO: 22). Ribbon diagram of the structure of influenza PA-Nter (SEQ ID NO: 22) with α-helices (medium grey) and β-strands (light grey). The key active site residues are indicated in stick representation.
Figure 14:
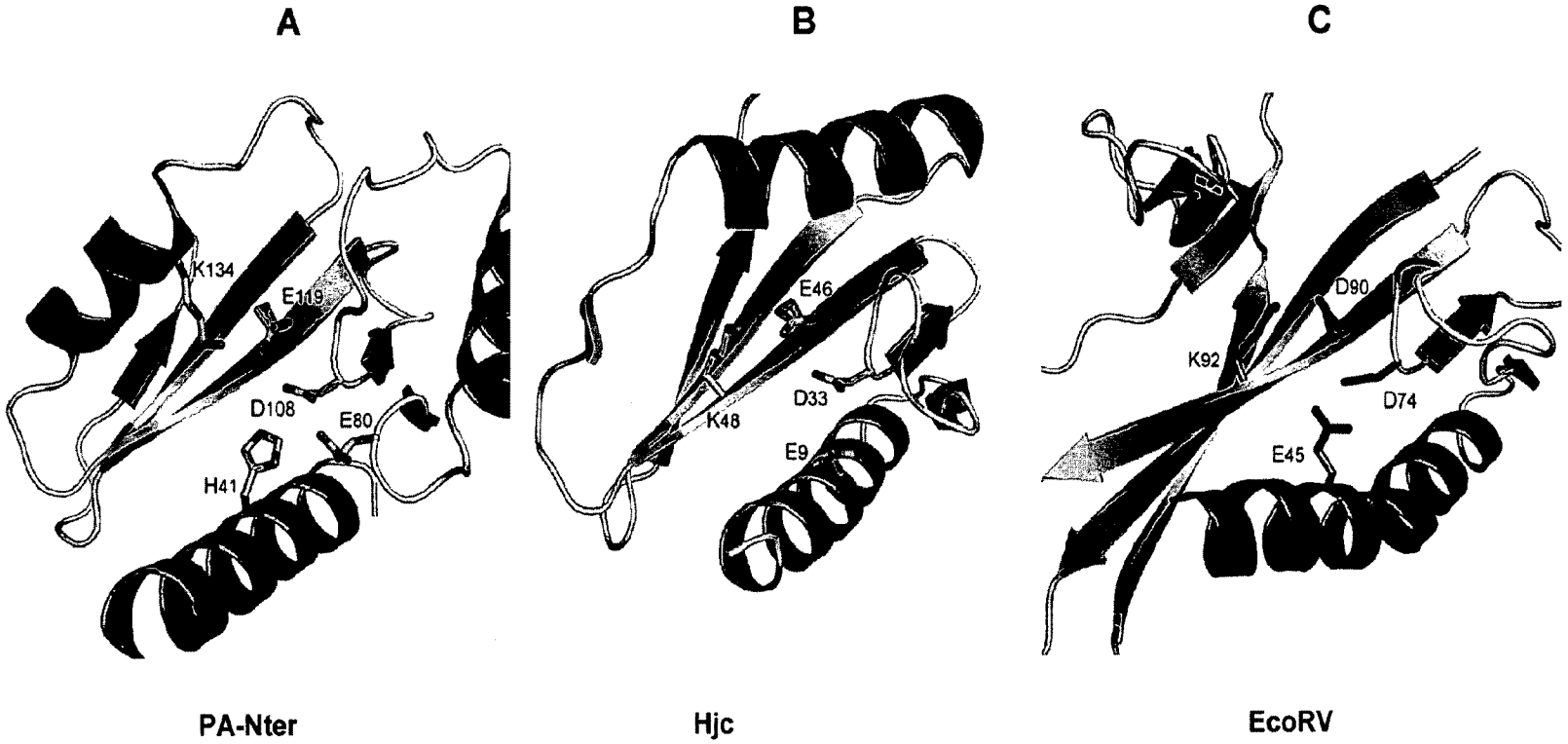
FIG. 14: Comparison of PA-Nter (SEQ ID NO: 22) with other nucleases of the PD-(D/E)XK superfamily. Comparison of PA-Nter (SEQ ID NO: 22; left, A), *P. furiosus* Holliday junction resolvase Hjc (PDB entry 1GEF) (middle, B) and *E. coli* EcoRV restriction enzyme (PDB entry 1 STX, product complex with DNA and manganese) (right, C) after superposition of the conserved core active site structural motif. The rootmean-square-deviations are 2.9 Å for 77 aligned Cα atoms of Hjc and 2.46 (3.1) A for 55 (72) aligned Cα atoms of EcoRV. Secondary-structure elements are as in FIG. 10 with key active sites residues in stick representation.
Figure 16:
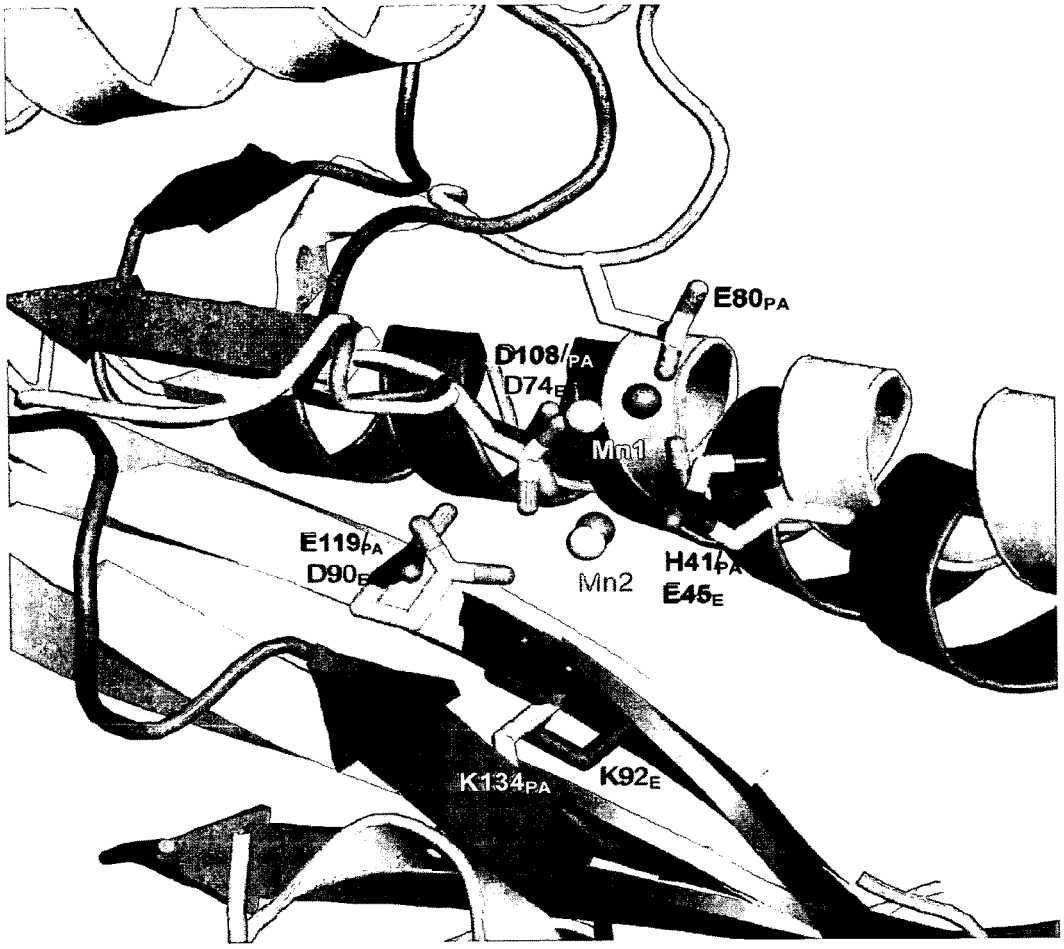
FIG. 16: Superposition of the active sites of influenza PA-Nter (SEQ ID NO: 22) and *E. coli* EcoRV restriction enzyme. PA-Nter (SEQ ID NO: 22) secondary structure elements and active sites residues (indicated with PA) are shown in light grey with the manganese ions in medium grey. Superposed are the equivalent elements of EcoRV (PDB entry 1 STX) (Horton and Perona, 2004, Biochemistry 43:6841-6857) in dark grey (indicated with E) for the protein and dark grey for the manganese ions. Key active site metal binding and catalytic functional groups of the two proteins align.

We grew small square-plate crystals of PA-Nter (SEQ ID NO: 22) in the presence of both manganese and magnesium that diffracted to about 2 Å resolution, with three independent molecules in the asymmetric unit. The crystal structure reveals a single, folded domain with residues 1-196 visible, comprising seven a-helices and a mixed, five-stranded β-sheet (FIG. 10). The structure based sequence alignment amongst influenza A, B and C viruses (FIG. 11) projected onto a surface representation reveals a very highly conserved depression that is strongly negatively charged due to a concentration of acidic residues (FIGS. 12 and 13), suggestive of an active site. A structure similarity search gave no high scoring hits indicating that the global fold is novel. The most similar protein found is the archaeal Holliday junction resolvase Hjc from *Pyrococcus furiosus* (Nishino et al., 2001, Structure 9:197-204). The structural alignment of PA-Nter (SEQ ID NO: 22) with Hjc superposes helix α3 and strands β1-5 (FIG. 14, left and middle panel) encompassing a structural motif characteristic of many nucleases including resolvases and type II restriction enzymes. The motif includes catalytically important divalent metal ion binding acidic residues Asp33 and Glu46 of Hjc upon which Asp108 and Glu119 of PA-Nter (SEQ ID NO: 22) exactly superpose. Structural alignment of PA-Nter (SEQ ID NO: 22) with type II restriction endonucleases such as BamHI or EcoRV reveals a similar superposition of active site elements (FIG. 14, right panel). Catalytically important Glu45, Asp74, Asp90 and Lys92 of EcoRV align with His41, Asp108, Glu119 and Lys134 of PA-Nter (SEQ ID NO: 22), respectively, although the lysines are positioned differently in the primary sequence (FIG. 16). The conserved lysine is implicated in stabilizing the attacking hydroxide nucleophile during catalysis. Thus PA-Nter (SEQ ID NO: 22) is a new member of the PD-(D/E)XK nuclease superfamily which encompasses a diversity of enzymes involved in various aspects of DNA metabolism. In PA-Nter (SEQ ID NO: 22), the characteristic motif occurs at 107-PDLYDYK (SEQ ID NO: 20), although the separation between the two acidic residues is unusually short and the putative catalytically important lysine (Lys134) has 'migrated' to an alternative position, as in some other members of the superfamily. Within this family, PA-Nter (SEQ ID NO: 22) is unusual in that it is biologically functional as an RNase and has a histidine in the active site.

Figure 15:
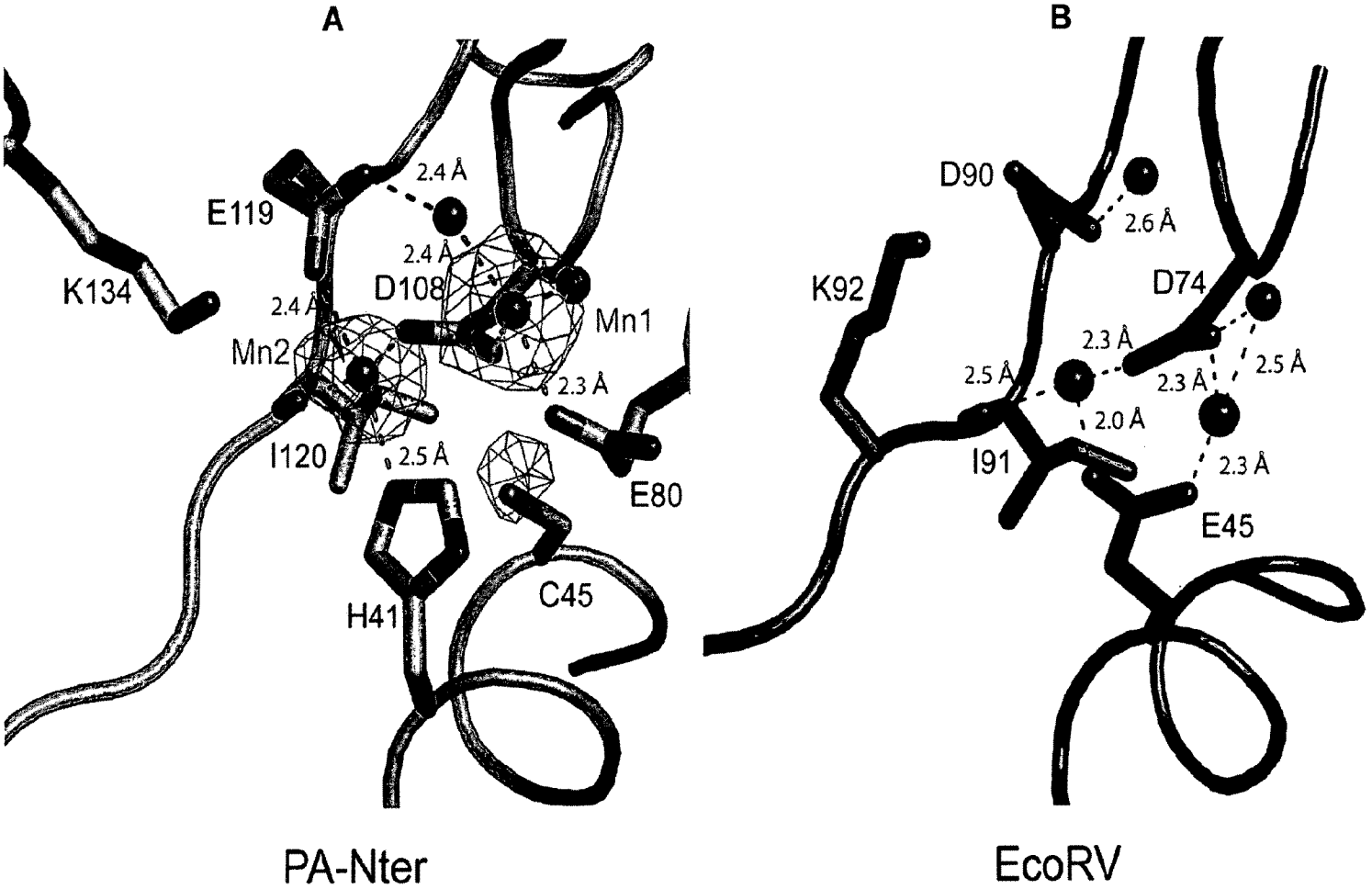
FIG. 15: Details of the manganese ion interactions with the active sites of influenza PA-Nter (SEQ ID NO: 22; molecule A) (left, A) and *E. coli* EcoRV restriction enzyme (product complex) (right, B). The active site elements and residues are shown respectively in light grey and dark grey (left) and dark grey (right). Manganese ions and water molecules are respectively medium grey and dark grey spheres. The anomalous difference map contoured at 3σ, calculated using manganese K edge (wavelength 1.89) diffraction data and model phases, is in dark grey. Peak heights are 14.1, 10.1, and 5.0 σ for Mn1, Mn2 and the sulphur of Cys45 respectively. Note that in metal dependent nucleases, the exact configuration of the metal ions and acidic side chains subtly depends on the reaction co-ordinate.
Figure 17:
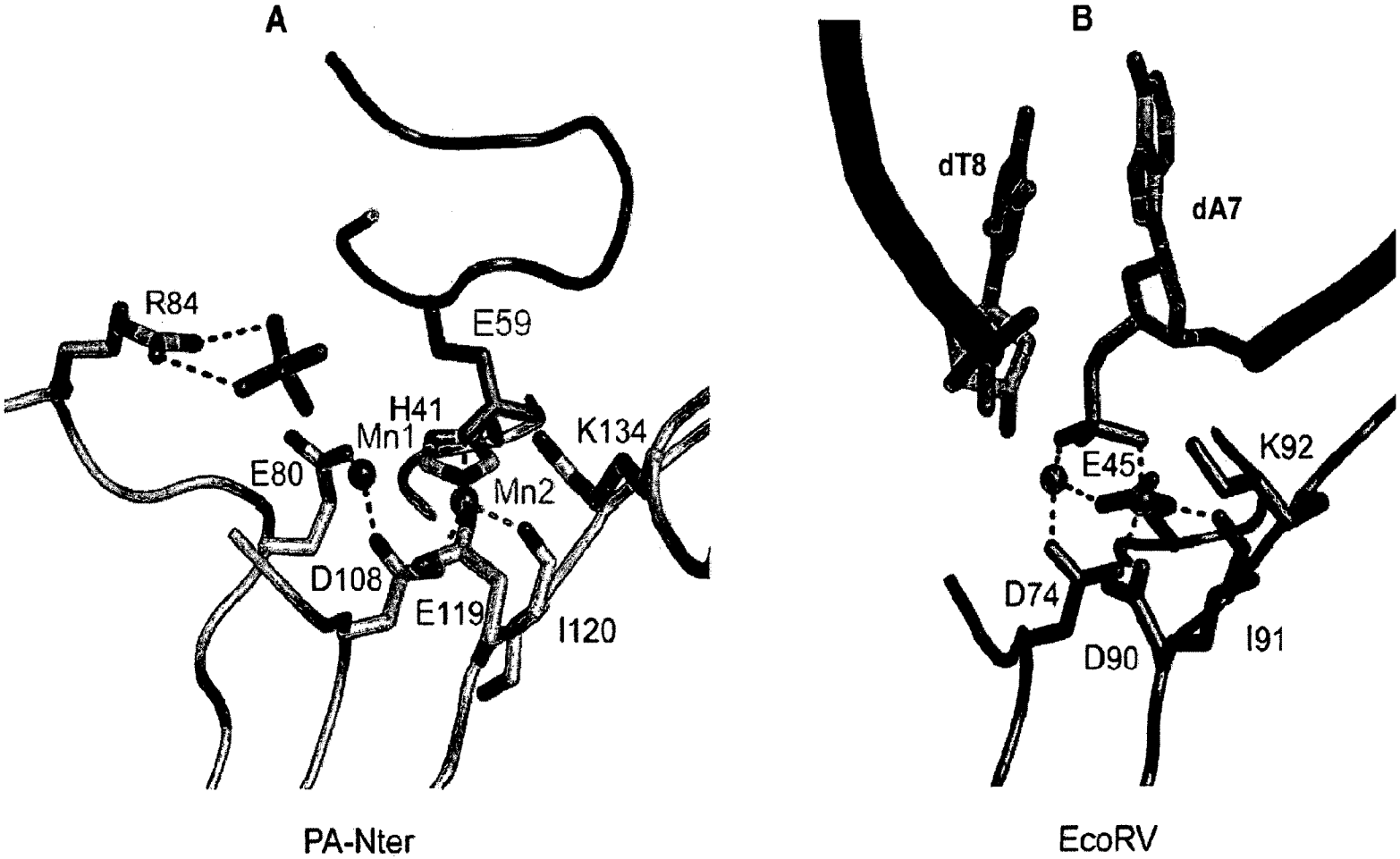
FIG. 17: Comparison of EcoRV product complex (B) and PA-Nter (SEQ ID NO: 22) with Glu66 from a neighboring molecule (A). The active site elements and residues of PA-Nter (SEQ ID NO: 22; molecule A) are shown in light grey with manganese ions in medium grey and the Glu66 containing loop of the adjacent molecule in light grey. In the same orientation, after superposition of the two structures, *E. coli* EcoRV restriction enzyme (PDB entry 1 STX) (Horton and Perona, supra) is shown in dark grey with the DNA bases in light grey and the manganese ions in medium grey. The carboxyl function of Glu59 superimposes on the scissile phosphate of dA7 whereas the well-ordered sulphate ion found in the active site of PA-Nter (SEQ ID NO: 22) occupies the position of the phosphate part of dT8.

To confirm that the conserved acidic residues of PA-Nter (SEQ ID NO: 22) are metal binding residues we calculated an anomalous difference map using data collected at the manganese K absorption edge. Two manganese ions were identified in each active site as adjacent anomalous peaks separated by about 3.8 Å (FIG. 15, left panel). The stronger peak (Mn1) is co-ordinated by Glu80, Asp108 and two water molecules; the weaker site (Mn2) by His41, Asp108, Glu119 and the carbonyl oxygen of Ile120. The cited residues are absolutely conserved in all influenza virus PA sequences (except for Ile120 which is conservatively substituted) (FIG. 11). The two metal sites correspond closely with those observed in restriction enzymes such as EcoRV (FIG. 15, right panel). His41 (positioned as Glu45 in EcoRV) from helix α3 could be important in conferring manganese specificity, since magnesium and calcium bind less readily to histidine. Manganese binding by His41 and the resulting stabilization of helix α3 could account for the additional helical content (estimated as 8-9 residues) detected upon incubating PA-Nter (SEQ ID NO: 22) with manganese (FIG. 3). In the crystal, Mn1 is also co-ordinated by Glu59 from a loop of an adjacent molecule. Superposition of DNA complexes of BamHI or EcoRV on PA-Nter (SEQ ID NO: 22) shows that the Glu59 carboxylate group corresponds closely to the position of the scissile phosphate group (FIG. 17). Thus our structure mimics a substrate or product complex.

Our structural and biochemical results combined with previous observations on the trimeric polymerase provide compelling evidence that PA-Nter (SEQ ID NO: 22) is the endonuclease that cleaves host mRNAs during cap-snatching. First, the domain has intrinsic RNA and DNA endonuclease activity which is preferentially activated by manganese, in accordance with observations reported for the viral RNPs (FIG. 6). Second, this activity is inhibited by a compound known to inhibit influenza endonuclease activity with a nearly identical $K_i$ (FIG. 9). Third, the domain contains a structural motif characteristic of the catalytic core of a broad family of nucleases, including type II endonucleases. The active site features a cluster of three acidic residues (Glu80, Asp108 and Glu119) and a putative catalytic lysine (Lys134) (FIGS. 14 to 16). Fourth, these acidic residues, together with His41, are all absolutely conserved in influenza viruses, co-ordinate two manganese ions in a configuration consistent with a two-metal dependent reaction mechanism as proposed for many nucleases (FIG. 15, left panel).

SEQUENCE LISTING

```
<160> NUMBER OF SEQ ID NOS: 23

<210> SEQ ID NO 1
<211> LENGTH: 2148
<212> TYPE: DNA
<213> ORGANISM: Influenza A virus
```

```
<220> FEATURE:
<221> NAME/KEY: CDS
<222> LOCATION: (1)..(2148)
<223> OTHER INFORMATION: PA-subunit of the Influenza A virus
      (A/Victoria/3/1975 (H3N2)) RNA-dependent RNA polymerase

<400> SEQUENCE: 1

atg gaa gat ttt gtg cga caa tgc ttc aat ccg atg att gtc gag ctt       48
Met Glu Asp Phe Val Arg Gln Cys Phe Asn Pro Met Ile Val Glu Leu
1               5                   10                  15

gca gaa aag gca atg aaa gag tat gga gag gat ctg aaa atc gaa aca       96
Ala Glu Lys Ala Met Lys Glu Tyr Gly Glu Asp Leu Lys Ile Glu Thr
            20                  25                  30

aac aaa ttt gca gca ata tgc act cac ttg gag gta tgt ttc atg tat      144
Asn Lys Phe Ala Ala Ile Cys Thr His Leu Glu Val Cys Phe Met Tyr
        35                  40                  45

tca gat ttt cac ttc atc aat gaa caa ggc gag tca ata gtg gta gag      192
Ser Asp Phe His Phe Ile Asn Glu Gln Gly Glu Ser Ile Val Val Glu
    50                  55                  60

ctt gat gat cca aat gca ctg tta aag cac aga ttt gaa ata ata gag      240
Leu Asp Asp Pro Asn Ala Leu Leu Lys His Arg Phe Glu Ile Ile Glu
65                  70                  75                  80

gga aga gac cga aca atg gcc tgg aca gta gta aac agt att tgc aac      288
Gly Arg Asp Arg Thr Met Ala Trp Thr Val Val Asn Ser Ile Cys Asn
                85                  90                  95

act act gga gct gag aaa ccg aag ttt ctg cca gat ttg tat gat tac      336
Thr Thr Gly Ala Glu Lys Pro Lys Phe Leu Pro Asp Leu Tyr Asp Tyr
            100                 105                 110

aag gag aat aga ttc ata gag att gga gta aca agg aga gaa gtc cac      384
Lys Glu Asn Arg Phe Ile Glu Ile Gly Val Thr Arg Arg Glu Val His
        115                 120                 125

ata tac tac ctt gaa aag gcc aat aaa att aaa tct gag aat aca cac      432
Ile Tyr Tyr Leu Glu Lys Ala Asn Lys Ile Lys Ser Glu Asn Thr His
    130                 135                 140

atc cac att ttc tca ttc act ggg gag gaa atg gcc aca aag gcc gac      480
Ile His Ile Phe Ser Phe Thr Gly Glu Glu Met Ala Thr Lys Ala Asp
145                 150                 155                 160

tac act ctt gat gag gaa agc agg gct agg atc aaa acc agg cta ttt      528
Tyr Thr Leu Asp Glu Glu Ser Arg Ala Arg Ile Lys Thr Arg Leu Phe
                165                 170                 175

acc ata aga caa gaa atg gcc aac aga ggc ctc tgg gat tcc ttt cgt      576
Thr Ile Arg Gln Glu Met Ala Asn Arg Gly Leu Trp Asp Ser Phe Arg
            180                 185                 190

cag tcc gaa aga ggc gaa gaa aca att gaa gaa aga ttt gaa atc aca      624
Gln Ser Glu Arg Gly Glu Glu Thr Ile Glu Glu Arg Phe Glu Ile Thr
        195                 200                 205

gga act atg cgc agg ctt gcc gac caa agt ctc ccg ccg aac ttc tcc      672
Gly Thr Met Arg Arg Leu Ala Asp Gln Ser Leu Pro Pro Asn Phe Ser
    210                 215                 220

tgc ctt gag aat ttt aga gcc tat gtg gat gga ttc gaa ccg aac ggc      720
Cys Leu Glu Asn Phe Arg Ala Tyr Val Asp Gly Phe Glu Pro Asn Gly
225                 230                 235                 240

tgc att gag ggc aag ctt tct caa atg tcc aaa gaa gtg aat gca aaa      768
Cys Ile Glu Gly Lys Leu Ser Gln Met Ser Lys Glu Val Asn Ala Lys
                245                 250                 255

att gaa cct ttt ctg aag aca aca cca aga cca atc aaa ctt ccg gat      816
Ile Glu Pro Phe Leu Lys Thr Thr Pro Arg Pro Ile Lys Leu Pro Asp
            260                 265                 270

ggc cct cct tgt ttt cag cgg tcc aaa ttc ctt ctg atg gat gct tta      864
Gly Pro Pro Cys Phe Gln Arg Ser Lys Phe Leu Leu Met Asp Ala Leu
        275                 280                 285
```

```
aaa tta agc att gaa gac cca agt cac gaa gga gag gga ata cca cta      912
Lys Leu Ser Ile Glu Asp Pro Ser His Glu Gly Glu Gly Ile Pro Leu
    290                 295                 300

tat gat gcg atc aag tgc atg aga aca ttc ttt gga tgg aaa gaa ccc      960
Tyr Asp Ala Ile Lys Cys Met Arg Thr Phe Phe Gly Trp Lys Glu Pro
305                 310                 315                 320

tat atc gtc aaa cca cac gaa agg gga ata aat tca aat tat ctg ctg     1008
Tyr Ile Val Lys Pro His Glu Arg Gly Ile Asn Ser Asn Tyr Leu Leu
                325                 330                 335

tca tgg aag caa gta ctg gca gaa cta cag gac att gaa aat gag gag     1056
Ser Trp Lys Gln Val Leu Ala Glu Leu Gln Asp Ile Glu Asn Glu Glu
            340                 345                 350

aag att cca aga act aaa aac atg aag aaa acg agt cag cta aag tgg     1104
Lys Ile Pro Arg Thr Lys Asn Met Lys Lys Thr Ser Gln Leu Lys Trp
        355                 360                 365

gca ctt ggt gag aac atg gca cca gag aaa gta gac ttt gac aac tgt     1152
Ala Leu Gly Glu Asn Met Ala Pro Glu Lys Val Asp Phe Asp Asn Cys
    370                 375                 380

aga gac ata agc gat ttg aag cag tat gat agt gac gaa cct gaa tta     1200
Arg Asp Ile Ser Asp Leu Lys Gln Tyr Asp Ser Asp Glu Pro Glu Leu
385                 390                 395                 400

agg tca ctt tca agc tgg atc cag aat gag ttc aac aag gca tgc gag     1248
Arg Ser Leu Ser Ser Trp Ile Gln Asn Glu Phe Asn Lys Ala Cys Glu
                405                 410                 415

ctg act gat tca atc tgg ata gag ctc gat gag att gga gaa gac gtg     1296
Leu Thr Asp Ser Ile Trp Ile Glu Leu Asp Glu Ile Gly Glu Asp Val
            420                 425                 430

gct cca att gaa tac att gca agc atg agg agg aat tat ttc aca gca     1344
Ala Pro Ile Glu Tyr Ile Ala Ser Met Arg Arg Asn Tyr Phe Thr Ala
        435                 440                 445

gag gtg tcc cat tgc aga gcc aca gaa tac ata atg aag ggg gta tac     1392
Glu Val Ser His Cys Arg Ala Thr Glu Tyr Ile Met Lys Gly Val Tyr
    450                 455                 460

att aat act gcc ttg ctt aat gca tcc tgt gca gca atg gat gat ttc     1440
Ile Asn Thr Ala Leu Leu Asn Ala Ser Cys Ala Ala Met Asp Asp Phe
465                 470                 475                 480

caa cta att ccc atg ata agc aag tgc aga act aaa gag gga agg cga     1488
Gln Leu Ile Pro Met Ile Ser Lys Cys Arg Thr Lys Glu Gly Arg Arg
                485                 490                 495

aaa acc aat tta tat gga ttc atc ata aag gga aga tct cac tta agg     1536
Lys Thr Asn Leu Tyr Gly Phe Ile Ile Lys Gly Arg Ser His Leu Arg
            500                 505                 510

aat gac acc gac gtg gta aac ttt gtg agc atg gag ttt tct ctc act     1584
Asn Asp Thr Asp Val Val Asn Phe Val Ser Met Glu Phe Ser Leu Thr
        515                 520                 525

gac ccg aga ctt gag cca cat aaa tgg gag aaa tac tgt gtc ctt gag     1632
Asp Pro Arg Leu Glu Pro His Lys Trp Glu Lys Tyr Cys Val Leu Glu
    530                 535                 540

ata gga gat atg cta cta aga agt gcc ata ggc cag atg tca agg cct     1680
Ile Gly Asp Met Leu Leu Arg Ser Ala Ile Gly Gln Met Ser Arg Pro
545                 550                 555                 560

atg ttc ttg tat gtg agg aca aat gga aca tca aag att aaa atg aaa     1728
Met Phe Leu Tyr Val Arg Thr Asn Gly Thr Ser Lys Ile Lys Met Lys
                565                 570                 575

tgg gga atg gag atg aga cgt tgc ctc ctt cag tca ctc caa caa atc     1776
Trp Gly Met Glu Met Arg Arg Cys Leu Leu Gln Ser Leu Gln Gln Ile
            580                 585                 590

gag agc atg att gaa gcc gag tcc tct gtt aaa gag aaa gac atg acc     1824
Glu Ser Met Ile Glu Ala Glu Ser Ser Val Lys Glu Lys Asp Met Thr
```

```
        595                 600                 605

aaa gag ttt ttt gag aat aaa tca gaa aca tgg ccc att ggg gag tct     1872
Lys Glu Phe Phe Glu Asn Lys Ser Glu Thr Trp Pro Ile Gly Glu Ser
    610                 615                 620

ccc aag gga gtg gaa gaa ggt tcc att ggg aag gtc tgt agg act tta     1920
Pro Lys Gly Val Glu Glu Gly Ser Ile Gly Lys Val Cys Arg Thr Leu
625                 630                 635                 640

ttg gcc aag tcg gta ttc aat agc ctg tat gca tcc cca caa ttg gaa     1968
Leu Ala Lys Ser Val Phe Asn Ser Leu Tyr Ala Ser Pro Gln Leu Glu
                645                 650                 655

gga ttt tca gcg gag tca aga aaa ctg ctt ctt gtc gtt cag gct ctt     2016
Gly Phe Ser Ala Glu Ser Arg Lys Leu Leu Leu Val Val Gln Ala Leu
            660                 665                 670

agg gac aac ctt gaa cct gga acc ttt gat ctt ggg ggg cta tat gaa     2064
Arg Asp Asn Leu Glu Pro Gly Thr Phe Asp Leu Gly Gly Leu Tyr Glu
        675                 680                 685

gca att gag gag tgc ctg att aat gat ccc tgg gtt ttg ctt aat gcg     2112
Ala Ile Glu Glu Cys Leu Ile Asn Asp Pro Trp Val Leu Leu Asn Ala
    690                 695                 700

tct tgg ttc aac tcc ttc cta aca cat gca tta aga                     2148
Ser Trp Phe Asn Ser Phe Leu Thr His Ala Leu Arg
705                 710                 715


<210> SEQ ID NO 2
<211> LENGTH: 716
<212> TYPE: PRT
<213> ORGANISM: Influenza A virus

<400> SEQUENCE: 2

Met Glu Asp Phe Val Arg Gln Cys Phe Asn Pro Met Ile Val Glu Leu
1               5                   10                  15

Ala Glu Lys Ala Met Lys Glu Tyr Gly Glu Asp Leu Lys Ile Glu Thr
            20                  25                  30

Asn Lys Phe Ala Ala Ile Cys Thr His Leu Glu Val Cys Phe Met Tyr
        35                  40                  45

Ser Asp Phe His Phe Ile Asn Glu Gln Gly Glu Ser Ile Val Val Glu
    50                  55                  60

Leu Asp Asp Pro Asn Ala Leu Leu Lys His Arg Phe Glu Ile Ile Glu
65                  70                  75                  80

Gly Arg Asp Arg Thr Met Ala Trp Thr Val Val Asn Ser Ile Cys Asn
                85                  90                  95

Thr Thr Gly Ala Glu Lys Pro Lys Phe Leu Pro Asp Leu Tyr Asp Tyr
            100                 105                 110

Lys Glu Asn Arg Phe Ile Glu Ile Gly Val Thr Arg Arg Glu Val His
        115                 120                 125

Ile Tyr Tyr Leu Glu Lys Ala Asn Lys Ile Lys Ser Glu Asn Thr His
    130                 135                 140

Ile His Ile Phe Ser Phe Thr Gly Glu Glu Met Ala Thr Lys Ala Asp
145                 150                 155                 160

Tyr Thr Leu Asp Glu Glu Ser Arg Ala Arg Ile Lys Thr Arg Leu Phe
                165                 170                 175

Thr Ile Arg Gln Glu Met Ala Asn Arg Gly Leu Trp Asp Ser Phe Arg
            180                 185                 190

Gln Ser Glu Arg Gly Glu Glu Thr Ile Glu Glu Arg Phe Glu Ile Thr
        195                 200                 205

Gly Thr Met Arg Arg Leu Ala Asp Gln Ser Leu Pro Pro Asn Phe Ser
    210                 215                 220
```

```
Cys Leu Glu Asn Phe Arg Ala Tyr Val Asp Gly Phe Glu Pro Asn Gly
225                 230                 235                 240

Cys Ile Glu Gly Lys Leu Ser Gln Met Ser Lys Glu Val Asn Ala Lys
                245                 250                 255

Ile Glu Pro Phe Leu Lys Thr Thr Pro Arg Pro Ile Lys Leu Pro Asp
            260                 265                 270

Gly Pro Pro Cys Phe Gln Arg Ser Lys Phe Leu Leu Met Asp Ala Leu
        275                 280                 285

Lys Leu Ser Ile Glu Asp Pro Ser His Glu Gly Glu Gly Ile Pro Leu
    290                 295                 300

Tyr Asp Ala Ile Lys Cys Met Arg Thr Phe Phe Gly Trp Lys Glu Pro
305                 310                 315                 320

Tyr Ile Val Lys Pro His Glu Arg Gly Ile Asn Ser Asn Tyr Leu Leu
                325                 330                 335

Ser Trp Lys Gln Val Leu Ala Glu Leu Gln Asp Ile Glu Asn Glu Glu
            340                 345                 350

Lys Ile Pro Arg Thr Lys Asn Met Lys Lys Thr Ser Gln Leu Lys Trp
        355                 360                 365

Ala Leu Gly Glu Asn Met Ala Pro Glu Lys Val Asp Phe Asp Asn Cys
    370                 375                 380

Arg Asp Ile Ser Asp Leu Lys Gln Tyr Asp Ser Asp Glu Pro Glu Leu
385                 390                 395                 400

Arg Ser Leu Ser Ser Trp Ile Gln Asn Glu Phe Asn Lys Ala Cys Glu
                405                 410                 415

Leu Thr Asp Ser Ile Trp Ile Glu Leu Asp Glu Ile Gly Glu Asp Val
            420                 425                 430

Ala Pro Ile Glu Tyr Ile Ala Ser Met Arg Arg Asn Tyr Phe Thr Ala
        435                 440                 445

Glu Val Ser His Cys Arg Ala Thr Glu Tyr Ile Met Lys Gly Val Tyr
    450                 455                 460

Ile Asn Thr Ala Leu Leu Asn Ala Ser Cys Ala Ala Met Asp Asp Phe
465                 470                 475                 480

Gln Leu Ile Pro Met Ile Ser Lys Cys Arg Thr Lys Glu Gly Arg Arg
                485                 490                 495

Lys Thr Asn Leu Tyr Gly Phe Ile Ile Lys Gly Arg Ser His Leu Arg
            500                 505                 510

Asn Asp Thr Asp Val Val Asn Phe Val Ser Met Glu Phe Ser Leu Thr
        515                 520                 525

Asp Pro Arg Leu Glu Pro His Lys Trp Glu Lys Tyr Cys Val Leu Glu
    530                 535                 540

Ile Gly Asp Met Leu Leu Arg Ser Ala Ile Gly Gln Met Ser Arg Pro
545                 550                 555                 560

Met Phe Leu Tyr Val Arg Thr Asn Gly Thr Ser Lys Ile Lys Met Lys
                565                 570                 575

Trp Gly Met Glu Met Arg Arg Cys Leu Leu Gln Ser Leu Gln Gln Ile
            580                 585                 590

Glu Ser Met Ile Glu Ala Glu Ser Ser Val Lys Glu Lys Asp Met Thr
        595                 600                 605

Lys Glu Phe Phe Glu Asn Lys Ser Glu Thr Trp Pro Ile Gly Glu Ser
    610                 615                 620

Pro Lys Gly Val Glu Glu Gly Ser Ile Gly Lys Val Cys Arg Thr Leu
625                 630                 635                 640
```

```
Leu Ala Lys Ser Val Phe Asn Ser Leu Tyr Ala Ser Pro Gln Leu Glu
                645                 650                 655

Gly Phe Ser Ala Glu Ser Arg Lys Leu Leu Leu Val Val Gln Ala Leu
            660                 665                 670

Arg Asp Asn Leu Glu Pro Gly Thr Phe Asp Leu Gly Gly Leu Tyr Glu
        675                 680                 685

Ala Ile Glu Glu Cys Leu Ile Asn Asp Pro Trp Val Leu Leu Asn Ala
    690                 695                 700

Ser Trp Phe Asn Ser Phe Leu Thr His Ala Leu Arg
705                 710                 715


<210> SEQ ID NO 3
<211> LENGTH: 2181
<212> TYPE: DNA
<213> ORGANISM: Influenza B virus
<220> FEATURE:
<221> NAME/KEY: CDS
<222> LOCATION: (1)..(2181)
<223> OTHER INFORMATION: PA-subunit of the Influenza B virus
      (B/Ann Arbor/1/1966 [wild-type]) RNA-dependent RNA polymerase

<400> SEQUENCE: 3

atg gat act ttt att aca aga aat ttc cag act aca ata ata caa aag       48
Met Asp Thr Phe Ile Thr Arg Asn Phe Gln Thr Thr Ile Ile Gln Lys
1               5                   10                  15

gcc aaa aac aca atg gca gaa ttt agt gaa gat cct gaa tta caa cca       96
Ala Lys Asn Thr Met Ala Glu Phe Ser Glu Asp Pro Glu Leu Gln Pro
            20                  25                  30

gca atg cta ttc aac atc tgc gtc cat ctg gag gtc tgc tat gta ata      144
Ala Met Leu Phe Asn Ile Cys Val His Leu Glu Val Cys Tyr Val Ile
        35                  40                  45

agt gat atg aat ttt ctt gat gaa gaa gga aaa aca tat aca gca tta      192
Ser Asp Met Asn Phe Leu Asp Glu Glu Gly Lys Thr Tyr Thr Ala Leu
    50                  55                  60

gaa gga caa gga aaa gaa caa aac ttg aga cca caa tat gaa gtg att      240
Glu Gly Gln Gly Lys Glu Gln Asn Leu Arg Pro Gln Tyr Glu Val Ile
65                  70                  75                  80

gag gga atg cca aga aac ata gca tgg atg gtt caa aga tcc tta gcc      288
Glu Gly Met Pro Arg Asn Ile Ala Trp Met Val Gln Arg Ser Leu Ala
                85                  90                  95

caa gag cat gga ata gag act cca agg tat ctg gct gat ttg ttc gat      336
Gln Glu His Gly Ile Glu Thr Pro Arg Tyr Leu Ala Asp Leu Phe Asp
            100                 105                 110

tat aaa acc aag agg ttt ata gaa gtt gga ata aca aag gga ttg gct      384
Tyr Lys Thr Lys Arg Phe Ile Glu Val Gly Ile Thr Lys Gly Leu Ala
        115                 120                 125

gac gat tac ttt tgg aaa aag aaa gaa aag ctg ggg aat agc atg gaa      432
Asp Asp Tyr Phe Trp Lys Lys Lys Glu Lys Leu Gly Asn Ser Met Glu
    130                 135                 140

ctg atg ata ttc agc tac aat caa gac tat tcg tta agt aat gaa cac      480
Leu Met Ile Phe Ser Tyr Asn Gln Asp Tyr Ser Leu Ser Asn Glu His
145                 150                 155                 160

tca ttg gat gag gaa gga aaa ggg aga gtg cta agc aga ctc aca gaa      528
Ser Leu Asp Glu Glu Gly Lys Gly Arg Val Leu Ser Arg Leu Thr Glu
                165                 170                 175

ctt cag gct gag tta agt ctg aaa aat cta tgg caa gtt ctc ata gga      576
Leu Gln Ala Glu Leu Ser Leu Lys Asn Leu Trp Gln Val Leu Ile Gly
            180                 185                 190

gaa gaa gat att gaa aaa gga att gac ttc aaa ctt gga caa aca ata      624
Glu Glu Asp Ile Glu Lys Gly Ile Asp Phe Lys Leu Gly Gln Thr Ile
        195                 200                 205
```

```
tct aaa cta agg gac ata tct gtt cca gct ggt ttc tcc aat ttt gaa      672
Ser Lys Leu Arg Asp Ile Ser Val Pro Ala Gly Phe Ser Asn Phe Glu
    210                 215                 220

gga atg agg agc tac ata gac aat ata gat cct aaa gga gca ata gag      720
Gly Met Arg Ser Tyr Ile Asp Asn Ile Asp Pro Lys Gly Ala Ile Glu
225                 230                 235                 240

aga aat cta gca agg atg tct ccc tta gta tca gtt aca ccc aaa aag      768
Arg Asn Leu Ala Arg Met Ser Pro Leu Val Ser Val Thr Pro Lys Lys
                245                 250                 255

tta aaa tgg gag gac cta aga cca ata ggg cct cac att tac agc cat      816
Leu Lys Trp Glu Asp Leu Arg Pro Ile Gly Pro His Ile Tyr Ser His
            260                 265                 270

gag cta cca gaa gtt cca tat aat gcc ttt ctt cta atg tct gat gag      864
Glu Leu Pro Glu Val Pro Tyr Asn Ala Phe Leu Leu Met Ser Asp Glu
        275                 280                 285

ttg ggg ctg gct aat atg act gaa ggg aag tcc aag aaa cca aag acc      912
Leu Gly Leu Ala Asn Met Thr Glu Gly Lys Ser Lys Lys Pro Lys Thr
    290                 295                 300

tta gcc aaa gaa tgt cta gaa aag tac tca aca cta cgg gat caa act      960
Leu Ala Lys Glu Cys Leu Glu Lys Tyr Ser Thr Leu Arg Asp Gln Thr
305                 310                 315                 320

gac cca ata tta ata atg aaa agc gaa aaa gct aac gaa aac ttc tta     1008
Asp Pro Ile Leu Ile Met Lys Ser Glu Lys Ala Asn Glu Asn Phe Leu
                325                 330                 335

tgg aag ttg tgg agg gac tgt gta aat aca ata agt aat gag gaa aca     1056
Trp Lys Leu Trp Arg Asp Cys Val Asn Thr Ile Ser Asn Glu Glu Thr
            340                 345                 350

agt aac gaa tta cag aaa acc aat tat gcc aag tgg gcc aca gga gat     1104
Ser Asn Glu Leu Gln Lys Thr Asn Tyr Ala Lys Trp Ala Thr Gly Asp
        355                 360                 365

gga tta aca tac cag aaa ata atg aaa gaa gta gca ata gat gac gaa     1152
Gly Leu Thr Tyr Gln Lys Ile Met Lys Glu Val Ala Ile Asp Asp Glu
    370                 375                 380

aca atg tac caa gaa gag ccc aaa ata cct aat aaa tgt aga gtg gct     1200
Thr Met Tyr Gln Glu Glu Pro Lys Ile Pro Asn Lys Cys Arg Val Ala
385                 390                 395                 400

gct tgg gtt caa aca gag atg aat cta ttg agc act ctg aca agt aaa     1248
Ala Trp Val Gln Thr Glu Met Asn Leu Leu Ser Thr Leu Thr Ser Lys
                405                 410                 415

agg gcc ctg gat cta cca gaa ata ggg cca gac gta gca ccc gtg gag     1296
Arg Ala Leu Asp Leu Pro Glu Ile Gly Pro Asp Val Ala Pro Val Glu
            420                 425                 430

cat gta ggg agt gaa aga agg aaa tac ttt gtt aat gaa atc aac tac     1344
His Val Gly Ser Glu Arg Arg Lys Tyr Phe Val Asn Glu Ile Asn Tyr
        435                 440                 445

tgt aag gcc tct acc gtt atg atg aag tat gta ctt ttt cac act tca     1392
Cys Lys Ala Ser Thr Val Met Met Lys Tyr Val Leu Phe His Thr Ser
    450                 455                 460

tta tta aat gaa agc aat gcc agc atg gga aaa tat aaa gta ata cca     1440
Leu Leu Asn Glu Ser Asn Ala Ser Met Gly Lys Tyr Lys Val Ile Pro
465                 470                 475                 480

ata acc aac aga gta gta aat gaa aaa gga gaa agt ttt gac ata ctt     1488
Ile Thr Asn Arg Val Val Asn Glu Lys Gly Glu Ser Phe Asp Ile Leu
                485                 490                 495

tat ggt ctg gcg gtt aaa ggg caa tct cat ctg agg gga gat act gat     1536
Tyr Gly Leu Ala Val Lys Gly Gln Ser His Leu Arg Gly Asp Thr Asp
            500                 505                 510

gtt gta aca gtt gtg act ttc gaa ttt agt agt aca gat ccc aga gtg     1584
Val Val Thr Val Val Thr Phe Glu Phe Ser Ser Thr Asp Pro Arg Val
```

```
        515                 520                 525

gac tca gga aag tgg cca aaa tat act gta ttt aga att ggt tcc tta     1632
Asp Ser Gly Lys Trp Pro Lys Tyr Thr Val Phe Arg Ile Gly Ser Leu
    530                 535                 540

ttt gtg agt gga agg gaa aaa tct gtg tac cta tat tgc cga gtg aat     1680
Phe Val Ser Gly Arg Glu Lys Ser Val Tyr Leu Tyr Cys Arg Val Asn
545                 550                 555                 560

ggt aca aac aag atc caa atg aaa tgg gga atg gaa gct aga aga tgt     1728
Gly Thr Asn Lys Ile Gln Met Lys Trp Gly Met Glu Ala Arg Arg Cys
                565                 570                 575

ctg ctt caa tca atg caa caa atg gaa gca att gtt gat caa gaa tca     1776
Leu Leu Gln Ser Met Gln Gln Met Glu Ala Ile Val Asp Gln Glu Ser
            580                 585                 590

tcg ata caa gga tat gac atg acc aaa gct tgt ttc aag gga gac aga     1824
Ser Ile Gln Gly Tyr Asp Met Thr Lys Ala Cys Phe Lys Gly Asp Arg
        595                 600                 605

gtg aat agt ccc aaa act ttc agt att ggg act caa gaa gga aaa cta     1872
Val Asn Ser Pro Lys Thr Phe Ser Ile Gly Thr Gln Glu Gly Lys Leu
    610                 615                 620

gta aaa gga tcc ttt ggg aaa gca cta aga gta ata ttc acc aaa tgt     1920
Val Lys Gly Ser Phe Gly Lys Ala Leu Arg Val Ile Phe Thr Lys Cys
625                 630                 635                 640

ttg atg cac tat gta ttt gga aat gcc caa ttg gag ggg ttt agt gcc     1968
Leu Met His Tyr Val Phe Gly Asn Ala Gln Leu Glu Gly Phe Ser Ala
                645                 650                 655

gaa tct agg aga ctt cta ctg tta att cag gca tta aag gac aga aag     2016
Glu Ser Arg Arg Leu Leu Leu Leu Ile Gln Ala Leu Lys Asp Arg Lys
            660                 665                 670

ggc cct tgg gta ttc gac tta gag gga atg tat tct gga ata gaa gaa     2064
Gly Pro Trp Val Phe Asp Leu Glu Gly Met Tyr Ser Gly Ile Glu Glu
        675                 680                 685

tgt att agt aac aac cct tgg gta ata cag agt gca tac tgg ttt aat     2112
Cys Ile Ser Asn Asn Pro Trp Val Ile Gln Ser Ala Tyr Trp Phe Asn
    690                 695                 700

gaa tgg ttg ggc ttt gaa aaa gag ggg agt aaa gta tta gaa tca ata     2160
Glu Trp Leu Gly Phe Glu Lys Glu Gly Ser Lys Val Leu Glu Ser Ile
705                 710                 715                 720

gat gaa ata atg gat gaa tga                                         2181
Asp Glu Ile Met Asp Glu
                725


<210> SEQ ID NO 4
<211> LENGTH: 726
<212> TYPE: PRT
<213> ORGANISM: Influenza B virus

<400> SEQUENCE: 4

Met Asp Thr Phe Ile Thr Arg Asn Phe Gln Thr Thr Ile Ile Gln Lys
1               5                   10                  15

Ala Lys Asn Thr Met Ala Glu Phe Ser Glu Asp Pro Glu Leu Gln Pro
            20                  25                  30

Ala Met Leu Phe Asn Ile Cys Val His Leu Glu Val Cys Tyr Val Ile
        35                  40                  45

Ser Asp Met Asn Phe Leu Asp Glu Glu Gly Lys Thr Tyr Thr Ala Leu
    50                  55                  60

Glu Gly Gln Gly Lys Glu Gln Asn Leu Arg Pro Gln Tyr Glu Val Ile
65                  70                  75                  80

Glu Gly Met Pro Arg Asn Ile Ala Trp Met Val Gln Arg Ser Leu Ala
                85                  90                  95
```

```
Gln Glu His Gly Ile Glu Thr Pro Arg Tyr Leu Ala Asp Leu Phe Asp
            100                 105                 110

Tyr Lys Thr Lys Arg Phe Ile Glu Val Gly Ile Thr Lys Gly Leu Ala
        115                 120                 125

Asp Asp Tyr Phe Trp Lys Lys Lys Glu Lys Leu Gly Asn Ser Met Glu
    130                 135                 140

Leu Met Ile Phe Ser Tyr Asn Gln Asp Tyr Ser Leu Ser Asn Glu His
145                 150                 155                 160

Ser Leu Asp Glu Glu Gly Lys Gly Arg Val Leu Ser Arg Leu Thr Glu
                165                 170                 175

Leu Gln Ala Glu Leu Ser Leu Lys Asn Leu Trp Gln Val Leu Ile Gly
            180                 185                 190

Glu Glu Asp Ile Glu Lys Gly Ile Asp Phe Lys Leu Gly Gln Thr Ile
        195                 200                 205

Ser Lys Leu Arg Asp Ile Ser Val Pro Ala Gly Phe Ser Asn Phe Glu
    210                 215                 220

Gly Met Arg Ser Tyr Ile Asp Asn Ile Asp Pro Lys Gly Ala Ile Glu
225                 230                 235                 240

Arg Asn Leu Ala Arg Met Ser Pro Leu Val Ser Val Thr Pro Lys Lys
                245                 250                 255

Leu Lys Trp Glu Asp Leu Arg Pro Ile Gly Pro His Ile Tyr Ser His
            260                 265                 270

Glu Leu Pro Glu Val Pro Tyr Asn Ala Phe Leu Leu Met Ser Asp Glu
        275                 280                 285

Leu Gly Leu Ala Asn Met Thr Glu Gly Lys Ser Lys Lys Pro Lys Thr
    290                 295                 300

Leu Ala Lys Glu Cys Leu Glu Lys Tyr Ser Thr Leu Arg Asp Gln Thr
305                 310                 315                 320

Asp Pro Ile Leu Ile Met Lys Ser Glu Lys Ala Asn Glu Asn Phe Leu
                325                 330                 335

Trp Lys Leu Trp Arg Asp Cys Val Asn Thr Ile Ser Asn Glu Glu Thr
            340                 345                 350

Ser Asn Glu Leu Gln Lys Thr Asn Tyr Ala Lys Trp Ala Thr Gly Asp
        355                 360                 365

Gly Leu Thr Tyr Gln Lys Ile Met Lys Glu Val Ala Ile Asp Asp Glu
    370                 375                 380

Thr Met Tyr Gln Glu Glu Pro Lys Ile Pro Asn Lys Cys Arg Val Ala
385                 390                 395                 400

Ala Trp Val Gln Thr Glu Met Asn Leu Leu Ser Thr Leu Thr Ser Lys
                405                 410                 415

Arg Ala Leu Asp Leu Pro Glu Ile Gly Pro Asp Val Ala Pro Val Glu
            420                 425                 430

His Val Gly Ser Glu Arg Arg Lys Tyr Phe Val Asn Glu Ile Asn Tyr
        435                 440                 445

Cys Lys Ala Ser Thr Val Met Met Lys Tyr Val Leu Phe His Thr Ser
    450                 455                 460

Leu Leu Asn Glu Ser Asn Ala Ser Met Gly Lys Tyr Lys Val Ile Pro
465                 470                 475                 480

Ile Thr Asn Arg Val Val Asn Glu Lys Gly Glu Ser Phe Asp Ile Leu
                485                 490                 495

Tyr Gly Leu Ala Val Lys Gly Gln Ser His Leu Arg Gly Asp Thr Asp
            500                 505                 510
```

```
Val Val Thr Val Val Thr Phe Glu Phe Ser Ser Thr Asp Pro Arg Val
        515                 520                 525

Asp Ser Gly Lys Trp Pro Lys Tyr Thr Val Phe Arg Ile Gly Ser Leu
    530                 535                 540

Phe Val Ser Gly Arg Glu Lys Ser Val Tyr Leu Tyr Cys Arg Val Asn
545                 550                 555                 560

Gly Thr Asn Lys Ile Gln Met Lys Trp Gly Met Glu Ala Arg Arg Cys
                565                 570                 575

Leu Leu Gln Ser Met Gln Gln Met Glu Ala Ile Val Asp Gln Glu Ser
            580                 585                 590

Ser Ile Gln Gly Tyr Asp Met Thr Lys Ala Cys Phe Lys Gly Asp Arg
        595                 600                 605

Val Asn Ser Pro Lys Thr Phe Ser Ile Gly Thr Gln Glu Gly Lys Leu
    610                 615                 620

Val Lys Gly Ser Phe Gly Lys Ala Leu Arg Val Ile Phe Thr Lys Cys
625                 630                 635                 640

Leu Met His Tyr Val Phe Gly Asn Ala Gln Leu Glu Gly Phe Ser Ala
                645                 650                 655

Glu Ser Arg Arg Leu Leu Leu Leu Ile Gln Ala Leu Lys Asp Arg Lys
            660                 665                 670

Gly Pro Trp Val Phe Asp Leu Glu Gly Met Tyr Ser Gly Ile Glu Glu
        675                 680                 685

Cys Ile Ser Asn Asn Pro Trp Val Ile Gln Ser Ala Tyr Trp Phe Asn
    690                 695                 700

Glu Trp Leu Gly Phe Glu Lys Glu Gly Ser Lys Val Leu Glu Ser Ile
705                 710                 715                 720

Asp Glu Ile Met Asp Glu
                725


<210> SEQ ID NO 5
<211> LENGTH: 2127
<212> TYPE: DNA
<213> ORGANISM: Influenza C virus
<220> FEATURE:
<221> NAME/KEY: CDS
<222> LOCATION: (1)..(2127)
<223> OTHER INFORMATION: PA-subunit of the Influenza C virus
      (C/Johannesburg/1/66) RNA-dependent RNA polymerase

<400> SEQUENCE: 5

atg tcg aaa act ttt gcc gaa ata gca gag act ttt cta gag cca gaa       48
Met Ser Lys Thr Phe Ala Glu Ile Ala Glu Thr Phe Leu Glu Pro Glu
1               5                   10                  15

gct gta aga ata gcc aaa gaa gca gtg gaa gaa tat ggg gat cac gaa       96
Ala Val Arg Ile Ala Lys Glu Ala Val Glu Glu Tyr Gly Asp His Glu
            20                  25                  30

aga aaa ata ata caa att gga ata cac ttt caa gtt tgc tgc atg ttc      144
Arg Lys Ile Ile Gln Ile Gly Ile His Phe Gln Val Cys Cys Met Phe
        35                  40                  45

tgt gat gag tat ttg agt aca aat ggg agt gat aga ttt gtg ctc att      192
Cys Asp Glu Tyr Leu Ser Thr Asn Gly Ser Asp Arg Phe Val Leu Ile
    50                  55                  60

gaa gga aga aaa aga gga act gca gtg tct tta caa aat gag cta tgt      240
Glu Gly Arg Lys Arg Gly Thr Ala Val Ser Leu Gln Asn Glu Leu Cys
65                  70                  75                  80

aaa agt tat gat ctt gaa cca cta cct ttt ctt tgt gac att ttc gac      288
Lys Ser Tyr Asp Leu Glu Pro Leu Pro Phe Leu Cys Asp Ile Phe Asp
                85                  90                  95
```

-continued

```
aga gaa gag aaa caa ttc gtt gaa att gga ata aca aga aaa gca gat      336
Arg Glu Glu Lys Gln Phe Val Glu Ile Gly Ile Thr Arg Lys Ala Asp
            100                 105                 110

gat agc tat ttt caa tcc aag ttt ggt aaa ctt gga aat agc tgc aag      384
Asp Ser Tyr Phe Gln Ser Lys Phe Gly Lys Leu Gly Asn Ser Cys Lys
        115                 120                 125

ata ttt gta ttc tcc tat gat gga aga ttg gac aaa aat tgt gaa ggc      432
Ile Phe Val Phe Ser Tyr Asp Gly Arg Leu Asp Lys Asn Cys Glu Gly
    130                 135                 140

cct atg gag gaa caa aaa ttg aga atc ttc agt ttt ctt gca act gct      480
Pro Met Glu Glu Gln Lys Leu Arg Ile Phe Ser Phe Leu Ala Thr Ala
145                 150                 155                 160

gct gat ttt ctt agg aaa gaa aac atg ttt aac gaa atc ttc tta cca      528
Ala Asp Phe Leu Arg Lys Glu Asn Met Phe Asn Glu Ile Phe Leu Pro
                165                 170                 175

gac aat gaa gaa acc atc att gaa atg aag aaa gga aaa aca ttt cta      576
Asp Asn Glu Glu Thr Ile Ile Glu Met Lys Lys Gly Lys Thr Phe Leu
            180                 185                 190

gaa ttg agg gat gaa agt gtt cct tta cct ttc caa act tat gaa cag      624
Glu Leu Arg Asp Glu Ser Val Pro Leu Pro Phe Gln Thr Tyr Glu Gln
        195                 200                 205

atg aaa gat tac tgt gaa aaa ttt aaa gga aat cca aga gaa tta gct      672
Met Lys Asp Tyr Cys Glu Lys Phe Lys Gly Asn Pro Arg Glu Leu Ala
    210                 215                 220

tct aaa gta agc caa atg caa agc aac att aaa ttg cca ata aaa cat      720
Ser Lys Val Ser Gln Met Gln Ser Asn Ile Lys Leu Pro Ile Lys His
225                 230                 235                 240

tat gag cag aat aaa ttt cga caa ata cgt cta cca aag gga cca atg      768
Tyr Glu Gln Asn Lys Phe Arg Gln Ile Arg Leu Pro Lys Gly Pro Met
                245                 250                 255

gca ccc tat acc cac aag ttc tta atg gaa gaa gca tgg atg ttt aca      816
Ala Pro Tyr Thr His Lys Phe Leu Met Glu Glu Ala Trp Met Phe Thr
            260                 265                 270

aaa att agt gat cct gaa aga tca aga gct ggt gaa att ctc att gat      864
Lys Ile Ser Asp Pro Glu Arg Ser Arg Ala Gly Glu Ile Leu Ile Asp
        275                 280                 285

ttc ttc aag aaa ggg aat ctt tct gca atc aga ccc aaa gac aaa ccg      912
Phe Phe Lys Lys Gly Asn Leu Ser Ala Ile Arg Pro Lys Asp Lys Pro
    290                 295                 300

tta caa ggg aaa tat ccc ata cat tac aaa aat ctt tgg aat cag att      960
Leu Gln Gly Lys Tyr Pro Ile His Tyr Lys Asn Leu Trp Asn Gln Ile
305                 310                 315                 320

aaa gca gca ata gcc gat aga acc atg gta ata aat gaa aat gat cat     1008
Lys Ala Ala Ile Ala Asp Arg Thr Met Val Ile Asn Glu Asn Asp His
                325                 330                 335

tca gaa ttt ctt gga gga att gga aga gcc tct aaa aag atc cca gag     1056
Ser Glu Phe Leu Gly Gly Ile Gly Arg Ala Ser Lys Lys Ile Pro Glu
            340                 345                 350

att tct cta aca caa gat gta ata aca aca gaa gga tta aaa caa tca     1104
Ile Ser Leu Thr Gln Asp Val Ile Thr Thr Glu Gly Leu Lys Gln Ser
        355                 360                 365

gag aat aag ttg cca gaa cca aga tct ttc cct aga tgg ttc aat gct     1152
Glu Asn Lys Leu Pro Glu Pro Arg Ser Phe Pro Arg Trp Phe Asn Ala
    370                 375                 380

gag tgg atg tgg gca ata aag gat tct gac ctt act gga tgg gtg ccc     1200
Glu Trp Met Trp Ala Ile Lys Asp Ser Asp Leu Thr Gly Trp Val Pro
385                 390                 395                 400

atg gca gaa tac cct cct gct gat aat gaa ttg gaa gat tac gct gaa     1248
Met Ala Glu Tyr Pro Pro Ala Asp Asn Glu Leu Glu Asp Tyr Ala Glu
                405                 410                 415
```

```
cat cta aat aaa acc atg gaa ggg gtc ttg caa gga aca aat tgc gca     1296
His Leu Asn Lys Thr Met Glu Gly Val Leu Gln Gly Thr Asn Cys Ala
            420                 425                 430

aga gaa atg ggg aaa tgc att ctt act gtt ggg gca cta atg act gaa     1344
Arg Glu Met Gly Lys Cys Ile Leu Thr Val Gly Ala Leu Met Thr Glu
        435                 440                 445

tgt aga cta ttt cct ggg aaa ata aaa gtg gtg ccc ata tat gct aga     1392
Cys Arg Leu Phe Pro Gly Lys Ile Lys Val Val Pro Ile Tyr Ala Arg
    450                 455                 460

agt aaa gaa agg aaa tca atg caa gaa ggg ctt ccg gtg ccc tca gaa     1440
Ser Lys Glu Arg Lys Ser Met Gln Glu Gly Leu Pro Val Pro Ser Glu
465                 470                 475                 480

atg gac tgt tta ttt ggt ata tgc gtc aag tca aaa tca cat tta aac     1488
Met Asp Cys Leu Phe Gly Ile Cys Val Lys Ser Lys Ser His Leu Asn
                485                 490                 495

aag gat gat gga atg tac aca ata ata aca ttt gaa ttc tca ata aga     1536
Lys Asp Asp Gly Met Tyr Thr Ile Ile Thr Phe Glu Phe Ser Ile Arg
            500                 505                 510

gag cct aat tta gaa aaa cat caa aaa tat act gta ttt gaa gct gga     1584
Glu Pro Asn Leu Glu Lys His Gln Lys Tyr Thr Val Phe Glu Ala Gly
        515                 520                 525

cac aca aca gtt aga atg aag aaa gga gag tca gtt att gga aga gaa     1632
His Thr Thr Val Arg Met Lys Lys Gly Glu Ser Val Ile Gly Arg Glu
    530                 535                 540

gtc cct ctt tat tta tac tgt agg aca act gcc ctt tcc aaa att aag     1680
Val Pro Leu Tyr Leu Tyr Cys Arg Thr Thr Ala Leu Ser Lys Ile Lys
545                 550                 555                 560

aat gac tgg cta tca aaa gct aga aga tgt ttc atc aca act atg gac     1728
Asn Asp Trp Leu Ser Lys Ala Arg Arg Cys Phe Ile Thr Thr Met Asp
                565                 570                 575

aca gtg gaa act ata tgt cta aga gag tca gca aag gct gaa gaa aat     1776
Thr Val Glu Thr Ile Cys Leu Arg Glu Ser Ala Lys Ala Glu Glu Asn
            580                 585                 590

cta gtt gaa aaa aca tta aac gaa aaa caa atg tgg att ggg aaa aaa     1824
Leu Val Glu Lys Thr Leu Asn Glu Lys Gln Met Trp Ile Gly Lys Lys
        595                 600                 605

aat gga gag tta att gct caa cct tta aga gaa gct tta agg gta cag     1872
Asn Gly Glu Leu Ile Ala Gln Pro Leu Arg Glu Ala Leu Arg Val Gln
    610                 615                 620

ctg gta caa caa ttt tat ttc tgc atc tat aat gac agt caa ttg gaa     1920
Leu Val Gln Gln Phe Tyr Phe Cys Ile Tyr Asn Asp Ser Gln Leu Glu
625                 630                 635                 640

ggc ttt tgt aat gag cag aag aaa atc cta atg gct ctt gaa ggt gac     1968
Gly Phe Cys Asn Glu Gln Lys Lys Ile Leu Met Ala Leu Glu Gly Asp
                645                 650                 655

aag aaa aat aaa tca tct ttt gga ttt aat cca gaa gga tta tta gaa     2016
Lys Lys Asn Lys Ser Ser Phe Gly Phe Asn Pro Glu Gly Leu Leu Glu
            660                 665                 670

aag att gaa gag tgt ctt ata aat aat ccg atg tgc ctt ttt atg gct     2064
Lys Ile Glu Glu Cys Leu Ile Asn Asn Pro Met Cys Leu Phe Met Ala
        675                 680                 685

caa agg ttg aat gaa ctt gtg att gag gcc tca aaa aga ggc gct aag     2112
Gln Arg Leu Asn Glu Leu Val Ile Glu Ala Ser Lys Arg Gly Ala Lys
    690                 695                 700

ttt ttc aaa act gat                                                 2127
Phe Phe Lys Thr Asp
705
```

<210> SEQ ID NO 6

<211> LENGTH: 709
<212> TYPE: PRT
<213> ORGANISM: Influenza C virus

<400> SEQUENCE: 6

Met Ser Lys Thr Phe Ala Glu Ile Ala Glu Thr Phe Leu Glu Pro Glu
1 5 10 15

Ala Val Arg Ile Ala Lys Glu Ala Val Glu Glu Tyr Gly Asp His Glu
20 25 30

Arg Lys Ile Ile Gln Ile Gly Ile His Phe Gln Val Cys Cys Met Phe
35 40 45

Cys Asp Glu Tyr Leu Ser Thr Asn Gly Ser Asp Arg Phe Val Leu Ile
50 55 60

Glu Gly Arg Lys Arg Gly Thr Ala Val Ser Leu Gln Asn Glu Leu Cys
65 70 75 80

Lys Ser Tyr Asp Leu Glu Pro Leu Pro Phe Leu Cys Asp Ile Phe Asp
85 90 95

Arg Glu Glu Lys Gln Phe Val Glu Ile Gly Ile Thr Arg Lys Ala Asp
100 105 110

Asp Ser Tyr Phe Gln Ser Lys Phe Gly Lys Leu Gly Asn Ser Cys Lys
115 120 125

Ile Phe Val Phe Ser Tyr Asp Gly Arg Leu Asp Lys Asn Cys Glu Gly
130 135 140

Pro Met Glu Glu Gln Lys Leu Arg Ile Phe Ser Phe Leu Ala Thr Ala
145 150 155 160

Ala Asp Phe Leu Arg Lys Glu Asn Met Phe Asn Glu Ile Phe Leu Pro
165 170 175

Asp Asn Glu Glu Thr Ile Ile Glu Met Lys Lys Gly Lys Thr Phe Leu
180 185 190

Glu Leu Arg Asp Glu Ser Val Pro Leu Pro Phe Gln Thr Tyr Glu Gln
195 200 205

Met Lys Asp Tyr Cys Glu Lys Phe Lys Gly Asn Pro Arg Glu Leu Ala
210 215 220

Ser Lys Val Ser Gln Met Gln Ser Asn Ile Lys Leu Pro Ile Lys His
225 230 235 240

Tyr Glu Gln Asn Lys Phe Arg Gln Ile Arg Leu Pro Lys Gly Pro Met
245 250 255

Ala Pro Tyr Thr His Lys Phe Leu Met Glu Glu Ala Trp Met Phe Thr
260 265 270

Lys Ile Ser Asp Pro Glu Arg Ser Arg Ala Gly Glu Ile Leu Ile Asp
275 280 285

Phe Phe Lys Lys Gly Asn Leu Ser Ala Ile Arg Pro Lys Asp Lys Pro
290 295 300

Leu Gln Gly Lys Tyr Pro Ile His Tyr Lys Asn Leu Trp Asn Gln Ile
305 310 315 320

Lys Ala Ala Ile Ala Asp Arg Thr Met Val Ile Asn Glu Asn Asp His
325 330 335

Ser Glu Phe Leu Gly Gly Ile Gly Arg Ala Ser Lys Lys Ile Pro Glu
340 345 350

Ile Ser Leu Thr Gln Asp Val Ile Thr Thr Glu Gly Leu Lys Gln Ser
355 360 365

Glu Asn Lys Leu Pro Glu Pro Arg Ser Phe Pro Arg Trp Phe Asn Ala
370 375 380

Glu Trp Met Trp Ala Ile Lys Asp Ser Asp Leu Thr Gly Trp Val Pro

```
385                 390                 395                 400

Met Ala Glu Tyr Pro Pro Ala Asp Asn Glu Leu Glu Asp Tyr Ala Glu
                405                 410                 415

His Leu Asn Lys Thr Met Glu Gly Val Leu Gln Gly Thr Asn Cys Ala
            420                 425                 430

Arg Glu Met Gly Lys Cys Ile Leu Thr Val Gly Ala Leu Met Thr Glu
        435                 440                 445

Cys Arg Leu Phe Pro Gly Lys Ile Lys Val Val Pro Ile Tyr Ala Arg
    450                 455                 460

Ser Lys Glu Arg Lys Ser Met Gln Glu Gly Leu Pro Val Pro Ser Glu
465                 470                 475                 480

Met Asp Cys Leu Phe Gly Ile Cys Val Lys Ser Lys Ser His Leu Asn
                485                 490                 495

Lys Asp Asp Gly Met Tyr Thr Ile Ile Thr Phe Glu Phe Ser Ile Arg
            500                 505                 510

Glu Pro Asn Leu Glu Lys His Gln Lys Tyr Thr Val Phe Glu Ala Gly
        515                 520                 525

His Thr Thr Val Arg Met Lys Lys Gly Glu Ser Val Ile Gly Arg Glu
    530                 535                 540

Val Pro Leu Tyr Leu Tyr Cys Arg Thr Thr Ala Leu Ser Lys Ile Lys
545                 550                 555                 560

Asn Asp Trp Leu Ser Lys Ala Arg Arg Cys Phe Ile Thr Thr Met Asp
                565                 570                 575

Thr Val Glu Thr Ile Cys Leu Arg Glu Ser Ala Lys Ala Glu Glu Asn
            580                 585                 590

Leu Val Glu Lys Thr Leu Asn Glu Lys Gln Met Trp Ile Gly Lys Lys
        595                 600                 605

Asn Gly Glu Leu Ile Ala Gln Pro Leu Arg Glu Ala Leu Arg Val Gln
    610                 615                 620

Leu Val Gln Gln Phe Tyr Phe Cys Ile Tyr Asn Asp Ser Gln Leu Glu
625                 630                 635                 640

Gly Phe Cys Asn Glu Gln Lys Lys Ile Leu Met Ala Leu Glu Gly Asp
                645                 650                 655

Lys Lys Asn Lys Ser Ser Phe Gly Phe Asn Pro Glu Gly Leu Leu Glu
            660                 665                 670

Lys Ile Glu Glu Cys Leu Ile Asn Asn Pro Met Cys Leu Phe Met Ala
        675                 680                 685

Gln Arg Leu Asn Glu Leu Val Ile Glu Ala Ser Lys Arg Gly Ala Lys
    690                 695                 700

Phe Phe Lys Thr Asp
705


<210> SEQ ID NO 7
<211> LENGTH: 2148
<212> TYPE: DNA
<213> ORGANISM: Influenza A virus
<220> FEATURE:
<221> NAME/KEY: CDS
<222> LOCATION: (1)..(2148)
<223> OTHER INFORMATION: PA-subunit of the Influenza A virus
      (A/duck/Vietnam/1/2007(H5N1)) RNA-dependent RNA-Polymerase

<400> SEQUENCE: 7

atg gaa gac ttt gtg cga caa tgc ttc aat cca atg att gtc gag ctt       48
Met Glu Asp Phe Val Arg Gln Cys Phe Asn Pro Met Ile Val Glu Leu
1               5                   10                  15
```

-continued

```
gca gaa aag gca atg aaa gaa tat ggg gaa gat ccg aaa atc gaa acg       96
Ala Glu Lys Ala Met Lys Glu Tyr Gly Glu Asp Pro Lys Ile Glu Thr
            20                  25                  30

aac aag ttt gct gca ata tgc aca cat ttg gag gtc tgt ttc atg tat      144
Asn Lys Phe Ala Ala Ile Cys Thr His Leu Glu Val Cys Phe Met Tyr
        35                  40                  45

tcg gat ttt cac ttt att gat gaa cgg agt gaa tca ata att gta gaa      192
Ser Asp Phe His Phe Ile Asp Glu Arg Ser Glu Ser Ile Ile Val Glu
    50                  55                  60

tct gga gat ccg aat gca tta ttg aaa cac cga ttt gaa ata att gaa      240
Ser Gly Asp Pro Asn Ala Leu Leu Lys His Arg Phe Glu Ile Ile Glu
65                  70                  75                  80

gga aga gac cga acg atg gcc tgg act gtg gtg aat agt att tgc aac      288
Gly Arg Asp Arg Thr Met Ala Trp Thr Val Val Asn Ser Ile Cys Asn
                85                  90                  95

acc aca gga gtt gag aaa cct aaa ttt ctc cca gat ttg tat gac tac      336
Thr Thr Gly Val Glu Lys Pro Lys Phe Leu Pro Asp Leu Tyr Asp Tyr
            100                 105                 110

aaa gag aat cga ttc att gaa att gga gtg aca cgg agg gaa gtt cat      384
Lys Glu Asn Arg Phe Ile Glu Ile Gly Val Thr Arg Arg Glu Val His
        115                 120                 125

aca tac tat ctg gag aaa gcc aac aag ata aag tcc gag aag aca cat      432
Thr Tyr Tyr Leu Glu Lys Ala Asn Lys Ile Lys Ser Glu Lys Thr His
    130                 135                 140

att cac ata ttc tca ttc aca ggg gag gaa atg gcc acc aaa gcg gac      480
Ile His Ile Phe Ser Phe Thr Gly Glu Glu Met Ala Thr Lys Ala Asp
145                 150                 155                 160

tac acc ctt gat gaa gag agc agg gca aga att aaa acc agg ctg ttc      528
Tyr Thr Leu Asp Glu Glu Ser Arg Ala Arg Ile Lys Thr Arg Leu Phe
                165                 170                 175

acc ata agg cag gaa atg gcc agt agg ggt cta tgg gat tcc ttt cgt      576
Thr Ile Arg Gln Glu Met Ala Ser Arg Gly Leu Trp Asp Ser Phe Arg
            180                 185                 190

caa tcc gag aga ggc gaa gag aca att gaa gaa aaa ttt gaa atc act      624
Gln Ser Glu Arg Gly Glu Glu Thr Ile Glu Glu Lys Phe Glu Ile Thr
        195                 200                 205

gga acc atg cgc aga ctt gca gac caa agt ctc ccg ccg aac ttc tcc      672
Gly Thr Met Arg Arg Leu Ala Asp Gln Ser Leu Pro Pro Asn Phe Ser
    210                 215                 220

agc ctt gaa aac ttt aga gcc tat gtg gat gga ttc gaa ccg aac ggc      720
Ser Leu Glu Asn Phe Arg Ala Tyr Val Asp Gly Phe Glu Pro Asn Gly
225                 230                 235                 240

tgc att gag ggc aag ctt tct caa atg tca aaa gaa gtg aat gcc aga      768
Cys Ile Glu Gly Lys Leu Ser Gln Met Ser Lys Glu Val Asn Ala Arg
                245                 250                 255

att gag cca ttt tta aag aca acg cca cgc tct ctc aga cta cct gat      816
Ile Glu Pro Phe Leu Lys Thr Thr Pro Arg Ser Leu Arg Leu Pro Asp
            260                 265                 270

ggg cct cct tgc tct cag cga tcg aag ttc ctg ctg atg gat gcc ctt      864
Gly Pro Pro Cys Ser Gln Arg Ser Lys Phe Leu Leu Met Asp Ala Leu
        275                 280                 285

aaa tta agt atc gaa gac ccg agt cat gag ggg gag ggg ata cca cta      912
Lys Leu Ser Ile Glu Asp Pro Ser His Glu Gly Glu Gly Ile Pro Leu
    290                 295                 300

tac gat gca atc aaa tgc atg aag aca ttt ttc ggc tgg aaa gaa ccc      960
Tyr Asp Ala Ile Lys Cys Met Lys Thr Phe Phe Gly Trp Lys Glu Pro
305                 310                 315                 320

aac atc gtg aaa cca cat gaa aaa ggt ata aac ccc aat tac ctc ctg     1008
Asn Ile Val Lys Pro His Glu Lys Gly Ile Asn Pro Asn Tyr Leu Leu
                325                 330                 335
```

```
gct tgg aag caa gtg ctg gca gaa ctc caa gat att gaa aat gag gag     1056
Ala Trp Lys Gln Val Leu Ala Glu Leu Gln Asp Ile Glu Asn Glu Glu
            340                 345                 350

aaa atc ccg aaa aca aag aac atg aaa aaa aca agc cag ttg aag tgg     1104
Lys Ile Pro Lys Thr Lys Asn Met Lys Lys Thr Ser Gln Leu Lys Trp
        355                 360                 365

gca ctc ggt gaa aac atg gca cca gag aaa gta gac ttt gag gac tgc     1152
Ala Leu Gly Glu Asn Met Ala Pro Glu Lys Val Asp Phe Glu Asp Cys
    370                 375                 380

aaa gat att agc gat cta aga cag tat gac agt gat gaa cca gag tct     1200
Lys Asp Ile Ser Asp Leu Arg Gln Tyr Asp Ser Asp Glu Pro Glu Ser
385                 390                 395                 400

aga tca cta gca agc tgg att cag agt gaa ttc aac aag gca tgt gaa     1248
Arg Ser Leu Ala Ser Trp Ile Gln Ser Glu Phe Asn Lys Ala Cys Glu
                405                 410                 415

ttg aca gat tcg agt tgg att gaa ctt gat gag ata gga gaa gac gta     1296
Leu Thr Asp Ser Ser Trp Ile Glu Leu Asp Glu Ile Gly Glu Asp Val
            420                 425                 430

gct cca att gag cac att gca agt atg aga agg aac tat ttt aca gcg     1344
Ala Pro Ile Glu His Ile Ala Ser Met Arg Arg Asn Tyr Phe Thr Ala
        435                 440                 445

gaa gta tcc cat tgc agg gcc act gaa tac ata atg aag gga gtg tac     1392
Glu Val Ser His Cys Arg Ala Thr Glu Tyr Ile Met Lys Gly Val Tyr
    450                 455                 460

ata aac aca gcc ctg ttg aat gca tcc tgt gca gcc atg gat gac ttt     1440
Ile Asn Thr Ala Leu Leu Asn Ala Ser Cys Ala Ala Met Asp Asp Phe
465                 470                 475                 480

caa ctg att cca atg ata agc aaa tgc aga acc aaa gaa gga aga cgg     1488
Gln Leu Ile Pro Met Ile Ser Lys Cys Arg Thr Lys Glu Gly Arg Arg
                485                 490                 495

aaa act aat ctg tat gga ttc att ata aaa ggg aga tcc cac ttg agg     1536
Lys Thr Asn Leu Tyr Gly Phe Ile Ile Lys Gly Arg Ser His Leu Arg
            500                 505                 510

aat gat act gat gtg gta aat ttt gtg agt atg gaa ttc tct ctt act     1584
Asn Asp Thr Asp Val Val Asn Phe Val Ser Met Glu Phe Ser Leu Thr
        515                 520                 525

gat ccg agg ctg gag cca cac aag tgg gaa aag tac tgt gtc ctc gag     1632
Asp Pro Arg Leu Glu Pro His Lys Trp Glu Lys Tyr Cys Val Leu Glu
    530                 535                 540

ata gga gac atg ctc ctc cgg act gca gta ggc caa gtt tca agg ccc     1680
Ile Gly Asp Met Leu Leu Arg Thr Ala Val Gly Gln Val Ser Arg Pro
545                 550                 555                 560

atg ttc ctg tat gta aga acc aat gga acc tcc aag atc aaa atg aaa     1728
Met Phe Leu Tyr Val Arg Thr Asn Gly Thr Ser Lys Ile Lys Met Lys
                565                 570                 575

tgg ggc atg gaa atg agg cgg tgc ctt ctt caa tcc ctt caa caa att     1776
Trp Gly Met Glu Met Arg Arg Cys Leu Leu Gln Ser Leu Gln Gln Ile
            580                 585                 590

gaa agc atg att gaa gcc gag tct tct gtc aaa gag aag gac atg acc     1824
Glu Ser Met Ile Glu Ala Glu Ser Ser Val Lys Glu Lys Asp Met Thr
        595                 600                 605

aaa gaa ttc ttt gaa aac aaa tca gaa aca tgg cca att gga gag tcc     1872
Lys Glu Phe Phe Glu Asn Lys Ser Glu Thr Trp Pro Ile Gly Glu Ser
    610                 615                 620

ccc aag gga gtg gag gaa ggc tcc atc gga aag gtg tgc aga acc ttg     1920
Pro Lys Gly Val Glu Glu Gly Ser Ile Gly Lys Val Cys Arg Thr Leu
625                 630                 635                 640

ctg gcg aag tct gtg ttc aac agt tta tat gca tct cca caa ctc gag     1968
Leu Ala Lys Ser Val Phe Asn Ser Leu Tyr Ala Ser Pro Gln Leu Glu
```

```
                645                 650                 655

ggg ttt tca gct gaa tca aga aaa ttg ctt ctc att tct cag gca ctt     2016
Gly Phe Ser Ala Glu Ser Arg Lys Leu Leu Leu Ile Ser Gln Ala Leu
            660                 665                 670

agg gac aac ctg gaa cct ggg acc ttc gat ctt gga ggg cta tat gaa     2064
Arg Asp Asn Leu Glu Pro Gly Thr Phe Asp Leu Gly Gly Leu Tyr Glu
        675                 680                 685

gca att gag gag tgc ctg att aac gat ccc tgg gtt ttg ctt aat gcg     2112
Ala Ile Glu Glu Cys Leu Ile Asn Asp Pro Trp Val Leu Leu Asn Ala
    690                 695                 700

tct tgg ttc aac tcc ttc ctc gca cat gca ctg aaa                     2148
Ser Trp Phe Asn Ser Phe Leu Ala His Ala Leu Lys
705                 710                 715


<210> SEQ ID NO 8
<211> LENGTH: 716
<212> TYPE: PRT
<213> ORGANISM: Influenza A virus

<400> SEQUENCE: 8

Met Glu Asp Phe Val Arg Gln Cys Phe Asn Pro Met Ile Val Glu Leu
1               5                   10                  15

Ala Glu Lys Ala Met Lys Glu Tyr Gly Glu Asp Pro Lys Ile Glu Thr
            20                  25                  30

Asn Lys Phe Ala Ala Ile Cys Thr His Leu Glu Val Cys Phe Met Tyr
        35                  40                  45

Ser Asp Phe His Phe Ile Asp Glu Arg Ser Glu Ser Ile Ile Val Glu
    50                  55                  60

Ser Gly Asp Pro Asn Ala Leu Leu Lys His Arg Phe Glu Ile Ile Glu
65                  70                  75                  80

Gly Arg Asp Arg Thr Met Ala Trp Thr Val Val Asn Ser Ile Cys Asn
                85                  90                  95

Thr Thr Gly Val Glu Lys Pro Lys Phe Leu Pro Asp Leu Tyr Asp Tyr
            100                 105                 110

Lys Glu Asn Arg Phe Ile Glu Ile Gly Val Thr Arg Arg Glu Val His
        115                 120                 125

Thr Tyr Tyr Leu Glu Lys Ala Asn Lys Ile Lys Ser Glu Lys Thr His
    130                 135                 140

Ile His Ile Phe Ser Phe Thr Gly Glu Glu Met Ala Thr Lys Ala Asp
145                 150                 155                 160

Tyr Thr Leu Asp Glu Glu Ser Arg Ala Arg Ile Lys Thr Arg Leu Phe
                165                 170                 175

Thr Ile Arg Gln Glu Met Ala Ser Arg Gly Leu Trp Asp Ser Phe Arg
            180                 185                 190

Gln Ser Glu Arg Gly Glu Glu Thr Ile Glu Glu Lys Phe Glu Ile Thr
        195                 200                 205

Gly Thr Met Arg Arg Leu Ala Asp Gln Ser Leu Pro Pro Asn Phe Ser
    210                 215                 220

Ser Leu Glu Asn Phe Arg Ala Tyr Val Asp Gly Phe Glu Pro Asn Gly
225                 230                 235                 240

Cys Ile Glu Gly Lys Leu Ser Gln Met Ser Lys Glu Val Asn Ala Arg
                245                 250                 255

Ile Glu Pro Phe Leu Lys Thr Thr Pro Arg Ser Leu Arg Leu Pro Asp
            260                 265                 270

Gly Pro Pro Cys Ser Gln Arg Ser Lys Phe Leu Leu Met Asp Ala Leu
        275                 280                 285
```

```
Lys Leu Ser Ile Glu Asp Pro Ser His Glu Gly Glu Gly Ile Pro Leu
    290                 295                 300

Tyr Asp Ala Ile Lys Cys Met Lys Thr Phe Phe Gly Trp Lys Glu Pro
305                 310                 315                 320

Asn Ile Val Lys Pro His Glu Lys Gly Ile Asn Pro Asn Tyr Leu Leu
                325                 330                 335

Ala Trp Lys Gln Val Leu Ala Glu Leu Gln Asp Ile Glu Asn Glu Glu
            340                 345                 350

Lys Ile Pro Lys Thr Lys Asn Met Lys Lys Thr Ser Gln Leu Lys Trp
        355                 360                 365

Ala Leu Gly Glu Asn Met Ala Pro Glu Lys Val Asp Phe Glu Asp Cys
    370                 375                 380

Lys Asp Ile Ser Asp Leu Arg Gln Tyr Asp Ser Asp Glu Pro Glu Ser
385                 390                 395                 400

Arg Ser Leu Ala Ser Trp Ile Gln Ser Glu Phe Asn Lys Ala Cys Glu
                405                 410                 415

Leu Thr Asp Ser Ser Trp Ile Glu Leu Asp Glu Ile Gly Glu Asp Val
            420                 425                 430

Ala Pro Ile Glu His Ile Ala Ser Met Arg Arg Asn Tyr Phe Thr Ala
        435                 440                 445

Glu Val Ser His Cys Arg Ala Thr Glu Tyr Ile Met Lys Gly Val Tyr
    450                 455                 460

Ile Asn Thr Ala Leu Leu Asn Ala Ser Cys Ala Ala Met Asp Asp Phe
465                 470                 475                 480

Gln Leu Ile Pro Met Ile Ser Lys Cys Arg Thr Lys Glu Gly Arg Arg
                485                 490                 495

Lys Thr Asn Leu Tyr Gly Phe Ile Ile Lys Gly Arg Ser His Leu Arg
            500                 505                 510

Asn Asp Thr Asp Val Val Asn Phe Val Ser Met Glu Phe Ser Leu Thr
        515                 520                 525

Asp Pro Arg Leu Glu Pro His Lys Trp Glu Lys Tyr Cys Val Leu Glu
    530                 535                 540

Ile Gly Asp Met Leu Leu Arg Thr Ala Val Gly Gln Val Ser Arg Pro
545                 550                 555                 560

Met Phe Leu Tyr Val Arg Thr Asn Gly Thr Ser Lys Ile Lys Met Lys
                565                 570                 575

Trp Gly Met Glu Met Arg Arg Cys Leu Leu Gln Ser Leu Gln Gln Ile
            580                 585                 590

Glu Ser Met Ile Glu Ala Glu Ser Ser Val Lys Glu Lys Asp Met Thr
        595                 600                 605

Lys Glu Phe Phe Glu Asn Lys Ser Glu Thr Trp Pro Ile Gly Glu Ser
    610                 615                 620

Pro Lys Gly Val Glu Glu Gly Ser Ile Gly Lys Val Cys Arg Thr Leu
625                 630                 635                 640

Leu Ala Lys Ser Val Phe Asn Ser Leu Tyr Ala Ser Pro Gln Leu Glu
                645                 650                 655

Gly Phe Ser Ala Glu Ser Arg Lys Leu Leu Leu Ile Ser Gln Ala Leu
            660                 665                 670

Arg Asp Asn Leu Glu Pro Gly Thr Phe Asp Leu Gly Gly Leu Tyr Glu
        675                 680                 685

Ala Ile Glu Glu Cys Leu Ile Asn Asp Pro Trp Val Leu Leu Asn Ala
    690                 695                 700
```

Ser Trp Phe Asn Ser Phe Leu Ala His Ala Leu Lys
705 710 715

<210> SEQ ID NO 9
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 20 to 30 of the PA-subunit of the
Influenza A virus (A/Victoria/3/1975(H3N2)) RNA-dependent RNA
polymerase

<400> SEQUENCE: 9

Ala Met Lys Glu Tyr Gly Glu Asp Leu Lys Ile
1 5 10

<210> SEQ ID NO 10
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 35 to 45 of the PA-subunit of the
Influenza A virus (A/Victoria/3/1975(H3N2)) RNA-dependent RNA
polymerase

<400> SEQUENCE: 10

Phe Ala Ala Ile Cys Thr His Leu Glu Val Cys
1 5 10

<210> SEQ ID NO 11
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 75 to 85 of the PA-subunit of the
Influenza A virus (A/Victoria/3/1975(H3N2)) RNA-dependent RNA
polymerase

<400> SEQUENCE: 11

Arg Phe Glu Ile Ile Glu Gly Arg Asp Arg Thr
1 5 10

<210> SEQ ID NO 12
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 80 to 90 of the PA-subunit of the
Influenza A virus (A/Victoria/3/1975(H3N2)) RNA-dependent RNA
polymerase

<400> SEQUENCE: 12

Glu Gly Arg Asp Arg Thr Met Ala Trp Thr Val
1 5 10

<210> SEQ ID NO 13
<211> LENGTH: 11
<212> TYPE: PRT
<213> ORGANISM: Influenza A virus
<220> FEATURE:
<221> NAME/KEY: CHAIN
<222> LOCATION: (1)..(11)

<223> OTHER INFORMATION: residues 100 to 110 of the PA-subunit of the
Influenza A virus (A/Victoria/3/1975(H3N2)) RNA-dependent RNA
polymerase

<400> SEQUENCE: 13

Ala Glu Lys Pro Lys Phe Leu Pro Asp Leu Tyr
1 5 10

<210> SEQ ID NO 14
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 115 to 125 of the PA-subunit of the
Influenza A virus (A/Victoria/3/1975(H3N2)) RNA-dependent RNA
polymerase

<400> SEQUENCE: 14

Asn Arg Phe Ile Glu Ile Gly Val Thr Arg Arg
1 5 10

<210> SEQ ID NO 15
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 125 to 135 of the PA-subunit of the
Influenza A virus (A/Victoria/3/1975(H3N2)) RNA-dependent RNA
polymerase

<400> SEQUENCE: 15

Arg Glu Val His Ile Tyr Tyr Leu Glu Lys Ala
1 5 10

<210> SEQ ID NO 16
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 130 to 140 of the PA-subunit of the
Influenza A virus (A/Victoria/3/1975(H3N2)) RNA-dependent RNA
polymerase

<400> SEQUENCE: 16

Tyr Tyr Leu Glu Lys Ala Asn Lys Ile Lys Ser
1 5 10

<210> SEQ ID NO 17
<211> LENGTH: 11
<212> TYPE: PRT
<213> ORGANISM: Influenza A virus
<220> FEATURE:
<221> NAME/KEY: CHAIN
<222> LOCATION: (1)..(11)
<223> OTHER INFORMATION: residues 135 to 145 of the PA-subunit of the
Influenza A virus (A/Victoria/3/1975(H3N2)) RNA-dependent RNA
polymerase

<400> SEQUENCE: 17

Ala Asn Lys Ile Lys Ser Glu Asn Thr His Ile
1 5 10

<210> SEQ ID NO 18

<211> LENGTH: 51
<212> TYPE: RNA
<213> ORGANISM: Artificial Sequence
<220> FEATURE:
<223> OTHER INFORMATION: U-rich RNA

<400> SEQUENCE: 18 ggccauccug uuuuuuuccc uuuuuuuuuu ucuuuuuuuu uuuuuuuuuu u 51

<210> SEQ ID NO 19
<211> LENGTH: 7
<212> TYPE: PRT
<213> ORGANISM: Artificial Sequence
<220> FEATURE:
<223> OTHER INFORMATION: peptide linker

<400> SEQUENCE: 19

Gly Met Gly Ser Gly Met Ala
1 5

<210> SEQ ID NO 20
<211> LENGTH: 7
<212> TYPE: PRT
<213> ORGANISM: Influenza A virus
<220> FEATURE:
<221> NAME/KEY: CHAIN
<222> LOCATION: (1)..(7)
<223> OTHER INFORMATION: residues 107 to 112 of the PA-subunit of the
Influenza A virus (A/Victoria/3/1975(H3N2)) RNA-dependent RNA
polymerase

<400> SEQUENCE: 20

Pro Asp Leu Tyr Asp Tyr Lys
1 5

<210> SEQ ID NO 21
<211> LENGTH: 7
<212> TYPE: PRT
<213> ORGANISM: Artificial Sequence
<220> FEATURE:
<223> OTHER INFORMATION: TEV cleavage site

<400> SEQUENCE: 21

Glu Asn Leu Tyr Phe Gln Gly
1 5

<210> SEQ ID NO 22
<211> LENGTH: 216
<212> TYPE: PRT
<213> ORGANISM: Artificial Sequence
<220> FEATURE:
<223> OTHER INFORMATION: PA-Nter

<400> SEQUENCE: 22

Gly Met Gly Ser Gly Met Ala Met Glu Asp Phe Val Arg Gln Cys Phe
1 5 10 15

Asn Pro Met Ile Val Glu Leu Ala Glu Lys Ala Met Lys Glu Tyr Gly
20 25 30

Glu Asp Leu Lys Ile Glu Thr Asn Lys Phe Ala Ala Ile Cys Thr His
35 40 45

Leu Glu Val Cys Phe Met Tyr Ser Asp Phe His Phe Ile Asn Glu Gln
50 55 60

Gly Glu Ser Ile Val Val Glu Leu Asp Asp Pro Asn Ala Leu Leu Lys
65 70 75 80

His Arg Phe Glu Ile Ile Glu Gly Arg Asp Arg Thr Met Ala Trp Thr

-continued

```
                85                  90                  95

Val Val Asn Ser Ile Cys Asn Thr Thr Gly Ala Glu Lys Pro Lys Phe
            100                 105                 110

Leu Pro Asp Leu Tyr Asp Tyr Lys Glu Asn Arg Phe Ile Glu Ile Gly
        115                 120                 125

Val Thr Arg Arg Glu Val His Ile Tyr Tyr Leu Glu Lys Ala Asn Lys
    130                 135                 140

Ile Lys Ser Glu Asn Thr His Ile His Ile Phe Ser Phe Thr Gly Glu
145                 150                 155                 160

Glu Met Ala Thr Lys Ala Asp Tyr Thr Leu Asp Glu Glu Ser Arg Ala
                165                 170                 175

Arg Ile Lys Thr Arg Leu Phe Thr Ile Arg Gln Glu Met Ala Asn Arg
            180                 185                 190

Gly Leu Trp Asp Ser Phe Arg Gln Ser Glu Arg Gly Glu Glu Thr Ile
        195                 200                 205

Glu Glu Arg Phe Glu Ile Thr Gly
    210                 215


<210> SEQ ID NO 23
<211> LENGTH: 7
<212> TYPE: PRT
<213> ORGANISM: Influenza A virus
<220> FEATURE:
<221> NAME/KEY: misc_feature
<222> LOCATION: (2)..(3)
<223> OTHER INFORMATION: Xaa can be any naturally occurring amino acid
<220> FEATURE:
<221> NAME/KEY: misc_feature
<222> LOCATION: (5)..(5)
<223> OTHER INFORMATION: Xaa can be any naturally occurring amino acid
<220> FEATURE:
<221> NAME/KEY: MISC_FEATURE
<222> LOCATION: (7)..(7)
<223> OTHER INFORMATION: Xaa at position 7 is Ser or Gly

<400> SEQUENCE: 23

Glu Xaa Xaa Tyr Xaa Gln Xaa
1               5
```

The invention claimed is:

1. An isolated polynucleotide encoding a polypeptide consisting of:

a)

i. amino acids 1 to 209 of the amino acid sequence of SEQ ID NO: 2 or a fragment thereof consisting of at least amino acids 15 to 196 of the amino acid sequence of SEQ ID NO: 2, or a variant consisting of at least 95% amino acid sequence identity to amino acids 1 to 209 of the amino acid sequence of SEQ ID NO: 2, or a fragment thereof consisting of at least 95% amino acid sequence identity to amino acids 15 to 196 of the amino acid sequence of SEQ ID NO: 2, ii. amino acids 1 to 206 of the amino acid sequence of SEQ ID NO: 4 or a fragment thereof consisting of at least amino acids 15 to 195 of the amino acid sequence of SEQ ID NO: 4, or a variant consisting of at least 95% amino acid sequence identity to amino acids 1 to 206 of the amino acid sequence of SEQ ID NO: 4, or a fragment thereof consisting of at least 95% amino acid sequence identity to amino acids 15 to 195 of the amino acid sequence of SEQ ID NO: 4, or iii. amino acids 1 to 189 of the amino acid sequence of SEQ ID NO: 6 or a fragment thereof consisting of at least amino acids 15 to 178 of the amino acid sequence of SEQ ID NO: 6, or a variant consisting of at least 95% amino acid sequence identity to amino acids 1 to 189 of the amino acid sequence of SEQ ID NO: 6, or a fragment thereof consisting of at least 95% amino acid sequence identity to amino acids 15 to 178 of the amino acid sequence of SEQ ID NO: 6, wherein said polypeptide has endonuclease activity of a PA subunit of a viral RNA-dependent RNA polymerase, and b) i. a protease recognition site with or without an amino acid linker, and ii. a heterologous peptide or heterologous protein tag.

2. A recombinant vector comprising said isolated polynucleotide of claim 1.

3. A recombinant host cell comprising said isolated polynucleotide of claim 1.

4. The isolated polynucleotide of claim 1, wherein said polypeptide encoded by said isolated polynucleotide consists of amino acids 1 to 209 of the amino acid sequence set forth in SEQ ID NO: 2 linked to the amino acid sequence of SEQ ID NO: 19.

5. The isolated polynucleotide of claim 1, wherein said protease recognition site is a thrombin, Factor Xa, PreScission or TEV protease recognition site.

6. The isolated polynucleotide of claim 1, wherein said protease recognition site is the amino acid sequence of SEQ ID NO: 23.

7. The isolated polynucleotide of claim 6, wherein said protease recognition site is the amino acid sequence of SEQ ID NO: 21.

8. The isolated polynucleotide of claim 1, wherein said amino acid linker is the amino acid sequence of SEQ ID NO: 19.

9. The isolated polynucleotide of claim 1, wherein said heterologous peptide or heterologous protein tag is a tag that facilitates purification or detection of the polypeptide.

10. The isolated polynucleotide of claim 1, wherein said heterologous peptide or heterologous protein tag is selected from the group consisting of hemagglutinin-tag, FLAG-tag, myc-tag, poly-His-tag, glutathione-S-transferase-tag, maltose-binding-protein-tag, NusA-tag, thioredoxin-tag, and a fluorescent protein-tag.

11. The isolated polynucleotide of claim 10, wherein said fluorescent protein-tag is selected from the group consisting of a green fluorescent protein, a yellow fluorescent protein, a red fluorescent protein, and a cyan fluorescence protein.

12. An isolated polynucleotide encoding a polypeptide consisting of:

a)

i. amino acids 1 to 209 of the amino acid sequence of SEQ ID NO: 2 or a fragment thereof consisting of at least amino acids 15 to 196 of the amino acid sequence of SEQ ID NO: 2, or a variant consisting of at least 95% amino acid sequence identity to amino acids 1 to 209 of the amino acid sequence of SEQ ID NO: 2, or a fragment thereof consisting of at least 95% amino acid sequence identity to amino acids 15 to 196 of the amino acid sequence of SEQ ID NO: 2, ii. amino acids 1 to 206 of the amino acid sequence of SEQ ID NO: 4 or a fragment thereof consisting of at least amino acids 15 to 195 of the amino acid sequence of SEQ ID NO: 4, or a variant consisting of at least 95% amino acid sequence identity to amino acids 1 to 206 of the amino acid sequence of SEQ ID NO: 4, or a fragment thereof consisting of at least 95% amino acid sequence identity to amino acids 15 to 195 of the amino acid sequence of SEQ ID NO: 4 or iii. amino acids 1 to 189 of the amino acid sequence of SEQ ID NO: 6 or a fragment thereof consisting of at least amino acids 15 to 178 of the amino acid sequence of SEQ ID NO: 6, or a variant consisting of at least 95% amino acid sequence identity to amino acids 1 to 189 of the amino acid sequence of SEQ ID NO: 6, or a fragment thereof consisting of at least 95% amino acid sequence identity to amino acids 15 to 178 of the amino acid sequence of SEQ ID NO: 6, wherein said polypeptide has endonuclease activity of a PA subunit of a viral RNA-dependent RNA polymerase, and a heterologous peptide or heterologous protein tag.

13. A recombinant vector comprising said isolated polynucleotide of claim 12.

14. A recombinant host cell comprising said isolated polynucleotide of claim 12.

15. The isolated polynucleotide of claim 12, wherein said polypeptide encoded by said isolated polynucleotide consists of amino acids 1 to 209 of the amino acid sequence set forth in SEQ ID NO: 2 linked to the amino acid sequence of SEQ ID NO: 19.

16. The isolated polynucleotide of claim 12, wherein said heterologous peptide or heterologous protein tag is a tag that facilitates purification or detection of the polypeptide.

17. The isolated polynucleotide of claim 12, wherein said heterologous peptide or heterologous protein tag is selected from the group consisting of hemagglutinin-tag, FLAG-tag, myc-tag, poly-His-tag, glutathione-S-transferase-tag, maltose-binding-protein-tag, NusA-tag, thioredoxin-tag, and a fluorescent protein-tag.

18. The isolated polynucleotide of claim 17, wherein said fluorescent protein-tag is selected from the group consisting of a green fluorescent protein, a yellow fluorescent protein, a red fluorescent protein, and a cyan fluorescence protein.

* * * * *